US011571696B2

(12) United States Patent
Zhou

(10) Patent No.: US 11,571,696 B2
(45) Date of Patent: Feb. 7, 2023

(54) BIOLOGICAL ENTITY SEPARATION DEVICE AND METHOD OF USE

(71) Applicant: Yuchen Zhou, San Jose, CA (US)

(72) Inventor: Yuchen Zhou, San Jose, CA (US)

(73) Assignee: Applied Cells Inc., Santa Clara, CA (US)

( * ) Notice: Subject to any disclaimer, the term of this patent is extended or adjusted under 35 U.S.C. 154(b) by 279 days.

(21) Appl. No.: 16/729,398

(22) Filed: Dec. 29, 2019

(65) Prior Publication Data

US 2020/0129982 A1 Apr. 30, 2020

Related U.S. Application Data

(63) Continuation-in-part of application No. 15/911,115, filed on Mar. 3, 2018.

(51) Int. Cl.

| | |
|---|---|
| ***B01L 3/00*** | (2006.01) |
| ***B03C 1/01*** | (2006.01) |
| ***B03C 1/28*** | (2006.01) |

(52) U.S. Cl.

CPC ..... *B01L 3/502761* (2013.01); *B01L 3/502715* (2013.01); *B03C 1/01* (2013.01); *B03C 1/28* (2013.01); *B01L 2200/0647* (2013.01); *B01L 2300/06* (2013.01); *B01L 2300/0627* (2013.01);

(Continued)

(58) Field of Classification Search

CPC ..... B01L 3/502761; B01L 3/502715; B01L 2200/0647; B01L 2300/06; B01L 2300/12; B01L 2300/0627; B01L 2300/123; B01L 2400/0481; B01L 2400/0439; B01L 2400/043; B03C 1/01; B03C 1/28; B03C 2201/18; B03C 1/288; B03C 1/30; B03C 1/0332

See application file for complete search history.

(56) References Cited

U.S. PATENT DOCUMENTS

| | | | |
|---|---|---|---|
| 4,759,775 | A | 7/1988 | Peterson et al. |
| 5,902,489 | A | 5/1999 | Yusada et al. |
| 5,972,721 | A | 10/1999 | Bruno et al. |

(Continued)

FOREIGN PATENT DOCUMENTS

| | | | |
|---|---|---|---|
| EP | 2857100 | 4/2015 | |
| EP | 2857100 A1 * | 4/2015 | ..... B01L 3/502707 |

(Continued)

OTHER PUBLICATIONS

UPS Battery Center (What is an Electric Current? A Simple Explanation, Battery Basics, 2016, 3 pages (Year: 2016).*

(Continued)

*Primary Examiner* — Benjamin R Whatley
*Assistant Examiner* — Jean Caraballo-Leon
(74) *Attorney, Agent, or Firm* — Bing K. Yen

(57) ABSTRACT

The current invention generally relates to apparatus and method to analyze and separate biological entities, including cells, bacteria and molecules from human blood, body tissue, body fluid and other human related biological samples. The claimed apparatus and method analyze, or detect, biological entities based on optical signals received from said entities by using optical detectors. The claimed apparatus and method further separate biological entities with using micro-actuator activated sorting devices.

20 Claims, 150 Drawing Sheets

(52) U.S. Cl.
CPC ..... *B01L 2300/12* (2013.01); *B03C 2201/18* (2013.01)

(56) References Cited

U.S. PATENT DOCUMENTS

| | | | | |
|---|---|---|---|---|
| 6,216,538 | B1 | 4/2001 | Yasuda et al. | |
| 6,254,830 | B1 | 7/2001 | Pivarnik et al. | |
| 6,929,750 | B2 | 8/2005 | Laurell et al. | |
| 7,348,185 | B2 | 3/2008 | Yamamichi | |
| 7,474,184 | B1 | 1/2009 | Humphries et al. | |
| 11,900,370 | | 3/2009 | Zhou | |
| 7,781,202 | B2 | 8/2010 | Yamamichi | |
| 8,273,302 | B2 | 9/2012 | Takahashi et al. | |
| 8,309,408 | B2 | 11/2012 | Ward et al. | |
| 8,573,060 | B2 | 11/2013 | Huang et al. | |
| 8,636,906 | B2 | 1/2014 | Stein | |
| 8,956,536 | B2 | 2/2015 | Yu et al. | |
| 8,986,944 | B2 | 3/2015 | Yamanishi et al. | |
| 9,095,494 | B2 | 8/2015 | Warner et al. | |
| 9,109,197 | B2 | 8/2015 | Yasuda et al. | |
| 9,217,131 | B2 | 12/2015 | Lamish et al. | |
| 9,272,234 | B2 | 3/2016 | Lipkens et al. | |
| 9,476,855 | B2 | 10/2016 | Ward et al. | |
| 9,510,998 | B2 | 12/2016 | Warner et al. | |
| 9,513,205 | B2 | 12/2016 | Yu et al. | |
| 9,551,643 | B2 | 1/2017 | Warner et al. | |
| 9,656,263 | B2 | 5/2017 | Laurell et al. | |
| 9,725,690 | B2 | 8/2017 | Presz et al. | |
| 9,745,569 | B2 | 8/2017 | Lipkens et al. | |
| 9,796,956 | B2 | 10/2017 | Lipkens et al. | |
| 9,835,540 | B2 | 12/2017 | Yu et al. | |
| 9,885,642 | B2 | 2/2018 | Yu | |
| 10,045,913 | B2 | 8/2018 | Warner et al. | |
| 10,052,431 | B2 | 8/2018 | Dreschel et al. | |
| 10,173,220 | B2 | 1/2019 | Middlebrook et al. | |
| 10,444,125 | B2 | 10/2019 | Yu | |
| 10,677,695 | B2 | 6/2020 | Koyata et al. | |
| 10,710,006 | B2 | 7/2020 | Lipkens et al. | |
| 10,724,029 | B2 | 7/2020 | Lipkens et al. | |
| 2004/0069708 | A1 | 4/2004 | Laurell et al. | |
| 2004/0229349 | A1* | 11/2004 | Daridon | C12M 21/06 435/305.2 |
| 2005/0106064 | A1 | 5/2005 | Laurell et al. | |
| 2006/0062698 | A1* | 3/2006 | Foster | B01L 3/50273 422/504 |
| 2006/0094051 | A1 | 5/2006 | Lee et al. | |
| 2006/0240572 | A1 | 10/2006 | Carron et al. | |
| 2007/0182517 | A1 | 8/2007 | Humphries et al. | |
| 2008/0160630 | A1 | 7/2008 | Liu et al. | |
| 2008/0302732 | A1 | 12/2008 | Soh et al. | |
| 2009/0052273 | A1 | 2/2009 | Sarvazyan | |
| 2010/0317093 | A1 | 12/2010 | Turewicz et al. | |
| 2011/0033922 | A1 | 2/2011 | Landers et al. | |
| 2012/0100546 | A1 | 4/2012 | Lowery et al. | |
| 2012/0122731 | A1 | 5/2012 | Soh et al. | |
| 2012/0190104 | A1* | 7/2012 | Foster | B01L 3/502738 435/288.7 |
| 2012/0295302 | A1 | 11/2012 | Lamish et al. | |
| 2013/0265054 | A1 | 10/2013 | Lowery et al. | |
| 2013/0330739 | A1 | 12/2013 | Yu | |
| 2014/0120570 | A1 | 5/2014 | Yu et al. | |
| 2014/0231315 | A1 | 8/2014 | Laurell et al. | |
| 2015/0010939 | A1 | 1/2015 | Warner et al. | |
| 2015/0093817 | A1* | 4/2015 | Foster | F16K 99/0046 216/36 |
| 2015/0140545 | A1* | 5/2015 | Johnson | B01L 3/502761 435/3 |
| 2015/0177111 | A1 | 6/2015 | Warmer et al. | |
| 2015/0253226 | A1 | 9/2015 | Augustsson et al. | |
| 2015/0308971 | A1 | 10/2015 | Bisgaard et al. | |
| 2015/0367346 | A1* | 12/2015 | Foster | G01N 15/1484 435/288.7 |
| 2016/0252445 | A1 | 9/2016 | Yu et al. | |
| 2017/0002846 | A1* | 1/2017 | Prakash | B01F 13/0077 |
| 2017/0038288 | A1* | 2/2017 | Ward | G01N 21/645 |
| 2017/0248508 | A1* | 8/2017 | Ward | G01N 15/1056 |
| 2018/0348097 | A1 | 12/2018 | Abbott et al. | |

FOREIGN PATENT DOCUMENTS

| | | | |
|---|---|---|---|
| WO | 2009132151 | 10/2009 | |
| WO | 2009139246 | 11/2009 | |
| WO | WO-2009139246 A1 * | 11/2009 | B01L 3/502738 |
| WO | 2013112121 | 8/2013 | |
| WO | WO-2013112121 A1 * | 8/2013 | B01L 3/502738 |

OTHER PUBLICATIONS

Black et al. (Basics of Voice Coil Actuators, PCIM, 1993, ACM-Magnetics Website, pp. 44-46 (Year: 1993).*

Petersson et al., Separation of lipids from blood utilizing ultrasonic standing waves in microfludic channels, Analyst, 2004, 938-943, vol. 129.

Jonsson et al., Particle separation using ultrasound can radically reduce embolic load to brain after cardiac surgery, The Annals of Thoracic Surgery, 2004, 1572-1578, vol. 78.

Petrov et al., Electrically controlled integrated optical filter, Technical Physics Letters, 2004, 120-122, vol. 30.

Xia et al., Combined microfluidic-micromagnetic separation of living cells in continuous flow, Biomedical Microdevices, 2006, 299-308, vol. 8.

Radisic et al., Micro- and nanotechnology in cell separation, International Journal of Nanomedicine, 2006, 3-14, vol. 1.

Pamme et al., Continuous sorting of magnetic cells via on-chip free-flow magnetophoresis, Lab on a Chip, 2006, 974-980, vol. 6.

Laurell et al., Chip integrated strategies for acoustic separation and manipulation of cells and particles, Chemical Society Reviews, 2007, 492-506, vol. 36.

Riethdorf et al., Detection of circulating tumor cells in peripheral blood of patients with metastatic breast cancer: A validation study of the CellSearch system, Clinical Cancer Research, 2007, 920-928, vol. 13.

June, Carl H., Adoptive T cell therapy for cancer in the clinic, The Journal of Clinical Investigation, 2007, 1466-1476, vol. 117.

Pamme, Nicole, Continuous flow separations in microfluidic devices, Lab on a Chip, 2007, 1644-1659, vol. 7.

Riley et al., Human T regulatory cell therapy: Take a billion or so and call me in the morning, Immunity, 2009, 356-665, vol. 30.

Tsutsui et al., Cell separation by non-inertial force fields in microfluidic systems, Mechanics Research Communications, 2009, 92-103, vol. 36.

Lenshof, Andreas, Acoustic standing wave manipulation of particles and cells in microfluidic chips, Doctoral Thesis, 2009, Lund University, Lund, Sweden.

Yu et al., Circulating tumor cells: approaches to isolation and characterization, The Journal of Cell Biology, 2018, 373-382, vol. 192.

Utz et al., Microfluidic waves, Lab on a Chip, 2011, 3846-3854, vol. 11.

Dykes et al., Efficient removal of platelets from peripheral blood progenitor cell products using a novel micro-chip based acoustophoretic platform, PLOS One, 2011, e23074, vol. 6.

Augustsson et al., Microfluidic label-free enrichment of prostate cancer cells in blood based on acoustophoresis, Analytical Chemistry, 2012, 7954-7962, vol. 84.

Kandilov et al., The national market for medicare clinical laboratory testing: implications for payment reform, Medicare & Medicaid Research Review, 2012, e1-e21, vol. 2.

Barnkob et al., Acoustic radiation- and streaming-induced microparticle velocities determined by micro-PIV in an ultrasound symmetry plane. Physical Review E, 2012, 056307, vol. 86.

Tajudin et al., Integrated acoustic immunoaffinity-capture (IAI) platform for detection of PSA from whole blood samples, Lab on a Chip, 2013, 1790-1796, vol. 13.

Burguillos et al., Microchannel acoustophoresis does not impact survival or function of microglia, leukocytes or tumor cells, PLOS One, 2013, e64233, vol. 8.

(56) References Cited

OTHER PUBLICATIONS

Singh et al., Manufacture of clinical-grade CD 19-specific T cells stably expressing chimeric antigen receptor using sleeping beauty system and arlilicial antigen presenting cells, PLOS One, 2013, e64138, vol. 8.
Lenshof et al., Efficient purification of CD4+ lymphocytes from peripheral blood progenitor cell products using affinity bead acoustophoresis, Cytometry Part A, 2014, 933-941, vol. 85A.
Ilie et al., "Sentinel" circulating tumor cells allow early diagnosis of lung cancer in patients with chronic obstructive pulmonary disease, PLOS One, 2014, e111597, vol. 9.
Matsueda et al., Immunotherapy in gastric cancer, World Journal of Gastroenterology, 2014, 1657-1666, vol. 20.
Grenvall et al., Concurrent isolation of lymphocytes and granulocytes using prefocused free flow acoustophoresis, Analytical Chemistry, 2015, 5596-5604, vol. 87.
Jakobsson et al., Thousand-fold volumetric concentration of live cells with a recirculating acoustofluidic device, Analytical Chemistry, 2015, 8497-8502, vol. 87.
Fong et al., A microfluidic platform for precision small-volume sample processing and its use to size separate biological particles with an acoustic microdevice, Journal of Visualized Experiments, 2015, e53051, vol. 105.
Shields et al., Microfluidic cell sorting: a review of the advances in the separation of cells from debulking to rare cell isolation, Lab on a Chip, 2015, 1230-1249, vol. 15.
Temiz et al., Lab-on-a-chip devices: how to close and plug the lab?, Microelectronic Engineering, 2015, 156-175, vol. 132.
Hahn et al., A numerically efficient damping model for acoustic resonances in microfluidic cavities, Physics of Fluids, 2015, 062005, vol. 27.
Poruk et al., Circulating tumor cell phenotype predicts recurrence and survival in pancreatic adenocarcinoma, Annals of Surgery, 2016, 1073-1081, vol. 264.
Jansson et al., Prognostic impact of circulating tumor cell apoptosis and clusters in serial blood samples from patients with metastatic breast cancer in a prospective observational cohort, BMC Cancer, 2016, 433, vol. 16.
Banys-Paluchowski et al., Circulating tumor cells in breast cancer-current status and perspectives, Critical Reviews in Oncology/Hematology, 2016, 22-29, vol. 97.
Urbansky et al., Affinity-bead-mediated enrichment of CD8+ lymphocytes from peripheral blood progenitor cell products using acoustophoresis, Micromachines, 2016, 101, vol. 7.
Chen et al., Cancer statistics in China, 2015, CA: A Cancer Journal for Clinicians, 2016, 115-132, vol. 66.
Magnusson et al., Clinical-scale cell-surface-marker independent acoustic microfluidic enrichment of tumor cells from blood, Analytical Chemistry, 2017, 11954-11961, vol. 89.
Boffa et al., Cellular expression of PD-L1 in the peripheral blood of lung cancer patients is associated with worse survival, Cancer Epidemiology, Biomarkers & Prevention, 2017, 1139-1145, vol. 26.
Cui, Mingyang, Particle enrichment in longitudinal standing bulk acoustic wave microfluidics, Master Thesis, 2017, Washington University, St. Louis, Missouri.
Eyer et al., Single-cell deep phenotyping of IgG-secreting cells for high-resolution immune monitoring, Nature Biotechnology, 2017, 977-982, vol. 35.
Fachin et al., Monolithic chip for high-throughput blood cell depletion to sort rare circulating tumor cells, Scientific Reports, 2017, 10936, vol. 7.
Cushing et al., Reducing WBC background in cancer cell separation products by negative acoustic contrast particle immuno-acoustophoresis, Analytica Chimica Acta, 2018, 256-264, vol. 1000.
Vormittag et al., A guide to manufacturing CAR T cell therapies, Current Opinion in Biotechnology, 2018, 164-181, vol. 53.
Yu et al., An integrated enrichment system to facilitate isolation and molecular characterization of single cancer cells from whole blood, Cytometry Part A, 2018, 1226-1233, vol. 93A.
Leipold et al., Comparison of CyTOF assays across sites: Results of a six-center pilot study, Journal of Immunological Methods, 2018, 37-43, vol. 453.
Abdlaty et al., Hyperspectral imaging: comparison of acousto-optic and liquid crystal tunable filters, Proceedings of SPIE, Medical Imaging 2018: Physics of Medical Imaging, 105732P, vol. 10573.
Bhagwat et al., An integrated flow cytometry-based platform for isolation and molecular characterization of circulating tumor single cells and clusters, Scientific Reports, 2018, 5035, vol. 8.
Kulasinghe et al., Capture of circulating tumor cell clusters using straight microfluidic chips, Cancers, 2019, 89, vol. 11.
Das et al., Naive T cell deficits at diagnosis and after chemotherapy impair cell therapy potential in pediatric cancers, Cancer Discovery, 2019, 492-499, vol. 9.
Chen et al., Next-generation sequencing in liquid biopsy: cancer screening and early detection, Human Genomics, 2019, 34, vol. 13.
Nilsson et al., Acoustic control of suspended particles in micro fluidic chips, Lab on a Chip, 2004, 131-135, vol. 4.
Petersson et al., Free flow acoustophoresis: microfluidic-based mode of particle and cell separation, Analytical Chemistry, 2007, 5117-5123, vol. 79.
Adams et al., Integrated acoustic and magnetic separation in microfluidic channels, Applied Physics Letters, 2009, 254103, vol. 95.
Adams et al., Tunable acoustophoretic band-pass particle sorter, Applied Physics Letters, 2010, 064103, vol. 97.
Guldiken et al., Sheathless size-based acoustic particle separation, Sensors, 2012, 905-922, vol. 12.
Glynne-Jones et al., Acoustofluidic 23: acoustic manipulation combined with other force fields, Lab on a Chip, 2013, 1003-1010, vol. 13.
Sajeesh et al., Particle separation and sorting in microfluidic devices: a review. Microfluidic Nanofluidic, 2014, 1-52, vol. 17.
Watarai, Hitoshi, Continuous separation principles using external microaction forces, Annual Review of Analytical Chemistry, 2013, 353-378, vol. 6.
Yasutaka et al., Dual-stage actuator for HDD achieving high-accuracy positioning and wide-bandwidth servo control, Toshiba Review, 2011, vol. 66.
Antfolk et al., Label-free single-cell separation and imaging of cancer cells using an integrated microfluidic system, 2017, 46507, vol. 7.
Urbansky et al., Label-free separation of leukocyte subpopulations using high throughput multiplex acoustophoresis, Lab on a Chip, 2019, 1406, vol. 19.
Chemi et al., Pulmonary venous circulating tumor cell dissemination before tumor resection and disease relapse, Nature Medicine, 2019, 1534-1539, vol. 25.
Liu et al., Epithelial-type systemic breast carcinoma cells with a restricted mesenchymal transition are a major source of metastasis, Science Advances, 2019, eaav4275, vol. 5.
Xu et al., Correlation of pulmonary venous circulating tumor cells with clinicopathological parameters in patients with early-stage lung adenocarcinoma, Translational Cancer Research, 2019, 887-898, vol. 8.
Ott et al., An ongoing analysis of a phase IB study of the personal neoantigen vaccine NEO-PV-01 + Nivolumab in patients with metastatic melanoma, NSCLC and bladder cancer, Handout from ESMO Congress, Munich, 2018.
Second-generation micro actuator for better head-positioning accuracy, Hitachi Global Storage Technology Tech Brief, 2017.

* cited by examiner

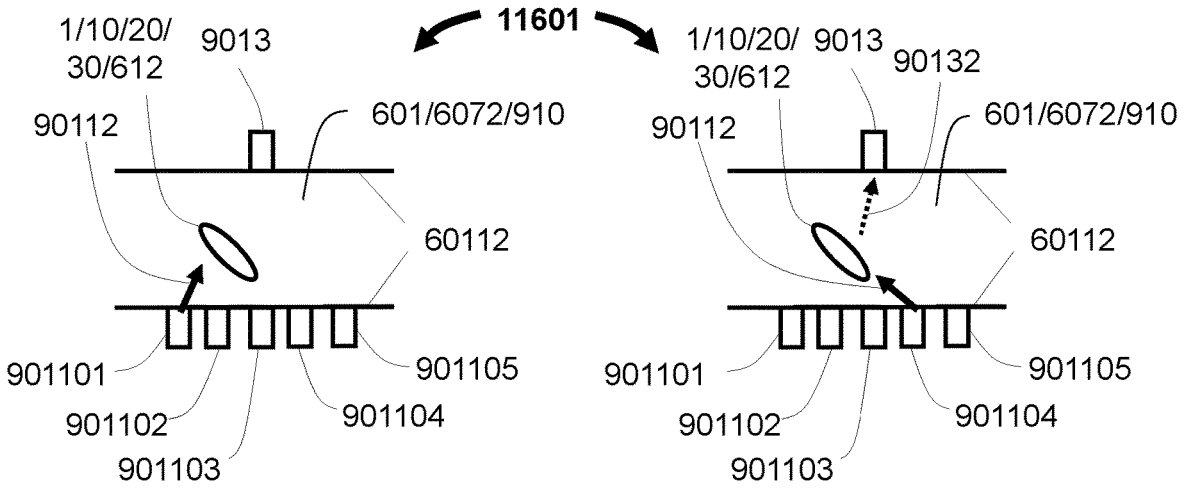
FIG. 114A
FIG. 114B
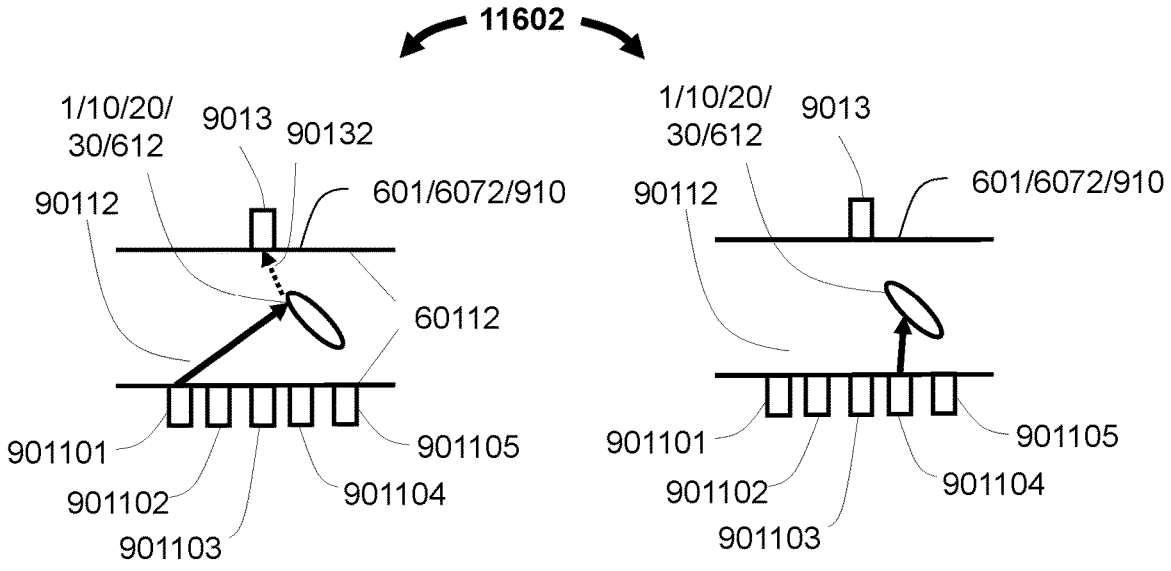
FIG. 114C
FIG. 114D

BIOLOGICAL ENTITY SEPARATION DEVICE AND METHOD OF USE

BACKGROUND

The current invention generally relates to device to analyze and separate biological entities, including cells, bacteria and molecules from human blood, body tissue, body fluid and other human related biological samples, and methods to achieve the same. The disclosed devices and methods may also be utilized to separate and analyze biological entities from animal and plant samples. More particularly, the current invention relates to the methods and apparatus for achieving separation of biological entities with using one or more magnetic devices, one or more micro-fluidic devices, one or more fluorescent detectors, one or more micro-actuator activated sorting devices, individually or in combination. For description purpose, "cells" will be used predominantly hereafter as a typical representation of biological entities in general. However, it is understood that the methods and apparatus as disclosed in this invention may be readily applied to other biological entities without limitation.

Separation of biological entities from a fluid base solution, for example separating a specific type of white blood cells from human blood, typically involves a first step of identifying the target biological entities with specificity, and followed by a second step of physical extraction of the identified target biological entities from the fluid base solution. In human blood, different types of biological cells may have various types of surface antigens or surface receptors, which are also referred to as surface markers in this invention. Certain surface markers on a given type of cells may be unique to said type of cells and may be used to identify said type of cells from blood sample with specificity.

FIG. 1A through FIG. 1C show examples of identifying or labeling target cells 1, with using superparamagnetic labels 2 ("SPL") as in FIG. 1A, using optical fluorescent labels 3 ("OFL") as in FIG. 1B, and using both the SPL 2 and OFL 3 together as in FIG. 1C.

In FIG. 1A, cell 1 has surface markers 11. SPLs 2 are conjugated with surface antibodies or ligands, also referred to as "probe" 21, which specifically bind to the surface markers 11 of cell 1. Large quantity of SPL 2 having probes 21 are put into the solution where cell 1 resides. After incubation processes 9, a plurality of SPLs 2 are bound to cell 1 surface with probes 21 selectively bound to surface markers 11 with specificity. Thus, cells 1 is magnetically identified or labeled by SPLs 2, i.e. magnetically labeled cell 10. A magnetic field with sufficient field gradient may be applied to cell 10 to produce a physical force on the SPLs 2 attached to the cells 10 surface. With sufficient strength, the physical force working through the SPLs 2 on cell 10 may be used to separate and physically remove cell 10 from its liquid solution.

In FIG. 1B, cell 1 has surface markers 12. OFLs 3 are conjugated with probes 22, which specifically bind to the surface markers 12 of cell 1. Large quantity of OFLs 3 having probes 23 are put into the solution where cell 1 resides. After incubation processes 9, a plurality of OFLs 3 are bound to cell 1 surface with probes 22 selectively bound to surface markers 12 with specificity. Thus, cells 1 is optically identified or labeled by OFLs 3, i.e. optically labeled cell 20. By using an optical based cell separation system, cell 1 may be separated from its liquid solution based on the optical signal that OFL 3 produces under an excitation light. One type of such optical based cell separation system is a flow cytometer, wherein said liquid solution is streamed through a conduit within said flow cytometer as a continuous flow. At least one excitation light source produces a light spot upon said liquid flow through said conduit at a first optical wavelength. In presence of OFL 3 in the light spot, OFL3 is excited by first wavelength and radiates optical light at a second wavelength. When cell 1 with bound OFLs 3 passes said light spot within said flow, OFLs 3 bound to cell 1 radiate optical signal in second wavelength, whereas strength of said optical signal as well as duration while cell 1 passes the light spot may be used to identify presence of cell 1 by the flow cytometer, which then diverts cell 1 into a second liquid flow path or mechanically remove cell 1 from the liquid flow, thus separating cell 1 from fluid base. In practice, OFL 3 bound to cell 1 may be in various types of fluorescent dyes or quantum dots, producing exited optical light at multiple wavelengths. A plurality of excitation light sources may also be used in same flow cytometer system to produce excitation light spots at different locations of the liquid flow with different excitation light wavelength. Combination of various wavelength produced by OFL 3 on same cell 1 may be used to increase specificity of separation of cell 1, especially when a combination of various types of surface markers 12 is needed to specifically identify a sub-category target cell 1 population from a major category of same type of cells, for example CD4-T cells from other white blood cells.

In FIG. 1C, cell 1 has both surface markers 11 and 12. SPLs 2 conjugated with probes 21 and OFLs 3 conjugated with probes 22 are both bound to cell 1 surface after incubation processes 9 to form magnetically and optically labeled cell 30. Cell 30 allows for separation of cell 30 with a combination of magnetic separation and an optical based cell separation system, where a magnetic separation through SPLs 2 may provide a fast first stage separation of cell category including cell 30, while the optical separation through OFLs 3 may provide a second stage separation of cell 30 after magnetic separation with more specificity. Alternatively, cell 30 may be separated via OFLs 3 in a first stage and via SPLs 2 in a second stage. In either case, SPLs 2 and OFLs 3 together may help increase speed, efficiency and specificity in separation of cell 1 compared with FIG. 1A and FIG. 1B.

FIG. 2A shows an example of conventional magnetic separation through SPL 2. In a container 5, liquid solution 6 contains cells 10 of FIG. 1A or cells 30 of FIG. 1C that are bound with plurality of SPLs 2 on cell surface. Magnet 4, preferably a permanent magnet, is positioned in proximity to wall of container 5. Magnet 4 has a magnetization represented by arrow 41 indicating a north pole ("N") and a south pole ("S") on top and bottom surfaces of the magnet 4. Magnetic field produced by the magnetization 41 in the solution 6 is higher at the container 5 wall directly opposing the N surface of the magnet 4, and lower at locations within solution 6 further away from the magnet 4, thus creating a magnetic field gradient pointing towards the magnet 4 within the solution 6. SPLs 2 bound to cell 10/30 are superparamagnetic, which are effectively non-magnetic in absence of magnetic field, but will gain magnetic moment in presence of the magnetic field produced by the magnet 4. With the magnetic moment of SPLs 2 and the magnetic field gradient from magnet 4, cells 10/30 will be pulled by the force produced by the magnetic field from magnet 4 towards magnet 4. After sufficient time 7, cells 10/30 may be depleted from solution 6 and form conglomerate at inside surface of the container 5 wall opposing magnet 4. In conventional practice, solution 6 may be removed from container 5, while maintaining magnet 4 position relative to container 5 thus cells 10/30 are retained as conglomerate against container 5 inside surface. Afterwards, magnet 4 may be removed from container 5. With absence of magnetic field, conglomerate of cells 10/30, together with any non-bound free SPLs in the conglomerate, shall self-demagnetize over extensive time to be non-magnetic and cells 10/30 may be removed from container 5 as individual cells 10/30.

Conventional method as shown in FIG. 2A has limitations in actual applications. For the SPL 2 to be superparamagnetic, the size of the fundamental superparamagnetic particles ("SPN") contained in SPL 2, for example iron oxide particles, shall be in the range of 10 nm (nanometer) to 30 nm, where a smaller particle size makes the particles more effectively superparamagnetic but harder to gain magnetic moment in presence of magnetic field, while a larger particle size makes the particles more difficult to become non-magnetic when magnetic field is removed. SPL 2 is typically composed of SPNs dispersed in a non-magnetic matrix. For example, certain SPL 2 is a solid sphere formed by SPNs evenly mixed within a polymer base, typically in the size of larger than 1 um (um). In another case, SPL 2 is solid bead formed by SPNs mixed within an oxide or nitride base, for example iron oxide nanoparticles mixed in silicon oxide base, which can be in the size of a few hundred nanometers or tens of nanometers. For the cells 10/30 of FIG. 2A to be suitable for additional cellular processes, including cell culture and cell analysis, SPL 2 size is desirable to be smaller than the cell itself, which is usually a few ums. Thus, SPL 2 with sub-um size (<1 um) is desired. SPL 2 size less than 500 nm is more preferred. SPL 2 size less than 200 nm is most preferred. However, when SPL 2 average size is smaller, variation of SPL 2 size becomes larger statistically. FIG. 2B shows example schematics of single SPL 2 magnetic moment in the presence of an applied magnetic field. Solid curve 22 indicates SPL 2 having a population nominal size, or average size, where SPL 2 magnetic moment increases with higher magnetic field. With magnetic field strength increasing from 0 to Hs, nominal size SPL magnetic moment increases with field strength in a linear trend at beginning, until reaching a saturation region where magnetic moment plateaus to Ms, which is determined by the saturation moment of the SPNs material within the SPL 2. For SPL 2 with a smaller size than nominal size, curve 23 indicates that at the same magnetic field strength, smaller size SPL 2 gains a lower moment, and thus experiencing a lower magnetic force, and requires a higher field to reach saturation magnetic moment Ms. For a larger size SPL 2 than nominal size, curve 24 indicates larger size SPL 2 is easier to saturate to Ms with a lower field and gains a higher moment at same magnetic field strength.

Now referring back to FIG. 2A, for SPL 2 with sub-um size that is suitable for cell separation and cellular processes, conventional method of FIG. 2A has limitation of not being able to produce high magnetic field strength and strong magnetic field gradient in solution 6 at locations further away from the container 5 wall opposing magnet 4 N surface. Therefore, smaller size SPL 2 of curve 23 of FIG. 2B at farther end of the container 5 from magnet 4 may be difficult to magnetize by magnet 4 field and experiences smaller force to move the cell 10/30 towards magnet 4. To reach complete depletion of cells 10/30 in solution 6 within container 5, it may require significant amount of time. Meanwhile, volume of container 5 is limited also due to magnetic field strength from magnet 4 may not be sufficient to magnetize the smaller SPL 2 of curve 23 of FIG. 2B at large container 5 sizes. Besides overall process being slow, another drawback in conventional method of FIG. 2A is that the operation as described in FIG. 2A typically involves air exposure of cells 10/30 conglomerate during the steps of solution removal and later removal of cells 10/30 from container 5. Such air exposure poses challenge in achieving sterile separation of cells 10/30 for clinical purpose, as well as risk of cell 10/30 damage or death that negatively affects further cellular processes of cell 10/30.

FIG. 3A shows another example of magnetic separation of cells 10/30 with SPL 2 in prior art. In FIG. 3A, solution 6 containing cells 10/30 is passed through a column 31 that is filled with ferromagnetic or ferromagnetic spheres 36. By applying a magnetic field across the column with magnets 32 and 33, where dashed lines 34 indicates applied magnetic field direction, spheres 36 may be magnetized by the field and producing localized magnetic field in gaps between neighboring spheres 36. Such local field and field gradient between spheres 36 gaps may be strong, due to the small dimensions of the gaps, to effectively magnetize SPL 2 of all sizes when SPL 2 in solution 6 passes through the gaps between the spheres 35 during a downward flow of solution 6 as indicated by arrow 35, where SPL 2 may be attracted to various spheres 36 surface and separated from the solution 6. Prior art of FIG. 3A may effectively avoid the air exposure issue of FIG. 2A, and may possess at a higher separation speed of cells 10/30 than FIG. 2A during the flow 35. However, an intrinsic issue of FIG. 3A method is that with the spheres 36 being ferromagnetic or ferromagnetic and is much larger in size than cells 10/30, magnetic domains in spheres 36 will exist even after removal of magnets 32 and 33 from the column 31. Such magnetic domains, and domain walls between the domains, will inevitably produce local magnetic field around the surface of the spheres 36, which will keep the SPLs 2 on cells 10/30 magnetized and strongly attracting the cells 10/30 when magnets 32 and 33 are removed. Therefore, the cells 10/30 are inherently more difficult to be removed from the column 31 in FIG. 3A than FIG. 2A. Cells 10/30 loss due to not completely removed from column 31 after separation is inherently high. In certain prior art method, a pressurized high speed buffer flow may be used to force wash the cells 10/30 from the spheres in column 36. However, such forced flow will inevitably cause mechanical damage to the cells and will still leave significant percentage of cells 10/30 in column 31 due to the strong domain wall field of spheres 36. Besides cells 10/30 loss, another intrinsic issue of FIG. 3A method is introducing spheres 36 as foreign materials in the flow of solution 6, which is not desirable for sterile process needed for clinical applications.

FIG. 3B then shows another prior similar to method of FIG. 3A, except mesh 37 made of ferromagnetic or ferromagnetic wires are introduced in the column 31 instead of spheres or blocks 36. When magnetic field 34 is applied by the magnets 32 and 33, wires of mesh 37 are magnetized and adjacent wires of mesh 37 produce local magnetic field around the wires. Clearances between wires of the mesh allow fluid 6 to flow in direction 35 within the column. When cells 10/30 is in proximity to wires of mesh 37, cells 10/30 may be attracted to the wire surface due to the local magnetic field and field gradient produced by the wires of the mesh 37. Compared to FIG. 3A prior art, FIG. 3B may adjust size of wires and size of clearance of mesh 37 to tradeoff between cells 10/30 separation speed and cell loss in column. However, in practice, due to the gap between spheres 36 is much smaller than clearance size in mesh 37, cells 10/30 separation speed in FIG. 3B is slower than FIG. 3A, while FIG. 3B still possesses the same cells loss issue of FIG. 3A, where domains in the wires of mesh 37 maintains SPL 2 magnetic moment after magnets 32 and 33 are removed and cells 10/30 are attracted to the wires by the domain and domain wall. Cells 10/30 loss due to the magnetic domains in wires of mesh 37 also exists in FIG. 3B. Additionally, FIG. 3B is same as FIG. 3A in introducing mesh 37 as foreign materials in the flow of solution 6, which is not desirable for sterile process.

FIG. 3C shows another prior art, where magnets 32 and 33 are each attached with a soft magnetic flux guide 38 with an apex. The flux guides 38 produce localized magnetic field between the apexes of the guides 38 with high field strength and high gradient close to the apexes. FIG. 3C shows the cross-sectional view of the conduit 39, which is intrinsically a circular tubing, whereas solution 6 containing cells 10/30 flows along the tubing 39 length in the direction perpendicular to the cross-section view. Tubing 39 is positioned on one side of the gap of the apexes. Magnetic field lines 34 exhibit a higher density closer to the gap indicates both higher magnetic field strength and higher magnetic field gradient towards the gap. Magnetic field 34 produces effective force on cells 10/30 in solution 6 and pulls the cells 10/30 from solution 6 towards the tubing 39 inside wall that is closest to the apexes of the guides 38. Prior art of FIG. 3C when compared to prior art of FIG. 3A and FIG. 3B has the advantages of: (1) not introducing foreign material in the flow path; (2) when magnets 32 and 33 are removed from tubing together with guides 38, there is no ferromagnetic or ferromagnetic sphere 36 or mesh 37 in the tubing, thus avoiding the domain structures related loss of cells 10/30.

However, prior art of FIG. 3C also has intrinsic deficiencies. First deficiency is the flow speed of solution 6, or flow rate, in the tubing 39 is limited by the prior art design of FIG. 3C. The separation speed of cells 10/30 of prior art as in FIG. 3C is not sufficient for many applications. Circular tubing conduit 39 as shown in FIG. 3C experiences high field and high field gradient at lower end of tubing 39, where cells 10/30 closer to the lower end of tubing 39 may experience a high force that pulls them to move towards the tubing 39 lower wall inner surface much faster. However, for the cells 10/30 closer to the top end of the tubing 39, due to the narrow wedge gap and position of the tubing 39 being on one side of the gap, magnetic field and gradient is significantly lower than the lower end. Thus cells 10/30 closer to the top end of the tubing 39 experiences a much smaller force and moves to lower end of tubing 39 at a much slower speed. For a limited length of the tubing 39 in the perpendicular to cross-sectional view direction, all cells 10/30 within the fluid 6 flowing through the tubing 39 need to be separated from solution 6 to form a conglomerate on the inside surface of the tubing close to the apexes before solution 6 exits the tubing 39. Due to slower speed of cells 10/30 moving from top of the tubing 39, flow rate of solution 6 needs to be slow such that it can allow enough time for all the cells 10/30 near top of tubing 39 to be attracted into the conglomerate. If solution 6 flows through the tubing 39 at higher speed, it will cause incomplete separation of cells 10/30 from solution. Such limitation on flow rate due to the circular design of tubing 39, where tubing top end being further away from high field and high gradient apexes cannot be cured by a smaller size tubing 39. A smaller cross-sectional size circular tubing 39 will bring the top end of the tubing 39 closer to the wedge gap. However, due to the smaller cross-section size, volume of solution 6 flowing through the tubing 39 in a unit time frame, i.e. flow rate of solution 6, will reduce when flow speed of solution 6 maintains. To maintain same flow rate as in a larger tubing 39, solution 6 flow speed needs to increase, which then gives less time for cells 10/30 at top end of smaller size tubing 39 to move to the conglomerate site, and offsets the effect of small size tubing 39.

A second deficiency of FIG. 3C prior art is the inability to dissociate individual cell 10/30 from conglomerate of cells 10/30 and non-bound free SPL 2, as the conglomerate will not self-demagnetize with ease after magnets 32 and 33, together will guides 38, are removed from tubing 39 in actual applications. Demagnetization of SPL 2 relies on the SPNs within SPL 2 being effectively nanoparticles. However, as the conglomerate forms an effective larger body of superparamagnetic material, the SPNs within SPL 2 experiences magneto-static field from a large number of closely packed SPNs from neighboring SPL 2 in the conglomerate, which reduces the super-paramagnetic nature of the SPNs. In one case, the SPL 2 of cells 10/30 within conglomerate requires extensive time to self-demagnetize, which is not practical for many applications. In another case, the conglomerate won't self-demagnetize due to the SPN being more ferromagnetic in conglomerate form, which is undesirable. High pressure flushing as utilized in FIG. 3A is not effective in FIG. 3C, as majority of the circular tubing 39 inner area is occupied by empty space, while conglomerate is compacted on the lower end of tubing 39, such flush will mainly flow through the top section of the tubing 39 without producing enough friction force on the conglomerate of cells 10/30 to remove the cells 10/30 from the tubing 39 lower wall. As prior art does not provide an effective method to dissociate conglomerate and remove cells 10/30 from tubing 39, such deficiency of FIG. 3C prior art is limiting its application.

Prior arts are limited either in causing cell loss and introducing foreign materials in the flow path, or limited in the flow rate of solution 6 and the ability to extract separated cells from conglomerate with an effective dissociation method.

It is desired to have a method and an apparatus that can achieve high flow rate magnetic separation of cells 10/30 without introducing foreign material in the flow path of the biological solution, and being able to dissociate cells 10/30 from conglomerate in a practically short time without damaging the cells.

SUMMARY OF THE INVENTION

This invention describes devices and methods that are able to: (1) separate biological entities based on their physical properties, including but not limited to: size, density, compressibility; (2) separate biological entities bound with SPL from biological solution; (3) analyze biological entities based on the optical signals emitted by fluorescent molecules bound to the surface receptors or antigens of said biological entities; (4) sort or separate biological entities with specificity based on the optical signals emitted by fluorescent molecules bound to the surface receptors or antigens of said biological entities with micro-actuator mechanism that are integrated into to fluidic path where said biological entities pass through within a fluidic sample.

The methods, components and apparatus as disclosed by this invention may be utilized to separate biological entities, including cells, bacteria and molecules, from human blood, human body tissue, human bones, human body fluid, human hairs, other human related biological samples, as well as biological entities from animal and plant samples alike without limitation.

26B being rotated to top end of the flexible channel.

Figure 26A:
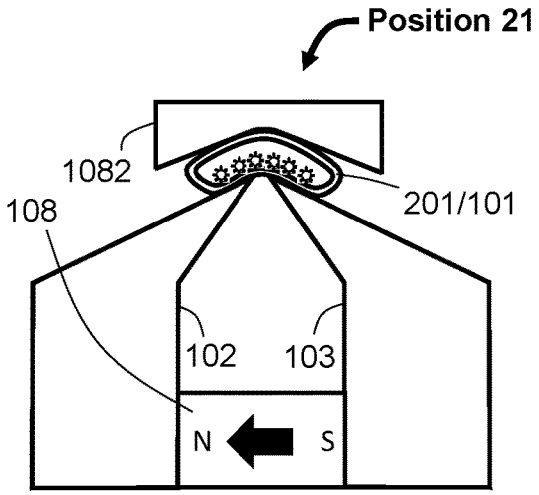
FIG. 26A illustrates the third embodiment of MAG having a flexible channel in separation position with cells being separated.
Figure 26B:
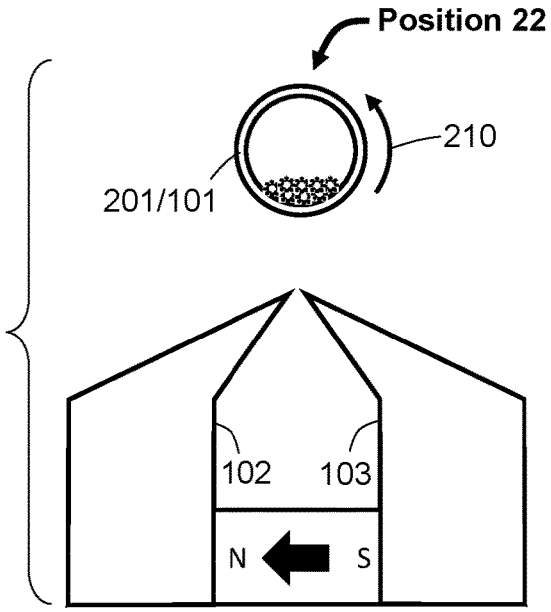
FIG. 26B illustrates the flexible channel of FIG. 26A departs from MAG and rotates.
Figure 26C:
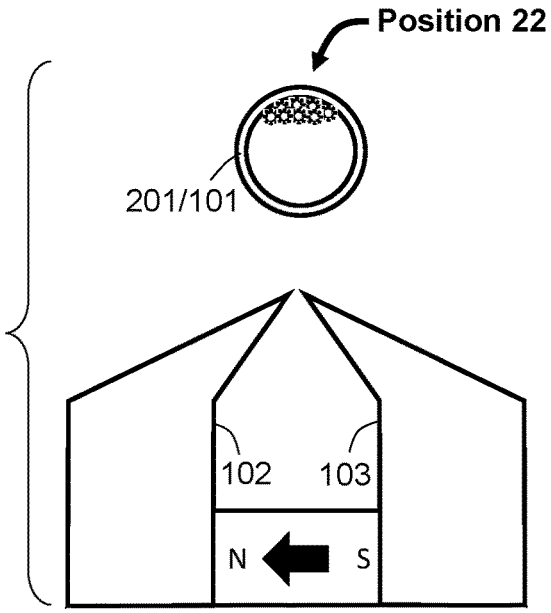
FIG. 26C illustrates the conglomerate of separated cells in the flexible channel of FIG.
Figure 26D:
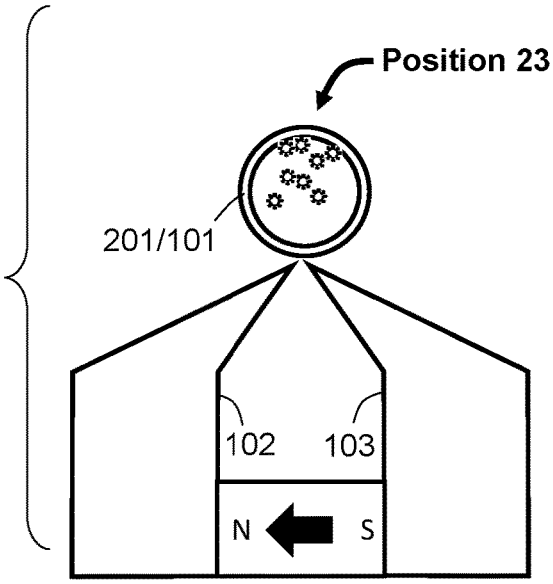

FIG. 26D illustrates the flexible channel of FIG. 26C moves to demagnetization position.

Figure 27A:
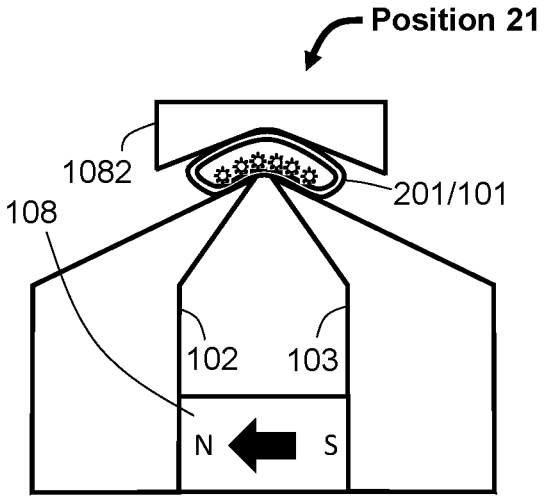

FIG. 27A illustrates the third embodiment of MAG having a flexible channel in separation position with cells being separated.

Figure 27B:
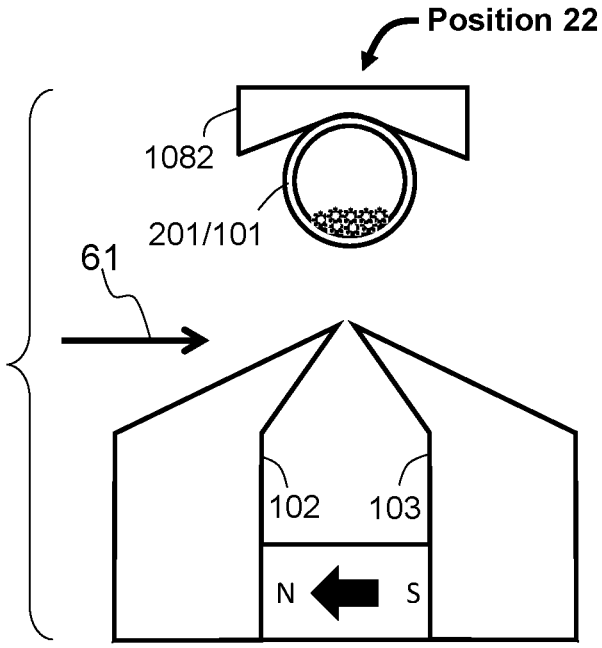

FIG. 27B illustrates the flexible channel and its holder of FIG. 27A depart from MAG.

Figure 27C:
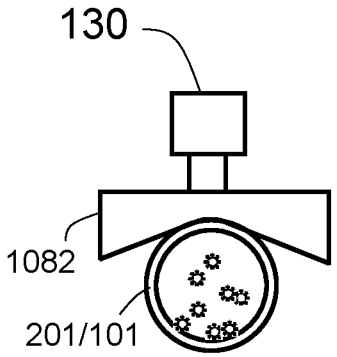

FIG. 27C illustrates mechanical vibration is applied to the channel holder by a motor.

Figure 27D:
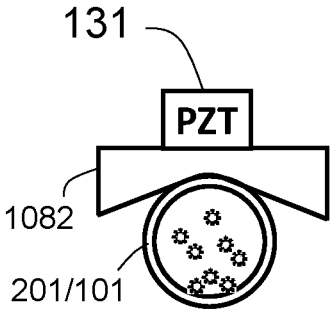

FIG. 27D illustrates ultrasound vibration is applied to the channel holder by a PZT.

Figure 28A:
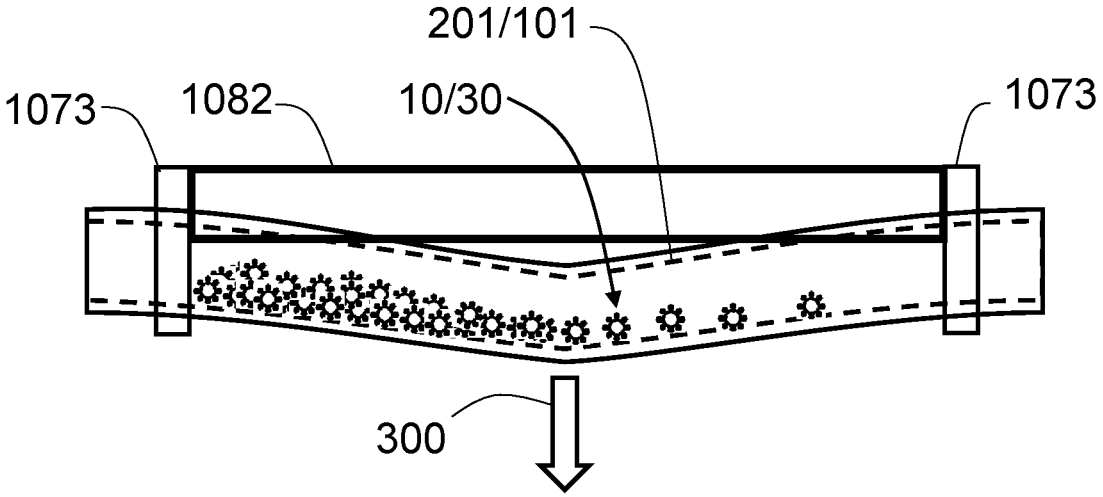

FIG. 28A illustrates a side view of a flexible channel where there flexible channel is mechanically stretched.

Figure 28B:
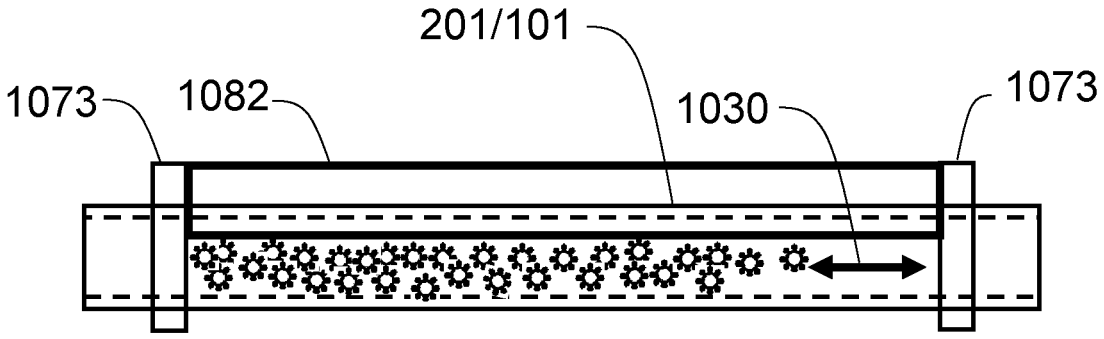

FIG. 28B illustrates cells being dissociated from conglomerate after removal of the external force of FIG. 28A.

Figure 29A:
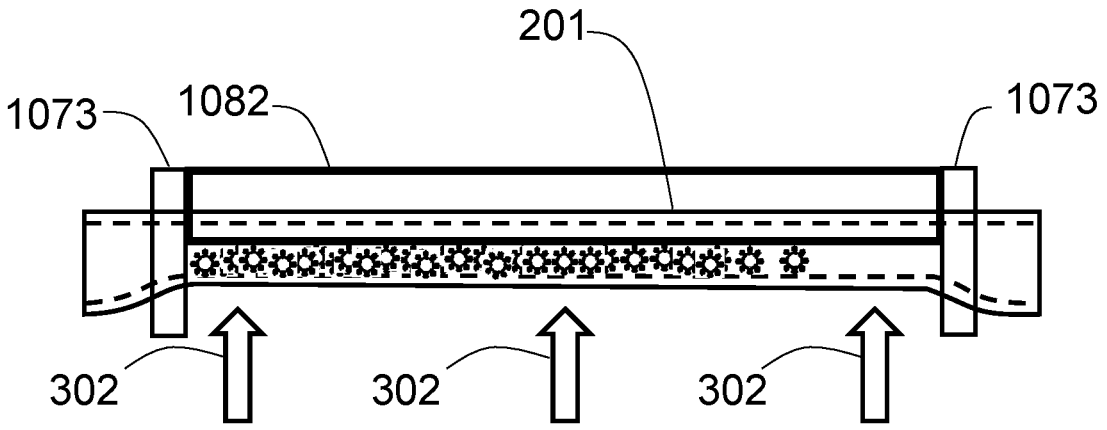

FIG. 29A illustrates a side view of a flexible channel where the flexible channel is mechanically compressed.

Figure 29B:
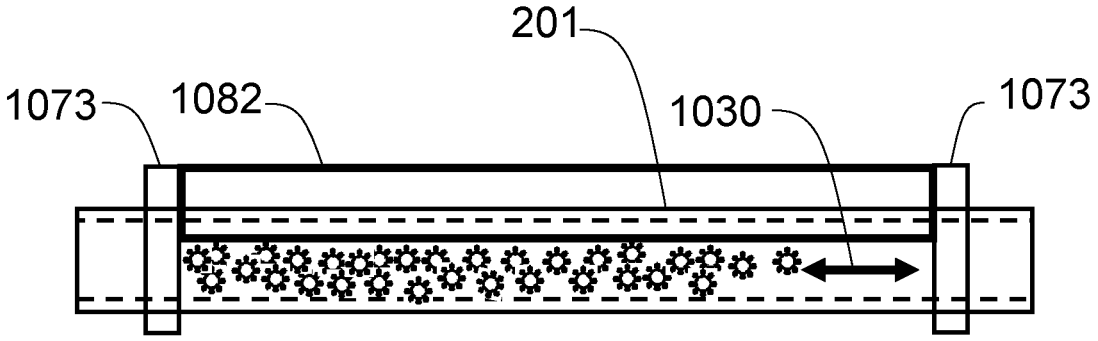

FIG. 29B illustrates cells being dissociated from conglomerate after removal of the external force of FIG. 29A.

Figure 30A:
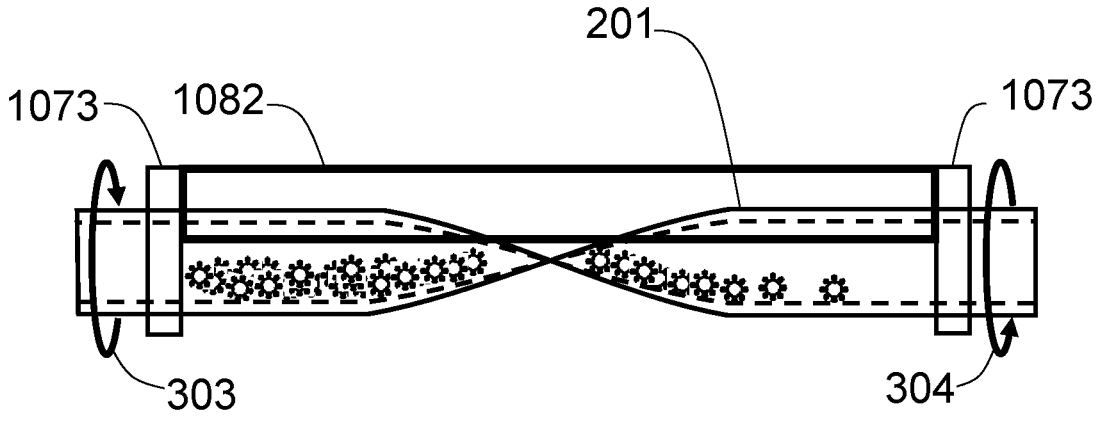

FIG. 30A illustrates a side view of a flexible channel where the flexible channel is mechanically twisted.

Figure 30B:
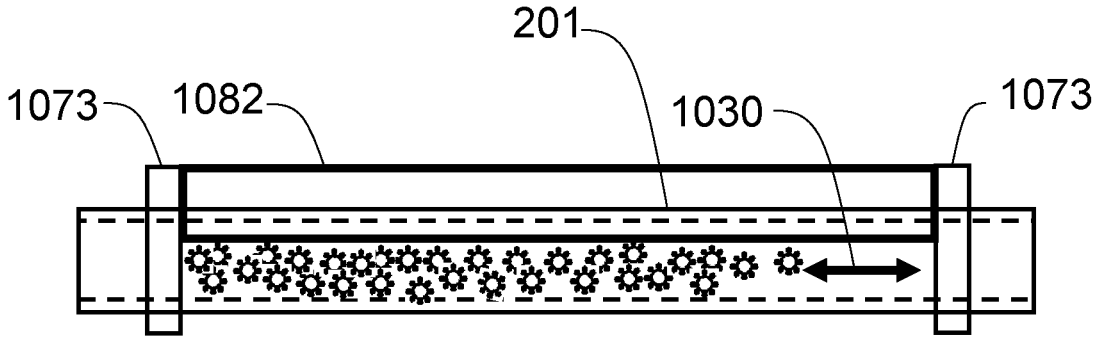

FIG. 30B illustrates cells being dissociated from conglomerate after removal of the external force of FIG. 30A.

Figure 31:
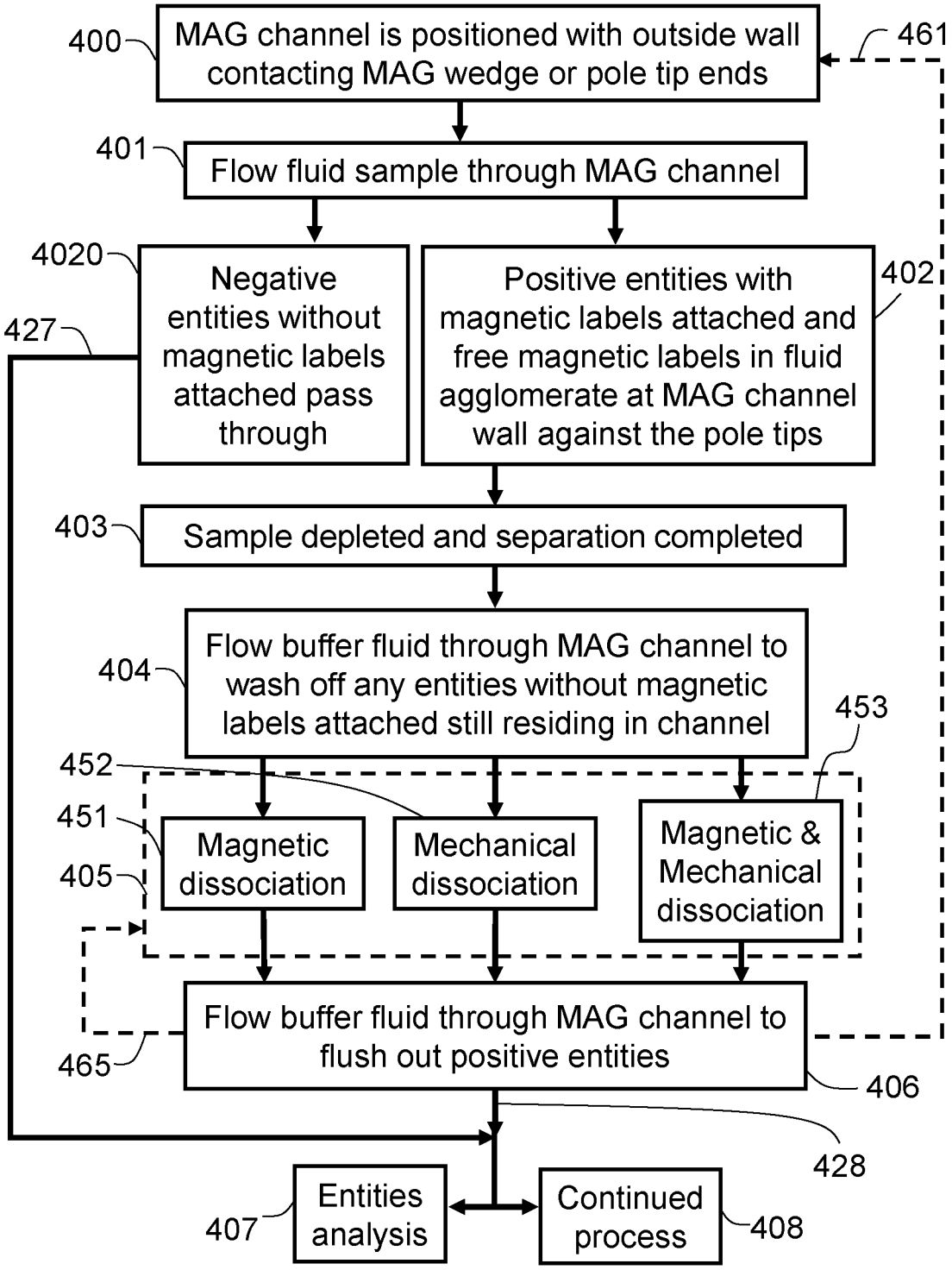

FIG. 31 is a schematic diagram illustrating methods to use MAG to magnetically separate biological entities from fluid solution.

Figure 32:
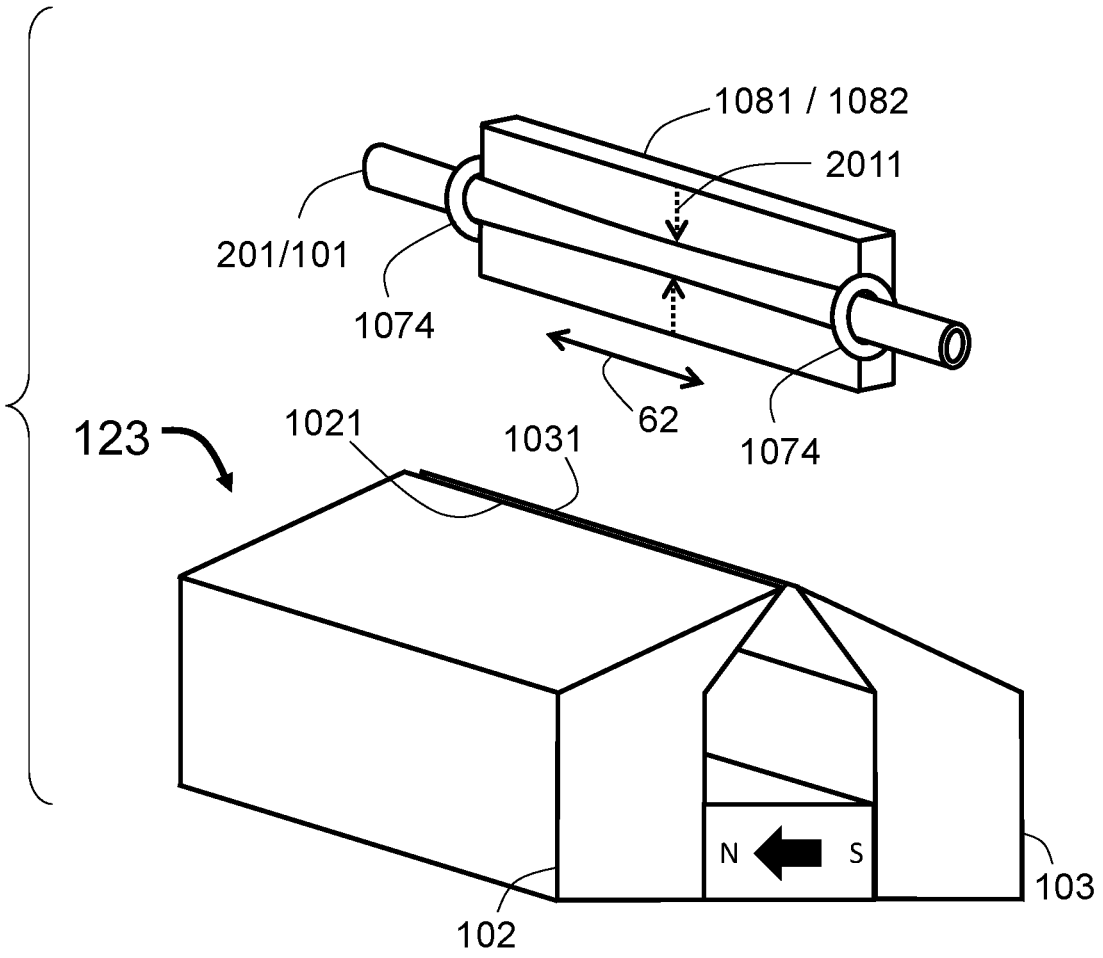

FIG. 32 illustrates a method to align a flexible channel MAG wedge of a MAG device.

Figure 33A:
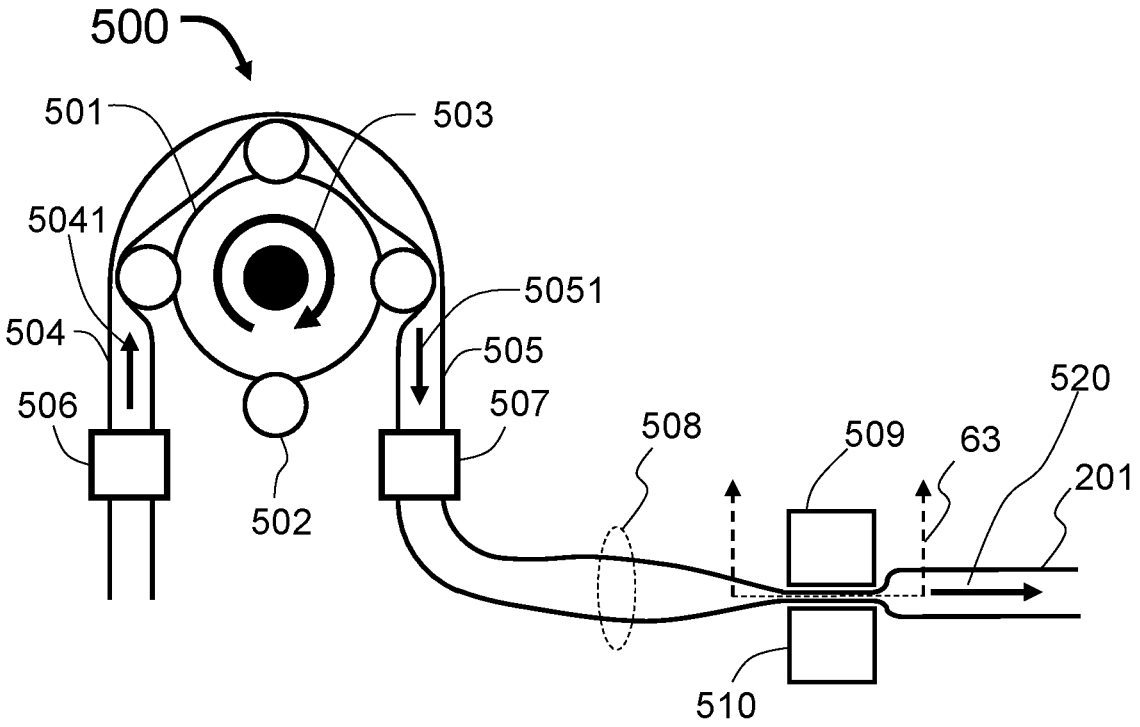

FIG. 33A illustrates a flexible channel attached to the output port of a peristaltic pump, where a flow limiter is attached to the flexible channel to reduce the flow rate pulsation.

Figure 33B:
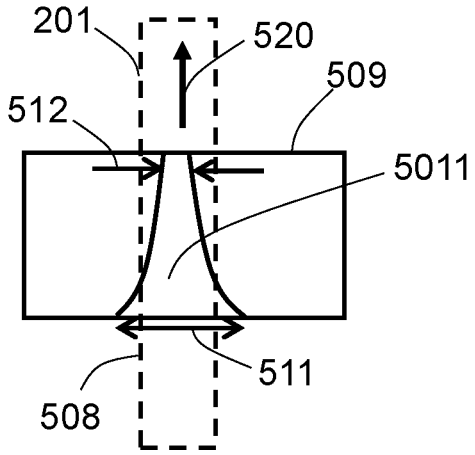

FIG. 33B illustrates a top-down view of the inner structure of a first type flow limiter.

Figure 33C:
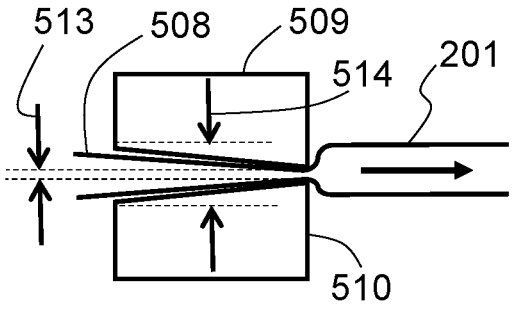

FIG. 33C illustrates a side view of a second type flow limiter.

Figure 34A:
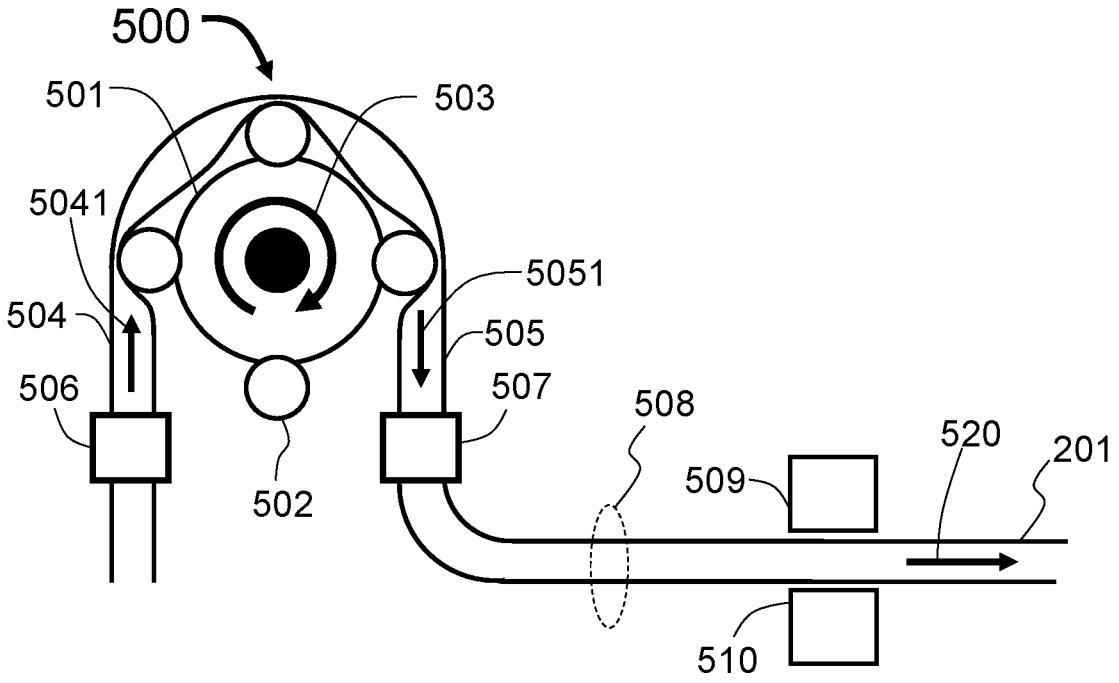

FIG. 34A illustrates FIG. 33A flow limiter being disengaged from the flexible channel.

Figure 34B:
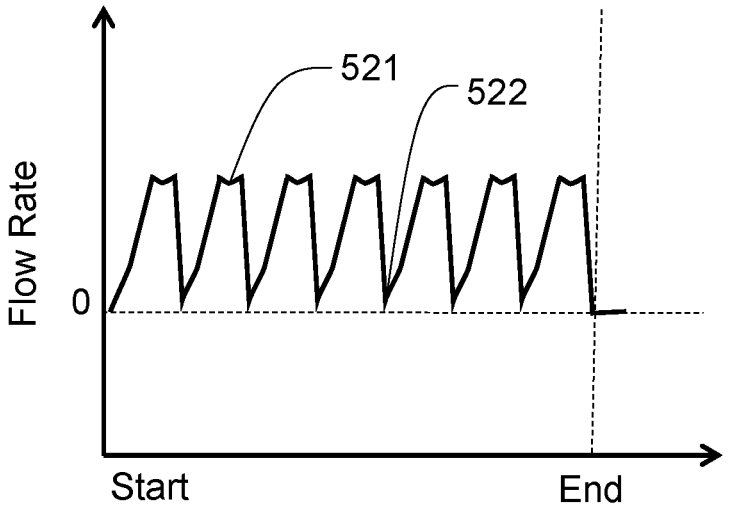

FIG. 34B is a schematic illustration of fluid flow rate with large pulsation.

Figure 35A:
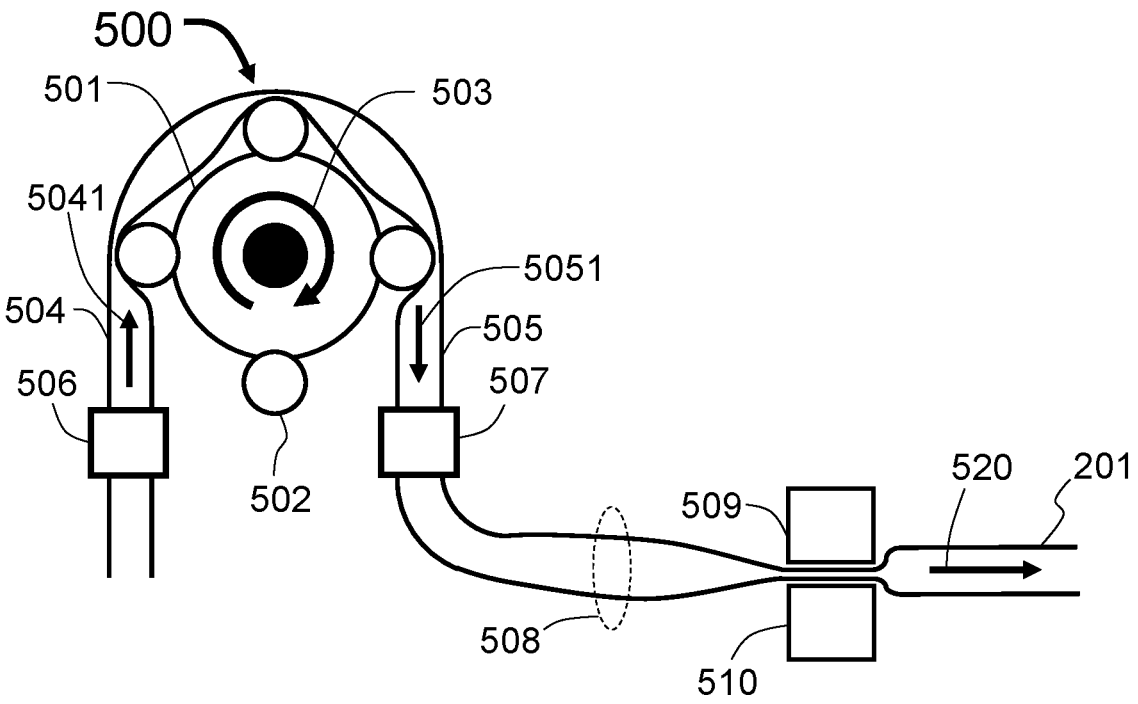

FIG. 35A illustrates FIG. 33A flow limiter being engaged upon the flexible channel.

Figure 35B:
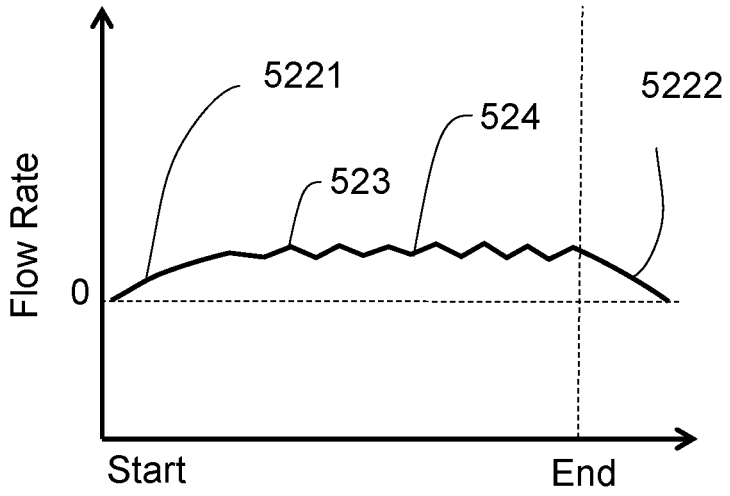

FIG. 35B is a schematic illustration of fluid flow rate with reduced pulsation.

Figure 36A:
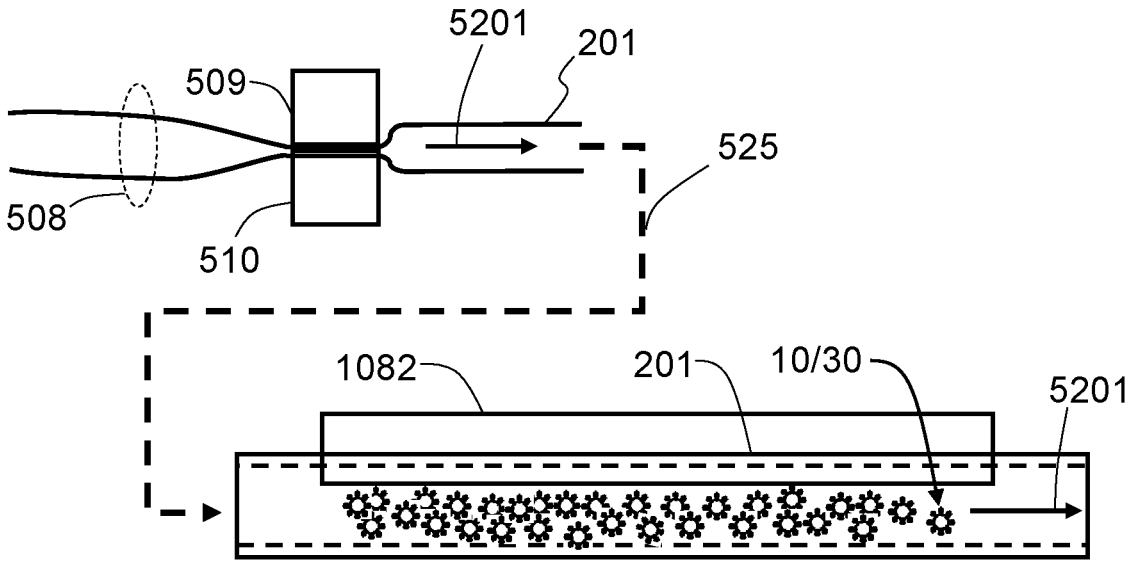

FIG. 36A illustrates FIG. 33A flow limiter causing pressure built up at the fluid incoming end of the flow limiter.

Figure 36B:
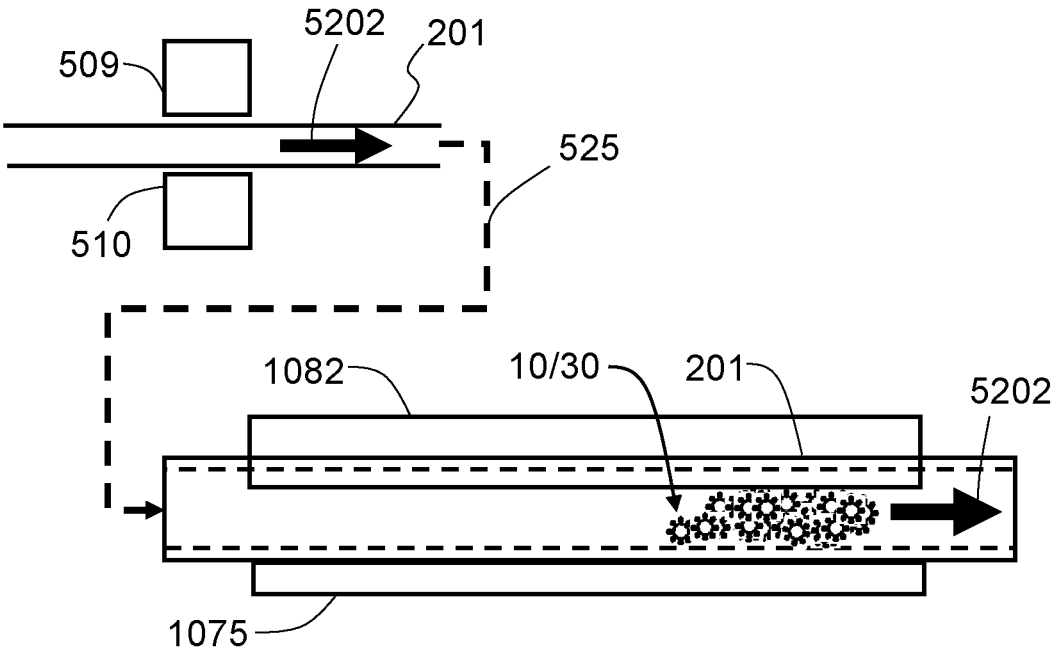

FIG. 36B illustrates FIG. 36A flow limiter being disengaged and causing high speed fluid pulse that pushes the dissociated cells of FIG. 36A out of the channel.

Figure 37:
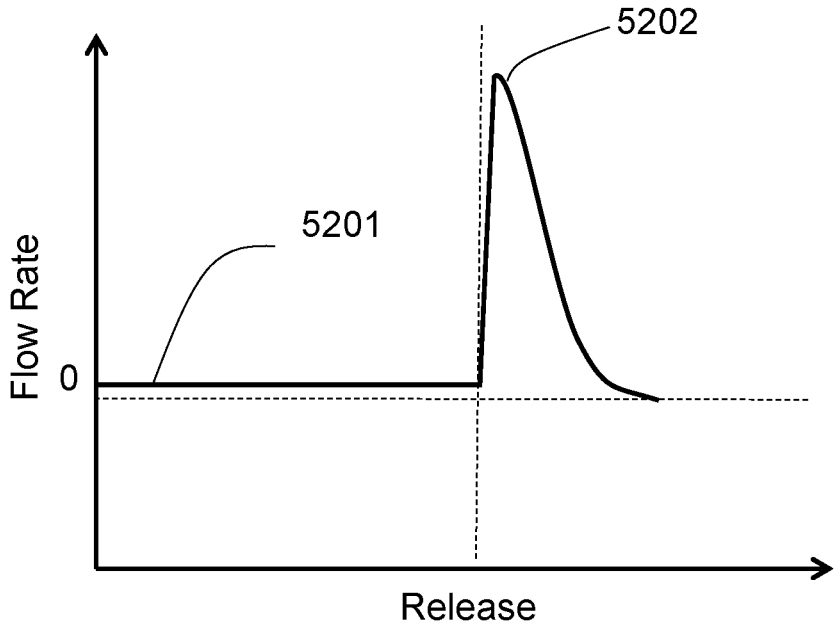

FIG. 37 is a schematic illustration of fluid flow rate pulse created by the process of FIG. 36A to FIG. 36B transition where flow limiter is disengaged.

Figure 38A:
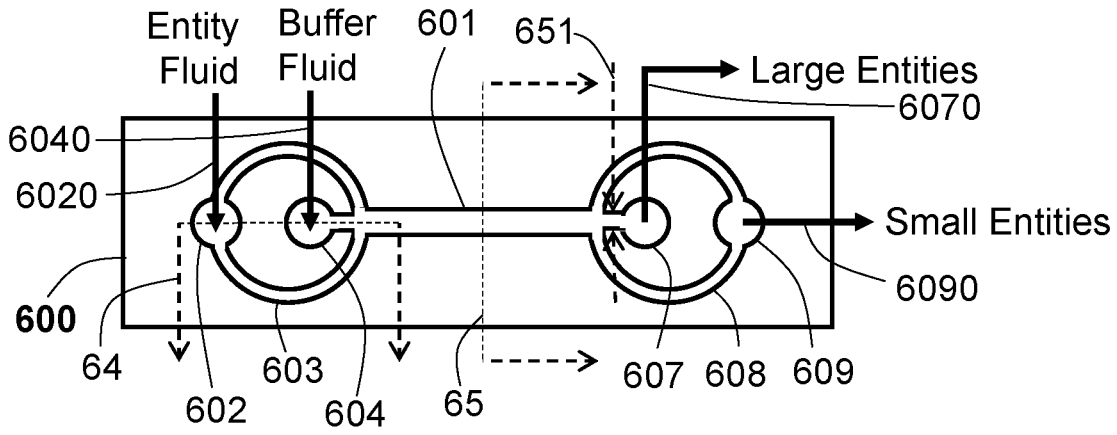

FIG. 38A is a top-down view of a micro-fluidic chip ("UFL").

Figure 38B:
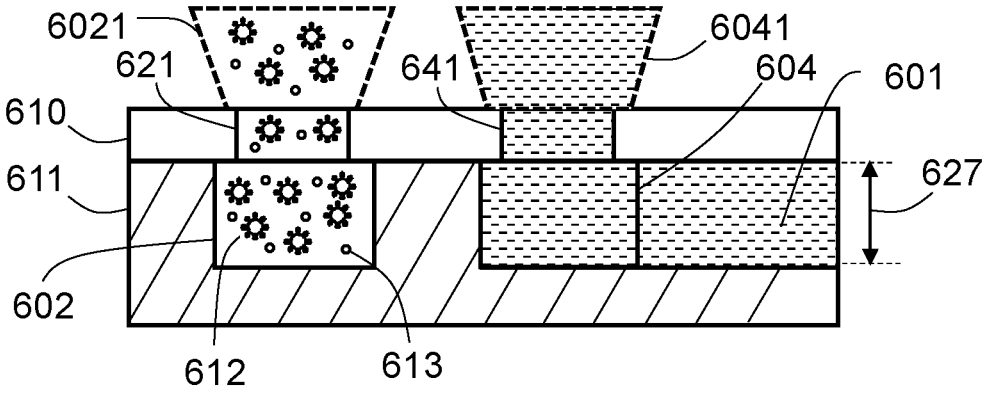

FIG. 38B is a cross-sectional view of a portion of the FIG. 38A UFL including entity fluid inlet, buffer fluid inlet, and part of the UFL.

Figures 38C, 38D:
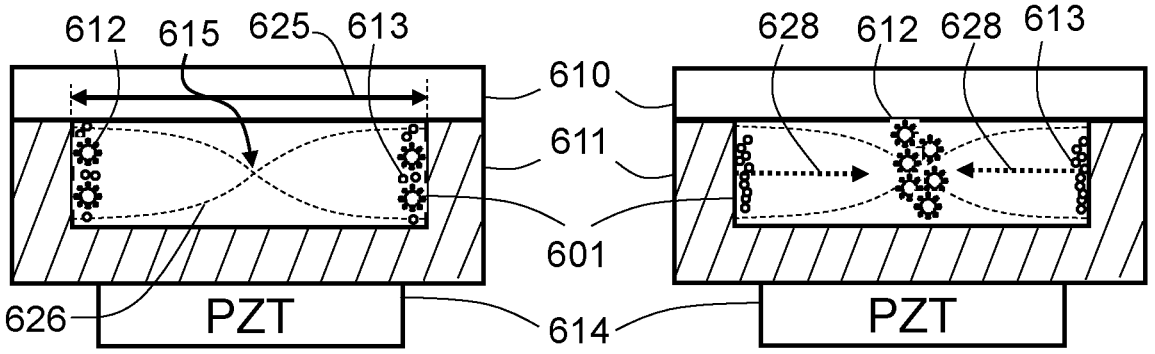

FIG. 38C is a schematic diagram illustrating a single fluidic pressure node created between two side walls of the UFL of FIG. 38A by ultrasound vibration generated by a PZT.

FIG. 38D is a schematic diagram illustrating the fluid acoustic wave of FIG. 38C causing larger size entities to move around center of the UFL.

Figure 39:
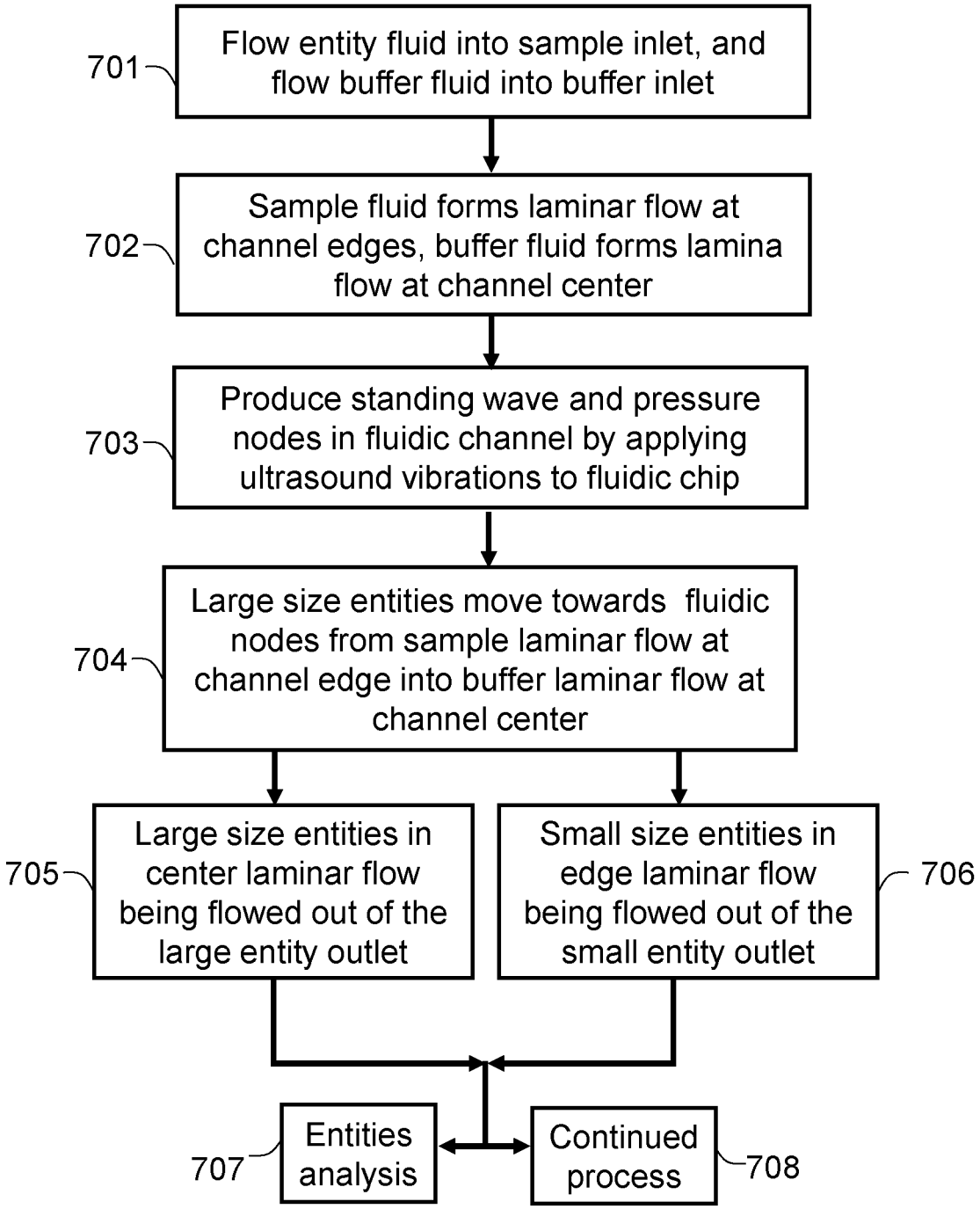

FIG. 39 is a schematic diagram illustrating methods to use UFL to separate biological entities of different sizes.

Figure 40A:
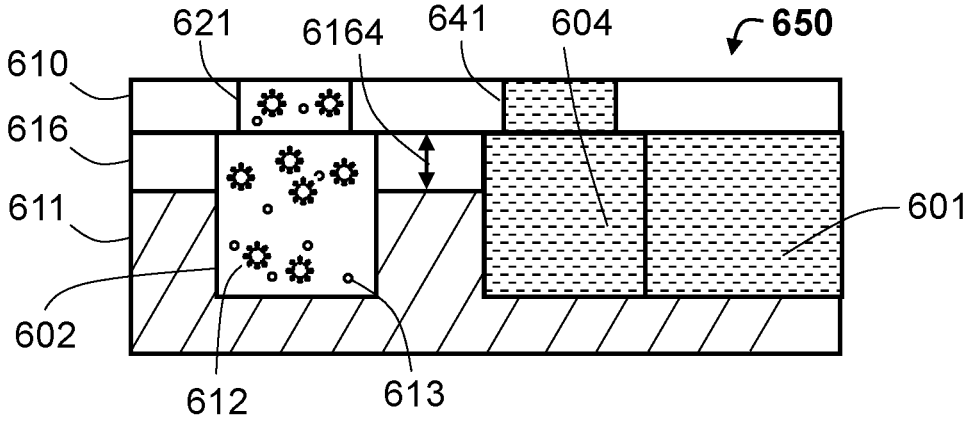

FIG. 40A is a cross-sectional view of a portion of first embodiment UFL which includes a uniformly formed soft magnetic layer.

Figure 40B:
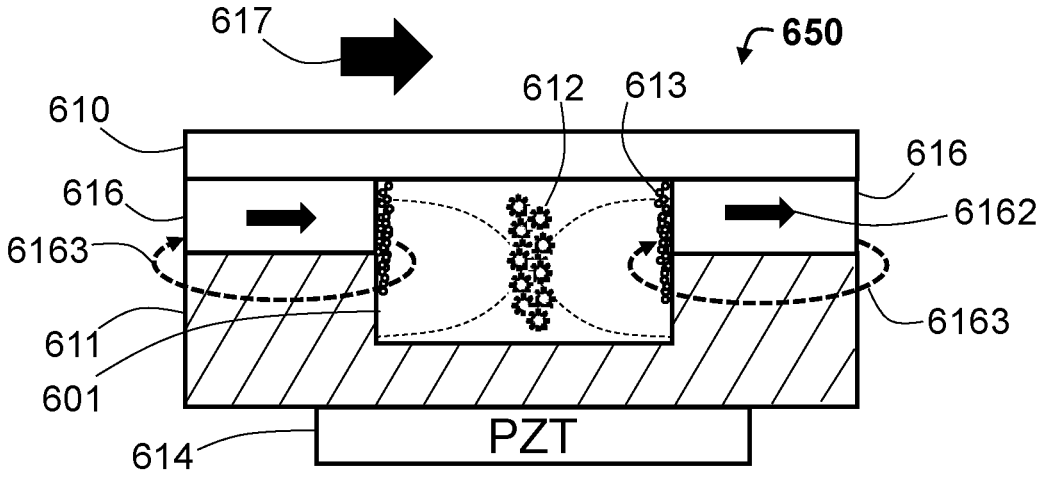

FIG. 40B is a schematic diagram illustrating the fluid acoustic wave and entities separation in UFL of FIG. 40A in presence of a magnetic field.

Figure 40C:
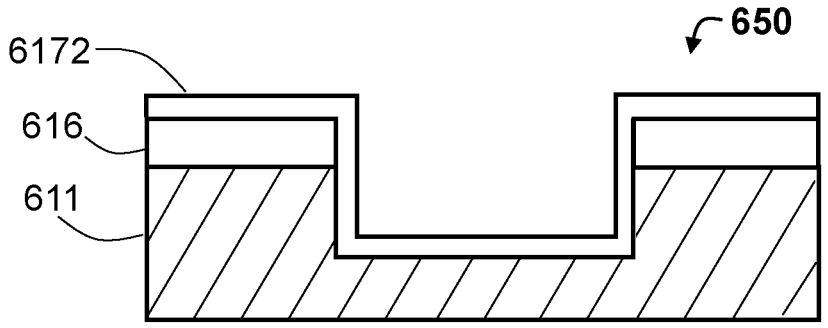

FIG. 40C is a schematic diagram illustrating a protection layer conformably deposited around the UFL surface before attached cap.

Figure 41A:
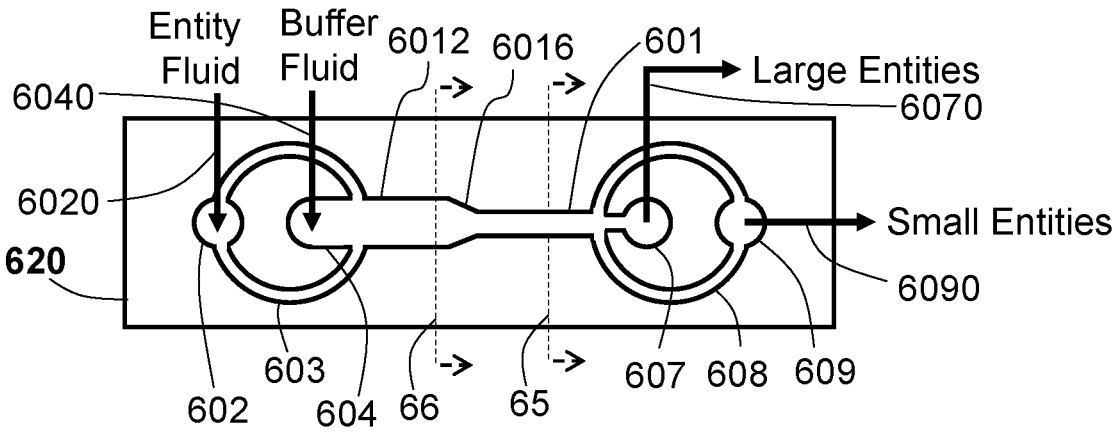

FIG. 41A is a top-down view of a second embodiment UFL including a wide channel and a narrow channel in sequential arrangement.

Figure 41B:
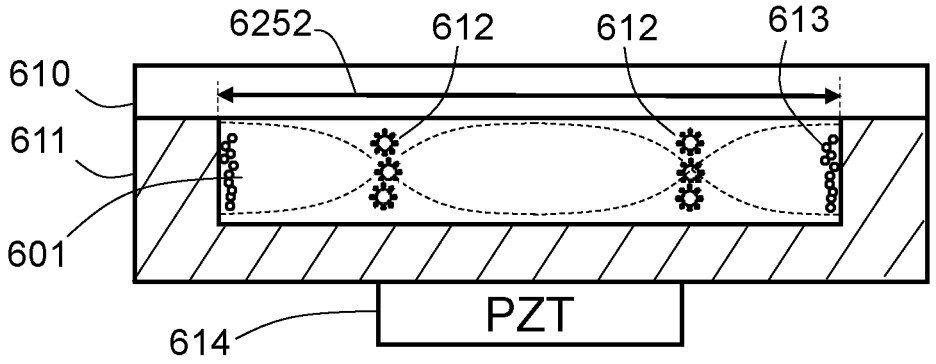

FIG. 41B is a cross-sectional view of second embodiment UFL across wide channel.

Figure 41C:
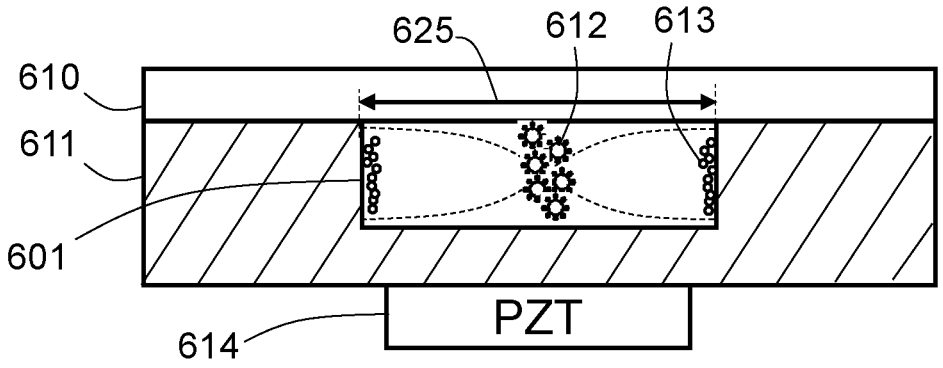

FIG. 41C is a cross-sectional view of second embodiment UFL across narrow channel.

Figure 42A:
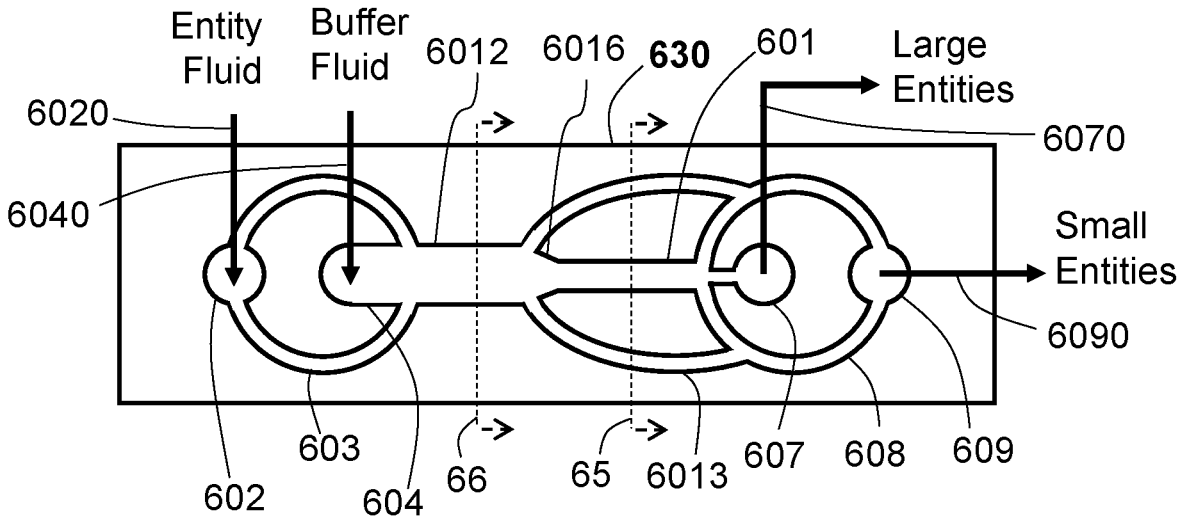

FIG. 42A is a top-down view of a third embodiment UFL including a wide channel and a narrow channel, and side channels from wide channel to narrow channel transition section.

Figure 42B:
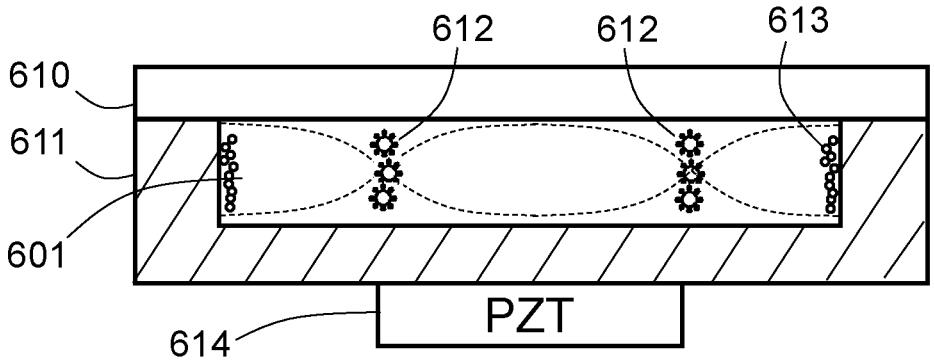

FIG. 42B is a cross-sectional view of third embodiment UFL across wide channel.

Figure 42C:
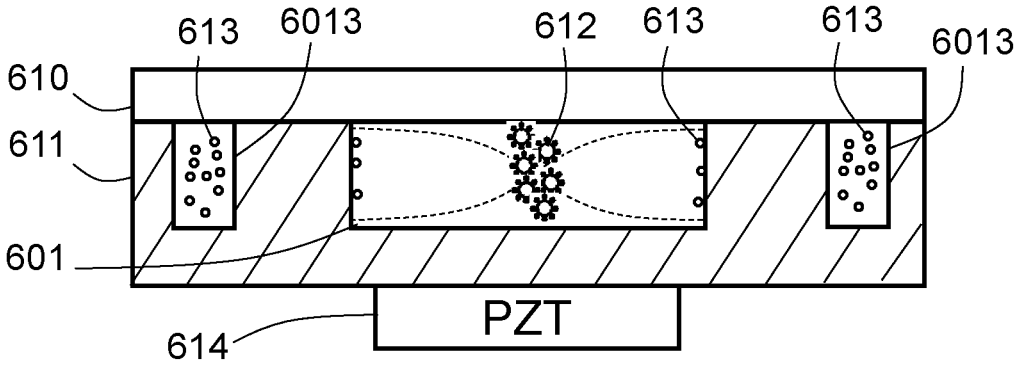

FIG. 42C is a cross-sectional view of third embodiment UFL across narrow channel and side channels.

Figure 43:
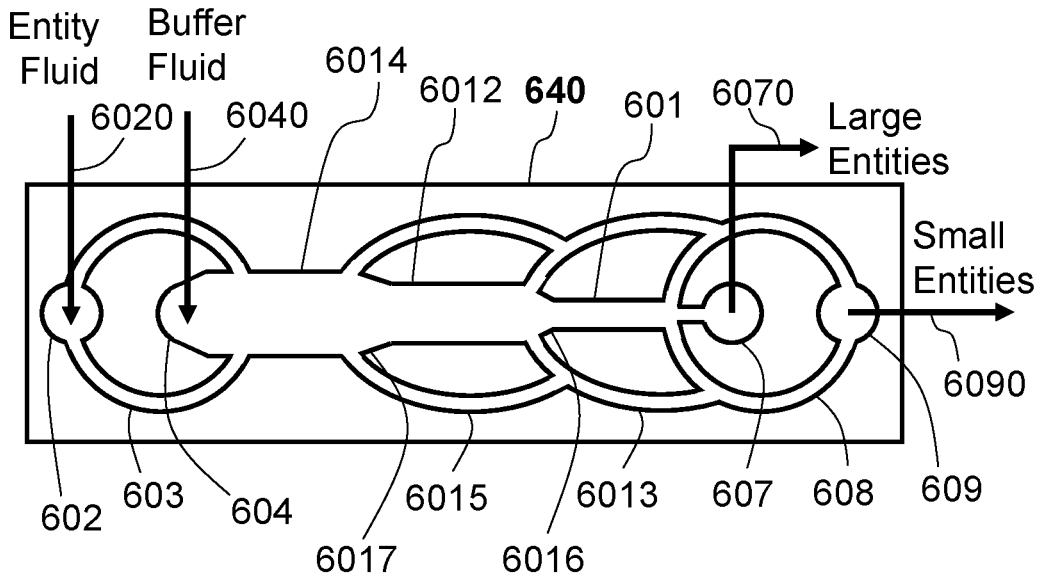

FIG. 43 is a top-down view of a fourth embodiment UFL having three-stage channel width reduction along channel flow direction, and side channels from transition sections.

Figure 44A:
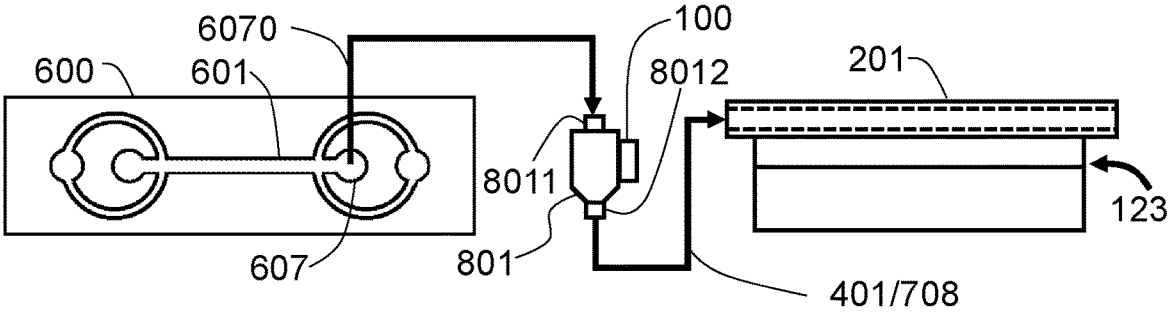

FIG. 44A illustrates first type sample processing method including UFL and MAG, with a first type flow connector connecting the UFL large entity outlet and MAG inlet.

Figure 44B:
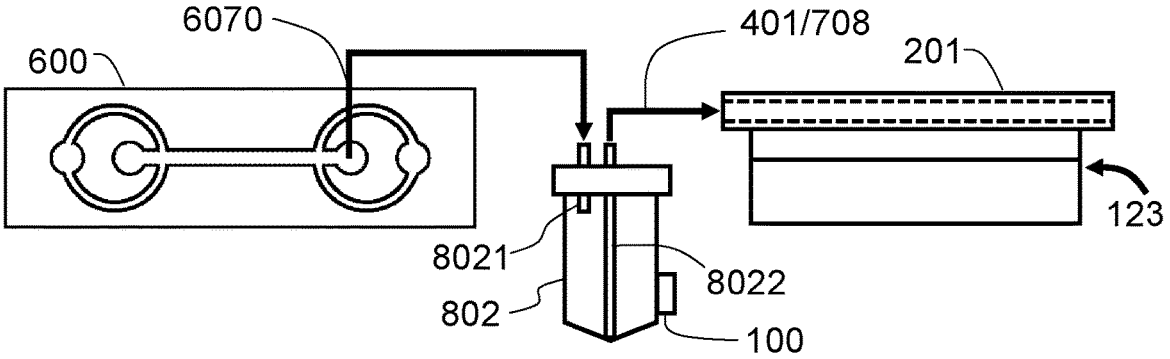

FIG. 44B illustrates first type sample processing method with a second type flow connector connecting the UFL large entity outlet and MAG inlet.

Figure 44C:
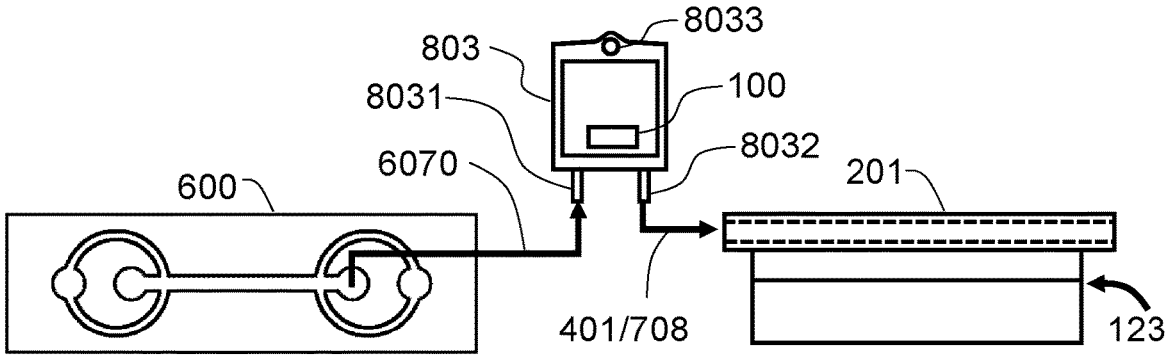

FIG. 44C illustrates first type sample processing method with a third type flow connector connecting the UFL large entity outlet and MAG inlet.

Figure 45A:
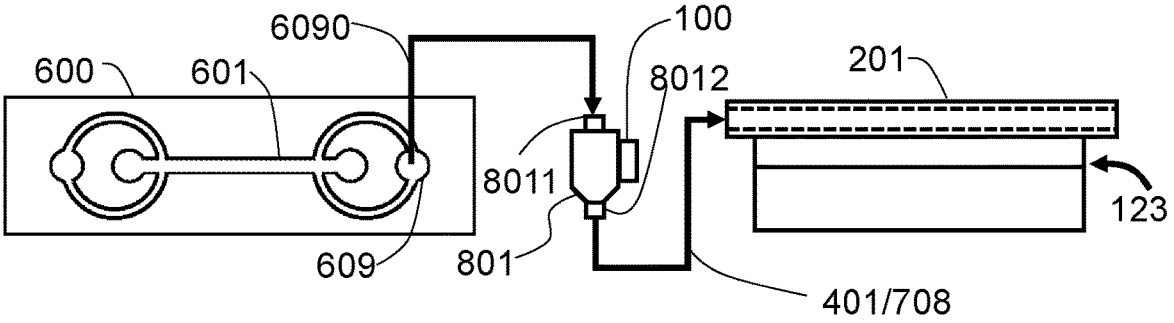

FIG. 45A illustrates second type sample processing method including UFL and MAG, with a first type flow connector connecting the UFL small entity outlet and MAG inlet.

Figure 45B:
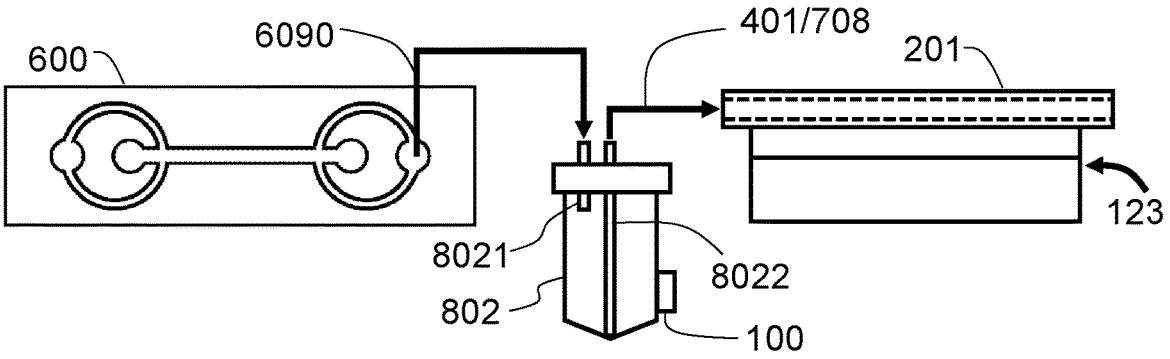

FIG. 45B illustrates second type sample processing method with a second type flow connector connecting the UFL small entity outlet and MAG inlet.

Figure 45C:
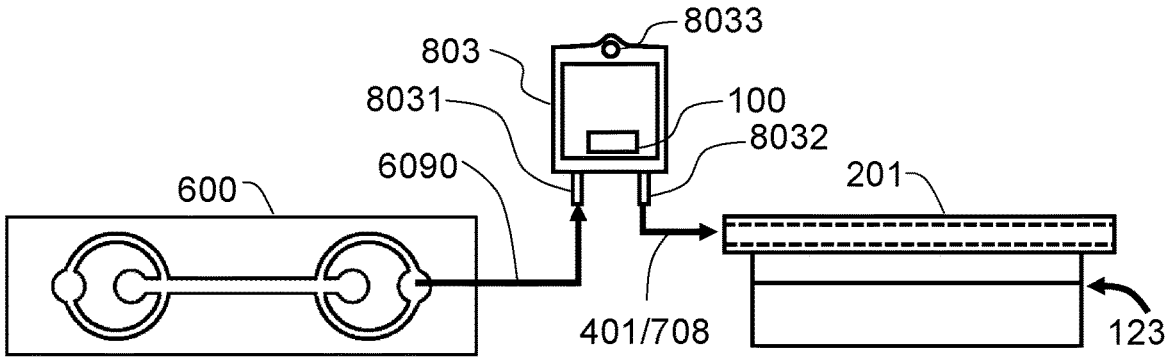

FIG. 45C illustrates second type sample processing method with a third type flow connector connecting the UFL small entity outlet and MAG inlet.

Figure 46A:
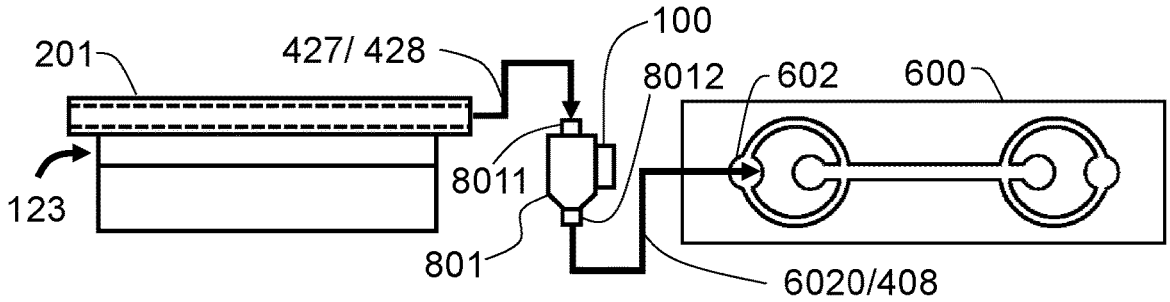

FIG. 46A illustrates third type sample processing method including MAG and UFL, with a first type flow connector connecting the MAG outlet and UFL entity fluid inlet.

Figure 46B:
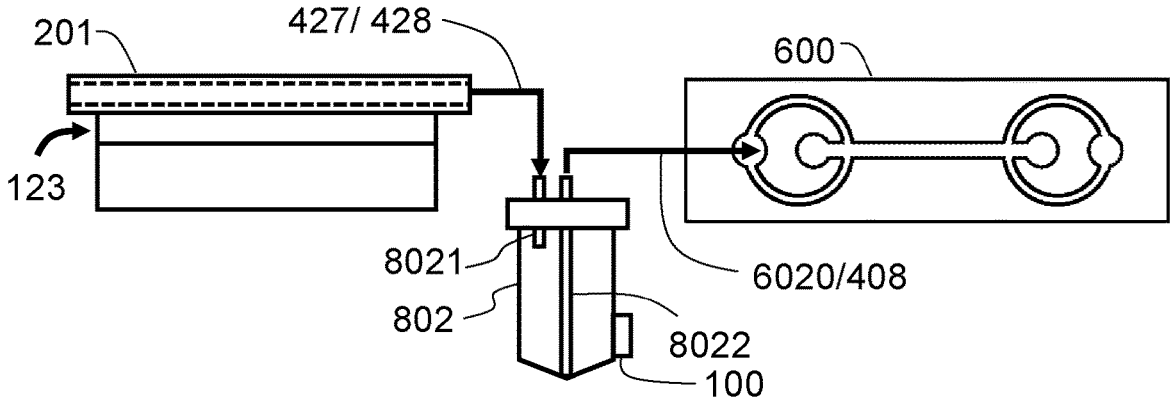

FIG. 46B illustrates third type sample processing method with a second type flow connector connecting the MAG outlet and UFL entity fluid inlet.

Figure 46C:
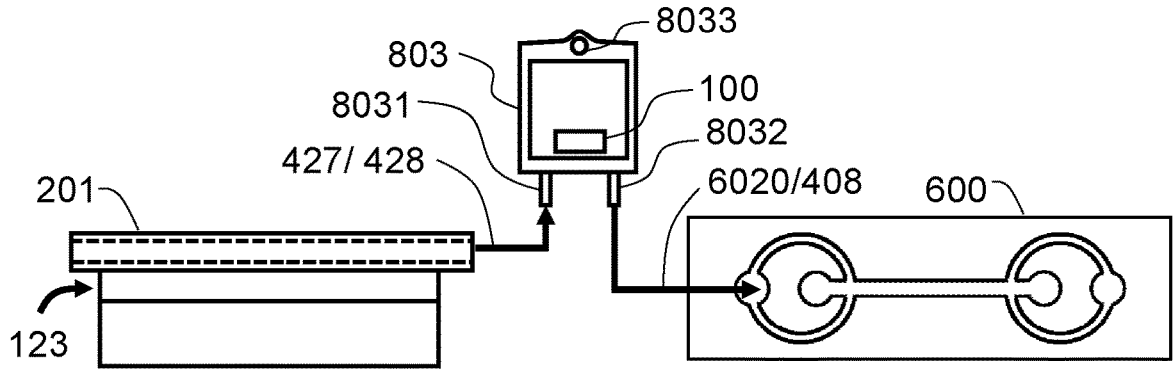

FIG. 46C illustrates third type sample processing method with a third type flow connector connecting the MAG outlet and UFL entity fluid inlet.

Figure 47:
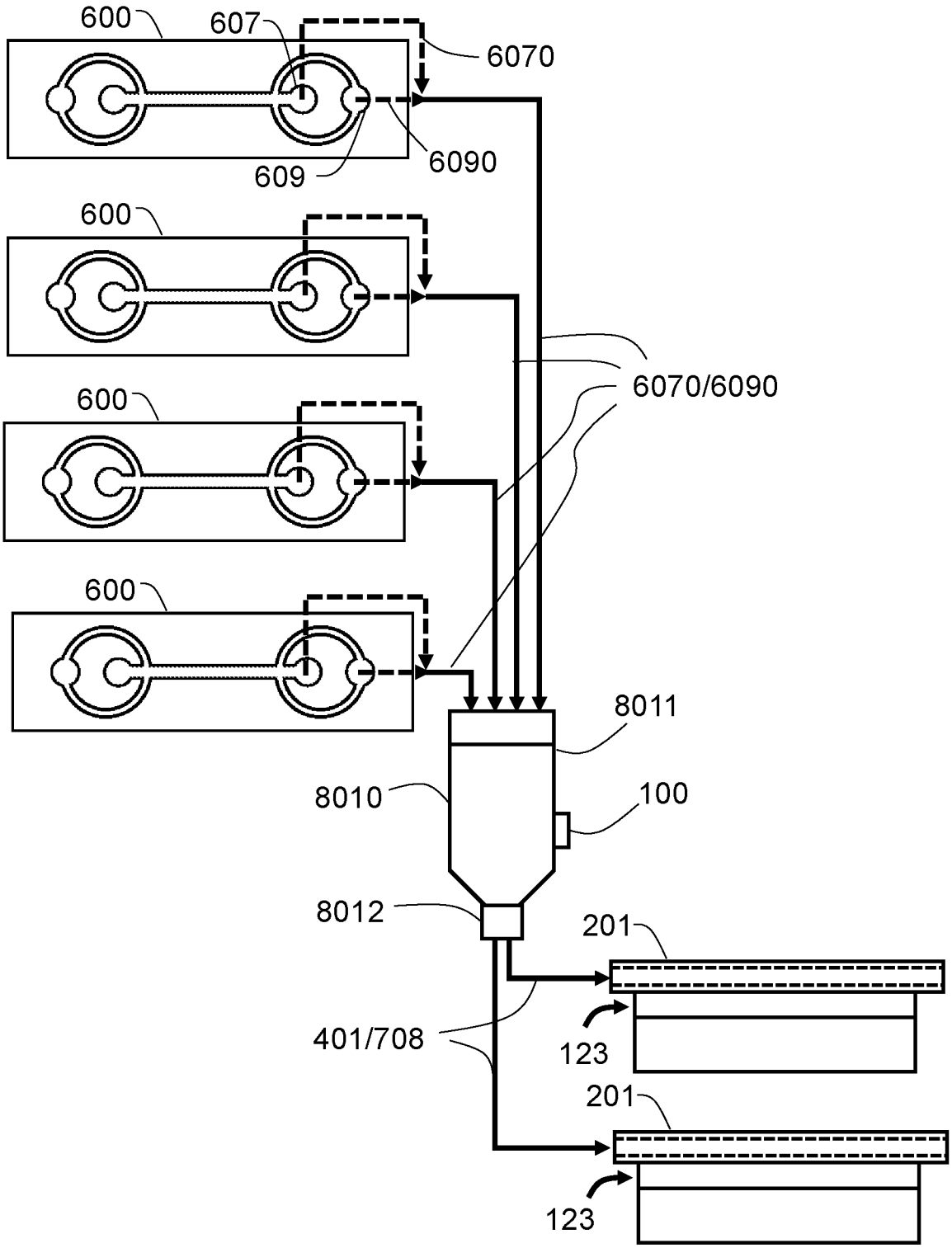

FIG. 47 illustrates fourth type sample processing method including multiple UFLs, a fourth type flow connector, and multiple MAGs.

Figure 48:
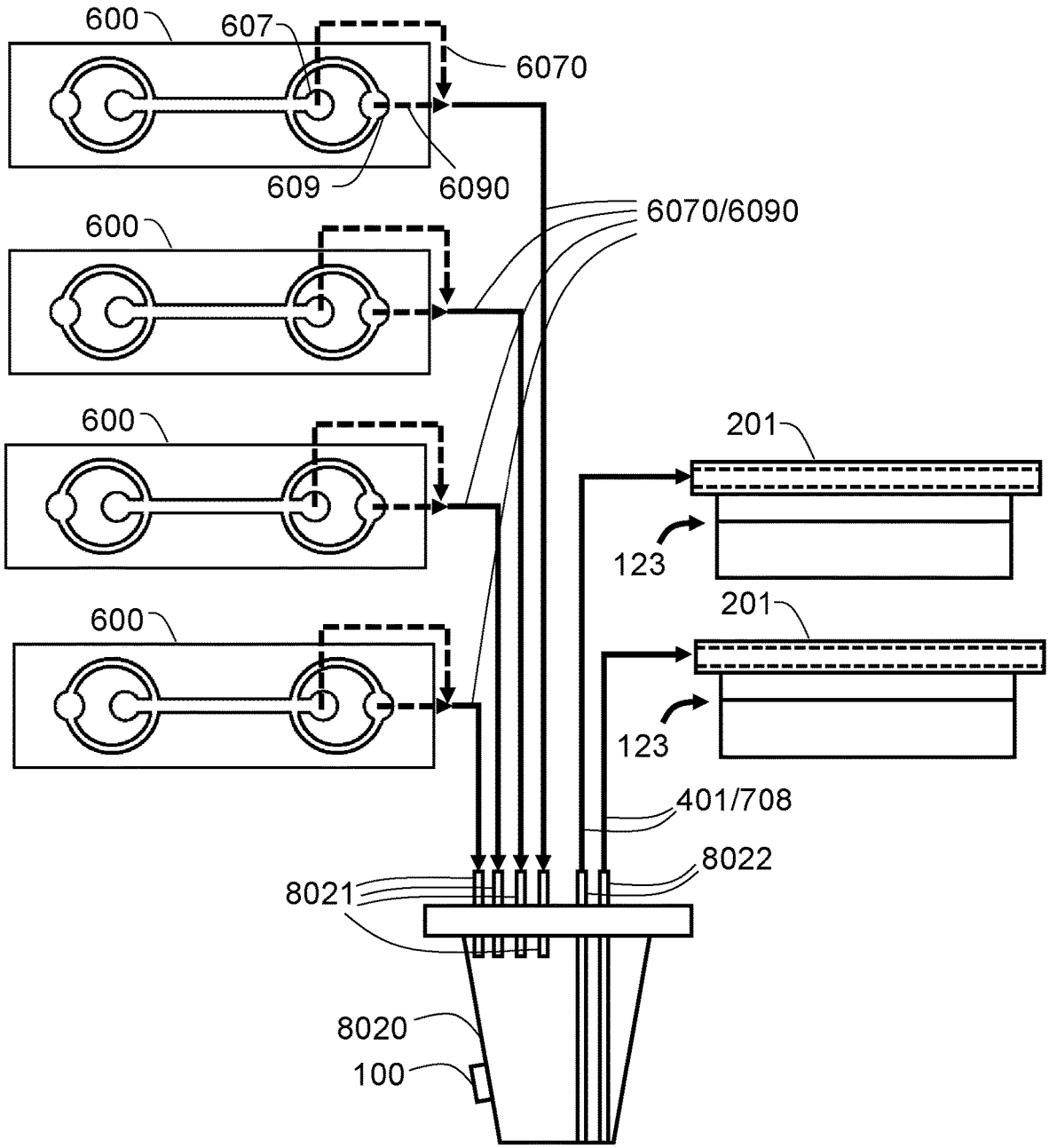

FIG. 48 illustrates fifth type sample processing method including multiple UFLs, a fifth type flow connector, and multiple MAGs.

Figure 49:
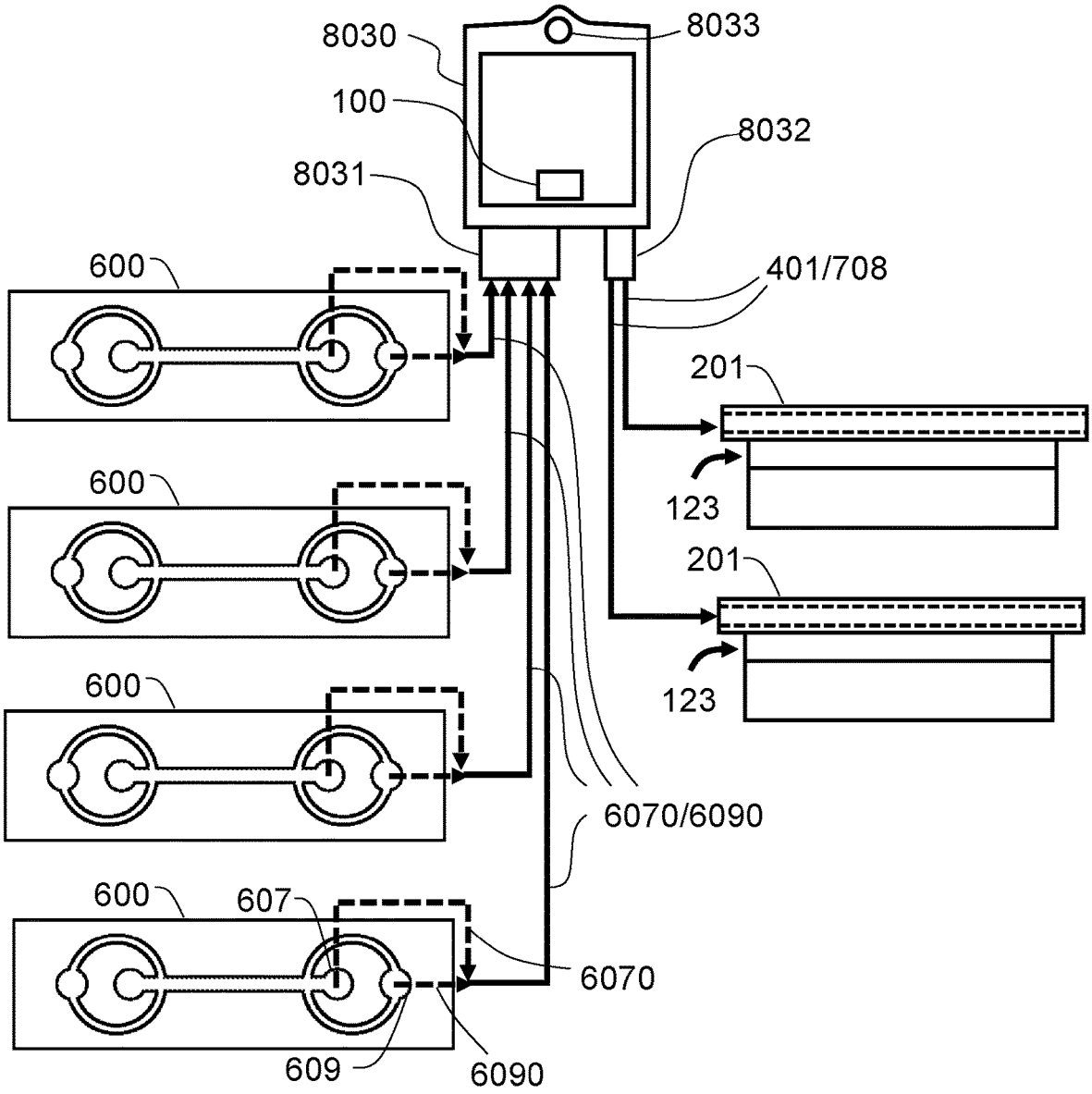

FIG. 49 illustrates fifth type sample processing method including multiple UFLs, a sixth type flow connector, and multiple MAGs.

Figure 50:
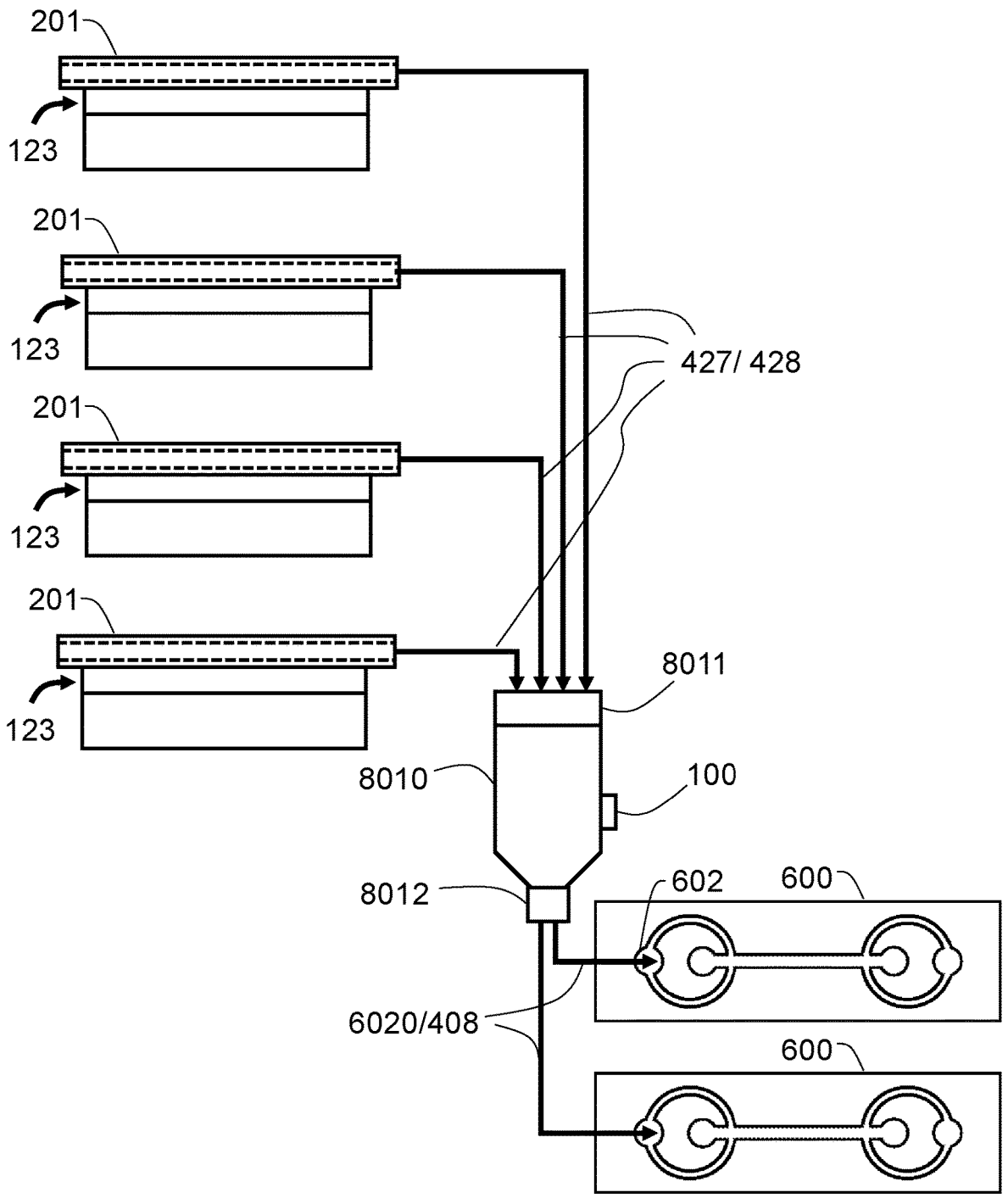

FIG. 50 illustrates seventh type sample processing method including multiple MAGs, a fourth type flow connector, and multiple UFLs.

Figure 51:
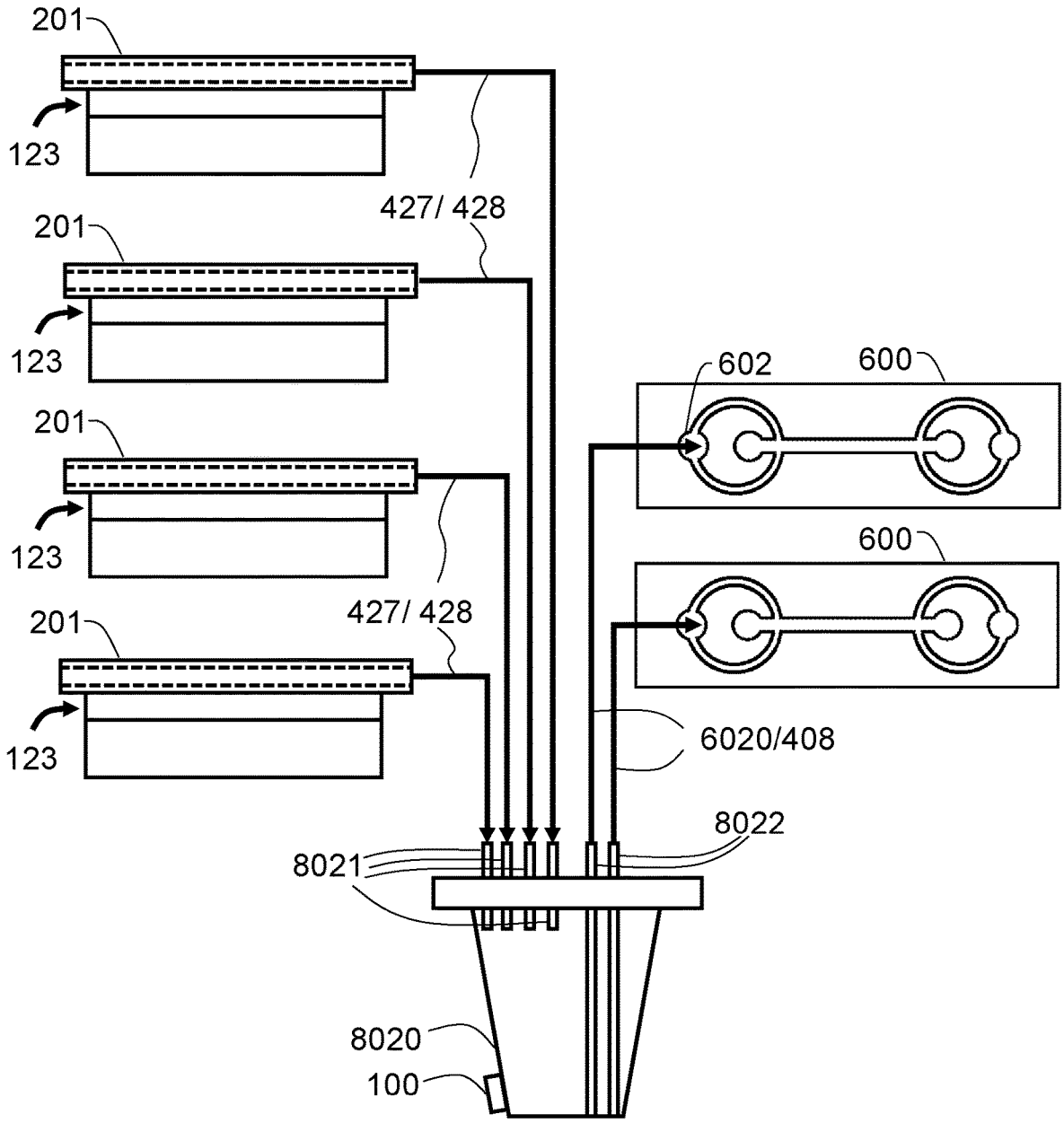

FIG. 51 illustrates eighth type sample processing method including multiple MAGs, a fifth type flow connector, and multiple UFLs.

Figure 52:
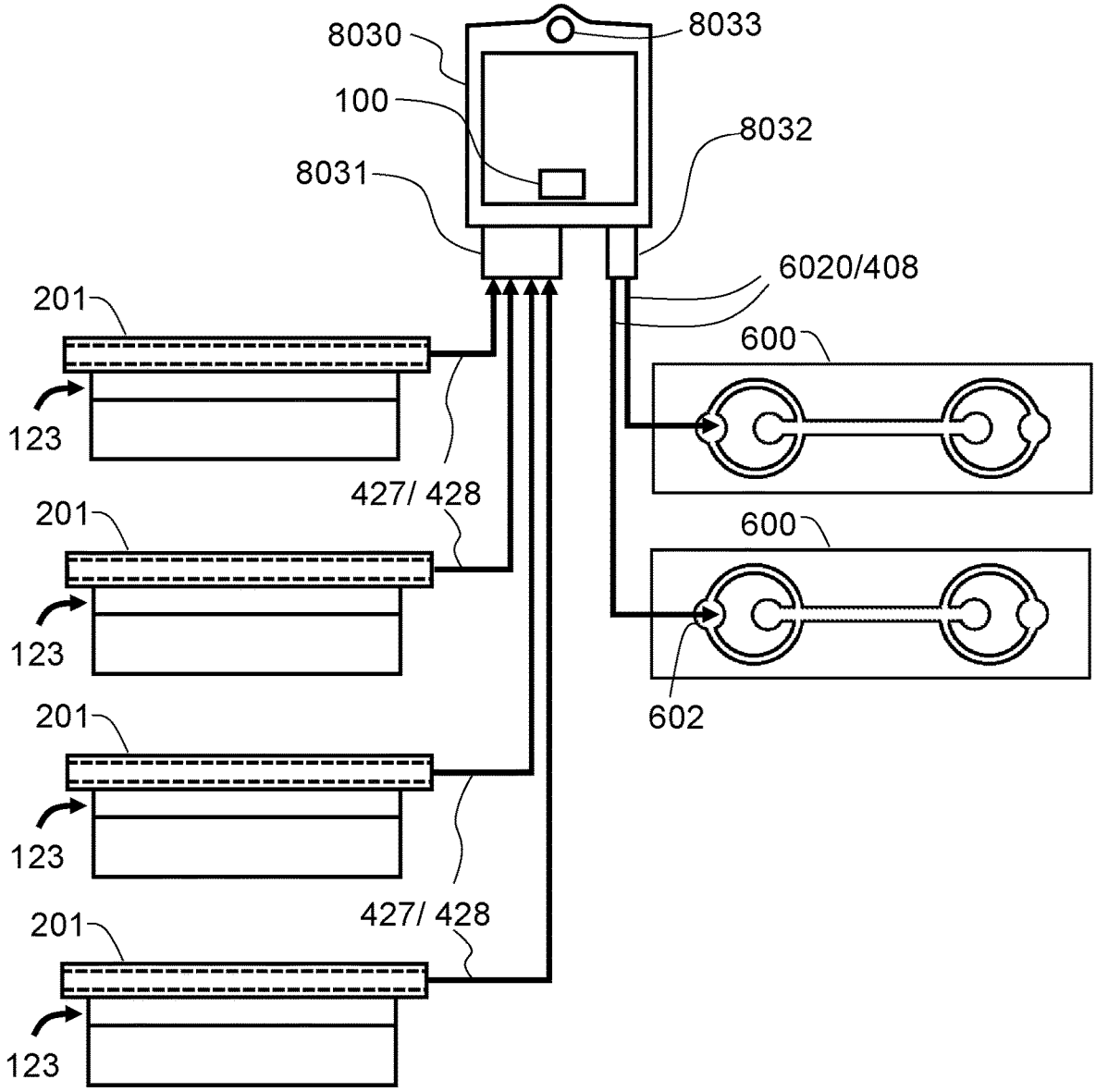

FIG. 52 illustrates ninth type sample processing method including multiple MAGs, a sixth type flow connector, and multiple UFLs.

Figure 53:
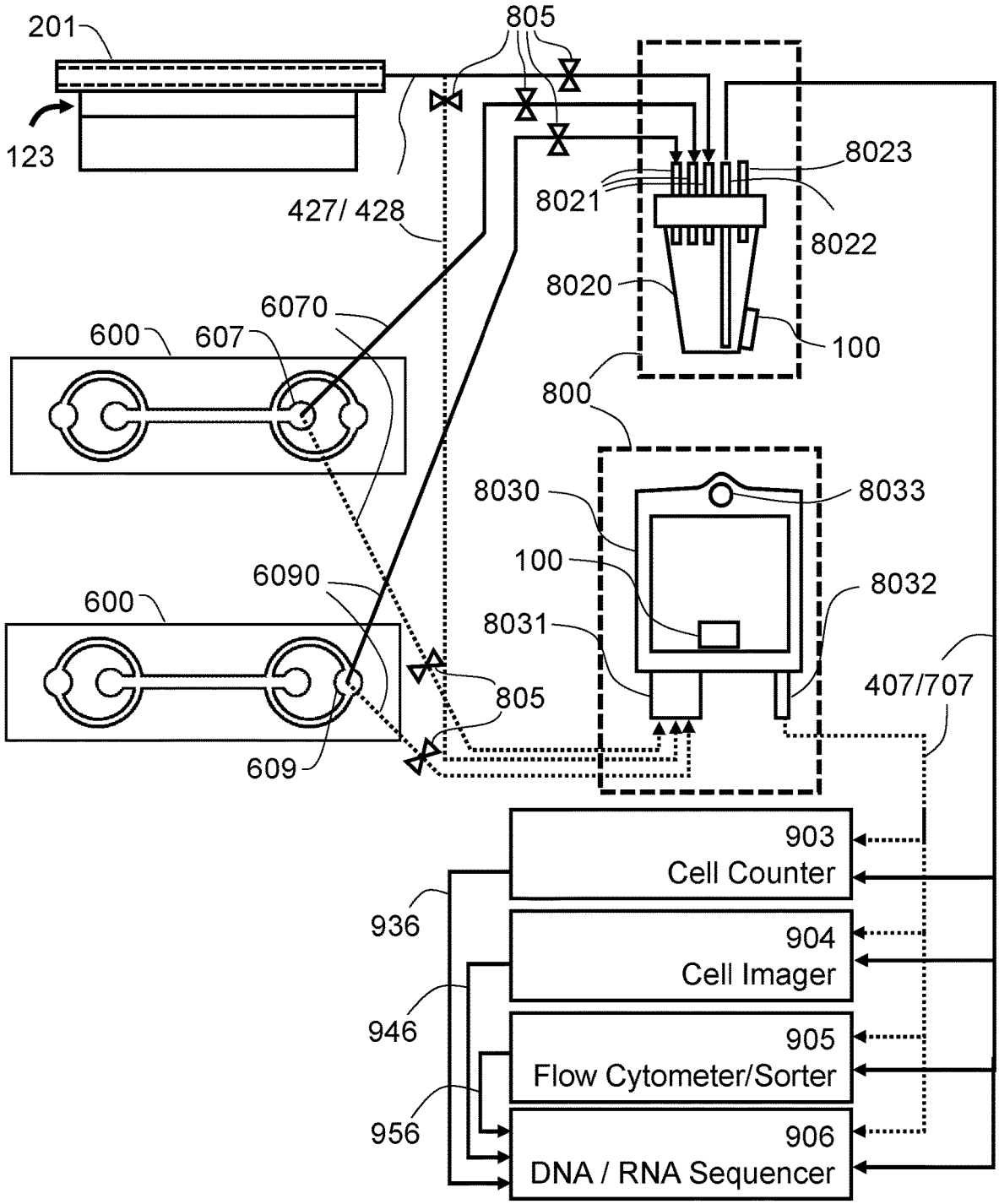

FIG. 53 illustrates tenth type sample processing method including one or more of UFLs and MAGs, a fifth or a sixth type flow connector, and different type of cell processing devices.

Figure 54A:
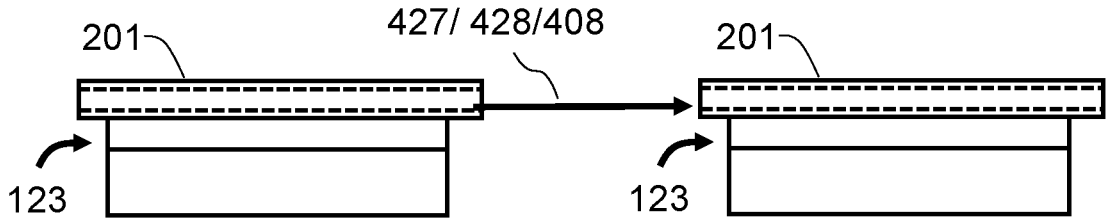

FIG. 54A illustrates eleventh type sample processing method including a multi-stage MAG process.

Figure 54B:
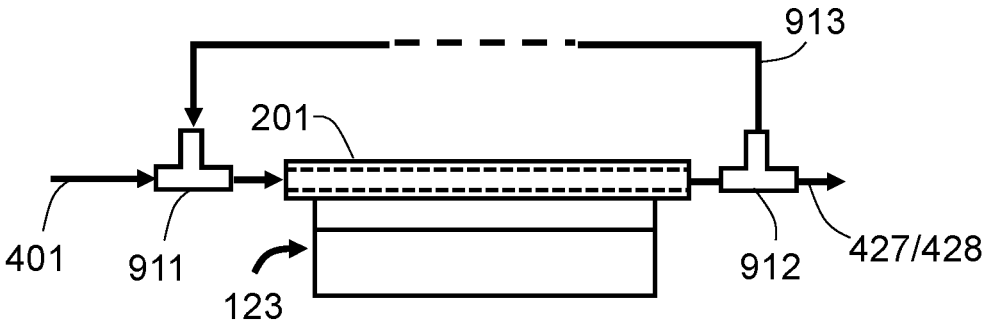

FIG. 54B illustrates twelfth type sample processing method including a multi-cycle MAG process.

Figure 54C:
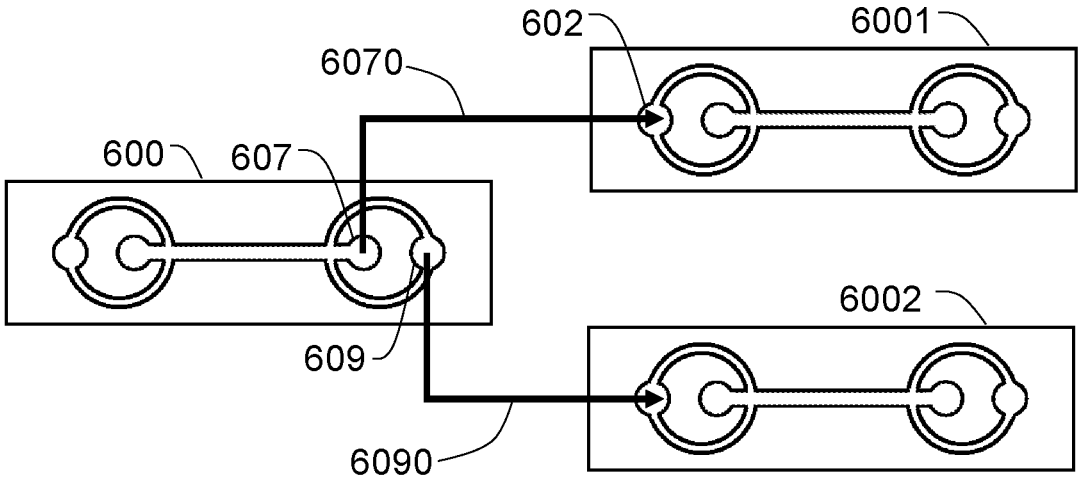

FIG. 54C illustrates thirteenth type sample processing method including a multi-stage UFL process.

Figure 55A:
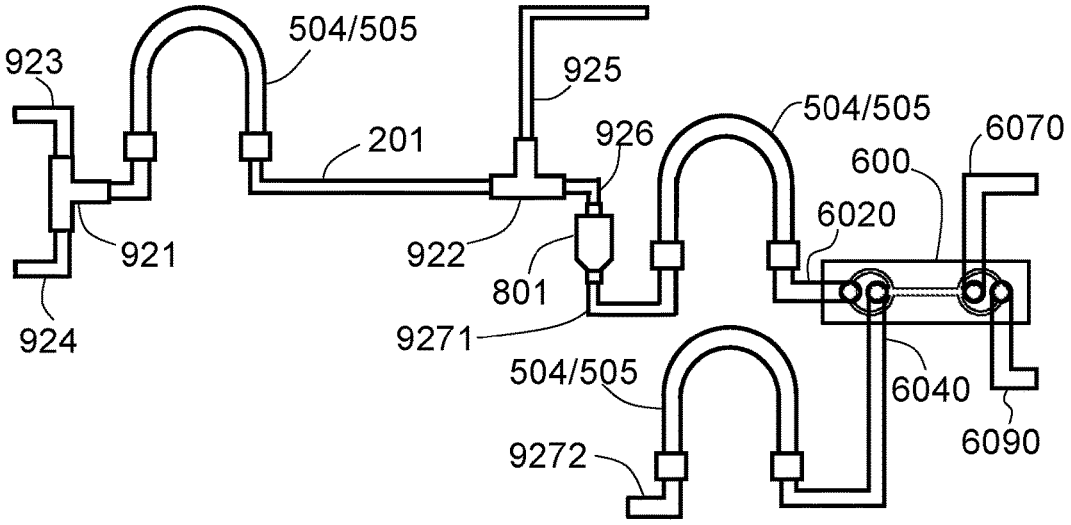

FIG. 55A illustrates first example of closed and disposable fluidic lines for third type sample processing method.

Figure 55B:
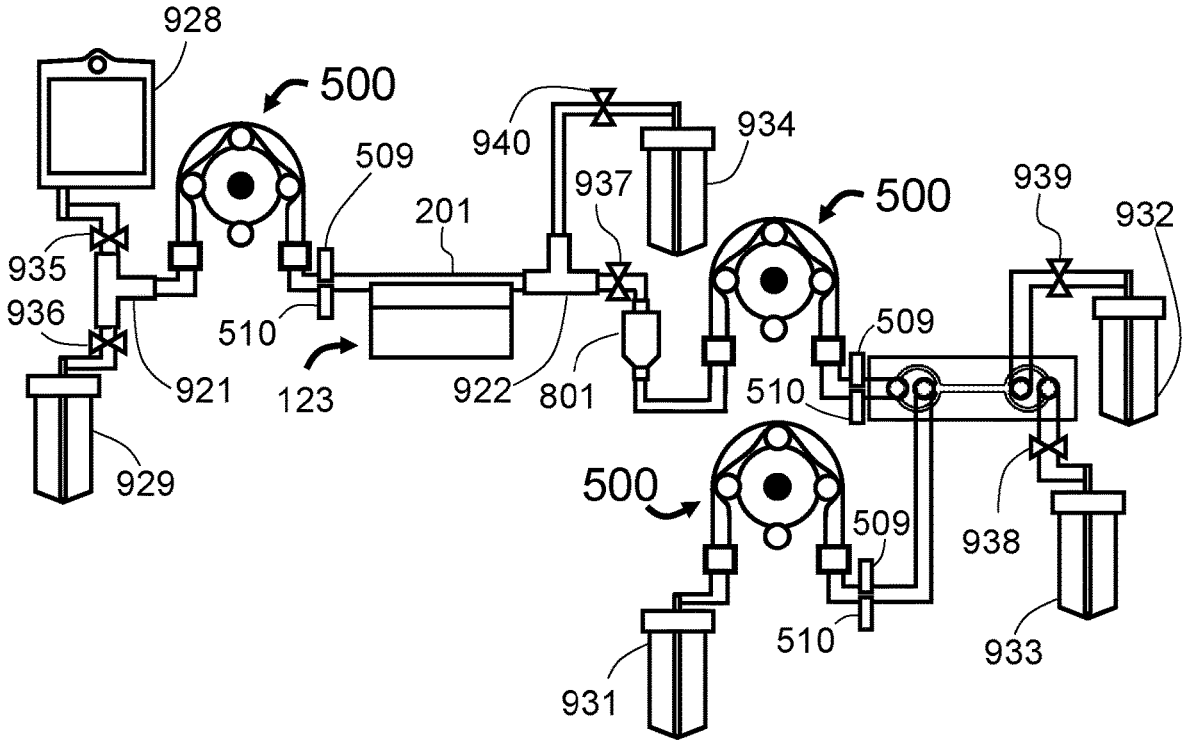

FIG. 55B illustrates fluidic lines of FIG. 55A being connected to, or attached with, various fluidic devices to realize third type sample processing method.

Figure 56A:
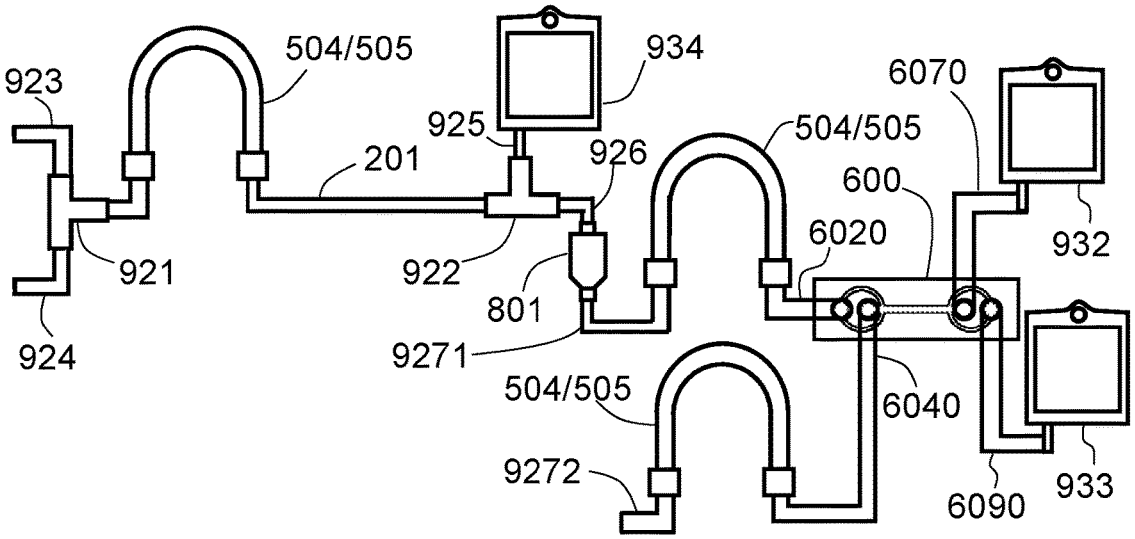

FIG. 56A illustrates second example of closed and disposable fluidic lines for third type sample processing method.

Figure 56B:
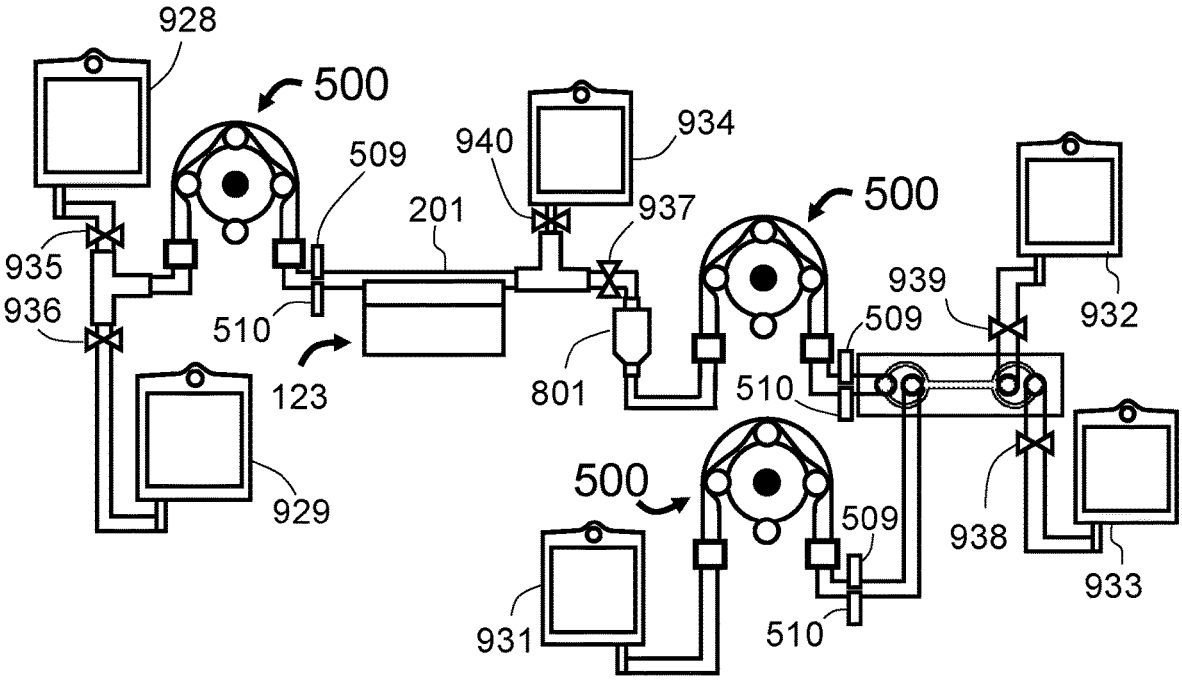

FIG. 56B illustrates fluidic lines of FIG. 56A being connected to, or attached with, various fluidic devices to realize third type sample processing method.

Figure 57A:
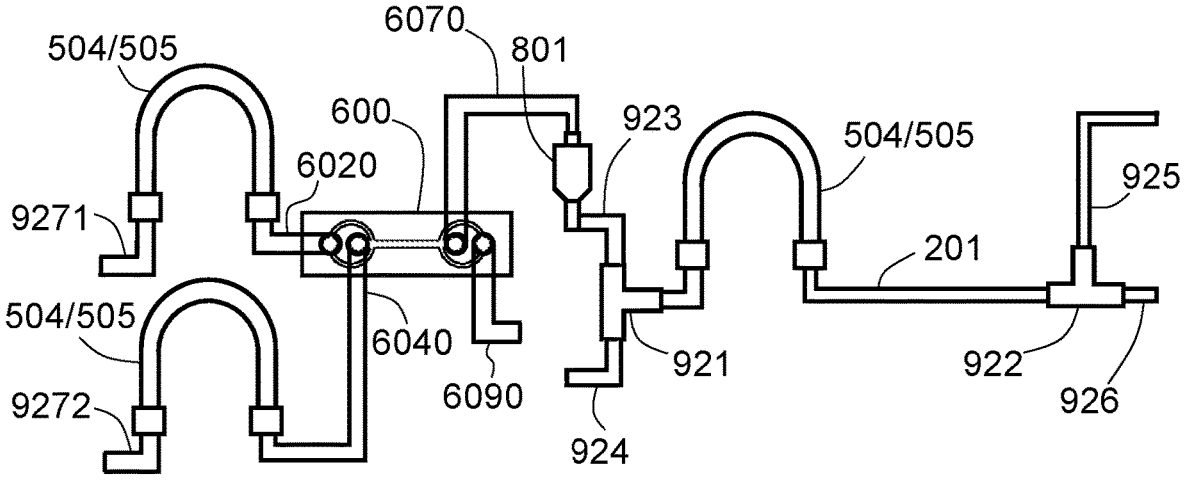

FIG. 57A illustrates example of closed and disposable fluidic lines for first type sample processing method.

Figure 57B:
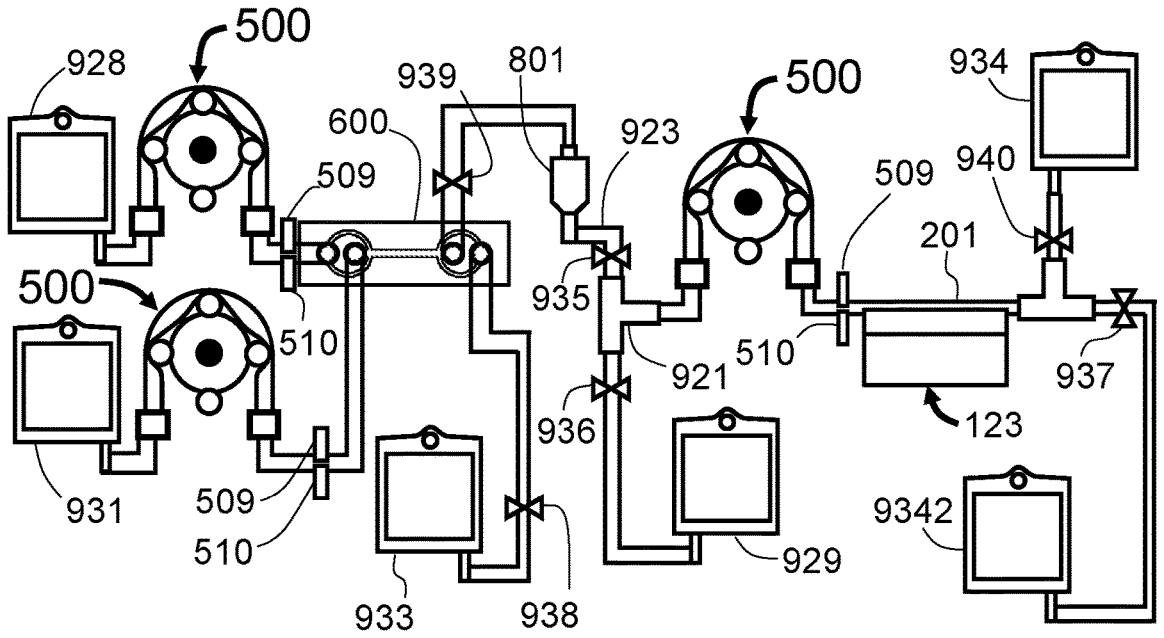

FIG. 57B illustrates fluidic lines of FIG. 57A being connected to, or attached with, various fluidic devices to realize first type sample processing method.

Figure 58A:
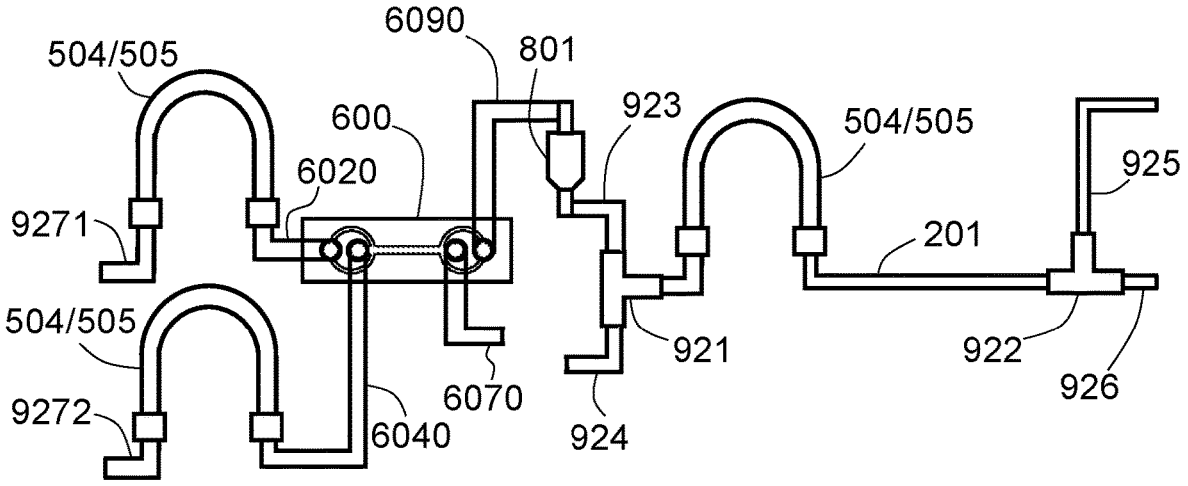

FIG. 58A illustrates example of closed and disposable fluidic lines for second type sample processing method.

Figure 58B:
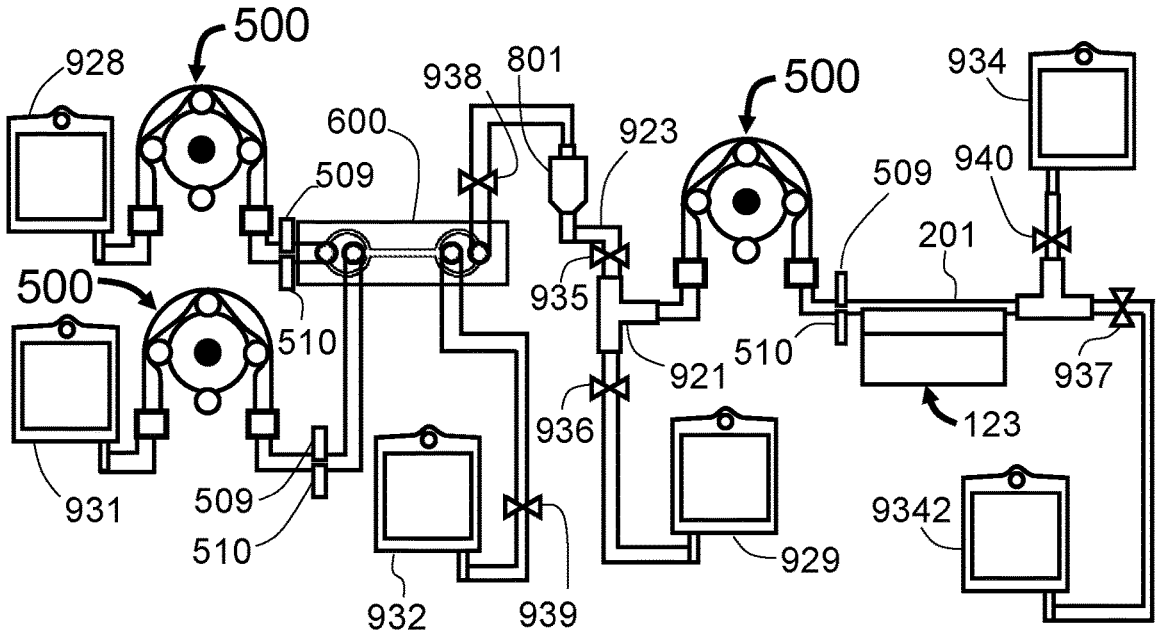

FIG. 58B illustrates fluidic lines of FIG. 58A being connected to, or attached with, various fluidic devices to realize second type sample processing method.

Figure 59A:
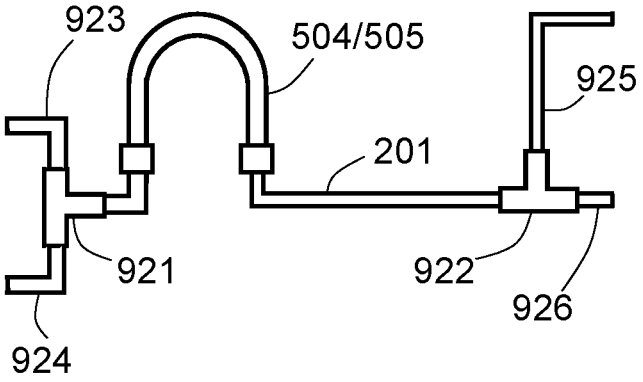

FIG. 59A illustrates example of closed and disposable fluidic lines for sample processing through a single MAG.

Figure 59B:
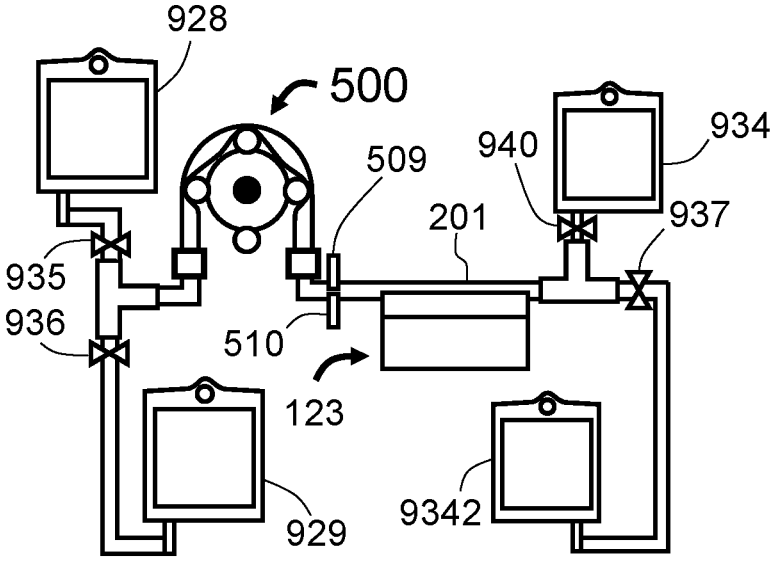

FIG. 59B illustrates fluidic lines of FIG. 59A being connected to, or attached with, various fluidic devices to realize sample processing through a single MAG.

Figure 60A:
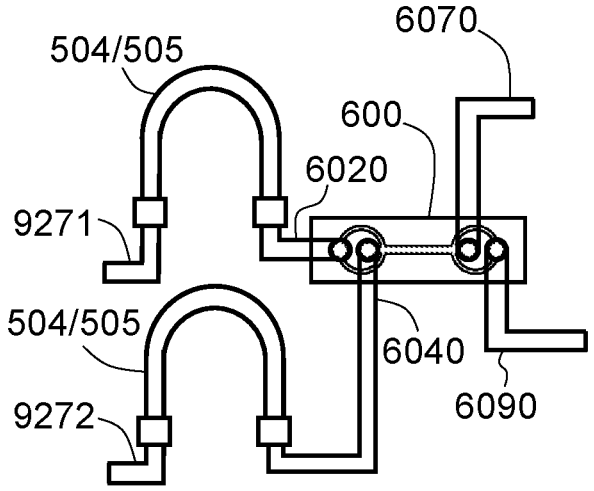

FIG. 60A illustrates example of closed and disposable fluidic lines for sample processing through a single UFL.

Figure 60B:
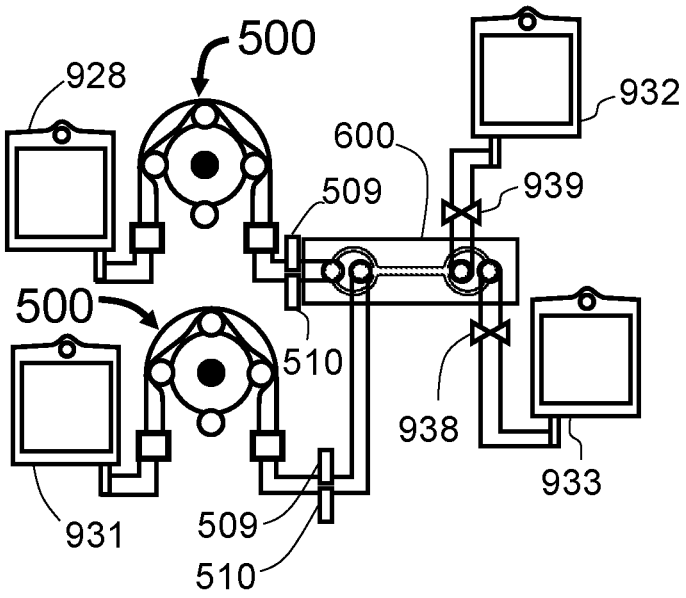

FIG. 60B illustrates fluidic lines of FIG. 60A being connected to, or attached with, various fluidic devices to realize sample processing through a single UFL.

Figure 61A:
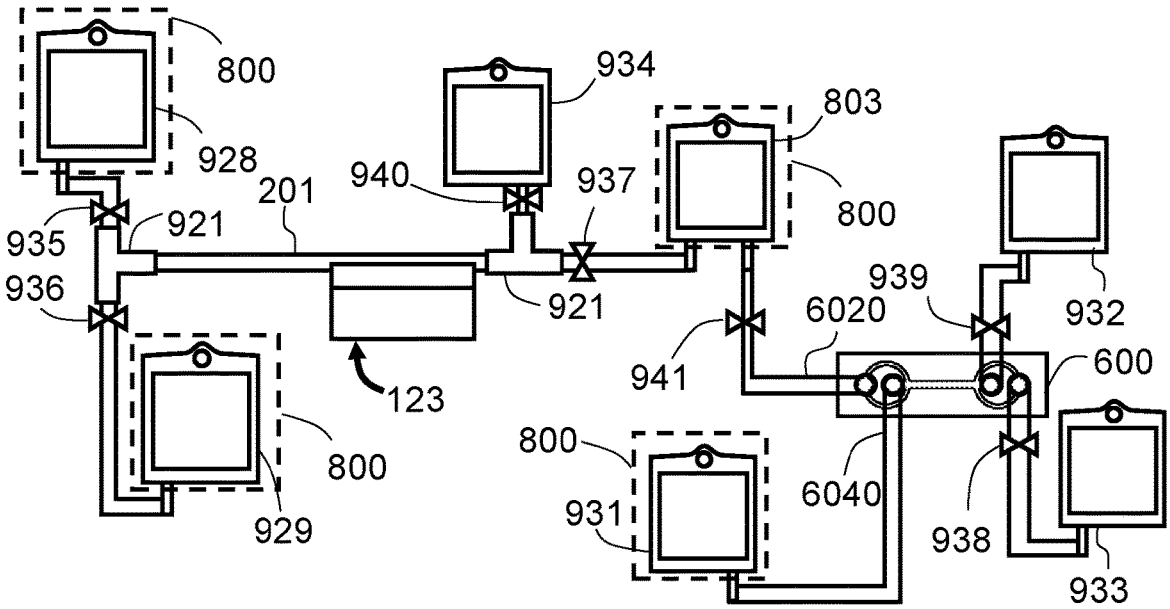

FIG. 61A illustrates replacing peristaltic pumps of FIG. 56B with using pressurized chambers on input sample bags to drive fluid through fluidic lines.

Figure 61B:
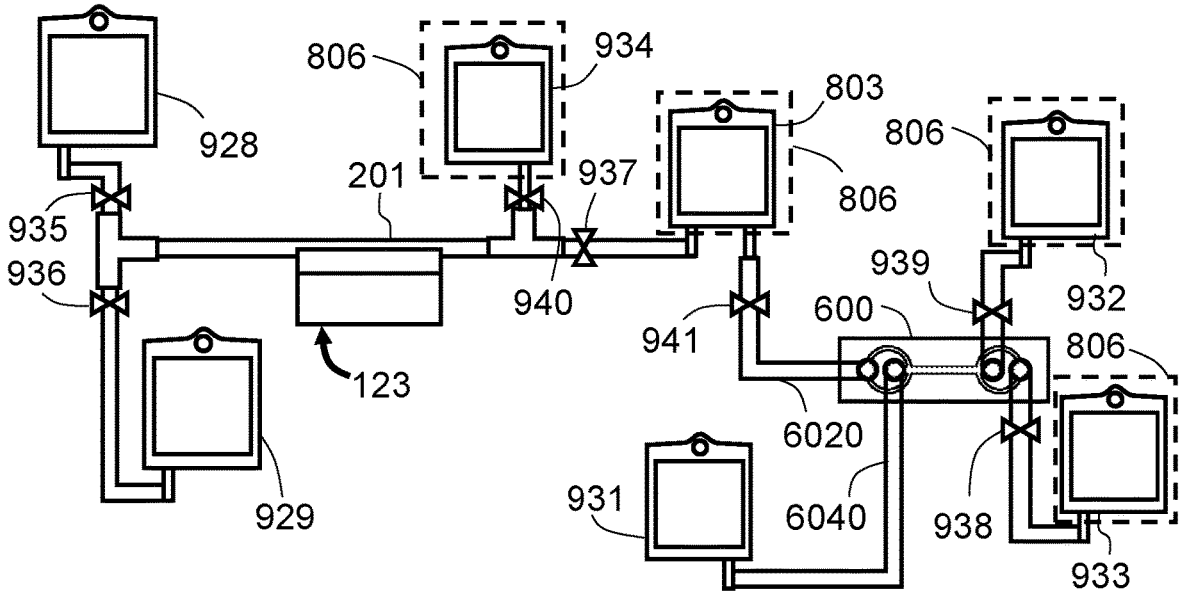

FIG. 61B illustrates replacing peristaltic pumps of FIG. 56B with using vacuum chambers on output sample bags to drive fluid through fluidic lines.

Figure 62A:
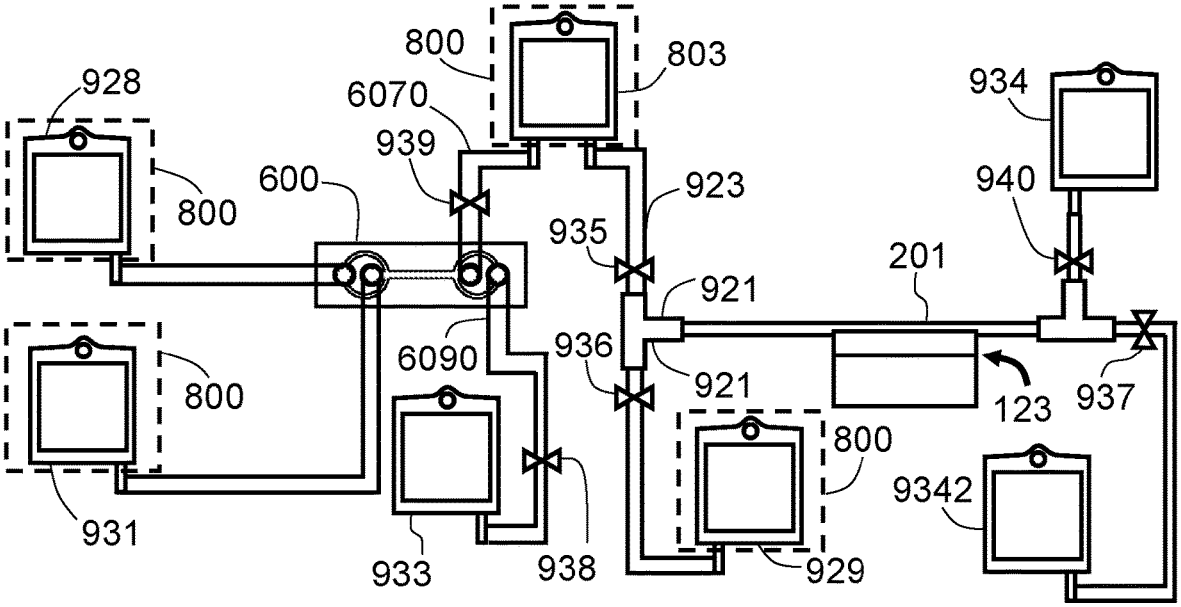

FIG. 62A illustrates replacing peristaltic pumps of FIG. 57B with using pressurized chambers on input sample bags to drive fluid through fluidic lines.

Figure 62B:
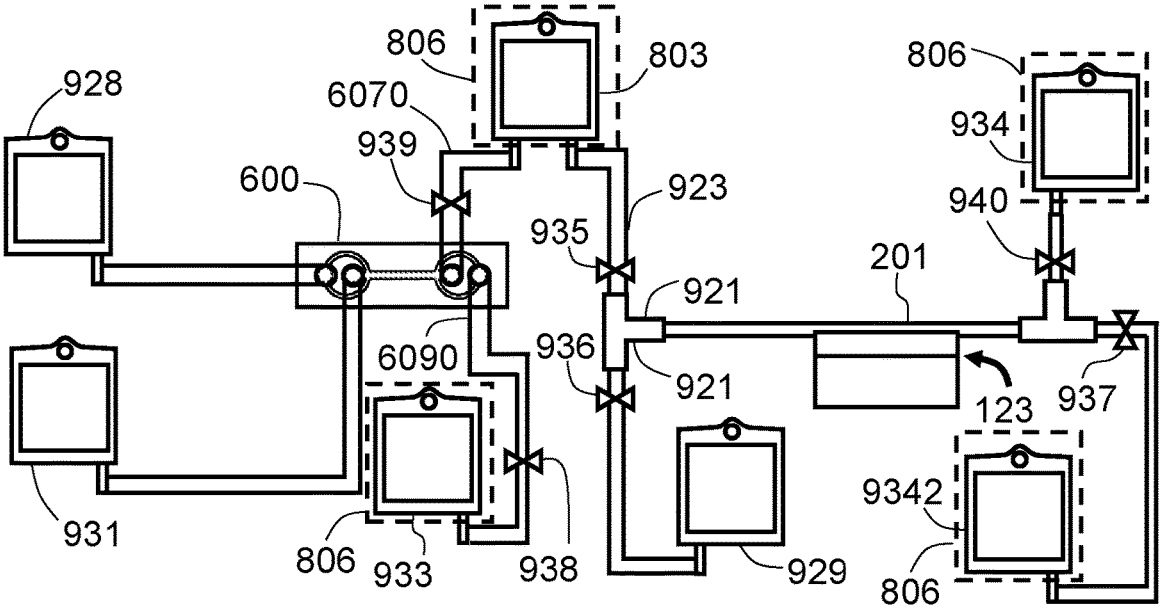

FIG. 62B illustrates replacing peristaltic pumps of FIG. 57B with using vacuum chambers on output sample bags to drive fluid through fluidic lines.

Figure 63A:
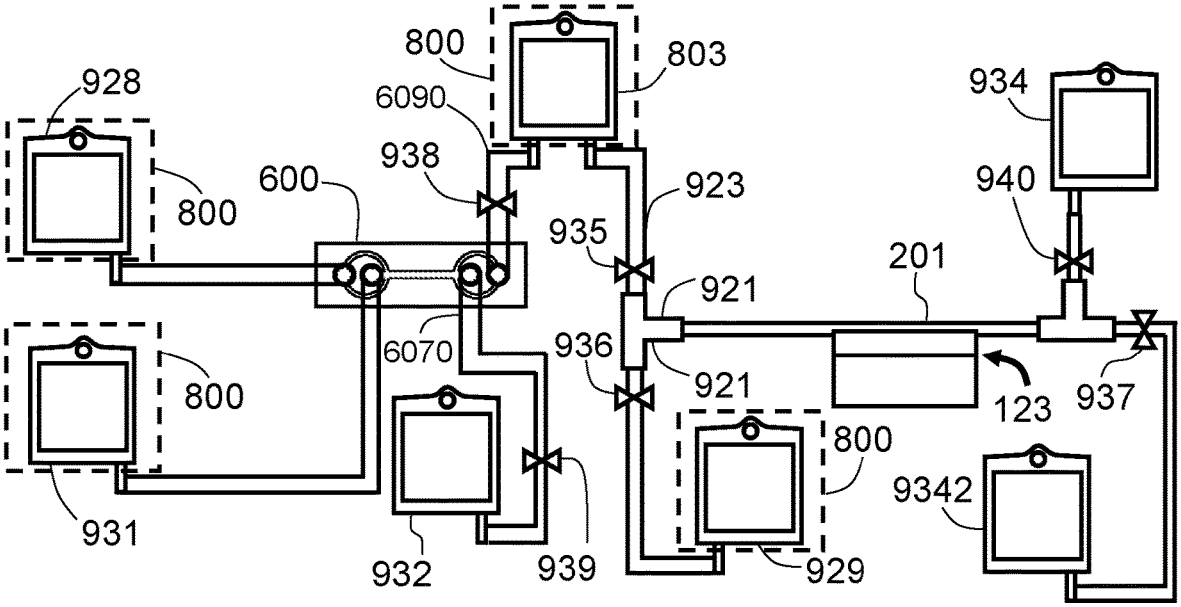

FIG. 63A illustrates replacing peristaltic pumps of FIG. 58B with using pressurized chambers on input sample bags to drive fluid through fluidic lines.

Figure 63B:
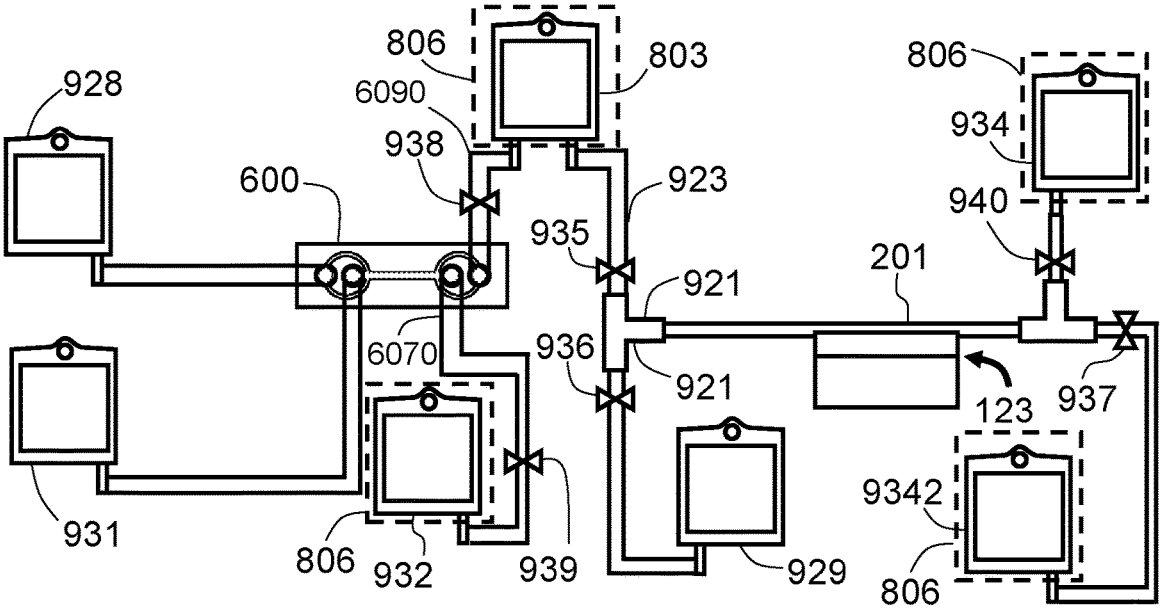

FIG. 63B illustrates replacing peristaltic pumps of FIG. 58B with using vacuum chambers on output sample bags to drive fluid through fluidic lines.

Figure 64A:
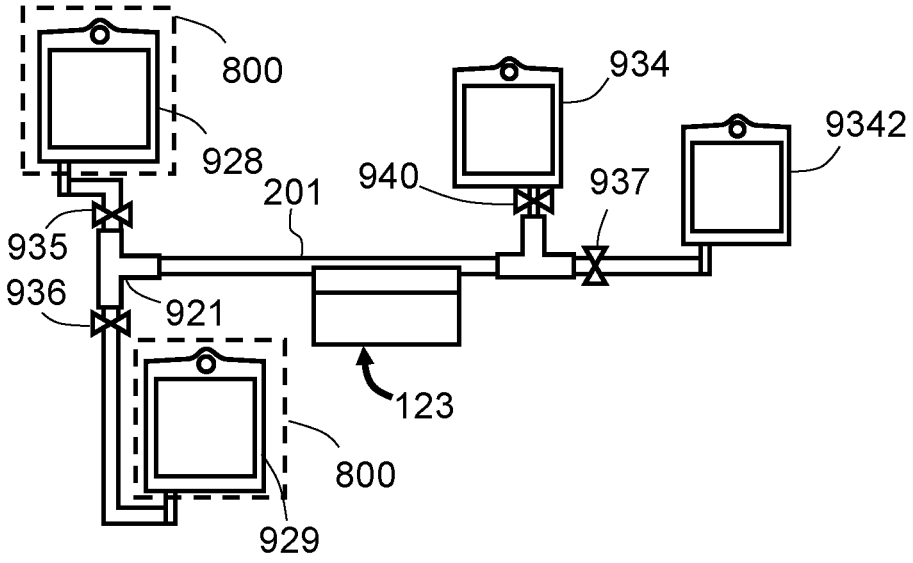

FIG. 64A illustrates replacing peristaltic pumps of FIG. 59B with using pressurized chambers on input sample bags to drive fluid through fluidic lines.

Figure 64B:
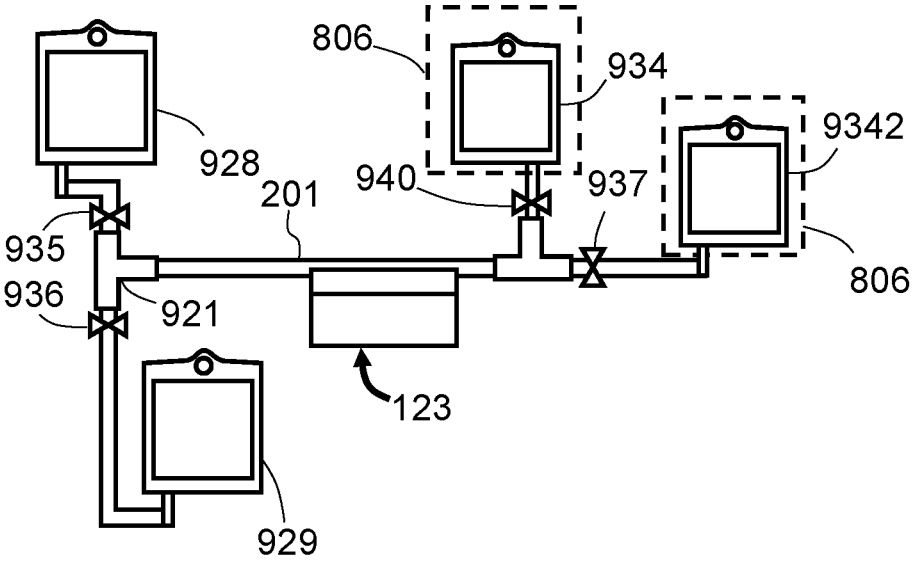

FIG. 64B illustrates replacing peristaltic pumps of FIG. 59B with using vacuum chambers on output sample bags to drive fluid through fluidic lines.

Figure 65A:
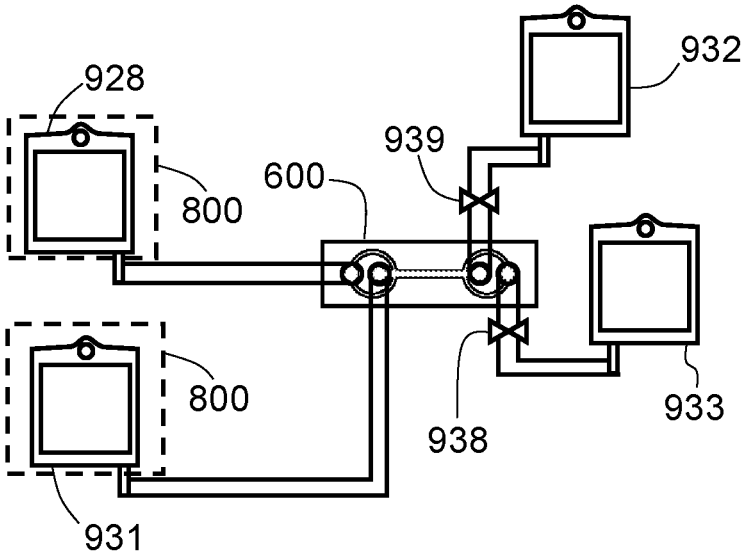

FIG. 65A illustrates replacing peristaltic pumps of FIG. 60B with using pressurized chambers on input sample bags to drive fluid through fluidic lines.

Figure 65B:
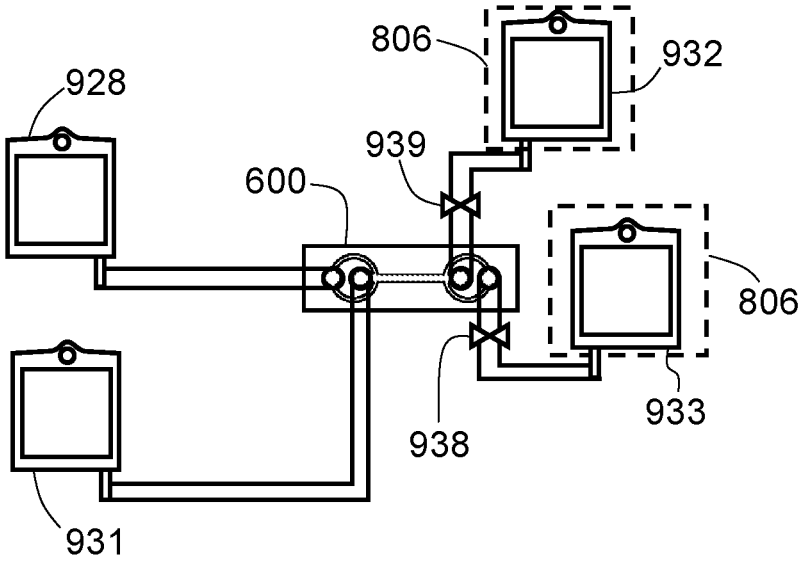

FIG. 65B illustrates replacing peristaltic pumps of FIG. 60B with using vacuum chambers on output sample bags to drive fluid through fluidic lines.

Figure 66:
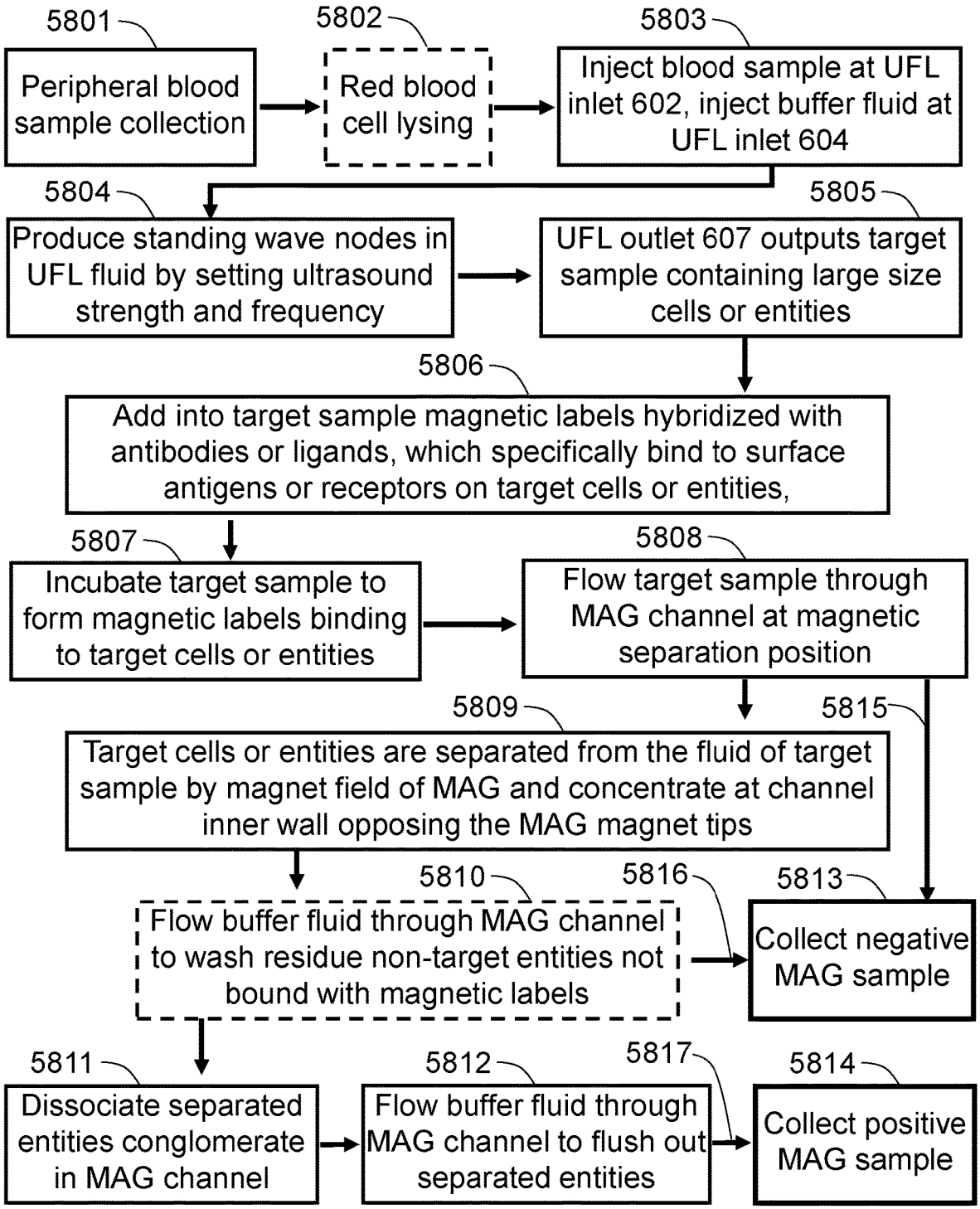

FIG. 66 illustrates a first process flow to separate biological entities from peripheral blood using UFL and MAG.

Figure 67:
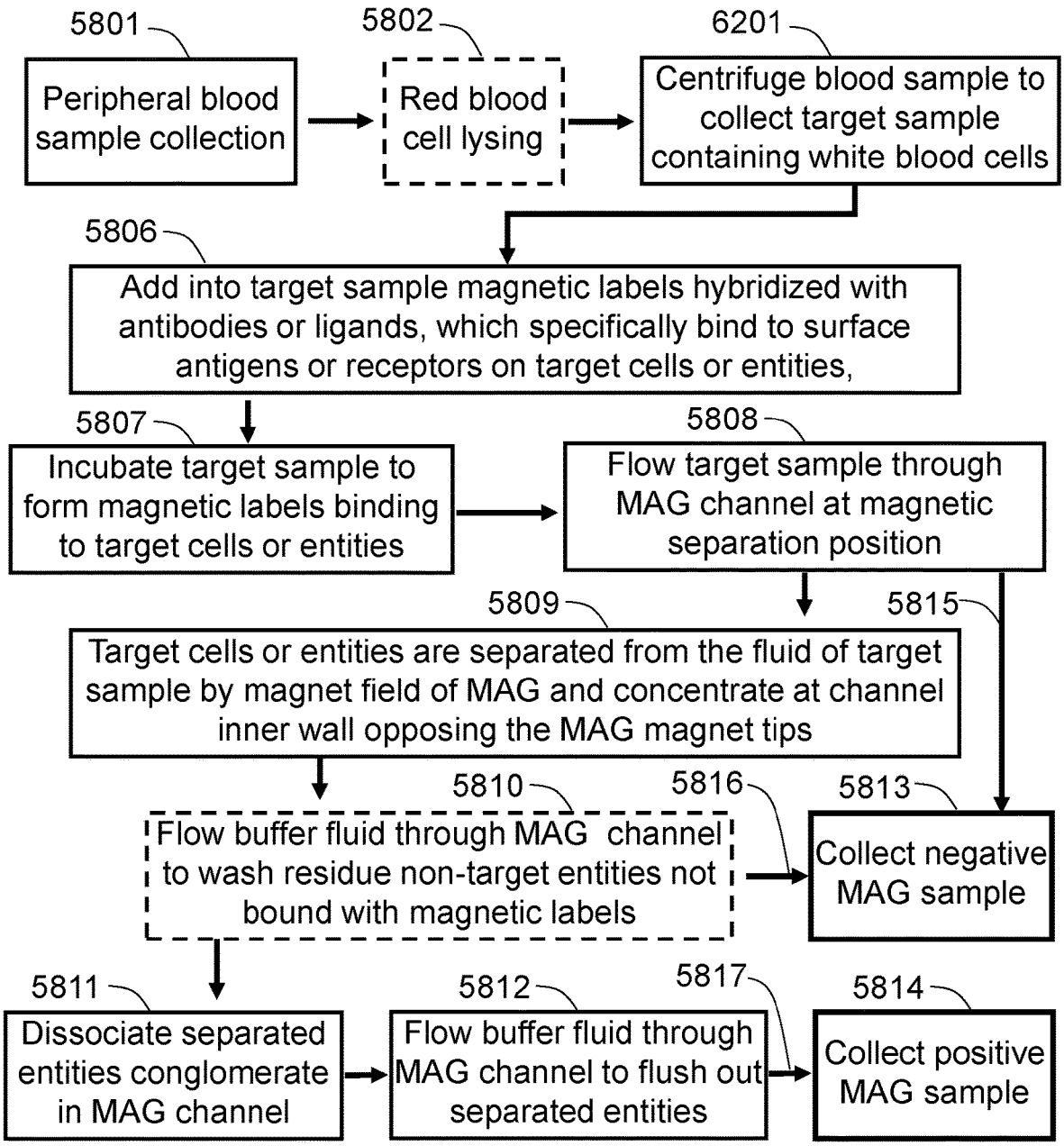

FIG. 67 illustrates a second process flow to separate biological entities from peripheral blood using MAG.

Figure 68:
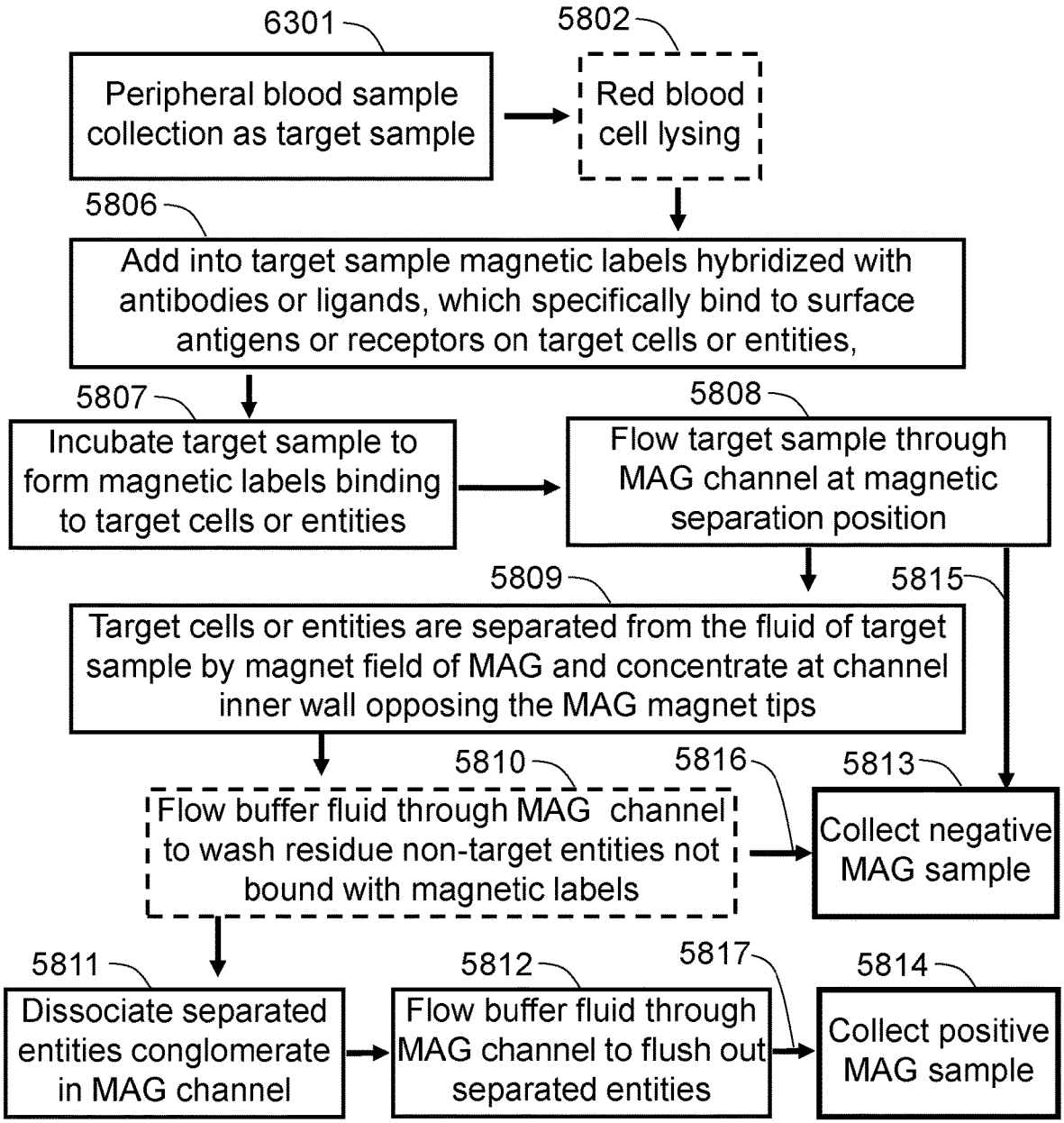

FIG. 68 illustrates a third process flow to separate biological entities from peripheral blood using MAG.

Figure 69:
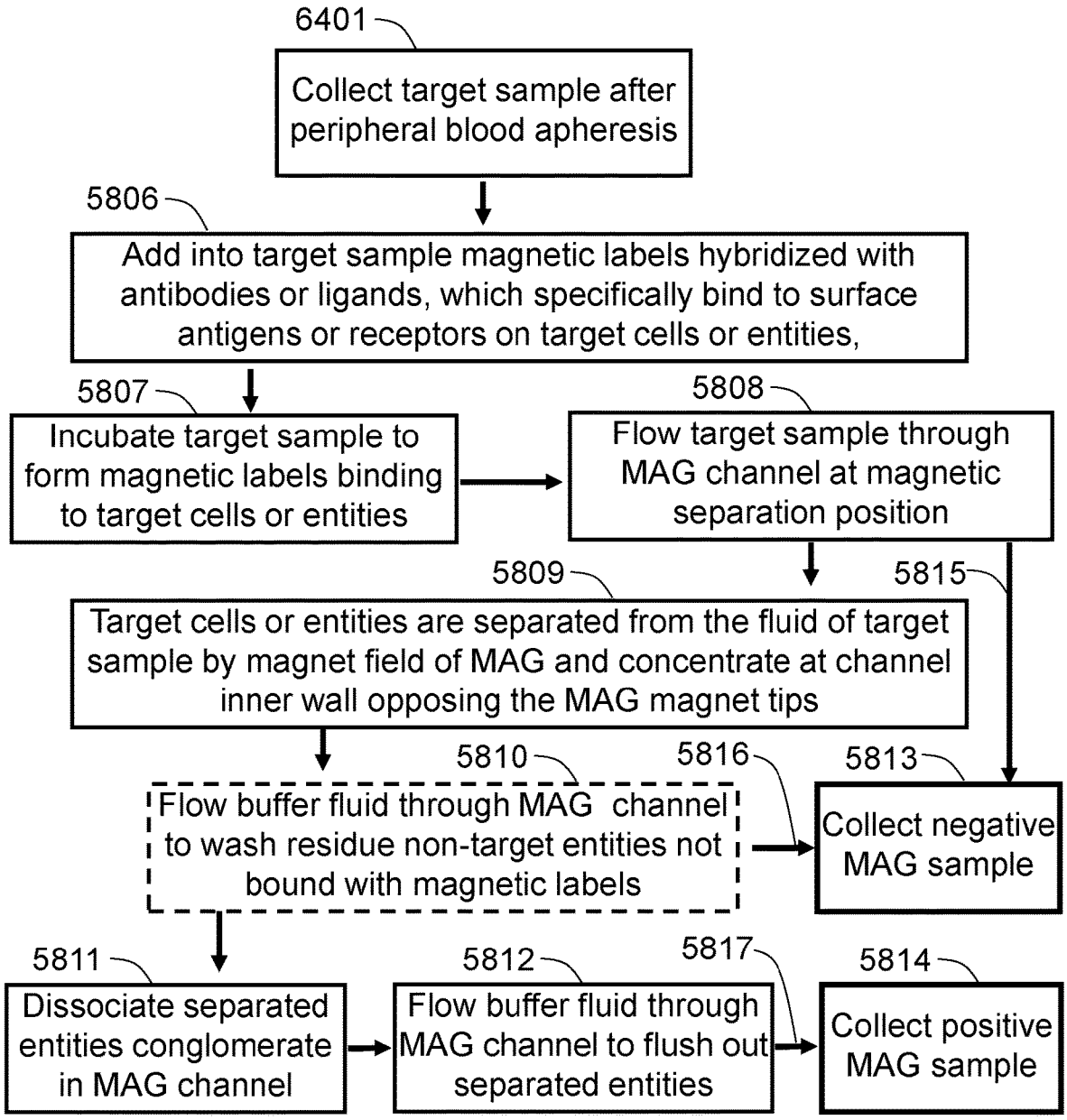

FIG. 69 illustrates a fourth process flow to separate biological entities from peripheral blood using MAG.

Figure 70:
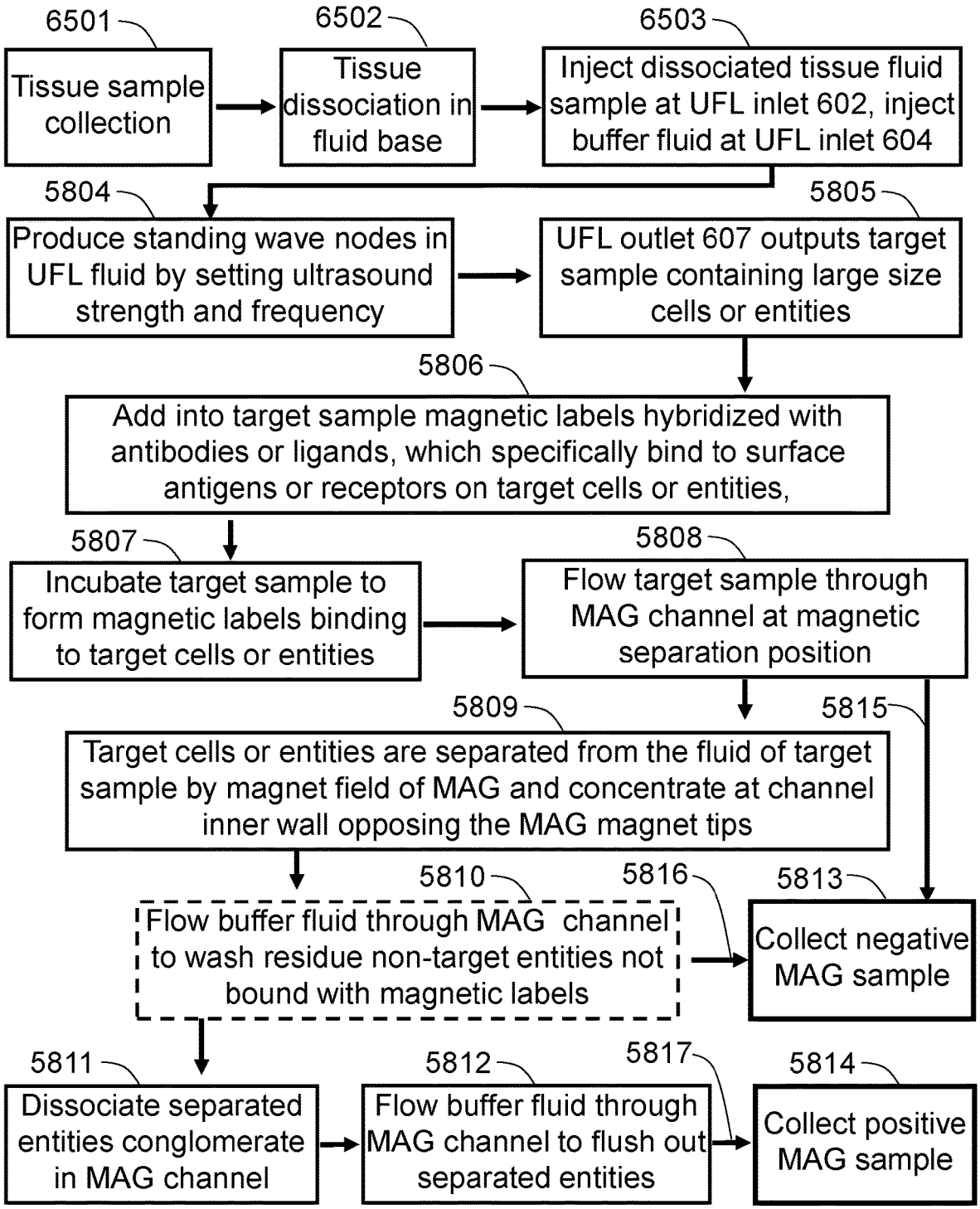

FIG. 70 illustrates a fifth process flow to separate biological entities from tissue sample using UFL and MAG.

Figure 71:
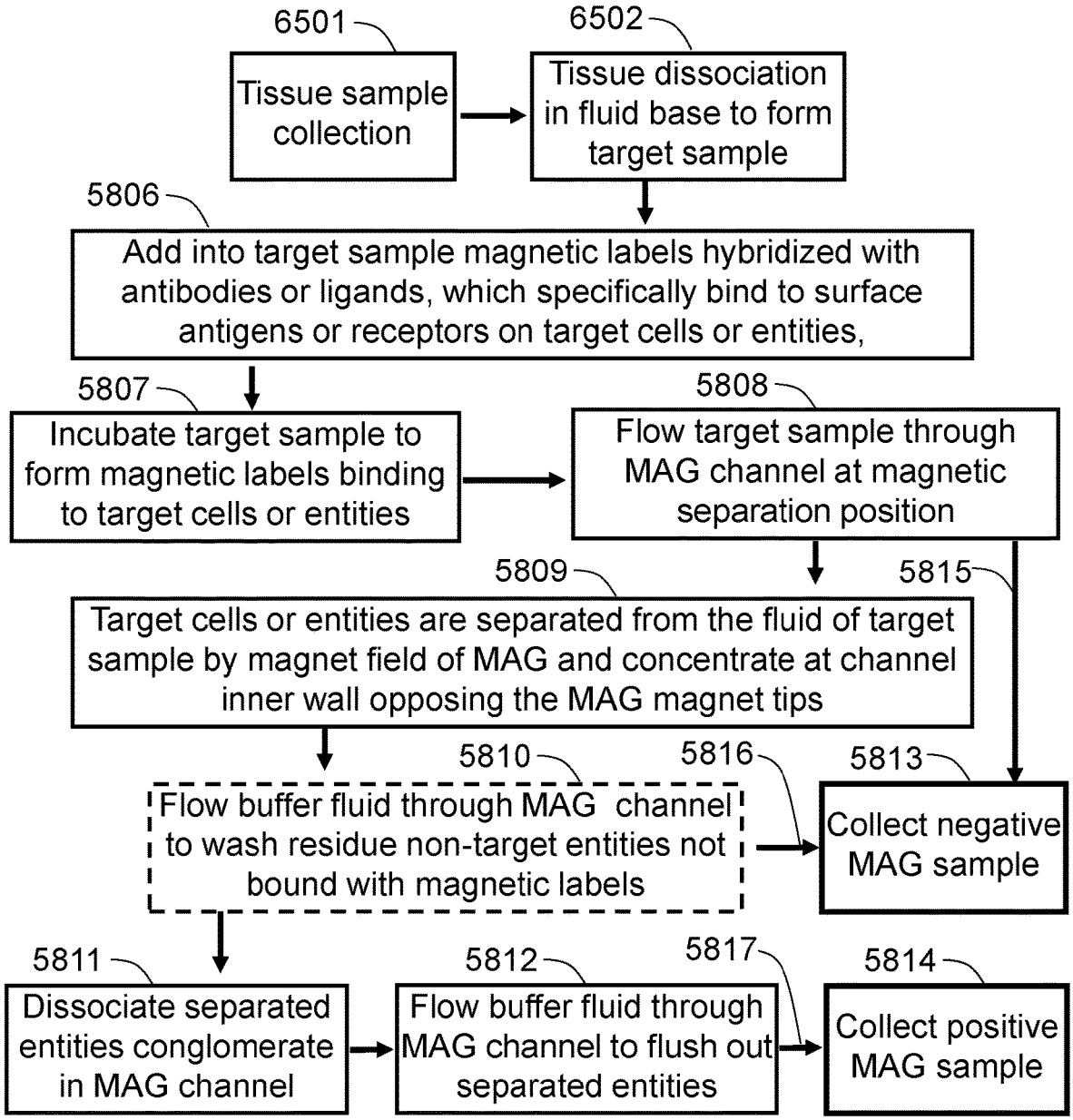

FIG. 71 illustrates a sixth process flow to separate biological entities from tissue sample using MAG.

Figure 72:
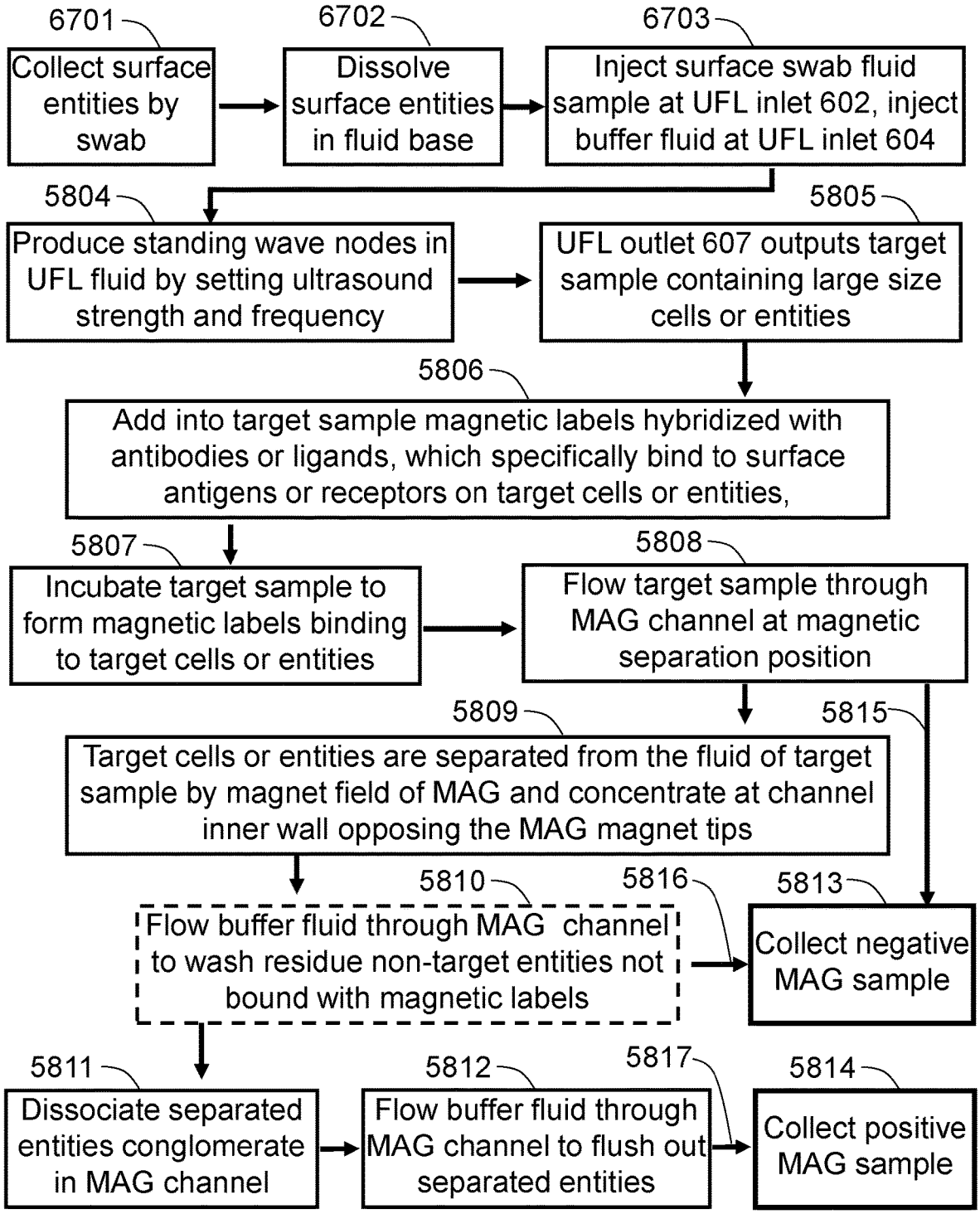

FIG. 72 illustrates a seventh process flow to separate biological entities from surface swab sample using UFL and MAG.

Figure 73:
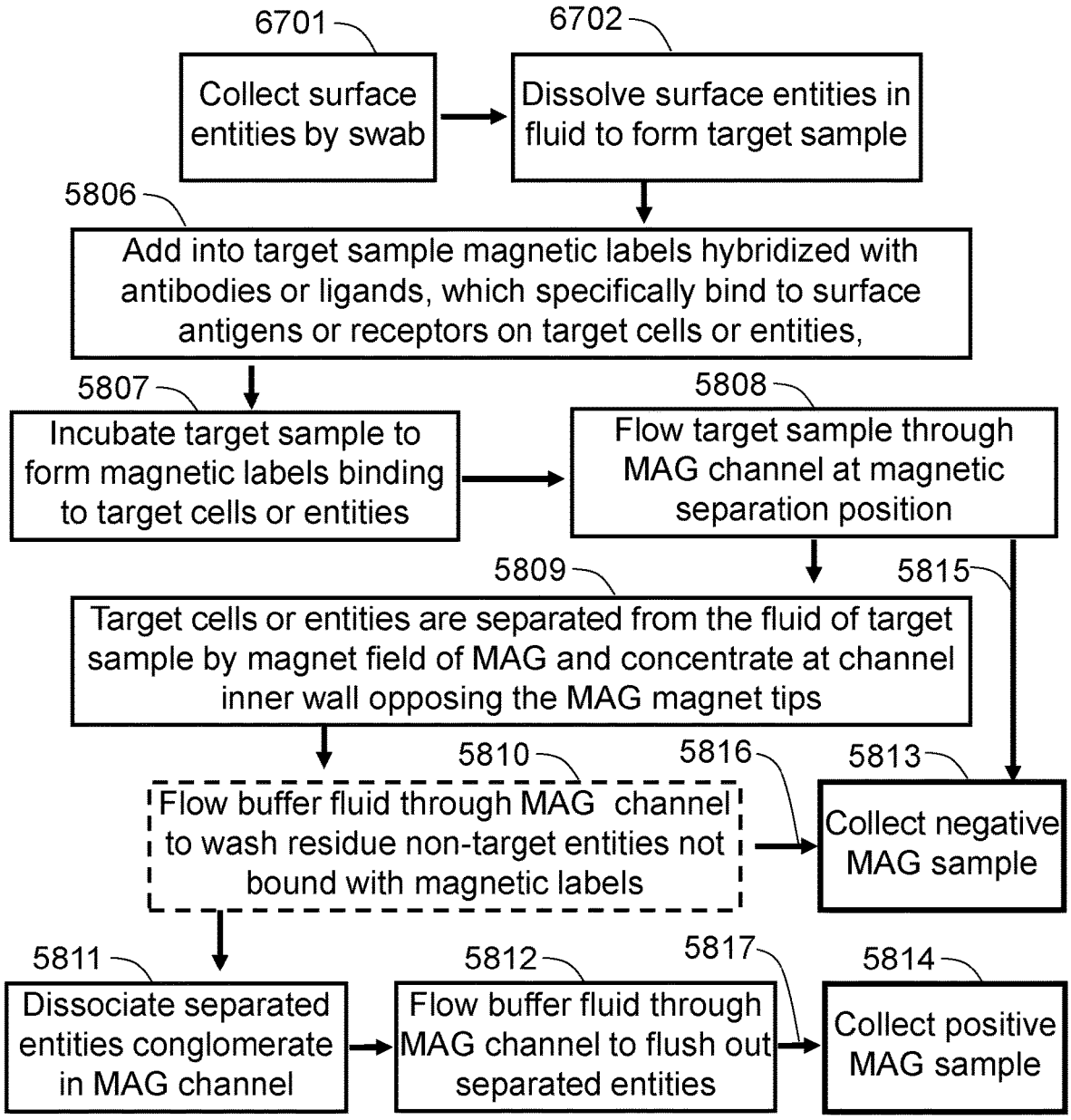

FIG. 73 illustrates an eighth process flow to separate biological entities from surface swab sample using MAG.

Figure 74:
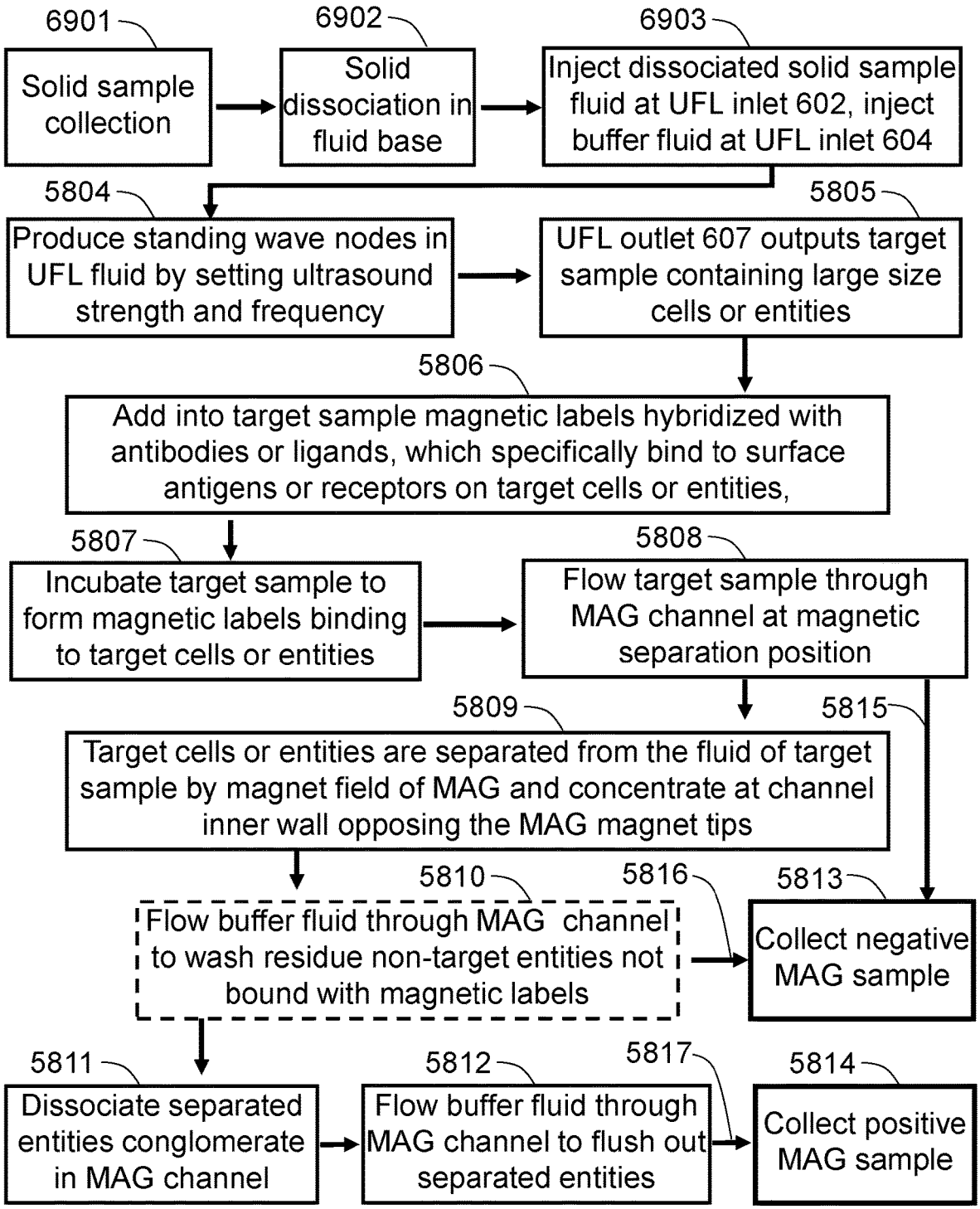

FIG. 74 illustrates a ninth process flow to separate biological entities from solid sample using UFL and MAG.

Figure 75:
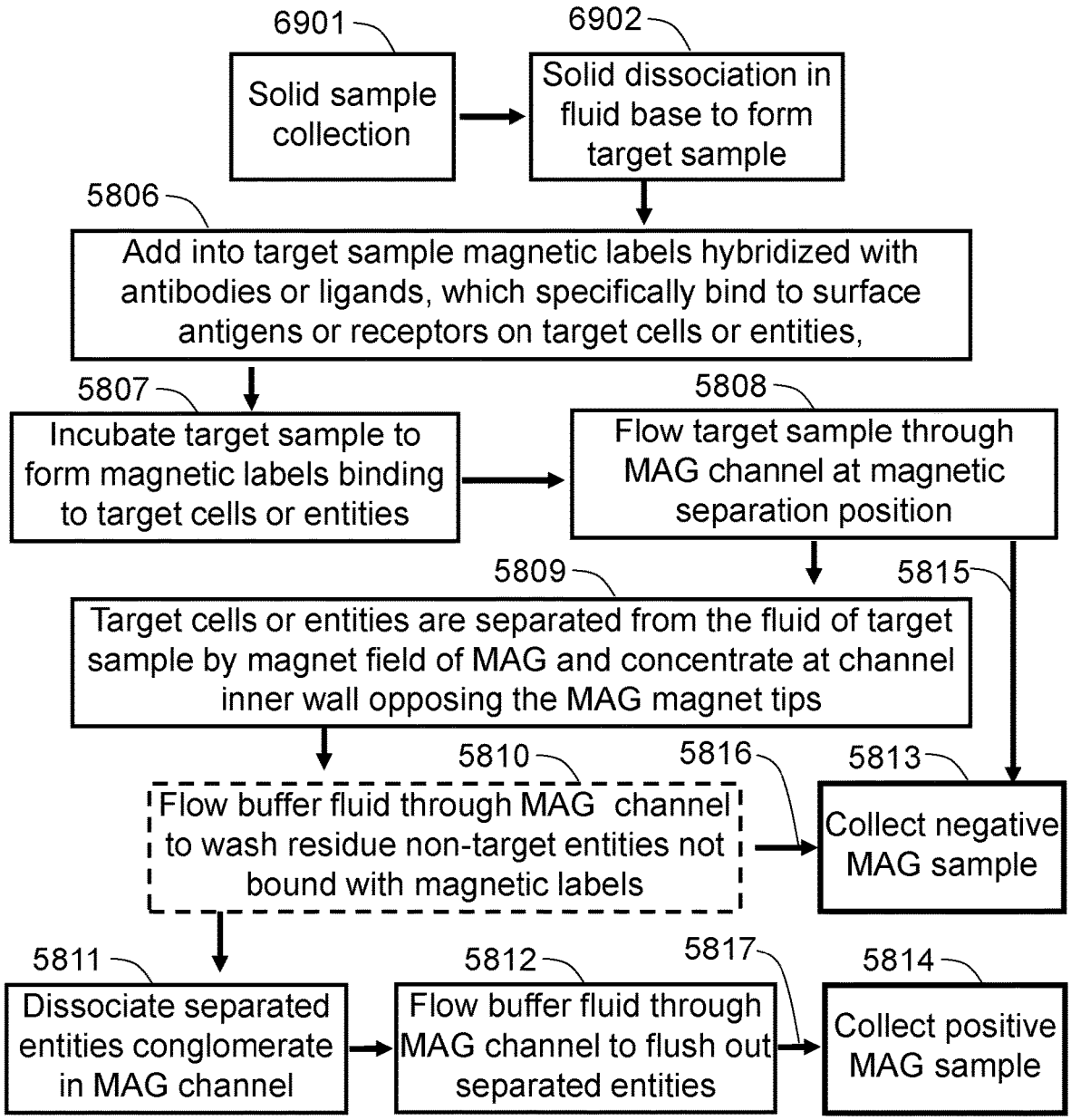

FIG. 75 illustrates a tenth process flow to separate biological entities from solid sample using MAG.

Figure 76A:
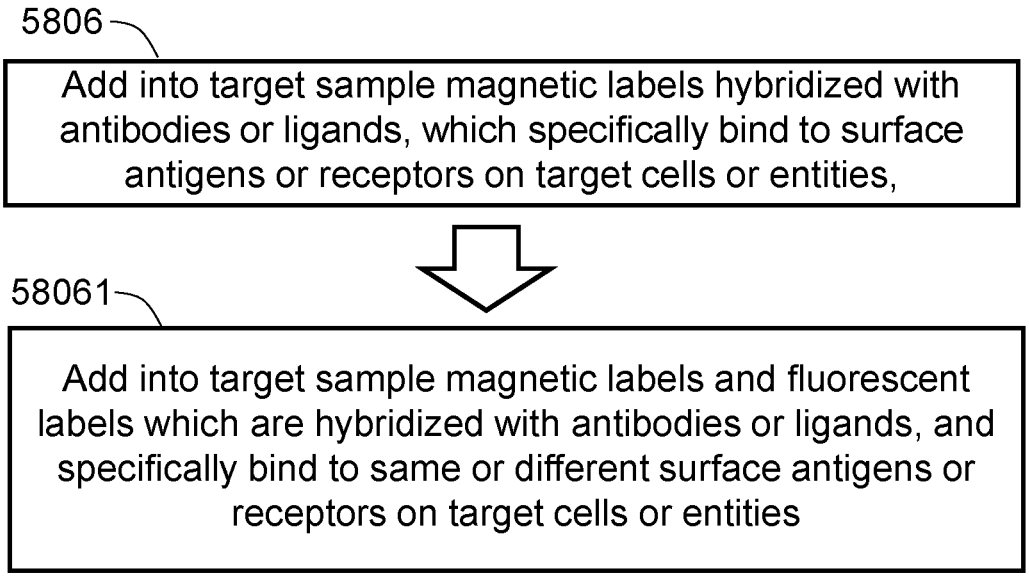

FIG. 76A illustrates addition of both magnetic and fluorescent labels into fluid samples for specific binding to target cells or entities.

Figure 76B:
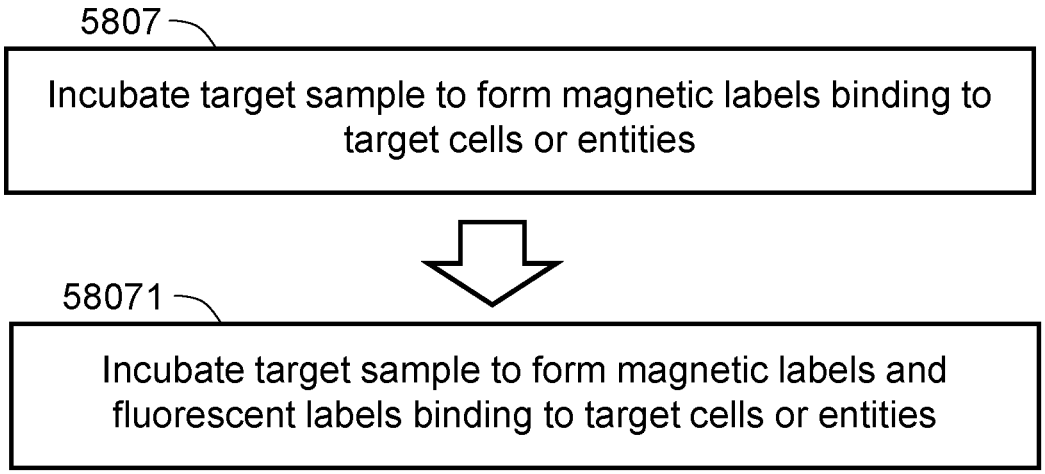

FIG. 76B illustrates incubation of both magnetic and fluorescent labels at same time to form specific binding to target cells or entities.

Figure 77A:
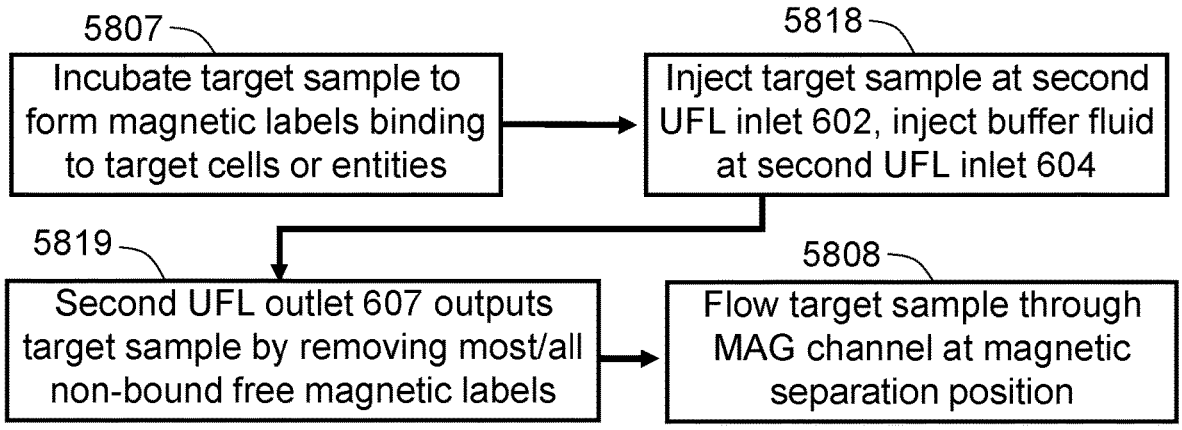

FIG. 77A illustrates process of removing non-bound free magnetic labels from sample fluid by UFL before magnetic separation by MAG.

Figure 77B:
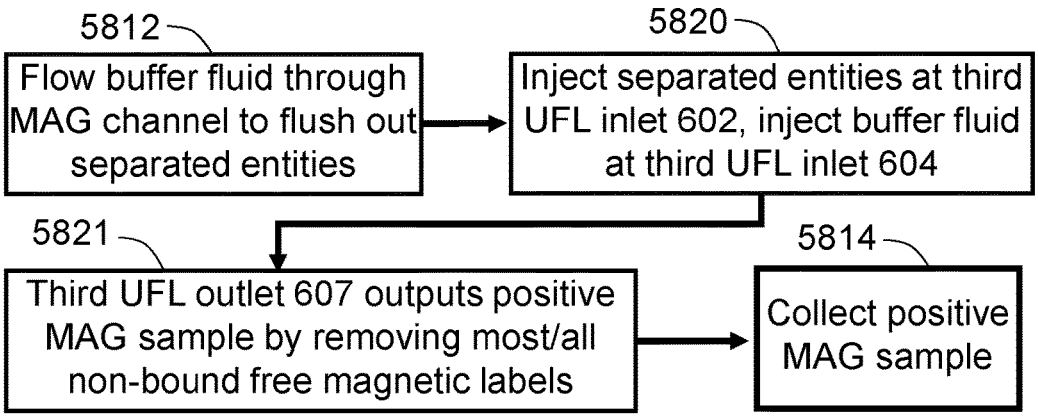

FIG. 77B illustrates process of removing non-bound free magnetic labels from sample fluid by UFL after magnetic separation by MAG.

Figure 78A:
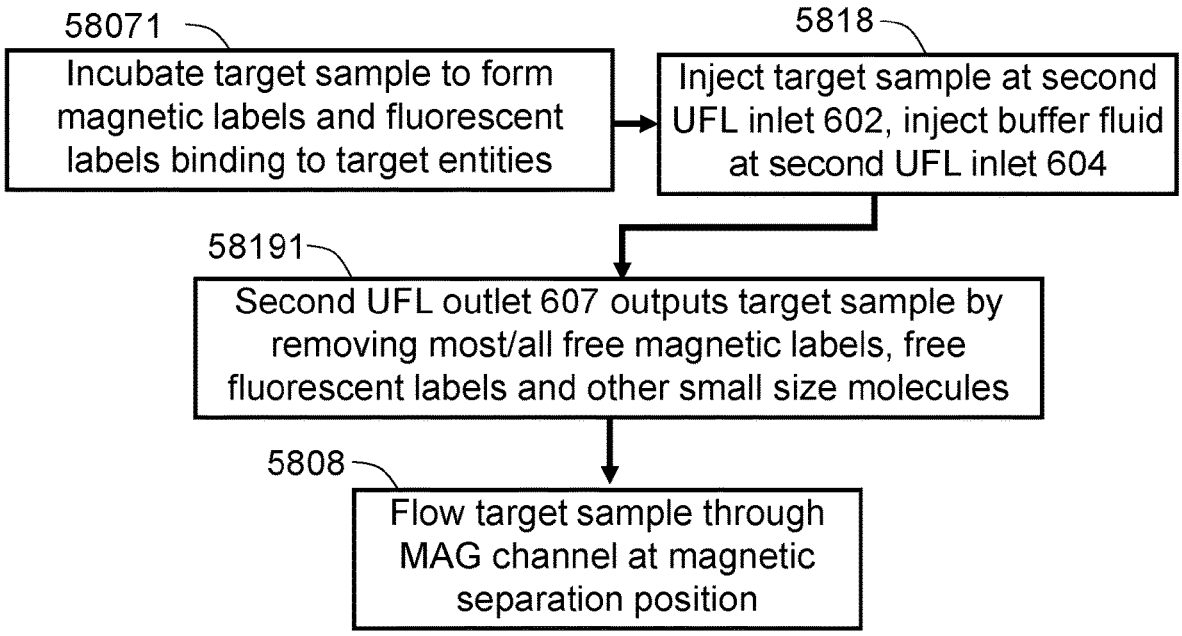

FIG. 78A illustrates process of removing non-bound free magnetic labels and free fluorescent labels from sample fluid by UFL before magnetic separation by MAG.

Figure 78B:
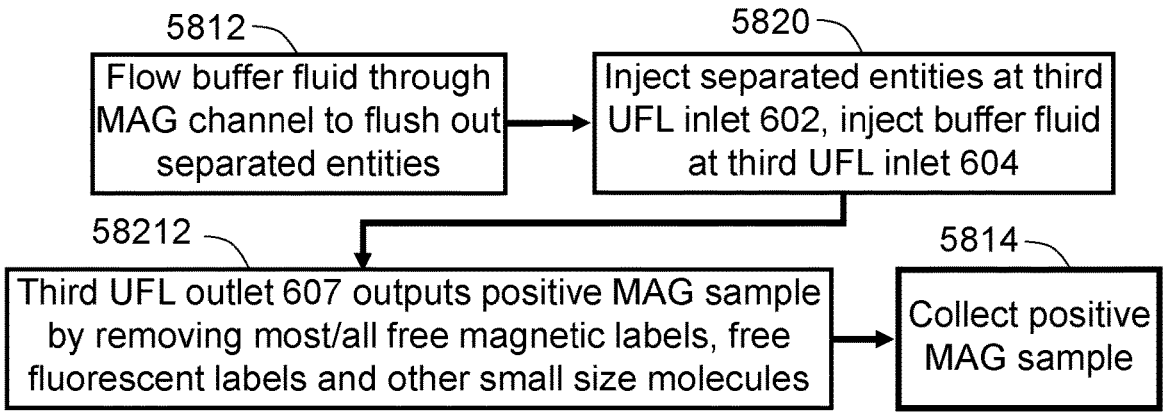

FIG. 78B illustrates process of removing non-bound free magnetic labels and free fluorescent labels from sample fluid by UFL after magnetic separation by MAG.

Figure 79:
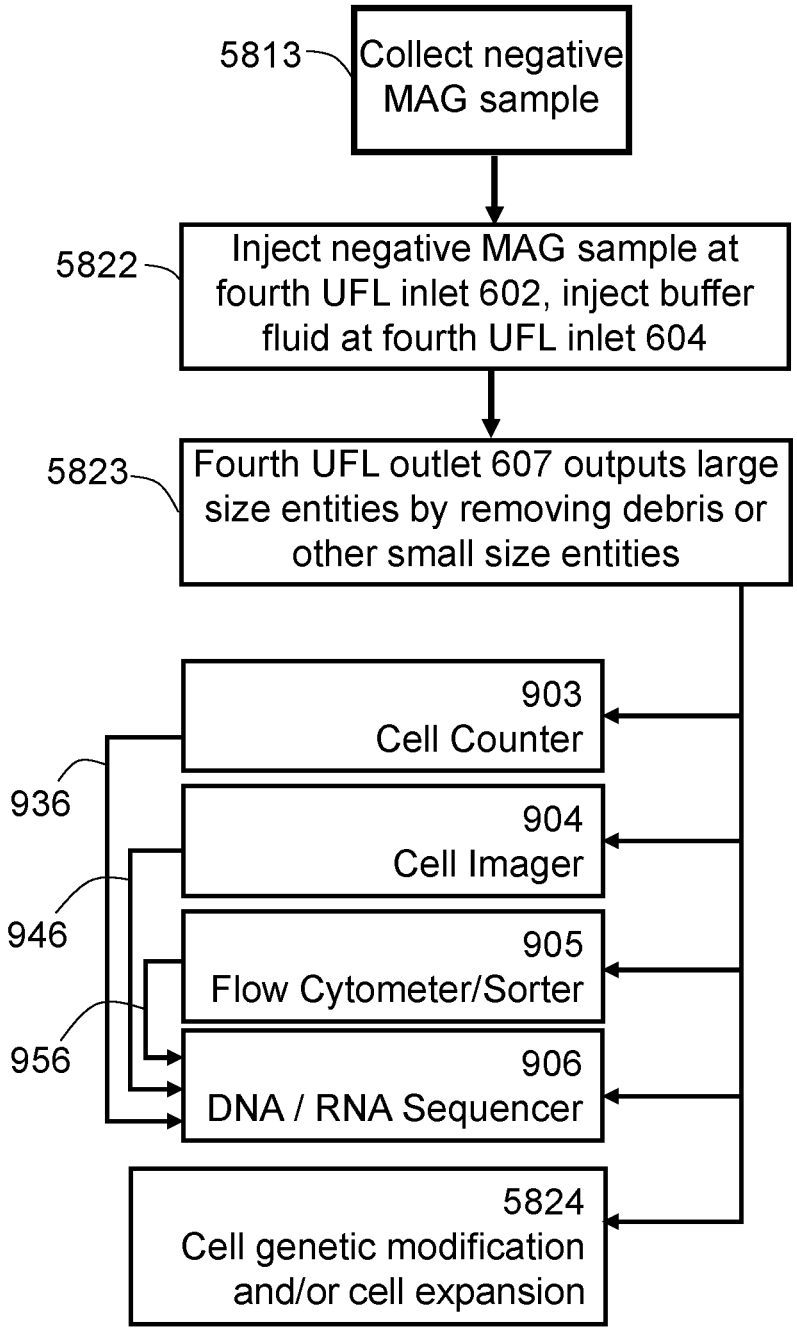

FIG. 79 illustrates continued process of negative MAG sample through UFL and various cell processing devices and procedures.

Figure 80:
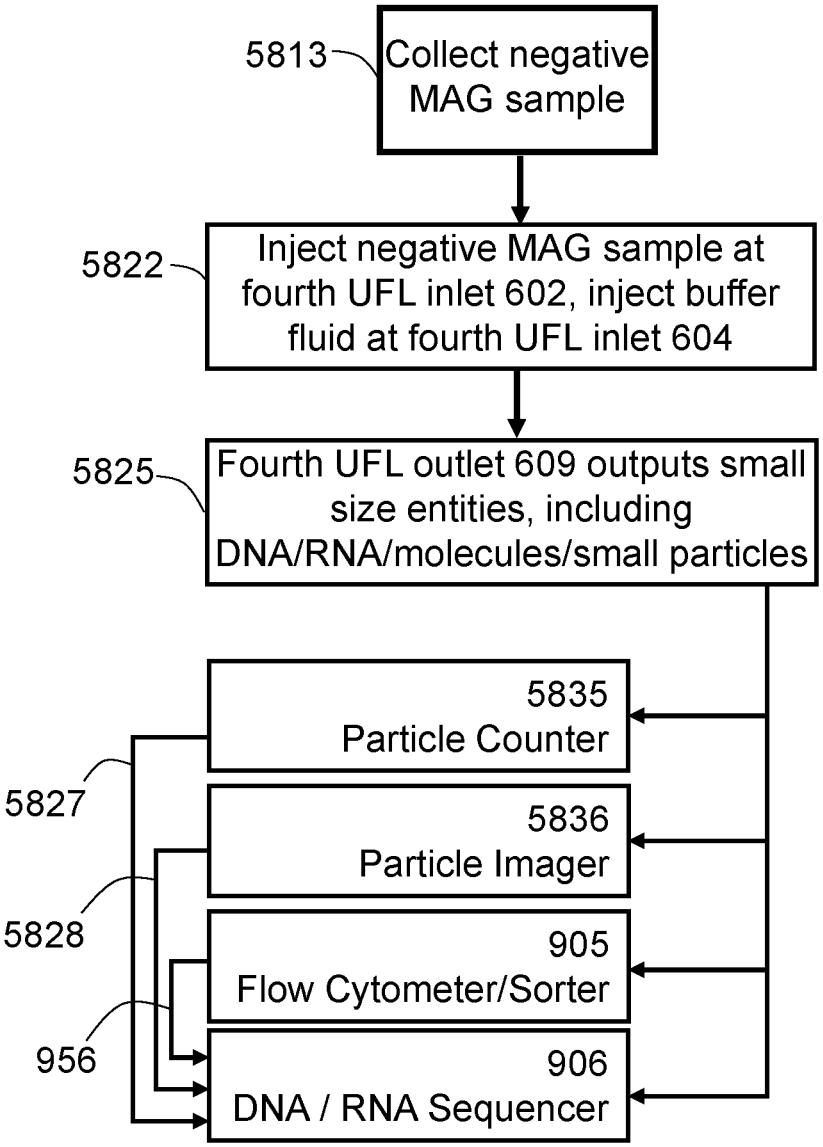

FIG. 80 illustrates continued process of negative MAG sample through UFL and various particle or molecule processing devices.

Figure 81:
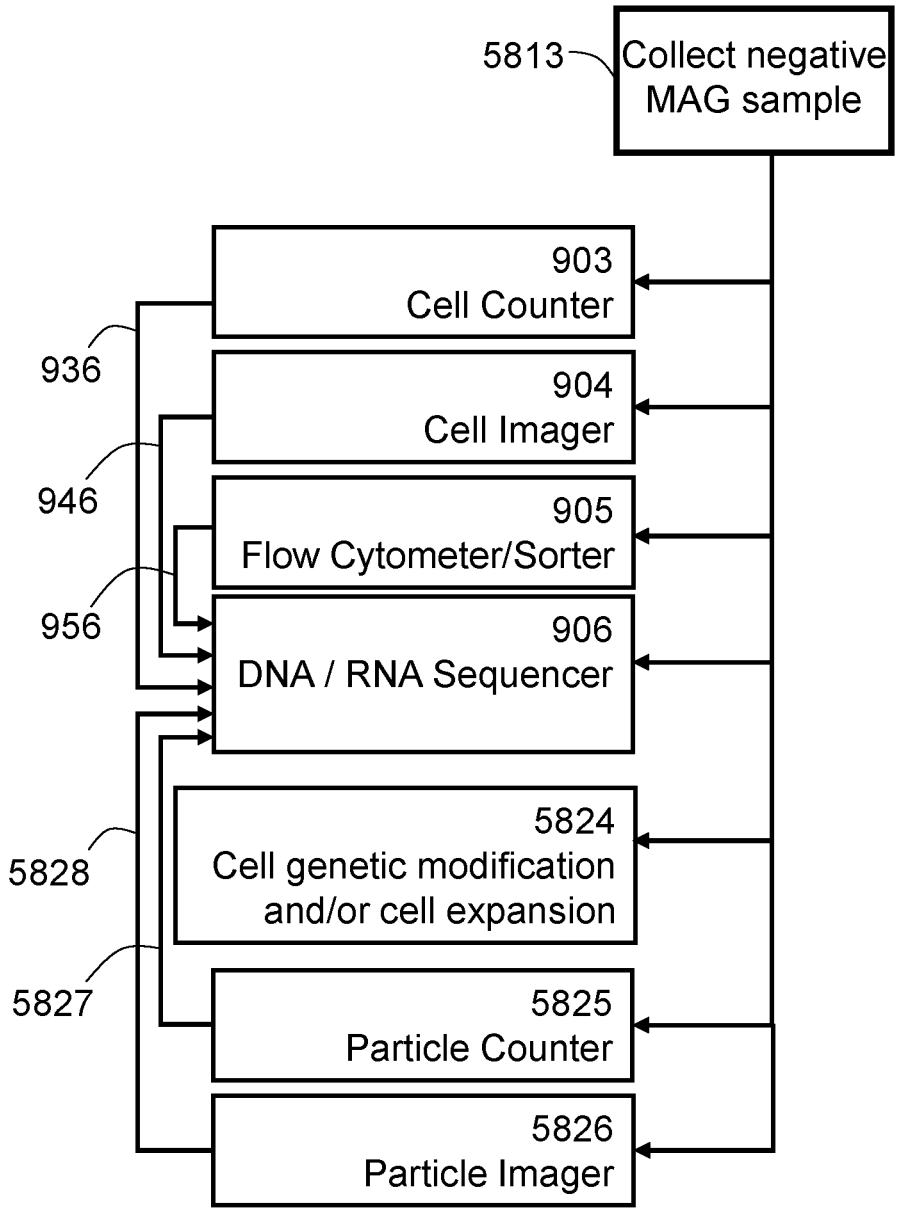

FIG. 81 illustrates entities analysis of negative MAG sample after MAG separation into various analyzing devices.

Figure 82:
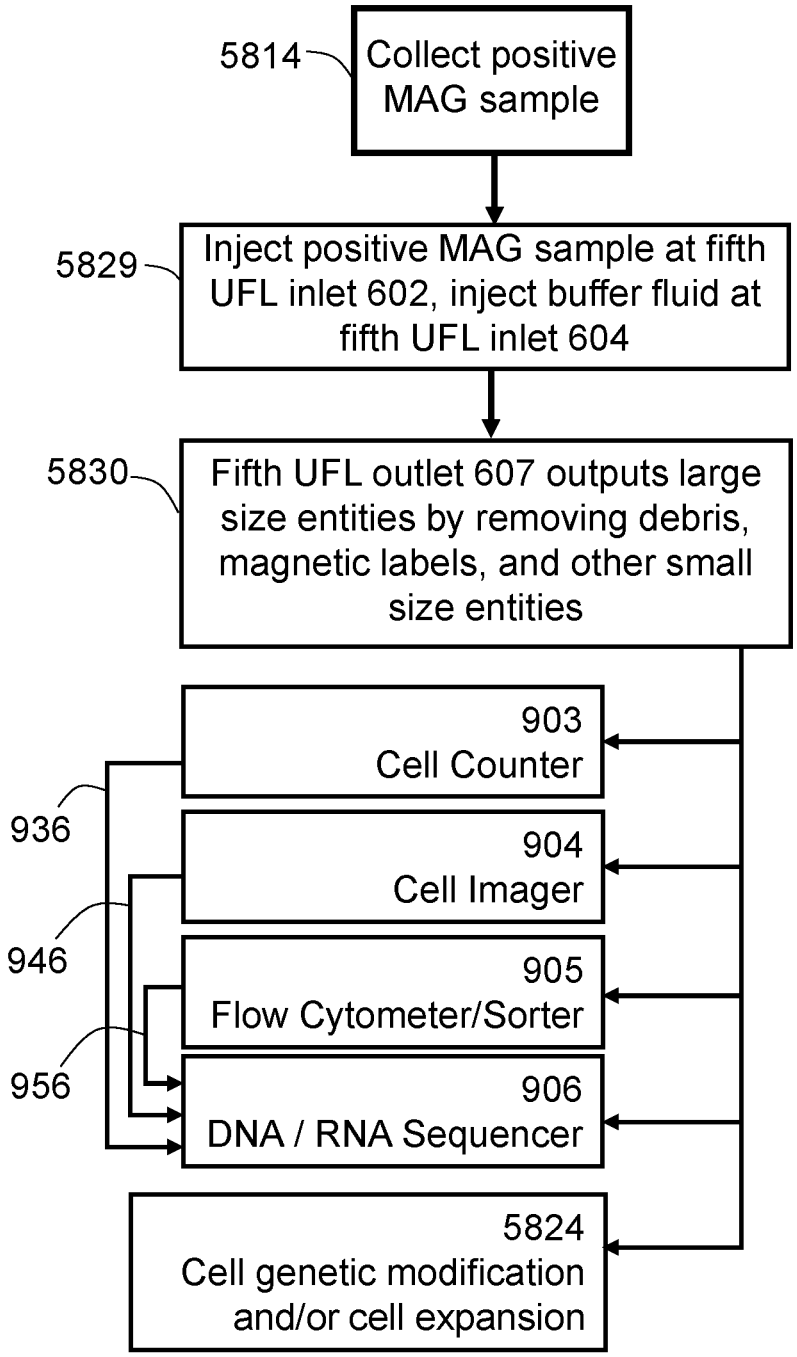

FIG. 82 illustrates continued process of positive MAG sample through UFL and various cell processing devices and procedures.

Figure 83:
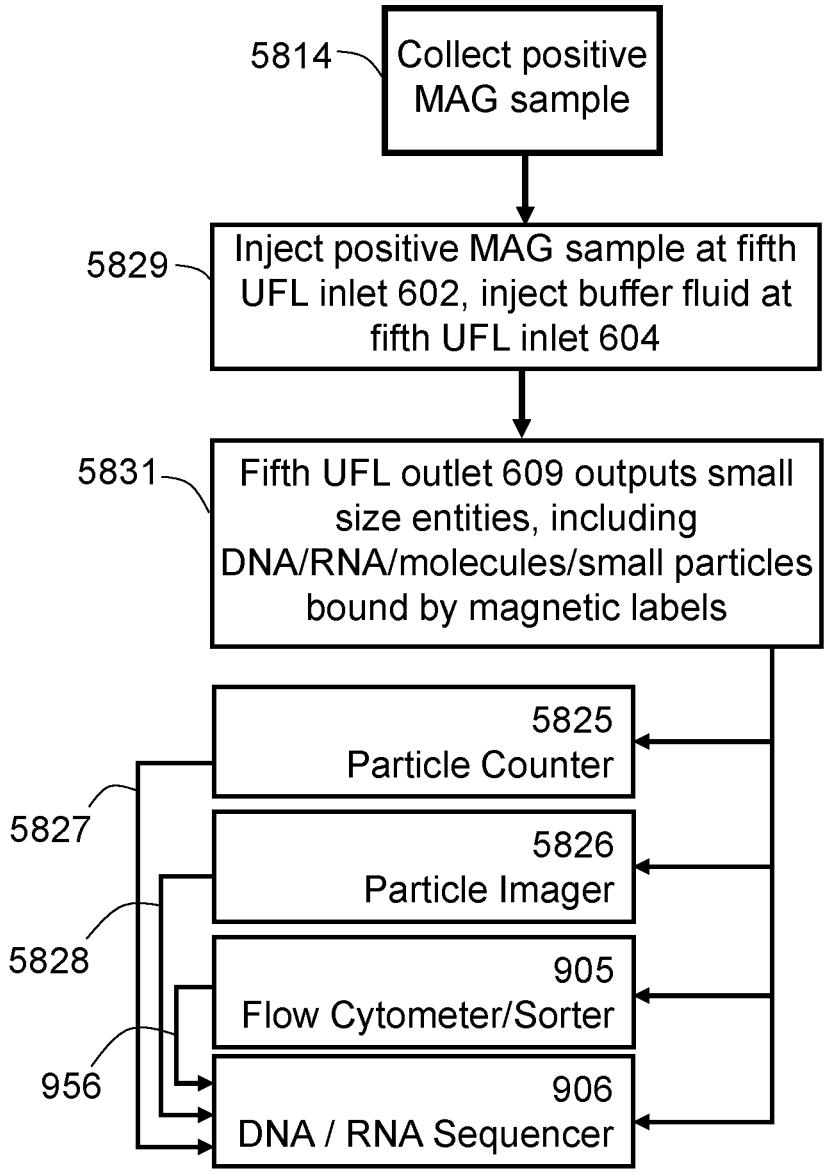

FIG. 83 illustrates continued process of positive MAG sample through UFL and various particle or molecule processing devices.

Figure 84:
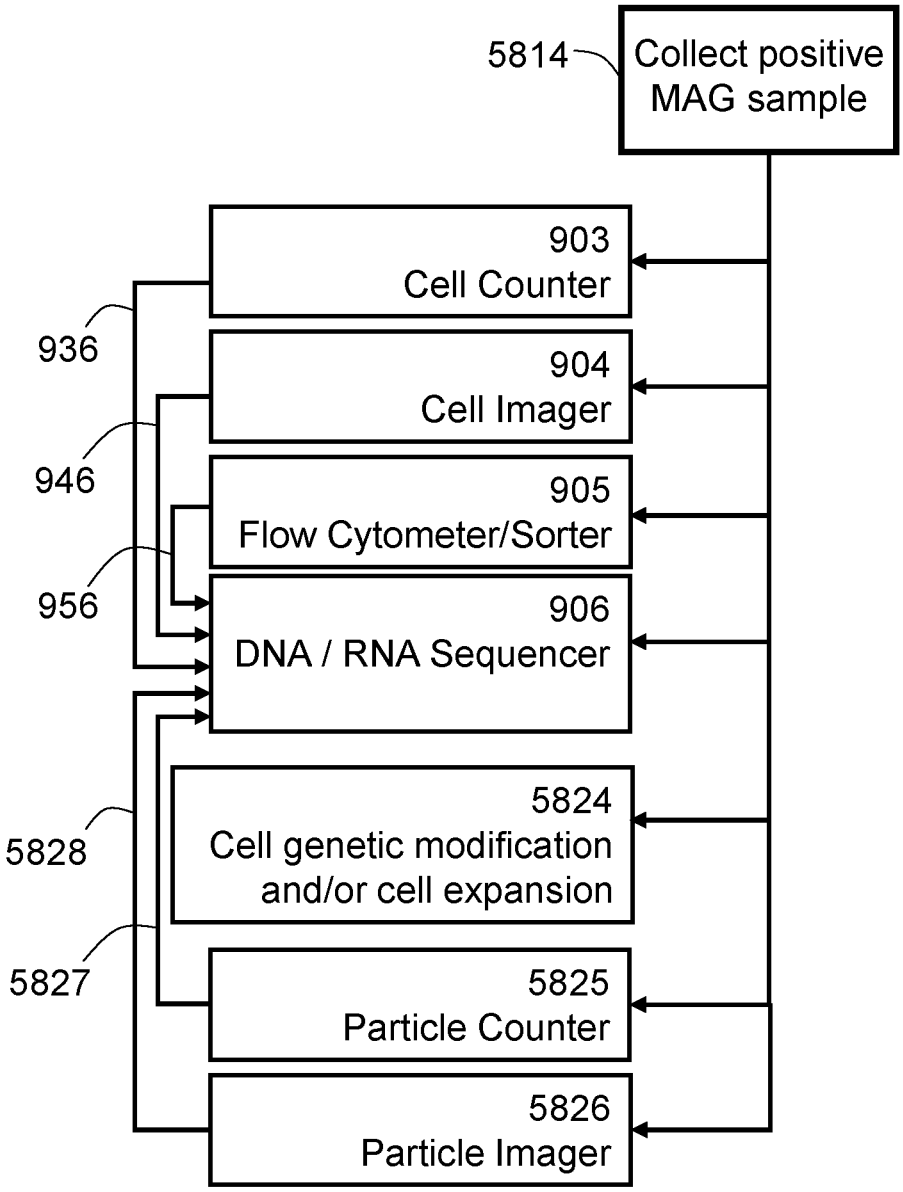

FIG. 84 illustrates entities analysis of positive MAG sample after MAG separation into various analyzing devices.

Figure 85A:
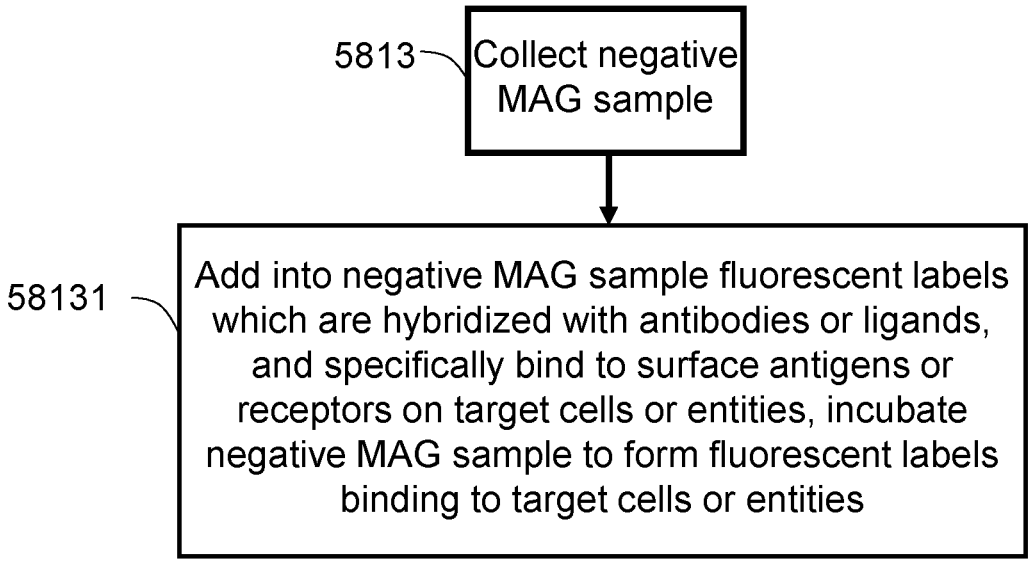

FIG. 85A illustrates adding fluorescent labels to specifically bind to target entities within negative MAG sample immediately after negative MAG sample collection.

Figure 85B:
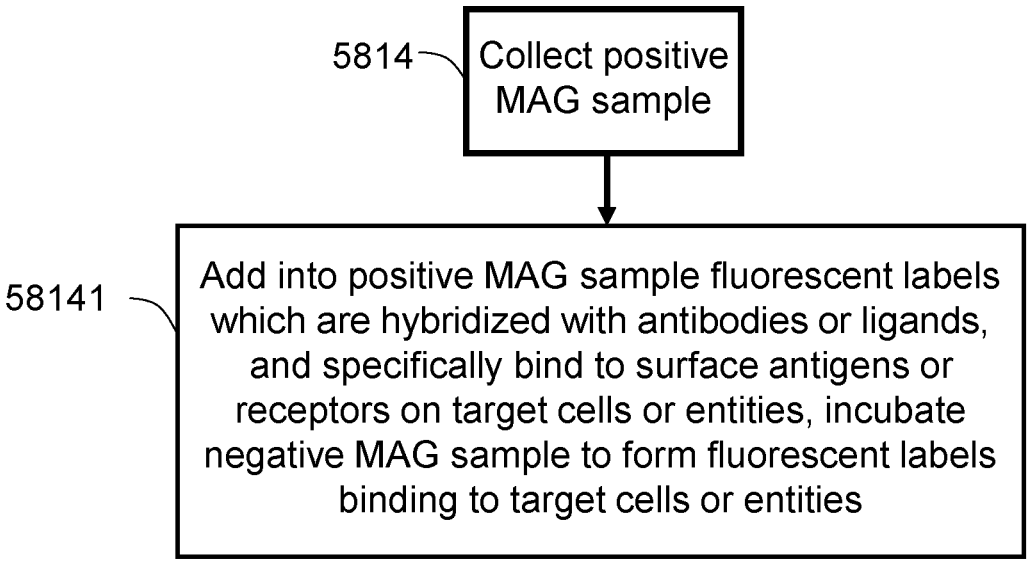

FIG. 85B illustrates adding fluorescent labels to specifically bind to target entities within positive MAG sample immediately after positive MAG sample collection.

Figure 86:
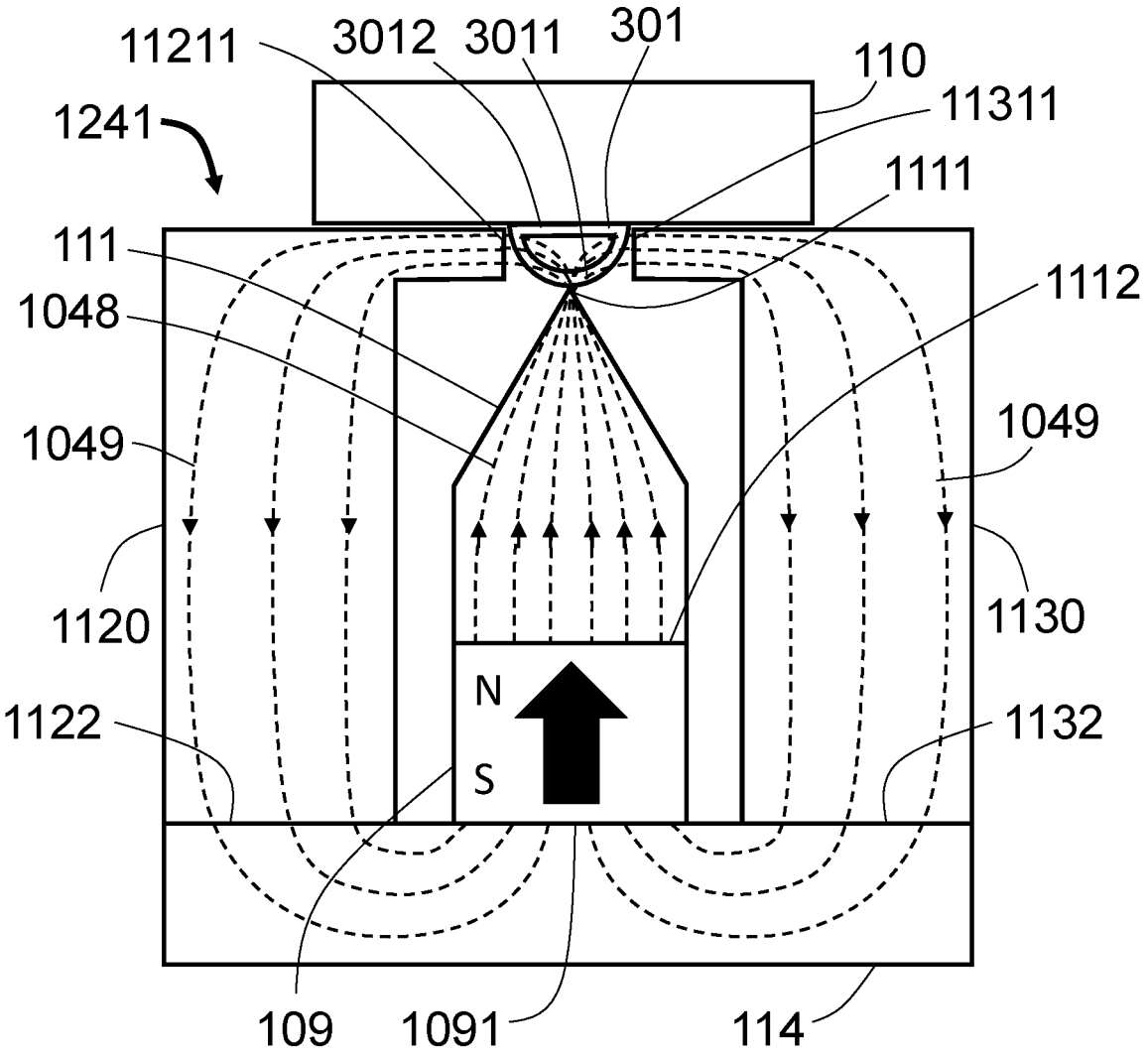

FIG. 86 illustrates cross-sectional view of the tenth embodiment of MAG having a separation channel in separation position.

Figure 87A:
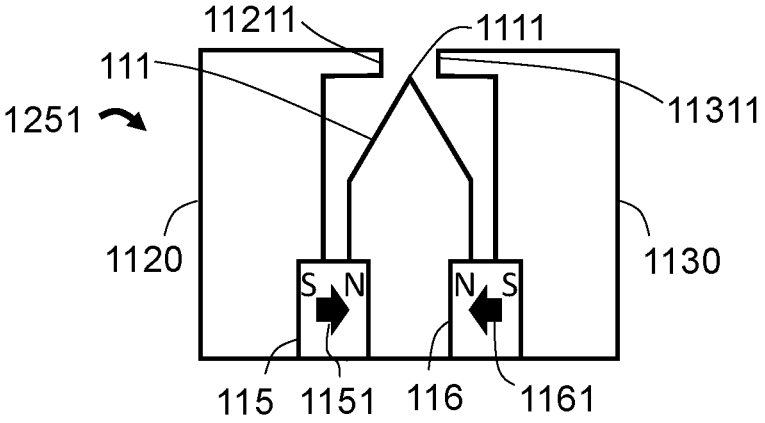

FIG. 87A illustrates cross-sectional view of the eleventh embodiment of MAG.

Figure 87B:
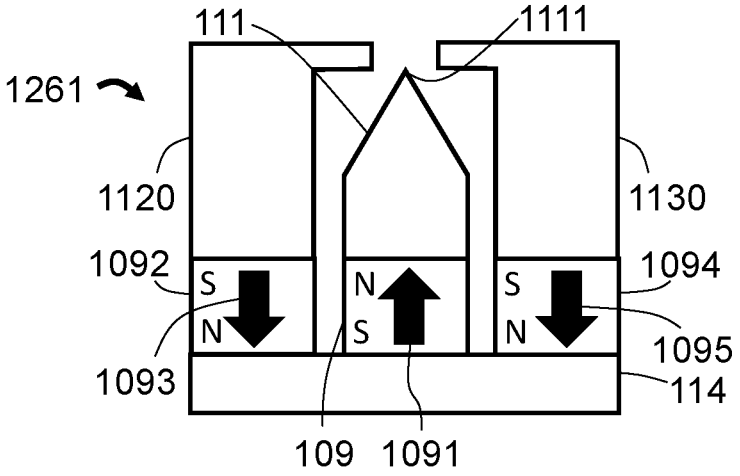

FIG. 87B illustrates cross-sectional view of the twelfth embodiment of MAG.

Figure 87C:
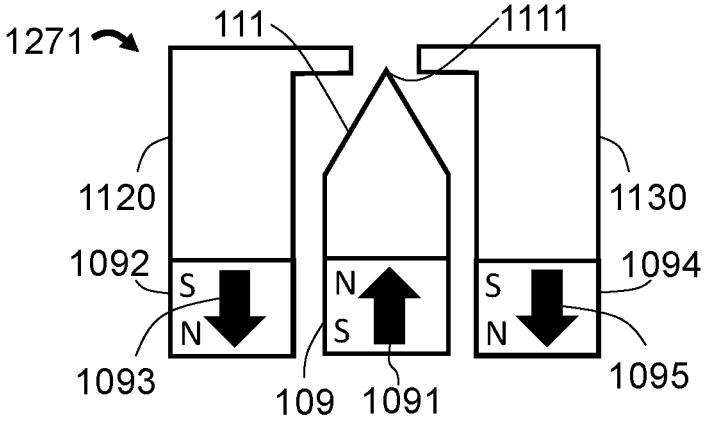

FIG. 87C illustrates cross-sectional view of the thirteenth embodiment of MAG.

Figure 88A:
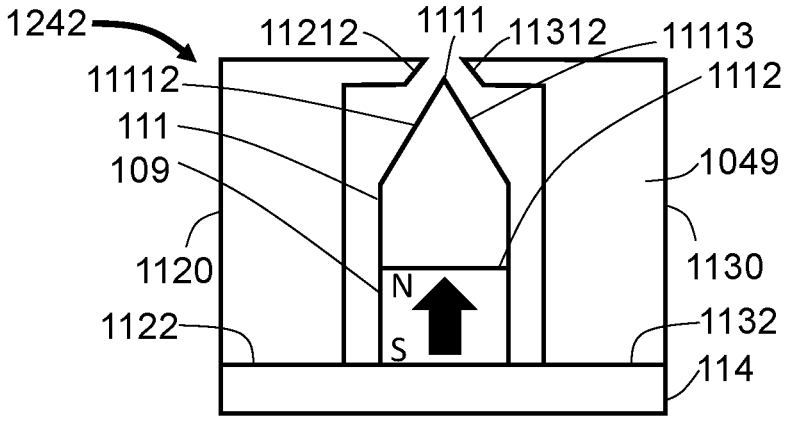

FIG. 88A illustrates cross-sectional view of the fourteenth embodiment of MAG.

Figure 88B:
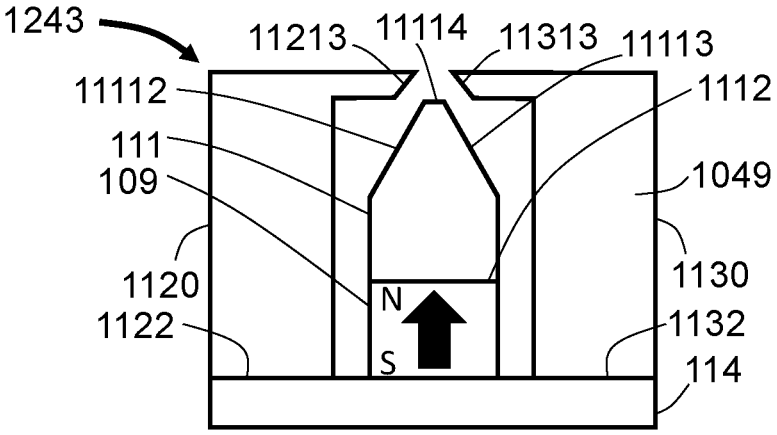

FIG. 88B illustrates cross-sectional view of the fifteenth embodiment of MAG.

Figure 88C:
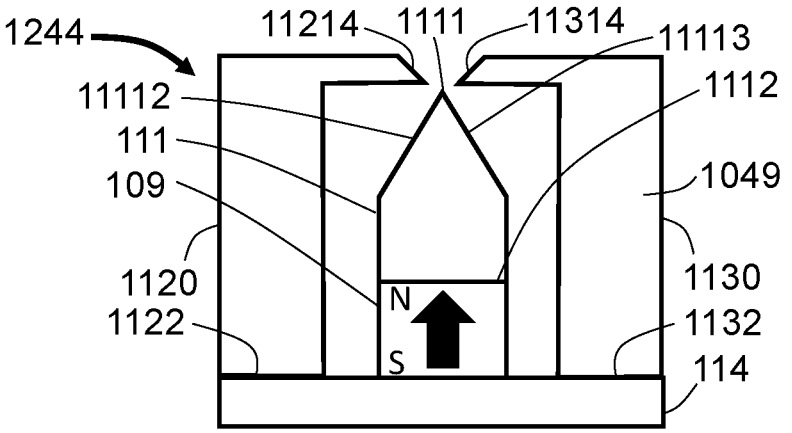

FIG. 88C illustrates cross-sectional view of the sixteenth embodiment of MAG.

Figure 89A:
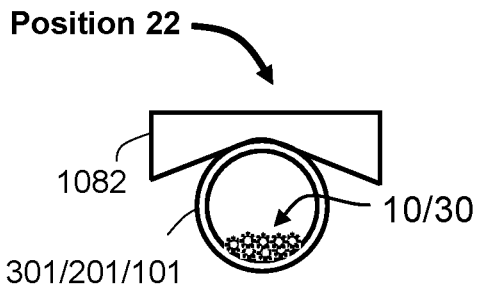

FIG. 89A illustrates the channel and its holder at lifted position from MAG.

Figure 89B:
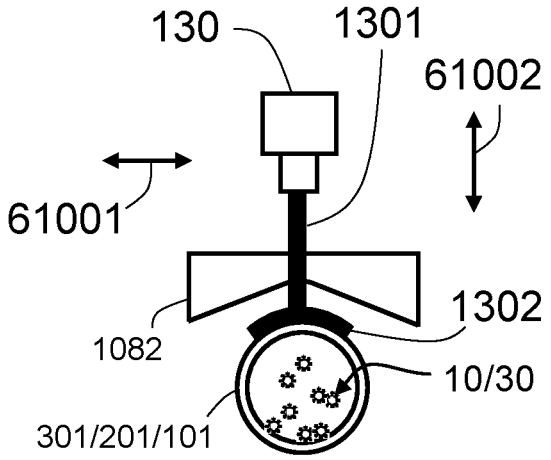

FIG. 89B illustrates mechanical vibration is applied to the channel through a second channel holder by a motor.

Figure 89C:
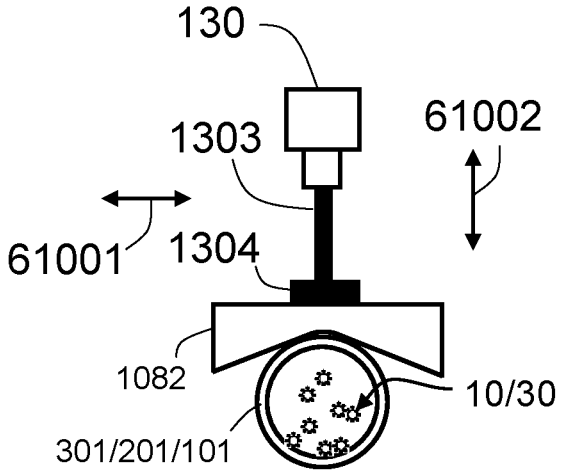

FIG. 89C illustrates mechanical vibration is applied to the channel holder by a motor through a vibration arm.

Figure 90A:
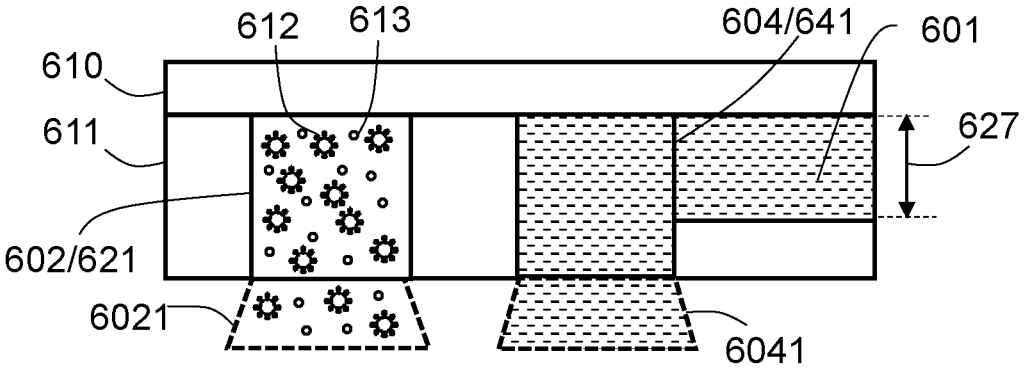

FIG. 90A illustrates a cross-sectional view of a portion of the FIG. 38A UFL including entity fluid inlet, buffer fluid inlet, and part of the UFL.

Figure 90B:
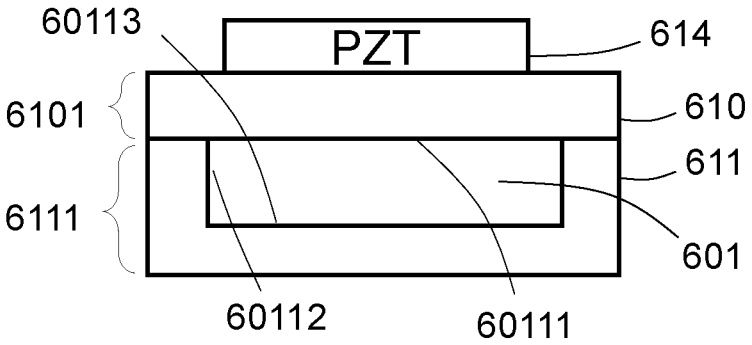

FIG. 90B illustrates s cross-sectional view of FIG. 38A UFL with PZT attached to top cover of the flow channel.

Figure 90C:
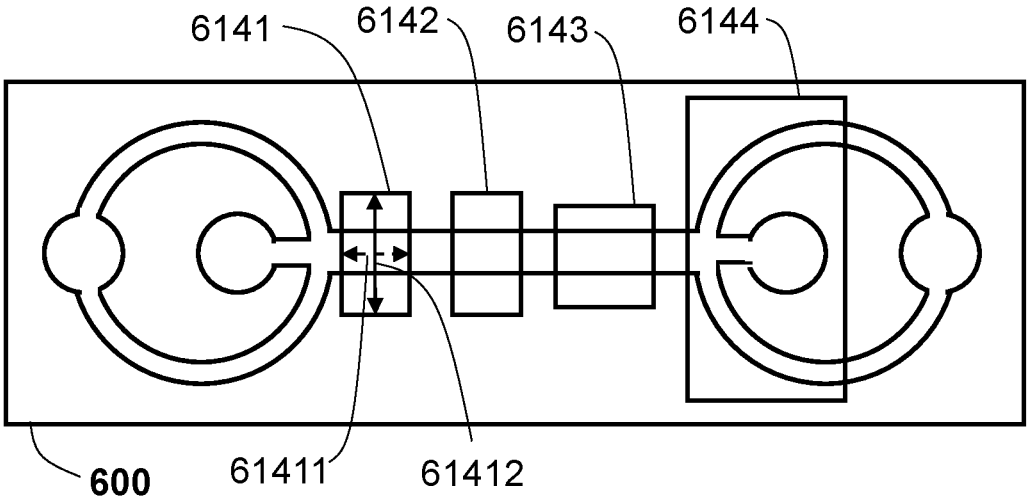

FIG. 90C illustrates top-down view FIG. 38A UFL device with multiple PZT attached to same top cover of same UFL device.

Figure 91A:
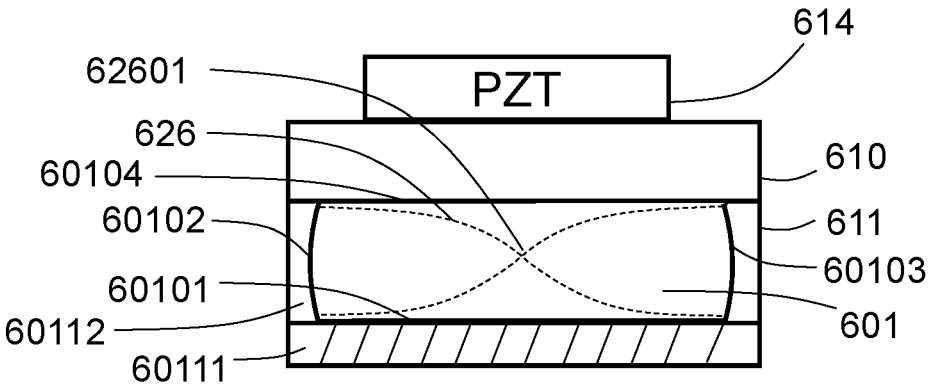

FIG. 91A illustrates cross-sectional view of a UFL similar to FIG. 90B but with a flow channel having circular curvature sides walls.

Figure 91B:
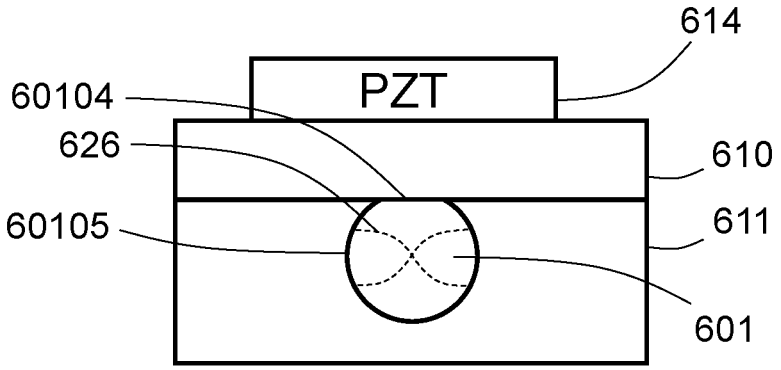

FIG. 91B illustrates cross-sectional view of a UFL similar to FIG. 91A but with a flow channel having a partial-circular shape formed within UFL substrate.

Figure 91C:
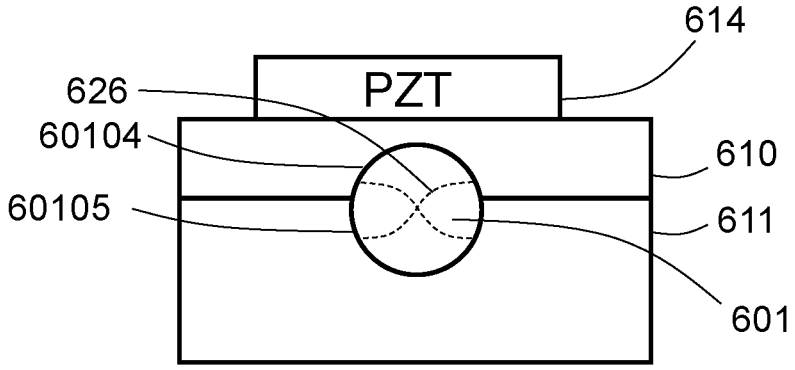

FIG. 91C illustrates cross-sectional view of a UFL similar to FIG. 91A but with a flow channel having a circular shape formed within both UFL substrate and UFL cover.

Figure 92A:
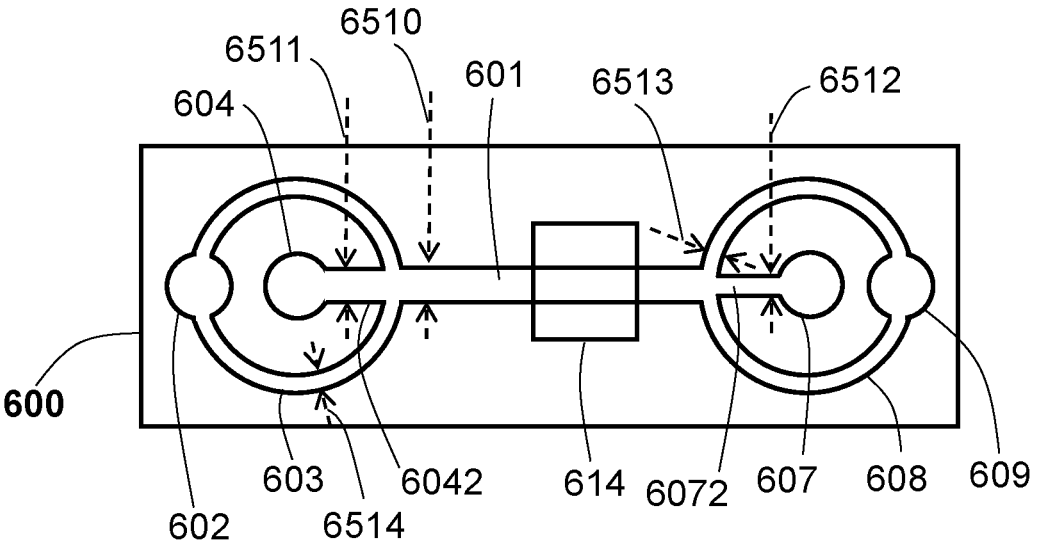

FIG. 92A illustrates top-down view of a UFL device having two inlets and two outlets.

Figure 92B:
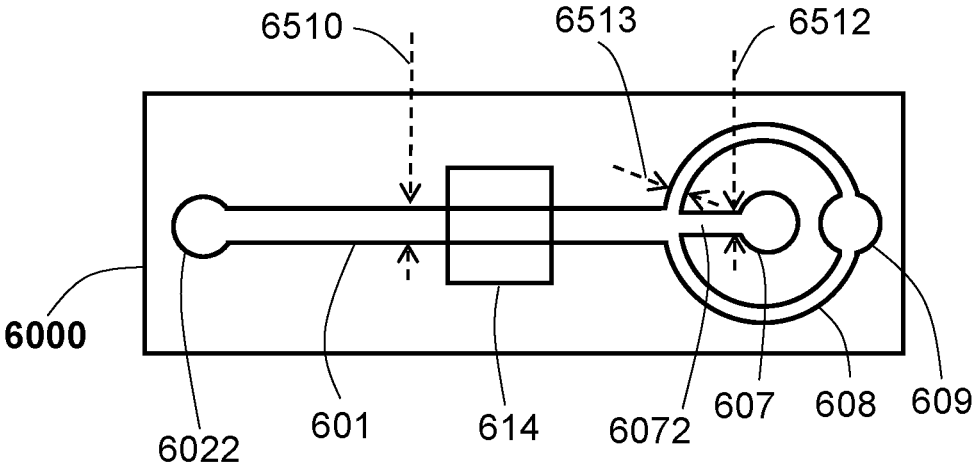

FIG. 92B illustrates top-down view of a UFL device one inlet and two outlets.

Figure 93A:
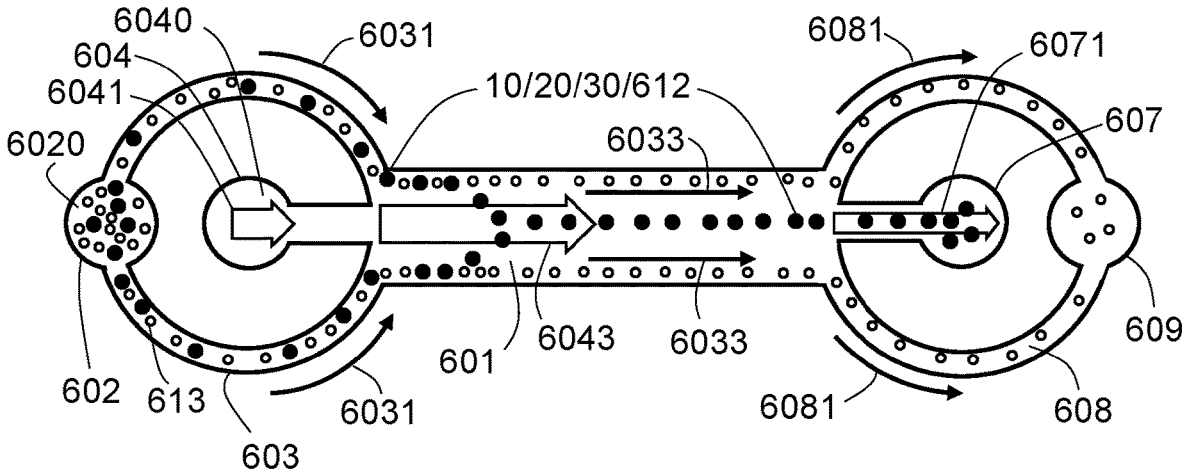

FIG. 93A illustrates operation of FIG. 92A UFL device.

Figure 93B:
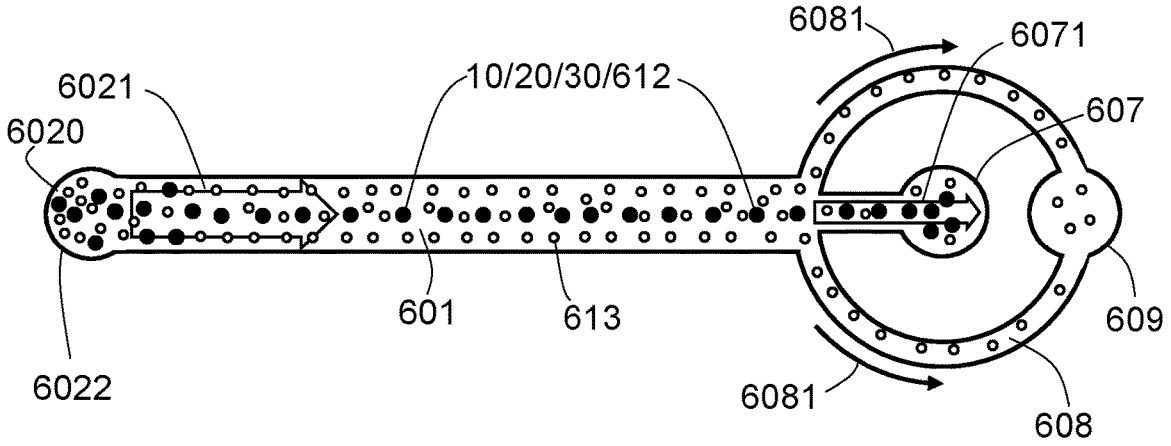

FIG. 93B illustrates operation of FIG. 92B UFL device.

Figure 94A:
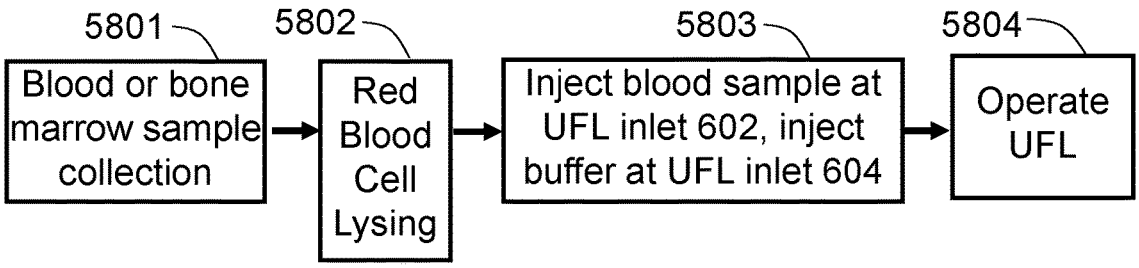

FIG. 94A illustrates embodiment of a process flow between blood or bone marrow sample collection and UFL operation.

Figure 94B:
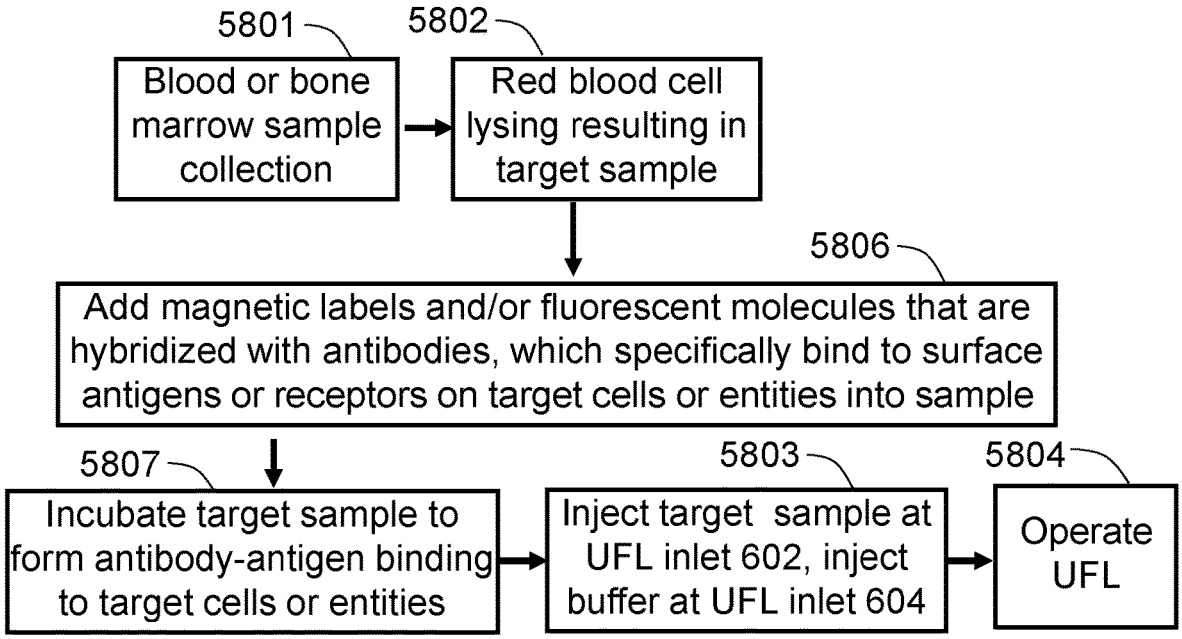

FIG. 94B illustrates embodiment of another process flow between blood or bone marrow sample collection and UFL operation.

Figure 95A:
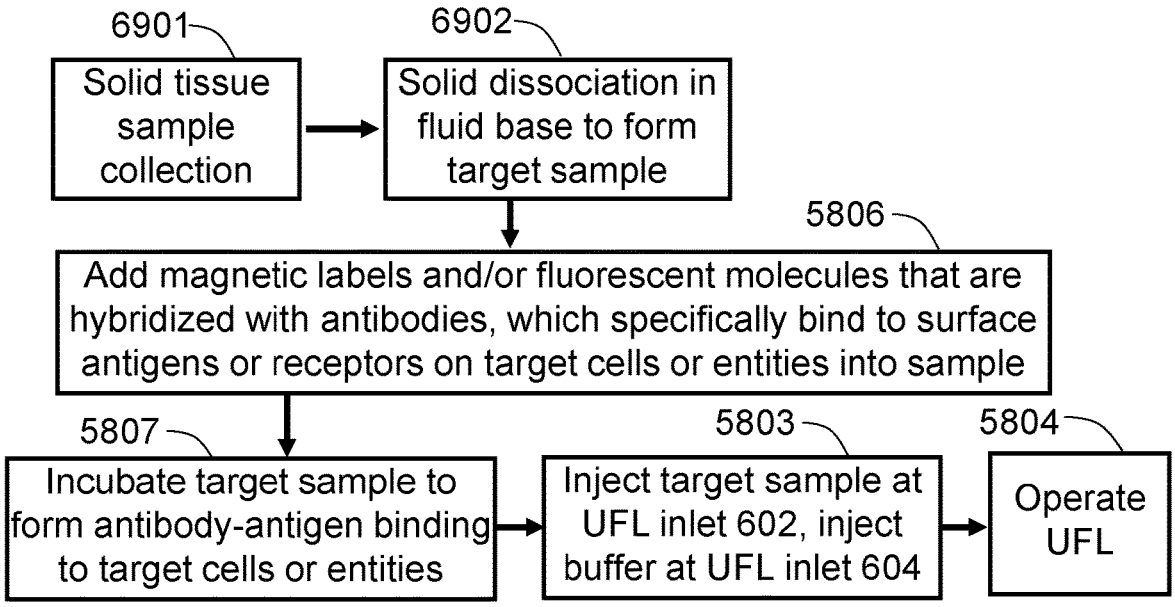

FIG. 95A illustrates embodiment of a process flow between solid sample collection and UFL operation.

Figure 95B:
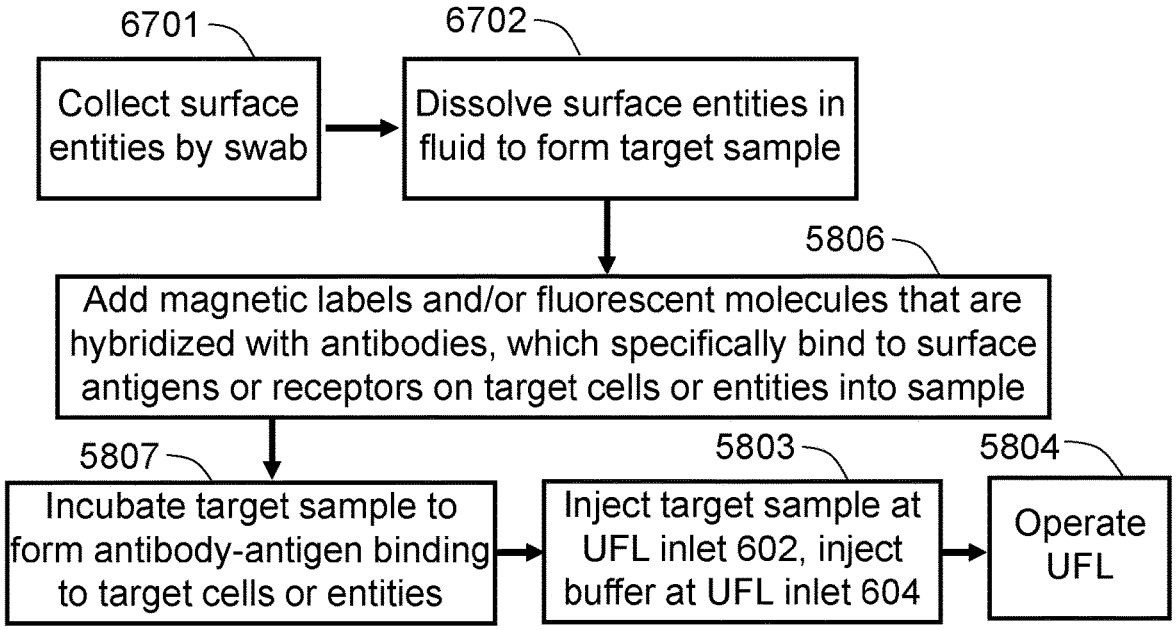

FIG. 95B illustrates embodiment of a process flow between surface sample collection and UFL operation.

Figure 96:
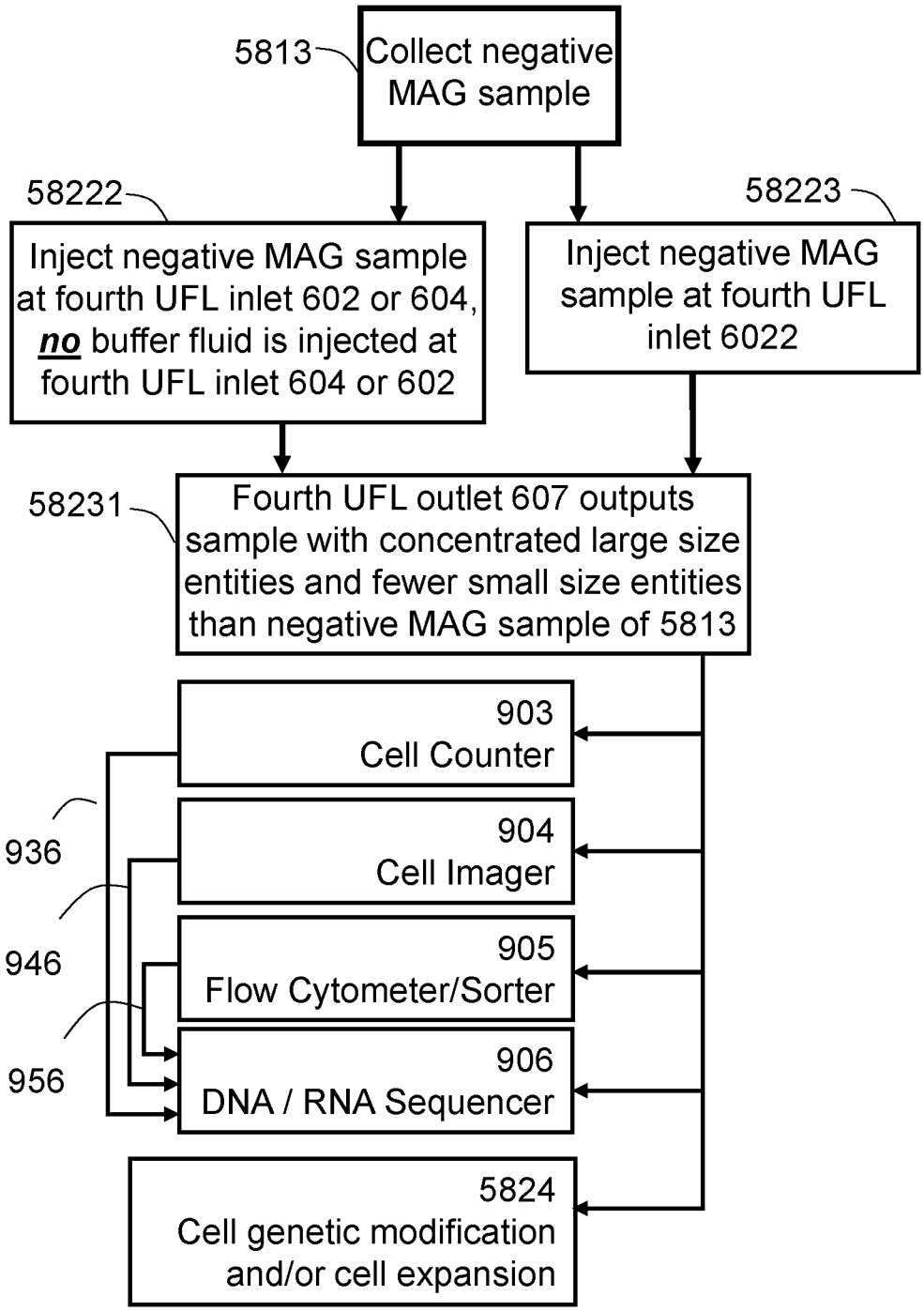

FIG. 96 illustrates embodiment of a process flow after negative MAG sample collection including UFL operation.

Figure 97:
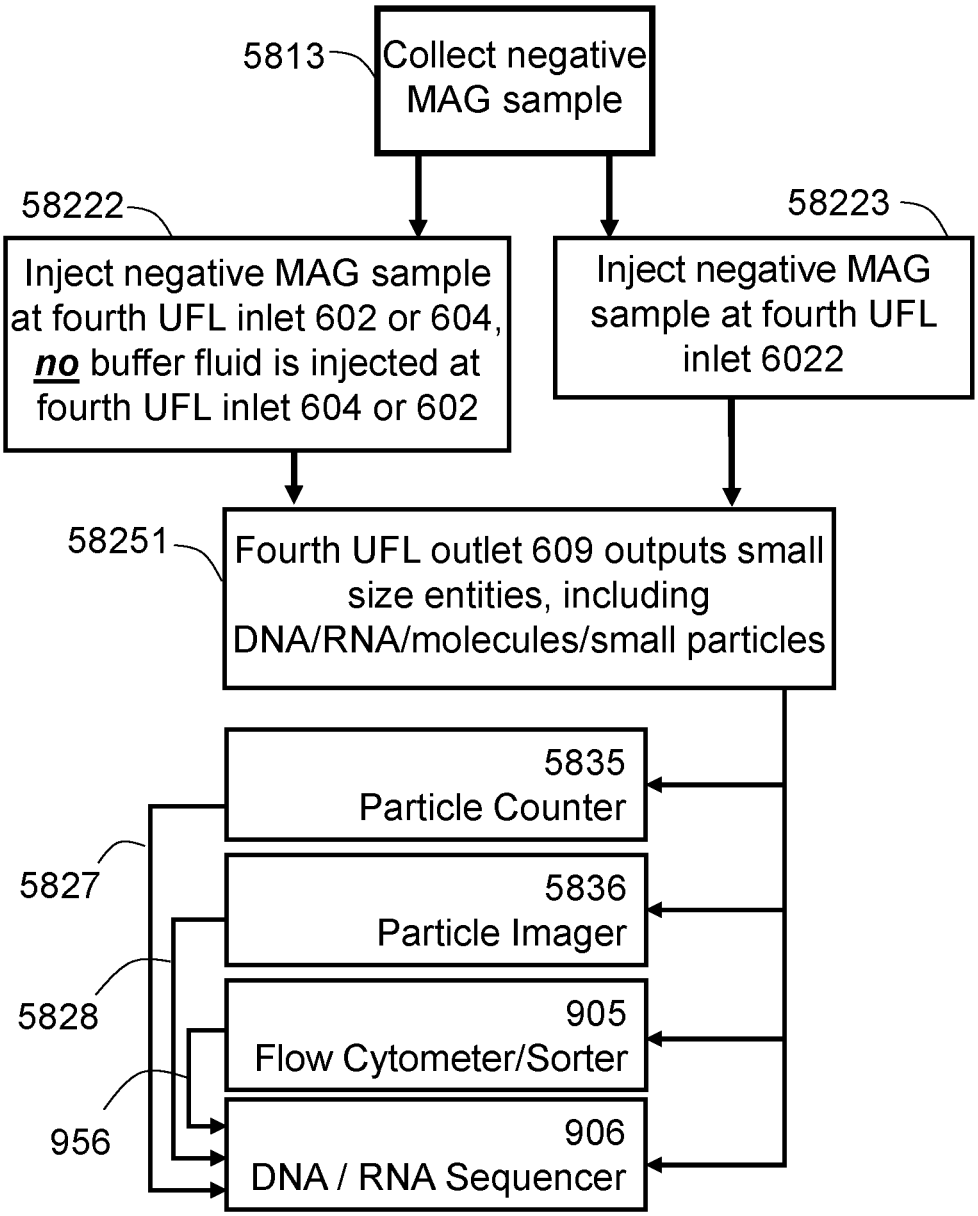

FIG. 97 illustrates embodiment of another process flow after negative MAG sample collection including UFL operation.

Figure 98:
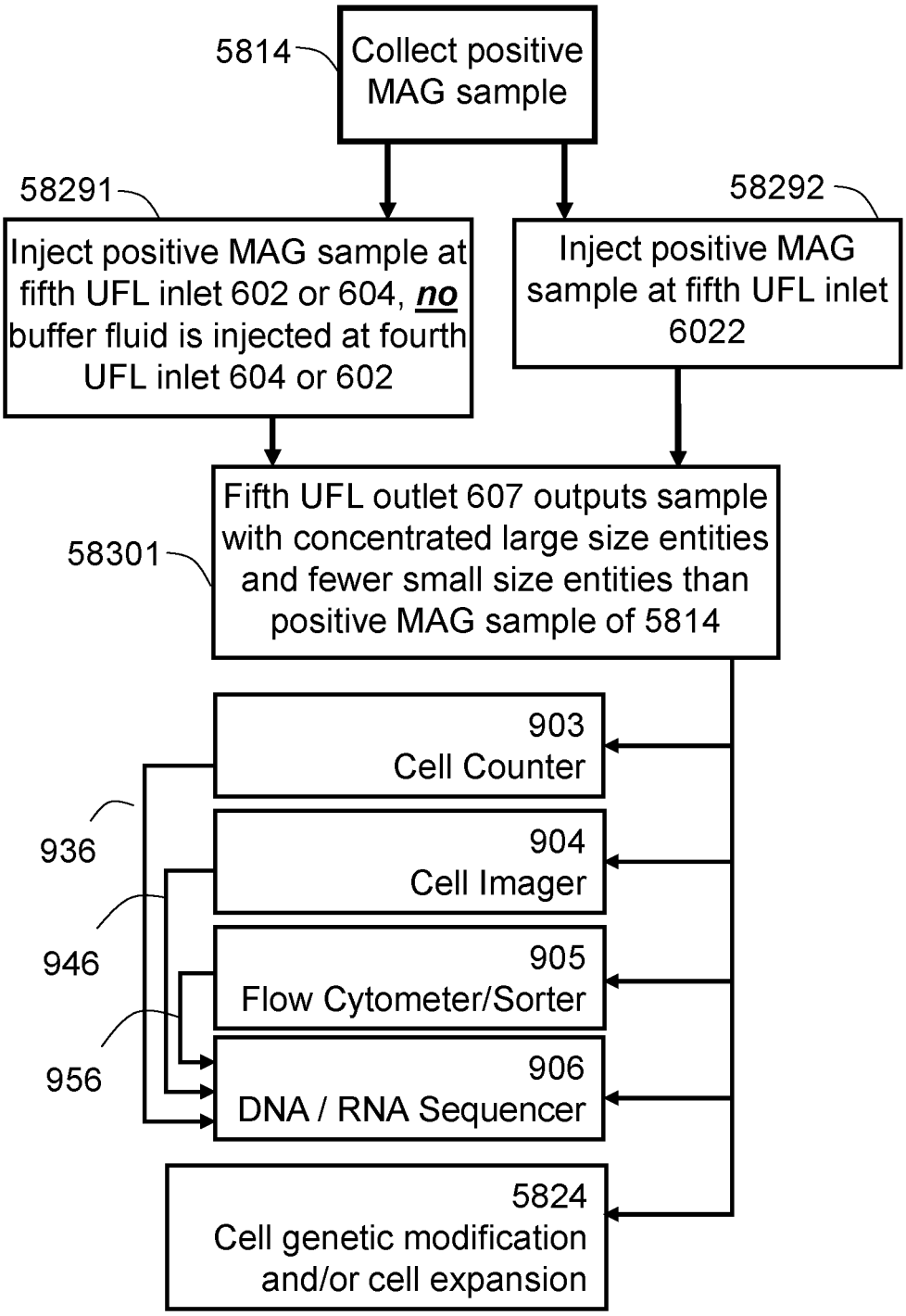

FIG. 98 illustrates embodiment of a process flow after positive MAG sample collection including UFL operation.

Figure 99:
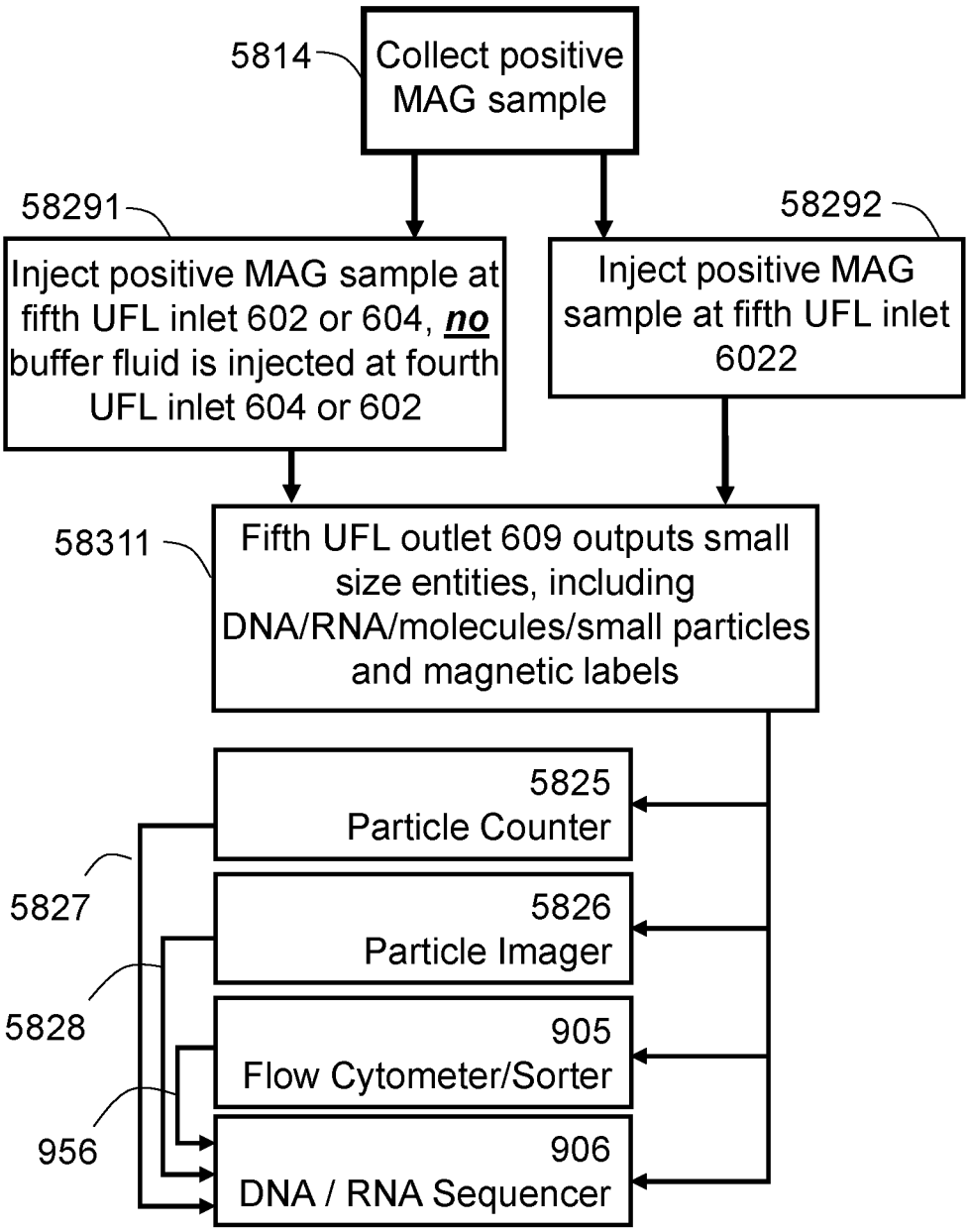

FIG. 99 illustrates embodiment of another process flow after positive MAG sample collection including UFL operation.

Figure 100A:
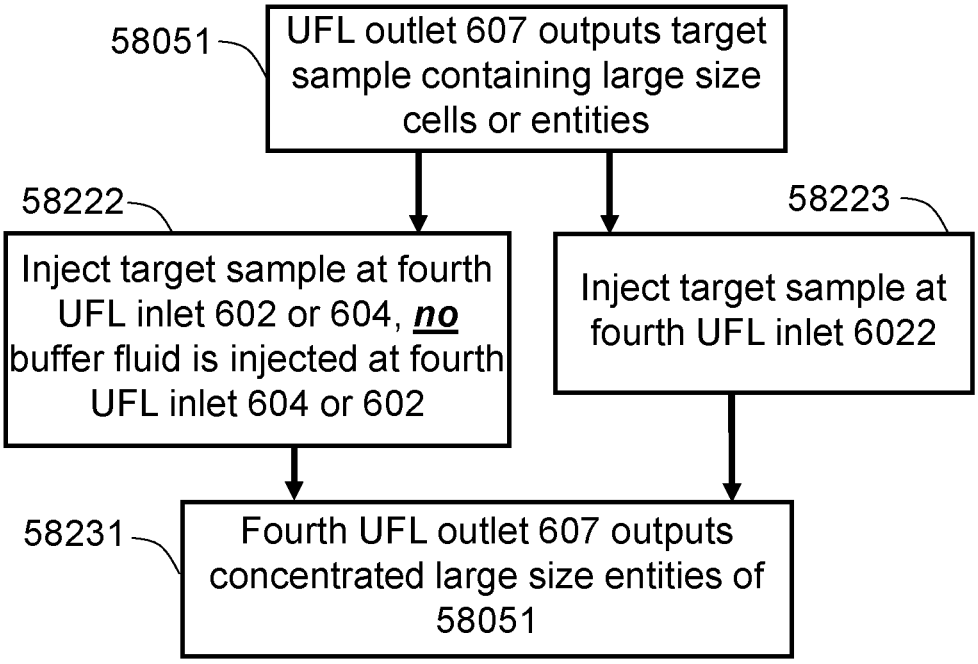

FIG. 100A illustrates embodiment of a process flow including two UFLs in serial operation.

Figure 100B:
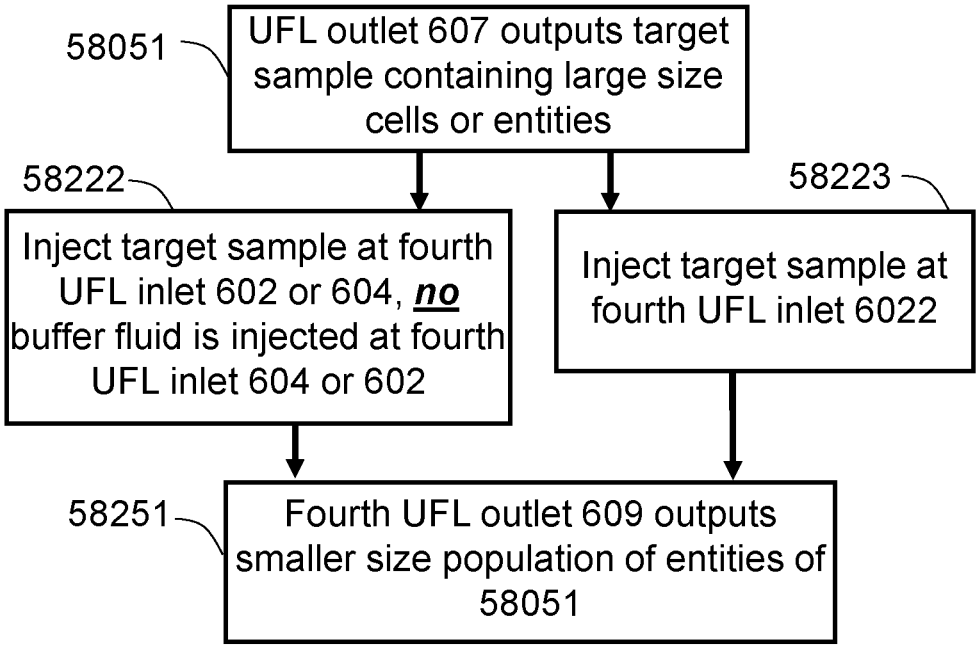

FIG. 100B illustrates embodiment of another process flow including two UFLs in serial operation.

Figure 101A:
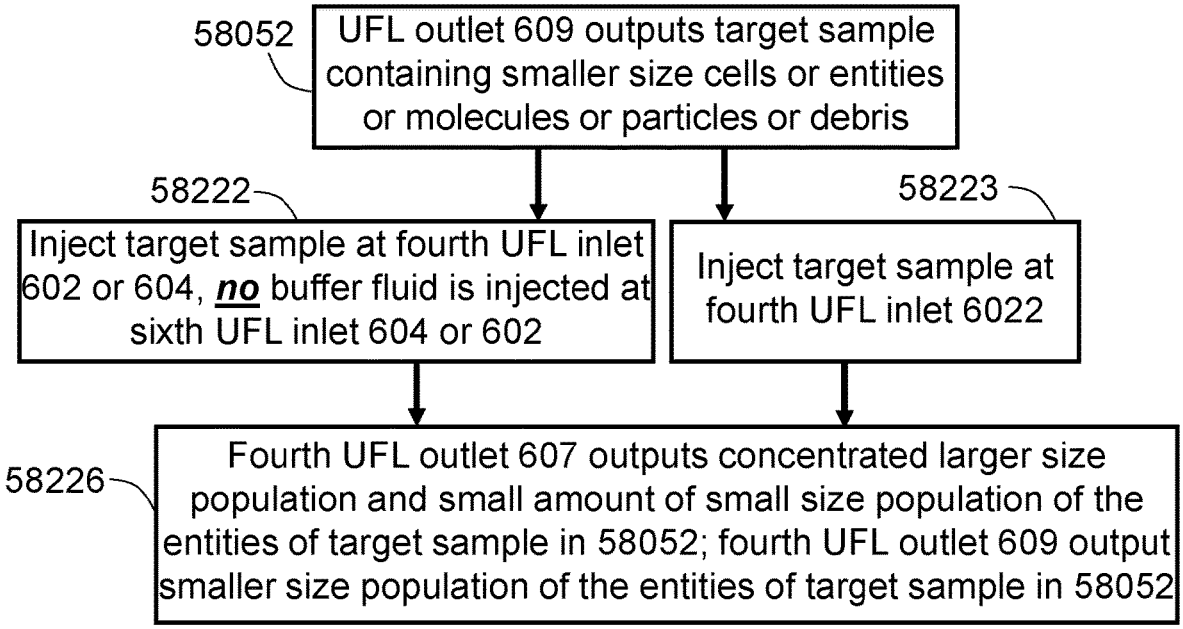

FIG. 101A illustrates embodiment of yet another process flow including two UFLs in serial operation.

Figure 101B:
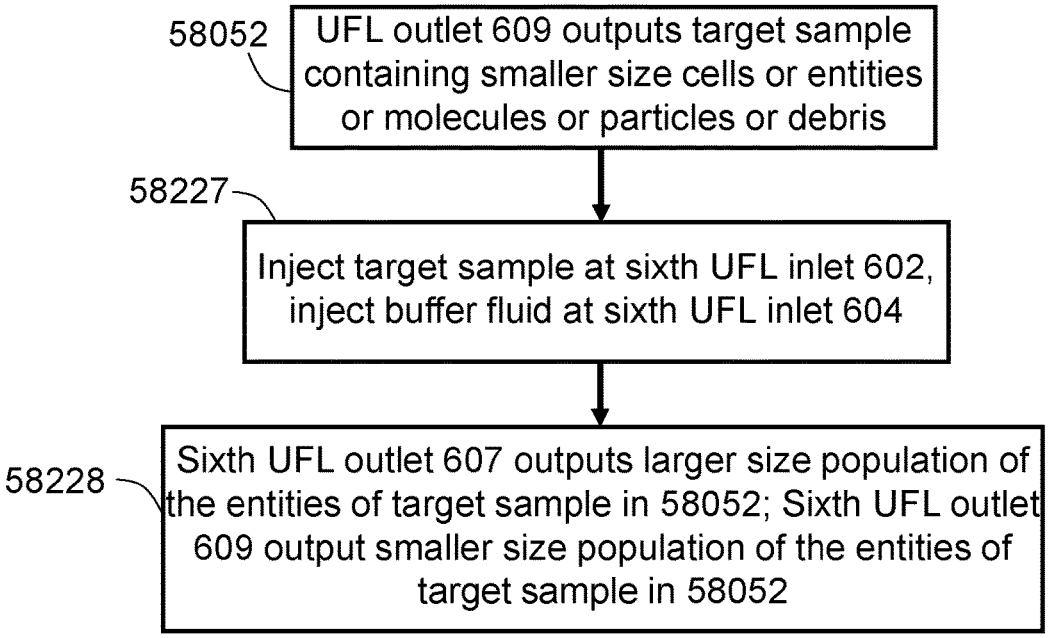

FIG. 101B illustrates embodiment of yet another process flow including two UFLs in serial operation.

Figure 102:
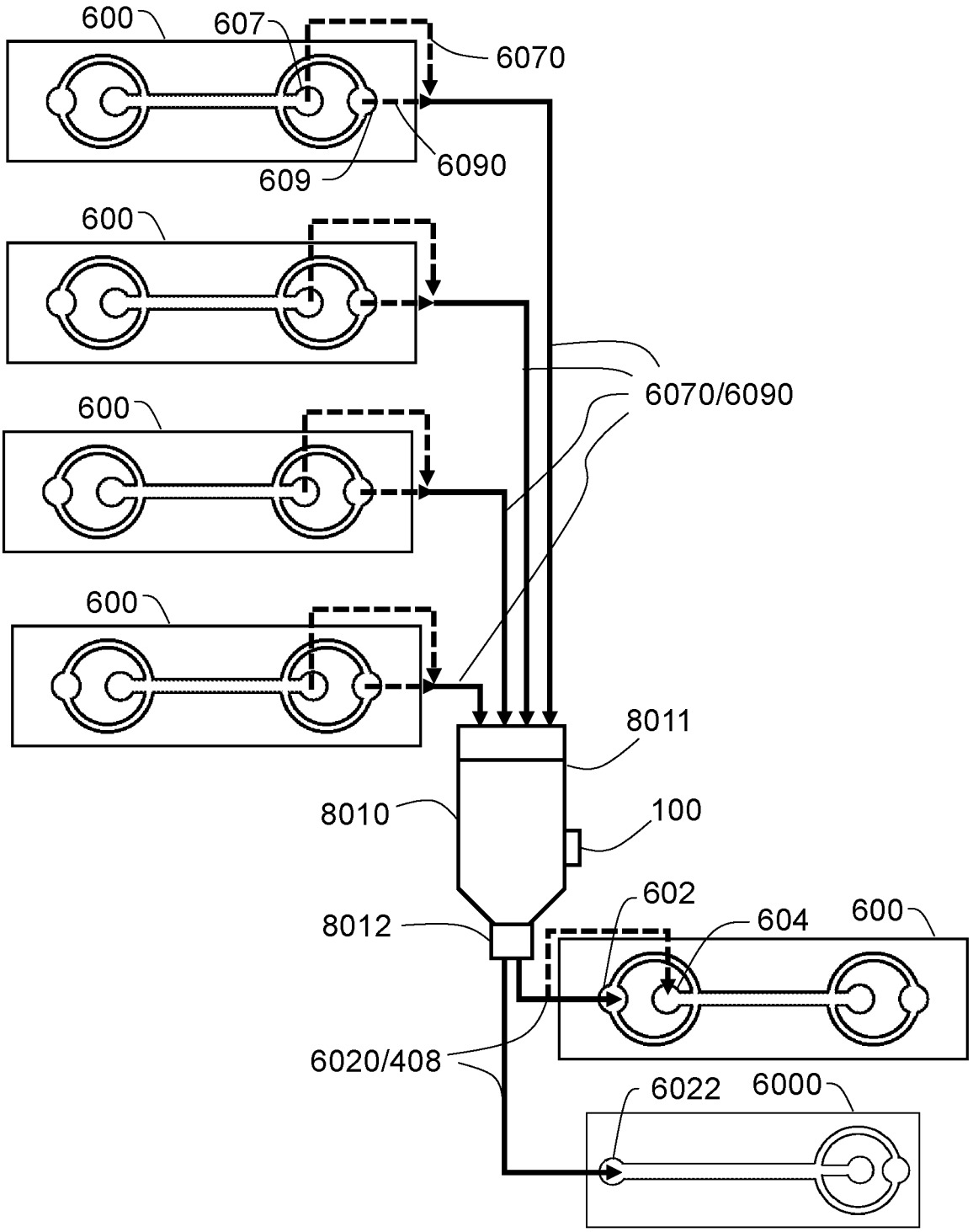

FIG. 102 illustrates embodiment of a method of operating UFLs in serial configuration.

Figure 103:
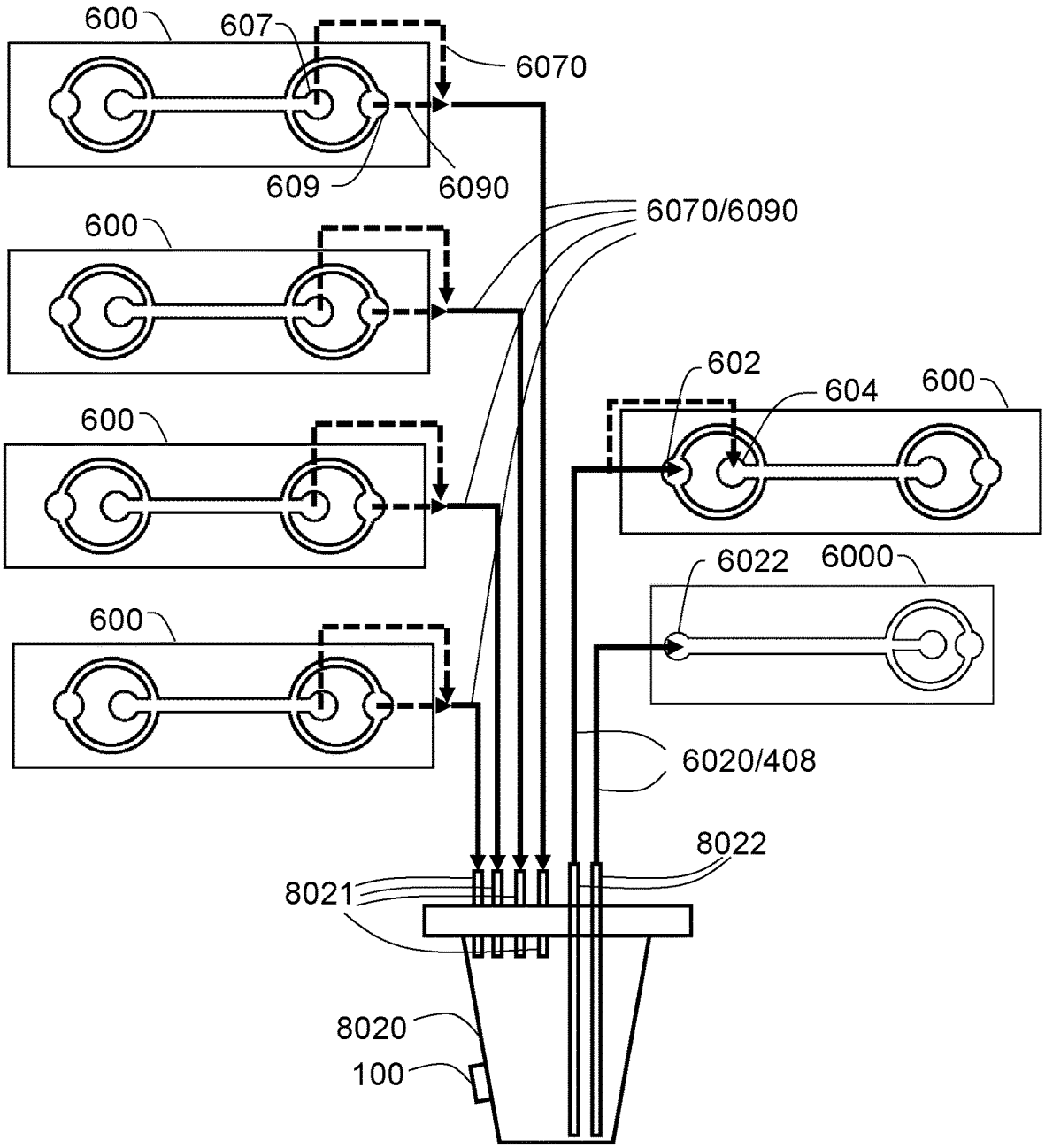

FIG. 103 illustrates embodiment of another method of operating UFLs in serial configuration.

Figure 104:
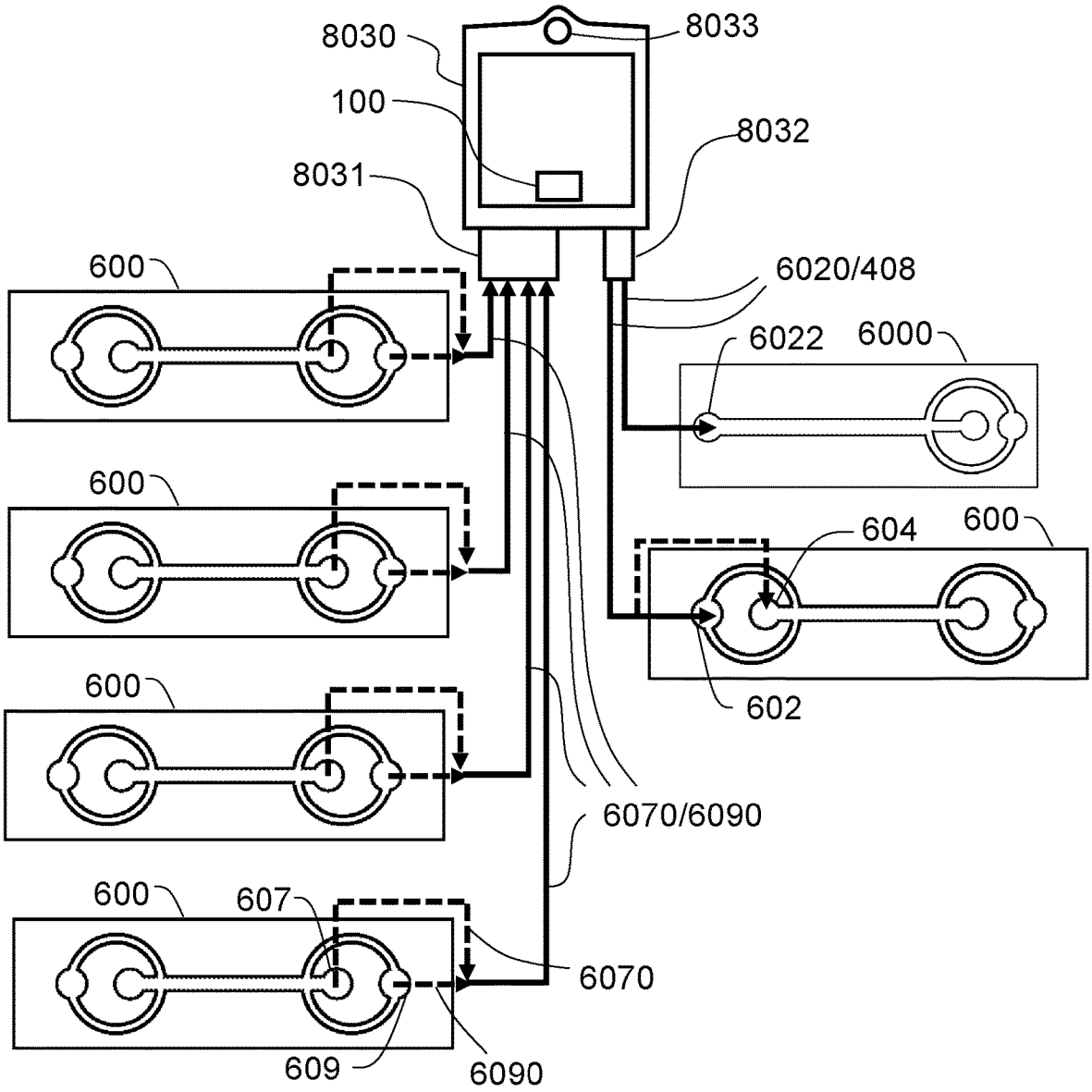

FIG. 104 illustrates embodiment of yet another method of operating UFLs in serial configuration.

Figure 105A:
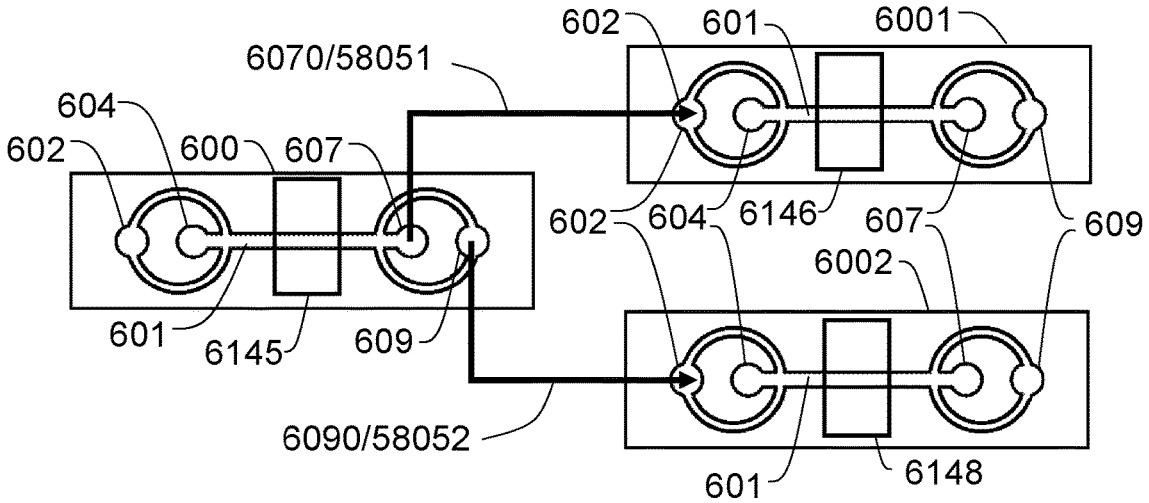

FIG. 105A illustrates embodiment of another method of operating UFLs in serial configuration.

Figure 105B:
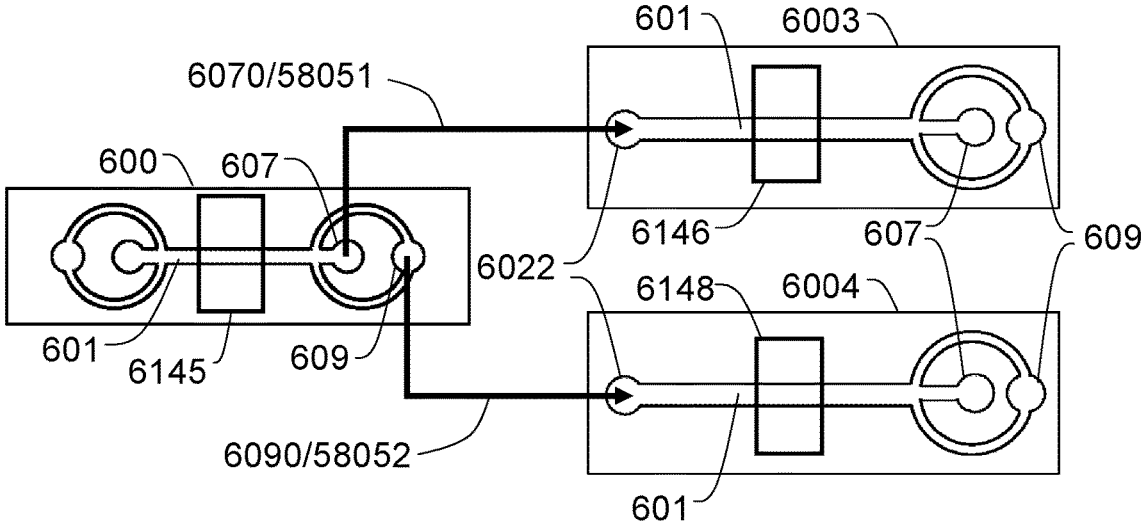

FIG. 105B illustrates embodiment of yet another method of operating UFLs in serial configuration.

Figure 106A:
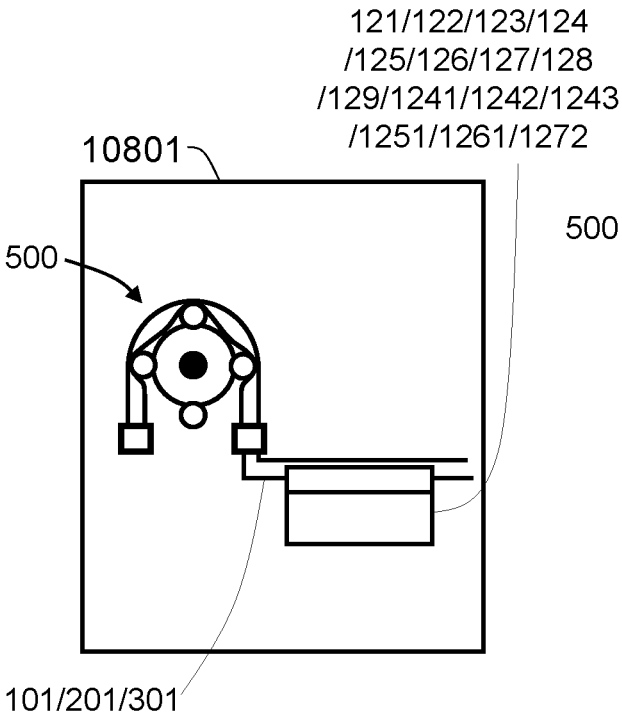

FIG. 106A illustrates embodiment of MAG in a module configuration.

Figure 106B:
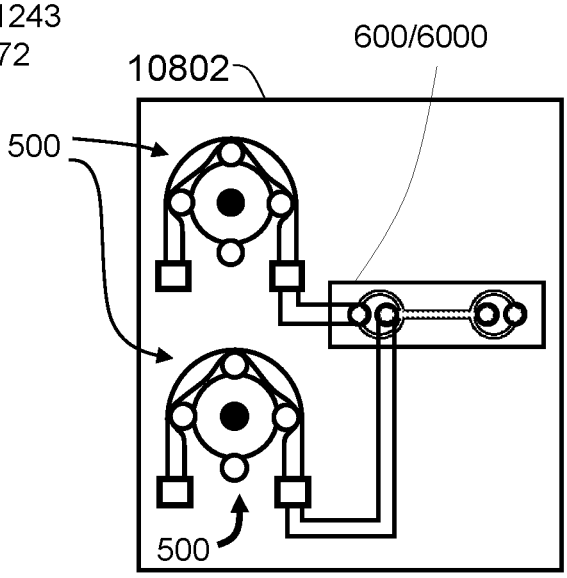

FIG. 106B illustrates embodiment of UFL in a module configuration.

Figure 106C:
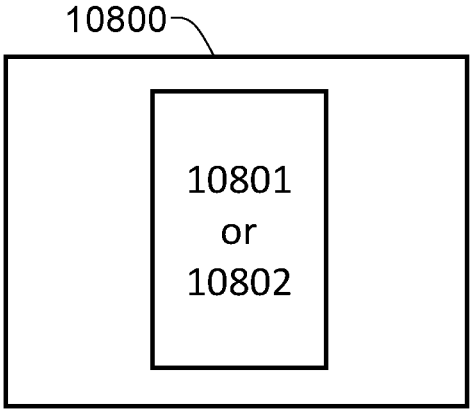

FIG. 106C illustrates embodiment of a system including a single module of MAG or a single module of UFL.

Figure 106D:
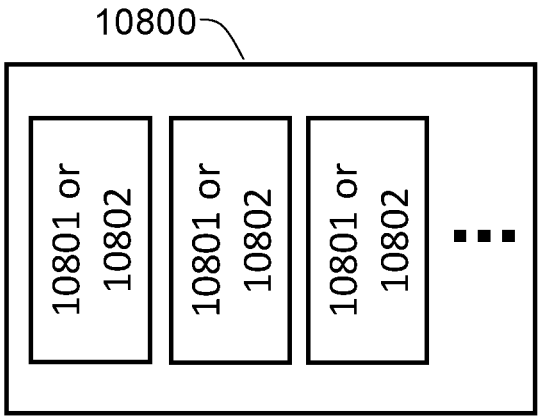

FIG. 106D illustrates embodiment of a system including multiple modules of MAG and UFL.

Figure 107:
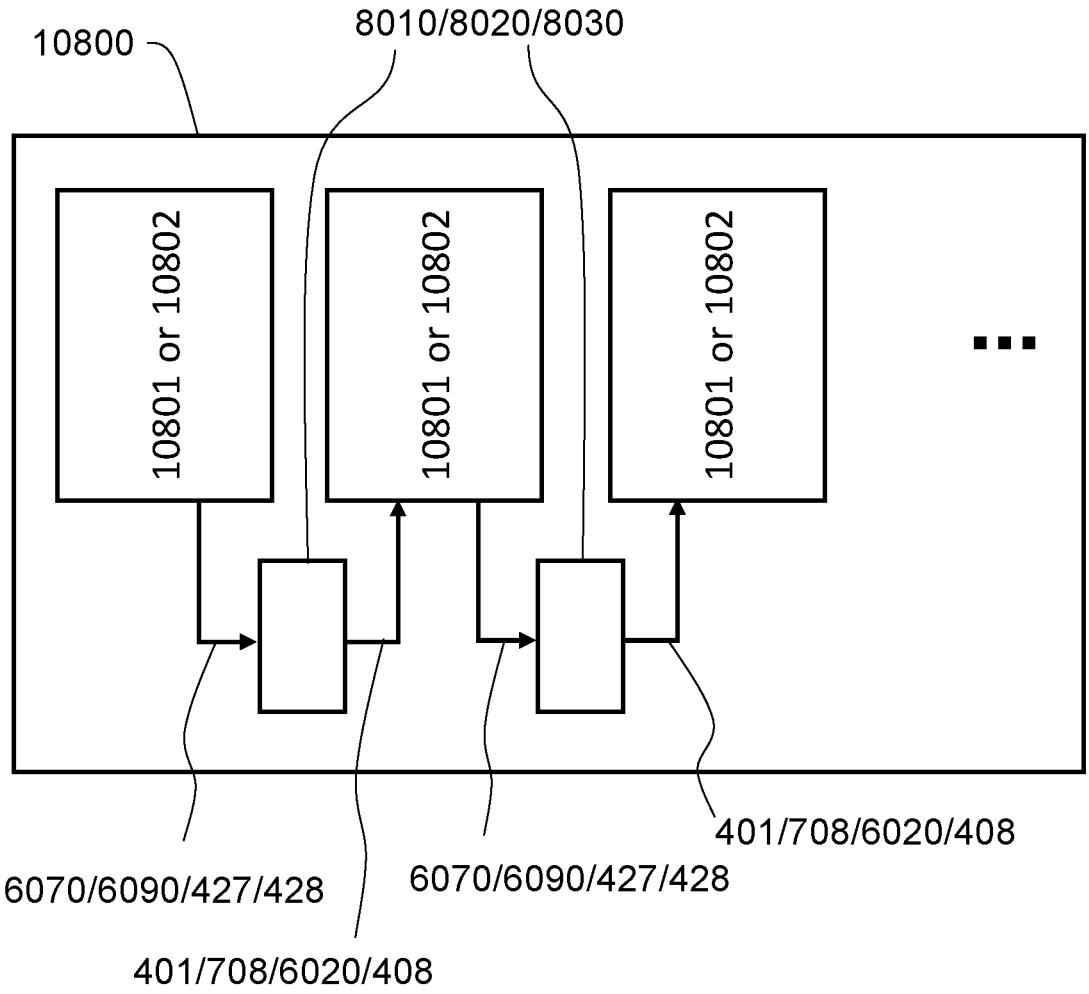

FIG. 107 illustrates embodiment of a system including multiple modules of MAG and UFL with fluidic sample flowing through the modules in serial.

Figure 108A:
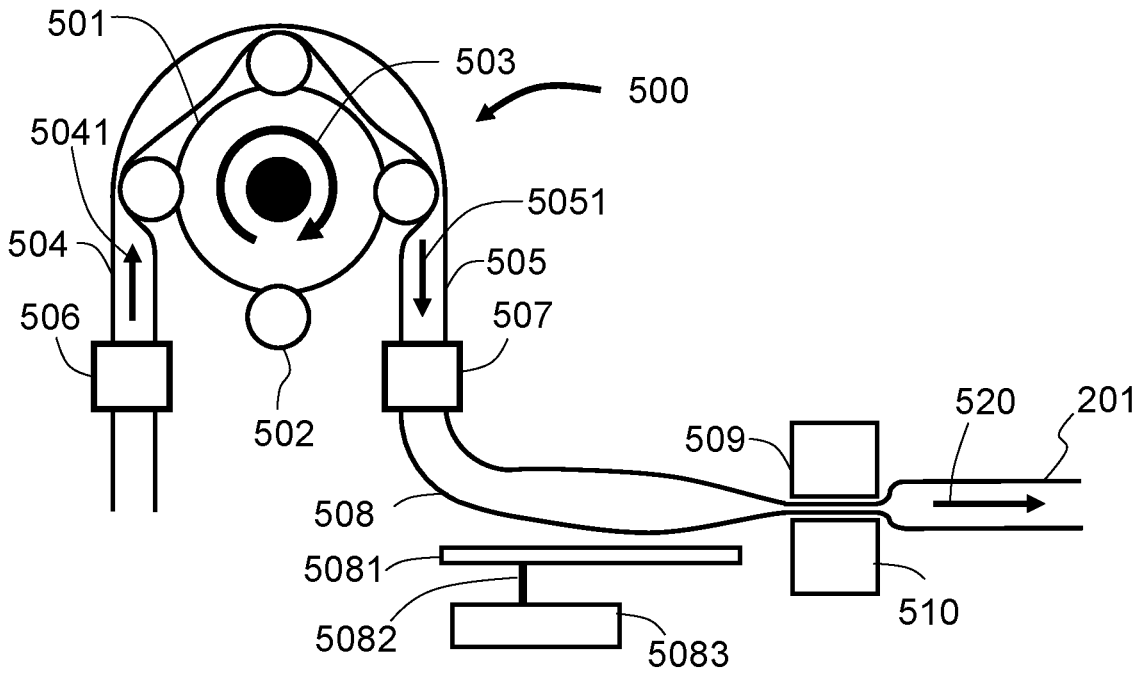

FIG. 108A illustrates FIG. 33A flexible channel attached to the output port of a peristaltic pump having a blockage sensor in proximity to the flexible channel.

Figure 108B:
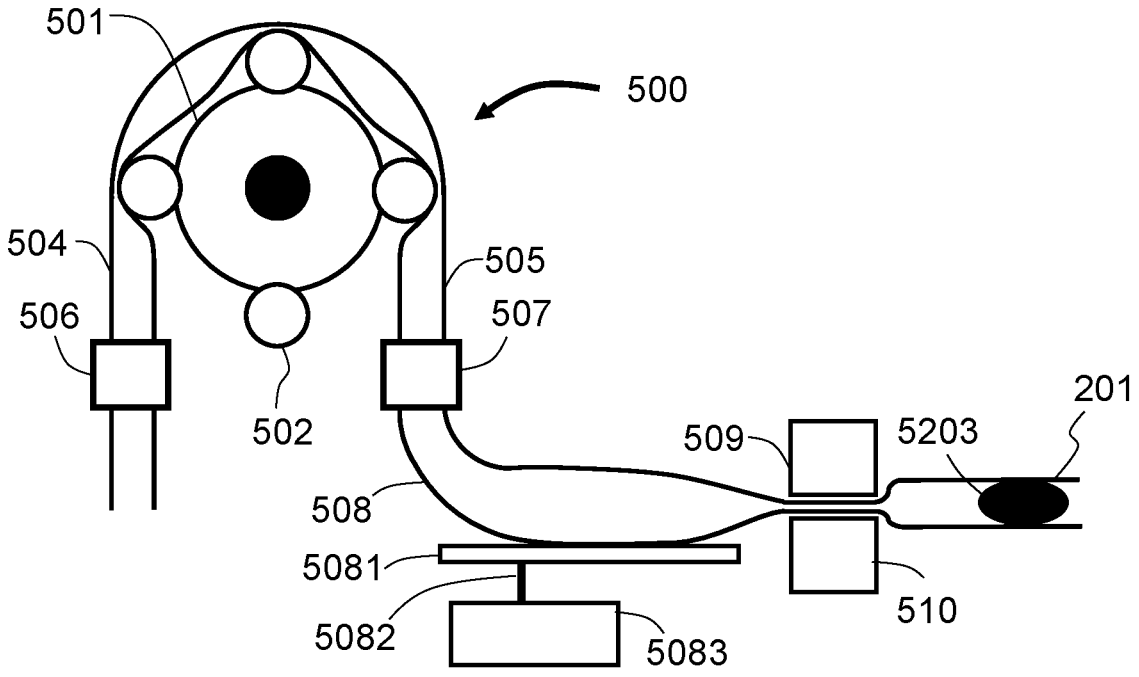

FIG. 108B illustrates FIG. 108A flexible channel expands due to blockage in fluidic line and contacts blockage sensor.

Figure 109A:
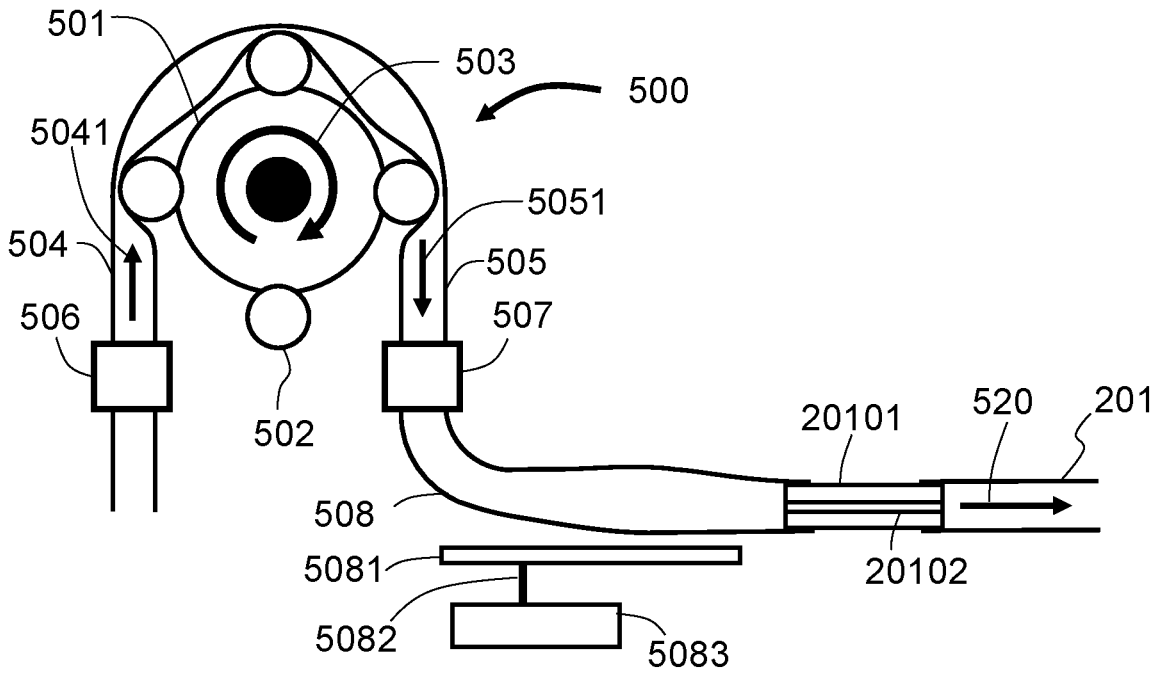

FIG. 109A illustrates a narrow inside diameter flow channel is used to replace the flow limiter of FIG. 108A to reduce flow rate pulsation.

Figure 109B:
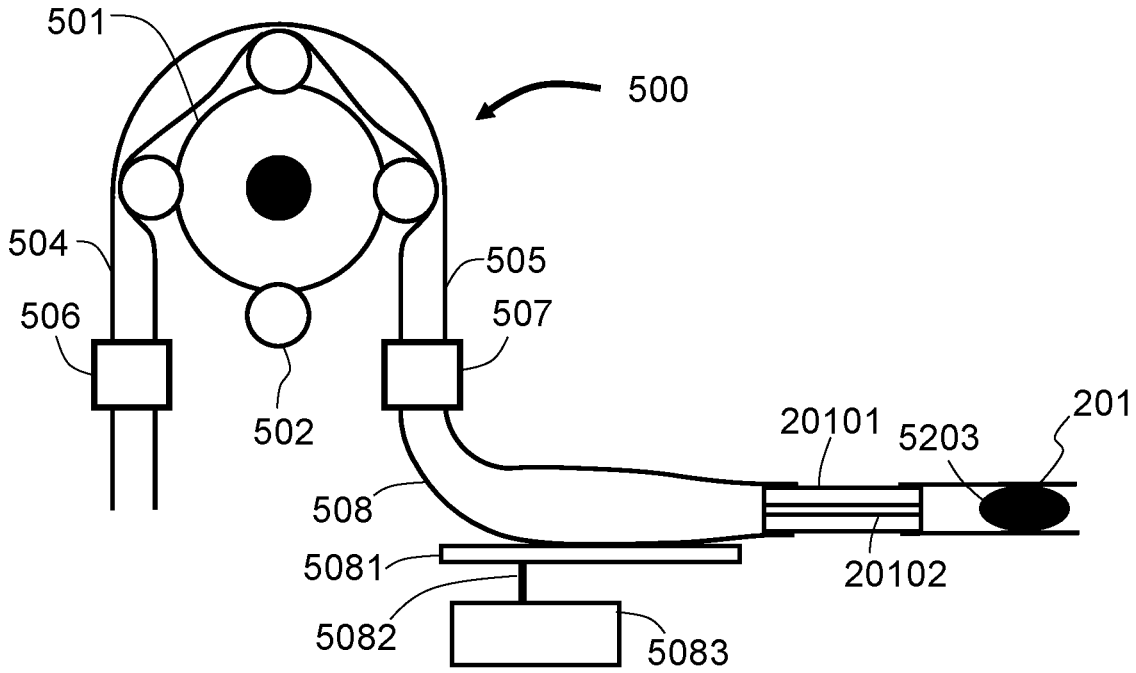

FIG. 109B illustrates FIG. 109A flexible channel expands due to blockage in fluidic line and contacts blockage sensor.

Figure 110A:
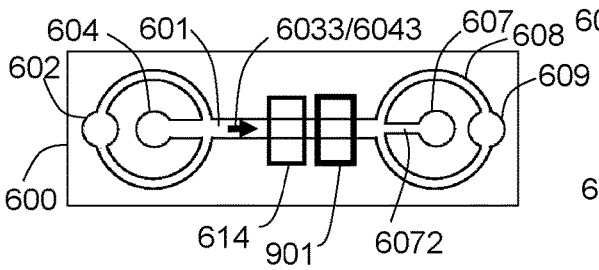

FIG. 110A illustrates an embodiment of a UFL having two inlets and an optical detector around main channel of the UFL.

Figure 110B:
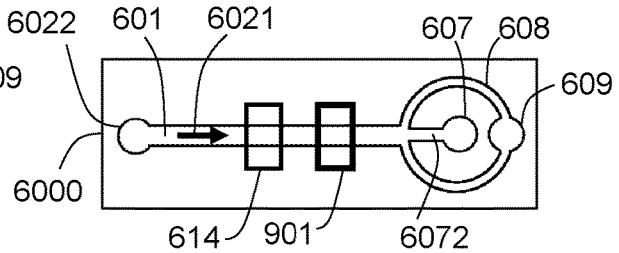

FIG. 110B illustrates an embodiment of a UFL having one inlet and an optical detector around main channel of the UFL.

Figure 110C:
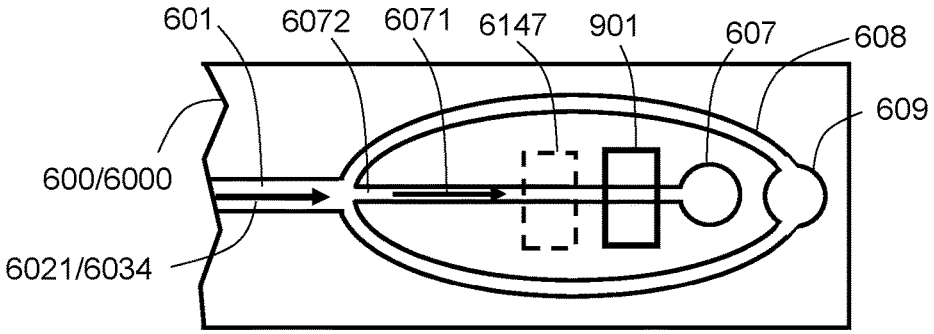

FIG. 110C illustrates an embodiment of a UFL having an optical detector around sample outlet channel of the UFL.

Figure 110D:
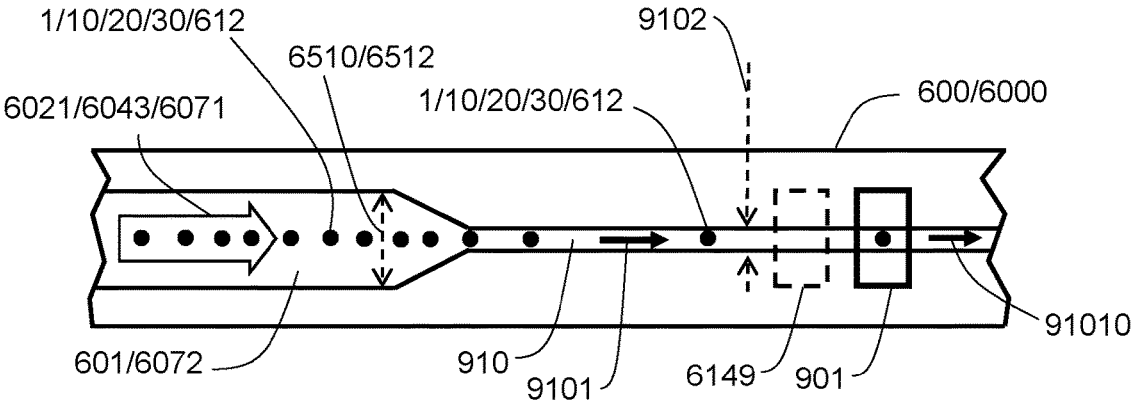

FIG. 110D illustrates another embodiment of a UFL having an optical detector around an extended channel.

Figure 111A:
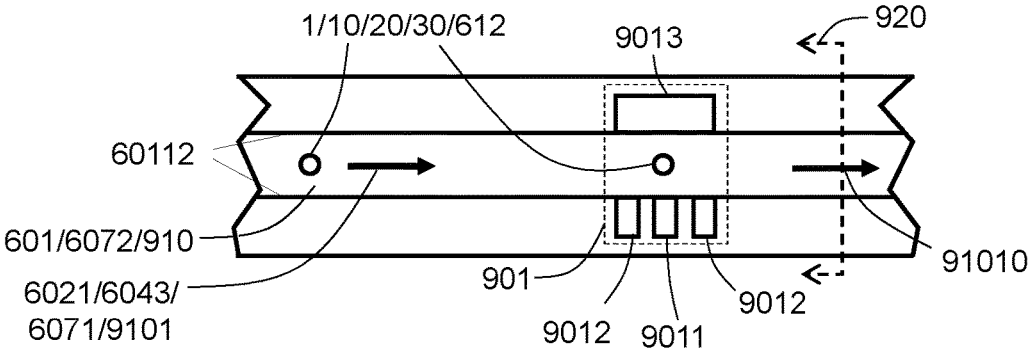

FIG. 111A illustrates an embodiment of an optical detector having illuminator, forward scatter sensors and back scatter sensors being used to detect a biological entity.

Figure 111B:
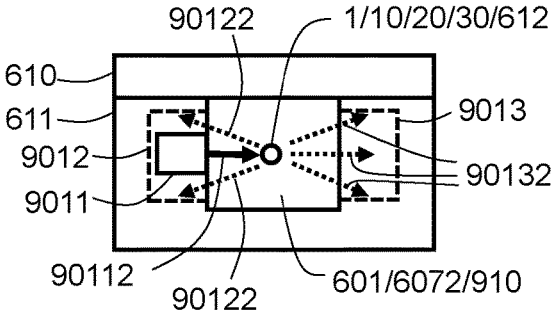

FIG. 111B illustrates an embodiment of FIG. 111A optical detector being embedded in channel walls with back scatter sensors and the illuminator centered along same horizontal line.

Figure 111C:
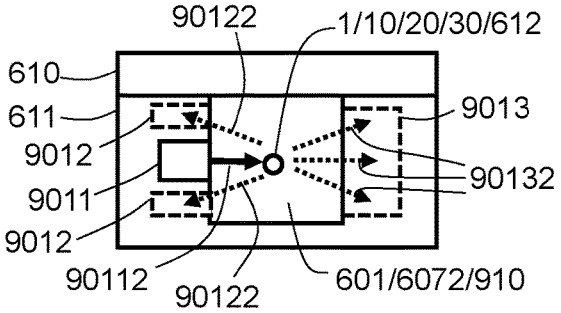

FIG. 111C illustrates an embodiment of FIG. 111A optical detector being embedded in channel walls with back scatter sensors being above or below the illuminator.

Figure 111D:
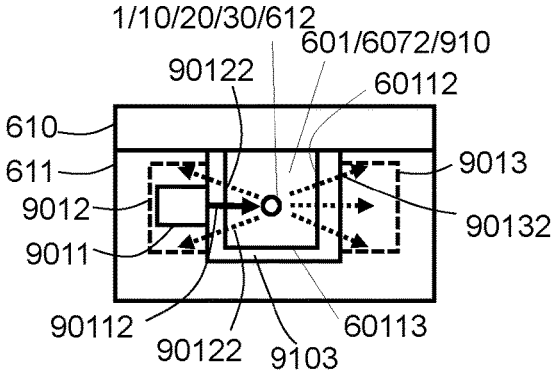

FIG. 111D illustrates an embodiment of FIG. 111A optical detector being embedded in channel walls with an optical transparent protective layer coated within the channel.

Figure 111E:
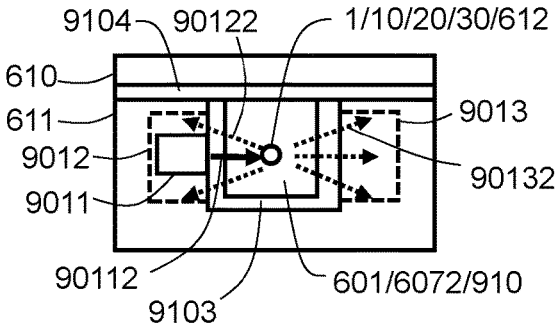

FIG. 111E illustrates an embodiment of FIG. 111A optical detector being embedded in channel walls with an optical transparent protective layer coated within the channel and an optical absorptive layer at the bottom of the cover forming the top wall of the channel.

Figure 112A:
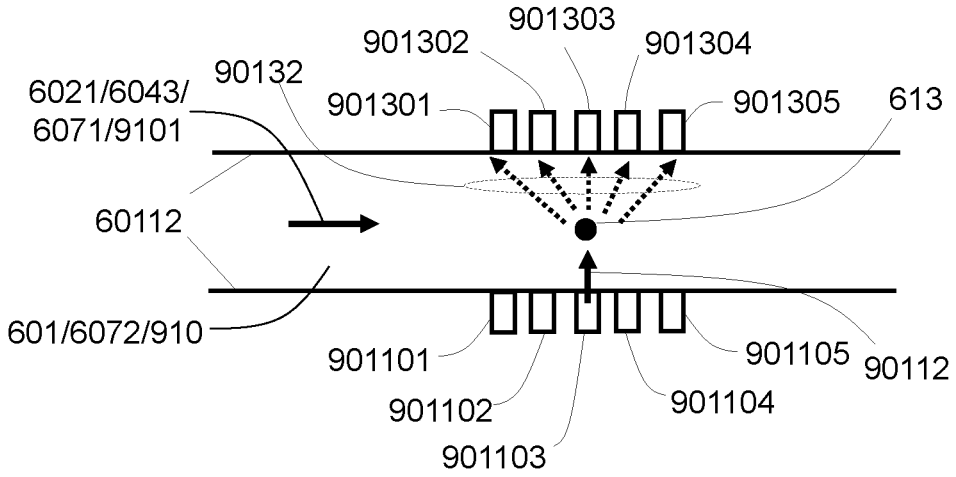

FIG. 112A illustrates an embodiment of an optical detector having illuminator array and forward scatter sensor array being used to detect a small size biological entity.

Figure 112B:
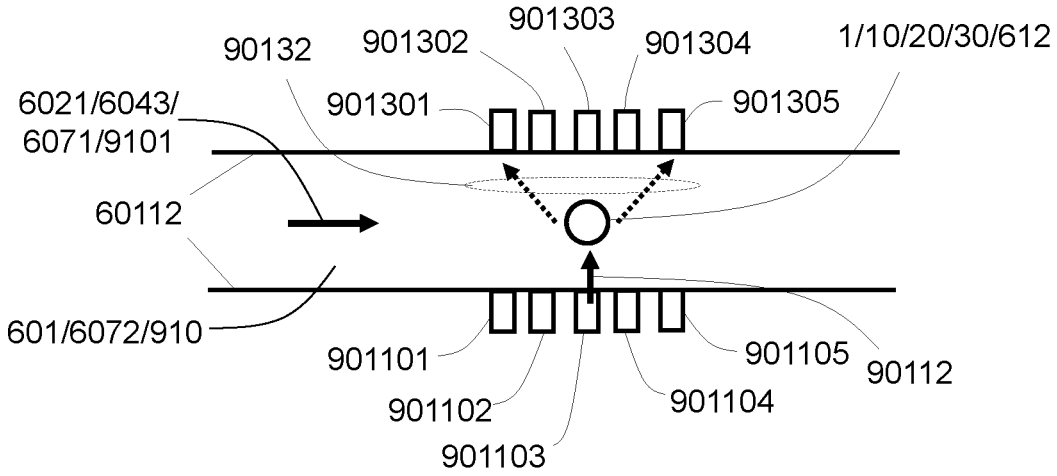

FIG. 112B illustrates an embodiment of an optical detector having illuminator array and forward scatter sensor array being used to detect a large size biological entity.

Figure 113A:
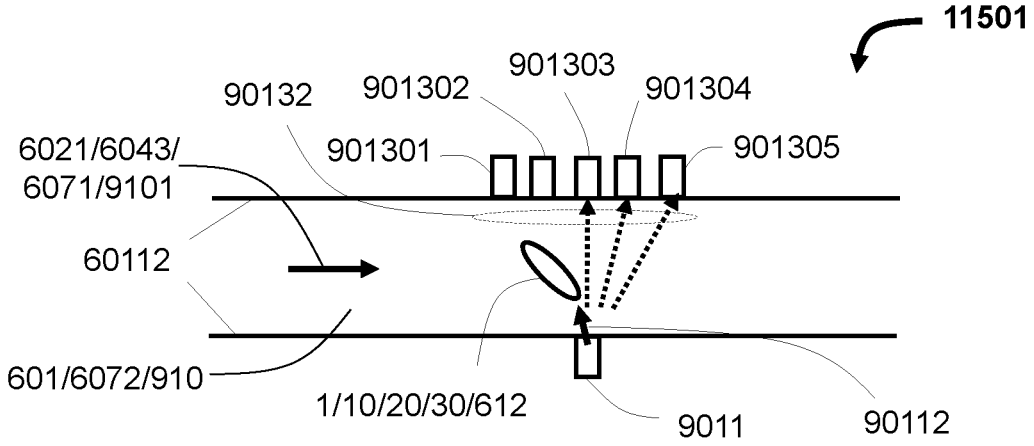

FIG. 113A illustrates an embodiment of an optical detector having one illuminator and forward scatter sensor array being used to detect a biological entity at a first entity position.

Figure 113B:
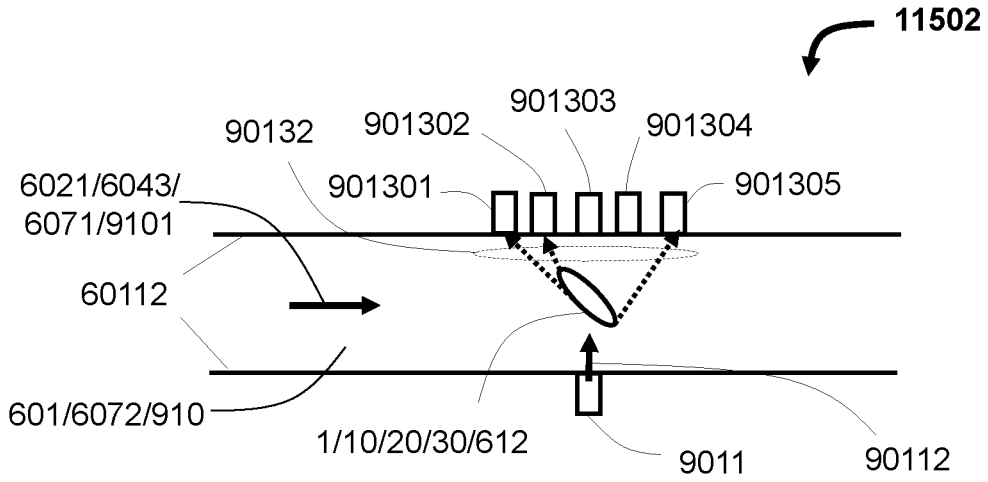

FIG. 113B illustrates an embodiment of an optical detector having one illuminator and forward scatter sensor array being used to detect a biological entity at a second entity position.

FIG. 114A illustrates an embodiment of an optical detector having illuminator array and one forward scatter sensor being used to detect a biological entity at a first entity position with operating a first illuminator.

FIG. 114B illustrates an embodiment of an optical detector having illuminator array and one forward scatter sensor being used to detect a biological entity at a first entity position with operating a second illuminator after first illuminator of FIG. 114A.

FIG. 114C illustrates an embodiment of an optical detector having illuminator array and one forward scatter sensor being used to detect a biological entity at a second entity position with operating a first illuminator.

FIG. 114D illustrates an embodiment of an optical detector having illuminator array and one forward scatter sensor being used to detect a biological entity at a second entity position with operating a second illuminator after first illuminator of FIG. 114C.

Figure 115A:
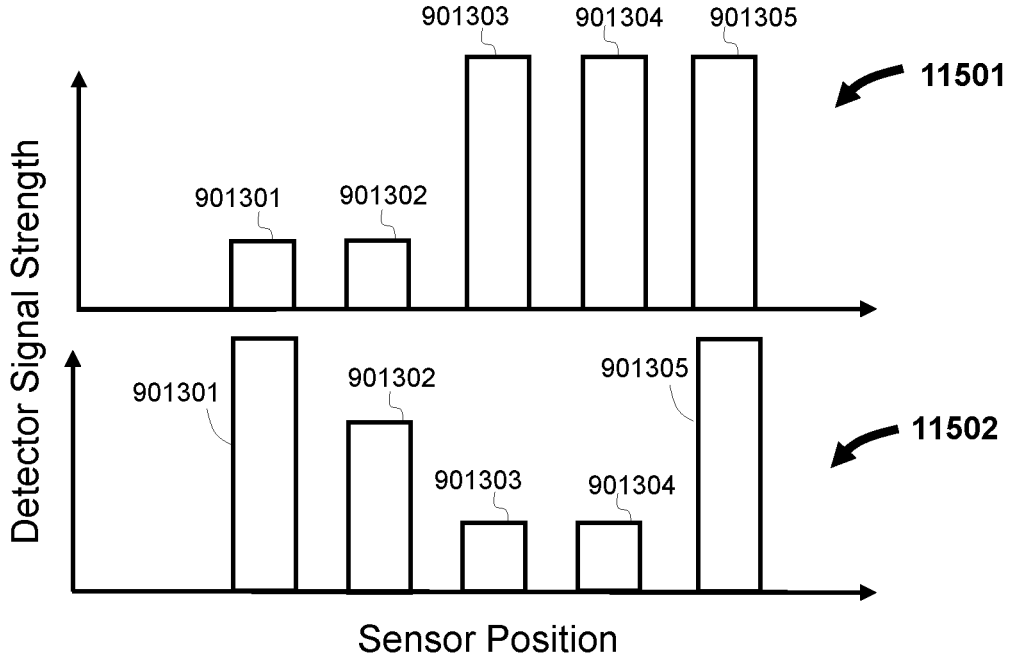

FIG. 115A illustrates an example of detector signal strength at different sensor positions for FIG. 113A and FIG. 113B embodiment.

Figure 115B:
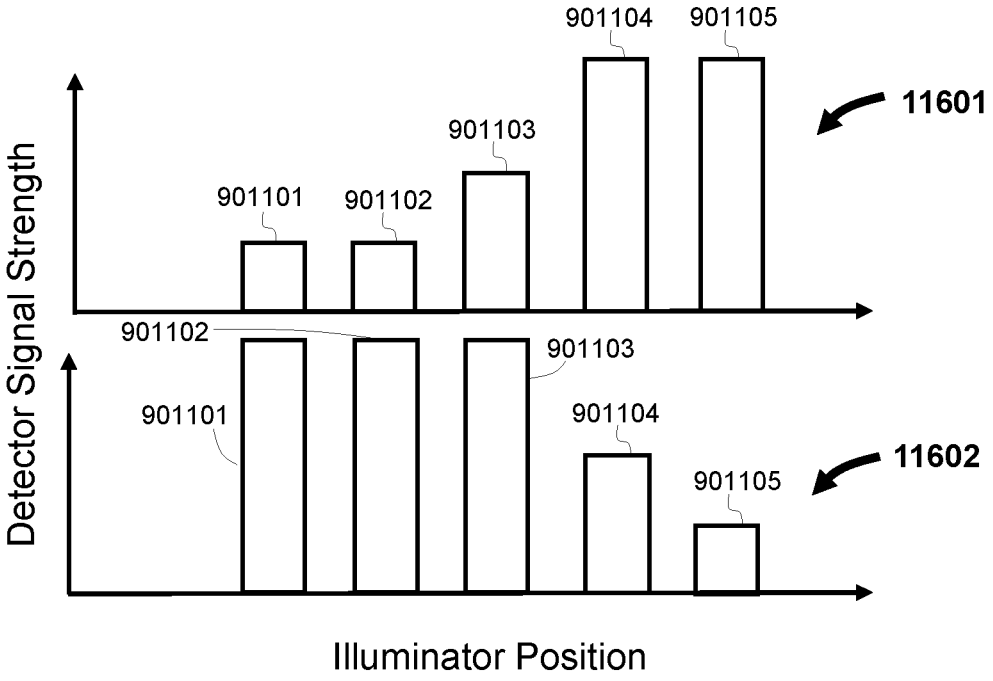

FIG. 115B illustrates an example of detector signal strength at different illuminator positions for FIG. 114A through FIG. 114D embodiment.

Figure 116A:
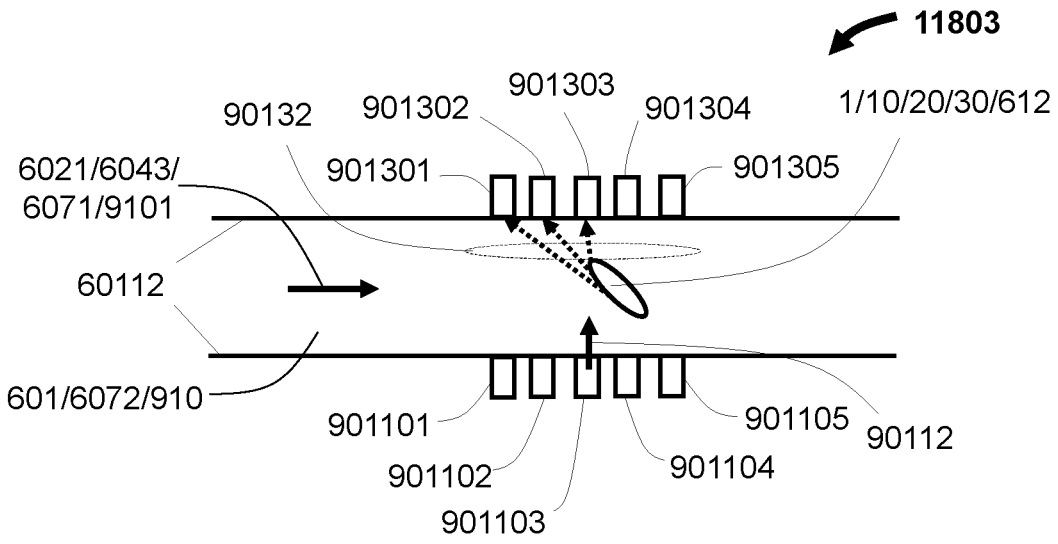

FIG. 116A illustrates an embodiment of an optical detector having illuminator array and forward scatter sensor array being used to detect shape of a biological entity at a first entity position with operating a first illuminator.

Figure 116B:
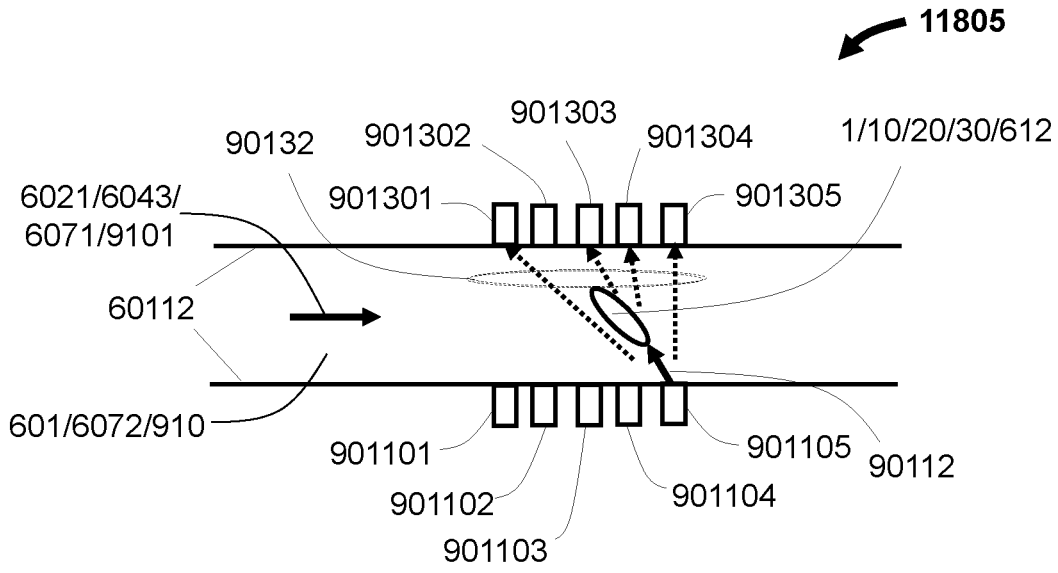

FIG. 116B illustrates an embodiment of an optical detector having illuminator array and forward scatter sensor array being used to detect shape of a biological entity at a first entity position with operating a second illuminator after first illuminator of FIG. 116A.

Figure 117:
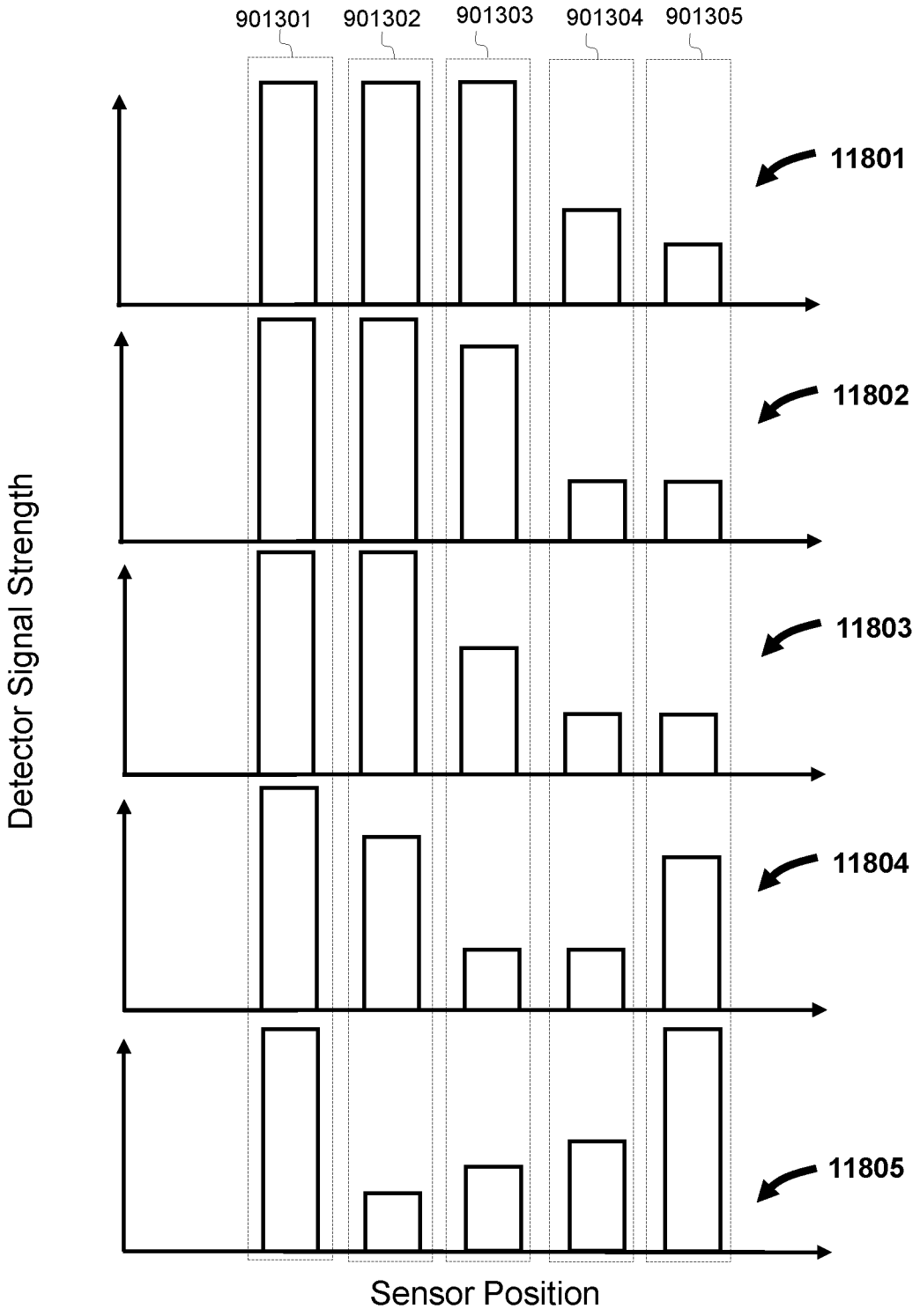

FIG. 117 illustrates example of detector signal strength at different sensor positions for FIG. 116A and FIG. 116B embodiment where illuminator array elements are individually operated.

Figure 118A:
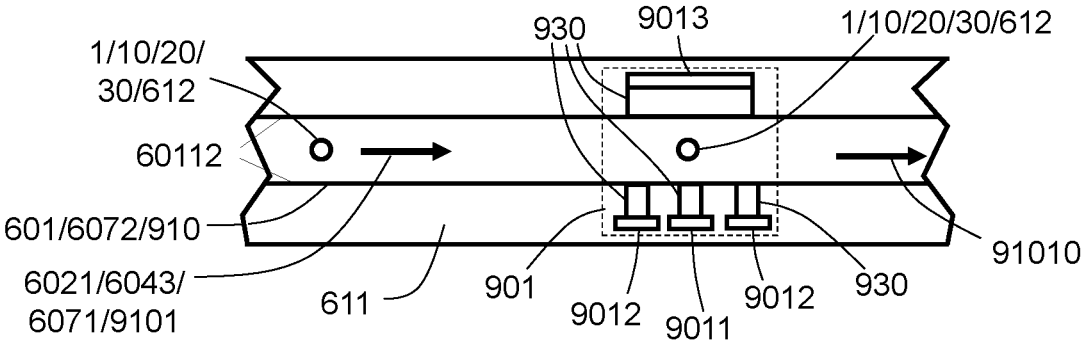

FIG. 118A illustrates an embodiment of an optical detector having illuminator, forward scatter sensors and back scatter sensors being embedded in channel walls but having optical components positioned between channel wall and each of illuminator and sensors.

Figure 118B:
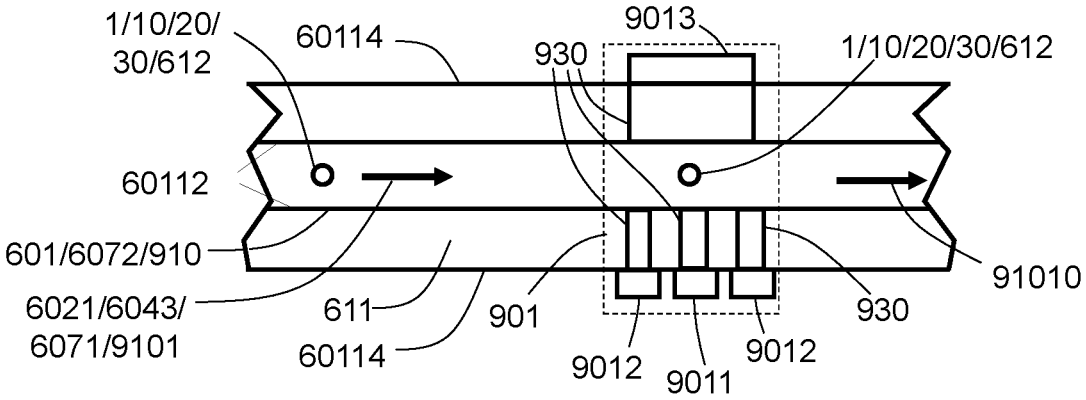

FIG. 118B illustrates an embodiment of an optical detector having illuminator, forward scatter sensors and back scatter sensors being positioned one the UFL outside surface facing the channel walls, and having optical components positioned between channel walls and each of illuminator and sensors.

Figure 119A:
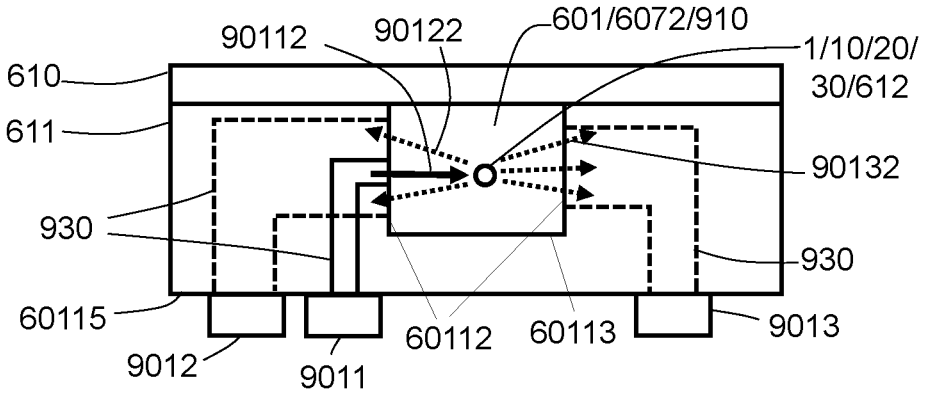

FIG. 119A illustrates an embodiment of an optical detector having illuminator, forward scatter sensors and back scatter sensors being positioned one the UFL substrate bottom surface, and having optical components positioned leading optical path between channel walls and each of illuminator and sensors.

Figure 119B:
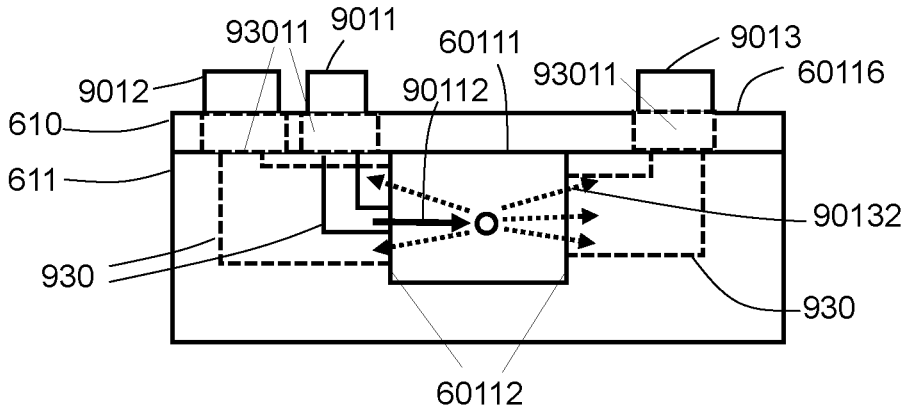

FIG. 119B illustrates an embodiment of an optical detector having illuminator, forward scatter sensors and back scatter sensors being positioned one the UFL cover top surface, and having optical components positioned leading optical path between channel walls and each of illuminator and sensors.

Figure 120A:
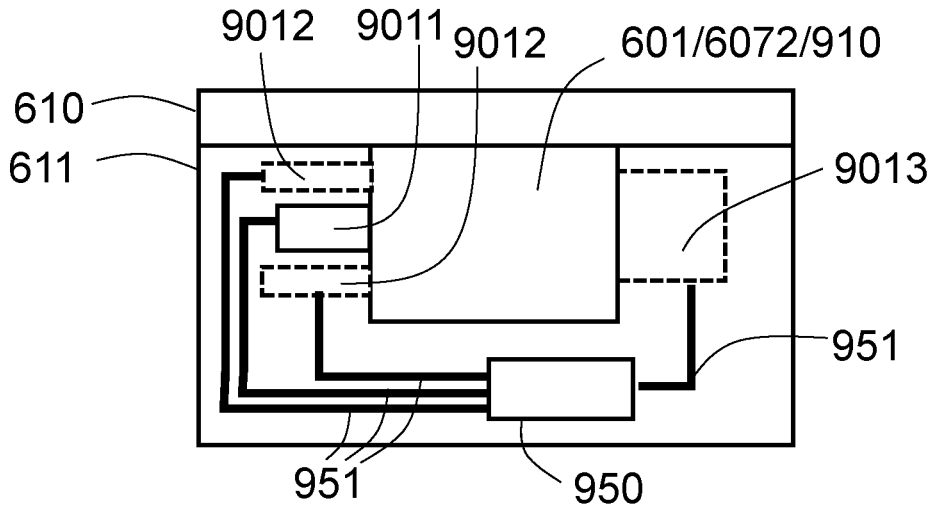

FIG. 120A illustrates an embodiment of an optical detector having illuminator, forward scatter sensors and back scatter sensors with controller of the optical detector embedded in the UFL substrate.

Figure 120B:
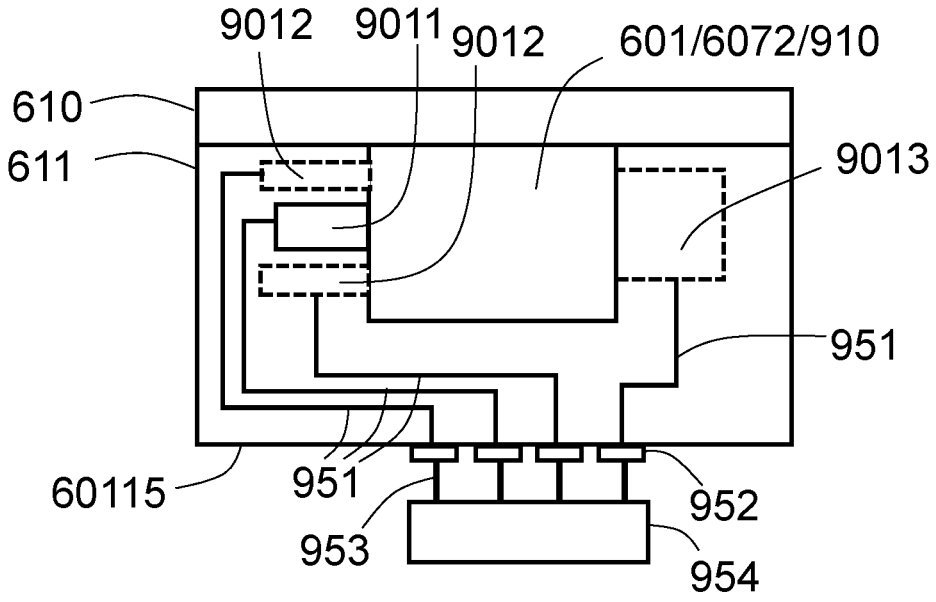

FIG. 120B illustrates an embodiment of an optical detector having illuminator, forward scatter sensors and back scatter sensors embedded in UFL substrate with controller of the optical detector being outside the UFL.

Figure 121A:
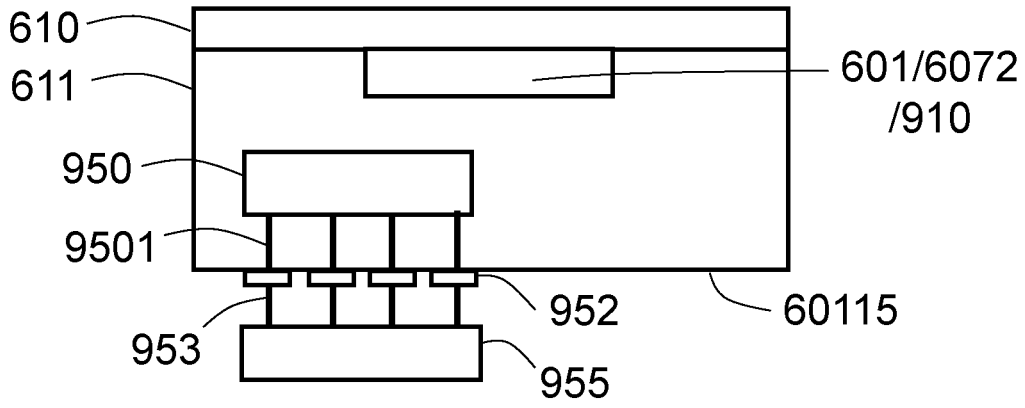

FIG. 121A illustrates an embodiment of FIG. 120A controller of the optical detector communicating with external computing device through electrical connections.

Figure 121B:
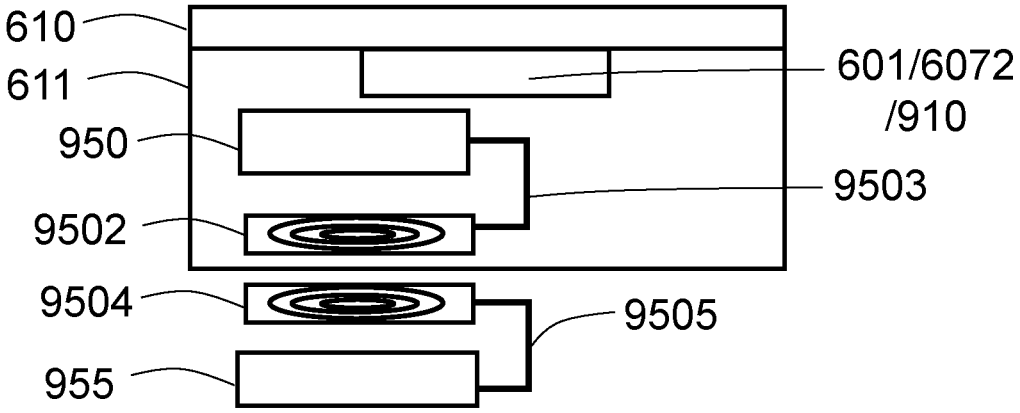

FIG. 121B illustrates an embodiment of FIG. 120A controller of the optical detector communicating with external computing device through wireless means.

Figure 122A:
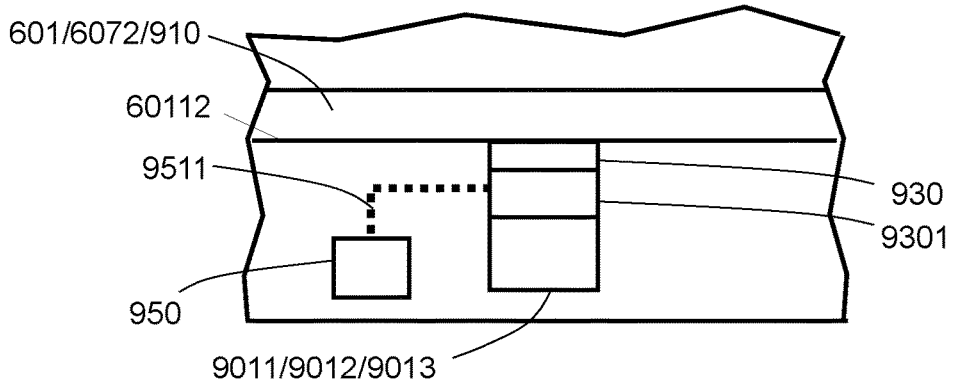

FIG. 122A illustrates an embodiment of electrically controlled optical filter positioned between UFL channel wall and FIG. 118A illuminator and scatter sensors.

Figure 122B:
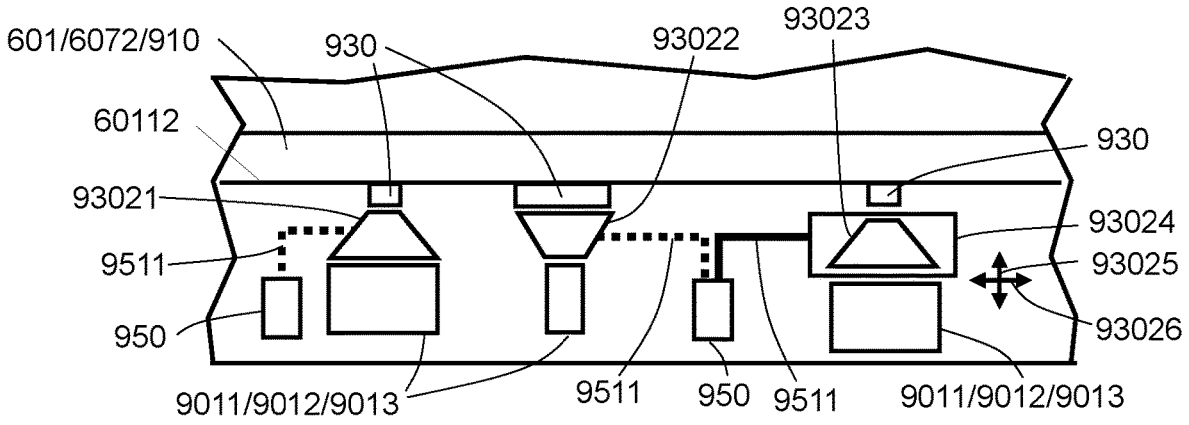

FIG. 122B illustrates an embodiment of electrically controlled optical lens positioned between UFL channel wall and FIG. 118A illuminator and scatter sensors.

Figure 122C:
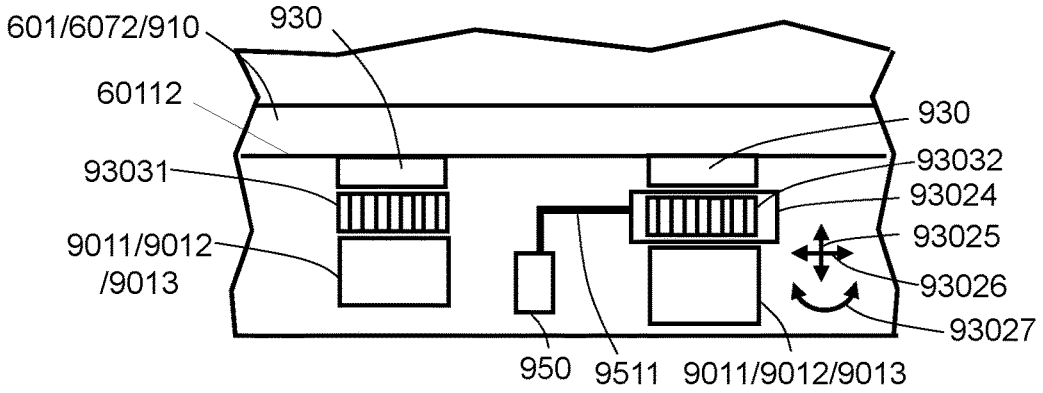

FIG. 122C illustrates an embodiment of using an optical gratings as optical filter and optionally using electrically positioned optical gratings between UFL channel wall and FIG. 118A illuminator and scatter sensors.

Figure 123A:
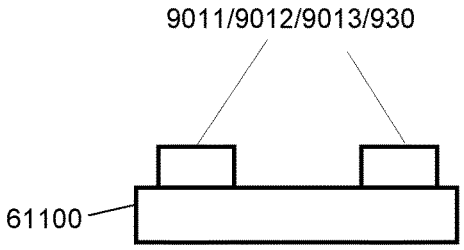

FIG. 123A illustrates FIG. 118A embedded illuminator, scatter sensors, and optical components being formed on a UFL substrate after a first fabrication step during manufacture process of the UFL.

Figure 123B:
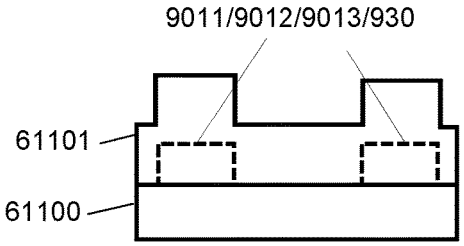

FIG. 123B illustrates a top layer deposited over FIG. 123A substrate surface covering embedded illuminator, scatter sensors, and optical components.

Figure 123C:
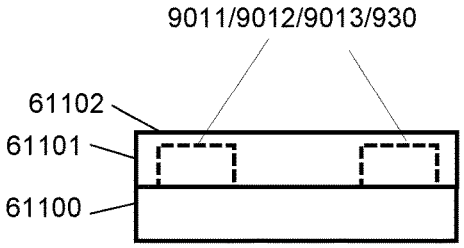

FIG. 123C illustrates planarization of top layer of FIG. 123B.

Figure 123D:
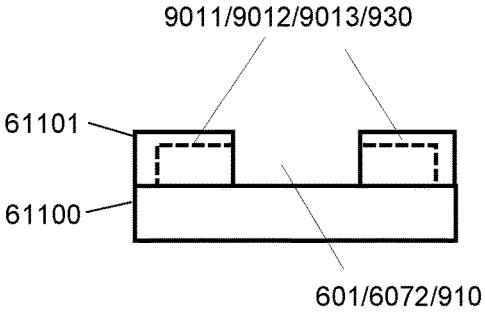

FIG. 123D illustrates a second etching step performed to form the main channel of the UFL within the top layer of FIG. 123C.

Figure 123E:
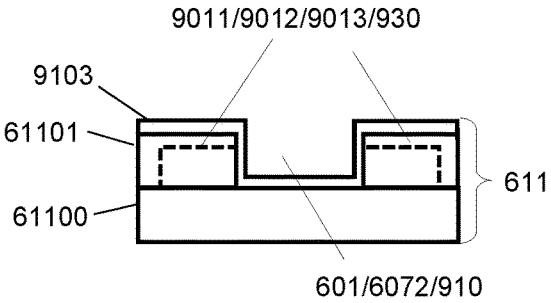

FIG. 123E illustrates a protection layer deposited conformally covering over FIG. 123D top layer surface and etched channel.

Figure 123F:
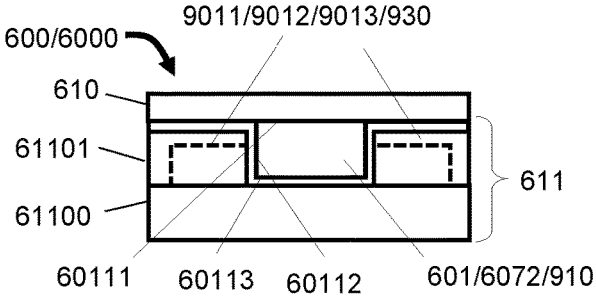

FIG. 123F illustrates a top cover is positioned over the top layer surface of FIG. 123E and forms the enclosure of the main channel of the UFL.

Figure 124A:
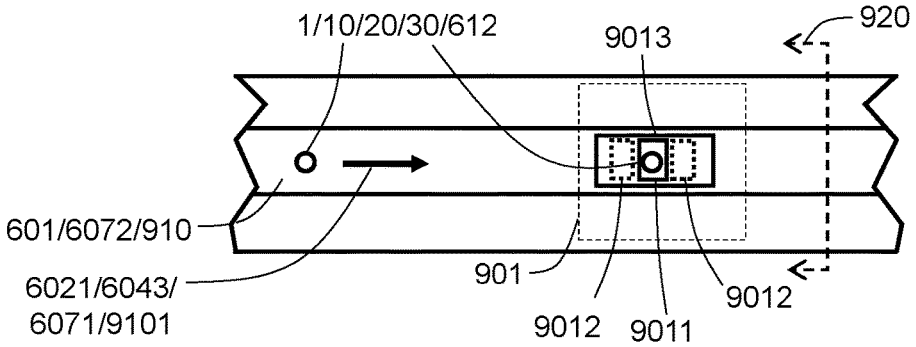

FIG. 124A illustrates another embodiment of an optical detector having illuminator, forward scatter sensors and back scatter sensors being used to detect a biological entity.

Figure 124B:
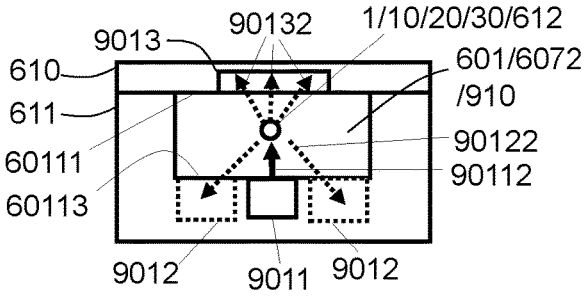

FIG. 124B illustrates an embodiment of FIG. 124A optical detector having back scatter sensors and the illuminator embedded in substrate of a UFL and forward scatter sensor embedded in cover of the UFL.

Figure 124C:
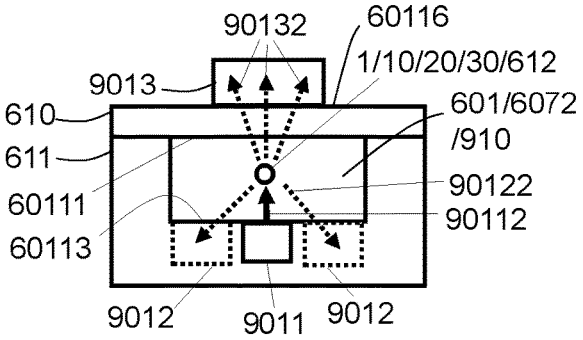

FIG. 124C illustrates an embodiment of FIG. 124A optical detector having back scatter sensors and the illuminator embedded in substrate of a UFL and forward scatter sensor attached to the top surface of the cover of the UFL.

Figure 124D:
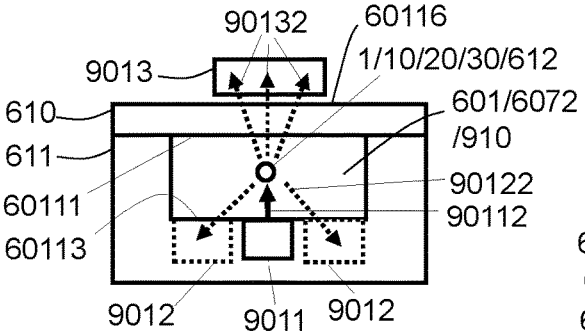

FIG. 124D illustrates an embodiment of FIG. 124A optical detector having back scatter sensors and the illuminator embedded in substrate of a UFL and forward scatter sensor positioned above the top surface of the cover of the UFL.

Figure 124E:
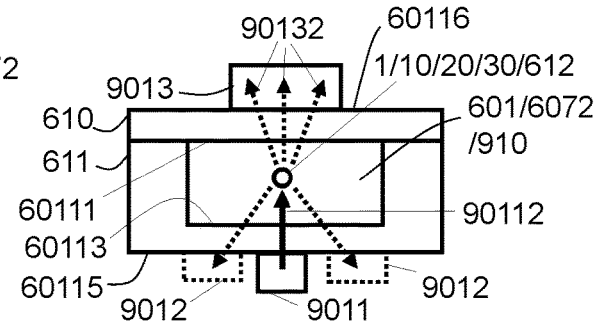

FIG. 124E illustrates an embodiment of FIG. 124A optical detector having back scatter sensors and the illuminator attached to the bottom surface of the substrate of a UFL and forward scatter sensor attached to the top surface of the cover of the UFL.

Figure 125A:
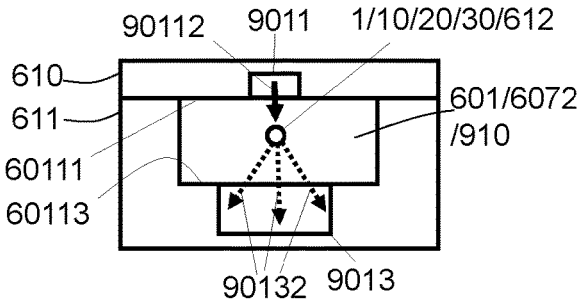

FIG. 125A illustrates an embodiment of FIG. 124A optical detector having illuminator embedded in the cover of a UFL and forward scatter sensor embedded in the substrate of the UFL.

Figure 125B:
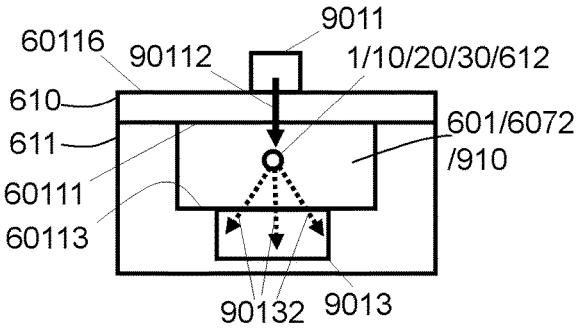

FIG. 125B illustrates an embodiment of FIG. 124A optical detector having illuminator attached to the top surface of the cover of a UFL and forward scatter sensor embedded in the substrate of the UFL.

Figure 125C:
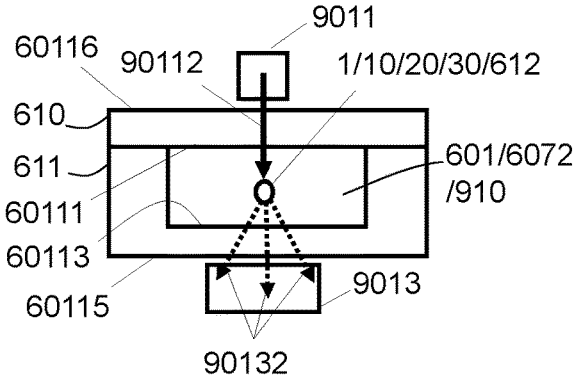

FIG. 125C illustrates an embodiment of FIG. 124A optical detector having illuminator positioned below the bottom surface of the substrate of a UFL and forward scatter sensor positioned above to the top surface of the cover of the UFL.

Figure 125D:
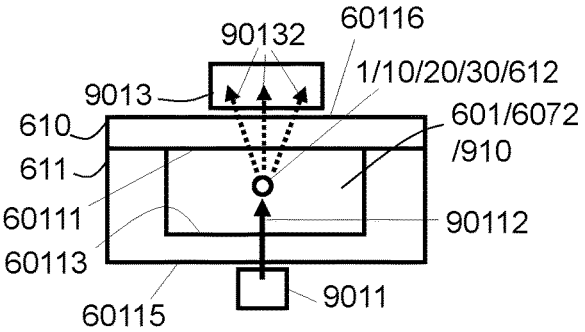

FIG. 125D illustrates an embodiment of FIG. 124A optical detector having illuminator positioned above to the top surface of the cover of a UFL and forward scatter sensor positioned below the bottom surface of the substrate of the UFL.

Figure 126A:
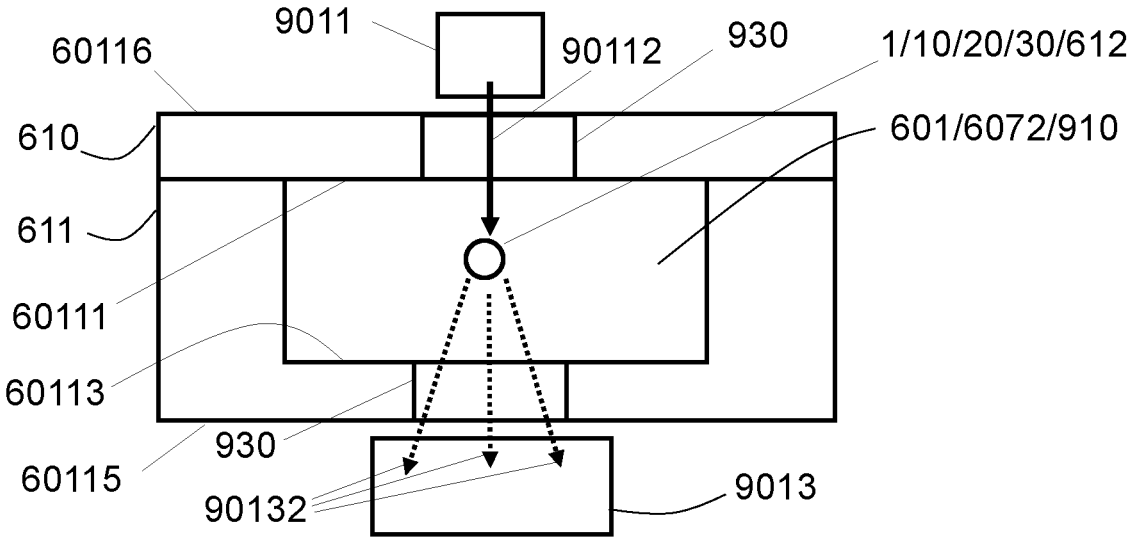

FIG. 126A illustrates an embodiment of FIG. 125C with an optical window formed in the cover to allow passage of optical light from illuminator into the UFL channel and an optical window formed in the substrate to allow passage of optical light from UFL channel into the forward scatter sensor.

Figure 126B:
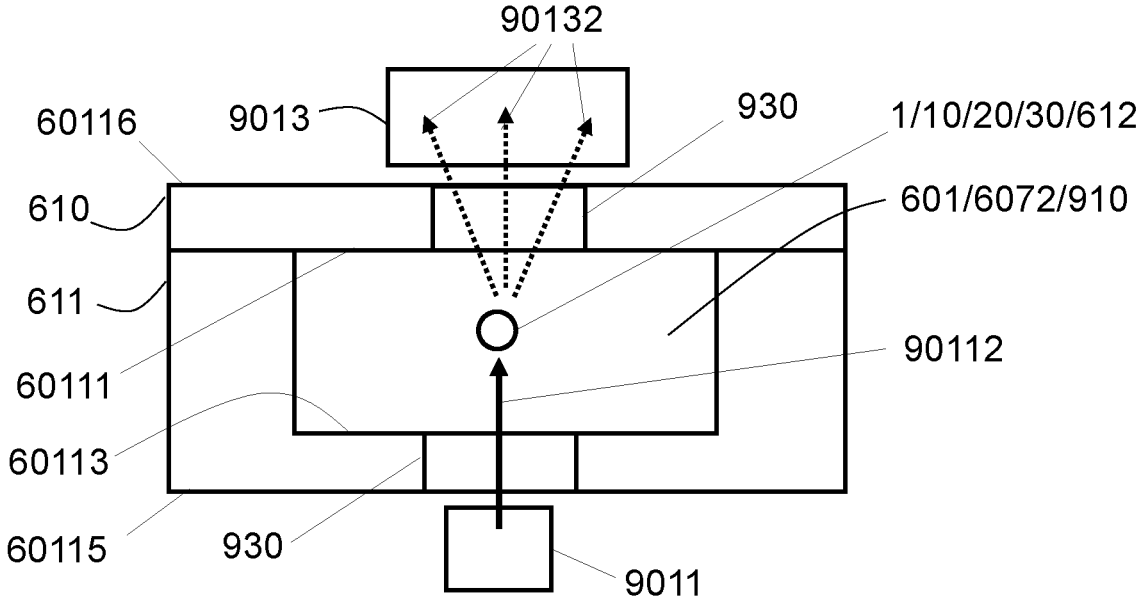

FIG. 126B illustrates an embodiment of FIG. 125D with an optical window formed in the substrate to allow passage of optical light from illuminator into the UFL channel and another optical window formed in the cover to allow passage of optical light from UFL channel into the forward scatter sensor.

Figure 127A:
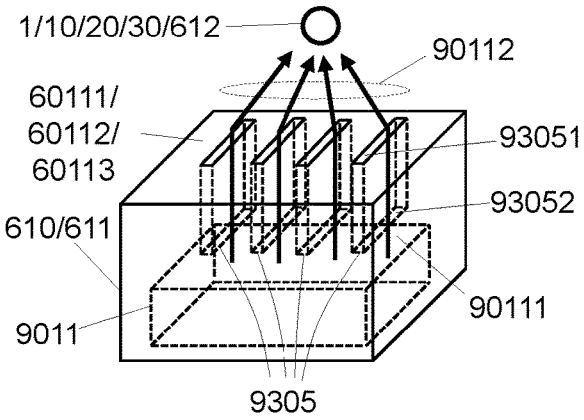

FIG. 127A illustrates an embodiment where an illuminator is embedded within the cover or the substrate of a UFL channel and light from the illuminator is passed through an optical grating embedded within the cover or substrate of the UFL channel.

Figure 127B:
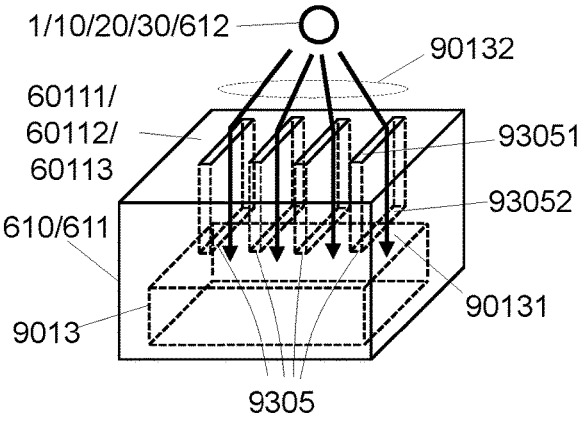

FIG. 127B illustrates an embodiment where forward scatter sensor is embedded within the cover or the substrate of a UFL channel and light is passed to the forward scatter sensor through an optical grating embedded within the cover or substrate of the UFL channel.

Figure 127C:
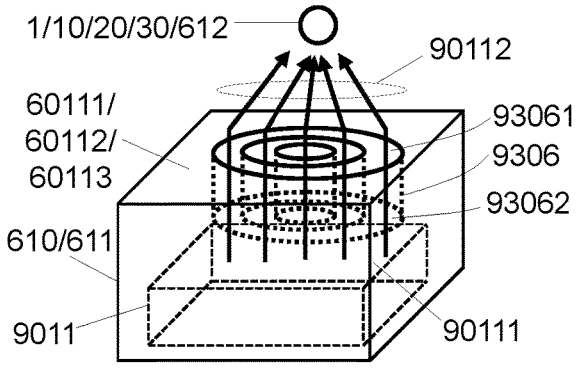

FIG. 127C illustrates an embodiment where an illuminator is embedded within the cover or the substrate of a UFL channel and light from the illuminator is passed through an optical phase plate embedded within the cover or substrate of the UFL channel.

Figure 127D:
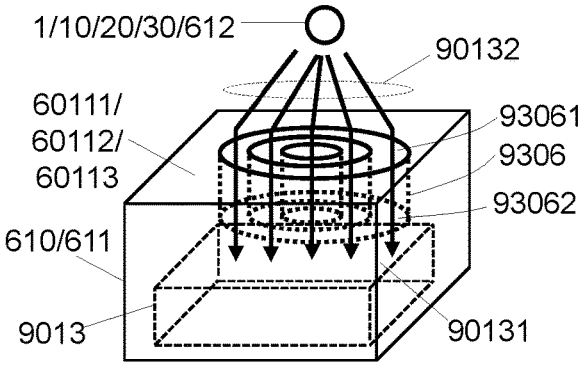

FIG. 127D illustrates an embodiment where forward scatter sensor is embedded within the cover or the substrate of a UFL channel and light is passed to the forward scatter sensor through an optical phase plate embedded within the cover or substrate of the UFL channel.

Figure 128A:
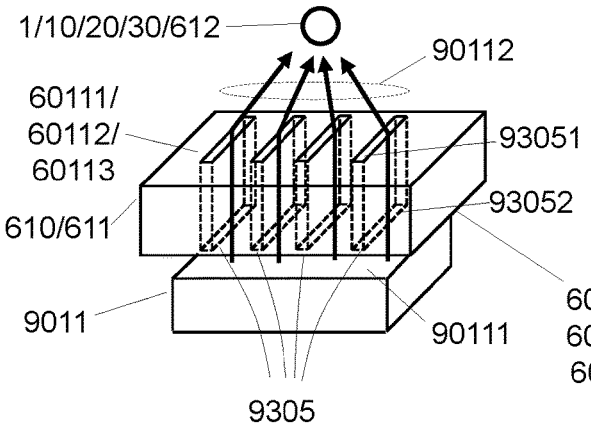

FIG. 128A illustrates an embodiment where an illuminator is located external to a UFL channel and light from the illuminator is passed through an optical grating embedded within the cover or the substrate of the UFL channel.

Figure 128B:
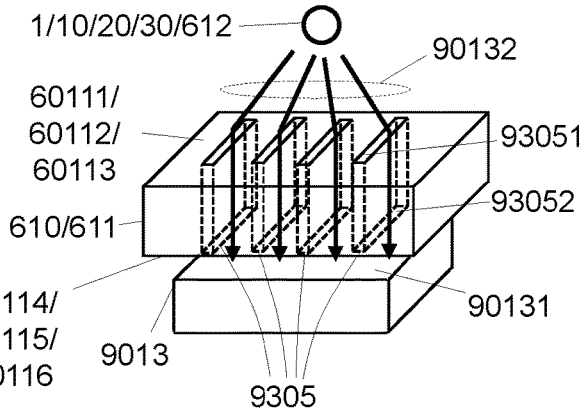

FIG. 128B illustrate an embodiment where forward scatter sensor is located external to a UFL channel and light is passed to the forward scatter sensor through an optical grating embedded within the cover or the substrate of the UFL channel.

Figure 128C:
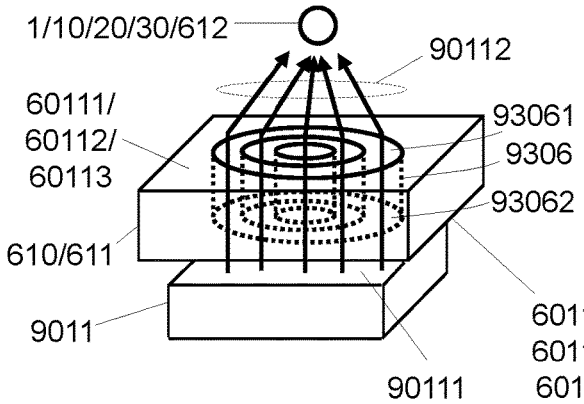

FIG. 128C illustrates an embodiment where an illuminator is located external to a UFL channel and light from the illuminator is passed through an optical phase plate embedded within the cover or the substrate of the UFL channel.

Figure 128D:
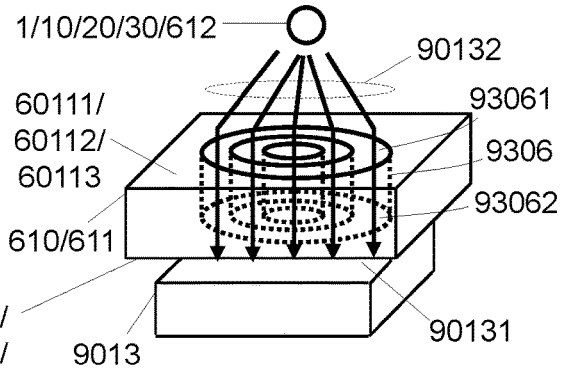

FIG. 128D illustrate an embodiment where forward scatter sensor is located external to a UFL channel and light is passed to the forward scatter sensor through an optical phase plate embedded within the cover or the substrate of the UFL channel.

Figure 129A:
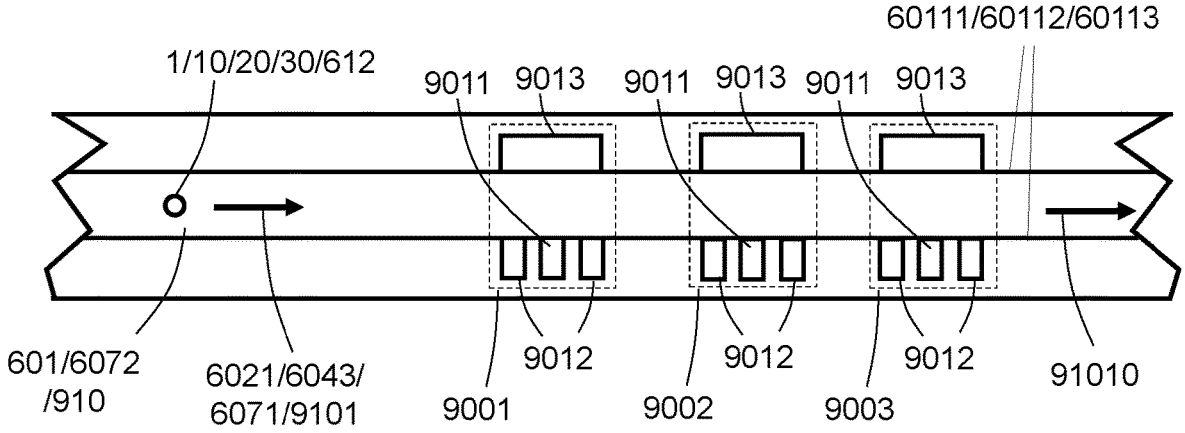

FIG. 129A illustrates an embodiment of multiple optical detectors each having illuminator, forward scatter sensors or back scatter sensors positioned along the channel walls of a UFL channel to produce serial optical detection of biological entities.

Figure 129B:
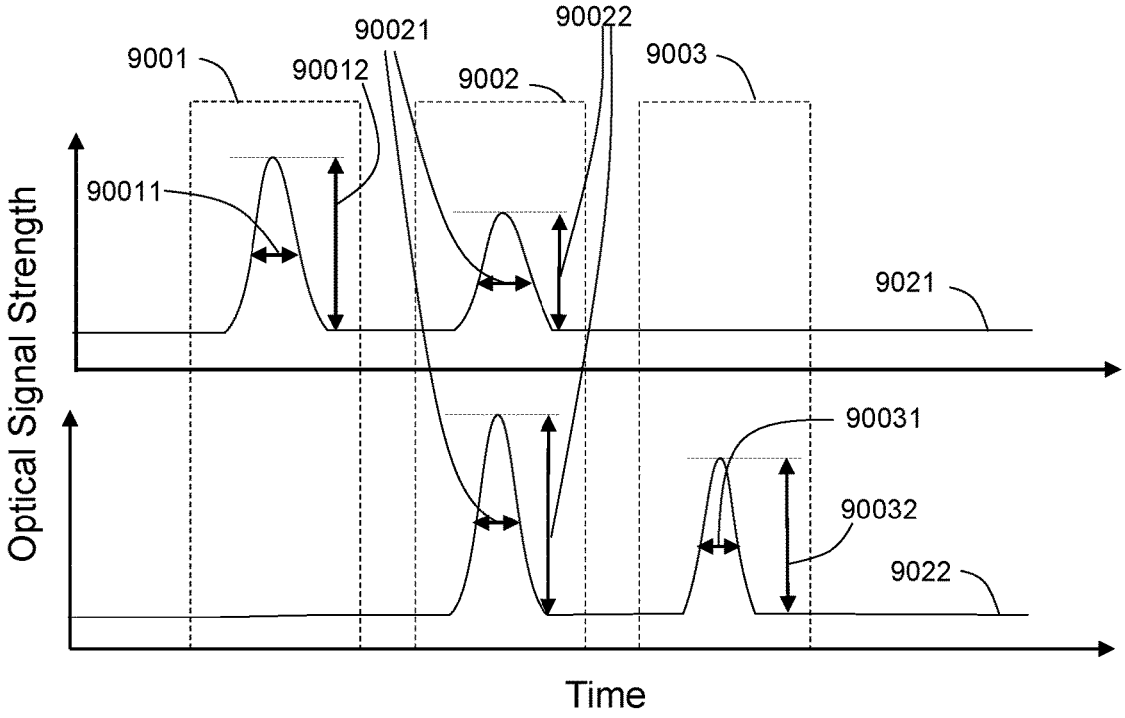

FIG. 129B illustrates one example of fluorescent optical signals from FIG. 129A optical detectors when biological entities pass through the UFL channel.

Figure 130A:
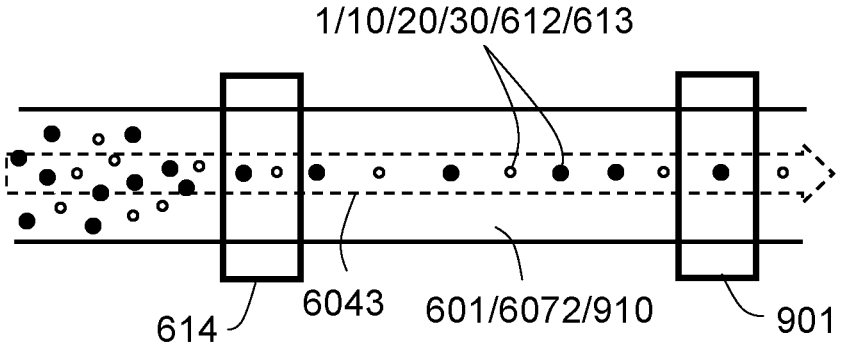

FIG. 130A illustrates the method to align biological entities into a linear stream in flow channel for optical detection using fluidic pressure node.

Figure 130B:
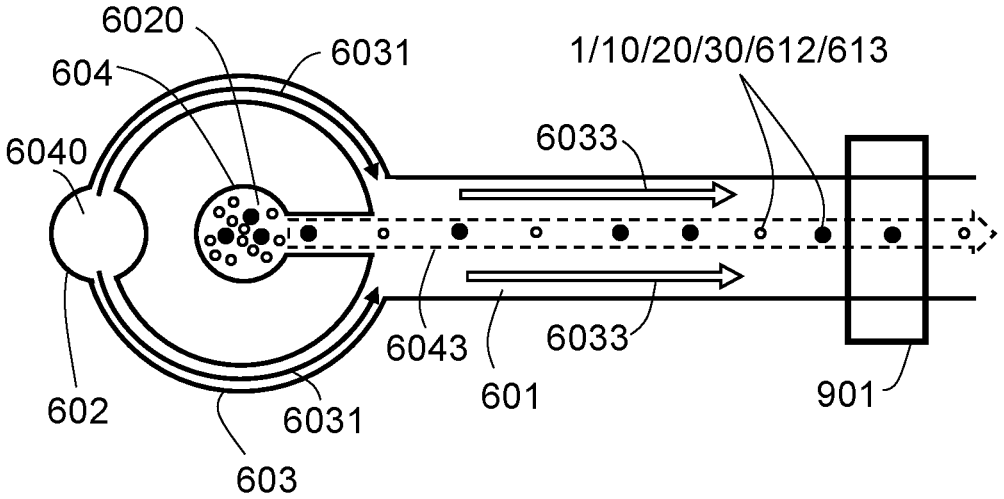

FIG. 130B illustrates the method to align biological entities into a linear stream in flow channel for optical detection using laminar flow.

Figure 130C:
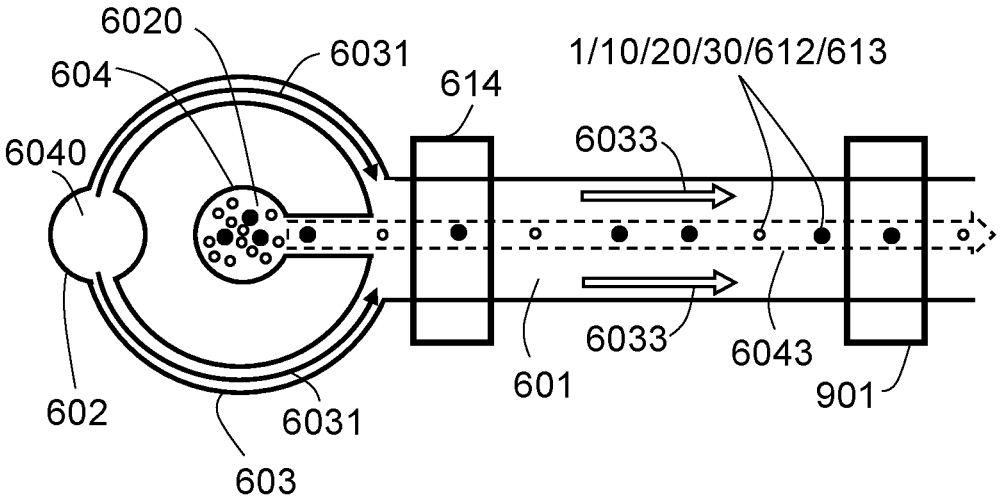

FIG. 130C illustrates the method to align biological entities into a linear stream in flow channel for optical detection using laminar flow in combination with fluidic pressure node.

Figure 131A:
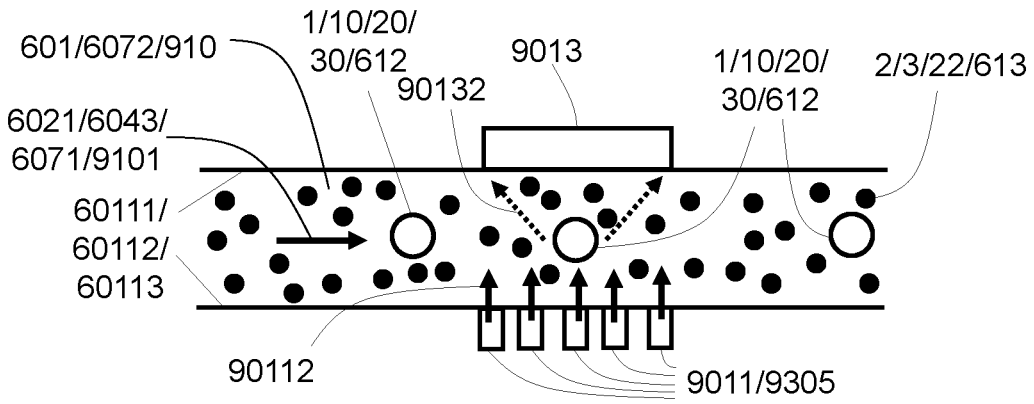

FIG. 131A illustrates the method to use spatially periodic illuminators or optical passages to detect biological entities.

Figure 131B:
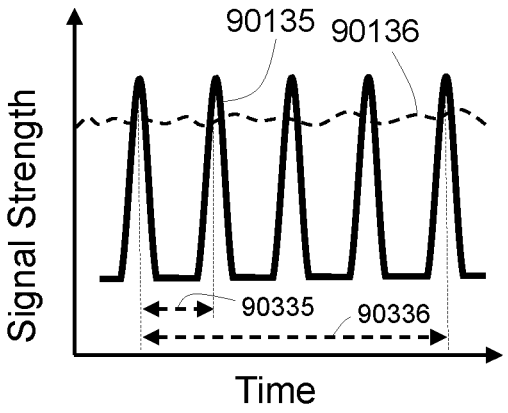

FIG. 131B illustrates example of detected signal by scatter sensor of FIG. 131A.

Figure 131C:
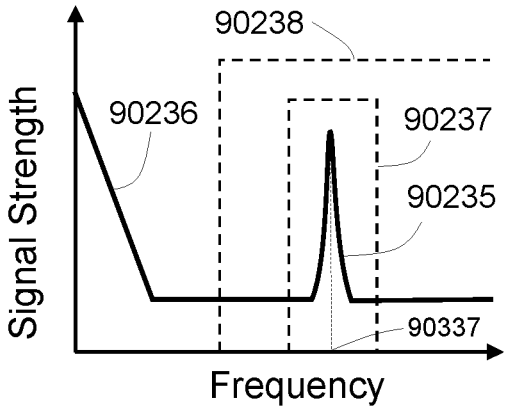

FIG. 131C illustrates enhancement of detection of biological entities by using signal filtering based on FIG. 131A spatial period.

Figure 132:
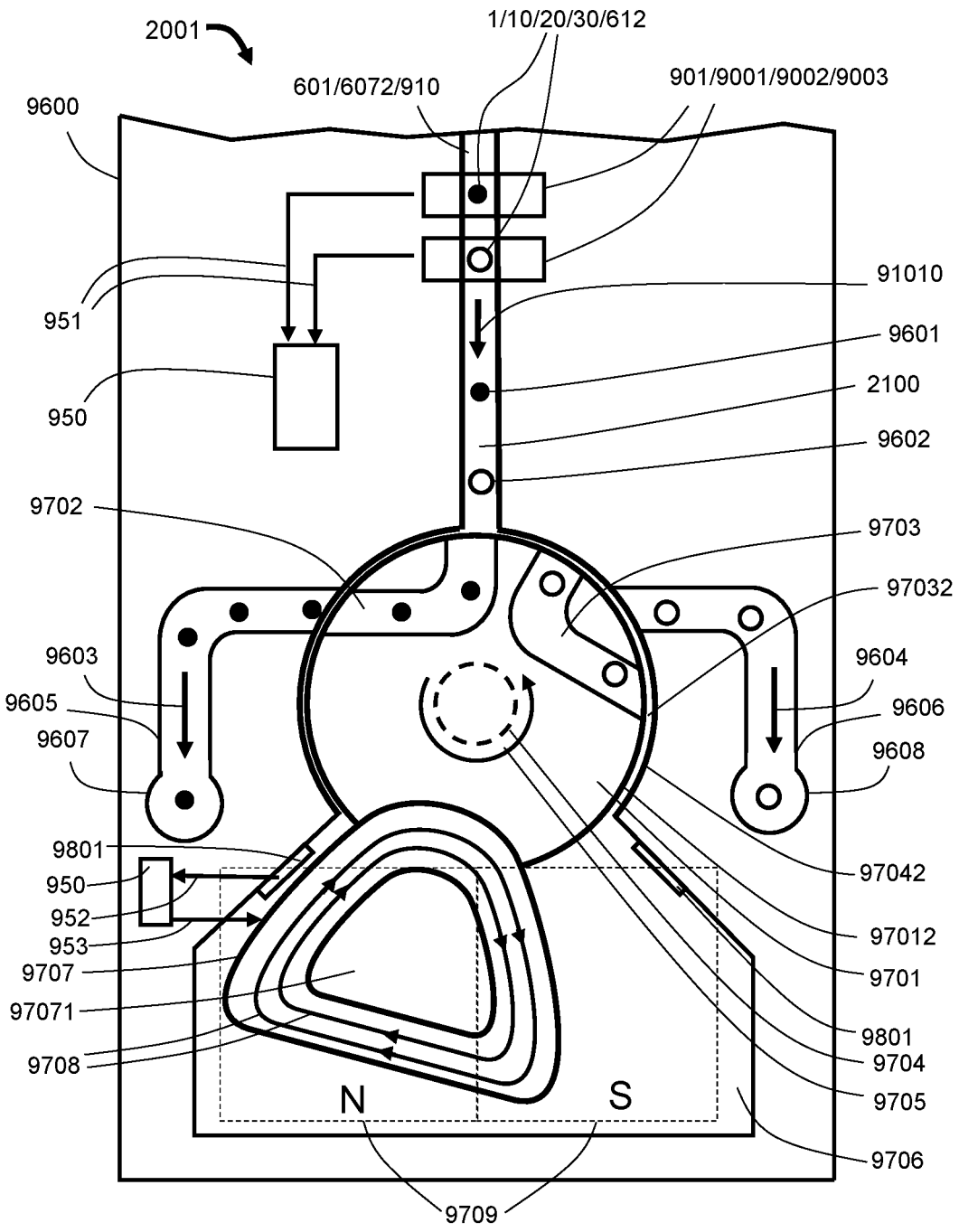

FIG. 132 illustrates a first embodiment of a biological entity sorting device having a fluid path selector being at a first sorting position.

Figure 133:
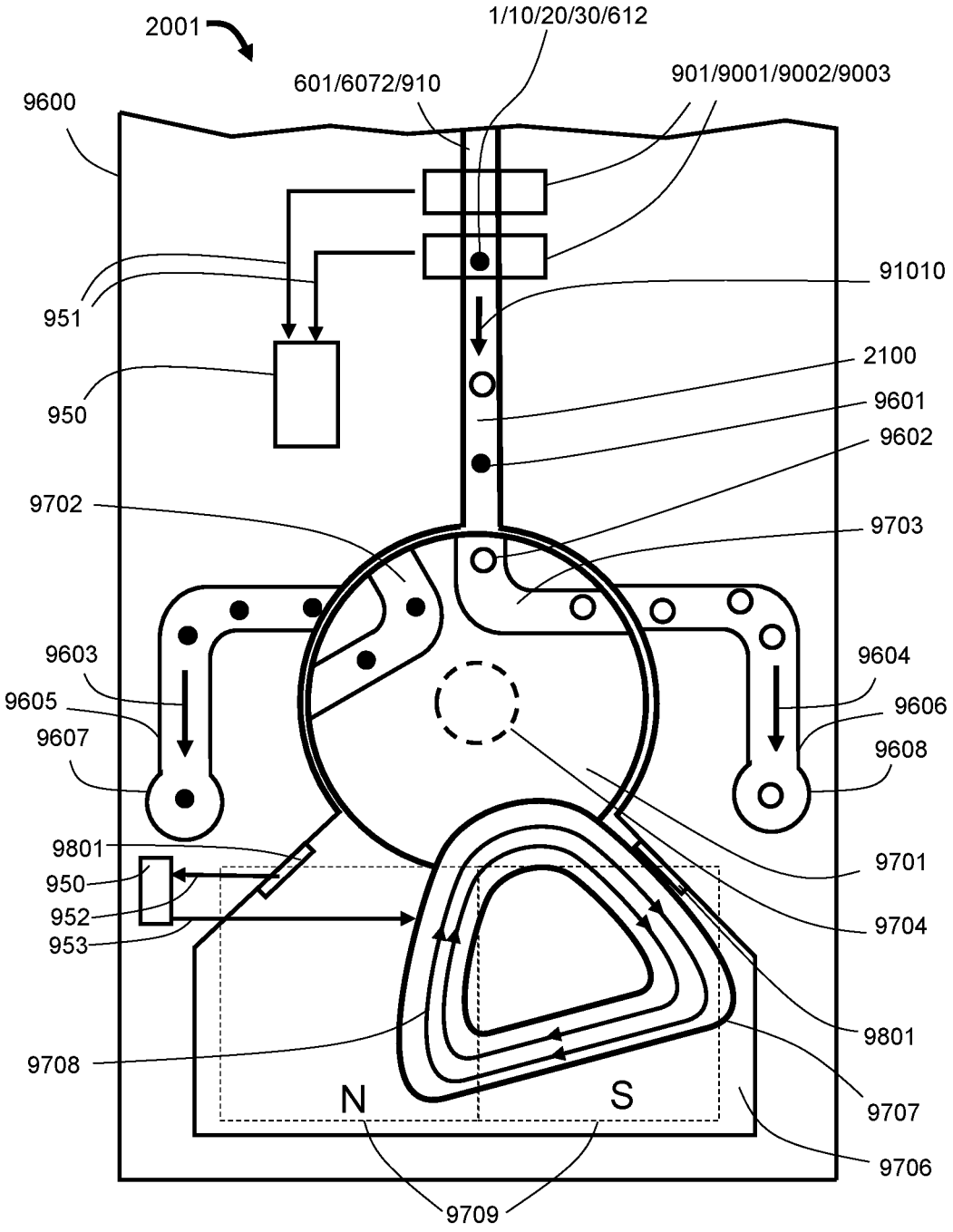

FIG. 133 illustrates FIG. 132 sorting device at a second sorting position.

Figure 134A:
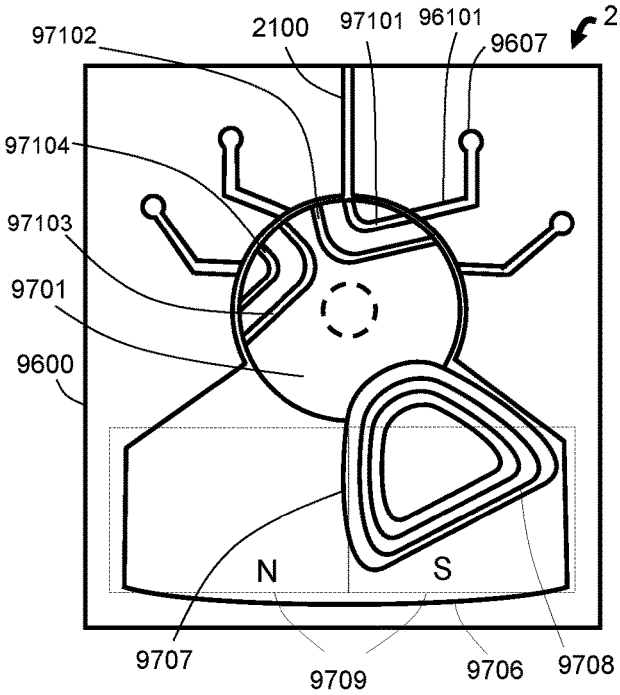

FIG. 134A illustrates FIG. 132 sorting device having four sorting positions and being in first sorting position.

Figure 134B:
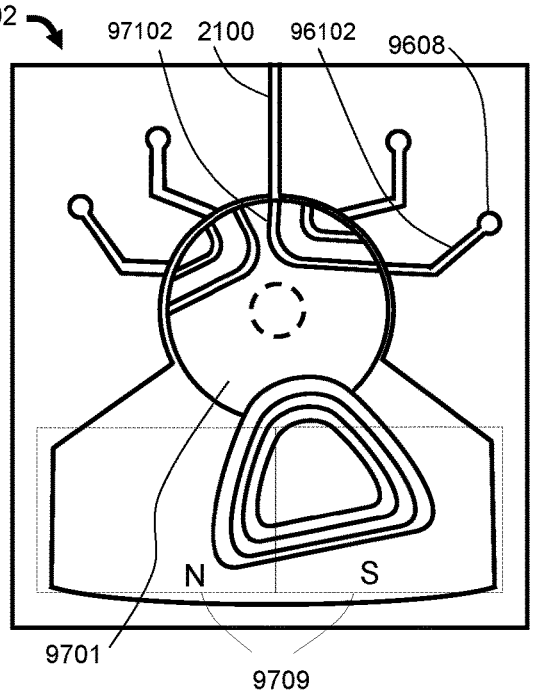

FIG. 134B illustrates FIG. 134A sorting device in second sorting position.

Figure 134C:
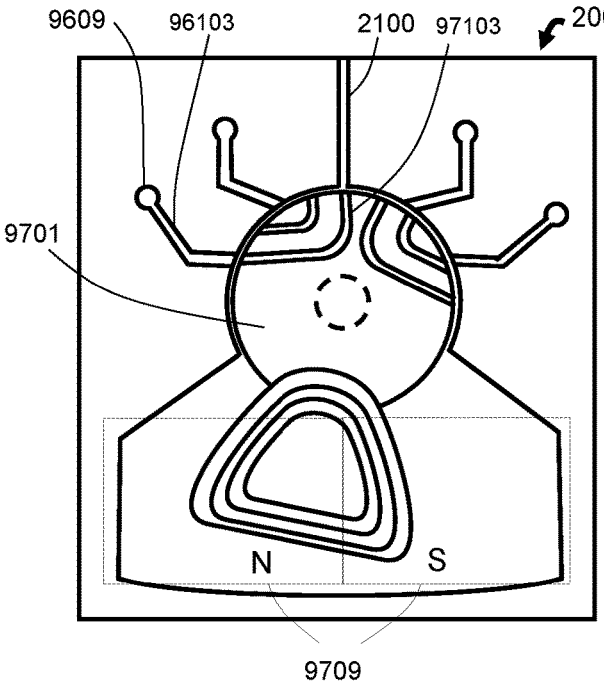

FIG. 134C illustrates FIG. 134A sorting device in third sorting position.

Figure 134D:
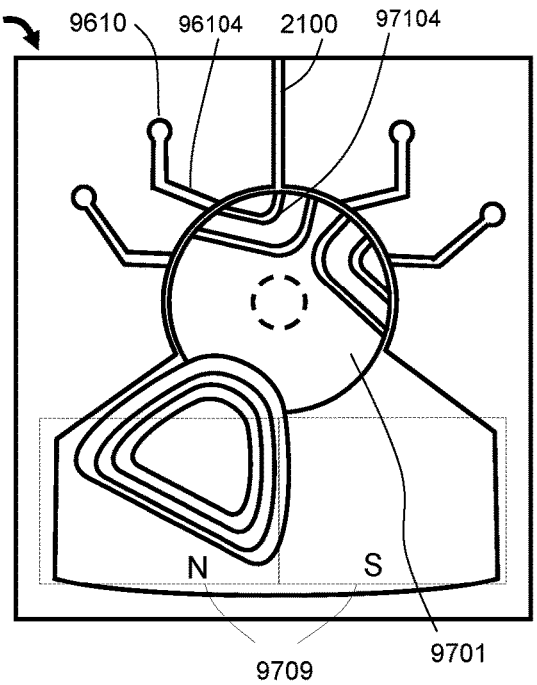

FIG. 134D illustrates FIG. 134A sorting device in fourth sorting position.

Figure 135A:
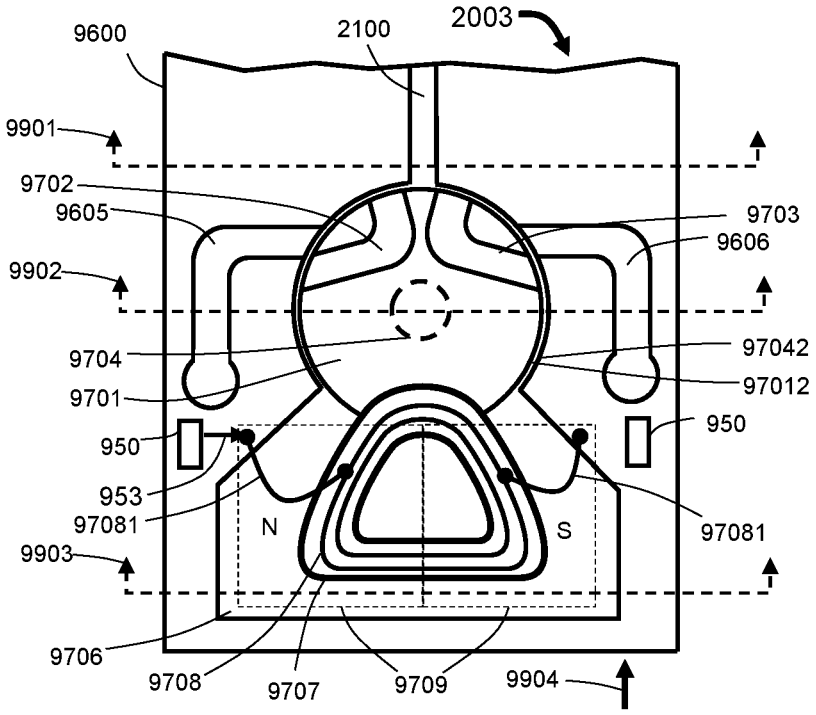

FIG. 135A illustrates FIG. 132 sorting device utilizing coil line of voice coil connecting to device body.

Figure 135B:
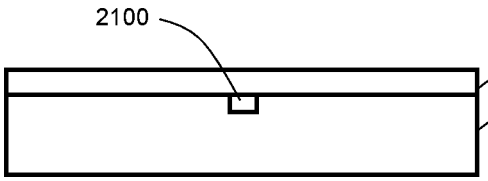

FIG. 135B illustrates view of FIG. 135A device along first cross section direction.

Figure 135C:
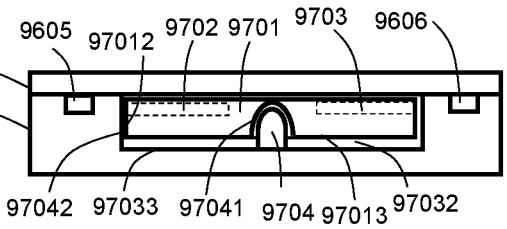

FIG. 135C illustrates a first example view of FIG. 135A device along second cross section direction.

Figure 135D:
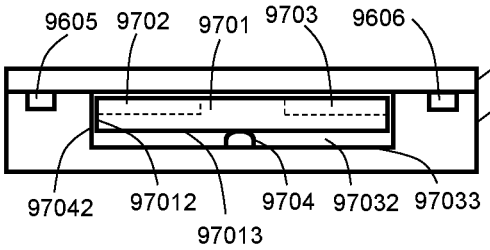

FIG. 135D illustrates a second example view of FIG. 135A device along second cross section direction.

Figure 135E:
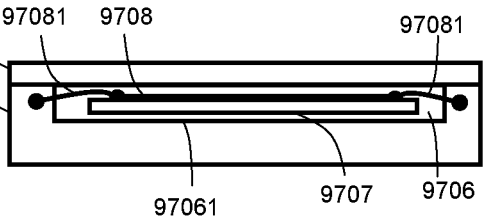

FIG. 135E illustrates view of FIG. 135A device along third cross section direction.

Figure 136A:
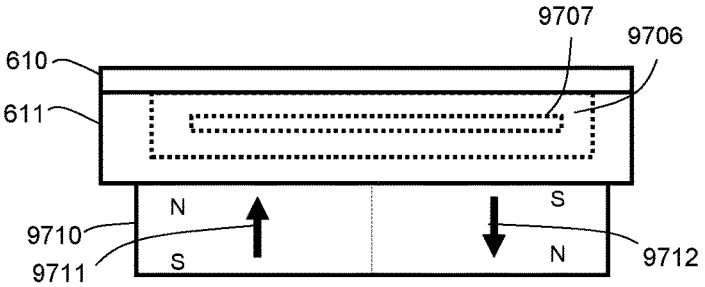

FIG. 136A illustrates view of FIG. 135A device having a first magnetic field application scheme.

Figure 136B:
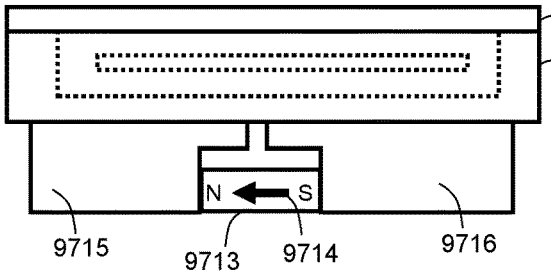

FIG. 136B illustrates view of FIG. 135A device having a second magnetic field application scheme.

Figure 136C:
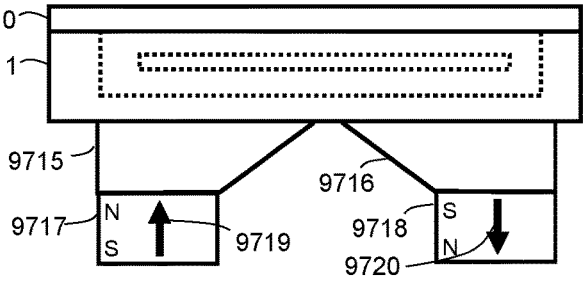

FIG. 136C illustrates view of FIG. 135A device having a third magnetic field application scheme.

Figure 136D:
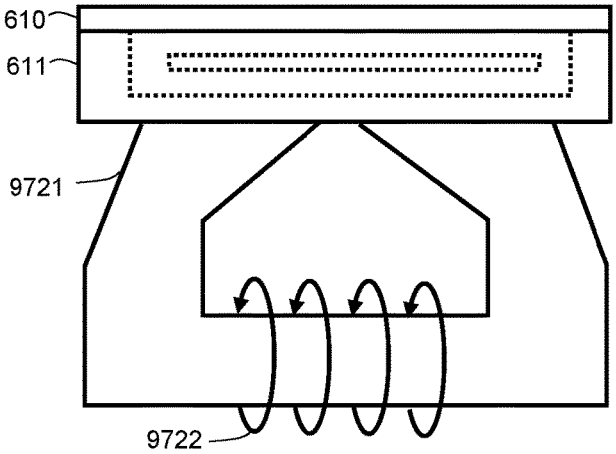

FIG. 136D illustrates view of FIG. 135A device having a fourth magnetic field application scheme.

Figure 137:
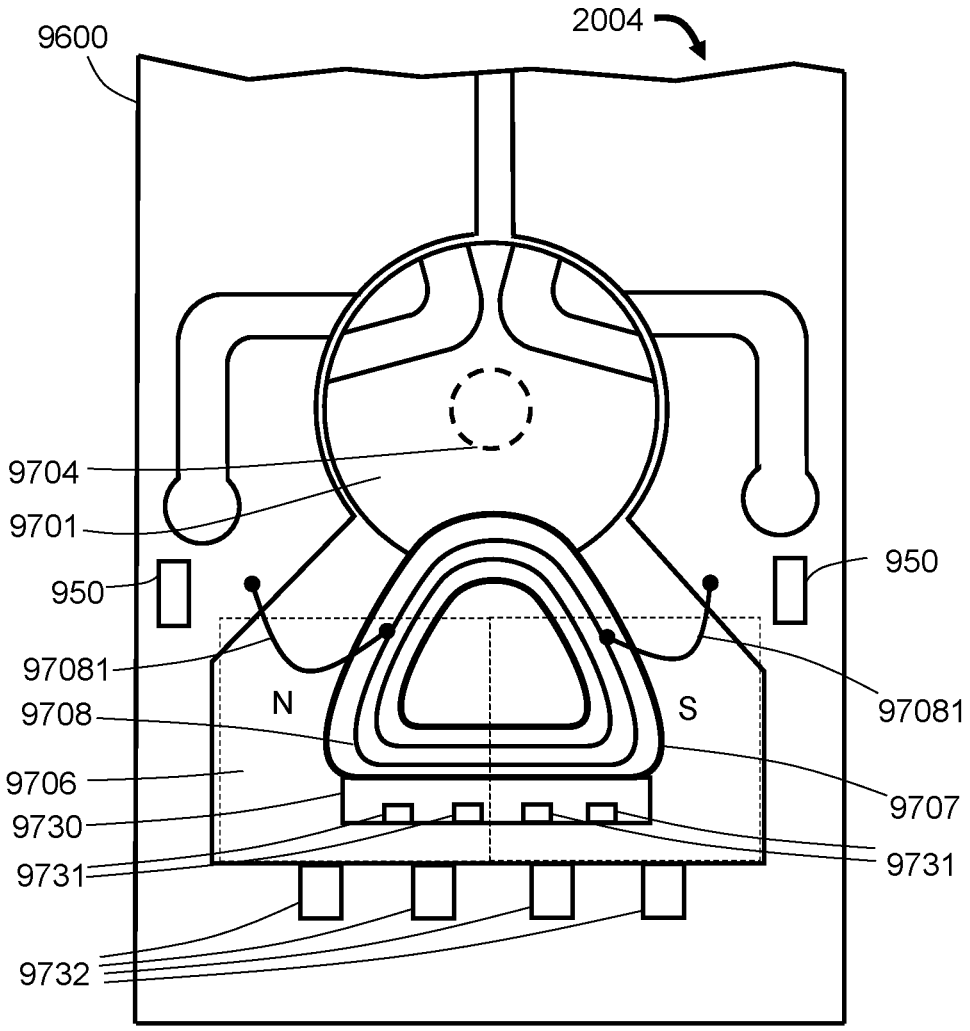

FIG. 137 illustrates sorting device incorporating actuator position decoders.

Figure 138A:
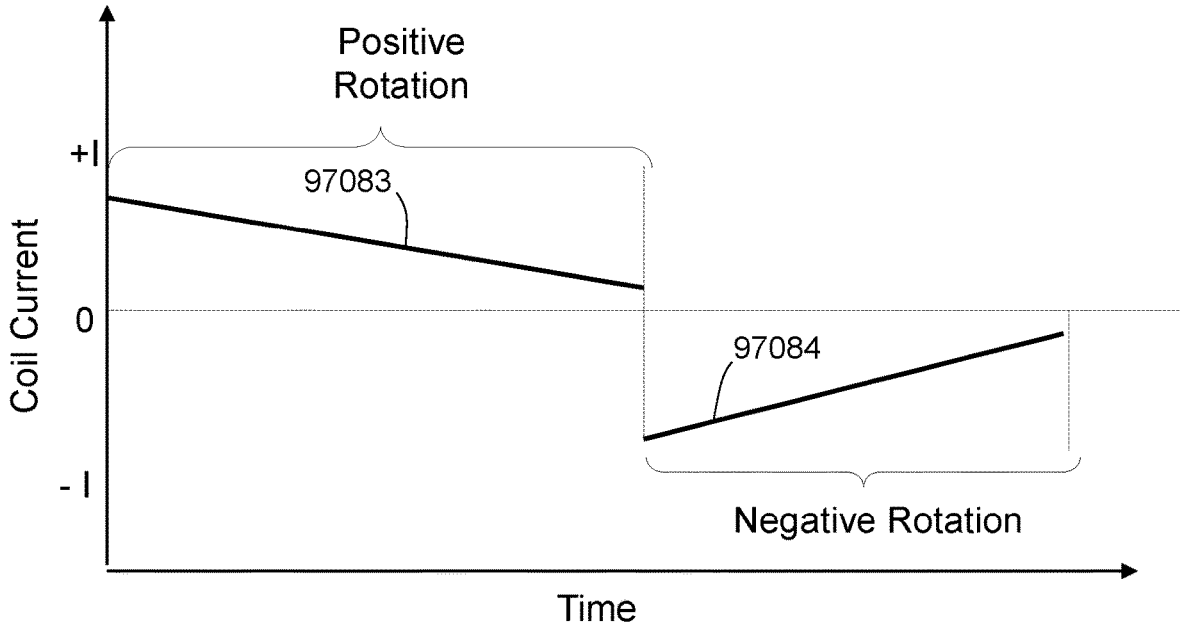

FIG. 138A illustrates first current driving scheme of actuator voice coil.

Figure 138B:
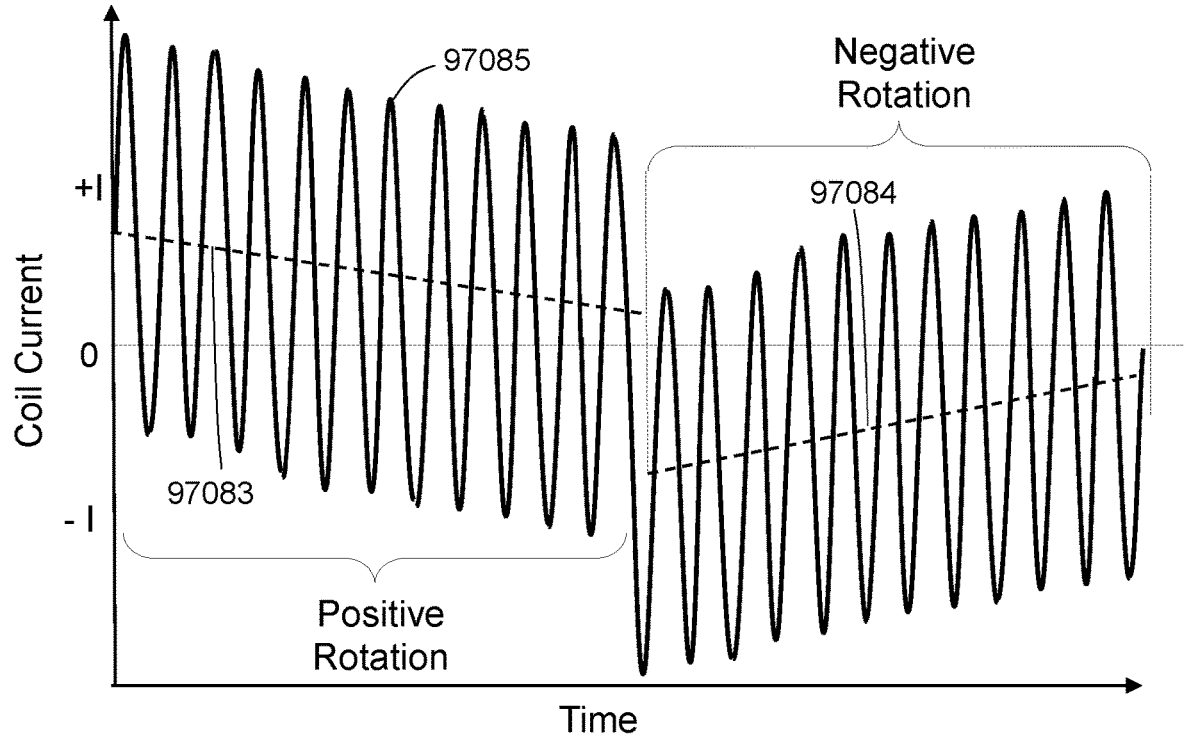

FIG. 138B illustrates second current driving scheme of actuator voice coil.

Figure 139:
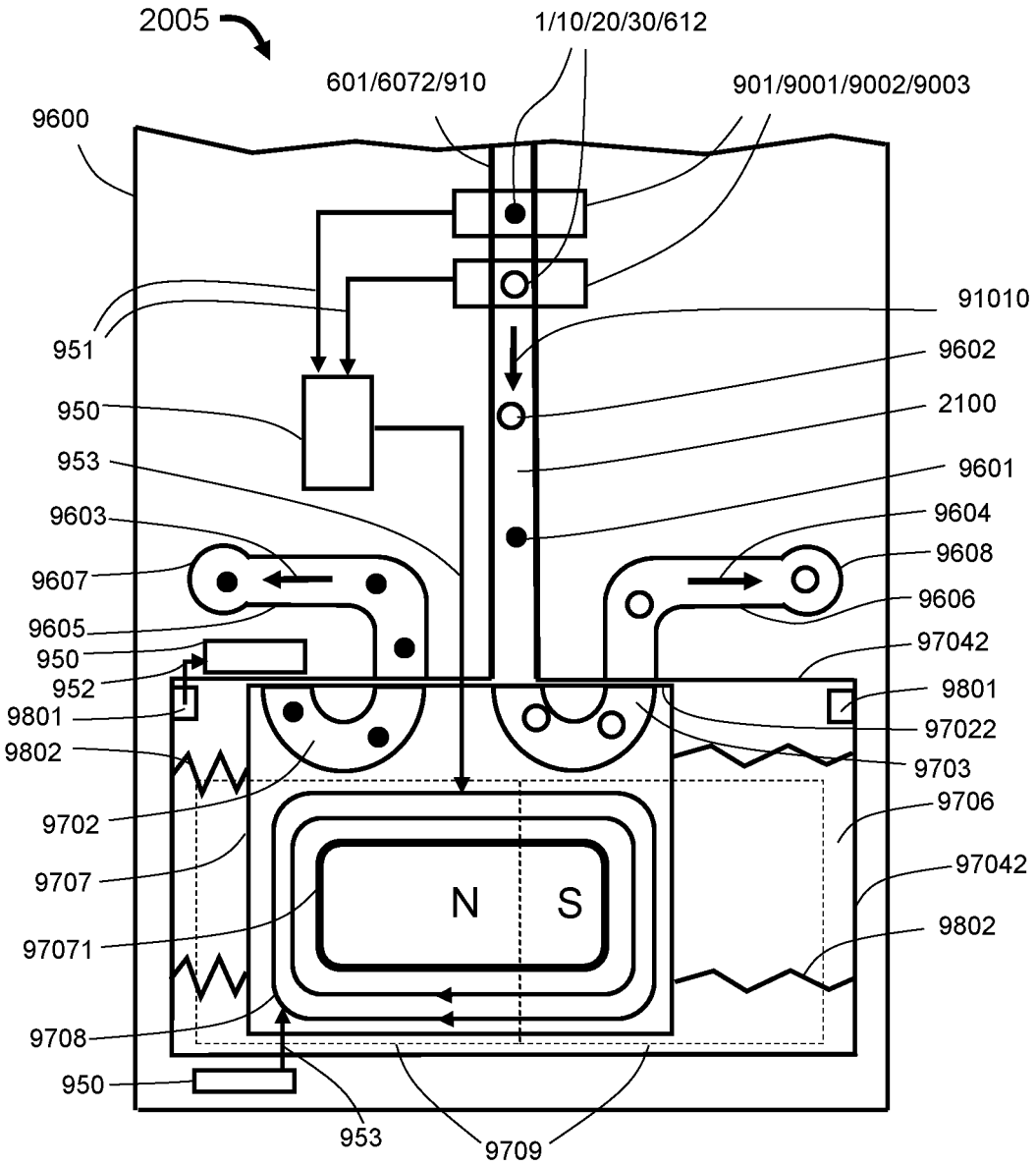

FIG. 139 illustrates a second embodiment of a biological entity sorting device having a fluid path selector being at a first sorting position.

Figure 140:
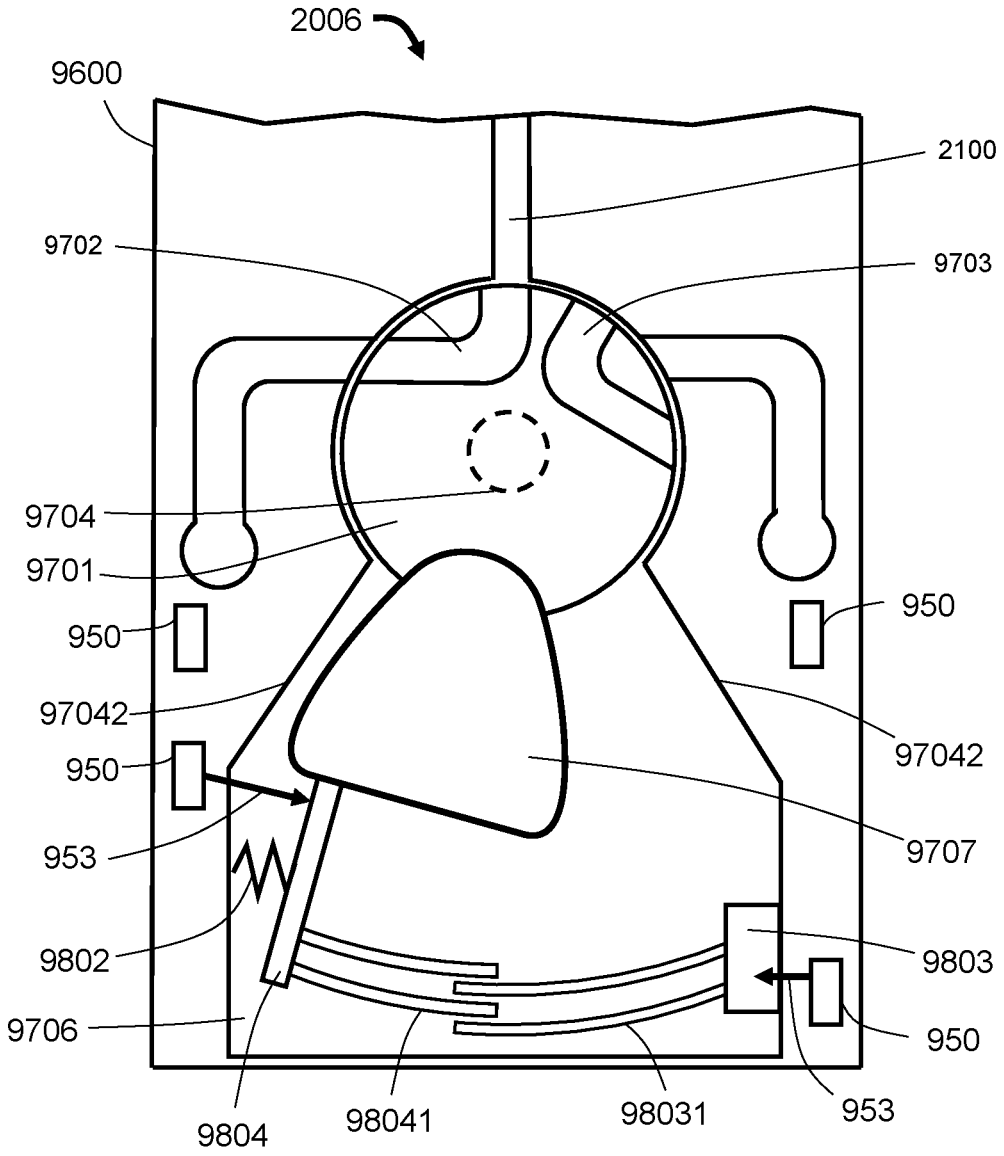

FIG. 140 illustrates a third embodiment of a biological entity sorting device having a capacitive actuator being at a first sorting position.

Figure 141:
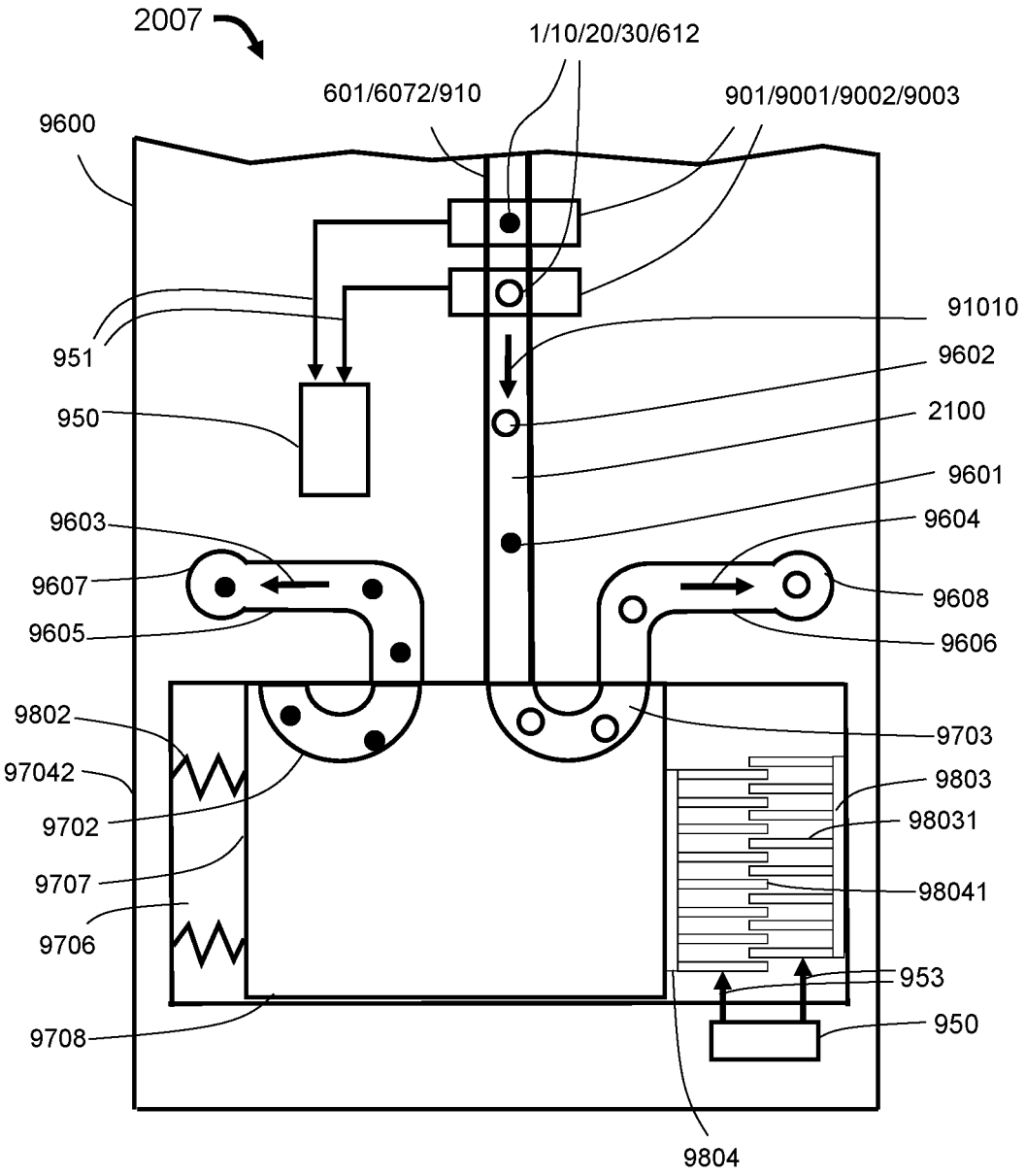

FIG. 141 illustrates a fourth embodiment of a biological entity sorting device having a capacitive actuator being at a first sorting position.

Figure 142:
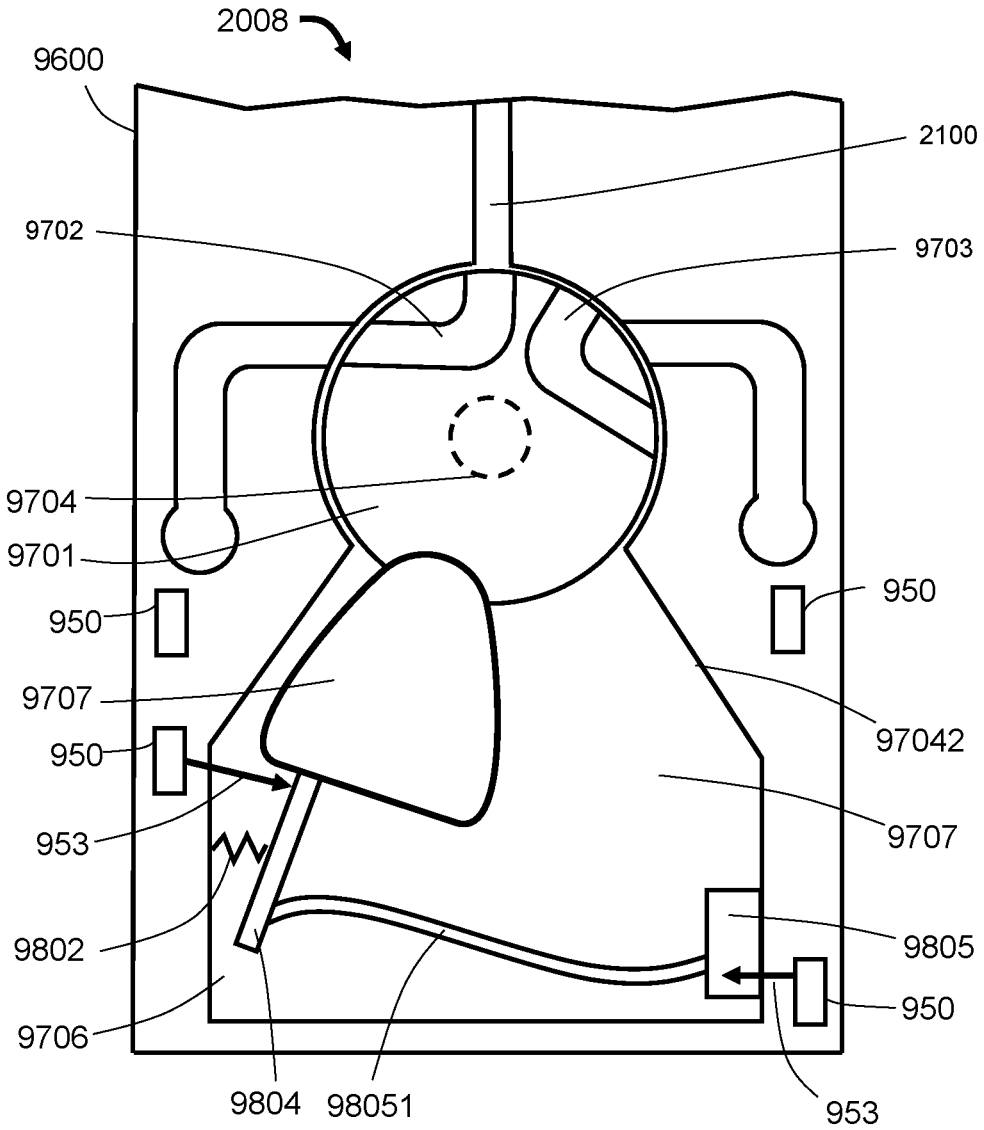

FIG. 142 illustrates a fifth embodiment of a biological entity sorting device having a thermal-elastic actuator being at a first sorting position.

Figure 143:
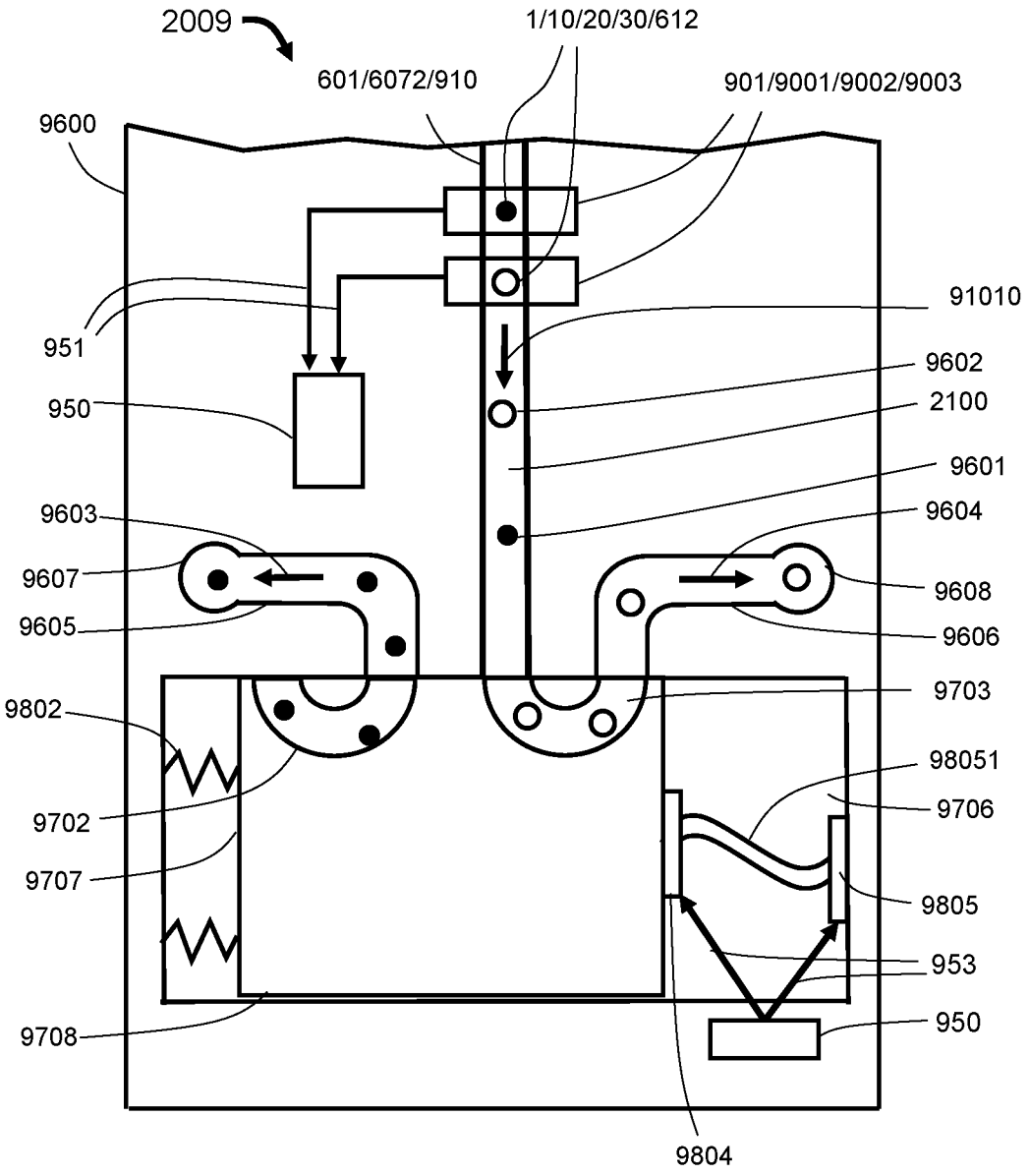

FIG. 143 illustrates a sixth embodiment of a biological entity sorting device having a thermal-elastic actuator being at a first sorting position.

Figure 144A:
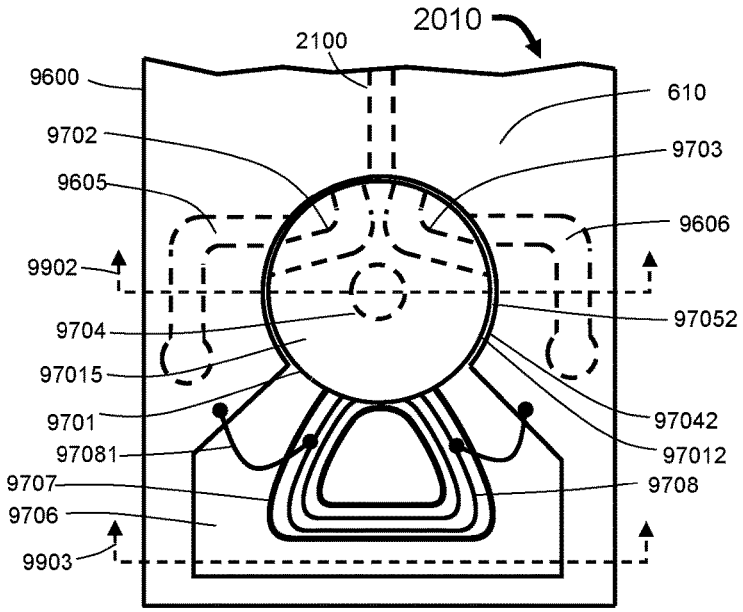

FIG. 144A illustrates example of FIG. 135A device having flow paths within substrate and flow paths within path selector being covered by separate top covers.

Figure 144B:
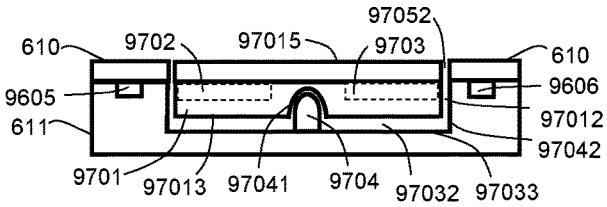

FIG. 144B illustrates view of FIG. 144A device along a first cross-section direction.

Figure 144C:
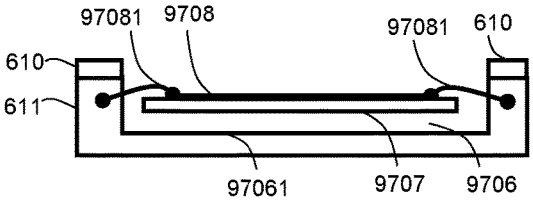

FIG. 144C illustrates view of FIG. 144A device along a second cross-section direction with actuator voice coil not covered by top cover.

Figure 144D:
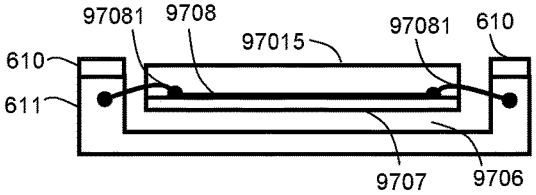

FIG. 144D illustrates view of FIG. 144A device along second cross-section direction with actuator voice coil covered by top cover.

Figure 144E:
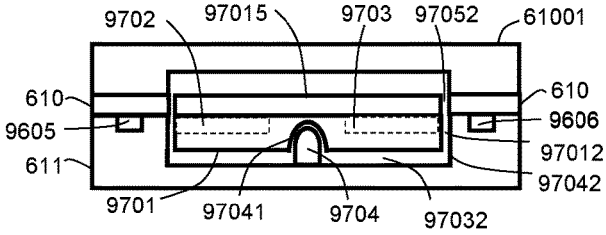

FIG. 144E illustrates view of FIG. 144A device along first cross-section direction showing an additional cover together with device substrate form an enclosure around sorting arm and actuator.

Figure 145:
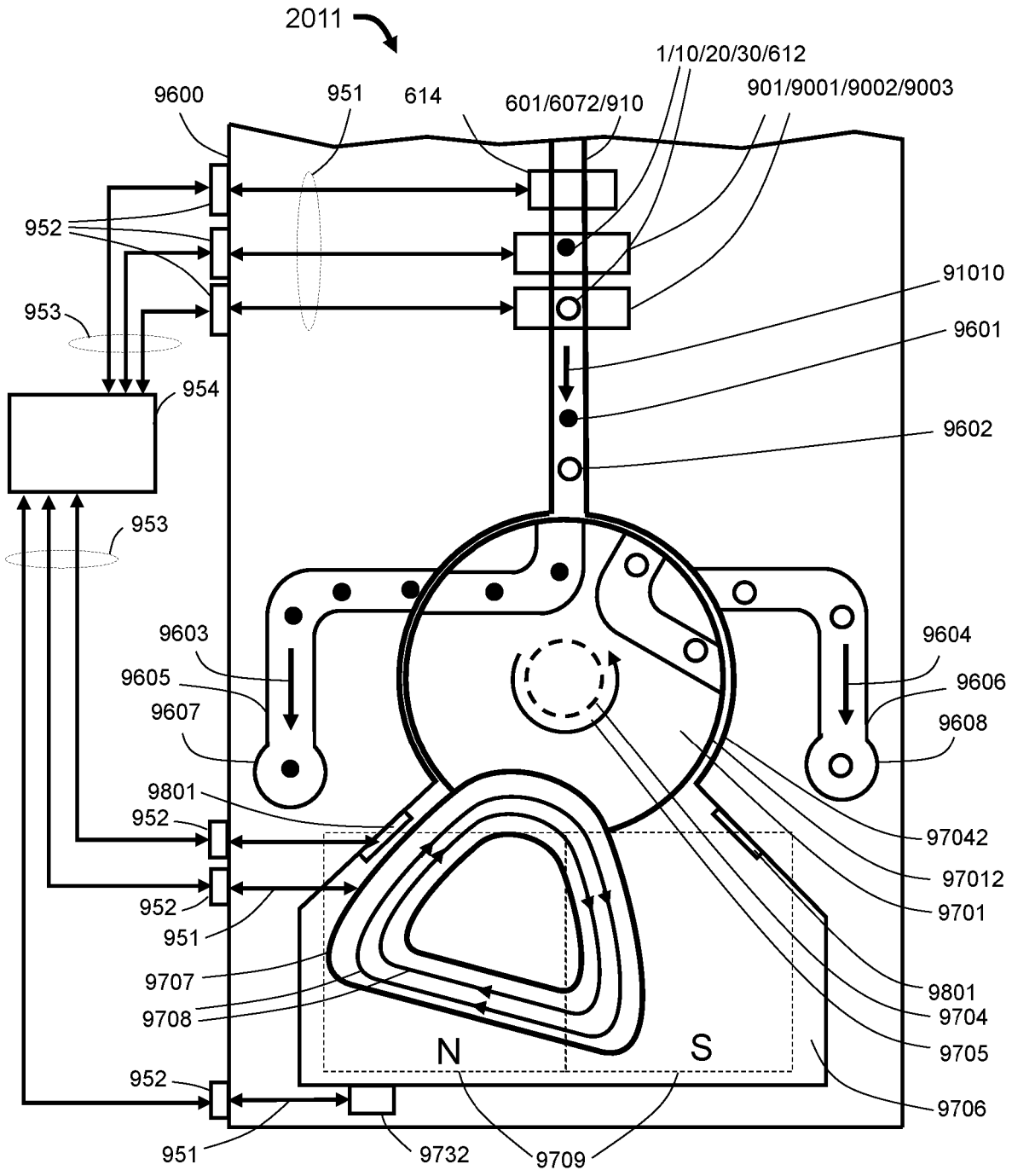

FIG. 145 illustrates external controller driving of sorting device.

Figure 146:
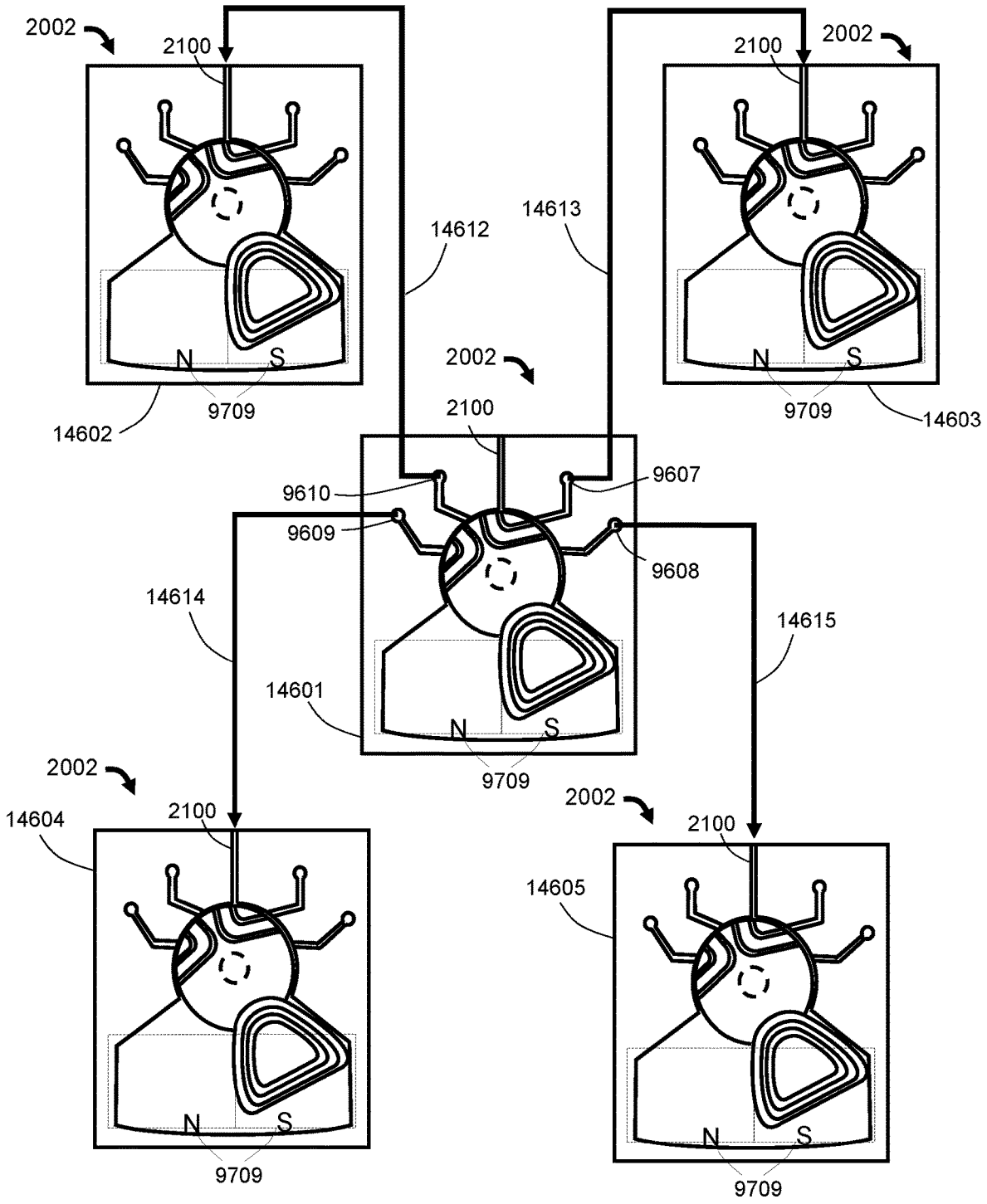

FIG. 146 illustrates an example of using multiple FIG. 134A devices in cascade arrangement to increase sorting categories.

Figure 147:
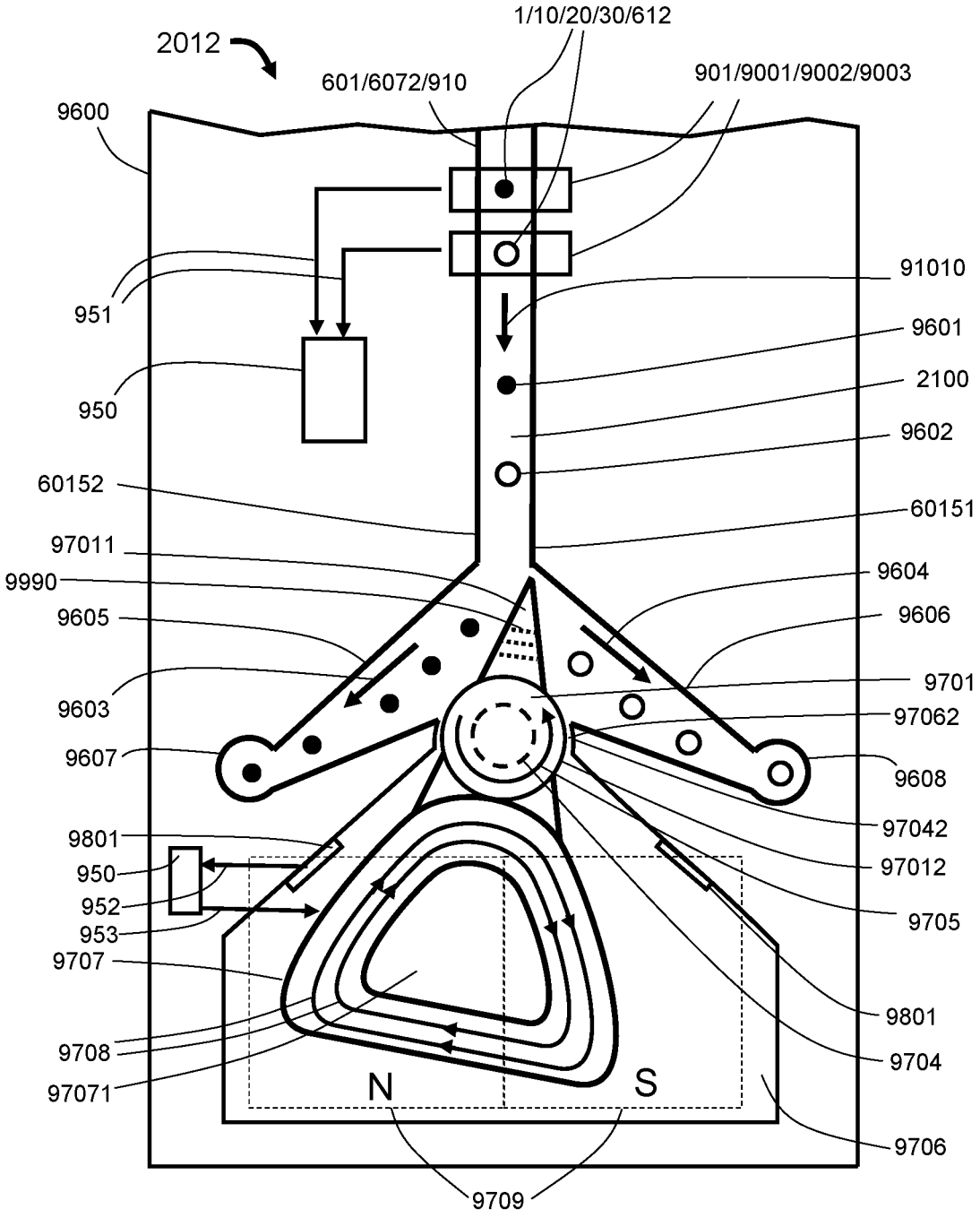

FIG. 147 illustrates a seventh embodiment of a biological entity sorting device having a fluid path selector being at a first sorting position.

Figure 148:
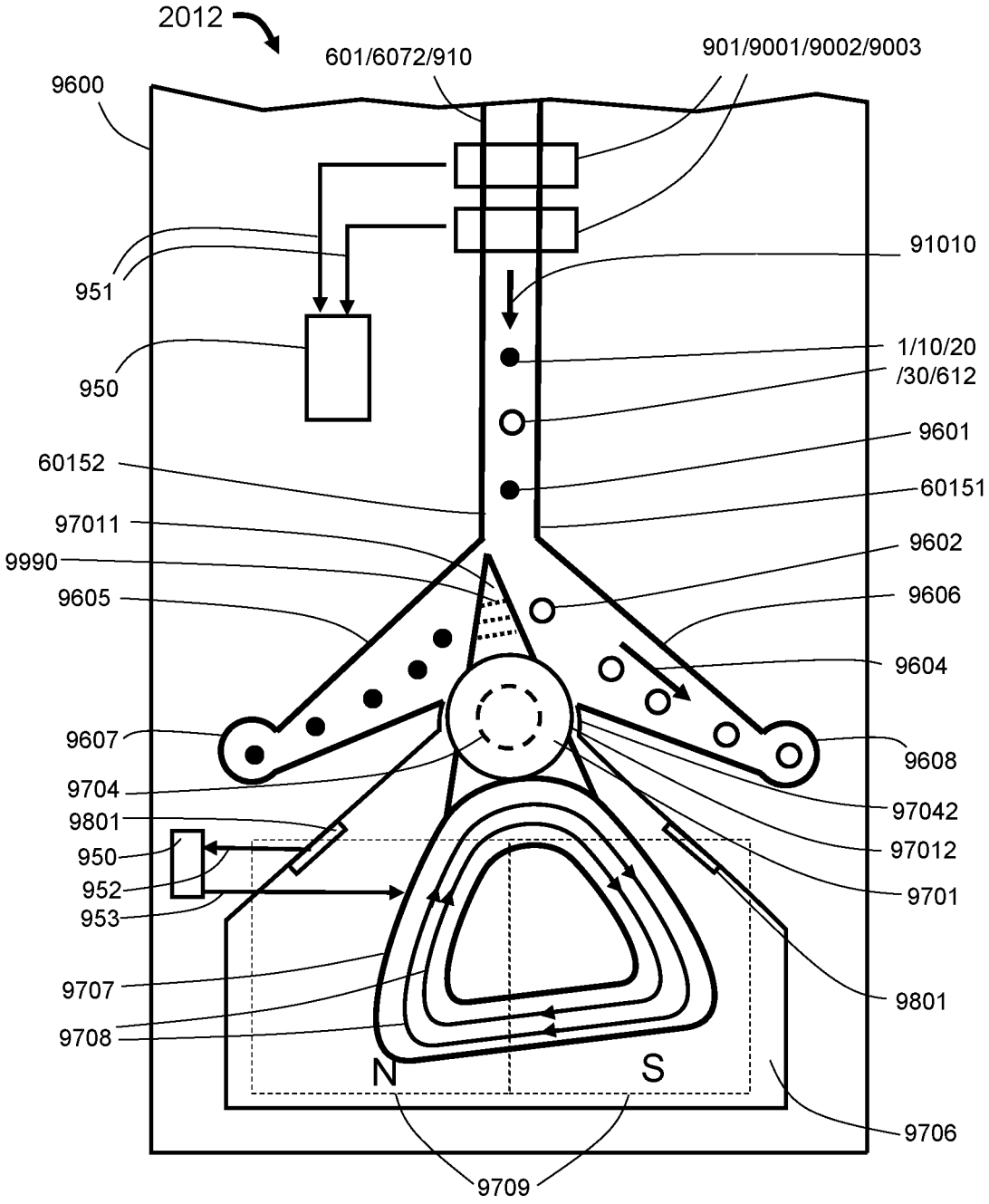

FIG. 148 illustrates FIG. 147 sorting device at a second sorting position.

Figure 149:
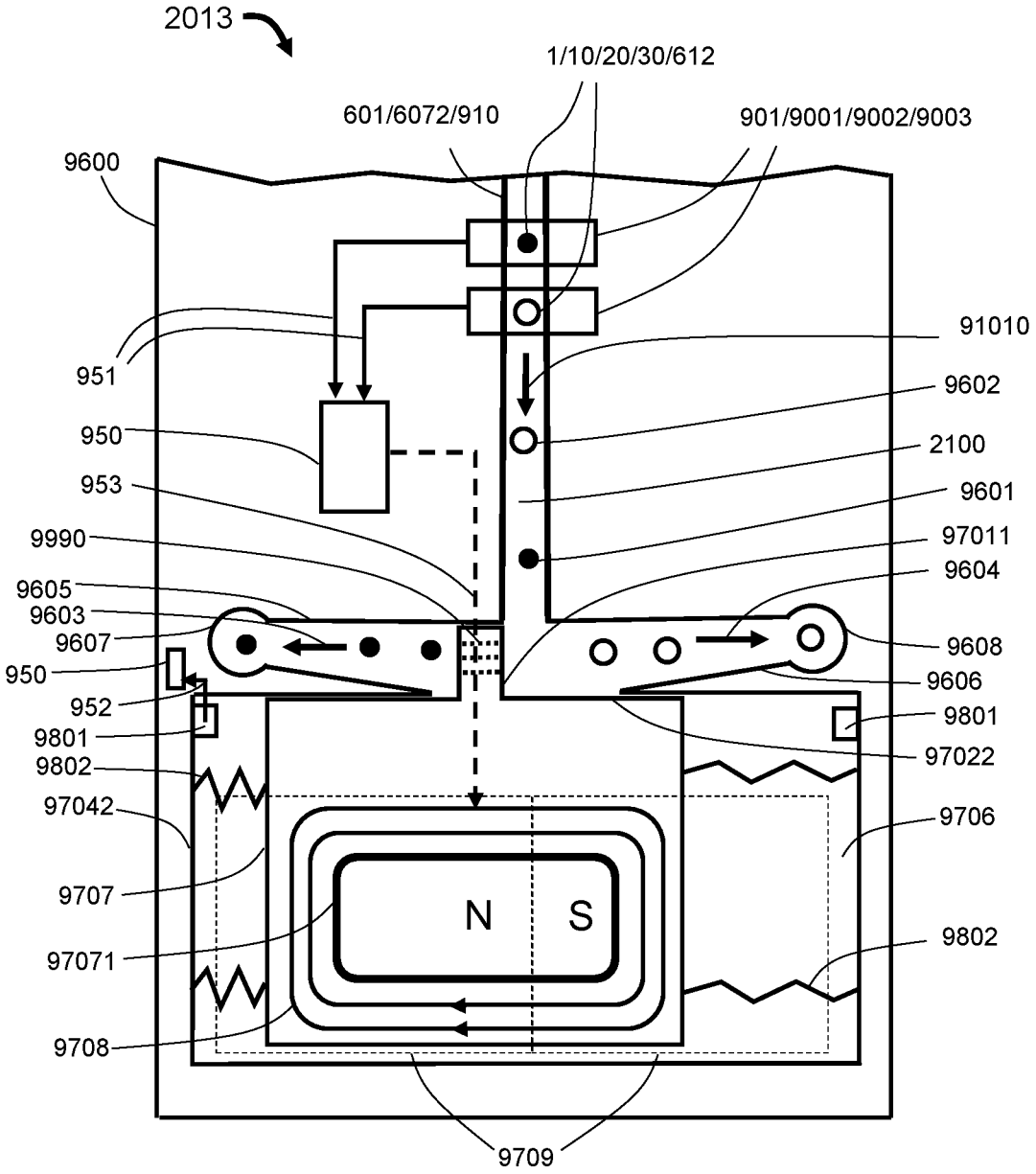

FIG. 149 illustrates an eighth embodiment of a biological entity sorting device having a fluid path selector being at a first sorting position.

Figure 150:
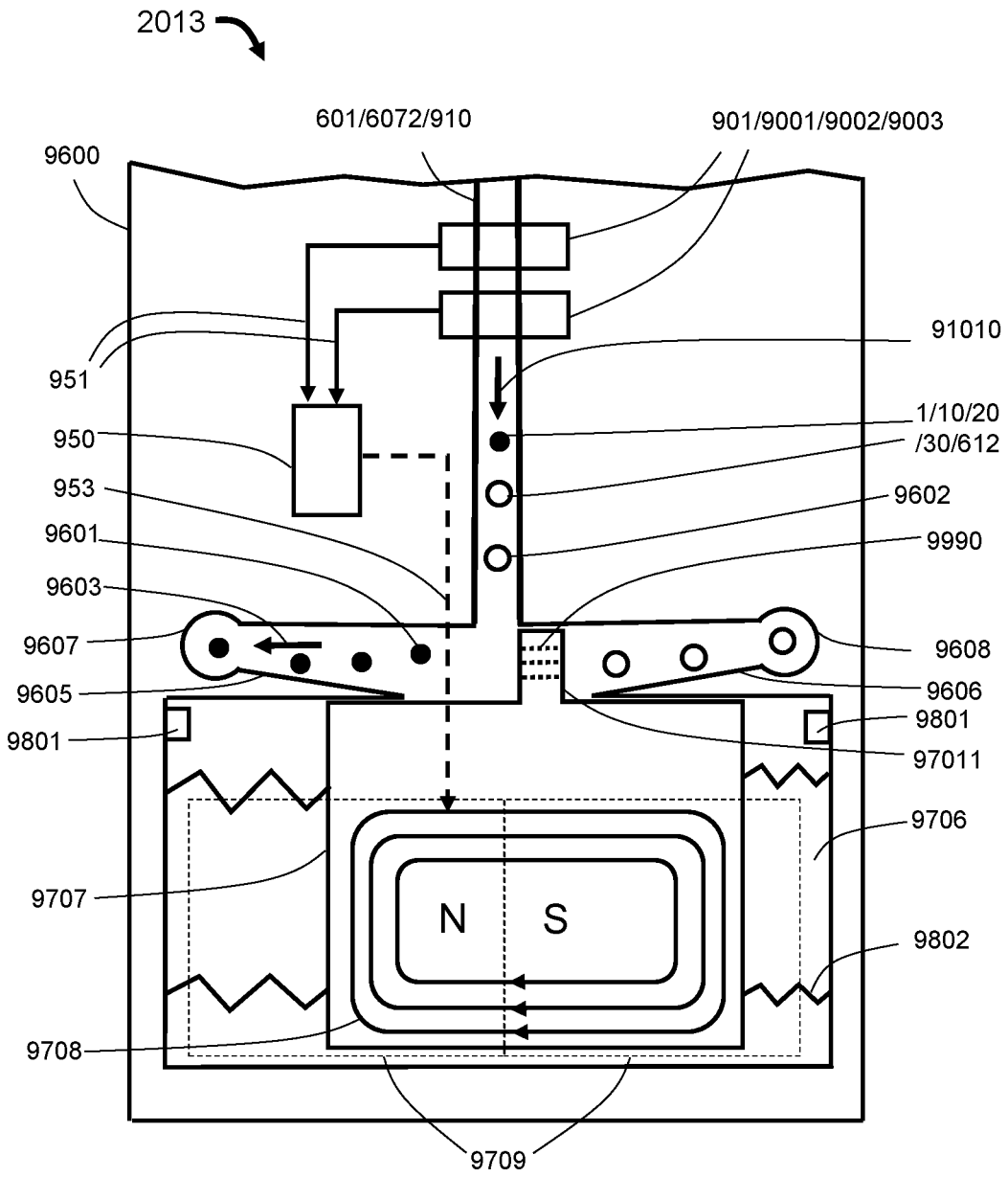

FIG. 150 illustrates FIG. 149 sorting device at a second sorting position.

For purposes of clarity and brevity, like elements and components will bear the same designations and numbering throughout the Figures, which are not necessarily drawn to scale.

DETAILED DESCRIPTION OF THE INVENTION

While the current invention may be embodied in many different forms, designs or configurations, for the purpose of promoting an understanding of the principles of the invention, reference will be made to the embodiments illustrated in the drawings and specific language will be used to describe the same. It will nevertheless be understood that no limitation or restriction of the scope of the invention is thereby intended. Any alterations and further implementations of the principles of the invention as described herein are contemplated as would normally occur to one skilled in the art to which the invention relates.

"Biological entities", or "entities", referred to hereafter include: cell, bacteria, virus, molecule, particles including RNA and DNA, cell cluster, bacteria cluster, molecule cluster, and particle cluster. Large entities and small entities refer to biological entities within same fluid having relatively larger physical size and smaller physical size. In one embodiment, large entities include any of: cells, bacteria, cell cluster, bacteria cluster, particle cluster, entities bound with magnetic labels, and entities bound with optical label. In another embodiment, small entities include any of: molecules, particles, virus, cellular debris, non-bound free magnetic labels, and non-bound free optical labels. In another embodiment, large entities have a physical size larger than 1 micrometer (um), and small entities have a physical size less than 1 um. In yet another embodiment, large entities have a physical size larger than 2 um, and small entities have a physical size less than 500 nanometer (nm). In yet another embodiment, large entities have a physical size larger than 5 um, and small entities have a physical size less than 2 um. Biological sample include: blood, body fluid, tissue extracted from any part of the body, bone marrow, hair, nail, bone, tooth, liquid and solid from bodily discharge, or surface swab from any part of body. Entity liquid, or fluid sample, or liquid sample, or sample solution, include: biological sample in its original liquid form, biological entities being dissolve or dispersed in a buffer liquid, or biological sample after dissociation from its original biological sample non-liquid form and dispersed in a buffer fluid. Biological entities and biological sample may be obtained from human or animal. Biological entities may also be obtained from plant and environment including air, water and soil. Entity fluid, or fluid sample, or sample may contain various types of magnetic or optical labels, or one or more chemical reagents that may be added during various steps within the embodiments of this invention. Sample flow rate is volume amount of a fluid sample flowing through a cross-section of a channel, or a fluidic part, or a fluidic path, in a unit time, where volume may be in unit of liter (l), milliliter (ml), microliter (ul), nanoliter (nl), and unit time may be in unit of minute (min), second (s), millisecond (ms), microsecond (us), nanosecond (ns). Sample flow speed is the distance of a free molecule or a free entity that travels within a liquid sample in a channel, or a fluidic part, or a fluidic path, in a unit time, where distance may be in unit of meter (m), centimeter (cm), millimeter (mm), micrometer (um). Separation efficiency is percentage of target entities within a liquid sample that are successfully separated from the liquid sample by a method designed to separate the target entities. Buffer fluid is a fluid base where biological entities may be dissolved into, or dispersed into, without introducing additional biological entities.

Figure 4:
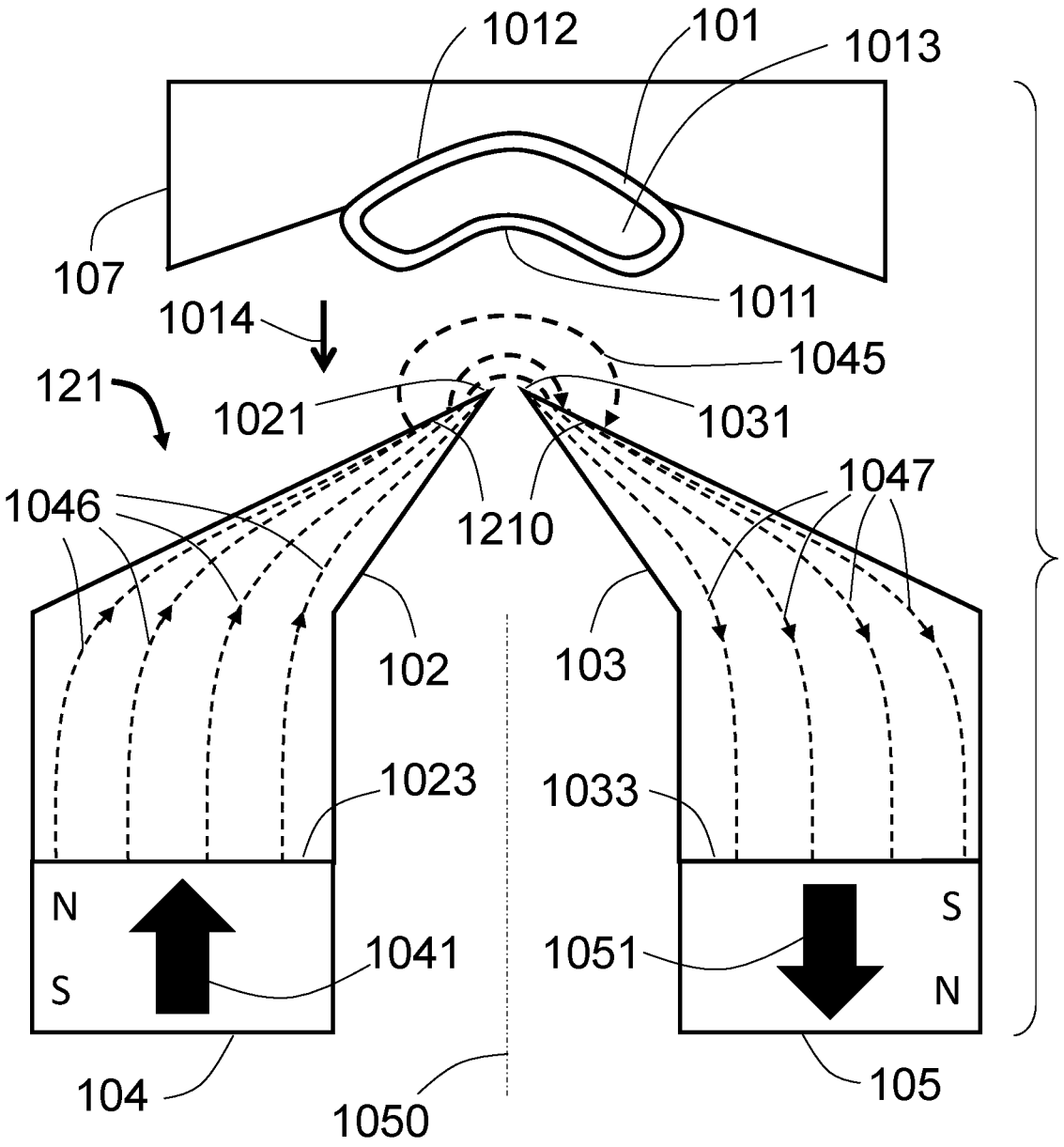
FIG. 4 is a cross-sectional view of the first embodiment of a magnetic separation device ("MAG") with a "C" shape rigid channel.

FIG. 4 shows a cross-sectional view of the first embodiment of a magnetic separation device ("MAG") of the current invention. MAG 121 is composed of two magnetic field producing poles, pole 102 and pole 103. Each of the poles 102 and 103 is composed of soft magnetic material, which may include one or more elements of iron (Fe), cobalt (Co), nickel (Ni), iridium (Ir), manganese (Mn), neodymium (Nd), boron (B), samarium (Sm), aluminum (Al). Pole 102 has a magnetic flux collection end 1023 and a tip end 1021, where shape of the pole 102 is converging from the flux collection end 1023 towards the tip end 1021. In FIG. 4, flux collection end 1023 is a flat surface which is contacting, or in proximity to, the North Pole ("N") surface of a permanent magnet 104. Permanent magnet 104 has a magnetization as shown by arrow 1041 in FIG. 4 which points from the South Pole ("S") surface of to the N surface of the magnet 104. Magnetization 1041 produces magnetic field in free space, which can be described as flux lines 1046 emitting from N surface to returning to S surface of the magnet 104. Pole 102 flux collection end 1023 being in contact with, or in close proximity to, the N surface of magnet 104 as shown in FIG. 4, due to the soft magnetic material of pole 102, magnetic flux 1046 from the N surface of magnet 104 is collected by the pole 102 and enters the body of the pole 102 through flux collection end 1023. Due to the converging shape of the pole 102, the collected magnetic flux is mainly channeled within the soft magnetic body of the pole 102 and emitted from the tip end 1021 of pole 102. Said close proximity between flux collection end 1023 and N surface of magnet 104 may be a gap distance in between surface of 1023 and N surface being less than 1 mmm. Tip end 1021 may have a much smaller surface area than flux collection end 1023, which makes flux exiting the tip end 1021 having a higher flux density than when flux 1045 is emitted by N surface of magnet 104, i.e. magnetic flux 1045 is concentrated and thus creating a local high magnetic field and high field gradient around the tip end 1021. It is preferred that tip end 1021 of the pole 102 is as small as possible, for example as a convergence point, to produce largest flux concentration for achieving highest magnetic field. However, in practice, due to manufacturing process, tip end 1021 may have a curved or domed shape, which shall not affect the general concept of flux concentration by the tip end 1021. Pole 103 is similar to pole 102 in that pole 103 has a larger flux collection end 1033 and a smaller tip end 1031, where flux collection end 1033 is in contact with, or in close proximity to, S surface of permanent magnet 105. It is preferred that pole 103 and magnet 105 are identical to pole 102 and magnet 104, but arranged as mirroring to pole 102 and magnet 104 around a center line 1050. Magnet 105 magnetization 1051 is opposite to magnetization 1041 of magnet 104. Magnetic flux 1047 collected by flux collection end 1033 from S surface of pole 103 is opposite to that of pole 102, and flux emitted from tip end 1031 of pole 103 is opposite to that of tip end 1021. Thus, between the gap of tip end 1021 and 1031, emitted flux can form closed loop and further enhance the magnetic field strength and field gradient around the tip ends 1021 and 1031. Dashed lines 1045 are schematic of the flux emitted from tip end 1021 and returns to tip end 1031. Flux lines 1045 closer to tip end 1021 and 1031 being denser indicates stronger magnetic field and larger field gradient closer to the gap area. As shown in FIG. 4, top section of pole 102 is tilted to the right side, while top section of pole 103 is tilted to the left. This tilted shape diverts the magnetic flux within poles 102 and 103 away from bottom section of the poles and helps make the tip end 1021 of pole 102 and tip end 1031 of pole 103 being the closest spaced features of the poles 102 and 103 to achieve high field in gap between tip ends 1021 and 1031 with minimizing flux leakage between lower bodies of pole 102 and 103. In FIG. 4, the tilted top sections of the poles 102 and 103 form a triangle shape, or convex shape, top surface 1210 of the MAG 121, which will be described as "MAG wedge" 1210 of MAG 121 hereafter. Permanent magnets 104 and 105 may be composed of any of, but not limited to, Nd, Fe, B, Co, Sm, Al, Ni, Sr, Ba, O, NdFeB, AlNiCo, SmCo, strontium ferrite (SrFeO), barium ferrite (BaFeO), cobalt ferrite (CoFeO).

FIG. 4 embodiment includes a rigid fixed shape channel 101. Channel 101 has a channel wall enclosing a channel space 1013, where fluid sample may flow through channel 101 in the channel space 1013 along the channel 101 length direction that is perpendicular to the cross-section view of FIG. 4. Channel 101 has a top surface 1012 and a bottom surface 1011. Bottom surface 1011 is formed in a shape conforming to the MAG wedge surface 1210, such that when channel 101 is moved in direction 1014 to be in contact with the MAG 121 poles 102 and 103, bottom surface 1011 of channel 101 is in contact with MAG wedge surface 1210 with no or minimal gap in between bottom surface 1011 and MAG wedge surface 1210. Top surface 1012 of channel 101 is preferred to be conformal to bottom surface 1011 to produce a channel space 1013 with a shape that maximizes exposure of fluid sample flowing through channel 101 to the highest magnetic field region of the MAG wedge gap field 1045.

In FIG. 4 embodiment, poles 102 and 103, magnets 104 and 105, and channel 101 extend in the direction perpendicular to the cross-section view of FIG. 4, which will be referred to as "length direction" hereafter. Fluid sample flows in the channel 101 and is contained in channel space 1013 along the length direction. Channel 101 being a rigid and fixed shape channel, the wall thickness of channel 101 at surface 1011 may be thinner than wall thickness at surface 1012, such that channel 101 mechanical robustness is maintained by the thicker wall at surface 1012, and magnetic field effect on fluid sample is enhanced by thinner wall at surface 1011 allowing fluid sample being closer to the MAG wedge 1210 and tip ends 1021 and 1031. Channel 101 may be attached to a non-magnetic channel holder 107 at the top surface 1012. Channel holder 107 may align channel 101 to MAG wedge 1210, move channel 101 to separation position in contact with MAG 121, or lift channel 101 away from MAG 121 after magnetic separation. Channel holder 107 may be composed of any non-magnetic material including, but not limited to, metal, non-metal element, plastic, polymer, ceramic, rubber, silicon, and glass. In FIG. 4, flux collection ends 1023 and 1033 of the soft magnetic poles 102 and 103 may also be referred to as base ends 1023 and 1033.

Permanent magnets as described in different embodiments of this invention, for example magnets 104 and 105 of FIG. 4, may each have opposite magnetization direction to that is described in the each of the figures and embodiments without affecting the designs, functions and processes of the embodiments.

Figure 1A:
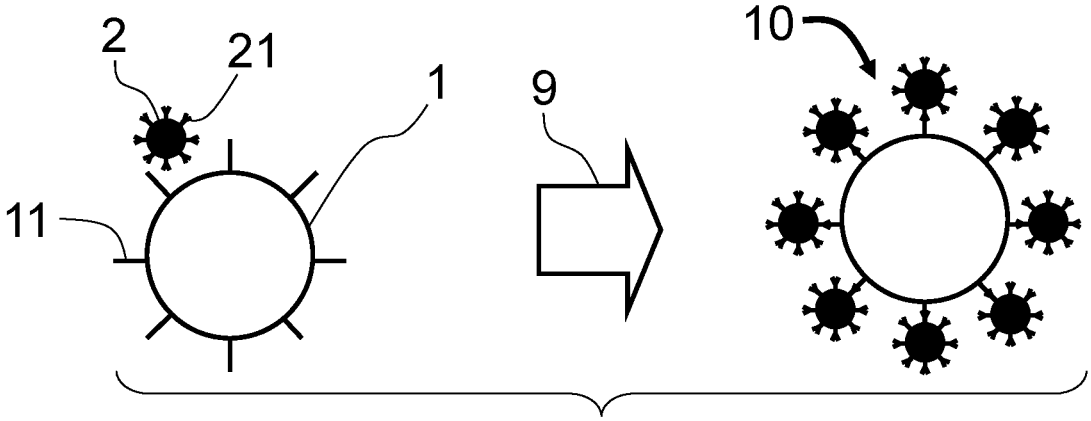
FIG. 1A illustrates superparamagnetic labels (SPL) binding to a cell.
Figure 1B:
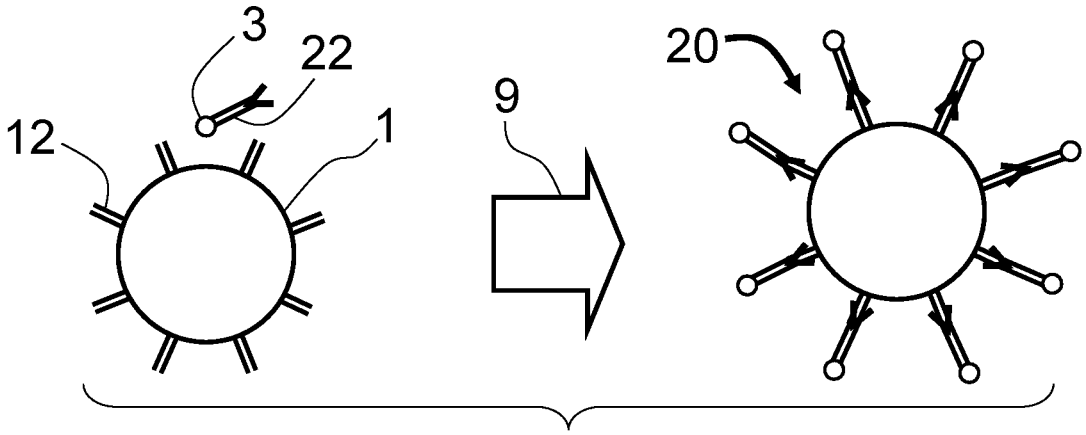
FIG. 1B illustrates optical fluorescent labels (OFL) binding to a cell.
Figure 1C:
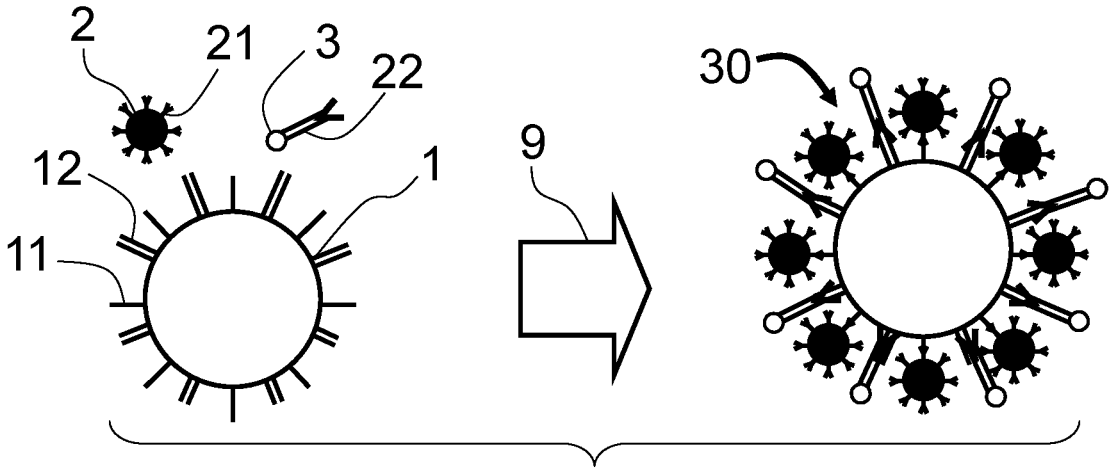
FIG. 1C illustrates SPLs and OFLs binding to a cell.
Figure 2A:
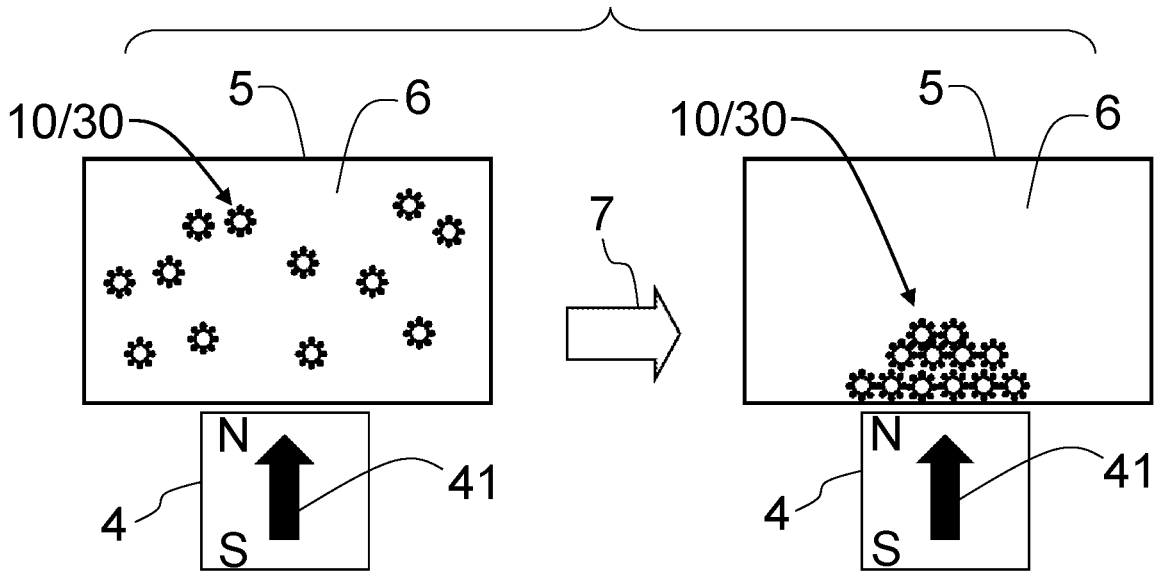
FIG. 2A illustrates cells bound with SPLs being separated by a magnet.
Figure 2B:
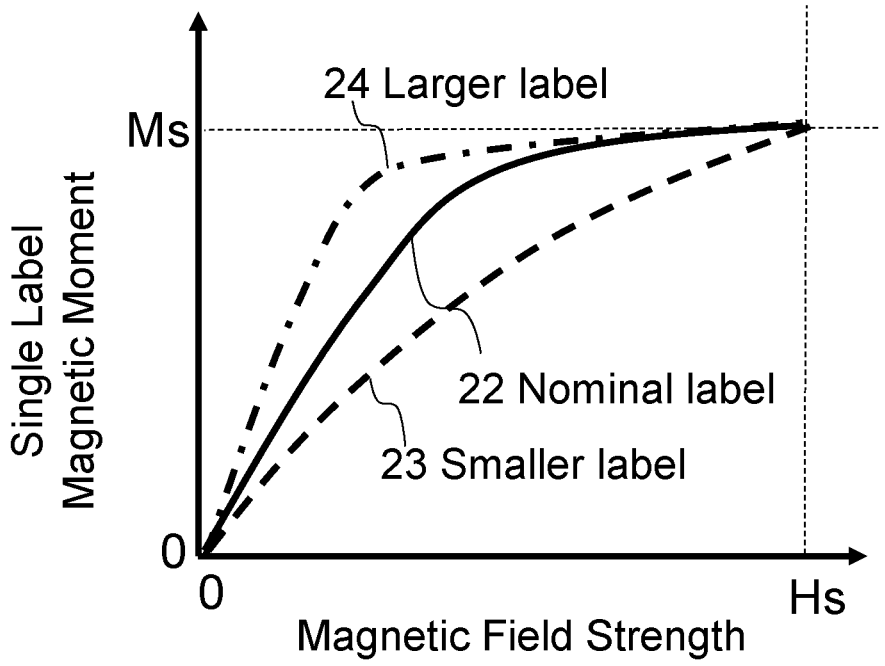
FIG. 2B is a plot of SPL magnetization vs magnetic field strength for different SPL sizes.
Figure 3A:
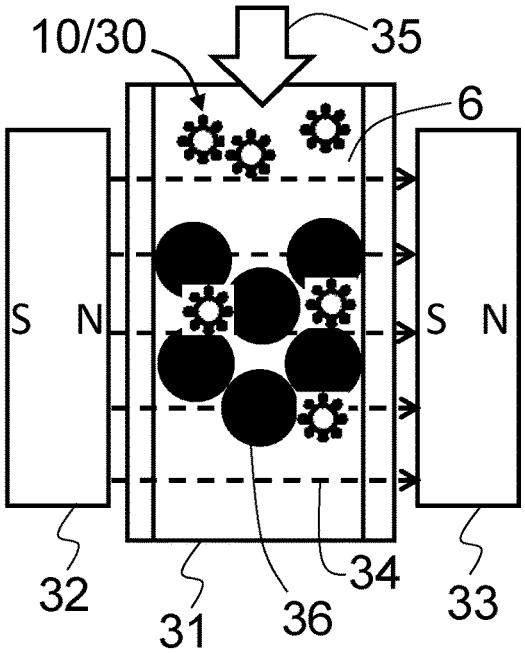
FIG. 3A (Prior Art)
FIG. 3A is a cross-sectional view of a prior art magnetic cell separator.
Figure 3B:
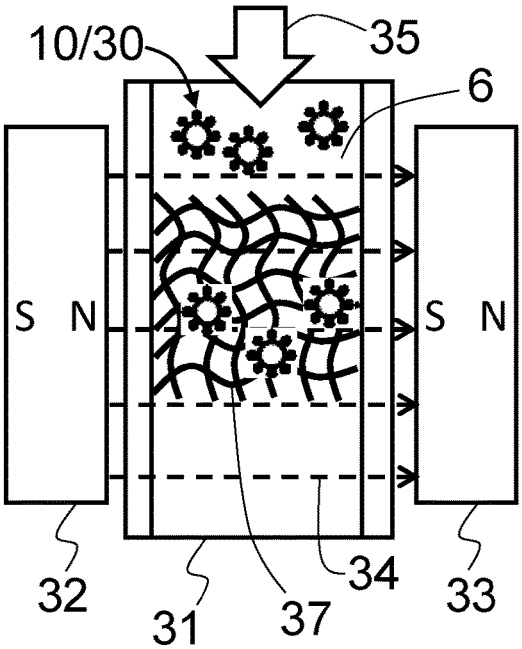
FIG. 3B (Prior Art)
FIG. 3B is a cross-sectional view of a prior art magnetic cell separator.
Figure 3C:
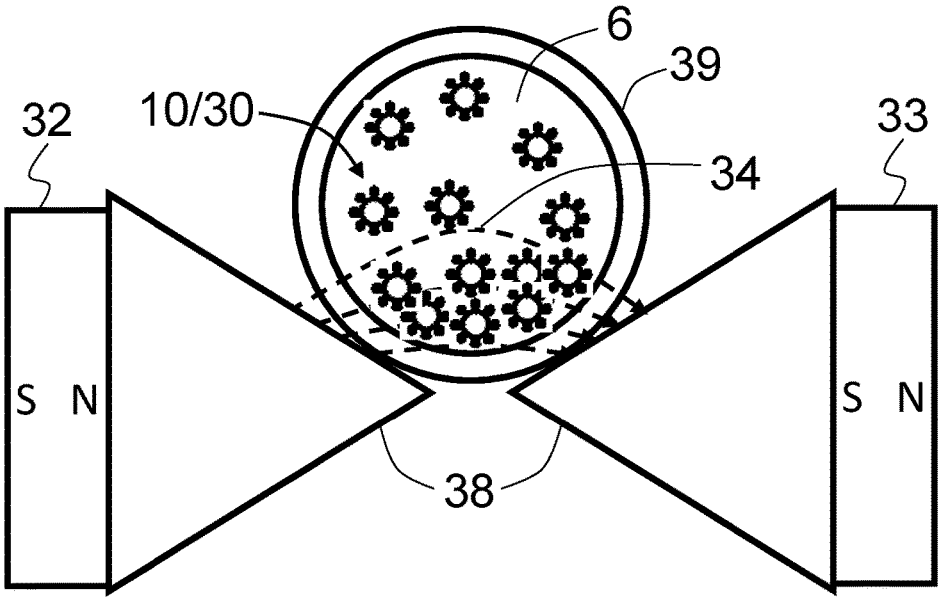
FIG. 3C (Prior Art)
FIG. 3C is a cross-sectional view of a prior art magnetic cell separator.
Figure 5:
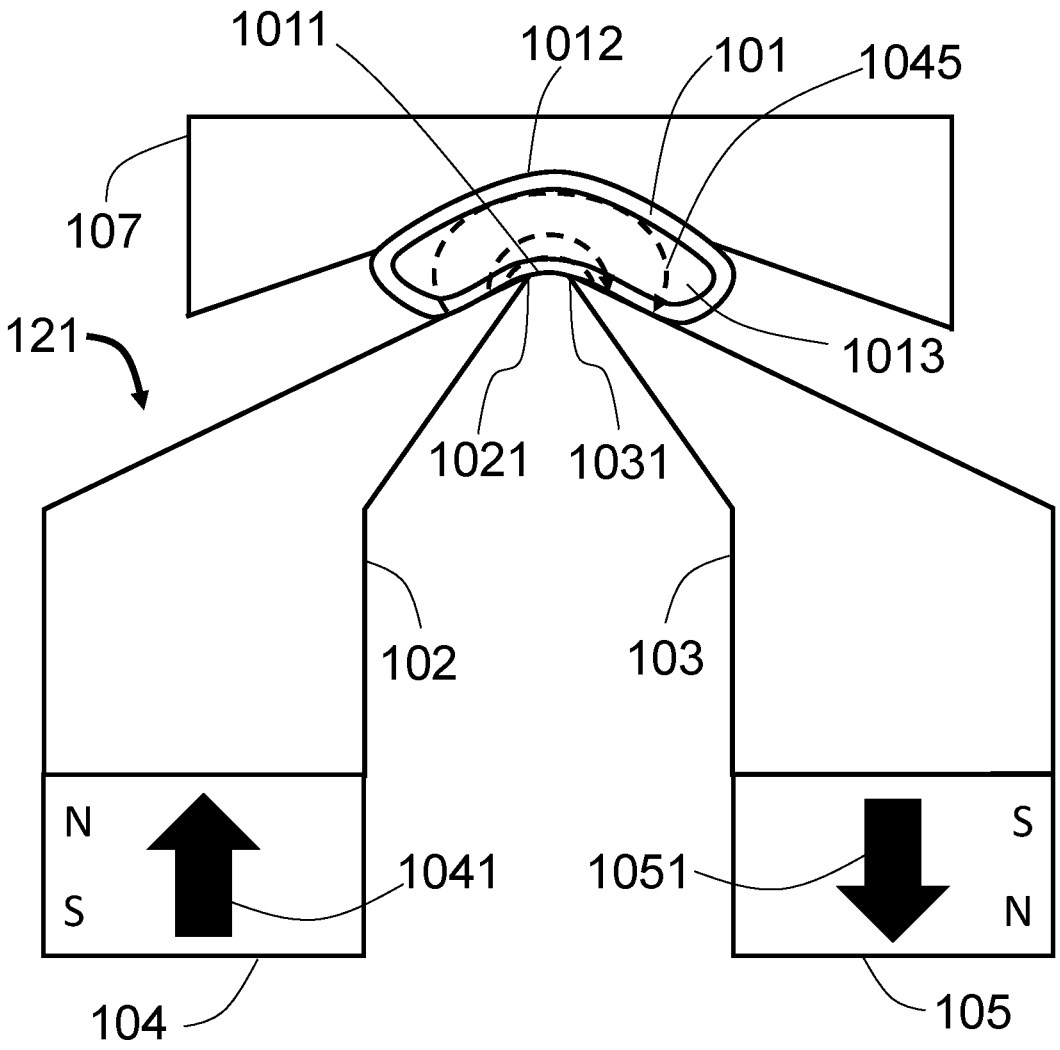
FIG. 5 is a cross-sectional view of the first embodiment of MAG having a "C" shape rigid channel in separation position.

FIG. 5 is the cross-sectional view of FIG. 4 first embodiment of MAG with channel 101 in magnetic separation position. Channel 101 of FIG. 4 moves along direction 1014 and comes into contact with MAG wedge 1210 surface by bottom surface 1011. MAG 121 gap formed by tip ends 1021 and 1031 is brought into contact with, or minimal distance to, wall of channel 101 and the fluid sample flowing in the channel 101. Channel 101 "C" shape matching to the MAG wedge shape helps achieve large cross-sectional area of the channel space 1013 to maintain a high flow rate, and at the same time confines cells 10/30 in the fluid sample flowing in channel 101 to a high field and high gradient region of the MAG 121 gap field as indicated by the field lines 1045. Compared to prior art of FIG. 3A and FIG. 3B, first embodiment MAG 121 does not introduce foreign material in the channel 101 while achieving comparable or higher magnetic field and field gradient on cells 10/30 flowing through the channel 101. Removing of poles 102 and 103 together with magnets 104 and 105 from channel 101 will eliminate field generation source and avoids limitation of prior art domain related cells loss. Compared to prior art of FIG. 3C, MAG wedge of FIG. 5 being in contact with the channel 101 wall brings highest achievable magnetic field and field gradient to the fluid sample in the channel 101 for a more efficient cell 10/30 separation. Channel 101 shape being conformal to MAG wedge shape allows channel 101 to have a large cross-sectional sample flow area, meanwhile avoids the deficiency of prior art that cells 10/30 at top end of a circular channel experiencing much lower magnetic field than at lower end that ultimately limits sample flow rate. Thus, sample flow rate in channel 101 can be higher than prior art while achieving better magnetic separation efficiency.

Figure 6:
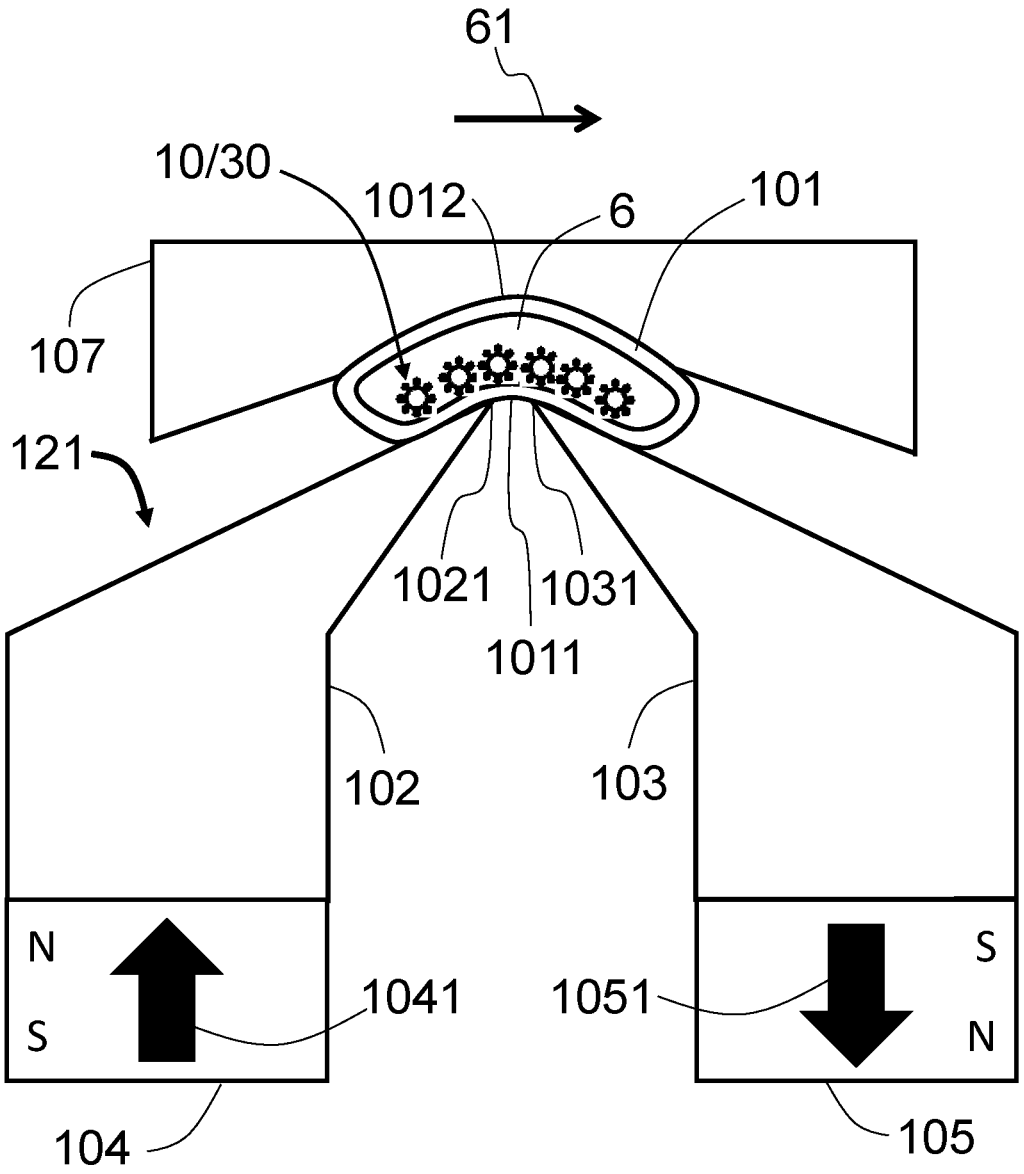
FIG. 6 is a cross-sectional view of the first embodiment of MAG having a "C" shape rigid channel in separation position with cells being separated.

FIG. 6 is same as FIG. 5, except biological entities, or cells 10/30 for simplicity of description, are included to describe magnetic separation by MAG 121 from a fluid sample 6.

Fluid sample 6 carrying cells 10/30 is flown through channel 101 along length direction of channel 101 perpendicular to the FIG. 6 cross-sectional view. MAG 121 gap magnetic field magnetizes the SPL 2 attached to cells 10/30 and field gradient pulls cells 10/30 from the fluid 6 towards the MAG wedge to form conglomerate layer against the 1011 bottom surface of channel 101. Due to MAG 121 design and channel 101 shape, cells 10/30 close to top surface 1012 experience magnetic field not significantly lower than close to bottom surface 1011, and distance for cells 10/30 to travel from top surface 1012 to conglomerate on bottom surface 1011 is much shorter than in prior art, these characteristics allow MAG 121 to resolve deficiencies of prior art.

Figure 7:
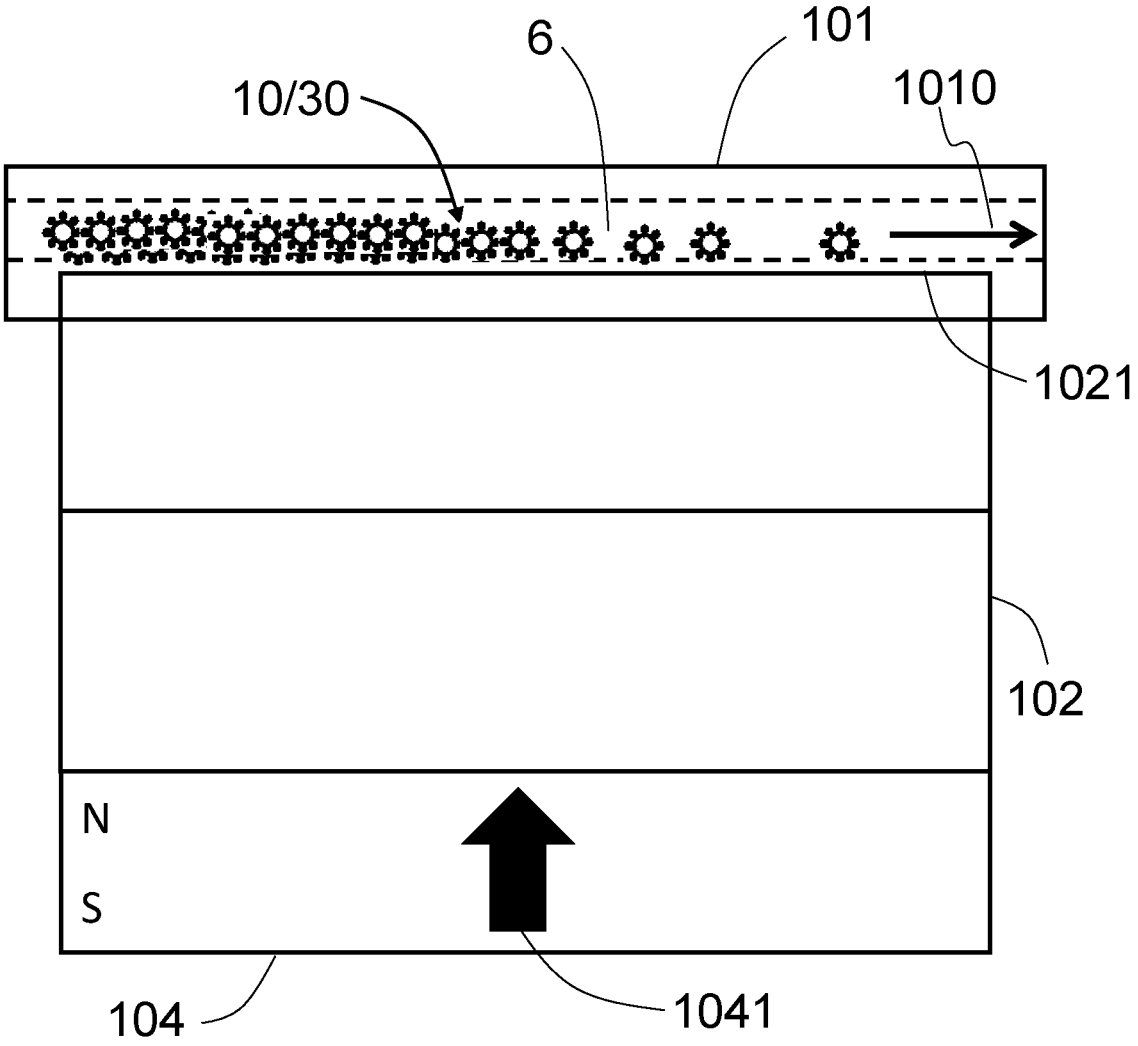
FIG. 7 is a side view of FIG. 6.

FIG. 7 is a side view of FIG. 6 along direction 61 of FIG. 6. Fluid sample 6 carrying cells 10/30 flows from left to right in the channel 101 as indicated by arrow 1010. With the MAG 121 gap field, cells 10/30 are separated from fluid 6 to form conglomerate on the channel wall of bottom surface 1011. FIG. 7 shows that majority of the cells 10/30 are separated from liquid 6 at the earlier section of the channel 101 length, as indicated by the crowded population of cells 10/30. As certain tail population cells 10/30 may have comparatively smaller size SPL 2 or fewer number of SPL 2 bound to it surface, time required for such tail population cells to be pulled to bottom surface 1011 is longer than nominal population during fluid 6 flowing through channel 101. Thus, population of separated cells 10/30 will show density decrease from inlet towards outlet of channel 101.

Figure 8A:
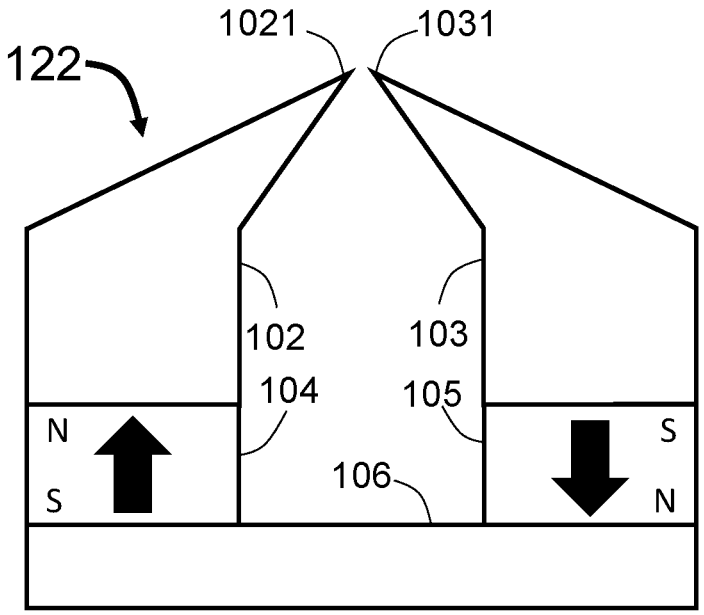
FIG. 8A is a cross-sectional view of the second embodiment of MAG.

FIG. 8A is a cross-sectional view of a second embodiment of MAG of current invention. MAG 122 in FIG. 8A is substantially similar as MAG 121, except a soft magnetic shield 106 is attached to the S surface of magnetic 104 and N surface of magnet 105. Magnetic flux from S surface of magnet 104 and N surface of magnet 105 forms closure path within the soft magnetic shield 106. MAG 122 compared to MAG 121 will have less magnetic flux leakage outside of the MAG 122 structure, where magnetic flux generated by magnets 104 and 105 are mainly confined within the soft magnetic material body of poles 102 and 103, and shield 106. MAG 122 is preferred in applications where magnetic interference from MAG 122 to other surrounding instrument or equipment is desired to be minimized.

Figure 8B:
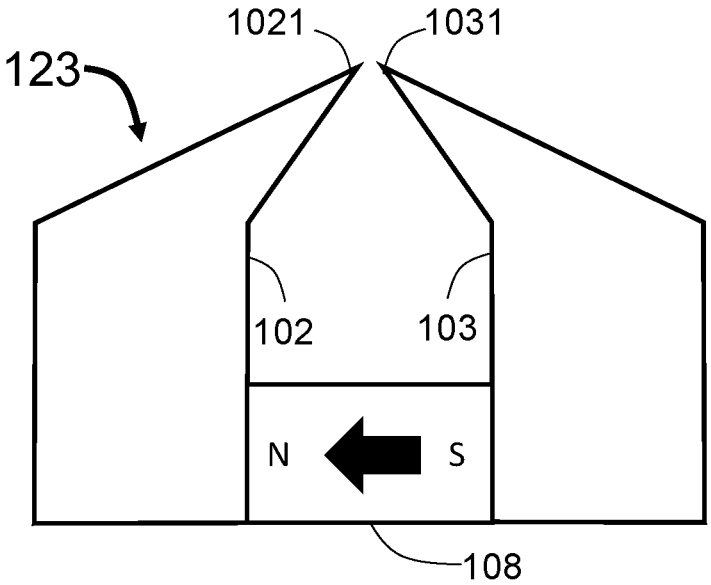
FIG. 8B is a cross-sectional view of the third embodiment of MAG.

FIG. 8B is a cross-sectional view of a third embodiment of MAG of current invention. Compared to MAG 121, MAG 123 of FIG. 8B incorporates only one permanent magnet 108, which is attached to both poles 102 and 103, where flux from N surface of magnet 108 and flux from S surface of magnetic 108 is conducted by poles 102 and 103 to produce MAG 123 gap field by tip ends 1021 and 1031. Compared to MAG 121, magnetic flux generated by magnet 108 is mainly confined within the soft magnetic material body of poles 102 and 103, and MAG 123 is comparatively easier to assemble and produces less magnetic flux leakage.

Figure 9:
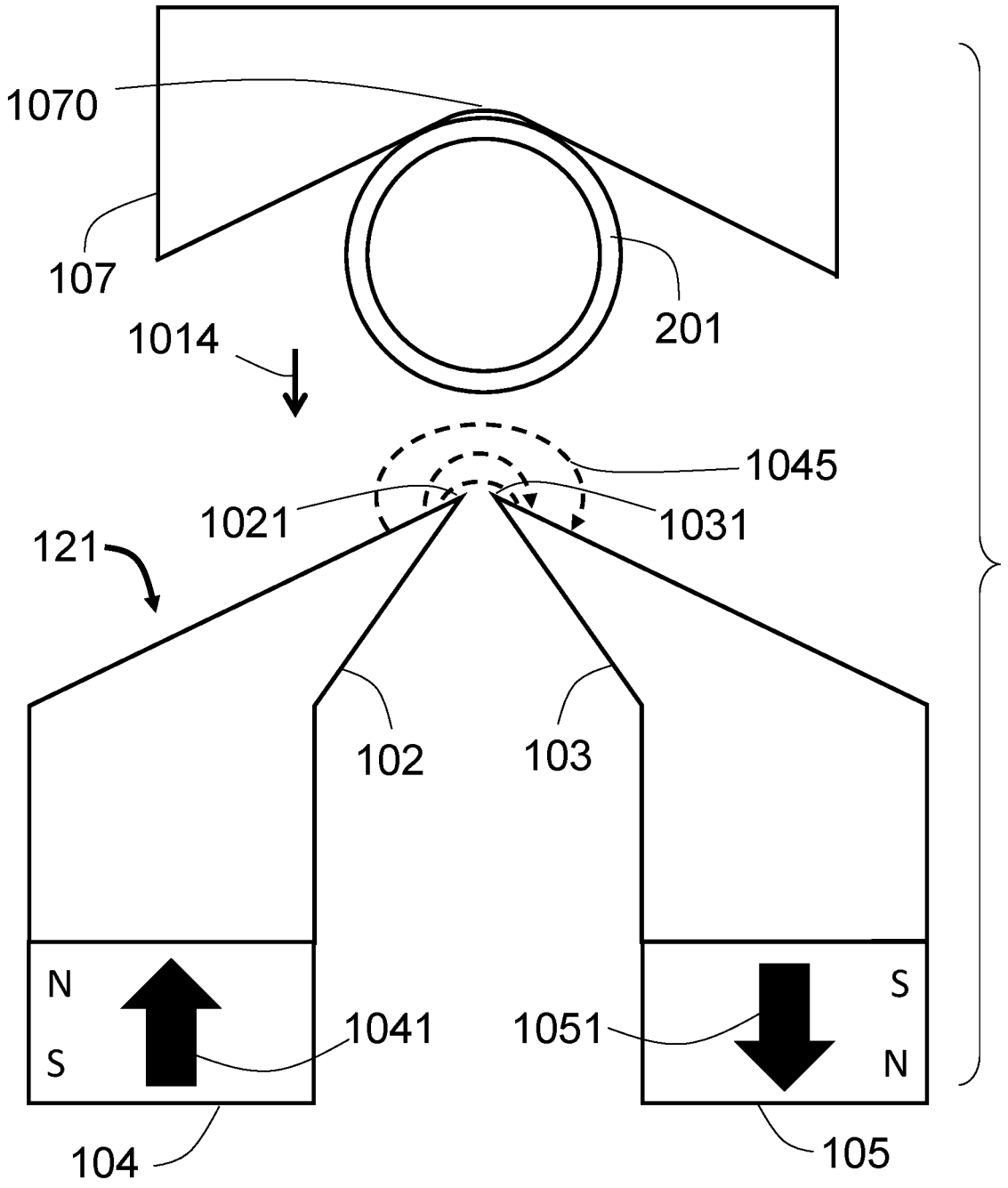
FIG. 9 a cross-sectional view of the first embodiment of MAG with a flexible channel.

FIG. 9 shows a cross-sectional view of the first embodiment MAG 121 being used for magnetic separation in combination with a flexible channel 201. FIG. 9 is similar to FIG. 4, except that the rigid channel 101 is replaced with a flexible channel 201. Flexible channel 201 may assume any shape, including a circular shape tubing form, at its non-deformed state, but can be deformed into other shapes by external force. Wall material of channel 201 is deformable and may be composed of any of, but not limited to, silicone, silicone rubber, rubber, PTFE, FEP, PFA, BPT, Vinyl, Polyimide, ADCF, PVC, HDPE, PEEK, LDPE, Polypropylene, polymer, thin metal or fiber mesh coated with polymer layer, Flexible channel 201 is also shown in FIG. 9 to have a channel holder 107 attached to the back of channel 201. Channel holder 107 may be composed of any non-magnetic material including, but not limited to, metal, non-metal element, plastic, polymer, ceramic, rubber, silicon, and glass. Channel 201 may attach to holder 107 through surface bonding, for example by gluing or injection molding, or via mechanical attachment through components 1074 of FIG. 32. Holder 107 has a bottom surface 1070 in contact with the top surface of channel 201, where surface 1070 being preferred to be substantially conformal to the MAG 121 wedge shape. In FIG. 9, holder 107 aligns attached flexible channel 201 to MAG 121 wedge gap and moves channel 201 towards MAG wedge gap in direction 1014.

Figure 10:
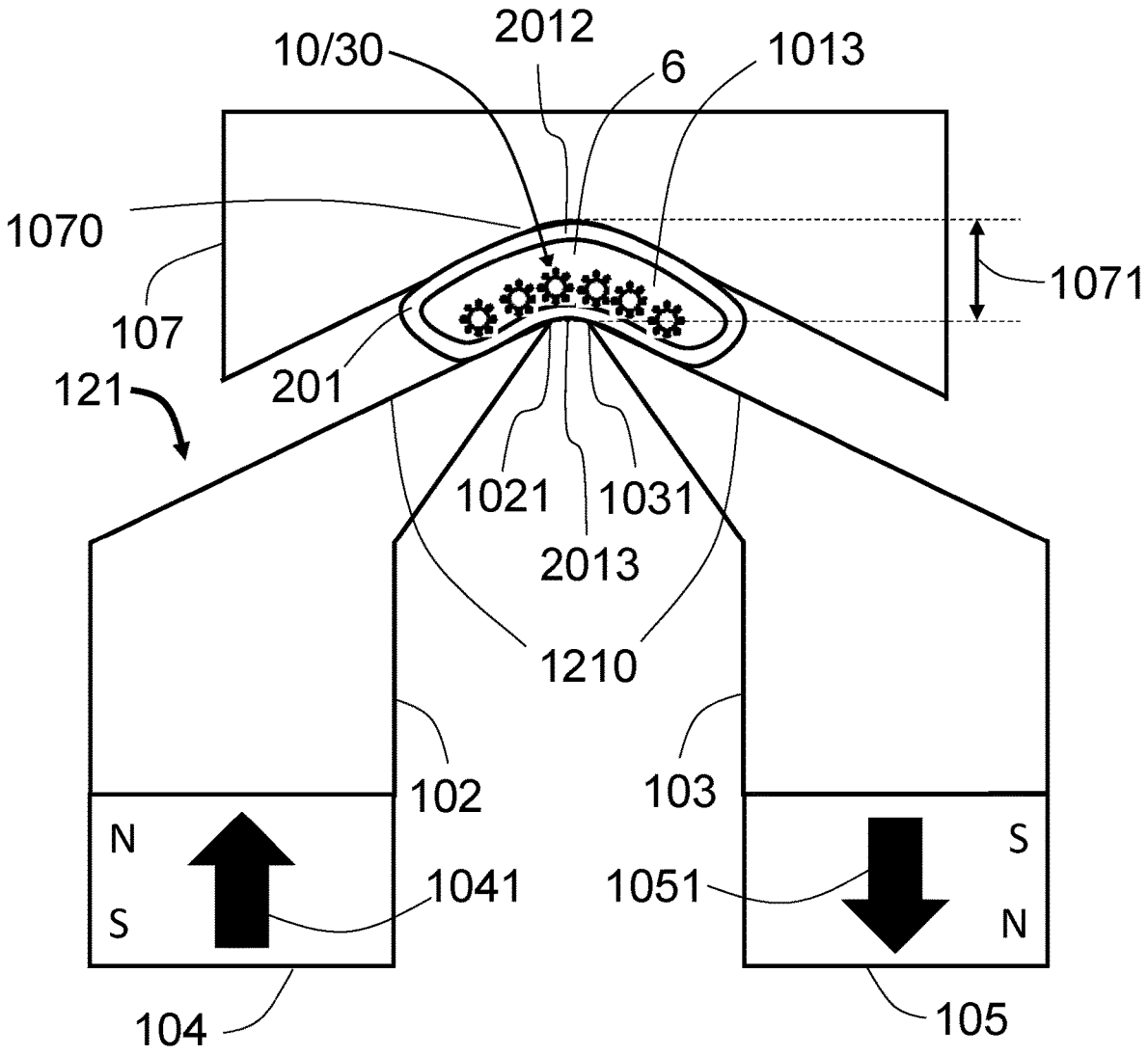
FIG. 10 illustrates the first embodiment of MAG having a flexible channel in separation position with cells being separated.

FIG. 10 illustrates the flexible channel 201 being pushed against the MAG wedge of MAG 121 by the channel holder 107. With pressure exerted by the holder 107 on flexible channel 201 against the MAG wedge of MAG 121, channel 201 is deformed in FIG. 10 with bottom surface 2013 of channel 201 becoming conformal and in surface contact to MAG wedge surface 1210. Meanwhile, as holder 107 bottom surface 1070 may also be conformal to the MAG wedge shape, top surface 2012 of channel may also be forced into a substantially conformal shape to the MAG wedge. FIG. 10 depicts the "separation position" of flexible channel 201 relative to the MAG 121 during magnetic separation of cells 10/30 from sample fluid 6. Shape of flexible channel 201 is substantially similar to channel 101 of FIG. 5 and FIG. 6, except such shape of channel 201 at separation position is result of channel 201 self-aligning and self-conforming to MAG wedge without the need of a manufacturing process to achieve shape of channel 101. Additionally, the flow space within channel 201 at separation position may be adjusted to allow for larger or smaller cross-sectional area of the flow space of channel 201, such that optimization of fluid sample 6 flow rate through channel 201 and cells 10/30 magnetic separation efficiency may be optimized. The flow space adjustment may be achieved by changing the vertical distance 1071 from the holder 107 surface 1070 top point in contact with channel 201 top surface 2012, to tip ends 1021 and 1031 or to an imaginary plane where tip ends 1021 and 1031 reside. With a larger 1071 distance, flexible channel 201 is less deformed and a larger flow space is realized, which allows for a slower flow speed at the same fluid flow rate. While with a smaller 1071 distance, flexible channel 201 has a smaller flow space but top edge 2012 is also closer to the MAG wedge gap and tip ends 1021 and 1031, which allows for higher magnetic field and faster separation of cells 10/30. Thus optimization between flow rate and separation efficiency may be achieved with adjusting the distance 1071 for a given combination of MAG 121 design and flexible channel 201. In one embodiment, distance 1071 is more than 0 mm and less than or equal to 1 mm. In another embodiment, distance 1071 is more than 1 mm and less than or equal to 3 mm. In yet another embodiment, distance 1071 is more than 3 mm and less than or equal to 5 mm. In yet another embodiment, distance 1071 is more than 5 mm and less than or equal to 10 mm. In yet another embodiment, distance 1071 is more than 2 times and less than or equal to 3 times of the wall thickness of flexible channel 201. In yet another embodiment, distance 1071 is more than 3 times and less than or equal to 5 times of the wall thickness of flexible channel 201. In yet another embodiment, distance 1071 is more than 5 times and less than or equal to 10 times of the wall thickness of flexible channel 201. Flexible channel 201 at separation position functions similarly to channel 101 in FIG. 6, where FIG. 10 also shows that during magnetic separation, cells 10/30 form conglomerate along channel 201 wall of lower surface 2013 directly opposing the MAG wedge surface 1210. Thickness of channel 201 wall at bottom surface 2013 may be thinner than channel 201 wall at top surface 2012.

Figure 11:
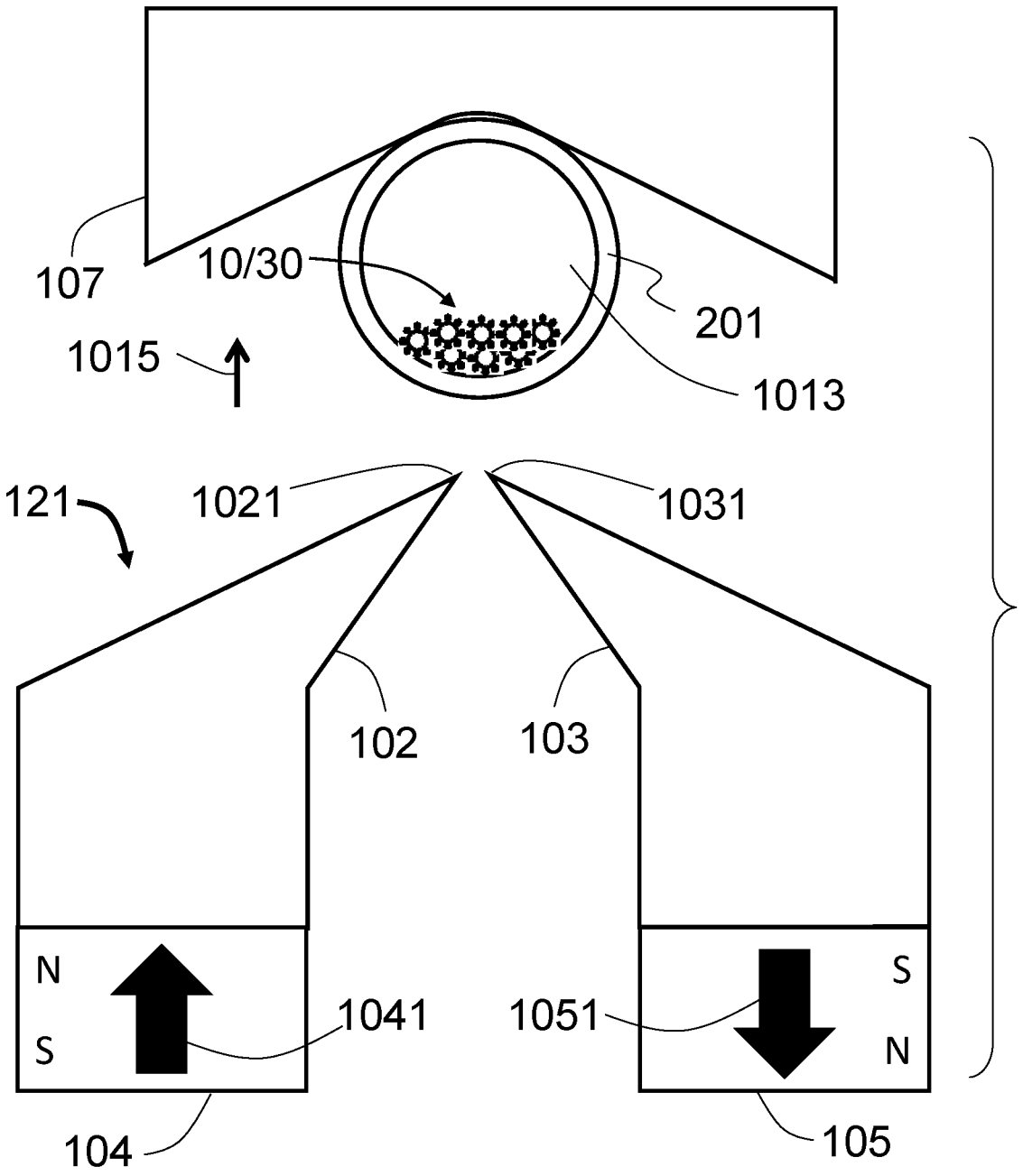
FIG. 11 illustrates the first embodiment of MAG having a flexible channel in lifted position after cell separation.

FIG. 11 illustrates after magnetic separation is completed in FIG. 10, the channel holder 107 moves away from the MAG 121 in direction 1015, causing the flexible channel 201 to separate from MAG wedge of MAG 121 to "lifted position" and flexible channel 201 may also return to its non-deformed shape, for example circular tubing as shown in FIG. 11. Magnetically separated cells 10/30 in FIG. 10 may hold the conglomerate form at the bottom surface of the flexible channel 201 at lifted position. After FIG. 11 lifted position of flexible channels 201 is reached, dissociation procedures on the cells 10/30 within the flexible channel 201 to break up the conglomerate may be performed, as described in FIG. 22A through FIG. 30B. Flexible channel 201 returning to non-deformed shape, for example circular tubing of FIG. 11, provides a larger cross-sectional area of the channel space 1013 as shown in FIG. 11 than at separation position in FIG. 10. Such larger channel space 1013 may be preferred for easier dissociation of cells 10/30 from the conglomerate form. Additional buffer fluid may be injected into the channel space 1013 of channel 201 at lifted position to assist channel 201 return to non-deformed shape. MAG 121 in FIG. 9 through FIG. 11 may be replaced by MAG 122 or MAG 123 without limitation on described methods and processes.

Figure 12:
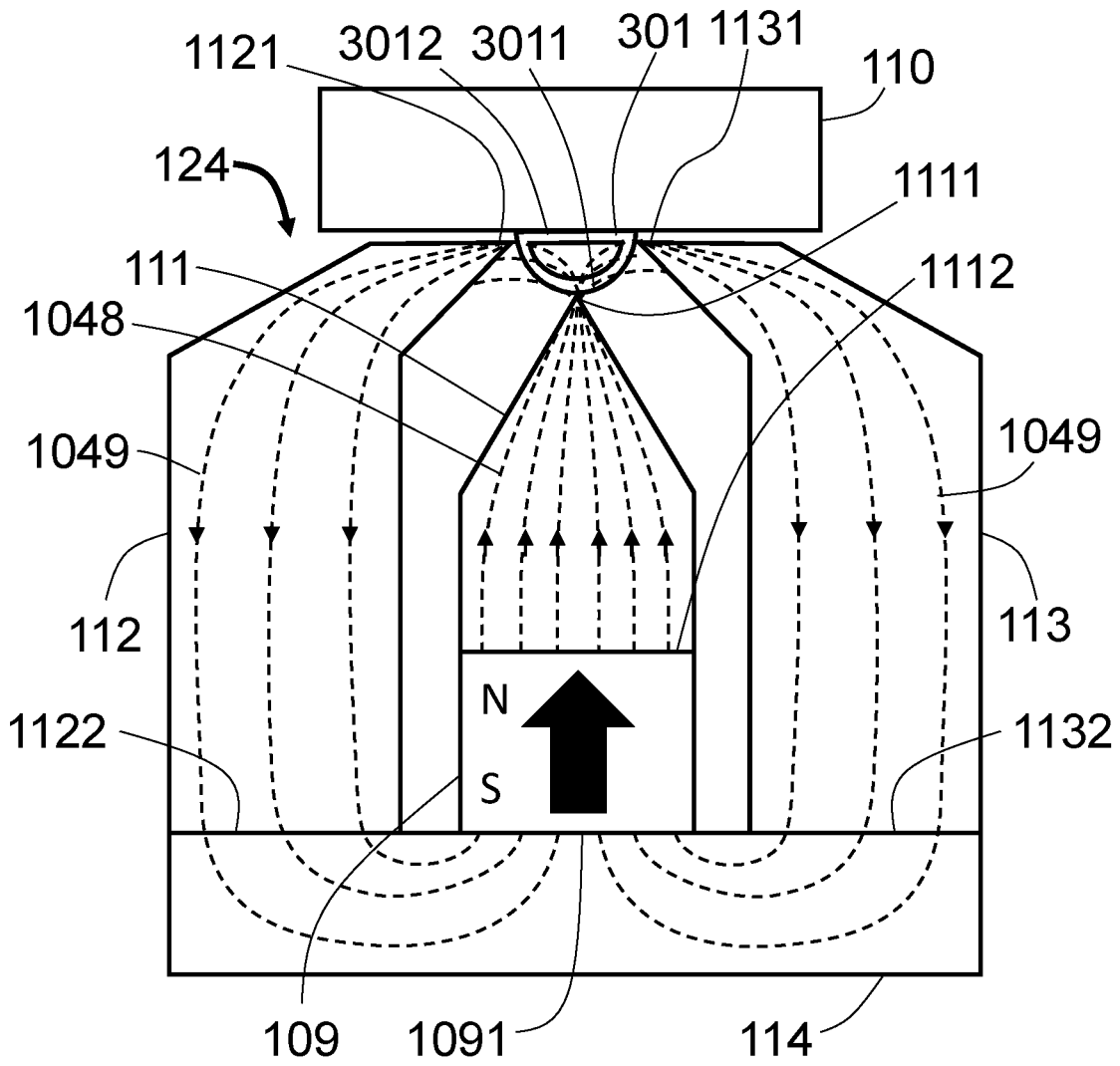
FIG. 12 illustrates cross-sectional view of the fourth embodiment of MAG having a "D" shape rigid channel in separation position.

FIG. 12 illustrates cross-sectional view of the fourth embodiment of MAG 124. MAG 124 has three soft magnetic poles 111, 112 and 113. Center pole 111 is attached to N surface of permanent magnet 109 at a flux collection end 1112, similar to flux collection end 1023 of pole 102 in FIG. 4, and flux 1048 from magnet 109 N surface is conducted by pole 111 soft magnetic body and then emitted from a tip end 1111, which is much smaller in area size than flux collection end 1112, of pole 111, and functions similar to tip end 1021 of FIG. 4 to produce a local high field around tip end 1111 by concentrating the magnetic flux conducted from magnet 109. Side poles 112 and 113 each have a flux collection end 1122 and 1132 respectively, which are attached to same top surface of a soft magnetic bottom shield 114. Bottom shield 114 is then attached to S surface of the permanent magnet 109. Thus the magnetic flux 1049 from the S surface of magnet 109 is conducted in the body of bottom shield 114 and divided between poles 112 and 113 and further conducted to the tip ends 1121 and 1131 of poles 112 and 113 respectively. Tip end 1111 is formed in proximity to tip ends 1121 and 1131. In one embodiment, tip end 1111 may recess from an imaginary plane where tip ends 1121 and 1131 reside towards magnet 109 by an offset distance between 0 mm to 1 mm. In another embodiment, tip end 1111 may recess from an imaginary plane where tip ends 1121 and 1131 reside towards magnet 109 by an offset distance between 1 mm to 5 mm. In yet another embodiment, tip end 1111 may recess from an imaginary plane where tip ends 1121 and 1131 reside towards magnet 109 by an offset distance between 5 mm to 10 mm. Tip end 1111 is preferred to be spaced equally to tip ends 1121 and 1131. Top section of pole 112 is tilted to the right side, while top section of pole 113 is tilted to the left, which is similar to pole 102 and pole 103 of FIG. 4. Such tilting is to increase gap between the main bodies of poles 112 and 113 to main body of pole 111 to reduce flux leakage such that flux concentration around tip ends 1111, 1121 and 1131 is maximized. When flux is emitted from tip ends 1111, 1121 and 1131, since flux 1048 conducted by center pole 111 is opposite to the flux 1049 conducted by side poles 112 and 113, the flux forms closure between tip ends 1111 to 1112, and tip ends 1111 to 1131. Thus, the magnetic flux generated by N and S surface of magnet 109 is conducted within bodies of poles 111,112, 113 and shield 114 with minimal leakage to outside of MAG 124 structure. Flux density is highest around tip end 1111, with tip ends 1121 and 1131 also producing high flux density, which all indicate high magnetic field and field gradient around tip ends 1111, 1121 and 1131. Compared to MAG 121, 122 and 123, MAG 124 has the advantage of more efficient flux closure within the MAG 124 soft magnetic bodies with less leakage and thus higher flux density around tip end 1111 to produce higher magnetic field and field gradient in channel 301.

Channel 301 is a rigid channel similar to channel 101 of FIG. 4, and has a fixed shape similar to a rotated "D". Channel 301 is shown to be in magnetic separation position in FIG. 12, where tip ends 1111, 1121 and 1131 may all be in contact with the curved bottom surface 3011 of the "D" shape of channel 301, which provides highest possible magnetic field and field gradient that MAG 124 can produce in the channel space where fluid sample flows in channel 301. In another embodiment, tip end 1111 may be in contact with the surface 3011 and tip ends 1121 and 1131 are not contacting surface 3011. Top surface 3012 of channel 301, in one embodiment may be on the imaginary plane where tip ends 1121 and 1131 reside, and in another embodiment top surface 3012 may be above the imaginary plane in between 0 mm to 1 mm, and in yet another embodiment top surface 3012 may be above the imaginary plane in between 1 mm to 5 mm. In one embodiment, channel 301 wall thickness at surface 3012 is thicker than wall thickness at surface 3011. Channel 301 may be attached to a non-magnetic channel holder 110 at the top surface 3012. Channel holder 110 may align channel 201 to MAG gap of MAG 124, move channel 301 to separation position in contact with MAG 124 pole 111 tip end 1111, or lift channel 301 away from MAG 124 after magnetic separation.

Figure 13:
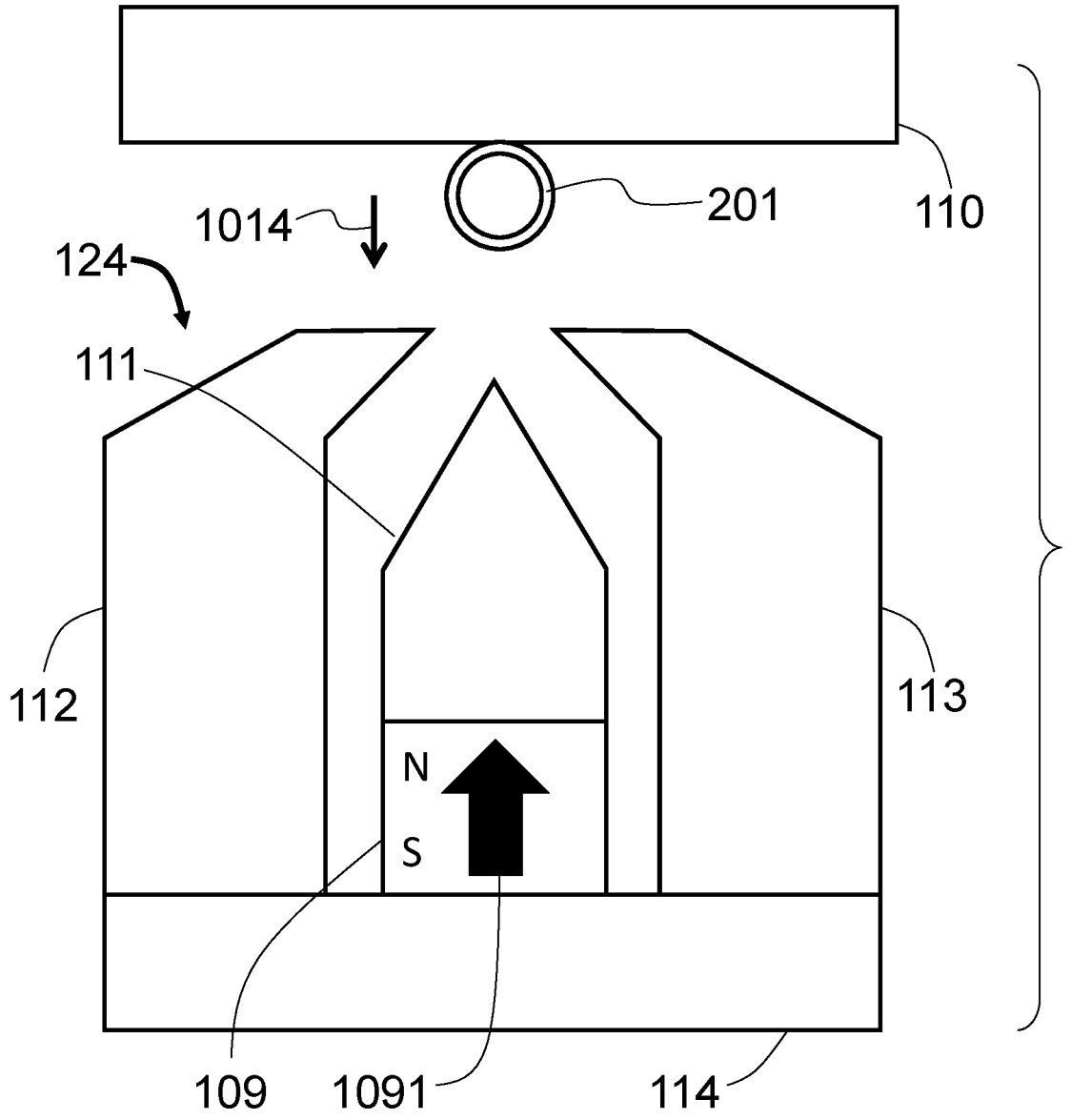
FIG. 13 illustrates cross-sectional view of the fourth embodiment of MAG with a flexible channel.

FIG. 13 shows a cross-sectional view of the fourth embodiment MAG 124 being used for magnetic separation in combination with the flexible channel 201, which is same as in FIG. 9. Channel holder 110 may be different shape than channel holder 107 of FIG. 9. Before magnetic separation, channel holder 110 is attached to channel 201. Channel holder 110 aligns channel 201 to MAG gap of MAG 124 which is composed of tip ends 1111, 1121 and 1131 as in FIG. 12, and moves channel 201 into the MAG gap of MAG 124 in direction 1014.

Figure 14:
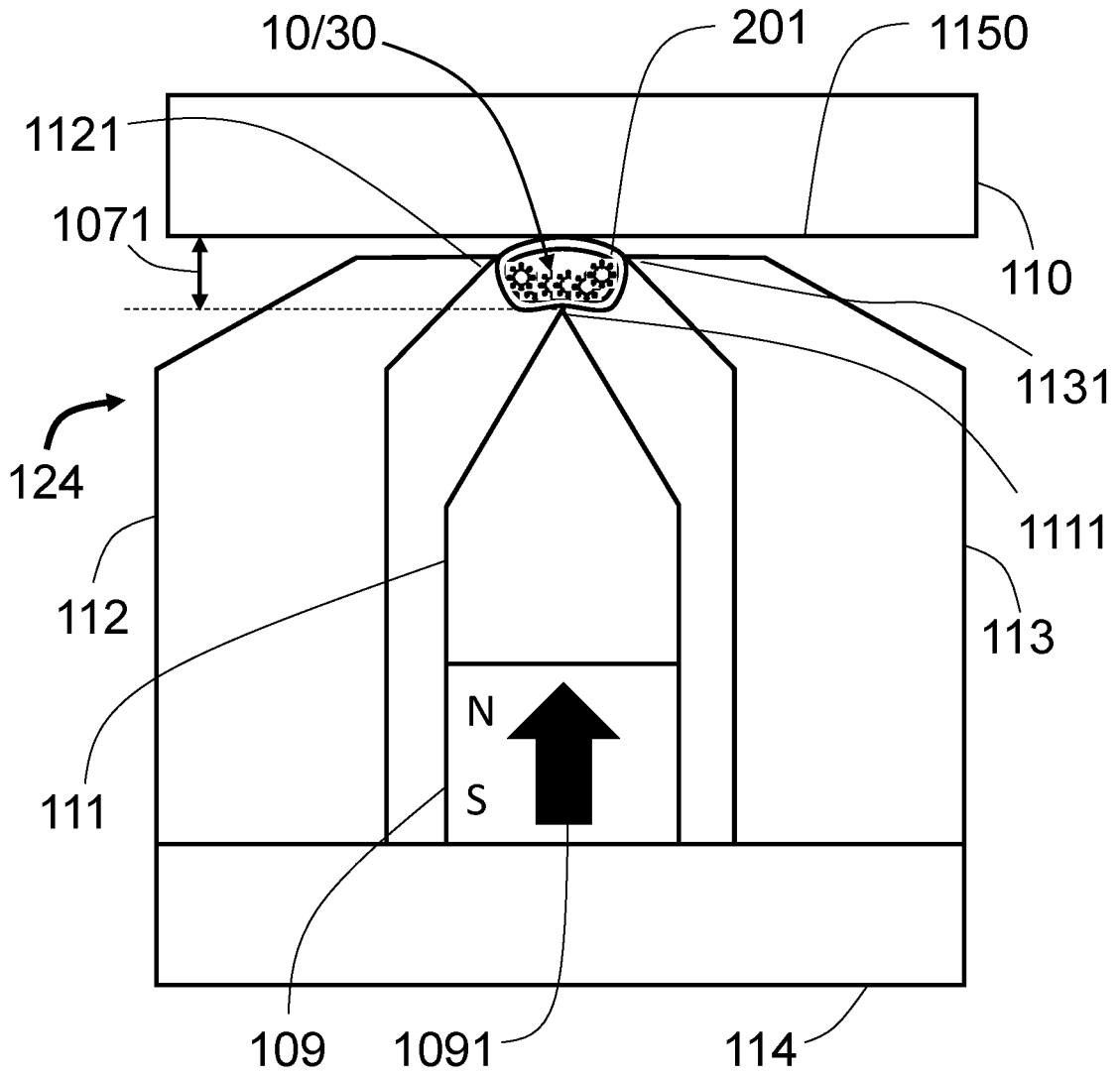
FIG. 14 illustrates cross-sectional view of the fourth embodiment of MAG having a flexible channel in separation position with cells being separated.

FIG. 14 illustrates the flexible channel 201 in separation position in the fourth embodiment MAG 124 with cells 10/30 being separated and form conglomerate around bottom and side walls of the channel 201 close to the tip ends 1111, 1121 and 1131. In FIG. 14, flexible channel 201 is deformed similarly as in FIG. 10 to conform to the MAG gap boundaries, which are mainly the tip ends 1111, 1121 and 1131. Shape of channel 201 may be different than channel 301 at separation position due to flexible channel 201 conforming to the MAG gap boundaries under pressure from holder 110. Shape of channel 201 in FIG. 14 may provide higher liquid sample flow rate with higher separation efficiency than channel 301. Distance 1071 between the lower surface 1150 of holder 110 and tip end 1111 may be adjusted to optimize flow rate in channel 201. Range of distance 1071 is same as 1071 described in FIG. 10.

Figure 15A:
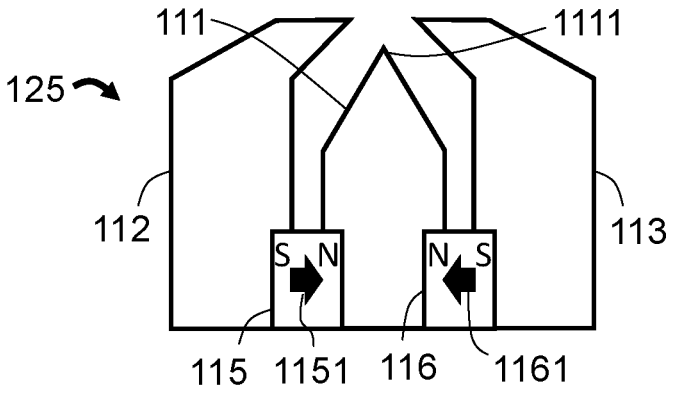
FIG. 15A illustrates cross-sectional view of the fifth embodiment of MAG.

FIG. 15A illustrates cross-sectional view of the fifth embodiment MAG 125. MAG 125 is same as MAG 124, except the magnet 109 and bottom shield 114 of MAG 124 of FIG. 12 are removed in MAG 125. Permanent magnets 115 and 116 with opposing magnetizations 1151 and 1161 are placed in between poles 111 and 112, and between poles 111 and 113, respectively as shown in FIG. 15A. Magnetizations 1151 and 1161 are horizontal in FIG. 15A, which enables center pole 111 conducting N surface flux from both magnets 115 and 116, while side poles 112 and 113 each conducts S surface flux from magnet 115 and 116 respectively. Compared to MAG 124, MAG 125 may produce higher field around tip ends 1111, 1121 and 1131 due to two magnets 115 and 116 are used. MAG 125 may also be easier to assemble than MAG 124.

Figure 15B:
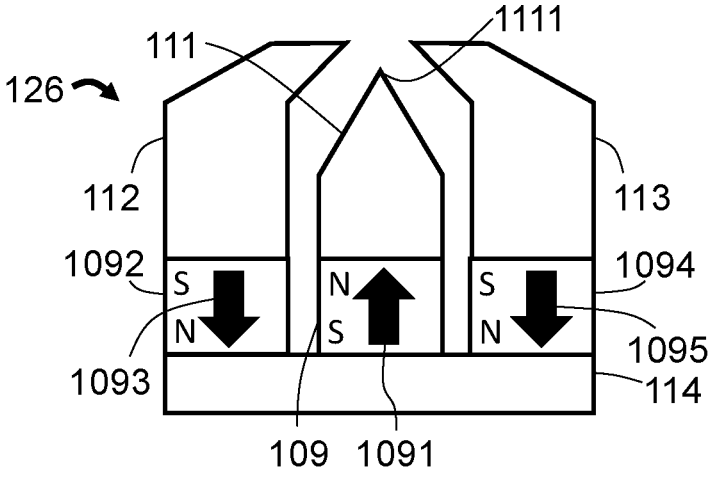
FIG. 15B illustrates cross-sectional view of the sixth embodiment of MAG.

FIG. 15B illustrates cross-sectional view of the sixth embodiment MAG 126. MAG 126 is same as MAG 124, except the side poles 112 and 113 are each attached to S surface of permanent magnets 1092 and 1094 respectively, with magnetizations 1093 and 1095 being opposite to magnetization 1091 of magnet 109. Bottom shield 114 is attached to both N surface of magnet 1092 and 1094, and S surface of magnet 109, and thus forming internal flux closure in shield 114 between magnets 109, 1092 and 1094. Compared to MAG 124, MAG 126 may produce higher field around tip ends 1111, 1121 and 1131 due to three magnets 109, 1092 and 1092 are used in MAG 126.

Figure 15C:
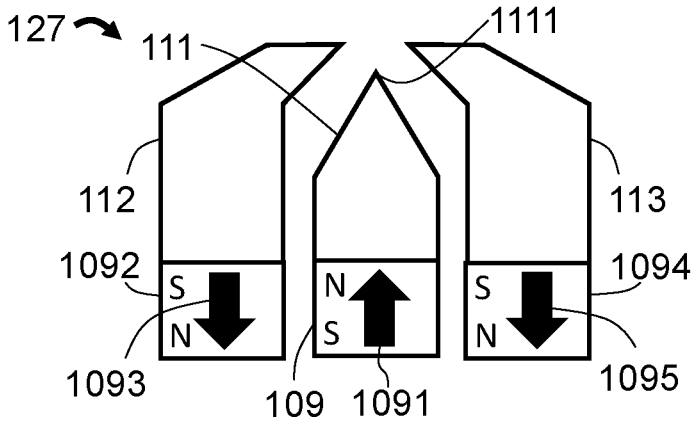
FIG. 15C illustrates cross-sectional view of the seventh embodiment of MAG.

FIG. 15C illustrates cross-sectional view of the seventh embodiment MAG 127. MAG 127 is same as MAG 126 of FIG. 15B, except the bottom shield 114 is removed.

Figure 16:
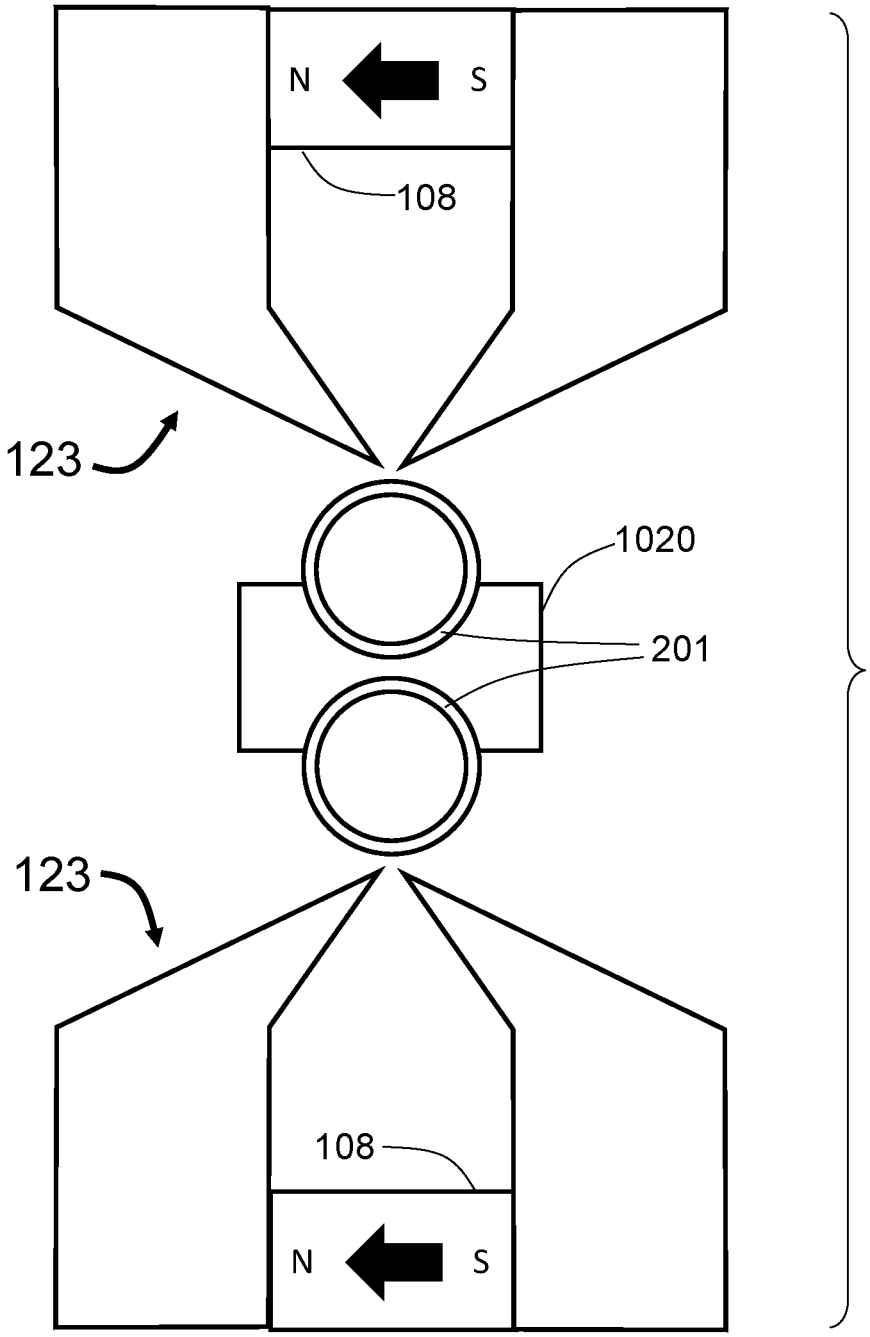
FIG. 16 illustrates cross-sectional view of a pair of third embodiment of MAGs with a pair of flexible channels on a single channel holder.

FIG. 16 illustrates two of the third embodiment MAGs 123 are used for magnetic separation on a pair of flexible channels 201. The pair of flexible channels 201 are fixed on the same channel holder 1020 in FIG. 16. The top MAG 123 and bottom MAG 123 are substantially identical, with top MAG 123 being upside down vertically. MAG wedges of the top and bottom MAGs 123 are substantially aligned with center of top and bottom channels 201. The magnets 108 of both top and bottom MAG 123 may have same magnetization directions, as the arrows within magnets 108 in FIG. 16 indicate, such that the magnetic fields produced in the top and bottom channels 201 by the top MAG 123 and bottom MAG 123 during magnetic separation have same direction horizontal field component, which limits magnetic flux leakage between top MAG 123 soft magnetic poles and bottom MAG 123 soft magnetic poles.

Figure 17:
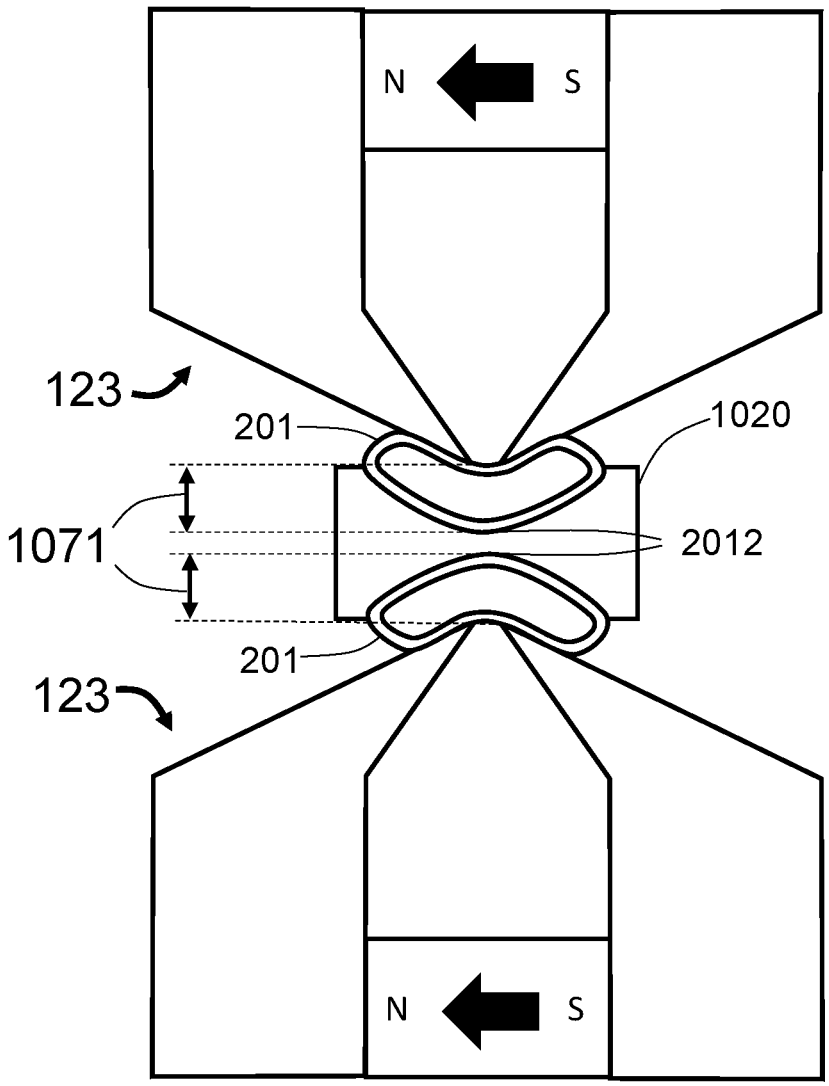
FIG. 17 illustrates cross-sectional view of a pair of third embodiment of MAGs with a pair of flexible channels on a single channel holder in separation position.

FIG. 17 illustrates the two MAG 123 of FIG. 16 are moved into separation position against the two flexible channels 201, which is same process as in FIG. 10. After reaching FIG. 17 separation position, fluid sample carrying cells 10/30 may flow through the channels 201 in length direction perpendicular to the cross-section view to start magnetic separation of cells 10/30 by top and bottom MAG 123. Distance 1071 between the holder 1021 surface contacting the channel 201 outer edge 2012 and MAG 123 tip ends 1021 and 1031, or the imaginary plane where tip ends 1021 and 1031 reside, may be adjusted to optimize flow rate in each of the two channels 201. Range of adjustment of distance 1071 is same as 1071 described in FIG. 10.

MAG 123 in FIG. 16 and FIG. 17 may be replaced by MAG 121 or MAG 122, and channels 201 may also be replaced with channel 101.

Figure 18:
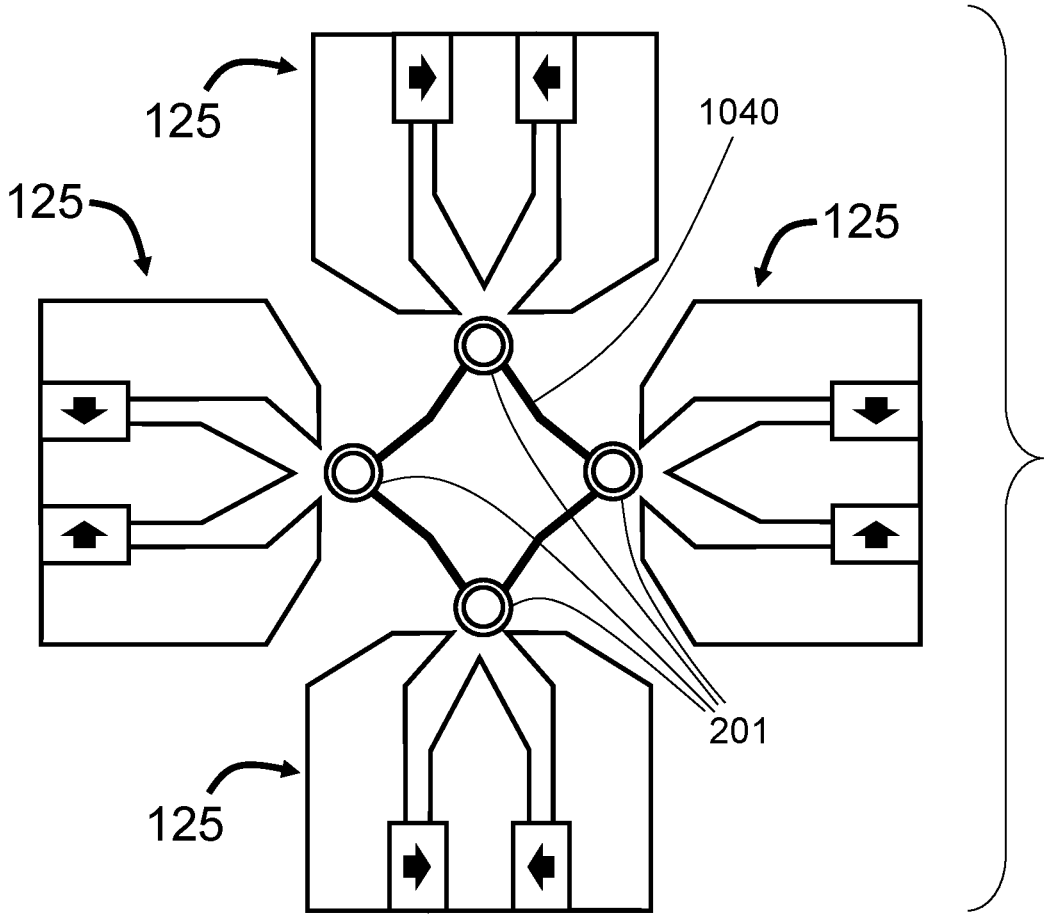
FIG. 18 illustrates cross-sectional view of four of fifth embodiment of MAGs with four flexible channels on a single channel holder.

FIG. 18 illustrates four of the fifth embodiment MAG 125 being used for magnetic separation on four of flexible channels 201. The four flexible channels 201 are fixed on the same channel holder 1040 as in FIG. 18. The four MAG 125 are substantially identical. MAG gaps of the four MAG 125 are substantially aligned with center of each of the corresponding flexible channels 201. The permanent magnets arrangement within each MAG 125 should be identical for example center pole of each of the four MAG 125 is attached to N surfaces of both magnets within each respective MAG 125, and side poles of each of the four MAG 125 are attached to S surfaces of magnets within each MAG 125, as shown in FIG. 18. Thus, neighboring MAG 125 nearest adjacent side poles are of same magnetic polarity, and leakage from side pole to side pole between neighboring MAG 125 may be minimized or avoided. Additionally, four of MAGs used on four of channels 201 in FIG. 18 is only shown in FIG. 18 as an example of multiple channel process capability with a circular channel arrangement, where channels are positioned at center of the MAG 125 circular array. Fewer and more MAG 125 used on corresponding number of channels 201 may be achieved in FIG. 18 type circular arrangement without limitation. FIG. 18 multiple channel circular arrangement with MAG 125 is intrinsically more flexible than MAG 123 as in FIG. 16, as two pole design of FIG. 16 MAG 123 may lead to magnetic flux leakage through the poles of neighboring MAG 123 when number of MAG 123 is more than two.

Figure 19:
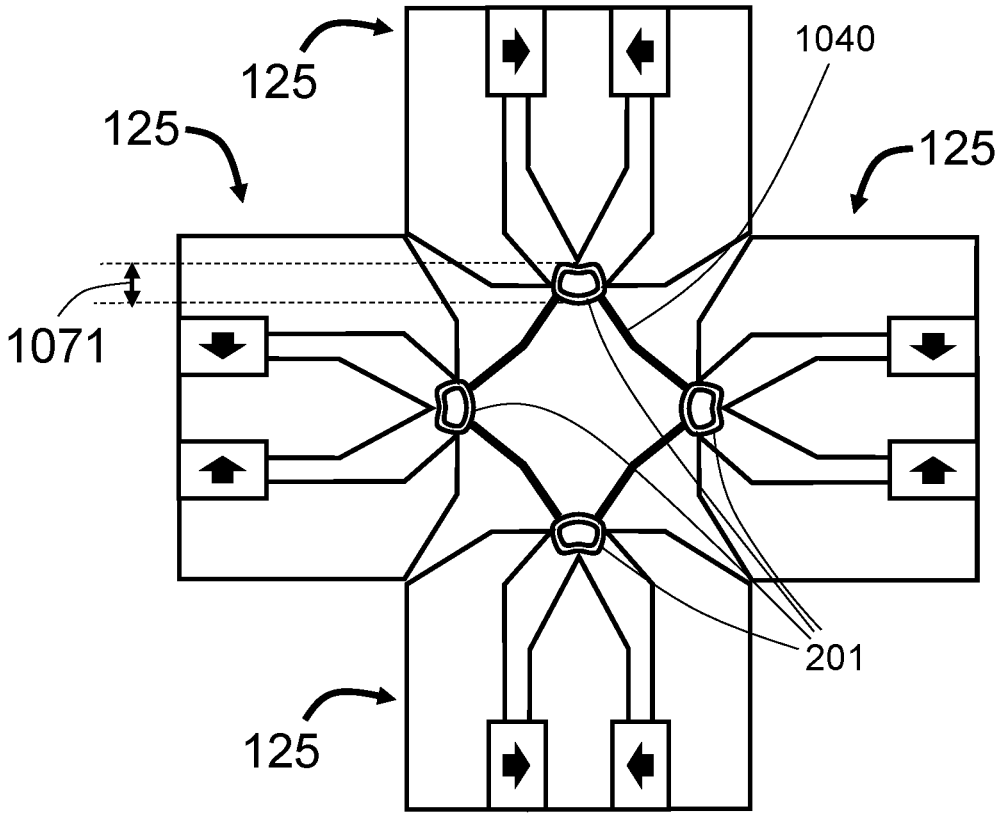
FIG. 19 illustrates cross-sectional view of four of fifth embodiment of MAGs with four flexible channels on a single channel holder in separation position.

FIG. 19 illustrates the four MAG 125 of FIG. 18 are moved into separation position against the four flexible channels 201, which is same process as in FIG. 14. After reaching FIG. 19 separation position, fluid sample carrying cells 10/30 may flow through the channels 201 in length direction perpendicular to the view of FIG. 19 to start magnetic separation of cells 10/30 by the four MAG 125.

Similarly as in FIG. 17, distance 1071 between the holder 1040 surface contacting the channel 201 outer edge 2012 and MAG 125 center pole 111 tip end 1111 for each channel 201 and MAG 125 pair may be adjusted to optimize flow rate in each of the four channels 201. Range of adjustment of distance 1071 is same as 1071 described in FIG. 10. MAG 125 in FIG. 18 and FIG. 19 may be replaced by MAG 124, MAG 126, or MAG 127, and where channels 201 may also be replaced with channel 301.

Figure 20A:
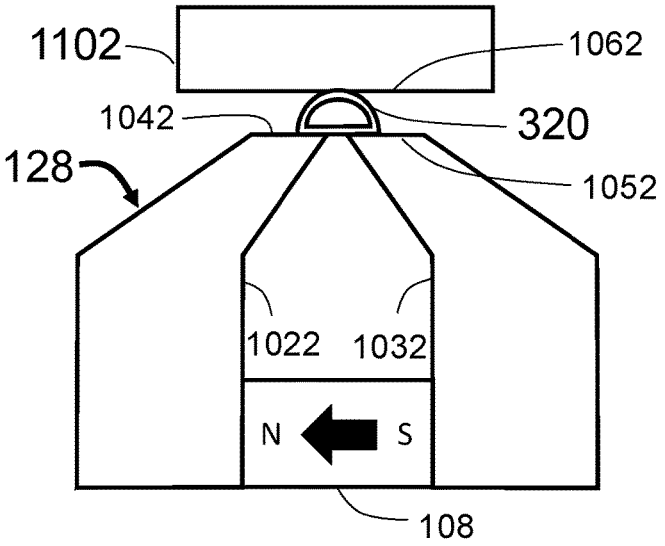
FIG. 20A illustrates cross-sectional view of the eighth embodiment of MAG with a rotated "D" shape rigid channel in separation position.

FIG. 20A illustrates the sixth embodiment of MAG 128 with having a rotated "D" shape rigid channel 320 in separation position. MAG 128 is similar to MAG 123, except that MAG wedge of MAG 123 is modified from a triangle shape to a flat top as in MAG 128. MAG 128 pole 1022 is similar to pole 102 of MAG 123, but with a flat top surface 1042 in pole 1022 instead of a tip end in pole 102. Same flat top 1052 exists on pole 1032 which is similar to pole 103 of MAG 123. Due to the flat top of the MAG wedge in MAG 128, rigid channel 320 may have a flat bottom surface 1062 matching to, and being in contact with, the MAG wedge flat surface in separation position, to gain highest magnetic field and field gradient region from MAG 128. Channel 320 may be attached to a non-magnetic channel holder 1102 at the top surface. Channel holder 1102 may align channel 320 to MAG wedge of MAG 128, move channel 320 to separation position in contact with MAG 128 poles 1022 and 1032 tip ends, or lift channel 320 away from MAG 128 after magnetic separation.

Figure 20B:
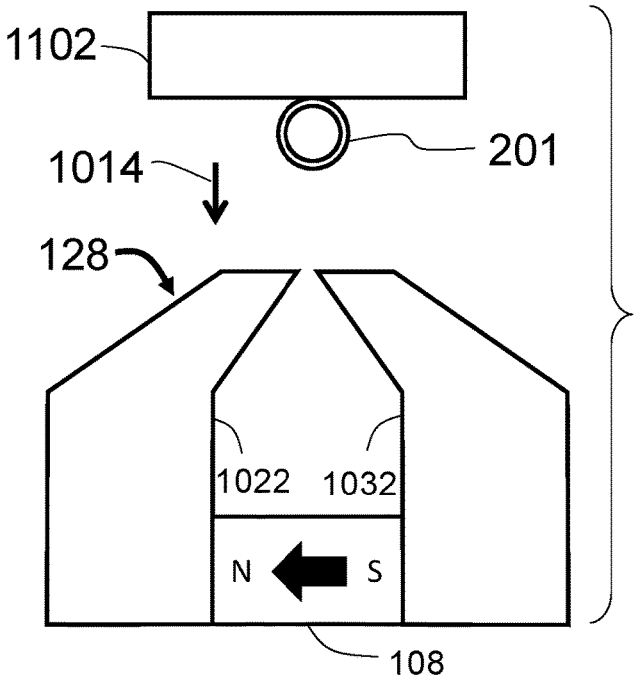
FIG. 20B illustrates cross-sectional view of the eighth embodiment of MAG with a flexible channel.

FIG. 20B illustrates the sixth embodiment MAG 128 being used on a flexible channel 201, where channel 201 is attached to channel holder 1102. Channel holder 1102 moves channel 201 towards MAG wedge of MAG 128 along direction 1014.

Figure 20C:
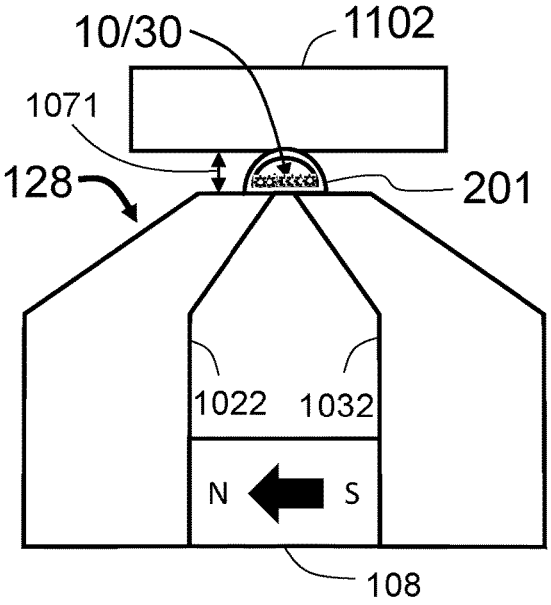
FIG. 20C illustrates cross-sectional view of the eighth embodiment of MAG having a flexible channel in separation position with cells being separated.

FIG. 20C illustrates the sixth embodiment MAG 128 having the flexible channel 201 of FIG. 20B moved into separation position with cells 10/30 being separated from a liquid sample to form conglomerate at bottom surface of channel 201 against the top flat surface of the MAG wedge of MAG 128. Channel 201 is forced to form into a rotated "D" shape channel by holder 1102 pushing channel 201 against the flat top of MAG wedge of MAG 128, where channel 201 shape at separation position shows similarity to channel 320 of FIG. 20A. Distance 1071 between the holder 1102 bottom surface 1062 contacting the channel 201 top edge 2012 and MAG 128 pole surfaces 1042 and 1052 may be adjusted to optimize flow rate in channel 201. Range of adjustment of distance 1071 is same as 1071 described in FIG. 10.

Magnet 108 of MAG 128 may be replaced by placement of magnets 104 and 105 as in MAG 121, and by placement of magnets 104 and 105 and bottom shield 106 as in MAG 122.

Figure 21A:
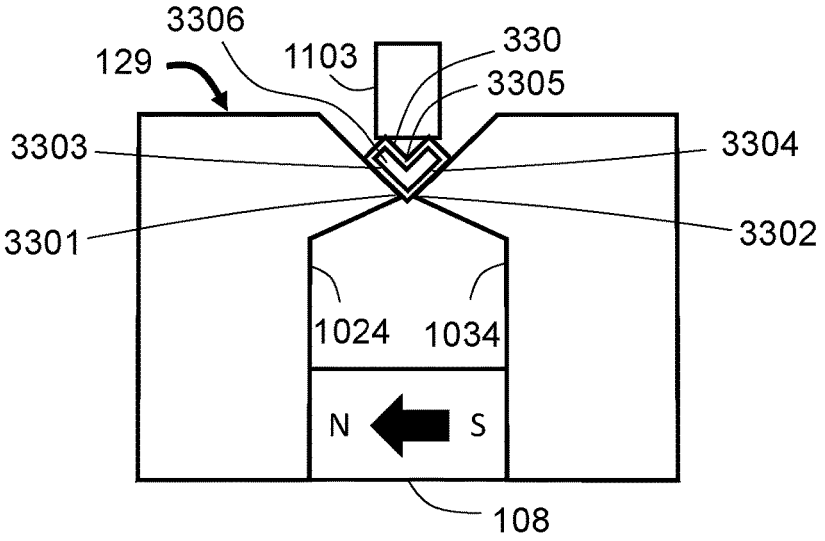
FIG. 21A illustrates cross-sectional view of the ninth embodiment of MAG having a "V" shape rigid channel in separation position.

FIG. 21A illustrates the seventh embodiment MAG 129 with having a "V" shape rigid channel 330 in separation position. MAG 129 is different from MAG 123 in pole shape, where pole 1024 and pole 1034 of MAG 129 have flux concentration tip ends 3301 and 3302 that forms a "V" shaped concave, instead of the triangle wedge shape of the MAG 123. With the V shape MAG concave of MAG 129, rigid channel 330 is also made into a V shape, with the lower edges 3303 and 3304 making direct contact with the surface of the tip ends 3301 and 3302. Additionally, channel 330 may also preferably have a V shape notch into the channel at the top edge 3305 following the V shape of the 3303 and 3304 edges, which helps confine fluid sample in the V shaped channel space 3306 to flow closer to the pole surfaces 3303 and 3004 that provide higher field and field gradient. Channel 330 may be attached to a non-magnetic channel holder 1103 at the top surface 3305. Channel holder 1103 may align channel 330 to MAG concave of MAG 129, move channel 323 to separation position in contact with poles 1024 and 1034 tip ends surface, or lift channel 330 away from MAG 129 after magnetic separation.

Figure 21B:
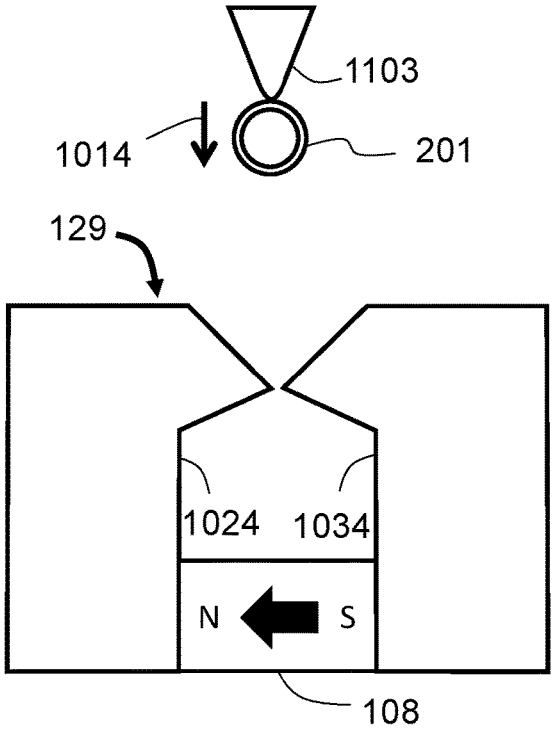
FIG. 21B illustrates cross-sectional view of the ninth embodiment of MAG with a flexible channel.

FIG. 21B illustrates the seventh embodiment MAG 129 being used with a flexible channel 201, where channel 201 is attached to channel holder 1103 at the top edge of channel 201. Channel holder 1103 moves channel 201 towards MAG 129 concave along direction 1014. Channel holder 1103 has a triangle shape, where a convergence point of the triangle touches the channel 201 top edge.

Figure 21C:
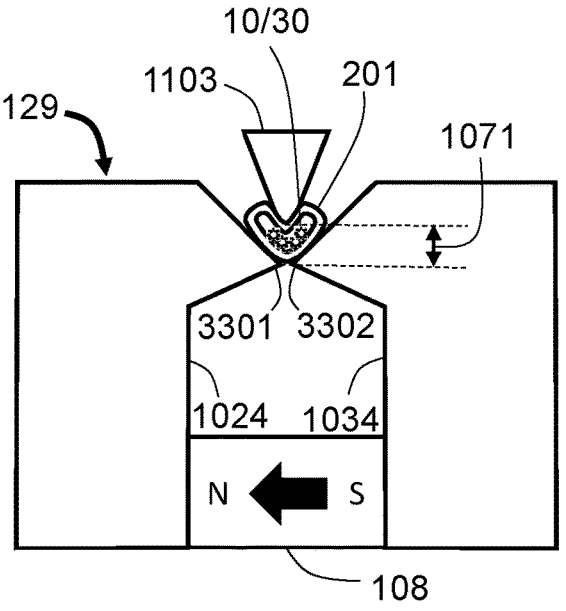
FIG. 21C illustrates cross-sectional view of the ninth embodiment of MAG having a flexible channel in separation position with cells being separated.

FIG. 21C illustrates the seventh embodiment MAG 129 having the flexible channel 201 of FIG. 21B moved into separation position with cells 10/30 being separated from a liquid sample to form conglomerate at bottom surface of channel 201 against the top surfaces of the MAG concave of tip ends 3301 and 3302 of MAG 129. Channel 201 is forced to form into a "V" shape channel by holder 1103. In FIG. 21C, holder 1103 forces channel 201 against the MAG concave of MAG 129 with the lower convergence point and deforms the top wall of the channel 201 downwards to move closer to the tip ends 3301 and 3302, while the same force also causes lower wall of channel 201 to conform to the MAG concave of MAG 129 to make contact with the tip ends 3301 and 3302 top surfaces 3303 and 3304. Thus, channel 201 shape in FIG. 21C at separation position shows V shape similar to channel 330 of FIG. 21A, which brings cells 10/30 in channel space 3306 closer to high field and high gradient tip ends 3301 and 3302 and tip surfaces 3303 and 3304. Vertical distance 1071 between the holder 1103 bottom convergence point contacting the channel 201 top edge 2012, and MAG 129 tip ends 3301 and 3302 or an imaginary plane where tip ends 3301 and 3302 reside, may be adjusted to optimize flow rate in channel 201. Range of adjustment of distance 1071 is same as 1071 described in FIG. 10.

Magnet 108 of MAG 129 may be replaced by placement of magnets 104 and 105 as in MAG 121, and by placement of magnets 104 and 105 and bottom shield 106 as in MAG 122.

Figure 22A:
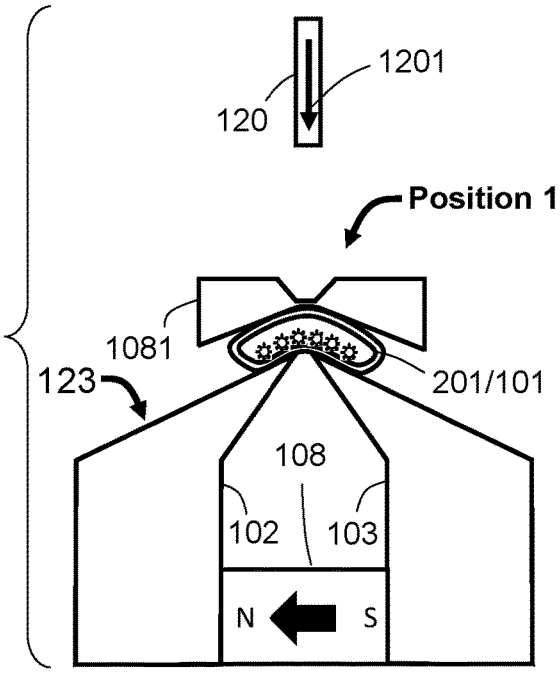
FIG. 22A illustrates the third embodiment of MAG having a flexible channel in separation position with cells being separated, and a demagnetization ("DMAG") magnet positioned over and away from MAG.

From FIG. 22A through FIG. 27D, various methods to demagnetize or dissociate magnetically separated cells 10/30 from conglomerate in MAG channel will be described. For simplicity of description, flexible channel 201 is used. However, channels in FIG. 22A through FIG. 27D may be labeled as "201/101", indicating flexible channel 201 as used for description may be replaced with rigid channel 101 without affecting the function and results of the described method. Also for the simplicity of description, MAG 123 is used in FIG. 22A through FIG. 27D, while any other MAG embodiment together with corresponding channel as described in prior figures may be used under same concepts without limitation FIG. 22A is substantially similar to FIG. 10, where channel 201 is at separation position and cells 10/30 have been separated by magnetic field from MAG. In FIG. 22A, MAG 123 is used instead of MAG 121 of FIG. 10. Channel holder 1081 may be different from channel holder 107 of FIG. 10 by having a top surface notch that allows the cells 10/30 demagnetization or dissociation magnetic structure ("DMAG"), which is permanent magnet 120 in FIG. 22A, to be able to reach closer to the channel 201/101 to provide sufficient field to demagnetize or dissociate cells 10/30 from the conglomerate in channel 201/101. Such notch is preferred, but may not be required. DMAG magnet 120 is positioned away from MAG 123 of FIG. 22A without affecting magnetic separation of cells 10/30 by MAG 123. DMAG magnet 120 magnetization is labeled as in vertical direction 1201, but may also be in horizontal direction without causing functional difference. Channel 201/101 position relative to the MAG 123 and DMAG 120 in FIG. 22A is "Position 1".

Figure 22B:
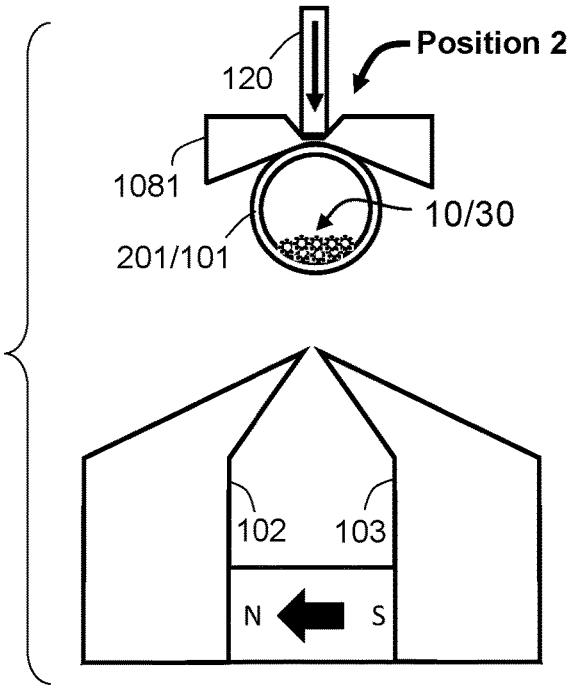
FIG. 22B illustrates the flexible channel of FIG. 22A departing MAG and moving into position where flexible channel holder is in close proximity to, or contacts, the DMAG magnet.

FIG. 22B is similar to FIG. 11, where channel holder 1081 moves channel 201/101 away from MAG 123 and come into contact with, or is in close proximity to, DMAG magnet 120 at the top surface of holder 1081, where the magnet 120 may fit into the notch of holder 1081 to provide highest magnetic field on cells 10/20 conglomerate in channel 201/101. Cells 10/30 form conglomerate after magnetic separation by MAG and do not break free from the conglomerate automatically due to SPL 2 on cells 10/30 not self-demagnetize when they are part of a conglomerate. By removing cells 10/30 gradually with magnetic field gradient from magnet 120, for example cells 10/30 with higher magnetic moment SPL 2 that respond to weaker magnetic field from DMAG 120 faster, conglomerate may reach to a critical volume that remaining cells 10/30 in the conglomerate do not see enough magneto-static field from other cells 10/30 and will self-demagnetize into individual cells 10/20 due to the regained superparamagnetic nature of SPL 2. Therefore, to dissociate cells 10/30 from conglomerate, removing certain amount of cells 10/30, or breaking up the conglomerate from a continuous large piece into multiple smaller pieces will help cells 10/30 to achieve self-demagnetization. Channel 201/101 position relative to the MAG 123 and DMAG 120 in FIG. 22B is "Position 2". Channel 201 compared to channel 101 may have an advantage during cells 10/30 dissociation by DMAG magnet 120, as channel 201 provides a larger channel space that allows farther separation between free cells 10/30 and from conglomerate, or between broken-up conglomerate pieces, which helps reduce magneto-static coupling and enhances self-demagnetization speed of SPL 2 on cells 10/30. For flexible channel 201, before Position 2 or at Position 2, it is preferred to fill the channel 201 with additional buffer fluid to return the channel 201 to circular shape for larger channel space.

Figure 22C:
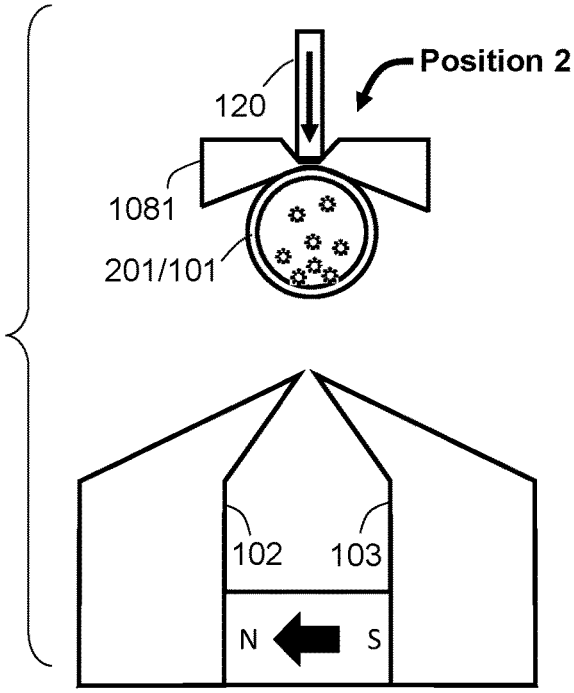
FIG. 22C illustrates the cells in the flexible channel of FIG. 22B being dissociated from conglomerate by the DMAG magnet.

FIG. 22C illustrates the cells 10/30 in the channel 201/101 of FIG. 22B being dissociated from conglomerate by the DMAG magnet 120 at Position 2.

Figure 22D:
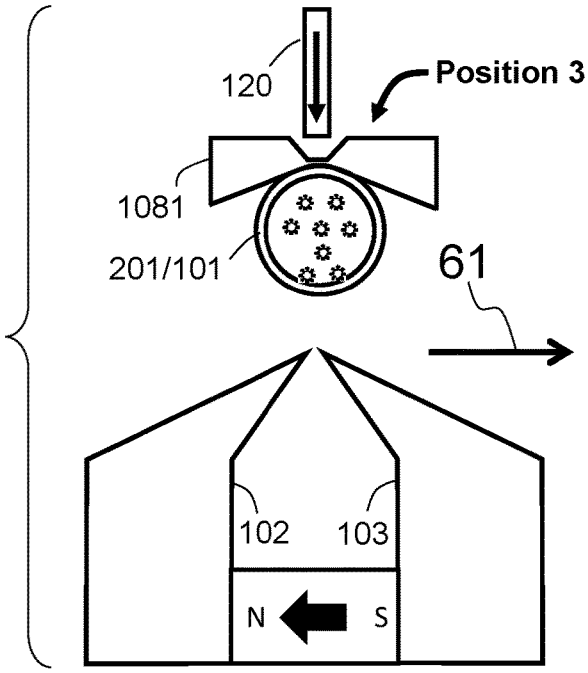
FIG. 22D illustrates the flexible channel of FIG. 22C moving into a low magnetic field position between MAG and DMAG magnet.

FIG. 22D illustrates the channel holder 1081 moves channel 201/101 from FIG. 22C DMAG Position 2 to a position, "Position 3", between MAG 123 and DMAG magnet 120. At Position 3, combined field on the cells 10/30 within channel 201/101 may be the smallest, which may help SPL 2 to self-demagnetize. Channel 201/101 may be kept at Position 3 for extensive time to allow SPL 2 and cells 10/30 to fully self-demagnetize and conglomerate to dissociate.

For an effective break up of conglomerate, mechanical agitations may be added to the conglomerate by the magnetic force exerted by MAG and DMAG magnets. For example, channel holder 1081 may alternate channel 201/101 between Positions 1 and 2, or Positions 2 and 3, or Positions 1, 2 and 3, such that alternating magnetic force by MAG and DMAG may move whole or part of the conglomerate in the channel space, thus helping break up the conglomerate into smaller pieces or cause enough cells 10/30 to break free from the conglomerate and conglomerate may self-dissociate. After conglomerate is sufficiently dissociated, free cells 10/30 may be flushed out of channel 201/101 at Position 3 or Position 2.

Figure 23A:
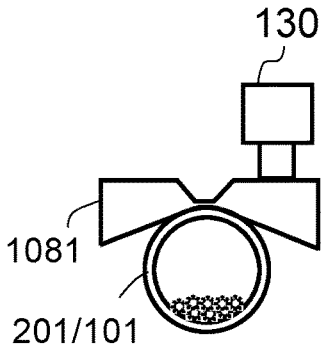
FIG. 23A illustrates mechanical vibration is applied to a flexible channel holder by a motor after cells are magnetically separated inside the flexible channel.

FIG. 23A illustrates mechanical vibration may be applied to the channel holder 1081 by a motor 130 when channel 201/101 is at Position 2 or Position 3 of FIG. 22B and FIG. 22C. Such vibration may be transferred from holder 1081 through wall of channel 201/101 and into the fluid within the channel 201/101 to cause localized turbulence flow at various locations within the channel 201/101, which may help mechanically break up the conglomerate into small pieces to assist conglomerate dissociation.

Figure 23B:
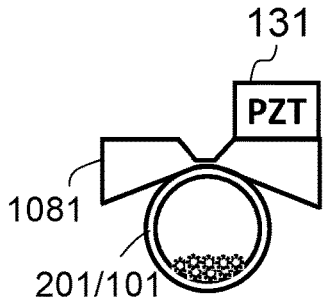
FIG. 23B illustrates ultrasound vibration is applied to a flexible channel holder by a piezoelectric transducer ("PZT") after cells are magnetically separated inside the flexible channel.

FIG. 23B illustrates ultrasound vibration by a piezoelectric transducer ("PZT") 131 may be applied to the channel holder 1081. Similar to FIG. 23A, ultrasound vibration may be transferred into the fluid within the channel 201/101 to cause localized high frequency turbulence within the channel 201/101, which may help mechanically break up the conglomerate into small pieces to assist conglomerate dissociation.

Figure 23C:
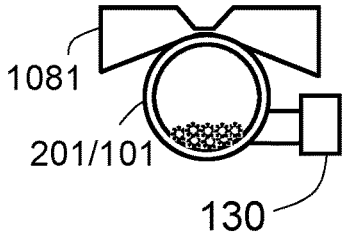
FIG. 23C illustrates mechanical vibration is applied to a flexible channel by a motor after cells are magnetically separated inside the flexible channel.

FIG. 23C illustrates mechanical vibration of FIG. 23A may be applied to the channel 201/101 wall directly by motor 130.

Figure 23D:
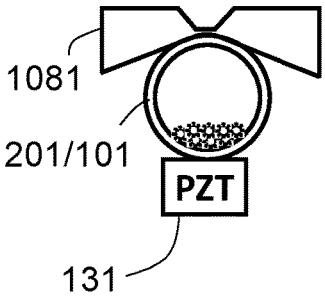
FIG. 23D illustrates ultrasound vibration is applied to a flexible channel by a PZT after cells are magnetically separated inside the flexible channel.

FIG. 23D illustrates ultrasound vibration of FIG. 23B may be applied to the channel 201/101 wall directly by PZT 131.

Figure 23E:
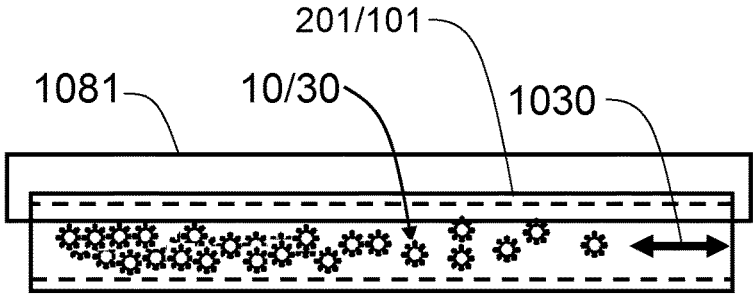
FIG. 23E is a side view of the flexible channel of FIG. 22D.

FIG. 23E is a side view of the channel 201/101 along the direction 61 as in FIG. 22D. Arrow 1030 represents alternating direction pulsed fluid flow may be applied to the channel liquid sample to produce a flow jittering in the liquid within the channel 201/101, which may also produce local turbulence flow with fluid in channel 201/101 to help mechanically break up the conglomerate into small pieces to assist conglomerate self-dissociation. FIG. 23E alternating pulsed flow may be combined with FIG. 23A through FIG. 23D vibration methods to apply to channel 201/101 at Position 2 or Position 3 of FIG. 22B through FIG. 22D.

When conglomerate in channel 201/101 is of large size, multiple rounds of cells 10/30 dissociation with FIG. 22B to FIG. 23E methods, and flushing of cells 10/30 out of channel 201/101, may be used. During each flush, a certain part of cells 10/30 may be washed out of channel, making dissociation of remaining cells 10/30 still in the conglomerate in channel 201/101 easier in next round.

Figure 24A:
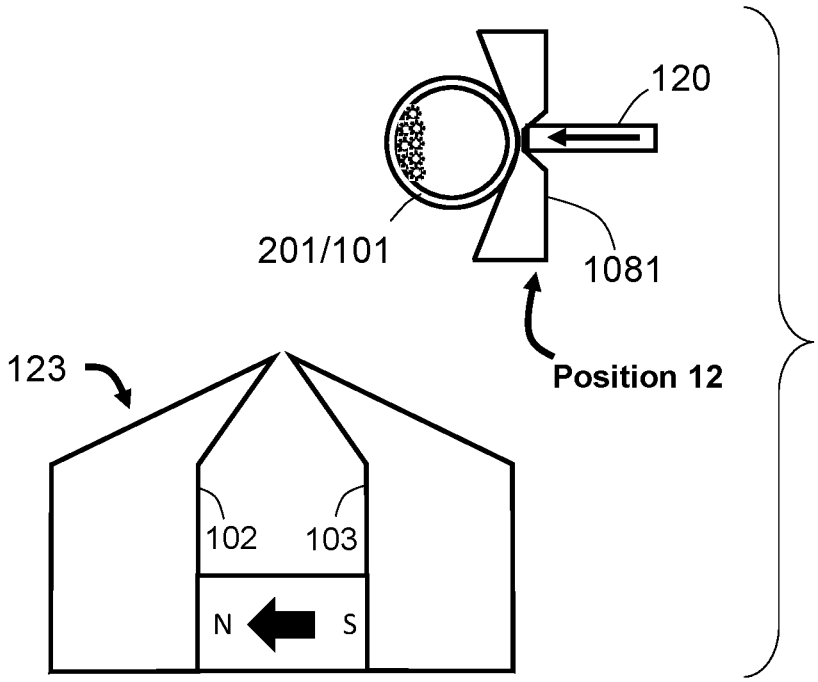
FIG. 24A illustrates the third embodiment of MAG having a flexible channel holder in close proximity to, or in contact with, a DMAG magnet after cells are magnetically separated by MAG, where DMAG magnet is positioned on the side and away from MAG.

FIG. 24A is similar to FIG. 22B, where channel holder 1081 is in contact, or in close proximity to, DMAG magnet 120 after cells 10/30 are magnetically separated by MAG 123.

Different than in FIG. 22B, DMAG magnet 120 of FIG. 24A is positioned on the side of and away from MAG 123, and holder 1081 is also rotated compared to FIG. 22B to fit its top surface notch to the magnet 120. Placement of magnet 120 in FIG. 24 may reduce magnetic field interference between MAG 123 and DMAG magnet 120. Channel 201/101 position relative to the MAG 123 and DMAG 120 in FIG. 24A is "Position 12".

Figure 24B:
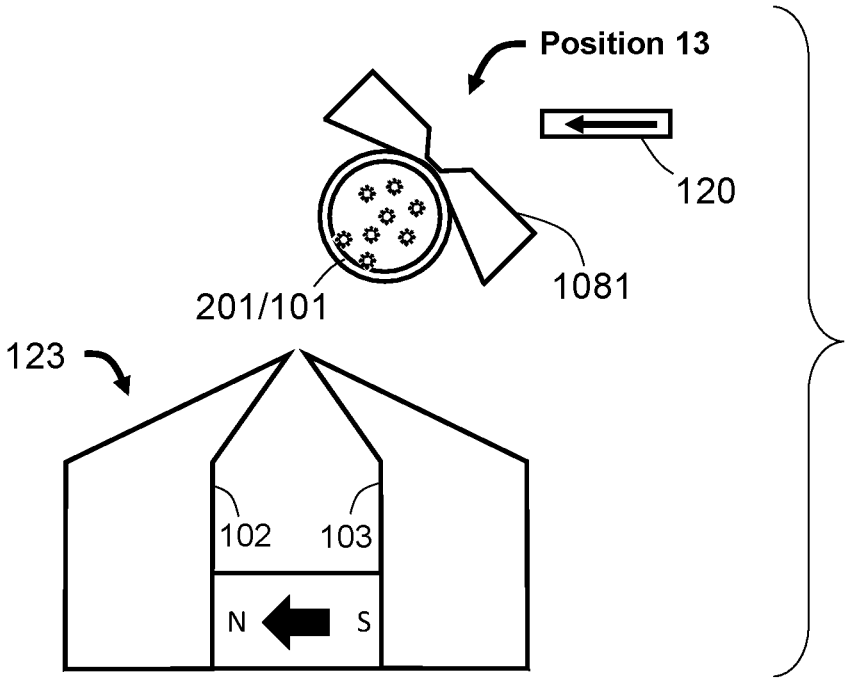
FIG. 24B illustrates the flexible channel of FIG. 24A rotating into a low magnetic field position between MAG and DMAG magnet.

FIG. 24B illustrates that after cells 10/30 are dissociated at Positon 12 of FIG. 24A, the channel 201/101 together with channel holder 1081 of FIG. 24A are rotated away from magnet 120 of FIG. 24A into a position between MAG 123 and DMAG magnet 120, where combined magnetic field from MAG 123 and DMAG magnet 120 on channel 201/101 and cells 10/30 therein is lowest, which is similar to Position 3 of FIG. 22D. Channel 201/101 position relative to the MAG 123 and DMAG 120 in FIG. 24B is "Position 13".

Figure 25A:
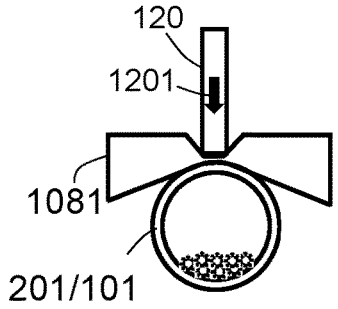
FIG. 25A illustrates a flexible channel holder at demagnetization position, where DMAG magnet is a permanent magnet.

FIG. 25A illustrates DMAG structure that is same as in FIG. 22B, where DMAG structure includes only permanent magnet 120 with magnetization 1201.

Figure 25B:
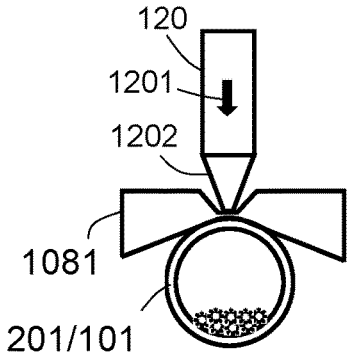
FIG. 25B illustrates a flexible channel holder at demagnetization position, where DMAG magnet is a permanent magnet attached with a soft magnetic pole.

FIG. 25B illustrates DMAG structure that includes permanent magnet 120 and a soft magnetic pole 1202 with convergence shape towards channel 201/101. Soft magnetic pole 1202 convergence shape helps concentrate magnetic flux from magnet 120 to produce higher field and high field gradient on cells 10/30 in channel 201/101 at Position 2 to more effectively demagnetize and dissociate the conglomerate of cells 10/30.

Figure 25C:
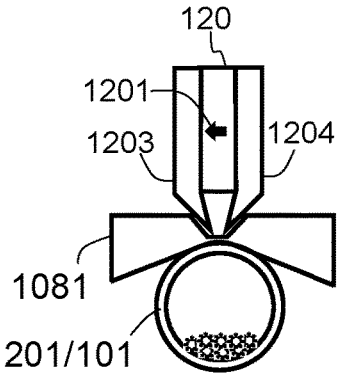
FIG. 25C illustrates a flexible channel holder at demagnetization position, where DMAG magnet is a permanent magnet attached with a pair of soft magnetic poles.

FIG. 25C illustrates DMAG structure that includes permanent magnet 120 and a pair of soft magnetic poles 1203 and 1204. Magnetization 1201 of magnet 120 is in horizontal direction, and each of poles 1203 and 1204 has an convergence shape pointing towards channel 201/101, where the convergence ends of poles 1203 and 1204 form a DMAG gap sitting in, or in close proximity to, the channel holder 1081 top surface notch, where flux from magnet 120 is conducted by the poles 1203 and 1204 and concentrated in the DMAG gap to produce high field and high field gradient on cells 10/30 in channel 201/101 at Position 2 to more effectively demagnetize and dissociate the conglomerate of cells 10/30.

Figure 25D:
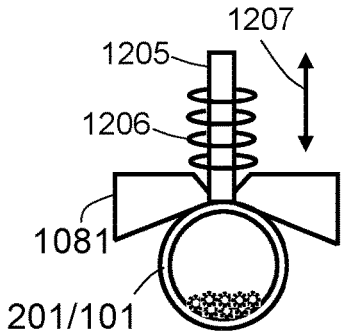
FIG. 25D illustrates a flexible channel holder at demagnetization position, where DMAG magnet is an electromagnet.

FIG. 25D illustrates DMAG structure that includes an electromagnet including a soft magnetic core 1205 and coils 1206, where electric current following in the coils 1206 may produce magnetization in core 1205 in directions of 1207, and core 1205 functions like magnet 120 to product magnetic field on cells 10/30 in channel 201/101 at Position 2 to demagnetize or dissociate the conglomerate of cells 10/30. By changing the electric current amplitude and direction in coils 1206, magnetic field from core 1205 on cells 10/30 may change strength and direction. In one embodiment, DC current is applied to coils 1206. In another embodiment, AC current with alternating polarities is applied to coils 1206. In yet another embodiment, current applied to coils 1206 is programmed to vary in amplitude, or in direction, or in frequency, or in amplitude ramp up or ramp down rates, to more effectively demagnetize and dissociate the conglomerate of cells 10/30.

Figure 25E:
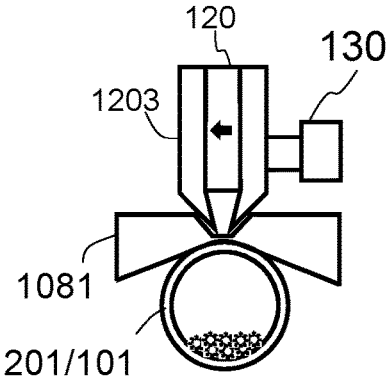
FIG. 25E illustrates flexible channel holder at demagnetization position, where mechanical vibration is applied to DMAG magnet by a motor.

FIG. 25E illustrates that motor 130 as shown in FIG. 23A may produce mechanical vibrations on DMAG structure of FIG. 25C, such vibrations may transfer from DMAG structure to holder 1081 through DMAG structure to holder 1081 contact, and finally transferred to fluid in channel 201/101, where DMAG structure can be changed to any of DMAG structures described in FIG. 25A through FIG. 25D.

Figure 25F:
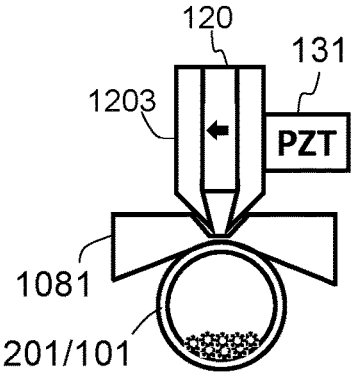
FIG. 25F illustrates flexible channel holder at demagnetization position, where ultrasound vibration is applied to DMAG magnet by a PZT.

FIG. 25F illustrates that PAT 131 as shown in FIG. 23B may produce ultrasound vibrations on DMAG structure of FIG. 25C, such vibrations may transfer from DMAG structure to holder 1081 through DMAG structure to holder 1081 contact, and finally transferred to fluid in channel 201/101, where DMAG structure can be changed to any of DMAG structures described in FIG. 25A through FIG. 25D.

To achieve demagnetization and dissociation of cells 10/30 from conglomerate in channel 201/101, an alternative method as described in FIG. 26A through FIG. 26D may be used without using a DMAG structure, where function of DMAG structure is achieved with same MAG.

FIG. 26A is same as FIG. 22A, where channel 201/101 is at separation position and cells 10/30 are separated by magnetic field of MAG 123 in channel 201/101, except channel holder 1082 may not have the top surface notch as holder 1081. Channel 201/101 position relative to the MAG 123 in FIG. 26A is "Position 21".

FIG. 26B illustrates channel 201/101 of FIG. 26A is lifted from MAG 123 to a lower field position, "Position 22". At Position 22 channel 201/101 may rotate around its center as indicated by arrow 210, preferable by 180 degrees. Such rotation may require channel 201/101 not being permanently fixed to holder 1082

FIG. 26C illustrates channel 201/101 of FIG. 26B after rotation of 180 degrees at Position 22, the cells 10/30 conglomerate formed on inner wall of channel 201/101 rotates together with channel wall to be at the top end of the channel 201/101 relative to MAG 123.

FIG. 26D illustrates that channel 201/101 is moved from Position 22 closer to MAG 123 to a Position 23 in between Position 21 and Position 22, where magnetic field from MAG 123 on cells 12/30 is stronger than Position 22 but weaker than Position 21. Cells 10/30 in conglomerate at top end of channel 201/101 may then be pulled away by MAG 123 field from conglomerate and demagnetization and dissociation of conglomerate may start. The process of FIG. 26B through FIG. 26D may repeat multiple times, where channel 201/101 may return to Position 22 from Position 23 to perform another rotation and then move back to Position 23, until cells 10/30 are sufficiently dissociated in channel 201/101. At end of demagnetization, cells 10/30 may be flushed out of channel 201/101 preferably at Position 22. Mechanical vibrations and flow jittering as described in FIG. 23C through FIG. 23E may be applied to channel 201/101 at Position 22 and Position 23.

FIG. 27A is same as FIG. 26A, where channel 201/101 is at separation position and cells 10/30 are separated by magnetic field of MAG 123. Channel 201/101 position relative to the MAG 123 is "Position 21". Channel 201/101 is attached to holder 1082 in FIG. 27A.

FIG. 27B illustrates channel 201/101 of FIG. 27A is lifted from MAG 123 to lower field Position 22 by holder 1082.

FIG. 27C illustrates that at Position 22, dissociation of cells 10/30 in channel 201/101 may be achieved only through mechanical vibration exerted by motor 130. FIG. 27C shows that motor 130 applies mechanical vibration to holder 1082, where such vibration may be transferred from holder 1082 through wall of channel 201/101 and into the fluid within the channel 201/101 to cause localized turbulence flow at various locations within the channel 201/101, which may help mechanically break up the conglomerate into small pieces to assist self-dissociation of cells 10/30 conglomerate. Motor 130 may also exert vibration directly on channel 201/101 as shown in FIG. 23C instead of through holder 1082. Alternating direction pulsed fluid flow as described in FIG. 23E may be applied to the channel liquid sample to produce a flow jittering in the liquid within the channel 201/101 at the same time of motor 130 vibration application.

FIG. 27D illustrates that at Position 22, dissociation of cells 10/30 in channel 201/101 may be achieved primarily through ultrasound vibration exerted by PZT 131. FIG. 27D shows that PZT 131 applies ultrasound vibration to holder 1082, where the ultrasound vibration may be transferred into the fluid within the channel 201/101 to cause localized high frequency turbulence within the channel 201/101, which may help mechanically break up the conglomerate into small pieces to assist self-dissociation of cells 10/30 conglomerate. PZT 131 may also exert ultrasound vibration directly on channel 201/101 as shown in FIG. 23D. Alternating direction pulsed fluid flow as described in FIG. 23E may be applied to the channel liquid sample to produce a flow jittering in the liquid within the channel 201/101 at the same time of PZT 131 ultrasound vibration application.

FIG. 28A through FIG. 30B describe embodiments of methods to assist cells 10/30 conglomerate dissociation by mechanical agitations, which may be applied to channel 201/101 as in FIG. 27B at Position 22 and applied to channel 201/101 as in FIG. 22B through FIG. 22D, FIG. 23A through FIG. 23D, FIG. 24A through FIG. 25F, FIG. 26B through FIG. 26D, FIG. 27B through FIG. 27D.

FIG. 28A shows a side view of channel 201/101 and holder 1082 along direction 61 of FIG. 27B, where cells 10/30 are magnetically separated by MAG field and form conglomerate on lower side of the channel 201/101 wall. Channel mounts 1073 may be used to attach channel 201/101 to channel holder 1082. Channel mounts 1073 may fix channel 201/101 at sections attached to mounts 1073 as anchors against channel 201/101 deformation, compression or elongation during mechanical agitation process. Channel mounts 1073 may also perform a valve function that closes fluid flow into or out of flexible channel 201 section between two channel mounts 1073 before mechanical agitation process of FIG. 28A, such that fluid enclosed in channel 201 may more efficiently produce localized turbulence within the channel 201. FIG. 28A illustrates that an externally applied force 300 may stretch or deform the channel 201/101 in a direction away from the holder 1082, for example perpendicular to the channel 201/101 length direction. Such deformation or stretch of channel 201/101 builds up elastic energy in the channel 201/101 wall material.

FIG. 28B illustrates that force 300 of FIG. 28A is released, and elastic energy built up in channel 201/101 wall acts to spring back channel 201/101 towards its original non-deform and non-stretch position. Depending on channel 201/101 wall material property, such spring back may provide a transient turbulence flow at various locations within the channel 201/101, which may help mechanically break up the cells 10/30 conglomerate into smaller pieces to assist self-dissociation of cells 10/30 conglomerate. After release of force 300 and channel 201/101 spring back, alternating flow 1030 may be applied similarly as in FIG. 23E to assist dissociation process of conglomerate of cells 10/30, where valve function of 1073 may turn off to allow fluid flow within channel 201/101.

The FIG. 28A and FIG. 28B channel 201/101 deform/stretch and release process may be repeated as many times as needed until conglomerate of cells 10/30 are sufficiently dissociated, which may then be flushed out of channel 201/101*by* buffer fluid.

FIG. 29A illustrates an alternative method of mechanical agitation from FIG. 28A. Every aspect is same as in FIG. 28A, except that a compressive force 302 may be applied to compress channel 201 in direction perpendicular to the channel 201 length direction, for example compressing channel 201 against channel holder 1082 as shown in FIG. 29A. As liquid within channel 201 has limited compressibility, force 302 may cause channel 201/101 wall to expand in direction perpendicular to the view of FIG. 29A, i.e. in direction perpendicular to both channel length direction and force 302 direction. Such expansion of channel 201/101 wall will again build up elastic energy in the channel 201 wall material.

FIG. 29B is same as FIG. 28B in every aspect, except that FIG. 29B is after compressive force 302 of FIG. 29A is released, and elastic energy built up in channel 201 wall acts to spring back channel 201 to its original non-compressed shape. Such spring back may provide a strong transient turbulence flow at various locations within the channel 201, which may help mechanically break up the cells 10/30 conglomerate into smaller pieces to assist self-dissociation of cells 10/30 conglomerate. After release of force 302 and channel 201 shape spring back, alternating flow 1030 may be applied similarly as in FIG. 23E to assist dissociation process of conglomerate of cells 10/30, where valve function of 1073 may turn off The FIG. 29A and FIG. 29B channel 201 compression and release process may be repeated as many times as needed until conglomerate of cells 10/30 are sufficiently dissociated, which may then be flushed out of channel 201.

FIG. 30A illustrates another alternative method of mechanical agitation. Every aspect is same as in FIG. 28A, except that rotational twisting force 303 or 304 may be applied to channel 201 to twist channel 201 along channel length direction, as shown in FIG. 30A. In one embodiment, only one of rotational force 303 or 304 is applied to one end of channel 201. In another embodiment, both rotational force 303 and force 304 are applied to difference ends of the channel 201 in opposite rotational directions to cause the channel 201 to twist along channel length direction. Such twist deformation of channel 201 will again build up elastic energy in the channel 201 wall material.

FIG. 30B is same as FIG. 28B in every aspect, except that FIG. 30B is after rotational force 303 and force 304 of FIG. 30A are released, and elastic energy built up in channel 201 wall acts to spring back channel 201 towards its original non-twisted shape. Such spring back may provide a strong transient turbulence flow at various locations within the channel 201, which may help mechanically break up the cells 10/30 conglomerate into smaller pieces to assist self-dissociation of cells 10/30 conglomerate. After release of forces 303 and 304, and channel 201 shape spring back, alternating flow 1030 may be applied similarly as in FIG. 23E to assist dissociation process of conglomerate of cells 10/30, where valve function of 1073 may turn off.

The FIG. 30A and FIG. 30B channel 201 twist and release process may be repeated as many times as needed until conglomerate of cells 10/30 are sufficiently dissociated, which may then be flushed out of channel 201 by buffer fluid.

Mechanical forces 300, 302, 303 and 304 may be applied by mechanical structures that are motorized and able to apply such forces repeatedly to channel 201, examples may include a flap for providing force 300, a compressor for provide force 302, and twisters for providing forces 303 and 304.

FIG. 31 is a schematic diagram illustrating a method to use MAG to separate biological entities conjugated with magnetic labels, for example cells 10/30, from a fluid solution. MAG channel of FIG. 31 may be any of channels 101, 201, 301, 320, or 330 described in any of the figures of this specification, and MAG of FIG. 31 may be any of the MAG 121, 122, 123, 124, 125, 126, 127, 128, or 129 described with the corresponding channel in any of the said figures. Method of FIG. 31 may include the following steps in sequence. In step 400, MAG channel is positioned with its outside wall contacting MAG wedge surface or pole tip ends, i.e. separation position of Position 1 or Position 21 as in FIG. 5, FIG. 10, FIG. 12, FIG. 14, FIG. 17, FIG. 19, FIG. 20A, FIG. 20C, FIG. 21A, FIG. 21C, FIG. 22A, FIG. 26A, FIG. 27A. In step 401, fluid sample is flown through the MAG channel in separation position. Then in step 402, positive entities with magnetic labels SPL 2 attached, for example cells 10/30, and free magnetic labels SPL 2 within the fluid sample are attracted by the magnetic field of MAG and agglomerate at the MAG channel wall against the MAG wedge or MAG pole tip ends. Meanwhile, in step 4020, negative entities without magnetic labels SPL 2 attached pass through the MAG channel without being attracted. The negative entities may then be processed directly in subsequent procedures as shown by path 427, where subsequent procedures may include entities analysis 407, for example processes as included in FIG. 79 through FIG. 81, or negative entities may be passed for continued process 408, for example through a UFL device as shown in FIG. 46A through FIG. 46C, FIG. 50 through FIG. 52, or through repeated MAG process as in FIG. 54A and FIG. 54B. After step 402, in step 403, sample may be depleted at input of the MAG channel and magnetic separation of positive entities may be completed. In step 404, which is an optional step, buffer fluid may be flown through MAG channel with MAG channel still at separation position to wash off any negative entities without magnetic labels SPL 2 but may have resided with the conglomerate of positive entities due to non-specific bindings. Then in step 405, MAG channel may be moved away from MAG to dissociation position including Position 2 and Position 22 at in FIG. 11, FIG. 22B, FIG. 22D, FIG. 24B, FIG. 26B, FIG. 26D, FIG. 27B, and magnetic dissociation 451, as shown in FIG. 22A through FIG. 26D, or mechanical dissociation 452 as shown in FIG. 27C through FIG. 30B, or magnetic together with mechanical dissociate 453 may be applied to the positive entities in MAG channel. In step 406, buffer fluid may be flown through MAG channel to flush out dissociated positive entities. If positive entities are not completely dissociated, 465 shows that repeated dissociation process 405 may be applied to remaining positive entities in MAG channel after prior flush out step, until positive entities are sufficiently dissociated and flushed out of the MAG channel. In the case that fluid sample is in large volume, fluid sample may be separated into multiple sub-volumes, where after process of a sub-volume from step 400 to step 406, a next sub-volume may be input into the MAG channel starting from step 400 for continued process as shown by 461 until completion of the fluid sample of the large volume. After positive entities are collected after step 406, they may be processed in subsequent procedures as shown by path 428, where subsequent procedures may include entities analysis 407 or continued process 408.

FIG. 32 illustrates a method to align channel 201/101 to MAG gap of MAG 123 device. Precise alignment of channel 201/101 to MAG wedge or MAG pole tip ends is of importance as descried in embodiments of this invention. In FIG. 32, side fixtures 1074 may be used to align and position channel 201/101 to designated locations on channel holder 1081 or 1082, where the fixtures 1074 may be fit into a pre-defined slot, notch, clip or other physical features on the sides of the channel holder 1081/1082. In one embodiment, channel 201/101 may be slightly stretched in channel length direction, thus channel 201/101 may have a reduced width 2011 in between the fixtures 1074, where such stretch helps guarantee a straight channel which may be then aligned with a straight MAG wedge of MAG 123. After channel 201/101 is attached to holder 1081/1082 by fixtures 1074, holder 1081/1082 may then move channel 201/101 to separation position, where holder 1081/1082 may have pre-determined physical orientation to MAG 123, for example a hinge, which aligns channel 201/101 to MAG wedge or MAG pole tip ends of MAG 123 precisely. Fixtures 1074 may be the same as 1073 as in FIG. 28A through FIG. 30B.

FIG. 33A through FIG. 37 illustrate method to utilize peristaltic pumps in embodiments of this invention.

FIG. 33A illustrates a typical peristaltic pump 500, which includes a rotor 501, drivers 502 attached to the rotor 501, and pump tubing 504/505, where tubing 504 is fluid incoming section and tubing 505 is fluid outgoing section of the same pump tubing. When rotor 501 rotates in direction 503, drivers 502 will squeeze pump tubing and force fluid to move from incoming section 504 to outgoing section 505 in directions 5041 and 5051 respectively. In the case when rotor rotates reversely to direction 503, fluid moves from outgoing section 505 to incoming section 504 of the pump tubing. Connectors 506 and 507 may be optional connections to incoming fluid line and outgoing fluid line 508 respectively. Advantage for peristaltic pump is the tubing 504/505 may be included as a continuous part of an enclosed fluid line as shown in FIG. 55A through FIG. 60B, which may be made disposable and single use, as well as sterile for clinical purpose. However, due to the spaced drivers 502 along the circumference of the rotor 501, flow rate of fluid output from section 505 has pulsation behavior, where flow rate increases and decreases with moving of each of the driver 502. Such pulsation is not desired for MAG and UFL fluid driving. FIG. 33A shows output section 505 outputs fluid through connector to channel 508. Channel 508 is preferred to be flexible tubing. Channel 508 may also be a section of channel 201. Flow limiter parts 509 and 510 function together to effectively clamp onto the channel 508 to reduce the fluid flow rate passing through the limiter. With reduced flow rate through the limiter, continued fluid output from pump 500 section 505 into the channel 508 will build up fluid pressure within channel 508. Due to the flexible nature of channel 508, channel 508 may enlarge its width perpendicular to the channel length direction, and forms fluid reservoir within channel 508 with elastic stress built up in channel wall. During pulsation of output flow from pump 500, when 5051 flow rate increases, channel 508 width will increase to build up stress in 508 channel wall and pressure within channel 508 and increase volume of channel 508 absorbs most of the instantaneous incoming flow, while flow rate 520 through limiter 509/510 into channel 501 shows smaller increase. When 5051 flow rate decreases, built-in elastic stress in channel 508 wall and fluid pressure in channel 508 continues to push fluid through the limiter 509/510, and flow rate 520 shows smaller flow rate decrease.

FIG. 33B illustrates top-down view of the inner structure of first type flow limiter 509 along the direction 63. FIG. 33B shows that flow limiter 509 has a shaped trench 5011, which allows fluid to flow through channel 508 when limiters 509 and 510 clamp onto channel 508 as in FIG. 33A. Trench 5011 has entrance width 511 to incoming fluid and exit width 512 to channel 201, where width 511 may be larger than width 512. Decreased trench 5011 width from 511 to 512 reduces the flow rate through the limiter 509/510. Flow limiter 510 may have same top down view and structure as limiter 509 when view in direction opposite to 63.

FIG. 33C illustrates a second type flow limiter in same view as FIG. 33A, where after flow limiters 509 and 510 clamp onto channel 508, flow limiters 509/510 form an effective opening of 514 towards channel 508, and opening of 513 towards channel 201. Opening 513 may be smaller than opening 514, which reduces flow rate through the limiter 509/510.

FIG. 34A is same as FIG. 33A except flow limiters 509/510 are disengaged from the flexible channel 508, where flow from pump 500 through channel 508 and channel 201 is continuous without limiter 509/510 and there is no elastic stress built up in channel 508 wall.

FIG. 34B is a schematic illustration of fluid flow rate 520 as in FIG. 34A situation, which shows large pulsation in flow rate 520. FIG. 34B shows the example 520 flow rate value vs pump 500 operation time from pumping start to pumping end. Value 521 illustrates the high flow rate and value 522 illustrates low flow rate of the pulsation behavior.

FIG. 35A is same as FIG. 33A, where flow limiters 509/510 are clamped upon flow channel 508, flow rate through the flow limiters 509/510 is reduced, and channel 508 has enlarged channel width with elastic stress built up in channel 508 wall.

FIG. 35B is a schematic illustration of fluid flow rate 520 as in FIG. 35A situation, which shows pulsation reduction in flow rate 520 compared to FIG. 34B. Value 523 corresponds to value 521 of FIG. 34B, and value 524 corresponds to value 522 of FIG. 34B. FIG. 35B illustrates that limiters 509/510 effectively reduce 520 flow rate pulsation. Due to the channel 508 liquid pressure build up at the start of pumping, and channel 508 liquid pressure dissipation at end of pumping, while limiters 509 and 510 are engaged, a flow rate ramp up slope 5221 after pump start and flow rate ramp down slope 5222 after pump end may exist in FIG. 35B.

FIG. 36A and FIG. 36B illustrate method to use flow limiter 509/510 to generate instantaneous high flow rate short pulse through channel 201 for flushing out magnetically separated entities, for example dissociated cells 10/30.

FIG. 36A illustrates FIG. 33A and FIG. 35A situation, where flow limiters 509 and 510 are clamped onto the flexible channel 508 while pump 500 pumps fluid into channel 508, where pressure is built up within the flexible channel 508, and elastic stress is built up in wall of channel 508. Line 525 represents a continuous channel 201 from after the limiters 509/510 to channel 201 over MAG structure. Flow rate 5201 represents averaged flow rate of flow rates 523 and 524 of FIG. 35B when flow limiters 509 and 510 are engaged.

FIG. 36B illustrates that flow limiters 509 and 510 are disengaged from the flexible channel 508, similar to FIG. 34A situation, while pump 500 still pumps fluid into channel 508, or immediately after pump 500 stops pumping and before pressure within channel 508 dissipates. At disengagement of limiters 509 and 510, liquid pressure in channel 508 and elastic stress in wall of channel 508 produces an instant high-speed fluid pulse flow 5202 into channel 201 which may flush the magnetically separated entities out of the channel 201. Such high speed short pulse flow 5202 may help achieve complete flush out of cells 10/30 with small volume of fluid that is originally contained in channel 508 of FIG. 36A. FIG. 36B also shows that a rigid cladding structure 1075 may be put into contact with channel 201 to help reduce deformation of flexible channel 201 during the cells 10/30 flush out to maintain the flow speed in channel 201.

FIG. 37 is a schematic illustration of fluid flow rate pulse created by the flow limiter operation of FIG. 36A to FIG. 36B, where 5201 is the fluid flow rate in channel 201 before limiters 509 and 510 release, and 5202 is flow rate peak value after limiters 509 and 510 release.

From FIG. 33A through FIG. 36B, channel 508 is a flexible channel, while channel 201 may be replaced by a rigid channel 101, 301, 320, or 330.

FIG. 38A through FIG. 43 describe various embodiments of micro-fluidic chip ("UFL") and method of use.

FIG. 38A is a top-down view of a first UFL embodiment UFL 600, where micro-fluidic channels are formed as trenches into a substrate material 611. UFL contains an entity fluid 6020 inlet 602, a buffer fluid 6040 inlet 604, a main channel 601, a large entities 6070 outlet 607, and a small entities 6090 outlet 609. Two side channels 603 connect inlet 602 to main channel 601 from the two sides of the main channel 601. Inlet 604 is directly connected to the main channel 601 at the center of the main channel 601. Main channel 601 connects to outlet 607 at the center of the main channel 601, and connects to outlet 609 from two sides of main channel 601 through two side channels 608. Entities fluid 6020 contains both large entities 6070 and small entities 6090. Buffer fluid 6040 is fluid for providing UFL function but without biological entities. Large entities 6070 fluid from outlet 607 contains mainly large entities 6070 and buffer fluid 6040. Small entities 6090 fluid from out 609 contains mainly small entities 6090 and fluid of entities fluid 6020 and may contain certain amount of buffer fluid 6040. During operation of UFL 600, buffer fluid 6040 and entity fluid 6020 are simultaneously pumped into outlets 604 and 602 respectively, where buffer fluid 6040 flows along center line of the main channel 601 and entity fluid flows close to the two side of the main channel as laminar flow. Buffer fluid 6040 carries large entities 6070 to exit outlet 607 and entity fluid carries remaining small entities 6090 to exit outlet 609. Channel 601 is substantially straight and linear along channel length direction from inlet 604 to outlet 607.

FIG. 38B is a cross-sectional view of a portion of the FIG. 38A UFL 600 along direction 64, which includes entity fluid inlet 602, buffer fluid inlet 604, and part of the UFL main channel 601. FIG. 38B illustrates UFL 600 is compose of two components, substrate 611 and cover 610. Inlets 602 and 604, outlets 607 and 609, channels 601, 603 and 608 are formed in substrate 611 as trenches of same depth 627 and preferably formed in a single step. In one embodiment, depth 627 is between 100 nm to 500 nm. In another embodiment, depth 627 is between 500 nm to 1 um.

In yet another embodiment, depth 627 is between 1 lum to 10 um. In yet another embodiment, depth 627 is between 10 um to 100 um. In yet another embodiment, depth 627 is between 100 um to 1 mm. Cover 610 contains external access ports to inlets and outlets of UFL 600 to allow entities fluid 6020 and buffer fluid 6040 to enter inlets 602 and 604, and to allow large entities 6070 fluid and small entities 6090 fluid to exit outlets 607 and 609. Inlets 602 and 604, outlets 607 and 609 are shown to be circular shape in FIG. 38A, but may be any other shape, including ellipse, square, rectangle, triangle, polygon, as suitable for application. Access ports of cover 610 are clearances, i.e. holes, through cover 610 directly over the inlets and outlets 602, 604, 607 and 609. FIG. 38B shows example of access ports 621 and 641 clearances matching to inlets 602 and 604 positions. After manufacture of the UFL 600 substrate 611 with the trenches of inlets, outlets and channels, and cover 610 with the access ports, cover 610 is positioned over the substrate 611 to form enclosed channels 601, 603 and 608, where cover 610 may bond to substrate 611 through any of: (1) surface to surface Van der Waals force; (2) gluing; (3) ultrasound thermal melting when one or both of substrate 611 and cover 610 being made of plastic or polymer material. Access ports clearances of cover 610, for example 621 and 641 to inlets and outlets 602, 604, 607 and 609 are preferred to be smaller in size than the corresponding inlets and outlets, which allows for positioning error during cover 610 to substrate 611 alignments without causing function loss of UFL due to misalignment. Injectors 6021 and 6041 then show example of possible external fluid injection to inlets of UFL 600 through cover 610 access ports clearance, where the injectors 6021 and 6041 may have a larger nozzles size than the matching access ports 621 and 641 for managing positioning errors between injectors and access ports. FIG. 38B shows that entities fluid 6020 containing large entities 612 and small entities 613, which may be injected by injector 6021, passing through assess port 621 and into inlet 602 and passing into main channel 601 as side laminar flows, while buffer fluid 6040 may be injected by injector 6041, passing through assess port 641 and into inlet 604 and passing into main channel 601 as center laminar flow.

Substrate 611 and cover 610 may be each composed of any of: glass, silicon, quartz, aluminum-titanium-carbon (AlTiC), SiC, SiN, silicon-oxide, alumina, plastic, PDMS, polymer, ceramic, or metal, where metal may be composed any one or any alloy of aluminum, iron, nickel, titanium, chromium, platinum, tungsten, rhenium, copper, gold, silver. In one embodiment, forming of inlets, outlets and channels in substrate 611 includes the steps of: (1) providing a substrate 611 having one substantially flat surface; (2) forming etching mask on top of said flat surface; (3) etch of substrate with a first etching method including: wet etch with fluid chemical, dry etch with chemical gas, plasma enhanced dry etch, sputter etch with ion plasma, and ion beam etch (IBE). In forming of etch mask of step (2), etch mask may be composed of photo resist (PR), which may include deposition or spin coating of PR on said flat surface; exposure by optical or ion/electron radiation with patterns of inlets, outlets and channels; development of PR after said exposure, where remaining PR with said patterns serves as etch mask. Etch mask may also be made of a hard mask material that has lower etch rate than the substrate material under the first etching method, and step (2) may include: deposition of a hard mask layer on said flat surface; deposition or spin coating PR layer on hard mask layer; exposure of said PR by optical or ion/electron radiation with patterns of inlets, outlets and channels, development of PR after said optical exposure, where remaining PR with said pattern serves as etching mask of said hard mask; hard mask is etched through with a second etch method including any of: wet etch with fluid chemical, dry etch with chemical gas, plasma enhanced dry etch, sputter etch with ion beam; removal of remaining PR layer. Second etch method and first etch method may be different in type, or different in chemistry.

In another embodiment, inlets, outlets and channels in substrate 611 may be formed by thermal press involving using a heated stencil with physical pattern of the inlets, outlets and channels to melt and deform part of substrate 611 to construct the inlets, outlets and channels, then cooling down substrate 611 and remove the stencil. In thermal press, substrate material is preferred to be plastic or polymer. In yet another embodiment, inlets, outlets and channels in substrate 611 may be formed by imprint, which involves using a stencil with physical pattern of the inlets, outlets and channels to imprint into a partially or completely melt substrate 611, and then cooling the substrate 611 and finally removing stencil, where cooled substrate retains the pattern transferred from stencil of the inlets, outlets and channels. In imprint, substrate material is preferred to be plastic or polymer. In another embodiment, inlets, outlets and channels are formed in substrate 611 by injection molding, where melted substrate 611 materials are injected into a mold cavity where substrate 611 body with engraved inlets, outlet and channels are defined by the mold cavity. Cover 610 may compose similar to substrate 611 materials, and assess ports of cover 610 may be formed in cover 610 similarly as the inlets, outlet and channels formed in substrate 611 as described above.

FIG. 38C is a schematic diagram illustrating a single fluidic pressure node 615 created between two side walls of the UFL 600 channel 601 of FIG. 38A by acoustic vibration, for example ultrasound vibration, generated by an acoustic generation device, for example a PZT 614. FIG. 38C is a cross-section view along direction 65 of FIG. 38A for part of the UFL 600 including main channel 601, substrate 611, cover 610 and PZT transducer 614 attached to the bottom of substrate 611. FIG. 38C shows that after injection of entities fluid 6020 and buffer fluid 6040, entities fluid 6020 containing large entities 612 and small entities 613 mainly flow along the edges of the channel 601 as laminar flow. AC voltage is applied to PZT 614, where frequency (Fp) of AC voltage is preferred to be at a frequency matching to the PZT resonance frequency (Fr). PZT 614 produces ultrasound vibrations to the substrate 611 at frequency Fp. Said ultrasound vibrations transfer to the fluid contained in channel 601. Channel 601 has channel width 625 defined as the normal distance between the two side walls of channel 601. In one embodiment, width 625 is between 100 nm to 1 um. In another embodiment, width 625 is between 1 um to 10 um. In yet another embodiment, width 625 is between 10 um to 100 um. In yet another embodiment, width 625 is between 100 um to 500 um. In yet another embodiment, width 625 is between 500 um to 5 mm. When channel width 625 is half wavelength, or an integer multiple of half wavelength, of the ultrasound mode in the fluid within channel 601 at frequency Fp, standing wave may be present in between the two side walls of channel 601 as indicated by the dashed lines 626. FIG. 38C shows when channel width 625 is half wavelength of fluid ultrasound mode at frequency Fp, where a single fluidic pressure node 615 is formed along the center line of channel 601 in the direction of channel length, which is perpendicular to the view of FIG. 38C. In another embodiment, channel width 625 is an integer times of half wavelength of fluid ultrasound mode at frequency Fp, where integer is larger than 1, and said integer number of fluidic pressure nodes may then be formed across the width 635 with each node being a line along the direction of channel length. Presence of standing wave 626 and pressure node 615 exert acoustic force, which is shown in FIG. 38D as arrows 628, on entities in the entities fluid laminar flow along the side walls of channel 601 and cause large size entities 6070 to move close to center node 615 during flowing through the channel 601. Said acoustic force 628 has the characteristics of: (1) largest amplitude close to channel 601 side walls with force direction pointing from the side walls towards the node 615; (2) smallest force, or close to zero force, around node 615; (3) being linearly proportional to size of the entities; (4) is a function of the density and compressibility of both the buffer fluid 6040 and the entities. Due to these characteristics, with proper optimization of buffer fluid composition, buffer fluid 6040 laminar flow speed, and entities fluid 6020 laminar flow speed, large entities 612 may be optimized to preferably break the laminar flow barrier to enter the buffer laminar flow due to a larger acoustic force acting on large entities 612, and be concentrated around the center node 615.

FIG. 38D is a schematic diagram illustrating the fluid acoustic wave of FIG. 38C causing larger size entities 612 to move into buffer fluid laminar flow around center of the channel 601. When fluid within the channel 601 exits the channel to outlets 607 and 609, channel 601 center sub-channel width 651 of FIG. 38A to outlet 607 may be much smaller than the width 625 of the channel 601, thus only allow large entities 612 at center flow within channel 601 to exit outlet 607 as large entities 6070 fluid. While smaller entities 613 mainly in the close to side wall laminar flow exit channel 601 through side channels 308 to exit from outlet 609 as small entities 6090 fluid.

Frequency Fp of PZT 614 vibration in one embodiment is between 100 kHz to 500 kHz, between 500 kHz to 1 MHz in another embodiment, between 1 MHz to 3 MHz in yet another embodiment, between 3 MHz to 5 MHz in yet another embodiment, between 5 MHz to 10 MHz in yet another embodiment, between 10 MHz to 50 MHz in yet another embodiment, and between 50 MHz to 100 MHz in yet another embodiment. In FIG. 38C and FIG. 38D, PZT 614 may also be attached to top of cover 610 in FIG. 38C and FIG. 38D, and ultrasound vibrations from PZT 614 is transferred from PZT 614 through cover 610 to fluid within channel 601, or through cover 601 to substrate 611 and then to the fluid within channel 601.

FIG. 39 is a schematic diagram illustrating methods to use a UFL to separate biological entities of different sizes, where UFL may be UFL 600 from FIG. 38A or FIG. 40A, UFL 620, 630 and 640 from FIG. 41A through FIG. 43. Sequential steps of 701 to 705 and 706 are substantially similar as described in FIG. 38A, FIG. 38B, FIG. 38C, and FIG. 38D, except steps 703 and 704 refer to possibility of multiple pressure nodes, as shown in FIG. 41B and FIG. 42B. Step 707 entities analysis can be performed on both the large entities 6070 and small entities 6090, and may include processes 903, 904, 905, 906, 5824, 5825, 5826 as described in FIG. 53, FIG. 79, FIG. 80, FIG. 82 and FIG. 83 on corresponding UFL output samples. Continued process 708, for example through a MAG device as shown in FIG. 44A through FIG. 45C, FIG. 47 through FIG. 49, or through cascaded UFL process as in FIG. 54C.

FIG. 40A is a cross-sectional view of a portion of a UFL 650 similar to FIG. 38B. UFL 650 is identical to UFL 600 from a top-down view as in FIG. 38A, except that a uniform soft magnetic layer ("SML") 616 is deposited on top the substrate 611 of UFL 650, and patterned together with the substrate 611 to form inlets 602 and 604, outlets 607 and 609, and channel 601, 603 and 608. SML 616 may be composed of at least one element from iron (Fe), cobalt (Co), and nickel (Ni). SML 616 thickness 6164 is between 10 nm to 100 nm in one embodiment, between 100 nm to 1 um in another embodiment, between 1 um to 10 um in yet another embodiment, between 10 um to 100 um in yet another embodiment, between 100 um to 1 mm in yet another embodiment, and between 1 mm to 3 mm in yet another embodiment. Deposition of SML layer 616 on substrate 611 may be by any of: electro-plating, vacuum plating, plasma-vapor-deposition (PVD), atomic layer deposition (ALD), chemical vapor deposition (CVD). Etching of layer 616 together with substrate 611 to form inlets 602 and 604, outlets 607 and 609, and channel 601, 603 and 608 may be by any of: dry etch, plasma enhanced dry etch, ion plasma etch, and IBE. Layer 616 may be a continuous layer along the channel 601 length direction and forms as part of the side walls of the channel 601.

FIG. 40B is similar as FIG. 38D and shows a schematic diagram illustrating the large entities 612 if concentrated by acoustic force 628 to the channel 601 center around the pressure node 615 and small entities 613 mainly remain around the channel 601 side wall. Additionally, a magnetic field 617 is applied in plane and induces magnetization 6162 in the SML layer 616. For the SML layer 616 located as part of the side walls of the channel 601, magnetization 6162 produces local magnetic field 6163, which has strongest magnetic field strength and field gradient close to the channel 601 side walls. Field 6163 may help maintain magnetic small entities, for example free magnetic labels SPL 2 that is part of the entities fluid 6020 in positive sample after MAG separation as shown in FIG. 82 and FIG. 83, to stay within the laminar flow close of channel 601 side walls and output from outlet 609 of FIG. 38A.

FIG. 40C shows that after etching of SML layer 616 together with substrate 611, and before cover 610 is attached to substrate 611, a passivation layer 6172 may be deposited covering exposed surfaces of SML layer 616 and substrate 611, Layer 6172 may help isolate fluid reaction with material of SML layer 616. Layer 6172 may be deposited over the etched surfaces of SML 616 and substrate 61, preferably conformably, by vacuum plating, electro-plating, PVD, ALD, CVD, molecular beam deposition (MBE), and diamond like carbon (DLC) deposition. Layer 6172 may be an oxide, or a nitride, or a carbide, of any one or more of elements of: Si, Ti, Ta, Fe, Al, W, Zr, Hf, V, Cu, Cr, Zn, Mg, Nb, Mo, Ni, Co, Fe, Ir, Mn, Ru, Pd, and C. Layer 6273 may compose at least one of: Si, Ti, Ta, Fe, Al, W, Zr, Hf, V, Cu, Cr, Zn, Mg, Nb, Mo, Ni, Co, Fe, Ir, Mn, Ru, Pd, and C. Layer 6273 may be a DLC layer. Thickness of layer 6273 may be between lnm to 10 nm in one embodiment, between 10 nm to 100 nm in another embodiment, between 100 nm to 10 um in another embodiment, and between 10 um to 100 um in another embodiment.

FIG. 41A is a top-down view of a second UFL embodiment UFL 620, which is same as FIG. 38A, except including a wider section 6012 of the main channel connecting between the inlet 604, and the narrower channel section 601 of FIG. 38A. Slope 6016 represents a transition section 6016 from wider section 6012 to narrow section 601. Channel sections 6012 and 601 are substantially straight and linear along channel length direction. Transition section 6016 may be a section of the main channel, where the main channel includes channel section 6012 connecting through the transition section 6016 to channel section 601. Transition section 6016 functions to funnel fluid flow from wider section 6012 into the narrower section 601. Channel wall of transition section 6016 may intersect with straight wall of wider section 6012 at a transition start point. Channel wall of transition section 6016 may intersect with straight wall of narrower section 601 at a transition stop point. In one embodiment, the channel shape of the transition section 6016 between transition start point and transition stop point may be a straight slope as shown in FIG. 41A. In another embodiment, the channel shape of the transition section 6016 between transition start point and transition stop point may be a curvature, whereas the curvature may be tangential to one of, or both of, channel wall of wider section 6012, and channel wall of narrower section 601.

FIG. 41B is a cross-sectional view of UFL 620 along direction 66 in FIG. 41A, which is across the wider section 6012. Wider section 6012 has a channel width 6252, which is the full wavelength of the ultrasound mode in the liquid within channel section 6012 at PZT 614 operating frequency Fp as described in FIG. 38C, and effectively twice the channel width 625 of channel 601 as in FIG. 38C and FIG. 41C. Due channel width 6252 being equal to the full wavelength of ultrasound mode at Fp, two pressure nodes may exist in channel section 6012, where acoustic force from the ultrasound mode may move and concentrate large entities 612 at each of the two nodes from the channel wall entity laminar flow.

FIG. 41C is a cross-sectional view of UFL 620 along direction 65 in FIG. 41A, which is across the narrower section 601, which is identical to FIG. 38D. After fluid within channel section 6012 flows through the transition 6016 to channel section 601, single pressure node of channel section 601 forces the large entities 612 to concentrate at channel section 601 center same as in FIG. 41C. Wider section 6012 provides a first stage large entities 612 separation from small entities 613. After transition section 6016, flow rates of center buffer laminar flow and channel side wall entities laminar flow increase to about twice the speed of same flow in section 6012 due to the channel width reduction from 6252 to 625. Channel section 601 provides a second stage large entities separation from small entities, together with the increase flow rate in channel section 601, purity of large entities 612 in 6070 fluid output from outlet 607, as well as purity of small entities 613 in 6090 fluid output from outlet 609, may be enhanced compared to UFL 600 of FIG. 38A.

FIG. 42A is a top-down view of a third UFL embodiment UFL 630, which is a further enhancement from the UFL 620 of FIG. 41A. Every aspect of FIG. 42A is same as FIG. 41A, except that when compared to UFL 620 of FIG. 41A, UFL 630 of FIG. 43A includes additional side channels 6013 that connect from around the transition section 6016 to side channels 608, or in another embodiment directly to the outlet 609, to divert side wall laminar flow of small entities 613 from wider section, or referred to as first stage section, 6012, as shown in FIG. 42B, directly to output 6090 without entering narrower section, or referred to as second stage section, 601. Channel sections 6012 and 601 are substantially straight and linear along channel length direction. In one embodiment, side channels 6013 connect from first stage section 6012 before the transition start point of section 6012 intersecting section 6016. In another embodiment, side channels 6013 connect from the transition start point of section 6012 intersecting section 6016. In yet another embodiment, side channels 6013 connect from the within the transition section 6016 between the transition start point of section 6012 intersecting section 6016 and the transition stop point of section 6012 intersection section 601. In yet another embodiment, side channels 6013 connect from the transition stop point of section 6012 intersecting section 601. In yet another embodiment, side channels 6013 connect from the second stage section 601 after the transition stop point of section 6012 intersecting section 601.

FIG. 42B is a cross-sectional view of UFL 630 along direction 66 in FIG. 42A, which is across the wider section 6012. FIG. 42B is identical to FIG. 41B.

FIG. 42C is cross-sectional view of UFL 630 along direction 65 in FIG. 42A, which is across the narrower section 601 and side channels 6013. Compared to FIG. 41C, side channels 6013 connecting from around the transition section 6016 of FIG. 42A contains mainly, or purely, small entities 613. While the channel 601 of FIG. 42C shows large entities 612 separation and concentration to channel 601 center pressure node similar as in FIG. 41C, but small entities 613 around section 601 channel walls is reduced in density when compared to FIG. 41C. Due to the pre-channel section 601 small entities diversion by side channel 6013, UFL 630 may have an even higher purity of large entities 612 in 6070 fluid output from outlet 607, as well as higher purity of small entities 613 in 6090 fluid output from outlet 609.

FIG. 43 is a top-down view of a fourth UFL embodiment UFL 640 having a multiple-stage UFL channel with sequential channel width reduction along the channel flow path. FIG. 43 shows a further enhancement in increasing large entities purity in 6070 and small entities purity in 6090. FIG. 43 shows an additional wider width section 6014 is added between inlet 604 and channel section 6012. Channel width of 6014 may be three times of the half wavelength of ultrasound mode of the liquid flowing through the UFL 640 channel at PZT frequency Fp, which is one half wavelength wider than channel width 6252 of section 6012. Channel width of 6014 may also be wider than the channel width 6252 of next stage channel section 6012 by an integer times of the half wavelength, where said integer is larger than one. Channel section 6014 changes to reduced channel width section 6012 through a transition section 6017. Side channels 6015 connect from around the transition section 6017 to side channels 6013, or 608, or directly to outlet 609 to divert small entities 613 from channel side wall laminar flow of section 6014 from entering section 6012, thereby increasing purity of large entities concentration in section 6012. Channel sections 6014, 6012 and 601 are substantially straight and linear along channel length direction.

As a further extension from FIG. 43, a multiple-stage UFL 640 may have multiple channel sections along the UFL 640 channel flow path, where each earlier section of the UFL channel along the channel flow path may have a channel width that is wider than the immediate next section channel width by an integer number of a half wavelength of ultrasound mode in the fluid flow at the PZT frequency Fp, where said integer is equal to or larger than 1. Final channel section before flow exiting the outlets of the UFL 640 is preferred to have a channel width equal to said half wavelength in one embodiment, but may also have a channel width that equals to an integer number of said half wavelength in another embodiment where integer is larger than one. Side channels connecting to each of the transition area between adjacent channel sections divert small entities from the earlier channel in the entities laminar flow close to the earlier channel walls towards the outlet 609 to reduce number of small entities entry into immediate next stage channel section.

FIG. 44A through FIG. 65B illustrate various embodiments of method to utilize MAG and UFL device to separate biological entities from an entity fluid. For simplicity of description UFL 600 of FIG. 38A and MAG 123 with channel 201 are used in the figures for explanation. However, UFL 600 may be replaced with UFL 650, 630, 640 of FIG. 40A, FIG. 41A, FIG. 42A, FIG. 43, while MAG 123 may be replaced with MAG 121, 122, 124, 124,125, 126, 127, 128, 129 and corresponding channel types as described in prior figures without limitation and without sacrifice of performance.

FIG. 44A illustrates first type sample processing method where biological sample is first passed through UFL 600 and the large entity output 6070 of UFL 600 is then passed through channel 201 adapted to MAG 123, with a first type flow connector 801 connecting the UFL 600 large entity outlet 607 and MAG inlet flow as in step 401 of FIG. 31 or step 708 of FIG. 39. For the in-series operation of UFL 600 and MAG 123 devices, optimal flow rate for UFL channel 601 and optimal flow rate for MAG channel 201 may be different. Optimal flow rate for UFL channel 601 acoustic force separation of large and small entities are determined by laminar flow condition, and separation efficiency between large and small entities. Optimal flow rate for MAG 123 separation is determined by the length of channel 201 and magnetic field force on magnetic labels attached to the entities. Direct fluidically coupled flow from UFL 600 outlet 607 to MAG channel 201 inlet will force the flow rate being the same through UFL 600 channel and MAG channel 201, which may incur negative impact on separation efficiency for either one or both of UFL 600 and MAG 123. It is necessary to decouple the fluid flows through UFL 600 and MAG 123 channel 201. Flow connector 801 serves to decouple flow rates of the UFL 600 and MAG 123. Output fluid 6070 is first injected into connector 801 through inlet 8011, and fluid in connector 801 is output through outlet 8012 as flow as in steps 401/708 into inlet of channel 201 of MAG 123. Both UFL 600 and MAG 123 channel 201 may operate at their respective optimal flow rate. In one embodiment where MAG 123 channel 201 optimal flow rate is larger than UFL 600 optimal flow rate, MAG 123 extracts fluid 401/708 from connector 801 faster than UFL 600 injects fluid 6070 into the connector 801. A fluid level sensor 100 may be attached to connector 801 to sense fluid level remaining in connector 801. If fluid level drops below a low threshold, sensor 100 may signal MAG 123 to pause flow as in steps 401/708 intake to wait for connector 801 internal liquid level to increase to another higher level before MAG 123 may restart extracting fluid as in steps 401/708 from connector 801. In another embodiment where MAG 123 channel 201 optimal flow rate is smaller than UFL 600 optimal flow rate, MAG 123 extracts fluid as in steps 401/708 from connector 801 slower than UFL 600 injects fluid 6070 into the connector 801. If fluid level increases above a low threshold, sensor 100 may signal UFL 600 to pause flow 6070 output to wait for connector 801 internal liquid level to drop to another lower level before UFL 600 may restart outputting fluid 6070 into connector 801. Flow connector 801 may be in the design as shown in FIG. 44A, where inlet 8011 is at a higher vertical location than outlet 8012, where flow 6070 enters connector 801 and accumulates at outlet 8012 at inside of 801 due to gravity. Alternatively, liquid sample may be completely processed through UFL 600 first and stored in connector 801. MAG 123 then extracts fluid from connector 801 as input into the MAG 123 channel 201 and completes processing of all liquid sample from connector 801. Connector 801 may be made as part of an enclosed fluidic line, where during the path of flow 6070 from UFL 600 outlet 607 to inlet 8011 of connector 801, to outlet 8012, to flow as in steps 401/708 into inlet of channel 201, fluid sample is not exposed to air, and being sterile.

FIG. 44B illustrates first type sample processing method of FIG. 44A with using a second type flow connector 802 connecting the UFL 600 large entity outlet 607 and MAG 123 channel 201 inlet. Connector 802 as shown in FIG. 44B takes the form similar to a vial. Flow 6070 enters connector 802 through a short length inlet tube 8021 of connector 802 and drips to bottom of the connector 802 due to gravity. Flow as in steps 401/708 is extracted from the fluid at the bottom of the connector 802 by a long length outlet tube 8022 to input of channel 201. Fluid level sensor 100 may be attached to connector 802 to sense fluid level within connector 802. UFL 600 and MAG 123 may both operate at their respective optimal flow rate, and fluid level sensor 100 may function to pause UFL 600 operation or MAG 123 operation with the same method as described in FIG. 44A. Alternatively, liquid sample may be completely processed through UFL 600 and stored in connector 802. MAG 123 then extracts fluid from connector 801 as input into the MAG 123 channel 201 and completes processing of all liquid sample from connector 802. Connector 802 may be made as part of an enclosed fluidic line similar as connector 801.

FIG. 44C illustrates first type sample processing method of FIG. 44A with using a third type flow connector 803 connecting the UFL 600 large entity outlet 607 and MAG 123 channel 201 inlet. Connector 803 as shown in FIG. 44C takes the form similar to a fluid bag or blood bag. Flow 6070 enters connector 803 through a bottom inlet 8031 fills connector 803 from bottom of the connector 803 due to gravity. Flow as in steps 401/708 is extracted from the fluid at the bottom of the connector 803 through outlet 8032 to input of channel 201. Fluid level sensor 100 may be attached to connector 803 to sense fluid level within connector 803. UFL 600 and MAG 123 may both operate at their respective optimal flow rate, and fluid level sensor 100 may function to pause UFL 600 operation or MAG 123 operation with the same method as described in FIG. 44A. Alternatively, liquid sample may be completely processed through UFL 600 and stored in connector 803. MAG 123 then extracts fluid from connector 801 as input into the MAG 123 channel 201 and completes processing of all liquid sample from connector 803. Connector 803 may be made as part of an enclosed fluidic line similar as connector 801.

FIG. 45A illustrates second type sample processing method where biological sample is first passed through UFL 600 and the small entity output 6090 of UFL 600 is then passed through MAG 123, with first type flow connector 801 connecting the UFL small entity 6090 outlet 609 and MAG 123 channel 201 inlet. FIG. 45A is identical to FIG. 44A in every aspect except small entities flow 6090 from outlet 609 is injected into the inlet 8011 of connector 801.

FIG. 45B illustrates second type sample processing method where biological sample is first passed through UFL 600 and the small entity output 6090 of UFL 600 is then passed through MAG 123, with second type flow connector 802 connecting the UFL small entity 6090 outlet 609 and MAG 123 channel 201 inlet. FIG. 45B is identical to FIG. 44B in every aspect except small entities flow 6090 from outlet 609 is injected into the inlet 8021 of connector 802.

FIG. 45C illustrates second type sample processing method where biological sample is first passed through UFL 600 and the small entity output 6090 of UFL 600 is then passed through MAG 123, with third type flow connector 803 connecting the UFL small entity 6090 outlet 609 and MAG 123 channel 201 inlet. FIG. 45C is identical to FIG. 44C in every aspect except small entities flow 6090 from outlet 609 is injected into the inlet 8031 of connector 803.

FIG. 46A illustrates third type sample processing method where biological sample is first passed through MAG 123 channel 201, and following procedure 427 or 428 of FIG. 31, the output of MAG 123 channel 201 is then passed through UFL 600 as entity fluid 6020 into inlet 602 as in step 408 of FIG. 31, with first type flow connector 801 connecting the MAG 123 channel 201 outlet and UFL 600 entity fluid 6020 inlet 602. In FIG. 46A, output from MAG 123 can be either negative entities that do not have attached SPL 2, or positive entities separated by MAG 123 magnetic field and subsequently dissociated and flushed out of channel 201 as described in FIG. 31. Similar as in FIG. 44A, MAG 123 and UFL 600 may each operate with their respective optimal flow rate. Fluid level sensor 100 may be attached to connector 801 to sense fluid level remaining in connector 801. Fluid level sensor 100 operates similarly as in FIG. 44A to sense fluid in connector 801, and depending on the flow rate difference between MAG 123 and UFL 600, may pause MAG 123 or UFL 600 flow to maintain fluid level in connector 801 above a low level or below a high level. Alternatively, liquid sample may be completely processed through MAG 123 first and stored in connector 801. UFL 600 then extracts fluid from connector 801 as input into the inlet 602 and completes processing of all liquid sample from connector 801. Connector 801 may be made as part of an enclosed fluidic line similarly as in FIG. 44A.

FIG. 46B is same as FIG. 46A in every aspect, except replacing connector 801 with connector 802, where operation of connector 802 and attached sensor 100 is same as described FIG. 44B.

FIG. 46C is same as FIG. 46A in every aspect, except replacing connector 801 with connector 803, where operation of connector 803 and attached sensor 100 is same as described FIG. 44C.

FIG. 47 illustrates fourth type sample processing method where biological sample is first passed through multiple UFLs 600, output fluids from the UFLs 600, which can be either large entities 6070 or small entities 6090, are then fed into inlets 8011 of a fourth type flow connector 8010, and from connector 8010 outlets 8012 into the inlets of channels 201 of multiple MAGs 123. FIG. 47 is functionally similar to FIG. 44A and FIG. 45A. Connector 8010 is also functionally same as connector 801, except inlet 8011 of connector 8010 accept multiple fluid output from multiple UFLs 600, and outlet 8012 of connector 8010 outputs to input of multiple channels 201 of multiple MAGs 123.

FIG. 48 illustrates fifth type sample processing method where biological sample is first passed through multiple UFLs 600, output fluids from the UFLs 600, which can be either large entities 6070 or small entities 6090, are then fed into inlets 8021 of a fifth type flow connector 8020, and from connector 8020 outlets 8022 into the inlets of channels 201 of multiple MAGs 123. FIG. 48 is functionally similar to FIG. 44B and FIG. 45B. Connector 8020 is also functionally same as connector 802, except inlet 8021 of connector 8020 accept multiple fluid output from multiple UFLs 600, and outlet 8022 of connector 8020 outputs to input of multiple channels 201 of multiple MAGs 123.

FIG. 49 illustrates sixth type sample processing method where biological sample is first passed through multiple UFLs 600, output fluids from the UFLs 600, which can be either large entities 6070 or small entities 6090, are then fed into inlets 8031 of a sixth type flow connector 8030, and from connector 8030 outlets 8032 into the inlets of channels 201 of multiple MAGs 123. FIG. 49 is functionally similar to FIG. 44C and FIG. 45C. Connector 8030 is also functionally same as connector 803, except inlet 8031 of connector 8030 accept multiple fluid output from multiple UFLs 600, and outlet 8032 of connector 8030 outputs to input of multiple channels 201 of multiple MAGs 123.

In each of FIG. 47, FIG. 48, and FIG. 49, in one embodiment, same biological sample is divided and processed simultaneously through multiple UFLs 600. In another embodiment, each of the UFLs 600 processes a different biological sample. Output from each UFL 600, either large entities 6070 fluid from outlet 607 or small entities fluid from outlet 609, shown as dashed lines in FIG. 47, FIG. 48 and FIG. 49, may be individually input into the inlet 8011 of connector 8010 of FIG. 47, or into inlet 8021 of connector 8020 of FIG. 48, or into inlet 8031 of connector 8030 of FIG. 49, as shown by solid lines 6070/6090 in each of FIG. 47, FIG. 48 and FIG. 49. From outlet 8012, 8022, 8032 of FIG. 47, FIG. 48 and FIG. 49 respectively, following steps of 401 or 708, each of the MAGs 123 of FIG. 47, FIG. 48, or FIG. 49 may extract fluid sample from corresponding connector 8010, 8020, and 8030 into its corresponding channel 201. Each of the UFL 600 and each of the MAG 123 of FIG. 47, FIG. 48, or FIG. 49 may operate at its own respective optimal sample flow rate, which may be different between different UFLs 600 and different between different MAGs 123 within same figure. Due to the existence of the connector 8010, 8020, and 8030, flow rate interference between the different UFLs 600 and MAGs 123 within each of FIG. 47, FIG. 48 and FIG. 49 are minimized or eliminated. Fluid level sensor 100 may be attached to buffers 8010, 8020, and 8030 to sense fluid level remaining in each of the flow connectors 8010, 8020, and 8030. Fluid level sensor 100 operates similarly as in FIG. 44A through FIG. 44C in sensing fluid in flow connectors 8010, 8020, and 8030, and depending on the flow rate difference between MAGs 123 and UFLs 600 of each figure, may pause operation of one or more MAGs 123, or may pause operation of one or more UFLs 600 of each figure to maintain fluid level in corresponding connector 8010, 8020, or 8030 to be above a low level threshold or below a high level threshold. Alternatively, liquid sample may be completely processed through all UFLs 600 first and stored in corresponding connector 8010, 8020, or 8030 of each FIG. 47, FIG. 48 and FIG. 49. MAGs 123 then extract fluid from corresponding connector 8010, 8020, or 8030 of each figure and complete processing of all liquid sample from each corresponding connector 8010, 8020, or 8030. Connectors 8010, 8020, and 8030 may each be made as part of a set of enclosed fluidic lines, which may include UFLs 600, channels 201 and connections from UFLs 600 to each connector 8010, 8020, 8030 and from each connector 8010, 8020, and 8030 to channels 201, similar as described in FIG. 44A through FIG. 44C.

FIG. 50 illustrates seventh type sample processing method where biological sample is first passed through multiple MAGs 123, output fluids from the MAGs 123 channels 201 are then fed into inlets 8011 of flow connector 8010 of FIG. 47, and from flow connector 8010 outlets 8012 into the entity fluid inlets 602 of multiple UFLs 600.

FIG. 51 illustrates eighth type sample processing method where biological sample is first passed through multiple MAGs 123, output fluids from the MAGs 123 channels 201 are then fed into inlets 8021 of flow connector 8020 of FIG. 48, and from flow connector 8020 outlets 8022 into the entity fluid inlets 602 of multiple UFLs 600.

FIG. 52 illustrates ninth type sample processing method where biological sample is first passed through multiple MAGs 123, output fluids from the MAGs 123 channels 201 are then fed into inlets 8031 of flow connector 8030 of FIG. 49, and from flow connector 8030 outlets 8032 into the entity fluid inlets 602 of multiple UFLs 600.

In each of FIG. 50, FIG. 51, and FIG. 52, in one embodiment, same biological sample is divided and processed simultaneously through multiple MAGs 123. In another embodiment, each of the MAGs 123 processes a different biological sample. Output from each MAG 123, either negative entities following procedure 427, or positive entities following procedure 428, may be individually input into the inlet 8011 of connector 8010 of FIG. 50, or into inlet 8021 of connector 8020 of FIG. 51, or into inlet 8031 of connector 8030 of FIG. 52, as shown by solid lines 427/428 in each of FIG. 50, FIG. 51 and FIG. 52. From outlet 8012, 8022, 8032 of FIG. 50, FIG. 51 and FIG. 52 respectively, following step of 408, each of the UFLs 600 of FIG. 50, FIG. 51, or FIG. 52 may extract fluid sample as entity fluid 6020 from corresponding connector 8010, 8020, and 8030 into its corresponding entities inlet 602, Each of the UFL 600 and each of the MAG 123 of FIG. 50, FIG. 51, or FIG. 52 may operate at its own respective optimal sample flow rate, which may be different between different UFLs 600 and different between different MAGs 123 within same figure. Due to the existence of the connector 8010, 8020, and 8030, flow rate interference between the different UFLs 600 and MAGs 123 within each of FIG. 50, FIG. 51 and FIG. 52 are minimized or eliminated. Fluid level sensor 100 may be attached to flow connectors 8010, 8020, and 8030 to sense fluid level remaining in each of the flow connectors. Fluid level sensor 100 operates similarly as in FIG. 46A through FIG. 47C in sensing fluid in flow connectors 8010, 8020, and 8030, and depending on the flow rate difference between MAGs 123 and UFLs 600 of each figure, may pause operation of one or more MAGs 123, or may pause operation of one or more UFLs 600 of each figure to maintain fluid level in corresponding connector 8010, 8020, or 8030 to be above a low level threshold or below a high level threshold. Alternatively, liquid sample may be completely processed through all MAGs 123 first and stored in corresponding connector 8010, 8020, or 8030 of each FIG. 50, FIG. 51 and FIG. 52. UFLs 600 then extract fluid from corresponding connector 8010, 8020, or 8030 of each figure and complete processing of all liquid sample from each corresponding connector 8010, 8020, or 8030. Flow connectors 8010, 8020, and 8030 may each be made as part of a set of enclosed fluidic lines, which may include UFLs 600, channels 201 and connections from channels 201 to each connector 8010, 8020, 8030 and from each connector 8010, 8020, and 8030 to UFLs 600, similar as described in FIG. 46A through FIG. 46C.

FIG. 53 illustrates tenth type sample processing method where biological sample after being passed through one or more of UFLs 600 or MAGs 123, output fluids from the UFLs 600 and MAGs 123 are fed into inlets of a flower connector 8020 or a flow connector 8030, and from the flow connectors 8020 and 8030 outlets into different type of cell processing devices. FIG. 53 shows example of liquid sample output from MAG 123 channel 201, including negative entities following procedure 427 and positive entities following procedure 428, may be injected to inlet 8021 of connector 8020 or inlet 8031 of connector 8030 similar as in FIG. 51 and FIG. 52. Alternatively, UFL 600 large entities output 6070 from outlet 607 or small entities output 6090 from outlet 609 may be also injected into to inlet 8021 of connector 8020 or inlet 8031 of connector 8030 similar as in FIG. 48 and FIG. 49. After sample fluid is completely processed through UFL 600 or MAG 123, and injected into, and stored within, connector 8020 or connector 8030, entities analysis as in step 407 of FIG. 31 and step 707 of FIG. 39 may be performed by sending sample fluid containing entities from connector 8020 or connector 8030 to any of: cell counter 903, cell imager 904, flow cytometer or sorter 905, and DNA or RNA sequencer 906. Entities may be further sent to DNA or RNA sequencer 906 after cell counter 903 as in 936, or after cell imager 904 as in 946, or after flow cytometer or sorter 905 as in 956. For sending the sample fluid from outlet 8022 of connector 8020, or from outlet 8032 of connector 8030, pressurized chamber 800 may be used to contain the connector 8020 or connector 8030 inside, and force sample fluid out of connector 8020 or connector 8030 in a steady and continuous flow stream. Chamber 800 may be a chamber filled with pressurized air inside. Connector 8020 in vial type may have an additional air port 8023 open to chamber 800 internal pressurized air to help push sample fluid out of connector 8020. While connector 8030 may be in a flexible blood bag form, which when under pressured air of chamber 800, will automatically deflate and force sample liquid out through outlet 8032. To avoid back flow into UFL 600 or MAG 123 channel 201, shut off valves 805 may be implemented on output lines from MAG 123 channel 201 and UFL 600 to connector 8020 or connector 8030.

FIG. 54A illustrates eleventh type sample processing method where biological sample after being passed through a first MAG 123 channel 201 during a magnetic separation may output negative entities fluid following procedure 427, or positive entities fluid following procedure 428, into inlet of a second MAG 123 channel 201 input as in step 408 of a continued process. FIG. 54A illustrates a multi-stage MAG process.

FIG. 54B illustrates twelfth type sample processing method where after biological sample passed through MAG 123 for magnetic separation, output fluid from MAG 123 channel 201, containing either negative entities or position entities, may be diverted through a T-connector 912 into flow 913. Flow 913 may then be re-input back into the input of the channel 201 of MAG 123 for another round of magnetic separation through T-connector 911. T-connector 911 allows initial fluid sample input as in step 401 and recycled flow 913 input to channel 201. T-connector 912 allows output from channel 201 into recycled flow 913 or output from MAG 123 as in procedures 427 and 428. In one embodiment, recycled flow 913 contains negative entities, repeated magnetic separation in FIG. 54B helps achieve complete depletion of all magnetic entities in the negative entities flow before output into 427/428 procedure. In another embodiment, recycled flow 913 contains positive entities after dissociation, repeated process as in FIG. 54B helps increase purity in positive magnetic entities to allow wash off of non-magnetic entities that may be in the conglomerate by non-specific bindings. FIG. 54B illustrates using same MAG 123 as a multi-cycle MAG process.

FIG. 54C illustrates thirteenth type sample processing method where biological sample after being passed through a first UFL 600, output fluids from first UFL 600, for example large entities 6070 fluid from outlet 607 or small entities 6090 fluid from outlet 609, may be passed into entity fluid inlets 602 of one or more subsequent UFLs 600 as a multi-stage UFL process.

FIG. 55A illustrates first embodiment of closed and disposable fluidic lines for third type sample processing method as shown in FIG. 46A, where connector 801 may be replaced with connector 802 or connector 803 without limitation. Input line 923 may connect to a sample liquid container. Input line 924 may connect to a MAG buffer container. Input line 923 and input line 924 are connected through a T-connector 921 to the inlet of the first pump tubing 504/505 that may be mounted into a peristaltic pump. First pump tubing 504/505 outlet connects to channel 201 which may be used as part of MAG 123. Output of channel 201 connects to T-connector 922, which connects to output line 925 and output line 926. Output line 925 may connect to a MAG out sample container and output line 926 connects to inlet of connector 801. In one embodiment, output line 925 may output negative entities to said MAG out sample container, and output line 926 may output positive entities to connector 801. In another embodiment, output line 925 may output positive entities to said MAG out sample container, and output line 926 may output negative entities to connector 801. Connector 801 outlet connects to input line 9271 of a second pump tubing 504/505. Said second pump tubing 504/505 outlet then connects to UFL 600 sample input line 6020. Input line 9272 may connect to UFL buffer container and connects to inlet of a third pump tubing 504/505. Said third pump tubing 504/505 outlet then connects to UFL 600 buffer input line 6040. UFL 600 large entities 6070 output line may connect to a large entities sample container. UFL 600 small entities 6090 output line may connect to a small entities sample container. FIG. 55A illustrates that besides the input and output lines 923, 924, 925, 9272, 6070, and 6090 that connect to external containers, entire fluid path from sample liquid input to line 923, to sample output to lines 925, 6070, 6090, all pumps, MAG 123 and other fluidic line components will be externally attached to the lines of FIG. 55A. Thus, lines of FIG. 55A are internally enclosed, suitable for single use disposable purpose and sterile applications.

FIG. 55B illustrates fluidic lines of FIG. 55A being connected to, or attached with, various fluidic components. Input line 923 connects to a liquid sample container 928 in blood bag form. Input line 924 connects to buffer container 929. Valves 935 and 936 are attached to lines 923 and 924 to control either sample liquid from bag 928 or buffer from container 929 is flown through T-connector 921 into first pump tubing 504/505. First, second and third pump tubing 504/505 is each installed into a peristaltic pump 500. Three pumps 500 operate to pump either sample fluid or buffer fluid into MAG 123 and UFL 600. A flow limiter 509/510 may be attached to the output line from each pump 500, including lines 201, 6020, 6040 to reduce flow rate pulsation from the pumps 500. Channel line 201 is mounted into MAG 123. Output line 925 connects to MAG out sample container 934. Valve 940 is attached to line 925 and valve 937 is attached to line 926, which control negative entities or positive entities from MAG 123 going into either container 934 or the connector 801 through the T-connector 922. Valves 940 and 937 may both shut down the flow in lines 925 and 926 during demagnetization/dissociation process of MAG 123. Input line 9272 may connect to UFL buffer container 931. UFL output line 6070 connects to large entities container 932 and output line 6090 connects to small entities 933. Adjustable valves 939 and 938 may be attached to the lines 6070 and 6090 to adjust the flow rate within each line of 6070 and 6090, which in turn controls the laminar flow speed in UFL channel for channel center buffer flow and channel edge entities sample flow.

FIG. 56A illustrates second embodiment of closed and disposable fluidic lines for third type sample processing method as shown in FIG. 46A. FIG. 56A is identical to FIG. 55A, except the output line 925 is connected to a MAG sample container 934, UFL output line 6070 is connected to a large entities container 932, and UFL output line 6090 is attached to a small entities container 933. FIG. 56A illustrates containers 934, 932, 933 are in the form of blood bags. Bags 932, 933, 934 as part of the enclose lines of FIG. 56A may be disposable and made sterile, and may also be separated from the lines after separation process for steps 407 and 408 of FIG. 31, or steps 707 and 708 of FIG. 39.

FIG. 56B describes the identical process of: connecting sample container 928, buffer container 929, buffer container 931 to the lines 923, 924 and 9272 respectively, same as in FIG. 55B. Containers 928, 929, 931 are in blood bag form. Also same as described in FIG. 55B, three pump tubing 504/505 are installed in the three peristaltic pumps 500, valves 935, 936, 940, 937, 939, 938, are each attached to the corresponding lines, and flow limiters 509/510 may be attached at output line of each pump 500 same as in FIG. 55B.

FIG. 57A illustrates embodiment of closed and disposable fluidic lines for first type sample processing method as shown in FIG. 44A, where connector 801 may be replaced with connector 802 or connector 803 without limitation. Input line 9271 may connect to a UFL sample liquid container, and also connects to inlet of a first pump tubing 504/505, which further connect to entities input line 6020 of UFL 600. Input line 9272 may connect to a UFL buffer container, and also connects to inlet of a second pump tubing 504/505, which further connect to buffer input line 6040 of UFL 600. UFL 600 large entities output line 6070 connects to inlet of connector 801. UFL 600 small entities output line 6090 may connect to a small entities container. Outlet of connector 801 connects to MAG sample input line 923. MAG buffer input line 924 may connect to a MAG buffer container. Input lines 923 and 924 are connected through a T-connector 921 to the inlet of the third pump tubing 504/505. Third pump tubing 504/505 outlet connects to channel 201 which may be used as part of MAG 123. Output of channel 201 connects to T-connector 922, which connects to output line 925 and output line 926. Output lines 925 and 926 may each connect to a MAG out sample container. In one embodiment, output line 925 may output negative entities to a first MAG out sample container, and output line 926 may output positive entities to a second MAG out sample container. FIG. 57A illustrates that besides the input and output lines 9271, 9272, 924, 6090, 925, and 926 that connect to external containers, entire fluid path from UFL sample and UFL buffer input lines 9271 and 9272, to sample output lines 6090, 925 and 926, all pumps, MAG 123 and other fluidic line components will be externally attached to the lines of FIG. 57A. Thus, lines of FIG. 57A are internally enclosed, suitable for single use disposable purpose and sterile applications.

FIG. 57B illustrates fluidic lines of FIG. 57A being connected to, or attached with, various fluidic components. First, second and third pump tubing 504/505 is each installed into a peristaltic pump 500. Three pumps 500 operate to pump either sample fluid or buffer fluid into MAG 123 and UFL 600. A flow limiter 509/510 may be attached to the output line from each pump 500, including lines 201, 6020, 6040 to reduce flow rate pulsation from the pumps 500. Input line 9271 connects to a liquid sample container 928 in blood bag form. Input line 9272 connects to UFL buffer container 931 also in blood bag form. UFL output line 6090 connects to small entities container 933 in blood bag form. Adjustable valves 939 and 938 may be attached to the lines 6070 and 6090 to adjust the flow rate within each line of 6070 and 6090, which in turn controls the laminar flow speed in UFL 600 channel for channel center buffer flow and channel edge entities sample flow. Input line 924 connects to MAG buffer container 929. Valves 935 and 936 are attached to lines 923 and 924 to control either sample liquid from connector 801 or buffer fluid from container 929 is flown through T-connector 921 into third pump tubing 504/505. Channel line 201 is mounted into MAG 123. Output line 925 connects to first MAG out sample container 934. Output line 926 connects to second MAG out sample container 9342. Valve 940 is attached to line 925 and valve 937 is attached to line 926, which control negative entities and positive entities from MAG 123 going into either container 934 or container 9342 through the T-connector 922. Valves 940 and 937 may both shut down the flow in lines 925 and 926 during demagnetization/dissociation process of MAG 123.

FIG. 58A illustrates embodiment of closed and disposable fluidic lines for second type sample processing method as shown in FIG. 45A. FIG. 58A is identical to FIG. 57A in every aspect, except the UFL 600 small entities output line 6090 connects to the inlet of the connector 801 instead of the output line 6070 as in FIG. 57A. Large entities output line 6070 of FIG. 58A may connect to a large entities container.

FIG. 58B illustrates fluidic lines of FIG. 58A being connected to, or attached with, various fluidic components. FIG. 58B is identical to FIG. 57B in every aspect, except the UFL 600 small entities output line 6090 connects to the inlet of the connector 801 instead of the output line 6070 as in FIG. 57B. Large entities output line 6070 of FIG. 58B connects to a large entities container 932 in blood bag form.

FIG. 59A illustrates embodiment of closed and disposable fluidic lines for sample processing through a single MAG. Input line 923 may connect to a sample liquid container. Input line 924 may connect to a MAG buffer container. Input line 923 and input line 924 are connected through a T-connector 921 to the inlet of the pump tubing 504/505 that may be mounted into a peristaltic pump. Pump tubing 504/505 outlet connects to channel 201 which may be used as part of MAG 123. Output of channel 201 connects to T-connector 922, which connects to output line 925 and output line 926. Output lines 925 and 926 may each connect to a MAG out sample container.

FIG. 59B illustrates fluidic lines of FIG. 59A being connected to, or attached with, various fluidic components. Input line 923 connects to a liquid sample container 928. Input line 924 connects to buffer container 929. Valves 935 and 936 are attached to lines 923 and 924 to control either sample liquid from bag 928 or buffer from container 929 is flown through T-connector 921 into first tubing 504/505. Pump tubing 504/505 is installed into a peristaltic pump 500. Pump 500 operates to pump either sample fluid or buffer fluid into MAG 123. A flow limiter 509/510 may be attached to the output line 201 from pump 500 to reduce flow rate pulsation from the pumps 500. Channel line 201 is mounted into MAG 123. Output line 925 connects to MAG out sample container 934. Output line 926 connects to MAG out sample container 9342. Valve 940 is attached to line 925 and valve 937 is attached to line 926, which control negative entities and positive entities from MAG 123 going into either container 934 or container 9342. Valves 940 and 937 may both shut down the flow in lines 925 and 926 during demagnetization/dissociation process of MAG 123. FIG. 59B shows containers 928, 929, 934 and 9342 may be in the form of blood bags, but may also be in other physical forms of vial or bottles.

FIG. 60A illustrates embodiment of closed and disposable fluidic lines for sample processing through a single UFL 600. Input line 9271 may connect to a UFL sample liquid container, and also connects to inlet of a first pump tubing 504/505, which further connects to entities input line 6020 of UFL 600. Input line 9272 may connect to a UFL buffer container, and also connects to inlet of a second pump tubing 504/505, which further connects to buffer input line 6040 of UFL 600. UFL 600 large entities output line 6070 may connect to a large entities container. UFL 600 small entities output line 6090 may connect to a small entities container.

FIG. 60B illustrates fluidic lines of FIG. 60A being connected to, or attached with, various fluidic components. First and second pump tubing 504/505 is each installed into a peristaltic pump 500. The two pumps 500 operate to pump sample fluid and buffer fluid into UFL 600. A flow limiter 509/510 may be attached to the output line from each pump 500, including lines 6020 and 6040 to reduce flow rate pulsation from the pumps 500. Input line 9271 connects to a liquid sample container 928. Input line 9272 connects to UFL buffer container 931. UFL output line 6070 connects to large entities container 932. UFL output line 6090 connects to small entities container 933. Adjustable valves 939 and 938 may be attached to the lines 6070 and 6090 to adjust the flow rate within each line of 6070 and 6090, which in turn controls the laminar flow speed in UFL 600 channel for channel center buffer flow and channel edge entities sample flow. FIG. 60B shows containers 928, 931, 932 and 933 may be in the form of blood bags, but may also be in other physical forms of vial or bottles without limitation.

FIG. 61A illustrates replacing peristaltic pumps of FIG. 56B with using pressurized chambers 800 on input sample bags to drive fluid through fluidic lines. In FIG. 61A, pumps 500, pump tubing 504/505, and flow limiters 509/510 of FIG. 56B are removed. Channel 201 is connected directly to T-connector 921. Connector 801 is replaced with connector 803 bag. UFL entity liquid line 6020 is connected to connector 803. Sample liquid bag 928, MAG buffer bag 929, connector 803 bag and UFL buffer bag 931 are each enclosed in a pressure chamber 800. Pressure chamber 800 may operate by increasing pressure of chamber medium, for example air or other fluid, where the bags enclosed in chambers are submerged in the chamber medium. With increase of chamber medium pressure, liquid contained in the bags may be forced out of the bags and into the fluid lines. FIG. 61A operation may need separate MAG 123 and UFL 600 operations. At first stage, valve 941 attached to line 6020 closes. Pressure in chambers 800 enclosing bags 803 and 931 is released. Pressure in chambers 800 enclosing bags 928 and 929 are increased to force sample fluid or buffer fluid into channel 201 to start MAG 123 separation. After MAG 123 separation and sample fluid in bag 928 is depleted, bag 934 and connector 803 are each filled with output samples from MAG 123 after MAG separation. Then, at second stage, valve 937 is closed and valve 941 is open. Chambers 800 around connector 803 and bag 931 increase in pressure to force connector 803 sample and buffer fluid in 931 to flow into the UFL 600 to start UFL separation. After sample in connector 803 is depleted, and UFL 600 separation finish, bags 932 and 933 contain large and small entities from UFL output. Connector 803 maybe replaced by connector 8020 of FIG. 52 which has an air port 8023.

FIG. 61B illustrates replacing peristaltic pumps of FIG. 56B with using vacuum chambers 806 on output sample bags to drive fluid through fluidic lines. FIG. 61B is same as FIG. 61A, except pressure chambers 800 are removed. Bag 934, 932, 933, and connector 803 are each enclosed in a vacuum chamber 806. Vacuum chamber 806 may operate by increasing vacuum level within each chamber 806, where fluid from the fluid lines connected to the bags is forced into the bags enclosed in chambers due to fluid line pressure being larger than the vacuum pressure. FIG. 61B operation may also need separate MAG 123 and UFL 600 operations. At first stage, valve 941 attached to line 6020 closes. Vacuum in chambers 806 enclosing bags 932 and 933 is released. Vacuum in chambers 806 enclosing bags 934 and 803 are increased to force sample fluid or buffer fluid into channel 201 to start MAG 123 separation. After MAG 123 separation and sample fluid in bag 928 is depleted, bag 934 and connector 803 are each filled with output samples from MAG 123 after MAG separation. Then, at second stage, valve 937 is closed and valve 941 is open. Vacuum in chamber 806 around connector 803 is released. Vacuum in chambers 806 enclosing bags 932 and 933 are increased to force connector 803 sample and buffer fluid in 931 to flow into the UFL 600 to start UFL separation. After sample in connector 803 is depleted, and UFL 600 separation finish, bags 932 and 933 contain large and small entities from UFL output. Connector 803 maybe replaced by connector 8020 of FIG. 52 which has an air port 8023.

FIG. 62A illustrates replacing peristaltic pumps of FIG. 57B with using pressurized chambers 800 on input sample bags to drive fluid through fluidic lines. In FIG. 62A, pumps 500, pump tubing 504/505, and flow limiters 509/510 of FIG. 57B are removed. Channel 201 is connected directly to T-connector 921. Connector 801 is replaced with connector 803 bag. MAG sample line 923 is connected to connector 803. Sample liquid bag 928, MAG buffer bag 929, connector 803 bag and UFL buffer bag 931 are each enclosed in a pressure chamber 800. FIG. 62A may separate UFL 600 and MAG 123 operations. At first stage, valve 935 attached to line 923 closes. Pressure in chambers 800 enclosing bags 803 is released. Pressure in chambers 800 enclosing bags 928 and 931 are increased to force sample fluid and UFL buffer fluid into UFL 600 inlets to start UFL 600 separation. After UFL 600 separation and sample fluid in bag 928 is depleted, bag 933 contains small entities fluid and connector 803 contains large entities fluid from UFL 600 separation.

Then, at second stage, valve 939 is closed and valve 935 is open. Chambers 800 around connector 803 and bag 929 increase in pressure to force connector 803 large entities fluid sample or MAG buffer fluid in 929 to flow into channel 201 of MAG 123 to start MAG 123 separation. After sample in connector 803 is depleted, and MAG 123 separation finish, bags 934 and 9342 contain positive sample and negative sample from MAG 123 channel 201 output. Connector 803 maybe replaced by connector 8020 of FIG. 52.

FIG. 62B illustrates replacing peristaltic pumps of FIG. 57B with using vacuum chambers 806 on output sample bags to drive fluid through fluidic lines. FIG. 62B is same as FIG. 62A, except pressure chambers 800 are removed. Bag 934, 9342, 933, and connector 803 are each enclosed in a vacuum chamber 806. FIG. 62B operation may separate MAG 123 and UFL 600 operations. At first stage, valve 935 attached to line 923 closes. Vacuum in chambers 806 enclosing bags 933 and 803 are increased to force sample fluid and UFL buffer fluid into inlets of UFL 600 to start UFL 600 separation. After UFL 600 separation and sample fluid in bag 928 is depleted, bag 933 contains small entities fluid and connector 803 contains large entities fluid from UFL 600 separation. Then, at second stage, valves 938 and 939 are closed and valve 923 is open. Vacuum in chamber 806 around connector 803 is released. Vacuum in chambers 806 enclosing bags 934 and 9342 are increased to force connector 803 large entities sample or MAG buffer fluid in 929 to flow into channel 201 of MAG 123 to start MAG 123 separation. After sample in connector 803 is depleted, and MAG 123 separation finish, bags 934 and 9342 contain positive sample and negative sample from MAG 123 channel 201 output. Connector 803 maybe replaced by connector 8020 of FIG. 52.

FIG. 63A illustrates replacing peristaltic pumps of FIG. 58B with using pressurized chambers 800 on input sample bags to drive fluid through fluidic lines. FIG. 63A is identical to FIG. 62A in fluid line layout and in operation of UFL 600 and MAG 123 with chambers 800, except that the UFL large entities output 6070 connects to large entities container 932 in blood bag form, and small entities output 6090 connects to connector 803.

FIG. 63B illustrates replacing peristaltic pumps of FIG. 58B with using vacuum chambers 806 on output sample bags to drive fluid through fluidic lines. FIG. 63A is identical to FIG. 62B in fluid line layout and in operation of UFL 600 and MAG 123 with chambers 806, except that the UFL large entities output 6070 connects to large entities container 932 in blood bag form with small entities container 932 enclosed in vacuum chamber 806 replacing container 933 of FIG. 62B, and small entities output 6090 connects to connector 803.

FIG. 64A illustrates replacing peristaltic pumps of FIG. 59B with using pressurized chambers 800 on input sample bags 928 and 929 to drive fluid through channel 201 of MAG 123. In FIG. 64A, pump 500, pump tubing 504/505, and flow limiter 509/510 of FIG. 59B are removed. Channel 201 is connected directly to T-connector 921. Sample liquid bag 928 and MAG buffer bag 929 are each enclosed in a pressure chamber 800. Pressure in chambers 800 enclosing bags 928 and 929 are increased to force sample fluid or buffer fluid into channel 201 to start MAG 123 separation. After MAG 123 separation and sample fluid in bag 928 is depleted, bag 934 and bag 9342 are each filled with either negative entities or positive entities from MAG 123 after MAG separation.

FIG. 64B illustrates replacing peristaltic pumps of FIG. 59B with using vacuum chambers 806 on output sample bags 934 and 9342 to drive fluid through channel 201 of MAG 123. FIG. 64B is same as FIG. 64A, except pressure chambers 800 are removed. Output sample bags 934 and 9342 are each enclosed in a vacuum chamber 806. Vacuum in chambers 806 enclosing bags 934 and 9342 are increased to force entities sample from bag 928 or MAG buffer fluid from bag 929 to flow into channel 201 of MAG 123 to start MAG 123 separation. After sample in bag 928 is depleted, and MAG 123 separation finish, bags 934 and 9342 contain positive sample and negative sample from MAG 123 channel 201 output.

FIG. 65A illustrates replacing peristaltic pumps of FIG. 60B with using pressurized chambers 800 on sample liquid bag 928 and UFL buffer bag 931 to drive fluid through UFL 600. In FIG. 65A, pump 500, pump tubing 504/505, and flow limiter 509/510 of FIG. 60B are removed. Sample liquid bag 928 and UFL buffer bag 931 are each enclosed in a pressure chamber 800. Pressure in chambers 800 enclosing bags 928 and 931 are increased to force sample fluid and UFL buffer fluid into UFL 600 inlets to start UFL 600 separation. After UFL 600 separation, sample fluid in bag 928 is depleted, bag 932 contains large entities fluid and bag 933 contains small entities fluid.

FIG. 65B illustrates replacing peristaltic pumps of FIG. 60B with using vacuum chambers 906 on output sample bags 932 and 933 to drive fluid through UFL 600. FIG. 65B is same as FIG. 65A, except pressure chambers 800 are removed. Output sample bags 932 and 933 are each enclosed in a vacuum chamber 806. Vacuum in chambers 806 enclosing bags 932 and 933 are increased to force sample liquid from bag 928 and UFL buffer fluid from bag 931 to flow through UFL 600 to start UFL separation. After sample in bag 928 is depleted, and UFL 600 separation finish, bag 932 contains large entities fluid and bag 933 contains small entities fluid.

Structures, components, and methods as described from FIG. 55A through FIG. 65B on enclosed fluidic lines including one UFL 600 and one MAG 123, may be applied to FIG. 47 through FIG. 52 without limitation, where enclosed fluidic lines including multiple MAGs 123 and multiple UFLs 600 may be achieved with replicating the components on single UFL 600 and single MAG 123 from FIG. 55A through FIG. 65B on each of the UFLs 600 and MAGs 123 of FIG. 47 through FIG. 52.

FIG. 66 through FIG. 88 illustrate embodiments of process flows to utilize MAG and UFL devices to separate biological entities from various biological samples. For simplicity of description, terms UFL and MAG are used in these figures for explanation. However, UFL may be any of UFL 600, 650, 620, 630, 640 of FIG. 40A, FIG. 41A, FIG. 42A, FIG. 43, while MAG may be any of MAG 121, 122, 123, 124, 124,125, 126, 127, 128, 129 with corresponding channel types as described in prior figures without limitation and without sacrifice of performance. If a component, or a structure, in FIG. 66 through FIG. 88 shares same name as in prior figures, it then means the same component, or same structure as in prior figures.

FIG. 66 illustrates embodiment of a first process flow to separate biological entities from peripheral blood using UFL and MAG. In step 5801, peripheral blood sample is collected from a patient or person under test; in step 5802, red blood cell lysing may be performed on said peripheral blood sample, where step 5802 in another embodiment may be skipped; in step 5803, said blood sample from step 5802, or directly from step 5801, is injected in UFL entity fluid inlet 602, while UFL buffer fluid is injected in outlet 604; in step 5804, set frequency and vibration strength of PZT attached to UFL to produce standing wave and pressure nodes in UFL fluid; in step 5805, UFL outlet 607 outputs target sample that contains large size entities or cells; in step 5806, add into target sample from step 5805 magnetic labels hybridized with antibodies or ligands, which specifically bind to surface antigens or receptors on target cells or entities; in step 5807, target sample from step 5806 is incubated to form magnetic labels binding to target cells or entities; in step 5808, flow target sample from step 5807 through MAG channel at magnetic separation positon, where during step 5808, negative MAG sample may be forwarded as in 5815 to be collected in step 5813; in step 5809, target cells or entities bound with magnetic label are separated by MAG within the MAG channel; in step 5810, after step 5809, buffer fluid may be flown through MAG channel to wash out residue non-target entities without magnetic label, the washed out fluid may be forwarded as in 5816 to be collected as negative MAG sample in step 5813, where step 5810 may be skipped in another embodiment; in step 5811, after step 5810 or directly after step 5809, separated entities conglomerate in MAG channel may be dissociated into isolated cells or entities; in step 5812, buffer fluid is flown through MAG channel to washed out dissociated cells and entities in MAG channel, which, as shown by 5817, may be collected as positive MAG sample in step 5814.

Peripheral blood sample of FIG. 66 may also be other body fluids, including but not limited to: saliva, tear, mucus, urine, secretion from various organs of body.

FIG. 67 illustrates an embodiment of second process flow to separate biological entities from peripheral blood using MAG. Every other aspect of FIG. 67 is same as FIG. 66, except step 5803, step 5804, and step 5805 of FIG. 66 are removed between step 5802 and step 5806 in FIG. 67. While in FIG. 67, blood sample from step 5802, or blood sample directly from step 5801, is centrifuged in step 6201 to extract target sample containing white blood cells. Target sample form step 6201 is then sent to step 5806, from step 5806 FIG. 67 flow is same as in FIG. 66.

FIG. 68 illustrates an embodiment of third process flow to separate biological entities from peripheral blood using MAG. Every other aspect of FIG. 68 is same as FIG. 66, except step 5803, step 5804, and step 5805 of FIG. 66 are removed between step 5802 and step 5806 in FIG. 68. While in FIG. 68, peripheral blood sample collected from patient or person under test as in step 6301, which is same as step 5801 of FIG. 66, is regarded target sample. Target sample form step 5802 after red blood cell lysing after step 6301, or directly from step 6301, is then sent to step 5806. From step 5806, FIG. 68 flow is same as in FIG. 66.

FIG. 69 illustrates an embodiment of fourth process flow to separate biological entities from peripheral blood using MAG. Every other aspect of FIG. 69 is same as FIG. 66, except step 5801, step 5802, step 5803, step 5804, and step 5805 of FIG. 66 are removed before step 5806 in FIG. 69. While in FIG. 69, target sample is collected after apheresis of peripheral blood sample collected from patient or person under test. Target sample form step 6401 is then sent to step 5806. From step 5806, FIG. 69 flow is same as in FIG. 66.

FIG. 70 illustrates an embodiment of fifth process flow to separate biological entities from tissue sample using UFL and MAG. Every other aspect of FIG. 70 is same as FIG. 66, except step 5801, step 5802, and step 5803 are removed before step 5804 in FIG. 70. In FIG. 70, tissue sample is collected in step 6501. In step 6502, tissue sample from step 6501 is dissociated in a fluid base. In step 6503, dissociated tissue fluid of step 6502 is injected into UFL channel through inlet 602 and UFL buffer fluid is injected through inlet 604. From step 5804, FIG. 70 flow is same as in FIG. 66. Tissue sample of FIG. 70 may include any of: human body tissue aspirate, human organ tissue aspirate, bone marrow, animal body or organ tissue aspirate. Target cells or entities of FIG. 70 may be rare disease cells, for example cancer cells, or micro-organisms, for example bacteria.

FIG. 71 illustrates an embodiment of sixth process flow to separate biological entities from tissue sample using MAG. Every other aspect of FIG. 71 is same as FIG. 70, except step 6503, step 5804, and step 5805 are removed before step 5806 in FIG. 71. In FIG. 71, tissue sample from step 6501 is dissociated in a fluid base in step 6502 to form target sample, and continues process in step 5806. From step 5806, FIG. 71 flow is same as in FIG. 70.

FIG. 72 illustrates an embodiment of seventh process flow to separate biological entities from surface swab sample using UFL and MAG. Every other aspect of FIG. 72 is same as FIG. 66, except step 5801, step 5802, and step 5803 are removed before step 5804 in FIG. 72. In FIG.

72, surface entities are collected in step 6701 by swab. In step 6702, surface entities collected on swab are dissolved in a fluid base. In step 6703, fluid base with dissolved surface entities from step 6702 is injected into UFL channel through inlet 602 and UFL buffer fluid is injected through inlet 604. From step 5804, FIG. 72 flow is same as in FIG. 66. Surface entities of FIG. 72 may be collected by swab from subjects including any of: human body, saliva, body fluid, human body discharge, animal, plant, soil, air, water, and merchandise. Target cells or entities of FIG. 72 may include cells from human body, or animal body, or plant, or include micro-organisms, for example bacteria, mold, or spores.

FIG. 73 illustrates an embodiment of eighth process flow to separate biological entities from surface swab sample using MAG. Every other aspect of FIG. 73 is same as FIG. 72, except step 6703, step 5804, and step 5805 are removed before step 5806 in FIG. 73. In FIG. 73, surface entities collected on swab in step 6701 are dissolved in a fluid base in step 6702 to form target sample, and continues process in step 5806. From step 5806, FIG. 73 flow is same as in FIG. 72.

FIG. 74 illustrates an embodiment of ninth process flow to separate biological entities from solid sample using UFL and MAG. Every other aspect of FIG. 74 is same as FIG. 66, except step 5801, step 5802, and step 5803 are removed before step 5804 in FIG. 74. In FIG. 74, solid sample is collected in step 6901. In step 6902, solid sample from step 6901 is dissociated in a fluid base. In step 6903, dissociated solid sample fluid of step 6902 is injected into UFL channel through inlet 602 and UFL buffer fluid is injected through inlet 604. From step 5804, FIG. 74 flow is same as in FIG. 66. Tissue sample of FIG. 70 may include any of: solid biological products or waste generated by human, animal, or plant, powder, and soil. Target cells or entities of FIG. 74 may include cells from human body, or animal body, or plant, or include micro-organisms, for example bacteria, mold, or spores.

FIG. 75 illustrates an embodiment of tenth process flow to separate biological entities from solid sample using MAG. Every other aspect of FIG. 75 is same as FIG. 74, except step 6903, step 5804, and step 5805 are removed before step 5806 in FIG. 75. In FIG. 75, solid sample from step 6901 is dissociated in a fluid base in step 6902 to form target sample, and target sample is continuously processed in step 5806. From step 5806, FIG. 75 flow is same as in FIG. 74.

FIG. 76A illustrates addition of both magnetic and fluorescent labels into fluid samples for specific binding to target cells or entities. FIG. 76A shows that step 5806 of FIG. 66 through FIG. 75 may be modified to step 58061, where in addition to magnetic labels, fluorescent labels hybridized with antibodies or ligands, which specifically bind to surface antigens or receptors on target cells or entities, may also be added in target sample from step 5805.

FIG. 76B then illustrates that incubation step 5807 of FIG. 66 through FIG. 75 may also be modified to step 58071, which includes incubation of both magnetic and fluorescent labels at the same time to form specific binding to target cells or entities. Binding sites of magnetic labels and fluorescent labels on same target cells or entities may be different.

Steps 5806 and step 58061 may be realized in a flow connector including any one of 801, 802, 803, 8010, 8020, 8030 of prior figures, where flow connector may contain pre-filled hybridized magnetic labels and fluorescent labels in liquid solution, or in dry powder form. Step 5807 and step 58071 may also occur in said flow connector, where said flow connector may also be located in a temperature control chamber to control incubation speed and quality. In another embodiment, said flow connector may have attached or embedded temperature control circuit to control incubation in flow connector.

FIG. 77A illustrates process of removing non-bound free magnetic labels from sample fluid by UFL before magnetic separation by MAG. FIG. 77A shows that for each of FIG. 66 through FIG. 75, step 5818 and step 5819 may be added between step 5807 and step 5808. After target sample is incubated in step 5807, in step 5818, target sample may be injected into second UFL through inlet 602, and buffer fluid may be injected into second UFL through inlet 604. In step 5819, second UFL outputs target sample containing large entities from outlet 607, and non-bound free magnetic labels are output from second UFL outlet 609. Then in step 5808, target sample containing large entities from second UFL outlet 607 is passed through MAG channel for magnetic separation. Target sample in step 5819 may contain cells 10/30 or entities bound with magnetic labels. Second UFL having an attached PZT that operates with a specified ultrasound vibration amplitude and frequency to create standing wave in second UFL channel fluid is assumed in step 5819.

FIG. 77B illustrates process of removing non-bound free magnetic labels from sample fluid by UFL after magnetic separation by MAG. FIG. 77B shows that for each of FIG. 66 through FIG. 75, step 5820 and step 5821 may be added between step 5812 and step 5814, replacing path 5817. After magnetic conglomerate within MAG channel is dissociated and the positive MAG sample entities from MAG channel are flushed out as in step 5812, flushed out positive MAG sample may be injected into third UFL through inlet 602, and buffer fluid may be injected into third UFL through inlet 604. In step 5821, third UFL outputs positive MAG sample containing large entities from outlet 607, and non-bound free magnetic labels are output from third UFL outlet 609. Then in step 5814, positive MAG sample with reduced or depleted free magnetic labels may be collected. Third UFL having an attached PZT that operates with a specified ultrasound vibration amplitude and frequency to create standing wave in third UFL channel fluid is assumed in step 5821.

FIG. 78A illustrates process of removing non-bound free magnetic labels and free fluorescent labels from sample fluid by UFL before magnetic separation by MAG. FIG. 78A is similar as FIG. 77A, with replacing step 5807 of FIG. 77A with step 58071 of FIG. 76B, and replacing step 5819 with step 58191. After adding magnetic labels and fluorescent labels into target sample as in step 58061 of FIG. 76A, target sample is incubated in step 58071 same as in FIG. 76B to form magnetic label and fluorescent label binding to target cells or entities. In step 5818, target sample may be injected into second UFL through inlet 602, and buffer fluid may be injected into second UFL through inlet 604. In step 58191, second UFL outputs target sample containing large entities from outlet 607, and non-bound free magnetic labels and free fluorescent labels are output from second UFL outlet 609. Then in step 5808, target sample containing large entities from second UFL outlet 607 is flown through MAG channel for magnetic separation. Target sample in step 58191 may contain cells 30 or entities bound with magnetic and fluorescent labels. Second UFL having an attached PZT that operates with a specified ultrasound vibration amplitude and frequency to create standing wave in second UFL channel fluid is assumed in step 58191.

FIG. 78B illustrates process of removing non-bound free magnetic labels and free fluorescent labels from sample fluid by UFL after magnetic separation by MAG. FIG. 78B is similar as FIG. 77B, with replacing step 5821 of FIG. 77A with step 58211. Separated entities in step 5812 and step 5820 of FIG. 78B may contain: cells 30 or entities bound with magnetic and fluorescent labels, non-bound free magnetic labels, and small amount of non-bound free fluorescent labels due to non-specific binding to conglomerate in MAG channel during magnetic separation. In step 58212, third UFL outputs positive MAG sample containing large entities from outlet 607, and non-bound free magnetic and free optical labels are output from third UFL outlet 609. Then in step 5814, positive MAG sample with reduced or depleted free magnetic labels and free fluorescent labels may be collected. Third UFL having an attached PZT that operates with a specified ultrasound vibration amplitude and frequency to create standing wave in third UFL channel fluid is assumed in step 58212.

FIG. 79 illustrates continued process of negative MAG sample after MAG separation, as in step 408 of FIG. 31, through UFL to remove small entities and passing of large entities into various cell processing devices and procedures. Step 5813 is same as in FIG. 66 through FIG. 75, where negative MAG sample is collected during MAG separation of a target sample. In step 5822, negative MAG sample of step 5813 is injected into fourth UFL inlet 602, and UFL buffer is injected into inlet 604 of fourth UFL. In step 5823, fourth UFL outputs negative MAG sample containing large entities from outlet 607, and small size entities are removed from large entities and output from fourth UFL outlet 609, a PZT that attaches to fourth UFL and operates with a specified ultrasound vibration amplitude and frequency to create standing wave in fourth UFL is assumed. Finally, negative MAG sample containing large entities from outlet 607 of fourth UFL may be sent to be analyzed by any of: cell counter 903, cell imager 904, flow cytometer or sorter 905, DNA/RNA sequencer 906. Alternatively, output from cell counter 903, or output from cell imager 904, or output from flow cytometer or sorter 905, may be further sent to be processed by DNA/RNA sequencer 906 as indicated respectively by path 936, 946, and 956. Negative MAG sample containing large entities from outlet 607 of fourth UFL in step 5823 may also be sent into the process of cell genetic modification and/or cell expansion 5824. Prior to DNA/RNA sequencing in DNA/RNA sequencer 906, a polymerase chain reaction (PCR) procedure on DNA/RNA sample obtained from cell lysing of large size entities from outlet 607 of fourth UFL from step 5823 may be performed, where PCR may be targeting one or more target DNA/RNA sequences and amplifies the number of target DNA/RNA sequences in the DNA/RNA sample.

FIG. 80 illustrates continued process of negative MAG sample after MAG separation, as in step 408 of FIG. 31, through UFL to retrieve small entities and passing of small entities into various molecule or small entity processing devices. After step 5813 of FIG. 66 through FIG. 75, where negative MAG sample is collected during MAG separation of a target sample, in step 5822, negative MAG sample of step 5813 is injected into fourth UFL inlet 602, and UFL buffer is injected into inlet 604 of fourth UFL. In step 5825, fourth UFL outputs negative MAG sample containing large entities from outlet 607, and small size entities including DNA, RNA, molecules, and other small particles are output from fourth UFL outlet 609, a PZT that attaches to fourth UFL and operates with a specified ultrasound vibration amplitude and frequency to create standing wave in fourth UFL is assumed. Finally, small size entities from outlet 609 of fourth UFL may be sent to be analyzed by any of: particle counter 5835, particle imager 5836, flow cytometer or sorter 905, DNA/RNA sequencer 906. Alternatively, output from particle counter 5835, or output from particle imager 5836, or output from flow cytometer or sorter 905, may be further sent to be processed by DNA/RNA sequencer 906 as indicated respectively by path 5827, 5828, and 956. DNA/RNA sequencer 906 may contain a PCR step on small size entities from outlet 609 of fourth UFL from step 5825 prior to DNA/RNA sequencing, where PCR may target one or more particular DNA/RNA sequences to amplify in quantity.

FIG. 81 illustrates entities analysis of negative MAG sample after MAG separation, as in step 407 of FIG. 31, into various analyzing devices. After step 5813 of FIG. 66 through FIG. 75, where negative MAG sample is collected during MAG separation of a target sample, collected negative MAG sample may be sent to be analyzed by any of: cell counter 903, cell imager 904, flow cytometer or sorter 905, particle counter 5835, particle imager 5836, DNA/RNA sequencer 906. Alternatively, output from cell counter 903, or output from cell imager 904, or output from flow cytometer or sorter 905, or output from particle counter 5835, or output from particle imager 5836, may be further sent to be processed by DNA/RNA sequencer 906 as indicated respectively by path 936, 946, 956, 5827, and 5828. Negative MAG sample may also be sent into the process of cell genetic modification and/or cell expansion 5824. DNA/RNA sequencer 906 may contain a PCR step on: (1) DNA/RNA obtained after cell lysing of cells contained within negative MAG sample; and (2) DNA/RNA/molecules contained within negative MAG sample. Prior to DNA/RNA sequencing, PCR may target one or more particular DNA/RNA sequences to amplify in quantity.

FIG. 82 illustrates continued process of positive MAG sample after MAG separation, as in step 408 of FIG. 31, through UFL to remove small entities and passing of large entities into various cell processing devices and procedures. Step 5814 is same as in FIG. 66 through FIG. 75, where positive MAG sample is collected after MAG separation of a target sample. In step 5829, positive MAG sample of step 5814 is injected into fifth UFL inlet 602, and UFL buffer is injected into inlet 604 of fifth UFL. In step 5830, fifth UFL outputs positive MAG sample containing large entities from outlet 607, and small size entities are removed from large entities and output from fifth UFL outlet 609, a PZT that attaches to fourth UFL and operates with a specified ultrasound vibration amplitude and frequency to create standing wave in fifth UFL is assumed. Finally, positive MAG sample containing large entities from outlet 607 of fifth UFL may be sent to be analyzed by any of: cell counter 903, cell imager 904, flow cytometer or sorter 905, DNA/RNA sequencer 906. Alternatively, output from cell counter 903, or output from cell imager 904, or output from flow cytometer or sorter 905, may be further sent to be processed by DNA/RNA sequencer 906 as indicated respectively by path 936, 946, and 956. Positive MAG sample containing large entities from outlet 607 of fifth UFL in step 5830 may also be sent into the process of cell genetic modification and/or cell expansion 5824. DNA/RNA sequencer 906 may contain a PCR step on DNA/RNA obtained after cell lysing of large size entities from outlet 607 of fifth UFL from step 5830 prior to DNA/RNA sequencing, where PCR may target one or more particular DNA/RNA sequences to amplify in quantity.

FIG. 83 illustrates continued process of positive MAG sample after MAG separation, as in step 408 of FIG. 31, through UFL to retrieve small entities and passing of small entities into various molecule or small entity processing devices. After step 5814 of FIG. 66 through FIG. 75, where positive MAG sample is collected after MAG separation of a target sample, in step 5829, positive MAG sample of step 5814 is injected into fifth UFL inlet 602, and UFL buffer is injected into inlet 604 of fifth UFL. In step 5831, fifth UFL outputs positive MAG sample containing large entities from outlet 607, and small size entities including DNA, RNA, molecules, and other small particles bound by magnetic labels are output from fifth UFL outlet 609, a PZT that attaches to fifth UFL and operates with a specified ultrasound vibration amplitude and frequency to create standing wave in fifth UFL is assumed. Finally, small size entities from outlet 609 of fifth UFL may be sent to any of: particle counter 5835, particle imager 5836, flow cytometer or sorter 905, DNA/RNA sequencer 906. Alternatively, output from particle counter 5835, or output from particle imager 5836, or output from flow cytometer or sorter 905, may be further sent to be processed by DNA/RNA sequencer 906 as indicated respectively by path 5827, 5828, and 956. DNA/RNA sequencer 906 may contain a PCR step on small size entities from outlet 609 of fifth UFL from step 5831 prior to DNA/RNA sequencing, where PCR may target one or more particular DNA/RNA sequences to amplify in quantity.

FIG. 84 illustrates entities analysis of positive MAG sample after MAG separation, as in step 407 of FIG. 31, into various analyzing devices. After step 5814 of FIG. 66 through FIG. 75, where positive MAG sample is collected after MAG separation of a target sample, collected positive MAG sample may be sent to be analyzed by any of: cell counter 903, cell imager 904, flow cytometer or sorter 905, particle counter 5835, particle imager 5836, DNA/RNA sequencer 906. Alternatively, output from cell counter 903, or output from cell imager 904, or output from flow cytometer or sorter 905, or output from particle counter 5835, or output from particle imager 5836, may be further sent to be processed by DNA/RNA sequencer 906 as indicated respectively by path 936, 946, 956, 5827, and 5828. Positive MAG sample may also be sent into the process of cell genetic modification and/or cell expansion 5824. DNA/RNA sequencer 906 may contain a PCR step on: (1) DNA/RNA obtained after cell lysing of cells contained within positive MAG sample; and (2) DNA/RNA/molecules contained within positive MAG sample, prior to DNA/RNA sequencing, where PCR may target one or more particular DNA/RNA sequences to amplify in quantity.

FIG. 85A illustrates adding fluorescent labels to specifically bind to target entities within negative MAG sample immediately after negative MAG sample collection. FIG. 85A shows that in step 58131, immediately after step 5813, where negative MAG sample is collected during MAG separation, fluorescent labels which are hybridized with antibodies or ligands, and specifically bind to surface antigens or receptors on target cells or entities are added into the negative MAG sample, and then negative MAG sample is incubated to form fluorescent labels binding to target cells or entities. Step 58131 may be inserted in FIG. 79 and FIG. 80 between step 5813 and step 5822, or inserted in FIG. 81 immediately after step 5813 and before devices or processes 903, 904, 905, 906, 5824, 5825, and 5826.

FIG. 85B illustrates adding fluorescent labels to specifically bind to target entities within positive MAG sample immediately after positive MAG sample collection. FIG. 85B shows that in step 58141, immediately after step 5814, where positive MAG sample is collected after MAG separation, fluorescent labels which are hybridized with antibodies or ligands, and specifically bind to surface antigens or receptors on target cells or entities are added into the positive MAG sample, and then positive MAG sample is incubated to form fluorescent labels binding to target cells or entities. Step 58141 may be inserted in FIG. 82 and FIG. 82 between step 5814 and step 5829, or inserted in FIG. 84 immediately after step 5814 and before devices or processes 903, 904, 905, 906, 5824, 5825, and 5826.

FIG. 86 illustrates cross-sectional view of the tenth embodiment of MAG 1241. FIG. 86 MAG 1241 is same design as FIG. 12 MAG 124 with variations from FIG. 12 MAG 123. FIG. 86 MAG 1231 is different from FIG. 12 MAG 123 with the flux collection ends 11211 and 11311 being flat to mainly function collect flux emitted from center pole 111 tip end 1111 to form magnetic flux closure within the main pole 111, side poles 1120 and 1130, and bottom shield 114. With flux collection end 11211 and 11311 being flat, highest magnetic field and highest magnetic field gradient are at the proximity to main pole 111 tip end 1111, and thus facilitating biological entities 10/30 moving towards the tip end 1111 in the channel 301. In FIG. 86 embodiment, flux collection ends 11211 and 11311 may also be described as soft magnetic shields of the main pole 111 tip end 1111, where the soft shields 11211 and 11311 may help confine the magnetic flux within the gaps between tip end 1111 and shields 11211 and 11311, as well as may increase effective magnetic force exerted on the biological entities 10/30 in channel 301 towards the tip end 1111. In FIG. 86, soft shields 11211 and 11311 flat ends being parallel to each other and form a physical space with the tip end 1111, i.e. MAG gap of MAG 1241, whereas the channel 301 is aligned by the soft shields 11211 and 11311 to be in contact with tip end 1111 at the bottom of the channel 301. In FIG. 86, the magnetic flux generated by N and S surface of magnet 109 is conducted within bodies of poles 111,1121, 1131 and shield 114 with minimal leakage to outside of MAG 1241 structure. Flux density is highest around tip end 1111 with soft shields 11211 and 11311 producing lower flux density, enabling high magnetic field and field gradient around tip end 1111. Compared to MAG 121, 122, 123, 124, MAG 1241 has the advantage of more efficient flux closure within the MAG 1241 soft magnetic bodies with least flux leakage and thus highest flux density around tip end 1111 to produce high magnetic force on biological entities 10/30 in channel 301.

Channel 301 of FIG. 86 is a rigid channel same as channel 301 of FIG. 12. Channel 301 may be attached to a non-magnetic channel holder 110 at the top surface 3012. Channel holder 110 may align channel 201 to MAG gap of MAG 1241, move channel 301 to separation position in contact with MAG 1241 pole 111 tip end 1111, or lift channel 301 away from MAG 1241 after magnetic separation. FIG. 301 may be replaced with soft channel 201 of FIG. 13 and FIG. 14 and operate with MAG 1241 of FIG. 86 similarly as with MAG 124 in FIG. 13 and FIG. 14.

FIG. 87A illustrates cross-sectional view of the eleventh embodiment MAG 1251. MAG 1251 is same as MAG 1241 of FIG. 86, except the magnet 109 and bottom shield 114 of MAG 1241 of FIG. 86 are removed in MAG 1251. Permanent magnets 115 and 116 with opposing magnetizations 1151 and 1161 are placed in between poles 111 and 1121, and between poles 111 and 1131, respectively as shown in FIG. 87A. Magnetizations 1151 and 1161 are horizontal in FIG. 87A, which enables center pole 111 conducting N surface flux from both magnets 115 and 116, while side poles 1120 and 1130 each conducts S surface flux from magnet 115 and 116 respectively. Compared to MAG 1241, MAG 1251 may produce higher field around tip end 1111 due to two magnets 115 and 116 are used.

FIG. 87B illustrates cross-sectional view of the twelfth embodiment MAG 1261. MAG 1261 is same as MAG 1241 of FIG. 86, except the side poles 1120 and 1130 are each attached to S surface of permanent magnets 1092 and 1094 respectively, with magnetizations 1093 and 1095 being opposite to magnetization 1091 of magnet 109. Bottom shield 114 is attached to both N surface of magnet 1092 and 1094, and S surface of magnet 109, and thus forming internal flux closure in shield 114 between magnets 109, 1092 and 1094. Compared to MAG 1241, MAG 1261 may produce higher field around tip end 1111 due to three magnets 109, 1092 and 1092 are used in MAG 1261.

FIG. 87C illustrates cross-sectional view of the thirteenth embodiment MAG 1271. MAG 1271 is same as MAG 1261 of FIG. 87B, except the bottom shield 114 is removed.

FIG. 88A illustrates cross-sectional view of the fourteenth embodiment MAG 1242. MAG 1242 is same as MAG 1241 of FIG. 86, except that the side shield surface 11212 and 11312 are not parallel to each other, but rather side shield surface 11212 is substantially parallel to main pole 111 tip slope 11112 and side shield surface 11213 is substantially parallel to main pole 111 tip slope 11113, where tip slopes 11112 and 11113 meet to form tip end 1111. MAG gap formed by tip end 1111, side shield surfaces 11212 and 11312, of FIG. 88A may produce higher flux concentration at tip end 1111 and higher effective magnetic force on biological entities 10/30 in channel 301/201 when channel 301/201 may be in contact with tip end 1111. In FIG. 88A, channel 301/201 may be in contact with main pole tip end 1111 of MAG 1242, or may be in close proximity to but not in contact with main pole tip end 1111.

FIG. 88B illustrates cross-sectional view of the fifteenth embodiment MAG 1243. MAG 1243 is same as MAG 1242 of FIG. 88A, except that the tip end 1111 of FIG. 88A is replaced with a flatten tip 11114 in FIG. 88B. MAG gap formed by flat tip end 11114, side shield surfaces 11212 and 11312, of FIG. 88B may avoid flat tip end 11114 flux saturation of main pole 111 to maximize the high magnetic field effective region within channel 301/201 when channel 301/201 may be in contact with tip end 11114, and thus increase effective magnetic force exerted on biological entities 10/30 in channel 301/201. The flat tip end of FIG. 88B may also be used to replace the tip end 1111 of main pole 111 of MAG embodiments in FIG. 12 through FIG. 15C, FIG. 18, FIG. 19, and FIG. 86 through FIG. 87C. In FIG. 88B, channel 301/201 may be in contact with main pole tip end 11114 of MAG 1243, or may be in close proximity to but not in contact with main pole tip end 11114.

FIG. 88C illustrates cross-sectional view of the sixteenth embodiment MAG 1244. MAG 1244 is same as MAG 1242 of FIG. 88A, except that the side shield surface 11214 and 11314 in FIG. 88C are positioned above main pole tip 1111, with each of side shield surface 11214 and 11314 being substantially a slope tilted in direction towards main pole tip 1111 to form a funnel shape that has a smaller opening between surface 11214 and 11314 when being closer to main pole tip 1111. Tip ends of side shield surface 11214 and 11314 may be above main pole tip end 1111. Tip ends of side shield surface 11214 and 11314 and main pole tip end 1111 may also be positioned within a horizontal plane. FIG. 88C side shield surface 11214 and 11314 arrangement may help produce high magnetic field and high magnetic field gradient in channel 301/201 and thus a higher effective magnetic force on biological entities 10/30 in channel 301/201 when channel 301/201 is in contact with tips ends of surface 11214 and 11314, and may be in contact with, or in close proximity to, tip end 1111 of MAG 1244. FIG. 88C side shield surface 11214 and 11314 arrangement may also help alignment of channel 301/201 to main pole tip end 1111 during positioning of channel 301/201 towards main pole tip end 1111. In FIG. 88C, channel 301/201 may be in contact with main pole tip end 1111 of MAG 1244, or may be in close proximity to but not in contact with main pole tip end 1111.

FIG. 86 through FIG. 88C are cross-sectional views of different embodiments of MAG designs, whereas the MAG designs extend in the direction that is into, or out of, the cross-sectional views. MAG tenth embodiment through fifteenth embodiment of FIG. 86 through FIG. 88C are similar to MAG first embodiment through ninth embodiment as illustrated prior figures, whereas soft shields 11211, 11311, 11212, 11312, 11213, 11313, tip end 1111, tip top 11114, and channel 101/201/301 that may be in contact with, or may be in close proximity to, tip end 1111 or tip top 11114, extend in direction of 62 as shown in FIG. 32 and being parallel to each other. Attachment of permanent magnets 115, 116, 1092, 109, 1094 to main pole 111, side poles 1120 and 1130 as in FIG. 87A, FIG. 87B, or FIG. 87C may be applied to each of FIG. 88A, FIG. 88B, and FIG. 88C.

FIG. 89A illustrates a cross-sectional view of channel 301/201/101, similar to FIG. 27B, where after magnetic separation of biological entities 10/30 in channel 301/201/101, channel 301/201/101 is lifted from MAG gap of MAG embodiments in FIG. 4 through FIG. 21C, and FIG. 86 through FIG. 88B, to a lower field Position 22 by holder 1082.

FIG. 89B illustrates that at Position 22 of FIG. 89A, dissociation of cells 10/30 in channel 301/201/101 may be achieved by using a second channel holder 1301 that comes to contact channel 301/201/101, where motor 130 is mechanically coupled to channel holder 1301 to produce mechanical vibration to channel holder 1301, and where said mechanical vibration from motor 130 may then transfer through channel holder 1301 to channel 301/201/101 that is in contact with channel holder 1301 and may cause localized turbulence flow at various locations within the channel 301/201/101, which may help mechanically break up the conglomerate into small pieces to assist self-dissociation of cells 10/30 conglomerate. In one embodiment, channel holder 1301 may push channel 301/201/101 and move channel 301/201/101 away from channel holder 1082 during dissociation of cells 10/30. Direction of vibration exerted upon channel 301/201/101 through channel holder 1301 may be in direction 61001, or in direction 61002, or alternating between directions 61001 and 61002. Channel holder 1301 may be in a shape that has a thinner handle connecting to motor 130 and a wider holder arm1302 being in contact with channel 301/201/101 for effective vibration transfer from motor 130 to channel 301/201/101. Channel holder 1301 length in the direction into or out of the cross-sectional view of FIG. 89B may be much shorter than channel holder 1082. Channel holder 1301 may come into contact with channel 301/201/101 through existing clearances in channel holder 1082 without physical contact with channel holder 1082.

FIG. 89C illustrates that at Position 22 of FIG. 89A, dissociation of cells 10/30 in channel 301/201/101 may be achieved by using a vibrator arm 1303 to contact channel holder 1082. Motor 130 is mechanically coupled to vibrator arm 1303 to produce mechanical vibration to vibrator arm 1303. Said mechanical vibration from motor 130 may then transfer through vibrator arm 1303 to channel holder 1082 and then to channel 301/201/101 that is in contact with channel holder 1082 and may cause localized turbulence flow at various locations within the channel 301/201/101, which may help mechanically break up the conglomerate into small pieces to assist self-dissociation of cells 10/30 conglomerate. Direction of vibration exerted upon channel 301/201/101 through channel holder 1082 may be in direction 61001, or in direction 61002, or alternating between directions 61001 and 61002. Vibrator arm 1303 may be in a fork shape that has a thinner handle connecting to motor 130 and a wider vibrator end 1304 being in contact with channel holder 1082 for effective vibration transfer from motor 130 to channel holder 1082. Vibrator end 1304 may have a locking mechanism that mechanically locks onto channel holder 1082 to produce effective vibration transfer.

Channels 101, 201, 301 of FIG. 4 though FIG. 7, FIG. 9 though FIG. 14, FIG. 16 though FIG. 30B, FIG. 32 though FIG. 36B, FIG. 44A though FIG. 65B, FIG. 86 though FIG. 89C, may each have a channel wall thickness in the range of any of: 0.01 mm to 0.02 mm, 0.02 mm to 0.05 mm, 0.05 mm to 0.1 mm, 0.1 mm to 0.2 mm, 0.2 mm to 0.3 mm, 0.3 mm to 0.4 mm, 0.4 mm to 0.5 mm, 0.5 mm to 1 mm, 1 mm to 2 mm, and 2 mm to 5 mm.

FIG. 90A is a cross-sectional view of a portion of the FIG. 38A UFL 600 along direction 64, which includes entity fluid inlet 602, buffer fluid inlet 604, and part of the UFL main channel 601. FIG. 90A illustrates UFL 600 is compose of two components, substrate 611 and cover 610, where channels 601, 603 and 608 are formed in substrate 611 as trenches of same depth 627 and preferably formed in a single step from as first surface of the substrate 611. In one embodiment, depth 627 is between 100 nm to 500 nm. In another embodiment, depth 627 is between 500 nm to 1 um. In yet another embodiment, depth 627 is between 1 um to 10 um. In yet another embodiment, depth 627 is between 10 um to 100 um. In yet another embodiment, depth 627 is between 100 um to 1 mm. Different from FIG. 38B embodiment, access ports for injecting fluid into the inlets 602 and 604, and access ports for exporting fluid from the outlets 607 and 608 are formed in substrate 611 as single clearances as the inlets 602, 604 and outlets 607 and 608, enabling fluid injection or export from a second surface of the substrate 611, opposing the first surface where channels 601, 603 and 608 are formed. FIG. 90A shows example of access port 621 and inlet 602 are formed as a single clearance connecting from bottom second surface of substrate 611 to the channel 603 formed from top first surface of substrate 611, while access port 641 and inlet 604 are formed as a single clearance connecting from bottom second surface of substrate 611 to the main channel 601 formed from top first surface of substrate 611. In FIG. 90A, different from FIG. 38B, cover 610 is a uniform cover without clearance features. Access ports in substrate 611, which are also inlets and outlets of UFL 600, allow entities fluid 6020 and buffer fluid 6040 to enter inlets 602 and 604, and to allow large entities 6070 fluid and small entities 6090 fluid to exit outlets 607 and 609. In FIG. 90A embodiment, alignment of access ports to inlets and outlets as in FIG. 38B is avoided. During manufacture of the UFL 600, after substrate 611 are patterned on top first surface with the trenches 601, 603, 608, clearances at locations of inlets 602, 604 and outlets 607, 609 may be formed through substrate 611 to connect from trenches to the bottom second surface. Cover 610 as a uniform piece may then be positioned over the substrate 611 top first surface to form enclosed channels 601, 603 and 608, where cover 610 may bond to substrate 611 through any of: (1) surface to surface Van der Waals force; (2) gluing; (3) ultrasound thermal melting when one or both of substrate 611 and cover 610 being made of plastic or polymer material. Injectors 6021 and 6041 then show example of possible external fluid injection to inlets of UFL 600 through substrate 611 access ports clearance, where the injectors 6021 and 6041 may have a larger nozzles size than the matching access ports 621 and 641 for managing positioning errors between injectors and access ports. FIG. 90A shows that entities fluid 6020 containing large entities 612 and small entities 613, which may be injected by injector 6021, passing through assess port 621/602 and passing into main channel 601 as side laminar flows, while buffer fluid 6040 may be injected by injector 6041, passing through assess port 641/604 and passing into main channel 601 as center laminar flow.

Substrate 611 and cover 610 of FIG. 90A may be each composed of any of: glass, silicon, quartz, aluminum-titanium-carbon (AlTiC), SiC, SiN, silicon-oxide, alumina, plastic, PDMS, polymer, ceramic, or metal, where metal may be composed any one or any alloy of aluminum, iron, nickel, titanium, chromium, platinum, tungsten, rhenium, copper, gold, silver. Cover 610 may be composed of different material than substrate 611.

In one embodiment, forming of access ports, inlets, outlets and channels in substrate 611 includes the steps of: (1) providing a substrate 611 having two substantially flat surface; (2) forming channels etching mask over first flat surface; (3) etching substrate with a first etching method including: wet etch with fluid chemical, dry etch with chemical gas, plasma enhanced dry etch, sputter etch with ion plasma, and ion beam etch (IBE), to form channels into substrate; (4) forming inlets and outlets etching mask over second flat surface of substrate opposing first flat surface; (5) etching substrate with said first etching method to form inlets and outlets in substrate connecting from second flat surface through substrate to the channels formed in step (3). In forming of etch mask of step (2) and step (4), etch mask may be composed of photo resist (PR), which may include deposition or spin coating of PR on said flat surface, then exposure by optical or ion/electron radiation with patterns of channels; development of PR after said exposure, where remaining PR with said patterns serves as etch mask. Etch mask may also be made of a hard mask material that has lower etch rate than the substrate material under the first etching method, and step (2) and step (4) may each include: deposition of a hard mask layer on said flat surface; deposition or spin coating PR layer on hard mask layer, then exposure of said PR by optical or ion/electron radiation with patterns of inlets, outlets and channels, development of PR after said optical exposure, where remaining PR with said pattern serves as etching mask of said hard mask; hard mask is etched through with a second etch method including any of: wet etch with fluid chemical, dry etch with chemical gas, plasma enhanced dry etch, sputter etch with ion beam; removal of remaining PR layer. Second etch method and first etch method may be different in type, or different in chemistry.

In another embodiment, inlets, outlets and channels in substrate 611 may be formed by thermal press involving using a heated stencil with physical pattern of the inlets, outlets and channels to melt and deform part of substrate 611 to construct the inlets, outlets and channels, then cooling down substrate 611 and remove the stencil. In thermal press, substrate material is preferred to be plastic or polymer. In yet another embodiment, inlets, outlets and channels in substrate 611 may be formed by imprint, which involves using a stencil with physical pattern of the inlets, outlets and channels to imprint into a partially or completely melt substrate 611, and then cooling the substrate 611 and finally removing stencil, where cooled substrate retains the pattern transferred from stencil of the inlets, outlets and channels. In imprint, substrate material is preferred to be plastic or polymer. In another embodiment, inlets, outlets and channels are formed in substrate 611 by injection molding, where melted substrate 611 materials are injected into a mold cavity where substrate 611 body with engraved inlets, outlet and channels are defined by the mold cavity.

FIG. 90B is a cross-section view along direction 65 of FIG. 38A for part of the UFL 600 including main channel 601, substrate 611, cover 610. FIG. 90B embodiment functions same as FIG. 38C, except PZT 614 is attached to the cover 610 and ultrasound vibration from PZT 614 is transferred into the ULF 600 channel 601 through cover 610. In FIG. 90B, cover 601 thickness 6101 is preferred to be equal or less than the thickness 6111 of the substrate 611. In one embodiment, thickness 6101 is less than the thickness 6111 subtracting channel 601 depth 627. Cover 610 thickness 6101 may be any one of: between 1 mm to 2 mm, between 0.5 mm to 1 mm, between 0.2 mm to 0.5 mm, between 0.1 mm to 0.2 mm.

FIG. 90C illustrates top-down view FIG. 38A UFL 600 with multiple PZTs attached to same UFL 600 device. Two or more of PZTs 6141, 6142, 6143, 6144 are attached to UFL 600 at different locations along the main channel 601 and covering the main channel 601. PZT 6144 covering at least one outlet or at least one inlet of UFL 600 needs to be attached to the substrate 611 of the UFL 600 in FIG. 38B, while needs to be attached to the cover 601 in FIG. 90A, opposing outlets or inlets openings in both embodiments. PZT 6141, 6142, 6143 may each be attached to the cover 601 or the substrate 611. In one embodiment, two or more of PZTs 6141, 6142, 6143, 6144 are attached to cover 601 of FIG. 90A. In another embodiment, two or more of PZTs 6141, 6142, 6143, 6144 are attached to substrate 611 of FIG. 38B. In yet another embodiment, two or more of PZTs 6141, 6142, 6143, are attached to cover 601 of FIG. 38B. In yet another embodiment, two or more of PZTs 6141, 6142, 6143, are attached to substrate 611 of FIG. 90A. In one embodiment, at least two PZTs selected from any of 6141, 6142, 6143, 6144 attached to UFL 600 operate at same frequency. In another embodiment, at least two PZTs selected from any of 6141, 6142, 6143, 6144 attached to UFL 600 operate as different frequencies, with each different PZT having a different frequency causing a different standing-wave mode being generated in the channel 601 directly covered by each PZT, whereas channel 601 may have varying channel width between an inlet to an outlet of UFL 600. In one embodiment, each PZT has a length 61411 along the channel 601 direction, and a width 61412 orthogonal to said length 61411 direction, and each PZT attached to UFL 600 has a length 61411 being longer than width 61412. In another embodiment, each PZT attached to UFL 600 has a length 61411 being shorter than width 61412. In yet another embodiment, each PZT selected from any of 6141, 6142, 6143, 6144 and attached to UFL 600 are identical, each PZT is attached to the same cover 601 surface or the same substrate surface 611 of the UFL 600, and a same alternating electrical voltage is applied simultaneously to drive each PZT attached to UFL 600 at the same frequency.

FIG. 91A illustrates cross-sectional view of a UFL similar to FIG. 90B but with a flow channel having circular curvature sides walls. Channel 601 of FIG. 91A is in the shape of a truncated circle, where the side walls 60102 and 60103 are part of the same circle, whereas the diameter of the circle is half wavelength, or an integer multiple of half wavelength, of the ultrasound mode in the fluid within channel 601 at resonance frequency, or driving frequency, Fp of PZT 614, standing ultrasound wave may be present in between the two side walls 60102 and 60103 of channel 601 as indicated by the dashed lines 626. Center of the circle that side walls 60102 and 60103 being part of is preferred to be at center of the channel as indicated by the point 62601, thus the bottom edge wall 60101 and top edge wall 60104 are substantially parallel to each other and having same width. Top edge wall 60104 is formed by top cover 610 covering over substrate 611. Truncated circular shape of the channel 601 of FIG. 91A may be formed by etching of substrate 611 by isotropic, or partial isotropic and partial anisotropic etching method, including wet etch and dry etch, which etches side walls 60101 and 60103 into substantially circular curvature, whereas the bottom channel wall 60101 may be kept flat during said etch with having a slow etching layer, i.e. etch stop layer, at the bottom channel wall 60101 location that does not etch easily as the substrate 611 wall 60102 and 60103. Substrate 611 may be a multi-layer structure that has an etch stop layer 60111 to form bottom wall 60101 during channel 601 etch, and etchable layer 60112 on top of etch stop layer 60111 to allow etching of the channel 611 into FIG. 91A channel truncated circular shape.

FIG. 91B illustrates cross-sectional view of a UFL similar to FIG. 91A but with a flow channel having a partial-circular shape formed within UFL substrate 611. Channel 601 of FIG. 91B is in the shape of a circle truncated only on top side, where the side walls 60105 is close to a full circle, whereas the diameter of the circle is half wavelength, or an integer multiple of half wavelength, of the ultrasound mode in the fluid within channel 601 at resonance frequency, or driving frequency, Fp of PZT 614, standing ultrasound wave may be present within the circle of the channel wall 60105, as indicated by the dashed lines 626. Top edge wall 60104 is formed by top cover 610 covering over substrate 611. Truncated circular shape of the channel 601 of FIG. 91B may be formed by etching of substrate 611 by isotropic, or partial isotropic and partial anisotropic etching method, including wet etch and dry etch, which etches side walls 60105 into substantially circular shape within substrate 611.

FIG. 91C illustrates cross-sectional view of a UFL similar to FIG. 91A but with a flow channel having a circular shape formed within both UFL substrate and UFL cover. Channel 601 of FIG. 91C is in the shape of a circle having a bottom channel wall 60105 of substantially a half circle shape formed within substrate 611, and a top channel wall 60104 of substantially a similar half circle shape with same diameter of 60105 circle and formed within top cover 610. Diameter of the circle formed by 60104 and 60105 is half wavelength, or an integer multiple of half wavelength, of the ultrasound mode in the fluid within channel 601 at resonance frequency, or driving frequency, Fp of PZT 614, standing ultrasound wave may be present within the circle of the channel wall 60104 and 60105, as indicated by the dashed lines 626. The half circular shape 60105 of the channel 601 in substrate 611, and half circular shape 60104 in cover 610 of FIG. 91C may be formed by etching of substrate 611 and cover by isotropic, or partial isotropic and partial anisotropic etching method, including wet etch and dry etch, which etches 60104 and 60105 into substantially circular shape within cover 610 and substrate 611 respectively. Then an alignment step of aligning channel walls 60104 and 60105 into an enclosing channel 601 is performed to form FIG. 91C channel shape.

In FIG. 91A through FIG. 91C, substrate 611, cover 601, and etch stop layer 60111 may: glass, silicon, quartz, aluminum-titanium-carbon (AlTiC), SiC, SiN, silicon-oxide, alumina, plastic, PDMS, polymer, ceramic, or metal, where metal may be composed any one or any alloy of aluminum, iron, nickel, titanium, chromium, platinum, tungsten, rhenium, copper, gold, silver.

For channels 601, 603, 608, inlets 602, 603, outlets 607, 609 of FIG. 38A, FIG. 38B and FIG. 91A, the channels, inlets and outlets after being patterned into its shape may be coated with one layer or multiple layers of any of silicon oxide, SiN, SiC, alumina, aluminum, iron, nickel, titanium, chromium, platinum, tungsten, rhenium, copper, gold, silver, with process of PVD, CVD, PE-CVD, oxidization, ALD or PE-ALD, such coated layer is in contact with liquid sample flowing through UFL 600 during operation.

FIG. 92A illustrates top-down view of a UFL device 600, similar as UFL 600 of FIG. 38A, having two inlets 602 and 604, and two outlets 607 and 609. Input sub-channel 6042 leading from inlet 604 to main channel 601 has a channel width 6511. Main channel has a channel width 6510. Input side-channel 603 leading from inlet 602 to main channel 601 has a channel width 6514. Output sub-channel 6072 leading from main channel 601 to outlet 607 has a channel width 6512. Output side-channel 608 leading from main channel 601 to outlet 609 has a channel width 6513. In one embodiment, channel width 6512 is smaller than channel with 6511. Channel width 6512 may be a percentage value of channel width 6511 with the percentage being within the range of any of: 10% to 20%, 20% to 40%, 40% to 60%, 60% to 80%, 80% to 100%, 100% to 150%, 150% to 200%, 200% to 500%, 500% to 1000%. In another embodiment, channel width 6512 is smaller than channel with 6513. Channel width 6512 may be a percentage value of channel width 6513 with the percentage being within the range of any of: 10% to 20%, 20% to 40%, 40% to 60%, 60% to 80%, 80% to 100%, 100% to 150%, 150% to 200%, 200% to 500%, 500% to 1000%. Output sub-channel 6072 channel width 6512 and side channel width 6513 may be adjusted such that output fluid flow rate through 607 and 609 may be made different. For example, 6512 being equal or smaller than 6513, output flow rate from outlet 607 is smaller than outlet 609. Ratio of output fluid flow rate from outlet 607 to output fluid flow rate from outlet 609 may be estimated as (channel width 6512) divided by (2 times of channel width 6513). In one embodiment, channel width 6511 is smaller than channel width 6510, channel width 6512 is smaller than channel width 6511, channel width 6512 is smaller than channel width 6513, channel width 6513 is larger than channel with 6514, channel width 6514 is smaller than channel width 6510. In one embodiment, ratio of channel width 6512 to channel width 6513 is smaller than the ratio of channel width

6511 to channel width 6514. In another embodiment, ratio of channel width 6512 to channel width 6513 is larger than the ratio of channel width 6511 to channel width 6514. In yet another embodiment, ratio of channel width 6512 to channel width 6513 is same as the ratio of channel width 6511 to channel width 6514. Ultrasound generator device 614, for example a PZT, may be attached to UFL 600 similarly as in FIG. 38C, or FIG. 90B through FIG. 91C.

FIG. 92B illustrates top-down view of a UFL device 6000 which is same as FIG. 92A in all other aspects except having only one inlet 6022, and two outlets 607 and 609. Main channel 601 connects directly from inlet 6022 to output side-channel 608 and output sub-channel 6072. In one embodiment, channel width 6512 is smaller than channel width 6513, channel width 6514 is smaller than channel width 6510. Ultrasound generator device 614, for example a PZT, may be attached to UFL 6000 similarly as in FIG. 38C, or FIG. 90B through FIG. 91C.

FIG. 93A illustrates operation of FIG. 92A UFL 600 device. Entity fluid 6020 of FIG. 38A containing large entities 10/20/30/612 and smaller entities 613 is injected into UFL 600 channel through inlet 602, and then passing through input side channels 603 with an effective volume flow rate 6031 into the main channel 601. Buffer fluid 6040 of FIG. 38A is injected into UFL 600 channel through inlet 604, and then passing through input sub-channels 6042 of FIG. 92A with an effective volume flow rate 6041 into the main channel 601. Buffer fluid 6040 and entity fluid 6020 meet in main channel 601 and form a lamina flow, where buffer fluid 6040 flows at the center of the main channel 601 and entity fluid 6020 flows on the side of the buffer fluid 6040 with the channel 601 and along the side wall of the channel 601. Due to the lamina flow, buffer fluid 6040 and entity fluid 6020 do not mix during the passage through channel 601. For achieving the said lamina flow, buffer fluid 6040 may have a different fluid density from entity fluid 6020, or buffer fluid 6040 may have a different viscosity than entity fluid 6020, or buffer fluid 6040 may have a different compressibility than entity fluid 6020. In one embodiment, buffer fluid 6040 has higher density than entity fluid. In one embodiment, buffer fluid 6040 has higher viscosity than entity fluid. In one embodiment, buffer fluid 6040 has higher compressibility than entity fluid. In main channel 601, entity fluid 6020 may have a linear flow speed 6033 along the channel 601 edge, buffer fluid 6040 may have a linear flow speed 6043 at the center of the channel 601. Linear speeds 6033 and 6043 may be different. In one embodiment, speed 6033 may be smaller than speed 6043; in another embodiment, speed 6033 may be larger than speed 6043; in yet another embodiment, speed 6033 may be substantially the same as speed 6043.

In FIG. 93A, ultrasonic standing wave mode created in main channel 601 caused by ultrasound generator device 614, as shown in FIG. 38C and FIG. 38D causes the large size entities 10/20/30/612 to move from the entity flow 6020 flowing at the channel 601 walls at speed 6033 into the buffer flow 6040 flowing at the center of the channel 601 at speed 6043, while all or most of the smaller entities 613 are maintained in entity flow 6020. Small entities 613 may be maintained in entity flow 6020 by their smaller size, or larger density, or smaller compressibility than large size entities 10/20/30/612. When lamina flow in channel 601 containing 6020 and 6040 reaches end of channel 601, part of the center buffer flow 6040 containing the large size entities 10/20/30/612 flows through output sub-channel 6072 of FIG. 92A, exits through outlet 607 with an effective volume flow rate 6071. While entity flow 6020 containing smaller entities 613 at side wall of channel 601 passes through output side channels 608 with an effective volume flow rate 6081 and exit through outlet 609. In one embodiment, flow rate 6071 is smaller than flow rate 6081 with channel width 6512 being smaller than channel width 6513 in FIG. 92A. In another embodiment, flow rate 6071 is larger than flow rate 6081 with channel width 6512 being larger than channel width 6513 in FIG. 92A. In yet another embodiment, flow rate 6071 is substantially similar to flow rate 6081 with channel width 6512 being similar to 6513 in FIG. 92A.

FIG. 93B illustrates operation of FIG. 92B UFL 6000 device. Entity fluid 6020 of FIG. 38A containing large entities 10/20/30/612 and smaller entities 613 is injected into UFL 6000 channel through inlet 6022 with an effective volume flow rate 6021 into the main channel 601. Ultrasonic standing wave mode, or also referred to as acoustic standing wave mode, created by ultrasound generation device, or also referred to as acoustic generation device, 614 in main channel 601 similar as shown in FIG. 38C and FIG. 38D causes the large size entities 10/20/30/612 flowing at the channel 601 edge walls to move to the center of the channel 601 at speed 6043, i.e. a concentration of large size entities 10/20/30/612 at channel 601 center line, while all or most of the smaller entities 613 are maintained in entity flow 6020 without much concentration. Small entities 613 may be maintained in entity flow 6020 without concentration by their smaller size, or larger density, or smaller compressibility than large size entities 10/20/30/612. When entity flow in channel 601 reaches end of channel 601, center portion of the entity flow 6020 containing most or all large size entities 10/20/30/612, and a small portion of smaller entities 613, flows through output sub-channel 6072 of FIG. 92B, exits through outlet 607 with an effective volume flow rate 6071. Side portion of entity flow 6020 containing mostly or entirely of smaller entities 613 passes through output side channels 608 with an effective volume flow rate 6081 and exit through outlet 609. In one embodiment, flow rate 6071 is smaller than flow rate 6081 with channel width 6512 being smaller than channel width 6513 in FIG. 92B. In another embodiment, flow rate 6071 is larger than flow rate 6081 with channel width 6512 being larger than 6513 in FIG. 92B. In yet another embodiment, flow rate 6071 is substantially similar to flow rate 6081 with channel width 6512 being similar to 6513 in FIG. 92B.

In FIG. 93B, with existence of both large size entities 10/20/30/612 and smaller size entities 613 in incoming entity fluid 6020, UFL 6000 of FIG. 93B functions to output 6070 fluid through outlet 607, with 6070 having a higher percentage and concentrated larger size entities 10/20/30/612 content and lower percentage of smaller size entities 613 than in the original incoming entity fluid 6020, while depleting large size entities 10/20/30/612 population from fluid 6090 output from outlet 609. In the case when entity fluid 6020 only contains large size entities 10/20/30/612, UFL 6000 of FIG. 93B functions to mainly output 6070 fluid with a reduced fluid volume compared to entity fluid 6020 through outlet 607, and a higher larger size entities 10/20/30/612 concentration in fluid 6070 than in entity fluid 6020. FIG. 93B UFL 6000 functions may be effectively achieved by FIG. 93A UFL 600 by using inlet 602 to inject entity flow 6020 and not injecting buffer flow 6040 through inlet 604, or by using inlet 604 to inject entity flow 6020 and not injecting buffer flow 6040 through inlet 602 in FIG. 93A.

In FIG. 93A and FIG. 93B, the flow rates 6071 and 6081 are inherent output flow rates values of the UFL 600 or UFL 6000, meaning when outlets 607 and 609 are not connected to any external conduits and fluid 6070 and 6090 of FIG.

38A flow out of outlets 607 and 609 freely. In the case where outlets 607 and 609 are connected to external conduits to conduct fluid 6070 and 6090 away from outlets 607 and 609, these conduits may be used to produce additional fluid resistance on either 6070 or 6090 and causes extrinsic modification to flow rates 6071 and 6081. In one embodiment, fluid resistance on fluid 6070 by conduit connected to outlet 607 is larger than fluid resistance on fluid 6090 by conduit connected to outlet 609, thus causing 6071 being smaller than effective volume flow rate of fluid 6090 through outlet 609, which is twice the value of 6081 in FIG. 93A and FIG. 93B. In another embodiment, fluid resistance on fluid 6070 by conduit connected to outlet 607 is smaller than fluid resistance on fluid 6090 by conduit connected to outlet 609, thus causing 6071 being larger than effective volume flow rate of fluid 6090 through outlet 609 in FIG. 93A and FIG. 93B.

FIG. 94A illustrates embodiment of a process flow between blood or bone marrow sample collection and UFL operation. In step 5801, peripheral blood sample or bone marrow sample is collected from a patient or person under test; in step 5802, red blood cell lysing may be performed on sample of step 5801; in step 5803, said sample from step 5802 after lysing is injected in UFL entity fluid inlet 602, while UFL buffer fluid is injected in outlet 604; in step 5804, UFL is operated similarly as step 5804 of FIG. 66. After step 5804, the steps after step 5804 as FIG. 66, FIG. 70, FIG. 72, FIG. 74 may be performed.

FIG. 94B illustrates embodiment of another process flow between blood or bone marrow sample collection and UFL operation. In step 5801, peripheral blood sample or bone marrow sample is collected from a patient or person under test; in step 5802, red blood cell lysing may be performed on sample of step 5801; in step 5806, add into target sample from step 5802 magnetic labels, and/or fluorescent molecules, hybridized with antibodies or ligands, which specifically bind to surface antigens or receptors on target cells or entities; in step 5807, target sample from step 5806 is incubated to form antibody-antigen or ligand-receptor binding to target cells or entities; in step 5803, target sample from step 5807 is injected in UFL entity fluid inlet 602, while UFL buffer fluid is injected in outlet 604; in step 5804, UFL is operated similarly as step 5804 of FIG. 66. After step 5804, the steps after step 5804 as FIG. 66, FIG. 70, FIG. 72, FIG. 74 may be performed.

FIG. 95A illustrates embodiment of a process flow between solid sample collection and UFL operation. In step 6901, solid tissue sample is collected; in step 6902, solid tissue sample from step 6901 is dissociated in a fluid base; in step 5806, add into target sample from step 6902 magnetic labels, and/or fluorescent molecules, hybridized with antibodies or ligands, which specifically bind to surface antigens or receptors on target cells or entities; in step 5807, target sample from step 5806 is incubated to form antibody-antigen or ligand-receptor binding to target cells or entities; in step 5803, target sample from step 5807 is injected in UFL entity fluid inlet 602, while UFL buffer fluid is injected in outlet 604; in step 5804, UFL is operated similarly as step 5804 of FIG. 66. After step 5804, the steps after step 5804 as FIG. 66, FIG. 70, FIG. 72, FIG. 74 may be performed.

FIG. 95B illustrates embodiment of a process flow between surface sample collection and UFL operation. In step 6701, surface entities are collected by swab; in step 6702, surface entities collected on swab are dissolved in a fluid base; in step 5806, add into target sample from step 6702 magnetic labels, and/or fluorescent molecules, hybridized with antibodies or ligands, which specifically bind to surface antigens or receptors on target cells or entities; in step 5807, target sample from step 5806 is incubated to form antibody-antigen or ligand-receptor binding to target cells or entities; in step 5803, target sample from step 5807 is injected in UFL entity fluid inlet 602, while UFL buffer fluid is injected in outlet 604; in step 5804, UFL is operated similarly as step 5804 of FIG. 66. After step 5804, the steps after step 5804 as FIG. 66, FIG. 70, FIG. 72, FIG. 74 may be performed.

FIG. 96 illustrates embodiment of a process flow after negative MAG sample collection including UFL operation. Step 5813 is same as in FIG. 66 through FIG. 75, where negative MAG sample is collected during MAG separation of a target sample. After step 5813, negative MAG sample of step 5813 is concentrated by UFL without using UFL buffer including either (a) in step 58222 injecting negative MAG sample of step 5813 into inlet 602 or 604 of fourth UFL 600 of FIG. 92A, and no UFL buffer is injected, or (b) in step 58223 injecting negative MAG sample of step 5813 into inlet 6022 of fourth UFL 6000 of FIG. 92B. After step 58222 or step 58223, in step 58231, fourth UFL outlet 607 outputs sample having concentrated large size entities with small size entities being fewer than in negative MAG sample of step 5813. Finally, negative MAG sample containing large entities from outlet 607 of fourth UFL may be sent to be analyzed by any of: cell counter 903, cell imager 904, flow cytometer or sorter 905, DNA/RNA sequencer 906. Alternatively, output from cell counter 903, or output from cell imager 904, or output from flow cytometer or sorter 905, may be further sent to be processed by DNA/RNA sequencer 906 as indicated respectively by path 936, 946, and 956. Negative MAG sample containing large entities from outlet 607 of fourth UFL in step 5823 may also be sent into the process of cell genetic modification and/or cell expansion 5824. Prior to DNA/RNA sequencing in DNA/RNA sequencer 906, a polymerase chain reaction (PCR) procedure on DNA/RNA sample obtained from cell lysing of large size entities from outlet 607 of fourth UFL from step 5823 may be performed, where PCR may be targeting one or more target DNA/RNA sequences and amplifies the number of target DNA/RNA sequences in the DNA/RNA sample.

FIG. 97 illustrates embodiment of another process flow after negative MAG sample collection including UFL operation. Step 5813 is same as in FIG. 66 through FIG. 75, where negative MAG sample is collected during MAG separation of a target sample. After step 5813, negative MAG sample of step 5813 is concentrated by UFL without using UFL buffer including either (a) in step 58222 injecting negative MAG sample of step 5813 into inlet 602 or 604 of fourth UFL 600 of FIG. 92A, and no UFL buffer is injected, or (b) in step 58223 injecting negative MAG sample of step 5813 into inlet 6022 of fourth UFL 6000 of FIG. 92B. After step 58222 or step 58223, in step 58251, fourth UFL outlet 609 outputs sample having small size entities, including DNA/RNA/molecules/small particles, with depletion of large size entities originally included in negative MAG sample of step 5813. Finally, small size entities from outlet 609 of fourth UFL may be sent to be analyzed by any of: particle counter 5835, particle imager 5836, flow cytometer or sorter 905, DNA/RNA sequencer 906. Alternatively, output from particle counter 5835, or output from particle imager 5836, or output from flow cytometer or sorter 905, may be further sent to be processed by DNA/RNA sequencer 906 as indicated respectively by path 5827, 5828, and 956. DNA/RNA sequencer 906 may contain a PCR step on small size entities from outlet 609 of fourth UFL from step 5825 prior to DNA/RNA sequencing, where PCR may target one or more particular DNA/RNA sequences to amplify in quantity.

FIG. 98 illustrates embodiment of a process flow after positive MAG sample collection including UFL operation. Step 5814 is same as in FIG. 66 through FIG. 75, where positive MAG sample is collected after MAG separation of a target sample. After step 5814, positive MAG sample of step 5814 is concentrated by UFL without using UFL buffer including either (a) in step 58291 injecting positive MAG sample of step 5814 into inlet 602 or 604 of fifth UFL 600 of FIG. 92A, and no UFL buffer is injected, or (b) in step 58292 injecting positive MAG sample of step 5814 into inlet 6022 of fifth UFL 6000 of FIG. 92B. After step 58291 or step 58292, in step 58301, fifth UFL outlet 607 outputs sample having concentrated large size entities with small size entities being fewer than in positive MAG sample of step 5814. Finally, positive MAG sample containing large entities from outlet 607 of fifth UFL may be sent to be analyzed by any of: cell counter 903, cell imager 904, flow cytometer or sorter 905, DNA/RNA sequencer 906. Alternatively, output from cell counter 903, or output from cell imager 904, or output from flow cytometer or sorter 905, may be further sent to be processed by DNA/RNA sequencer 906 as indicated respectively by path 936, 946, and 956. Positive MAG sample containing large entities from outlet 607 of fifth UFL in step 5823 may also be sent into the process of cell genetic modification and/or cell expansion 5824. Prior to DNA/RNA sequencing in DNA/RNA sequencer 906, a polymerase chain reaction (PCR) procedure on DNA/RNA sample obtained from cell lysing of large size entities from outlet 607 of fourth UFL from step 5823 may be performed, where PCR may be targeting one or more target DNA/RNA sequences and amplifies the number of target DNA/RNA sequences in the DNA/RNA sample.

FIG. 99 illustrates embodiment of another process flow after positive MAG sample collection including UFL operation. Step 5814 is same as in FIG. 66 through FIG. 75, where positive MAG sample is collected after MAG separation of a target sample. After step 5814, positive MAG sample of step 5814 is concentrated by UFL without using UFL buffer including either (a) in step 58291 injecting positive MAG sample of step 5814 into inlet 602 or 604 of fifth UFL 600 of FIG. 92A, and no UFL buffer is injected, or (b) in step 58292 injecting positive MAG sample of step 5814 into inlet 6022 of fifth UFL 6000 of FIG. 92B. After step 58291 or step 58292, in step 58311, fifth UFL outlet 609 outputs sample having small size entities, including DNA/RNA/molecules/small particles, with depletion of large size entities originally included in positive MAG sample of step 5814. Finally, small size entities from outlet 609 of fifth UFL may be sent to be analyzed by any of: particle counter 5835, particle imager 5836, flow cytometer or sorter 905, DNA/RNA sequencer 906. Alternatively, output from particle counter 5835, or output from particle imager 5836, or output from flow cytometer or sorter 905, may be further sent to be processed by DNA/RNA sequencer 906 as indicated respectively by path 5827, 5828, and 956. DNA/RNA sequencer 906 may contain a PCR step on small size entities from outlet 609 of fourth UFL from step 5825 prior to DNA/RNA sequencing, where PCR may target one or more particular DNA/RNA sequences to amplify in quantity.

FIG. 100A illustrates embodiment of a process flow including two UFLs in serial operation. In step 58051, an input sample is injected into inlet 602 or 604 of UFL 600 of FIG. 92A or inlet 6022 of UFL 6000 of FIG. 92B, then UFL outlet 607 outputs a target sample containing large size cells or entities from original input sample. After step 58051, target sample from step 58051 is concentrated by UFL without using UFL buffer including either (a) in step 58222 injecting target sample from step 58051 into inlet 602 or 604 of fourth UFL 600 of FIG. 92A, and no UFL buffer is injected, or (b) in step 58223 injecting target sample from step 58051 into inlet 6022 of fourth UFL 6000 of FIG. 92B. After step 58222 or step 58223, in step 58231, fourth UFL outlet 607 outputs sample having concentrated large size entities with small size entities being fewer than in target sample from step 58051. After step 58231 of FIG. 100A, processes as described in FIG. 96 utilizing 903, 904, 905, 906, 5824 after step 58231 may be similarly performed.

FIG. 100B illustrates embodiment of another process flow including two UFLs in serial operation. FIG. 100B is same as FIG. 100A, except that after step 58222 or step 58223, in step 58251, in step 58251, fourth UFL outlet 609 outputs sample having small size entities, including DNA/RNA/molecules/small particles, with depletion of large size entities originally included in target sample from step 58051. After step 58251 of FIG. 100B, processes as described in FIG. 97 utilizing 5835, 5836, 905, 906 after step 58251 may be similarly performed.

FIG. 101A illustrates embodiment of yet another process flow including two UFLs in serial operation. In step 58052, an input sample is injected into inlet 602 or 604 of UFL 600 of FIG. 92A or inlet 6022 of UFL 6000 of FIG. 92B, then UFL outlet 609 outputs a target sample containing smaller size cells or entities from original input sample. After step 58052, target sample from step 58052 is concentrated by UFL without using UFL buffer including either (a) in step 58222 injecting target sample from step 58052 into inlet 602 or 604 of fourth UFL 600 of FIG. 92A, and no UFL buffer is injected, or (b) in step 58223 injecting target sample from step 58052 into inlet 6022 of fourth UFL 6000 of FIG. 92B. After step 58222 or step 58223, in step 58226, fourth UFL outlet 607 outputs first sample having concentrated large size entities with small size entities being fewer than in target sample from step 58052 and fourth UFL outlet 609 outputs second sample having small size entities, including DNA/RNA/molecules/small particles, with depletion of large size entities originally included in target sample from step 58052. After step 58226 of FIG. 101A, processes as described in FIG. 96 utilizing 903, 904, 905, 906, 5824 after step 58231 may be similarly performed on first sample from step 58226; processes as described in FIG. 97 utilizing 5835, 5836, 905, 906 after step 58251 may be similarly performed on second sample from step 58226.

FIG. 101B illustrates embodiment of yet another process flow including two UFLs in serial operation. In step 58052, an input sample is injected into inlet 602 or 604 of UFL 600 of FIG. 92A or inlet 6022 of UFL 6000 of FIG. 92B, then UFL outlet 609 outputs a target sample containing smaller size cells or entities from original input sample. After step 58052, in step 58227 injecting target sample from step 58052 into inlet 602 and injecting buffer fluid into inlet 604 of sixth UFL 600 of FIG. 92A. After step 58227, in step 58226, sixth UFL outlet 607 outputs first sample having mainly large size entities with depletion of small size entities originally included in target sample from step 58052; and outlet 609 outputs second sample having mainly smaller size entities, including DNA/RNA/molecules/small particles, with depletion of large size entities originally included in target sample from step 58052. After step 58228 of FIG. 101B, processes as described in FIG. 96 utilizing 903, 904, 905, 906, 5824 after step 58231 may be similarly performed on first sample from step 58228; processes as described in FIG. 97 utilizing 5835, 5836, 905, 906 after step 58251 may be similarly performed on second sample from step 58228.

FIG. 102 illustrates embodiment of a method of operating multiple UFLs in serial, or cascaded, configuration. FIG. 102 illustrates biological sample is passed through a first stage multiple UFLs 600, output fluids from the UFLs 600, which can be either large entities 6070 or small entities 6090, are then fed into inlets 8011 of a fourth type flow connector 8010, and from connector 8010 outlets 8012 into (a) inlet 602 or inlet 604 of one or multiple second stage UFLs 600; or (b) inlet 6022 of one or multiple second stage UFLs 6000.

FIG. 103 illustrates embodiment of another method of operating multiple UFLs in serial, or cascaded, configuration. FIG. 102 illustrates biological sample is passed through a first stage multiple UFLs 600, output fluids from the UFLs 600, which can be either large entities 6070 or small entities 6090, are then fed into inlets 8021 of a fifth type flow connector 8020, and from connector 8020 outlets 8022 into (a) inlet 602 or inlet 604 of one or multiple second stage UFLs 600; or (b) inlet 6022 of one or multiple second stage UFLs 6000.

FIG. 104 illustrates embodiment of yet another method of operating multiple UFLs in serial, or cascaded, configuration. FIG. 104 illustrates biological sample is passed through a first stage multiple UFLs 600, output fluids from the UFLs 600, which can be either large entities 6070 or small entities 6090, are then fed into inlets 8031 of a sixth type flow connector 8030, and from connector 8030 outlets 8032 into (a) inlet 602 or inlet 604 of one or multiple second stage UFLs 600; or (b) inlet 6022 of one or multiple second stage UFLs 6000.

Serial or cascade structures of FIG. 102, FIG. 103, and FIG. 104 may be used in serial to achieve multiple stages UFL function, for example large entities 6070 or small entities 6090 from outlets 607 and 609 of second stage UFL 600 or UFL 6000 of each of FIG. 102, FIG. 103, and FIG. 104 may be similarly injected into third stage UFL 600 or UFL 6000 of each of FIG. 102, FIG. 103, and FIG. 104 through another intermediate 8010/8020/8030 connector in any combination.

FIG. 105A illustrates embodiments of another method of operating multiple UFLs in serial, or cascaded, configuration. FIG. 105A illustrates biological sample is first passed through a first UFL 600, output target sample from the UFL 600 may be large entities 6070 from outlet 607, as in step 58051 of FIG. 100A or FIG. 100B, or small entities 6090 from outlet 609, as in step 58052 of FIG. 101A or FIG. 101B. UFL 6001 and UFL 6002 are similar to UFL 600 in design or operation.

In first embodiment of FIG. 105A, large entities 6070 target sample from UFL 600 may then be injected into inlet 602 of UFL 6001, where large entities 6070 from UFL 600 may then be further separated by UFL 6001 into first sample containing larger size population entities of 6070 from UFL 600 and output from outlet 607 of UFL 6001, or second sample containing smaller size population entities of 6070 from UFL 600 and output from outlet 609 of UFL 6001. In first embodiment of FIG. 105A, ultrasound vibration generator 6145 attached to UFL 600 may be operating at any of: a higher vibration strength, a higher driving voltage, a higher resonant frequency, or having a larger area size, than ultrasound vibration generator 6146 attached to UFL 6001; main channel 601 of UFL 600 may have any of: a narrower channel width, a deeper channel depth than main channel 601 of UFL 6001; buffer fluid 6040 entering inlet 604 of UFL 600 may have any of: a smaller density, a smaller viscosity, a larger compressibility, a slower flow rate, than buffer fluid 6040 entering inlet 604 of UFL 6001.

In second embodiment of FIG. 105A, smaller entities 6090 target sample from UFL 600 may then be injected into inlet 602 of UFL 6002, where smaller entities 6090 from UFL 600 may then be further separated by UFL 6001 into third sample containing larger size population entities of 6090 from UFL 600 and output from outlet 607 of UFL 6002, or fourth sample containing smaller size population entities of 6090 from UFL 600 and output from outlet 609 of UFL 6002. In second embodiment of FIG. 105A, ultrasound vibration generator 6148 attached to UFL 6002 may be operating at any of: a higher vibration strength, a higher driving voltage, a higher resonant frequency, or having a larger area size, than ultrasound vibration generator 6145 attached to UFL 600; main channel 601 of UFL 6002 may have any of: a narrower channel width, a deeper channel depth than main channel 601 of UFL 600; buffer fluid 6040 entering inlet 604 of UFL 6002 may have any of: a same or larger density, a same or larger viscosity, a same or larger compressibility, a same or slower flow rate, than buffer fluid 6040 entering inlet 604 of UFL 600.

FIG. 105B illustrates embodiments of yet another method of operating multiple UFLs in serial, or cascaded, configuration. FIG. 105B and FIG. 105A are same except: (a) UFL 6001 of FIG. 105A is replace with UFL 6003 and UFL 6002 or FIG. 105A is replaced with UFL 6004, where UFLs 6003 and 6004 are similar to UFL 6000 of FIG. 92B and FIG. 93B; (b) large entities output sample 6070 of UFL 600 enters inlet 6022 of UFL 6003 and smaller entities sample 6090 of UFL 600 enters inlet 6022 of UFL 6004; (c) buffer 6040 is not injected in UFLs 6003 and 6004.

In first embodiment of FIG. 105B, large entities 6070 target sample from UFL 600 may then be injected into inlet 6022 of UFL 6001, where large entities 6070 from UFL 600 may then be further separated by UFL 6003 into fifth sample containing mostly larger size population entities of 6070 from UFL 600 and output from outlet 607 of UFL 6003, or sixth sample containing smaller size population entities of 6070 from UFL 600 and output from outlet 609 of UFL 6003. In first embodiment of FIG. 105B, ultrasound vibration generator 6145 attached to UFL 600 may be operating at any of: a higher vibration strength, a higher driving voltage, a higher resonant frequency, or having a larger area size, than ultrasound vibration generator 6146 attached to UFL 6003; main channel 601 of UFL 600 may have any of: a narrower channel width, a deeper channel depth than main channel 601 of UFL 6003.

In second embodiment of FIG. 105B, smaller entities 6090 target sample from UFL 600 may then be injected into inlet 6022 of UFL 6004, where smaller entities 6090 from UFL 600 may then be further separated by UFL 6004 into seventh sample containing larger size population entities of 6090 from UFL 600 and output from outlet 607 of UFL 6004, or eighth sample containing smaller size population entities of 6090 from UFL 600 and output from outlet 609 of UFL 6004. In second embodiment of FIG. 105B, ultrasound vibration generator 6148 attached to UFL 6004 may be operating at any of: a higher vibration strength, a higher driving voltage, a higher resonant frequency, or having a larger area size, than ultrasound vibration generator 6145 attached to UFL 600; main channel 601 of UFL 6004 may have any of: a narrower channel width, a deeper channel depth than main channel 601 of UFL 600.

FIG. 106A illustrates embodiment of MAG in a module configuration. If FIG. 106A, at least one MAG unit 121, 122, 123, 124, 125, 126, 127, 128, 129, 1241, 1242, 1243, 1251, 1261, 1272 in combination with at least one channel 101, 201, or 301, and holder 107, 110, 1020, 1040, 1102, 1103, 1081, 1082, and at least one pump 500, are included in a module 10801 having a physical enclosure. Module 10801 may also have other electronic components, electronic boards, control circuit, control programs, embedded software, and peripheral structures that make module 10801 function as a stand-alone unit performing functions of: (1) intake of sample into channel 101/201/301 that is in contact with said MAG unit; (2) separation of entities 10/30 with said MAG unit from said sample; (3) dissociation of 10/30 from said channel; (4) output negative MAG sample and positive MAG sample as in step 5813 and step 5814 of FIG. 66 through FIG. 75. Flow limiter 509, 510 from FIG. 38A through FIG. 36B, and valves 805, 935, 936, 937, 938, 939, 940, 941 from FIG. 53 through FIG. 65B may be included in module 10801. Fluidic lines as described in FIG. 59A, FIG. 59B, FIG. 64A, FIG. 64B may be included as part of module 10801.

FIG. 106B illustrates embodiment of UFL in a module configuration. If FIG. 106B, at least one UFL 600 or 6000, with two pumps 500 injecting sample into inlet 602 and inlet 604 of UFL 600, or one pump 500 injecting sample into inlet 6022 of UFL 6000, are included in a module 10802 having a physical enclosure. Module 10802 may also have other electronic components, electronic boards, control circuit, control programs, embedded software, and peripheral structures that make module 10802 function as a stand-alone unit performing functions of: (1) intake of sample into UFL 600 inlet 602, or UFL 6000 inlet 6022; (2) intake of buffer into UFL 600 inlet 604; (3) separation of entities within said sample into large entities sample 6070 and output through outlet 607 of UFL 600 or UFL 6000; (4) separation of entities within said sample into smaller entities sample 6090 and output through outlet 609 of UFL 600 or UFL 6000. Flow limiter 509, 510 from FIG. 38A through FIG. 36B, and valves 805, 935, 936, 937, 938, 939, 940, 941 from FIG. 53 through FIG. 65B may be included in module 10802. Fluidic lines as described in FIG. 60A, FIG. 60B, FIG. 65A, FIG. 65B may be included as part of module 10802.

FIG. 106C illustrates embodiment of a system 10800 including a single module of MAG 10801 or a single module of UFL 10802. In FIG. 106C, system 10800 may include module 10801 or module 10802, and may provide any of: (1) a physical enclosure for fixture of module 10801 or module 10802; (2) electrical connections, including electrical power, electrical data communication lines, to module 10801 or module 10802; (3) a data interface between a control unit of system 10800 and module 10801 or module 10802, preferable with a standard communication protocols, including wire and wireless protocols, and including but not limited to GPIB, Bluetooth, NFC, USB, TCP/IP, serial, and parallel protocols; (4) a user interface for controlling the module 10801 or module 10802 by a user.

FIG. 106D illustrates embodiment of a system including multiple modules of MAG 10801 and UFL 10802. In FIG. 106D, system 10800 may include at least two modules with each module being either module 10801 or module 10802, and provide to each said module any of: (1) a physical enclosure for fixture of all modules; (2) electrical connections, including electrical power, electrical data communication lines, to each of module 10801 or module 10802; (3) a data interface between a control unit of system 10800 and each of module 10801 or module 10802, preferable with a standard communication protocols, including wire and wireless protocols, and including but not limited to GPIB, Bluetooth, NFC, USB, TCP/IP, serial, and parallel protocols; (4) a user interface for controlling each of the module 10801 or module 10802 by a user. In FIG. 106D, each module 10801 or module 10802 included in system 10800 may operate independently, and each said module may have fluidic lines included in each said module and without connection of said fluidic line between any of said modules.

FIG. 107 illustrates embodiment of a system including multiple modules of MAG 10801 and UFL 10802 with fluidic sample flowing through the modules in serial. In FIG. 107, system 10800 may include at least two modules with each module being either module 10801 or module 10802, and provide to each said module any of: (1) a physical enclosure for fixture of all modules; (2) electrical connections, including electrical power, electrical data communication lines, to each of module 10801 or module 10802; (3) a data interface between a control unit of system 10800 and each of module 10801 or module 10802, preferable with a standard communication protocols, including wire and wireless protocols, and including but not limited to GPIB, Bluetooth, NFC, USB, TCP/IP, serial, and parallel protocols; (4) a user interface for controlling each of the module 10801 or module 10802 by a user. In FIG. 107, neighboring modules 10801 or module 10802 included in system 10800 may operate dependently, fluidic lines included in each said module may connect to neighbor modules, where an output sample from one module may be injected as input sample of the neighboring module. FIG. 107 show an example that modules from left to right function in serial, where output sample 6070, or 6090, or 427, or 428 from a module 10801 or 10802, may pass through a flow connector 801, 802, 803, 8010, 8020, 8030, and enters the module on the right as input sample of 401, or 708, or 6020, or 408, wherein fluidic lines between module may exist to achieve said output sample to input sample function. Fluidic lines as described in FIG. 55A through 58B, and in FIG. 61A through FIG. 63B, which include both MAG and UFL may be included as continuous fluidic lines with different portion of the continuous fluidic lines being part of different module 10801 or module 10802, and said continuous fluidic lines connect across multiple modules 10801 or 10802 as shown in system 10800 of FIG. 107.

FIG. 108A illustrates FIG. 33A flexible channel attached to the output port of a peristaltic pump having a blockage sensor in proximity to the flexible channel. FIG. 108A is substantially same as FIG. 33A, except a sensor 5081 is included. Sensor 5081 may function to detect the event that the channel wall of channel 508 comes into physical contact with sensor 5081, or to detect the event that the channel wall of channel 508 moves within proximity threshold to sensor 5081, wherein said proximity threshold means a minimal physical distance between channel 508 external wall and surface of sensor 5081 in any range of: 0.001 mm to 0.1 mm, 0.1 mm to 1 mm, 1 mm to 2 mm, 2 mm to 10 mm, 10 mm to 20 mm. Sensor 5081 may connect to a control circuit 5083 through electrical connection 5082, where control circuit 5083 may provide power to sensor 5081 and may sense the event of channel 508 coming into physical contact with sensor 5081 or the event of channel 508 moving within proximity threshold to sensor 5081. Sensor 5081 may be in the form of any of: metal strip, electrode, contact surface, optical sensor set including an optical emitter and an optical sensor. Sensing by control circuit of 5083 may be through the sensing of change of parameter measured from sensor 5081 including any of: capacitance, inductance, thermal radiation, thermal conductivity, temperature, optical transmission or reflection, acoustic transmission or reflection, contact force or contact pressure, electrical conductivity, where said parameter may be measured for any of: between sensor 5081 to channel 508, between sensor 5081 to a reference structure including but not limited to: electrical ground, temperature plate, dummy structure, where reference structure may be included in sensor 5081 or circuit 5083, or between sensor 5081 to ambient environment. FIG. 108A shows that in normal operation when channel 508 may expand due to fluidic pressure built up in channel 508 caused by narrow flow path produced by clamp 509 and 510 as described in FIG. 33A, but channel 201 after clamp 509 and 510 is not blocked, therefore channel 508 expansion does not cause channel 508 to contact sensor 5081 or comes below proximity threshold to sensor 5081.

FIG. 108B shows that in the case of a blockage occurrence in fluidic lines after clamp 509 and 510, channel 508 may further expand due to additional fluid pressure built up in channel 508 caused by blockage. FIG. 108B shows blockage of 5203 in channel 201 causes fluid flow speed in channel 201 significantly reduced or completely stopped, where increased fluid pressure in channel 508 by continued pumping of fluid sample into channel 508 by pump 500 may cause channel 508 to further expand and contacts sensor 5081 and control circuit 5083 may detect such event of contact and determines that a blockage event may have occurred in channel 201. Pump 500 may then stop to avoid further fluid injection into channel 508 with detection of said blockage event.

FIG. 109A is identical to FIG. 108A in all other aspects except that the clamp 509 and 510 are replaced with a limiter 20101. Limiter 20101 may take the form of a section of a tubing that connects to channel 508 on one end and channel 201 on the other end, where limiter 20101 may have an internal diameter 20102 that is much smaller than the internal diameter of either channel 508 or channel 201, and thus function similarly as clamp 509 and 510 to reduce fluidic flow speed when fluid passes through limiter 20101 from channel 508 to channel 201. The internal diameter 20102 may be in the range of any of: 0.01 mm to 0.1 mm, 0.1 mm to 0.2 mm, 0.2 mm to 0.3 mm, 0.3 mm to 0.4 mm, 0.4 mm to 0.5 mm, 0.5 mm to 1 mm, and 1 mm to 2 mm. The internal diameter 20102 relative to the internal diameter of channel 201 may be in the range of any of: 1% to 5%, 5% to 10%, 10% to 20%, 20% to 30%, 30% to 40%, 40% to 50%, 50% to 60%, 60% to 80%.

FIG. 109B is same as FIG. 108B, with replacing clamps 509 and 510 with limiter 20101 similar as in FIG. 109A. FIG. 109B shows that in the case of a blockage 5203 occurrence in channel 201 after limiter 20101, channel 508 may further expand due to additional fluid pressure built up in channel 508 caused by blockage and may contact sensor 5081 and control circuit 5083 may detect such event of contact and determines that a blockage event may have occurred in channel 201. Pump 500 may then stop to avoid further fluid injection into channel 508 with detection of said blockage event.

FIG. 110A illustrates an embodiment of a UFL 600 having two inlets, and an optical detector 901 is located around main channel 601 of the UFL 600. UFL 600 of FIG. 110A is similar to UFL 600 of FIG. 90C and FIG. 32A, and an ultrasound generator device 614 is attached to UFL 600. Optical detector 901 may include one or more optical emitters, and one or more optical detectors, where optical emitters emit light beams into the main channel 601 and optical detectors detect said light beams after being reflected, or scattered, by entities 1/10/20/30/612/613 flowing in stream 6043, or stream 6033, within channel 601 of UFL 600. Said optical detectors may also detect blockage of said light beams by said entities 1/10/20/30/612/613, or detect secondary light emissions by said entities 1/10/20/30/612/613. Optical detector 901 may be used to detect, or collect, the properties of entities 1/10/20/30/612/613 with said properties including any of: type, size, shape, speed of moving, transparency, morphology. Optical detector 901 may also be used to obtain entities 1/10/20/30/612/613 information including any of: count of different types of entities passing through channel 601 within a given amount of time, or within a given volume of fluid sample; color of fluorescent molecules attached to detected entities; number of colors of fluorescent molecules attached to detected entities; fluorescence optical strength from fluorescent molecules attached to detected entities; and optical images of detected entities.

FIG. 110B illustrates an embodiment of a UFL 6000 having one inlet 6022, and an optical detector 901 is located around main channel 601 of the UFL 6000. UFL 6000 of FIG. 110B is similar to UFL 6000 of FIG. 92B and FIG. 93B, and an ultrasound generator device 614 is attached to UFL 6000. Optical detector 901 of FIG. 110B is same as optical detector 901 of FIG. 110A. Optical detector 901 of FIG. 110B functions to detect entities 1/10/20/30/612/613 and obtain information of entities 1/10/20/30/612/613 in stream 6021 flowing in channel 601 of UFL 6000 similarly as detector 901 of FIG. 110A.

FIG. 110C illustrates an embodiment of a UFL, which may be UFL 600 or UFL 6000, having an optical detector 901 located around sample sub-channel 6072 of the UFL. Fluid stream 6043 or 6021 flowing in main channel 601 of UFL 600 or UFL 6000 carrying mainly large size entities of sample fluid becomes flow stream 6071 after entering sub-channel 6072. Optical detector 901 of FIG. 110C is same as optical detector 901 of FIG. 110A. Optical detector 901 of FIG. 110C functions to detect entities 1/10/20/30/612 within flow stream 6071 and obtain information of entities 1/10/20/30/612 in stream 6071 flowing in sub-channel 6072 similarly as detector 901 of FIG. 110A detecting and obtaining information of entities 1/10/20/30/612/613 in stream 6033/6034 flowing in channel 601 of FIG. 110A. In FIG. 110C, an ultrasound generator device 6147 may optionally be attached around sub-channel 6072 similar to device 614 around channel 601 of FIG. 110A, to produce ultrasound standing wave similar to FIG. 38C and FIG. 38D to cause entities 1/10/20/30/612 within flow stream 6071 to align to substantially center of channel 6072 for optical detection by detector 901.

FIG. 110D illustrates another embodiment of a UFL having an optical detector 901 around an extended channel 910 in UFL. FIG. 110D shows that in UFL 600 or UFL 6000, flow stream 6021/6043/6071 carrying entities 1/10/20/30/612 flows in channel 601 or channel 6072 and enters extended channel 910 and becomes flow stream 9101. Extended channel 910 has channel width 9102 which may be narrower than channel width 6510/6512 of channel 601/6072, where channel 910 width 9102 relative to channel 601/6072 width 6510/6512 may be in the range of any of: 1% to 5%, 5% to 10%, 10% to 20%, 20% to 30%, 30% to 40%, 40% to 50%, 50% to 60%, 60% to 80%, of channel 601/6072 width 6510/6512. With effective volume flow rate being constant from flow 6021/6043/6071 to flow 9101, linear flow speed of 9101 may be faster than linear flow speed of 6021/6043/6071, while entities 1/10/20/30/612 in flow 9101 may be spatially distributed more distant to each other than in flow 6021/6043/6071, and thus enables a better spatial resolution during detection of entities 1/10/20/30/612 by optical detector 901. Optical detector 901 of FIG. 110D is same as optical detector 901 of FIG. 110A. Optical detector 901 of FIG. 110D functions to detect entities 1/10/20/30/612 within flow stream 9101 and obtain information of entities 1/10/20/30/612 in stream 9101 flowing in channel 910 similarly as detector 901 of FIG. 110A detecting and obtaining information of entities 1/10/20/30/612 in stream 6034 flowing in channel 601 of FIG. 110A. In FIG. 110D, an ultrasound generator device 6149 may optionally be attached around channel 910 similar to device 614 around channel 601 of FIG. 110A, to produce ultrasound standing wave similar to FIG. 38C and FIG. 38D to cause entities 1/10/20/30/612 within flow stream 9101 to align to substantially center of channel 910 for optical detection by detector 901. Flow 9101 carrying entities 1/10/20/30/612 after passing detector 901 in FIG. 110D is designated as flow 91010.

FIG. 111A illustrates an embodiment of an optical detector 901 having optical emitter or illuminator 9011, forward scatter sensors 9013 and back scatter sensors 9012 being used to detect a biological entity 1/10/20/30/612. FIG. 111A describes more detailed structure of detector 901 as in FIG. 110A through FIG. 110D. In FIG. 111A, flow 6021/6043/6071/9101 carries biological entities 1/10/20/30/612 through channel 601/6072/910. Dashed line indicates detector 901, which include components of illuminator 9011, forward scatter sensors 9013 and back scatter sensors 9012. In FIG. 111A, components 9011, 9012 are shown to be embedded within one side of the channel wall of channel 601/6072/, and component 9013 is shown to be embedded within opposing side of the channel wall of channel 601/6072/910, where components 9011/9012/9013 may each terminate at the channel 601/6072/910 side walls 60112 to allow light passage between channel 601/6072/910 and said components 9011/9012/9013. When a biological entity 1/10/20/30/612 flows through the dashed box of 901 detector region of detection, information of biological entity 1/10/20/30/612 as described in FIG. 110A through FIG. 110D may be optically extracted by components 9011, 9012, and 9013. Illuminator 9011 may include any of: light emitting diodes (LED), organic light emitting diode (OLED), laser diode, edge emitting laser. Detector 9012 and detector 9013 may each include any of: photo diode, avalanche photo diode (APD), charge-coupled device (CCD), or a complementary metal-oxide-semiconductor (CMOS) device.

In FIG. 111A, illuminator 9011 may be driven by a first modulation signal that modulates intensity of light emitted by illuminator 9011 at a modulation frequency. Detected optical signal from detector 9012, or from detector 9013, may then be converted to second electrical signal, and a lock-in-amplification operation may then be performed with multiplying, or convolution of, the first modulation signal and second electrical signal at the modulation frequency, with necessary phase correction, and signal processing including band pass or low pass filtering, to extract the optical signal component generated from the biological entity 1/10/20/30/612 with higher signal to noise ratio. Extraction of said optical signal component generated from the biological entity 1/10/20/30/612 may be from first, second, third, or fourth harmonic of the modulation frequency during said lock-in amplification operation. Lock-in amplification operation may be achieved by feeding first modulation signal as reference signal, and second electrical signal as input signal into a lock-in amplifier control, or circuit, or component.

FIG. 111B illustrates an embodiment of FIG. 111A optical detector 901 components being embedded in channel walls of channel 601/6072/910, with back scatter sensor 9012 and the illuminator 9011 located in channel wall of same side, and forward scatter sensor 9013 located in opposing channel wall. FIG. 111B is a cross-section view of FIG. 111A along 920 cross-section line and viewing direction. In FIG. 111B, illuminator 9012 and back scatter sensor 9012 are substantially around same vertical level from the bottom of the channel 601/6072/910, where illuminator 9012 and back scatter sensor 9012 may be positioned with one in the front and the other in the back positions in the view of FIG. 111B. Light 90112 is emitted from illuminator 9012 toward entity 1/10/20/30/612 flowing in channel 601/6072/910, back scatter light 90122 may be captured by back scatter sensor 9012, and forward scatter light 90132 may be captured by forward scatter sensor 9013. Light 90122 may be light 90112 reflected from entity 1/10/20/30/612, and light 90132 may be light 90112 diffracted by, or optically scattered by, entity 1/10/20/30/612, where light 90122 or light 90132 may each have same optical frequency or optical color as light 90112. Light 90122 may be fluorescent light emitted from entity 1/10/20/30/612 after being excited by light 90112, and light 90132 may be fluorescent light emitted from entity 1/10/20/30/612 after being excited by light 90112, where light 90122 or light 90132 may each have lower optical frequency or longer optical wavelength than light 90112, and where light 90122 or light 90132 may each be emitted by fluorescent molecules attached to entity 1/10/20/30/612.

FIG. 111C is substantially same as FIG. 111B, except that FIG. 111C shows that back scatter sensors 9012 are positioned above and below the illuminator 9011 while embedded in the same side channel wall of channel 601/6072/910.

FIG. 111D illustrates an embodiment of FIG. 111A where FIG. 111D is substantially same as FIG. 111B or FIG. 111C, except an optically transparent layer 9103 are coated within the channel 601/6072/910 internal wall of 60112 and 60113. Layer 9103 may be composed of single layer or a multi-layer structure, with each layer being any of: silicon nitride (SiN), silicon oxide (SiOx), silicon carbide (SiC), aluminum oxide (AlOx), aluminum nitride (AlN), zinc oxide (ZnOx), titanium nitride (TiN), titanium oxide (TiOx), magnesium oxide (MgO), diamond like carbon (DLC). Layer 9103 may include of any of: Si, Cu, Fe, Ti, Ta, Al, C, N, O, Tb, Sb, Ni, Cr, B, Ag, Au, Pt, Sn, Ir, Mn, Ru, W, Be, Re, Hf, Nb, Mo, Zr, Cr, V, Mg, Rh, Pd. Layer 9103 may coated over only the internal side walls of the channel 601/6072/910, or may be coated conformally over the internal side walls and internal bottom surface of channel 601/6072/910. Layer 9103 may be coated by thin film coating process in vacuum chamber by any of: physical vapor deposition (PVD), chemical vapor deposition (CVD), atomic layer deposition (ALD), plasma-enhanced chemical vapor deposition (PECVD), plasma-enhanced atomic layer deposition (PEALD), or molecular-beam epitaxy (MBE).

FIG. 111E illustrates an embodiment of FIG. 111A, where FIG. 111E is substantially same as FIG. 111D, except the top cover 610 may have a bottom layer 9104 that forms the top cover of the channel 601/6072/910 after cover 610 closing down onto substrate 611. Layer 9104 may be composed of same optically transparent material as layer 9103. Layer 9104 may be composed of an optically absorptive material, which may absorb light 90112, or light 90122, or light 90132, when such light radiates upon layer 9104 and thus may reduce optical noise that sensor 9012 or sensor 9013 senses. Layer 9104 may be composed of single layer or a multi-layer structure, with each layer being any of: silicon nitride (SiN), silicon oxide (SiOx), silicon carbide (SiC), aluminum oxide (AlOx), aluminum nitride (A1N), zinc oxide (ZnOx), titanium nitride (TiN), titanium oxide (TiOx), magnesium oxide (MgO), diamond like carbon (DLC), tantalum nitride (TaN), tantalum oxide (TaOx), tungsten (W), aluminum titanium nitride (AlTiN), graphene. Layer 9104 may include of any of: Si, Cu, Fe, Ti, Ta, Al, C, N, O, Tb, Sb, Ni, Cr, B, Ag, Au, Pt, Sn, Ir, Mn, Ru, W, Be, Re, Hf, Nb, Mo, Zr, Cr, V, Mg, Rh, Pd. Layer 9104 may be coated by any of: PVD, CVD, ALD. PECVD, PEALD, MBE.

FIG. 112A illustrates an embodiment of an optical detector having illuminator array and forward scatter sensor array being used to detect a small size biological entity. FIG. 112A is same as FIG. 111A in all other aspects, except: illuminator 9011 of FIG. 111A of detector 901 may be replaced with illuminator array of FIG. 112A that contains five individual illuminators 901101, 901102, 901103, 901104, 901105, forward scatter sensor 9013 of FIG. 111A of detector 901 may be replaced with forward scatter sensor array of FIG. 112A that contains five individual sensors 901301, 901302, 901303, 901304, 901305, while each of said individual illuminator and individual sensor may terminate at channel wall 60112. Back scatter sensor 9012 of FIG. 111A of detector 901 may be removed in FIG. 112A. FIG. 112A shows that illuminator 901103 emits light 90112 towards a small entity 613 in the channel, which may be carried within channel 601/6072/910 by flow 6021, or by 6033 which may merge into flow 6043/6071/9101. Due to the small size of the entity 613, light 90112 may be scattered into a widely distributed light 90132 that may be captured by one or more of the sensors within the scatter sensor array, for example by all sensors 901301, 901302, 901303, 901304, 901305.

FIG. 112B is same as FIG. 112A, except that illuminator 901103 emits light 90112 towards a larger entity 1/10/20/30/612, where the larger size of the entity 1/10/20/30/612 may block certain amount of light 90112 and scattered light 90132 from entity 1/10/20/30/612 may be captured by one or more of sensors of the scatter sensor array, but the number of sensors capturing light 90132 being fewer than in FIG. 112A, for example only sensors 901301 and 901305 at the ends of the scatter sensor array as shown in FIG. 112B.

For FIG. 112A and FIG. 112B, each sensor of 901301, 901302, 901303, 901304, 901305, within the scatter sensor array may sense light 90132: (1) at a different light color range or light wavelength range; (2) with different sensitivity; and (3) at different time during passage of entities 1/10/20/30/612/613 through channel 601/607/910. Each illuminator of 901101, 901102, 901103, 901104, 901105 within the illuminator array may emit light 90112 towards center of channel 601/6072/910 at different strength, different optical phase, different polarization, different light emission angle relative to entity 1/10/20/30/612/613, or different light emission time during passage of entities 1/10/20/30/612/613 through channel 601/607/910. Individual sensor in sensor array or individual illuminator in illuminator array may have coordinated light sensing and light emission timing. In one embodiment, illuminators 901101, 901102, 901103, 901104, 901105, are separately turned on and off to illuminate light 90112 towards center of channel 601/6072/910, and one or more of the sensors 901301, 901302, 901303, 901304, 901305, capture light 90132 simultaneously after each individual emission of light 90112 by an individual illuminator of the illuminator array. In another embodiment, illuminators 901101, 901102, 901103, 901104, 901105, are separately turned on and off to illuminate light 90112 towards center of channel 601/6072/910, and each of the sensors 901301, 901302, 901303, 901304, 901305, sequentially, or separately, or individually, captures light 90132 after each individual emission of light 90112 by an individual illuminator of the illuminator array. In one embodiment, illuminator array may contain only one illuminator while scatter sensor array may contain more than one sensor. In another embodiment, illuminator array may contain more than one illuminator, while scatter sensor array may contain only one sensor. Although FIG. 112A and FIG. 112B show illuminator array and scatter sensor array in one-dimensional array formation, either illuminator array or scatter sensor array may be in the form of a two-dimensional array formation, with illuminators or sensors existing in directions into or out of the viewing plane of FIG. 112A and FIG. 112B. Lock-in-amplification operation as described in FIG. 111A, may be performed by driving first modulation signal to modulate intensity of light 90112 emitted by one or more illuminators 901101, 901102, 901103, 901104, 901105 of illuminator array either simultaneously or individually or sequentially, at a modulation frequency. Detected optical signal from scattered light 90132 may be obtained from one or more of sensors 901301, 901302, 901303, 901304, 901305, either simultaneously or individually or sequentially, and then may be converted to second electrical signal, and a lock-in-amplification operation may then be similarly performed as described in FIG. 111A.

FIG. 113A illustrates an embodiment of an optical detector having one illuminator 9011 and forward scatter sensor array containing sensors 901301, 901302, 901303, 901304, 901305, being used to detect a biological entity 1/10/20/30/612 at a first entity position 11501 within channel 601/6072/910. In FIG. 113A, illuminator 9011 may emit light 90112 towards center of channel 601/6072/910. At position 11501, due to size, shape, optical opacity, or optical reflectivity of entity 1/10/20/30/612, scatter light 90132 from entity 1/10/20/30/612 with illumination light 90112 may be mainly captured by sensors 901303, 901304, or 901305 as shown in FIG. 113A, while sensors 901301 and 901302 may not capture sufficient optical signal from scattered light 90132 due to their position relative to entity 1/10/20/30/612 and illuminator 9011 in FIG. 113A. Light 90132 property including any of: intensity, color, light wavelength, polarization, phase, modulation, of light 90132 captured by each individual sensors of 901303, 901304, or 9013, may be different. Each of components 9011, 901301, 901302, 901303, 901304, 901305 may terminate at channel wall 60112.

FIG. 113B illustrates FIG. 113A entity 1/10/20/30/612 further moving along channel 601/6072/910 within flow 6021/6043/6071/9101 to a new position 11502. In FIG. 113B, illuminator 9011 may emit light 90112 towards center of channel 601/6072/910. At position 11502, due to size, shape, optical opacity, or optical reflectivity of entity 1/10/20/30/612, scatter light 90132 from entity 1/10/20/30/612 with illumination light 90112 may be mainly captured by sensors 901301, 901302, or 901305 as shown in FIG. 113B, while sensors 901303 and 901304 may not capture sufficient optical signal from scattered light 90132 due to their position relative to entity 1/10/20/30/612 and illuminator 9011 in FIG. 113B. With entity 1/10/20/30/612 position change from 11501 of FIG. 113A to 11502 of FIG. 113B, sensors 901301, 901302, 901303, 901304, 901305 may capture different scatter light spatial distribution as described in FIG. 113A and FIG. 113B with sensors that capture scatter light 90132 being varied with position 11501 change to position 11502.

FIG. 114A illustrates an embodiment of an optical detector having illuminator array containing illuminators 901101, 901102, 901103, 901104, 901105 and forward scatter sensor 9013 being used to detect a biological entity 1/10/20/30/612 at a first entity position 11601 in channel 601/607/910 with operating a first illuminator 901101. In FIG. 114A, illuminator 901101 may emit light 90112 towards center of channel 601/6072/910, while other illuminators may not emit light 90112. At position 11601, due to size, shape, optical opacity, or optical reflectivity of entity 1/10/20/30/612, and relative positions between entity 1/10/20/30/612, illuminator 901101 and sensor 9013, scatter light 90132 from entity 1/10/20/30/612 with illumination light 90112 may not reach sensor 9013, or not be detected by sensor 9013 with sufficient optical signal in FIG. 114A. Each of components 9013, 901101, 901102, 901103, 901104, 901105, may terminate at channel wall 60112.

FIG. 114B is same as FIG. 114A, except in FIG. 114B, illuminator 901104 may emit light 90112 towards center of channel 601/6072/910, while other illuminators may not emit light 90112. At position 11601, due to size, shape, optical opacity, or optical reflectivity of entity 1/10/20/30/612, and relative positions between entity 1/10/20/30/612, illuminator 901104 and sensor 9013, scatter light 90132 from entity 1/10/20/30/612 with illumination light 90112 may be detected by sensor 9013 with a first optical signal intensity in FIG. 114B.

FIG. 114C illustrates FIG. 114A entity 1/10/20/30/612 further moving along channel 601/6072/910 within flow 6021/6043/6071/9101 to a new position 11602. In FIG. 114C, illuminator 901101 may emit light 90112 towards center of channel 601/6072/910, while other illuminators may not emit light 90112. At position 11602, due to size, shape, optical opacity, or optical reflectivity of entity 1/10/20/30/612, and relative positions between entity 1/10/20/30/612, illuminator 901101 and sensor 9013, scatter light 90132 from entity 1/10/20/30/612 with illumination light 90112 may reach sensor 9013 or be detected by sensor 9013 with sufficient optical signal as in FIG. 114C.

FIG. 114D is same as FIG. 114C, except in FIG. 114D, illuminator 901104 may emit light 90112 towards center of channel 601/6072/910, while other illuminators may not emit light 90112. At position 11602, due to size, shape, optical opacity, or optical reflectivity of entity 1/10/20/30/612, and relative positions between entity 1/10/20/30/612, illuminator 901104 and sensor 9013, scatter light 90132 from entity 1/10/20/30/612 with illumination light 90112 may not reach or not be detected by sensor 9013 with sufficient optical signal in FIG. 114D.

FIG. 114A together with FIG. 114B, and FIG. 114C together with FIG. 114D, illustrate two individual illuminators 901101 and 901104 being separately operating and emitting light 90112. In one embodiment, illuminators 901101, 901102, 901103, 901104, 901105 may be sequentially, or individually, operating and emitting light 90112 while other illuminators do not emit light 90112, and sensor 9013 may be used to detect scatter light 90132 after each of individual illuminators 901101, 901102, 901103, 901104, 901105 emits light 901102, and may also be used to produce a sensed light 90132 property including any of: intensity, color, light wavelength, polarization, phase, modulation, of light 90132 detected by sensor 9013 after individual emission of light 90112 by each individual illuminator of 901101, 901102, 901103, 901104, 901105 at either position 11601 or position 11602.

FIG. 115A illustrates an example of detector signal strength at different sensor positions for FIG. 113A and FIG. 113B embodiment. FIG. 115A shows that at position 11501 of FIG. 113A, light 90112 emitted from illuminator 9011 towards center of channel 601/6072/910, may be blocked by entity 1/10/20/30/612 and sensors 901301 and 901302 may detect lowest strength light signal from light 90132 as indicated by the lowest bars, while sensors 901303, 901304, and 901305 may detect full strength light signal from light 90132 as indicated by the highest bars. FIG. 115A also shows that at position 11502 of FIG. 113B, entity 1/10/20/30/612 moves with flow 6021/6043/6071/9101 further towards sensor 901305, and thus sensors 901301 and 901305 may detect full strength light signal from light 90132 as indicated by the highest bar, sensors 901303 and 901304 may detect lowest strength light signal from light 90132 as indicated by the lowest bars, and sensor 901302 may detect medium strength light signal from light 90132 as indicated by the medium height bar. From detected light signal strength levels of sensors 901301, 901302, 901303, 901304, and 901305 at positions 11501 and 11502 as shown in FIG. 115A, and by including information from any of: physical or designed location of illuminator 9011; physical or designed location of each of said sensors; designated or designed detectable light wavelength of each of said sensors; operating timing or sequence of each of said sensors; or designated or designed detectable light polarization of each of said sensors, information related to entity 1/10/20/30/612 may be obtained, such information may include any of: (1) size, shape, surface scattering property, optical opacity, material composition, moving speed of entity 1/10/20/30/612; (2) number of colors, or number of types, of fluorescent molecules attached to entity 1/10/20/30/612, and may include numbers of molecules, or emitted optical light intensity, from each of said color, or each of said type, of said fluorescent molecules; (3) entity 1/10/20/30/612 being a single entity, or a cluster of multiple entities, or a conglomerate of multiple entities; (4) physical location of entity 1/10/20/30/612 within the channel 601/6072/910; (5) distances of entity 1/10/20/30/612 from one or more channel walls of the channel 601/6072/910.

FIG. 115B illustrates an example of detector 9013 signal strength at different illuminator positions for FIG. 114A through FIG. 114D embodiment. FIG. 115B shows that at position 11601 of FIG. 114A and FIG. 114B, light 90112 emitted from illuminator 901101 towards center of channel 601/6072/910, may be blocked by entity 1/10/20/30/612 and sensors 9013 may detect lowest strength light signal from light 90132 as indicated by the lowest bar correlating to 901101, while light 90112 emitted from illuminator 901104 towards center of channel 601/6072/910, may cause light 90132 detected by sensor 9013 at highest strength light signal as indicated by the highest bar correlating to 901104. FIG. 115B also shows that at position 11601, sensor 9013 detects lowest light intensity of 90132 when emitter 901102 emits light 90112, medium light intensity of 90132 when emitter 901103 emits light 90112, highest light intensity of 90132 when emitter 901105 emits light 90112. FIG. 115B also shows that at position 11602 of FIG. 114C and FIG. 114D, entity 1/10/20/30/612 moves further towards illuminator 901105. At position 11602, sensor 9013 detects strongest light intensity of 90132 when emitters 901101, 901102, 901103 each individually emits light 90112, medium light intensity of 90132 when emitter 901104 emits light 90112, lowest light intensity of 90132 when emitter 901105 emits light 90112. From detected light signal strength levels by sensor 9013 for illuminators 901101, 901102, 901103, 901104, and 901105 at positions 11601 and 11602 as shown in FIG. 115B, and by including information from any of: physical or designed location of sensor 9013; physical or designed location of each of said illuminators; designated or designed illuminating light 90112 wavelength from each of said illuminators; operating timing or sequence of each of said illuminators; or designated or designed light polarization of each of said illuminators, information related to entity 1/10/20/30/612 may be obtained, such information may include any of: (1) size, shape, surface scattering property, optical opacity, material composition, moving speed of entity 1/10/20/30/612; (2) number of colors, or number of types, of fluorescent molecules attached to entity 1/10/20/30/612, and may include numbers of molecules, or emitted optical light intensity, from each of said color, or each of said type, of said fluorescent molecules; (3) entity 1/10/20/30/612 being a single entity, or a cluster of multiple entities, or a conglomerate of multiple entities; (4) physical location of entity 1/10/20/30/612 within the channel 601/6072/910; (5) distances of entity 1/10/20/30/612 from one or more channel walls of the channel 601/6072/910; (6) existence of entity 1/10/20/30/612.

FIG. 116A illustrates an embodiment of an optical detector having illuminator array and forward scatter sensor array being used to detect shape of a biological entity at a first entity position with operating a first illuminator. FIG. 116A is same as FIG. 112A and FIG. 112B, where illuminator array containing five individual illuminators 901101, 901102, 901103, 901104, 901105, and sensor array containing five individual sensors 901301, 901302, 901303, 901304, 901305 are used, where each individual illuminator and individual sensor may terminate at channel wall 60112. In FIG. 116A, illuminators 901101, 901102, 901103, 901104, 901105 may be individually enabled and operated to emit light 90112 towards center of channel 601/6072/910, while sensors 901301, 901302, 901303, 901304, 901305 may sense scatter light 90132, or in some cases emission light 90112, simultaneously or individually. FIG. 116A shows an operation step 11803 where illuminators 901101, 901102, 901104, 901105 are disabled, and only illuminator 901103 emits light 90112, while sensors 901301, 901302, 901303, 901304, 901305 may sense scatter light 90132, and may also sense emission light 90112 in one embodiment. In FIG. 116A, due to the position, orientation and shape of the entity 1/10/20/30/612 within the channel 601/6072/910, sensors 901301, 901302, 901303 may detect stronger light 90132 signal and sensors 901304, 901305 may detect lower light 90132 signal.

FIG. 116B is same as FIG. 116A, except FIG. 116B illustrates another operation step 11805 where illuminators 901101, 901102, 901103, 901104 are disabled, and only illuminator 901105 emits light 90112, while sensors 901301, 901302, 901303, 901304, 901305 may sense scatter light 90132, and may also sense emission light 90112 in one embodiment. In FIG. 116B, due to the position, orientation and shape of the entity 1/10/20/30/612 within the channel 601/6072/910, sensors 901301, 901303, 901304, 901305 may detect stronger light 90132 signal and sensor 901302 may detect lower light 90132 signal.

FIG. 117 illustrates example of detector signal strength at different sensor positions for FIG. 116A and FIG. 116B embodiments where illuminator array elements are individually operated. Light intensity detected by sensors 901301, 901302, 901303, 901304, 901305 is described by vertical bar for each sensor, where a higher bar indicates a stronger detected light intensity, and a lower bar indicates a lower detected light intensity. Step 11803 of FIG. 117 corresponds to step 11803 of FIG. 116A where sensors 901301, 901302 may detect strongest 90132 light signal, 901303 may detect medium 90132 light signal and sensors 901304, 901305 may detect lowest light 90132 signal. Step 11805 of FIG. 117 corresponds to step 11805 of FIG. 116B, where sensors 901301 may detect strongest 90132 light signal, sensor 901302 may detect lowest light 90132 signal, 901303, 901304, 901305 may detect increasingly stronger light 90132 signal. In FIG. 117, step 11801 then describes the operation step where only illuminator 901101 emits light 90112, step 11802 describes the operation step where only illuminator 901102 emits light 90112, and step 11804 describes the operation step where only illuminator 901104 emits light 90112, in FIG. 116A or FIG. 116B, while sensors 901301, 901302, 901303, 901304, 901305 may sense scatter light 90132, and may also sense emission light 90112 in one embodiment. Bar heights in operation steps 11801, 11802, and 11804 describe detected light intensity by each of sensors 901301, 901302, 901303, 901304, 901305 in each said operation step. With the variation of detected light intensity at each of sensors 901301, 901302, 901303, 901304, 901305, including light 90132, and light 90112 in one embodiment, at different operation steps of FIG. 117 where illuminators are individually operated, information of entity 1/10/20/30/612 may be extracted, including any of: (1) existence of entity 1/10/20/30/612; (2) size, shape, surface scattering property, optical opacity, material composition, moving speed of entity 1/10/20/30/612; (3) number of colors, or number of types, of fluorescent molecules attached to entity 1/10/20/30/612, and may include numbers of molecules, or emitted optical light intensity, from each of said color, or each of said type, of said fluorescent molecules; (4) entity 1/10/20/30/612 being a single entity, or a cluster of multiple entities, or a conglomerate of multiple entities; (5) physical location of entity 1/10/20/30/612 within the channel 601/6072/910; (6) distances of entity 1/10/20/30/612 from one or more channel walls of the channel 601/6072/910. shape, orientation, position within channel 601/6072/910, Illuminators 9011, 901101, 901102, 901103, 901104, 901105 of FIG. 112A through FIG. 117 may each be a multi-color LED or micro-LED unit. Illuminators 901101, 901102, 901103, 901104, 901105 may each also be a LED or micro-LED unit within a multi-color LED or micro-LED array or display. Each of said multi-color LED or micro-LED unit may contain multiple light emission components, with each said light emission component capable of emitting light at a different light wavelength or color, for example light emission components including LEDs or micro-LEDs emitting red, green and blue lights. Illuminators 9011, 901101, 901102, 901103, 901104, 901105, may be used to emit light 90112 at different colors or color combinations, for example alternating in emission of red, green, and blue lights from the same illuminator at different time. Sensors 9013, 901301, 901302, 901303, 901304, 901305 of FIG. 112A through FIG. 117 may each be a monochrome or a multi-color sensing unit, for example a CMOS sensing unit. Sensors 901301, 901302, 901303, 901304, 901305 may each be a sensing unit within a monochrome or multi-color sensing array, for example a pixel within a monochrome or color CMOS image sensor. Sensors 9011, 901301, 901302, 901303, 901304, 901305 may detect light 90132 at different colors, and may detect strength of light 90132 at said different colors. Illuminators 9011, 901101, 901102, 901103, 901104, 901105 may each produce light 90112 in form of light pulses. Sensors 9013, 901301, 901302, 901303, 901304, 901305 may each sense light 90132 in form of shuttered sensing within a designated time window.

In one embodiment, illuminators 9011, 901101, 901102, 901103, 901104, 901105 of FIG. 112A through FIG. 117 may be placed in a spatially periodic arrangement and may produce spatially periodic illumination light 90112 upon entity 1/10/20/30/612 when entity 1/10/20/30/612 passes through illumination region of illuminator 9011 of optical detector 910. Such spatially periodic illumination created by spatially periodic illuminators additionally may induce a production of temporally periodic scattered light 90132 when entity 1/10/20/30/612 passes through illumination region of illuminator 9011, especially when flow speed of entity 1/10/20/30/612 within flow 6021/6043/6071/9101 is substantially constant, where said temporally periodic scattered light 90132 may in turn produce a detected periodic signal by sensor 9013 or sensors 901301, 901302, 901303, 901304, 901305, at a frequency that may correlate to said spatial period of said illuminators 9011, 901101, 901102, 901103, 901104, 901105 and may correlate to the flow speed of entity 1/10/20/30/612 passing through the illumination region of illuminator 9011, for example said frequency may be calculated as said flow speed of said entity divided by said spatial period of said illuminators, wherein a band pass filter, or a low pass filter, or a high pass filter, which may be implemented by electronics of controller 950, 954, or by program of computing device 955 of FIG. 120A through FIG. 122C, may be applied to said detected periodic signal by sensor 9013 or sensors 901301, 901302, 901303, 901304, 901305 to enhance signal detection from entity 1/10/20/30/612 and may be used to reduce noise from other entities 2/3/22/613.

FIG. 118A illustrates an embodiment of an optical detector having illuminator 9011, forward scatter sensors 9013 and back scatter sensors 9012 embedded in substrate 611 where channel 601/6072/910 is formed, but having optical components 930 positioned between wall of channel 601/6072/910 and each of said illuminator and sensors. FIG. 118A is substantially similar to FIG. 111A, except the optical components 930 being used as optical intermediate path between channel 601/6072/910 wall and said illuminator and sensors. Optical components 930 may be composed of an optically transmitting material, and may be composed of single layer or a multi-layer structure, with each layer being any of: silicon nitride (SiN), silicon oxide (SiOx), silicon carbide (SiC), aluminum oxide (A10*x*), aluminum nitride (A1N), zinc oxide (ZnOx), titanium nitride (TiN), titanium oxide (TiOx), magnesium oxide (MgO), diamond like carbon (DLC), graphene. Optical components 930 may include of any of: Si, Cu, Fe, Ti, Ta, Al, C, N, O, Tb, Sb, Ni, Cr, B, Ag, Au, Pt, Sn, Ir, Mn, Ru, W, Be, Re, Hf, Nb, Mo, Zr, Cr, V, Mg, Rh, Pd. Optical components 930 may be deposited within substrate 611 by any of: PVD, CVD, ALD. PECVD, PEALD, MBE. Each of optical components 930 may have one end terminating at the channel 601/6072/910 wall 60112 and being in contact with flow 6021/6043/6071/9101, and another end being in contact with, or aligned to, at least one of the illuminator 9011, sensors 9013 and 9012. Each of optical components 930 may be chemically, or physically, or biologically compatible with compositions of flow 6021/6043/6071/9101, may show minimal degradation of material integrity and quality of light transmission of each of optical components 930. Each of optical components 930 may function as an optical filter that has different optical wavelength passage property and provides optical filtering for the illuminator 9011, sensors 9013 and 9012 that each of said optical components 930 is in contact with or aligned to. For example, optical components 930 in contact with sensors 9012 and 9013 may allow passage of light 90132, from FIG. 111A through FIG. 116B, that is scattered from, or emitted from, entity 1/10/20/30/612 to pass through while blocking light 90112 emitted from illuminator 9011, thus enabling sensing of scattered light 90132 without interference from light 90112. Each of optical components 930 may function as an optical polarizer that produces optical polarization on light 90132 or 90112 that passes through or selectively pass light 90132 or 90112 with a matching polarization. Each of optical components 930 may function as an optical lens that produces optical focusing, optical bending, optical diffraction, or optical divergence on light 90132 or 90112 that passes through said optical components 930. For example, optical component 930 attached to, or aligned to, illuminator 9011 may focus light 90112 to a narrower light beam towards center of channel 601/6072/910 to achieve better spatial resolution during illumination by light 90112. As another example, optical component 930 attached to, or aligned to, sensor 9013 may focus light 90132 to a narrower light beam towards sensor 9013 to achieve higher optical sensitivity or optical signal during detections by sensor 9013.

In FIG. 118A, illuminator 9011 may be replaced with illuminator array, for example illuminators 9011, 901101, 901102, 901103, 901104, 901105, and sensor 9013 may be replaced with sensor array, for example sensors 9013, 901301, 901302, 901303, 901304, 901305, as in FIG. 112A through FIG. 116B, where optical components 930 may exist on one or more of each of said illuminators or said sensors.

FIG. 118B illustrates an embodiment of an optical detector having illuminator 9011, forward scatter sensors 9013 and back scatter sensors 9012 positioned one the UFL outside surface facing the UFL channel 601/6072/910 walls, and having optical components 930 positioned between channel walls 60112 and each of illuminator 9011 and sensors 9012 and 9013. FIG. 118B is same as FIG. 118A, except that illuminator 9011, sensors 9012 and 9013 are not embedded in substrate 611, but rather externally attached to, or externally formed upon, the outside walls 60114 of the substrate 611. Optical components 930 in FIG. 118B, are same as in FIG. 118A, except the optical components 930 have one end terminating at channel wall surface 60112 of channel 610/6072/910, same as in FIG. 118A, but another end terminates at the outside walls 60114 of the substrate 611, connecting to, or aligned to, illuminator 9011, or sensors 9012 and 9013. In FIG. 118B, illuminator 9011 may be replaced with illuminator array, for example illuminators 901101, 901102, 901103, 901104, 901105, and sensor 9013 may be replaced with sensor array, for example sensors 901301, 901302, 901303, 901304, 901305, as in FIG. 112A through FIG. 116B, where optical components 930 may exist on one or more of each of said illuminators or said sensors.

In FIG. 118B, illuminator 9011, and sensors 9012 and 9013, may not be part of the substrate 611 but rather separated devices that may be physically aligned to each corresponding optical component 930, to produce illumination light 90112 into the channel 601/6072/910, or to detect light 90122 and 90132 from channel 601/6072/910 through the optical components 930. The substrate 611 external walls 60114 where illuminator 9011, and sensors 9012 and 9013 may be positioned may be parallel to the channel walls of channel 601/6072/910, and optical components 930 may be substantially straight optical pathways.

FIG. 119A illustrates an embodiment of an optical detector having illuminator 9011, forward scatter sensors 9013 and back scatter sensors 9012 positioned on the UFL substrate surface facing the UFL channel 601/6072/910 bottom surface 60115, and having optical components 930 positioned between channel 601/6072/910 side walls 60112 and each of illuminator 9011 and sensors 9012 and 9013 to conduct light 90112 out of illuminator 9011, light 90122 into sensor 9012, and light 90132 into sensors 9013. FIG. 119A is substantially same as FIG. 118B in every other aspect, except the illuminator 9011, sensors 9012 and 9013 are either attached to, or externally positioned against the UFL substrate surface 60115 opposing the bottom surface 60113 of channel 601/6072/910. In FIG. 119A, optical components 930 are embedded in substrate 611 of UFL, however may have curved shapes to achieve light conduction between the side walls of channel 601/6072/910 and illuminator 9011, sensors 9012 and 9013. Similar as in FIG. 118B, in FIG. 119A, illuminator 9011, and sensors 9012 and 9013, may not be part of the substrate 611 but rather separated devices that may be physically aligned to each corresponding optical components 930, to produce illumination light 90112 into the channel 601/6072/910, or to detect light 90122 and 90132 from channel 601/6072/910 through the optical components 930. In FIG. 119A, illuminator 9011 may be replaced with illuminator array, for example illuminators 901101, 901102, 901103, 901104, 901105, and sensor 9013 may be replaced with sensor array, for example sensors 901301, 901302, 901303, 901304, 901305, as in FIG. 112A through FIG. 116B, where optical components 930 may exist on one or more of each of said illuminators or said sensors.

FIG. 119B illustrates another embodiment of an optical detector having illuminator 9011, forward scatter sensors 9013 and back scatter sensors 9012 positioned on the UFL cover surface 60116 facing the UFL channel 601/6072/910 top surface 60111, and having optical components 930 positioned between channel 601/6072/910 side walls and each of illuminator 9011 and sensors 9012 and 9013 to conduct light 90112 out of illuminator 9011, light 90122 into sensor 9012, and light 90132 into sensors 9013. FIG. 119B is identically to FIG. 119A in every other aspect except the optical components 930 are conducting light 90112, 90122 and 90132 between 601/6072/910 side walls 60112 and top cover 610 of UFL. In FIG. 119B, top cover 610 may be composed of a transparent material, or optically transmitting material that allows light of certain wavelength values to pass through with lower loss than other wavelength values. In FIG. 119B, optical components 930 may not be in contact with illuminator 9011, forward scatter sensors 9013 and back scatter sensors 9012, but rather aligned with the positions of illuminator 9011, forward scatter sensors 9013 and back scatter sensors 9012, thus light 90112, 90122 and 90132 passes through both the optical components 930 and top cover 610. In another embodiment, top cover 610 may have physical clearances 93011 corresponding to optical components 930 positions and illuminator 9011, forward scatter sensors 9013 and back scatter sensors 9012 positions, such that light 90112, 90122 and 90132 pass through said clearances 93011 and said optical components 930, where said clearances 93011 may be filled with transparent or optical filter material within said cover 610. In FIG. 119B, optical components 930 are embedded in substrate 611 of UFL, however may have curved shapes to achieve light conduction between the side walls of channel 601/6072/910 and illuminator 9011, sensors 9012 and 9013. Similar as in FIG. 119A, in FIG. 119B, illuminator 9011, and sensors 9012 and 9013, may not be part of the cover 610 but rather separated devices that may be physically aligned to each corresponding optical components 930, to produce illumination light 90112 into the channel 601/6072/910, or to detect light 90122 and 90132 from channel 601/6072/910 through the optical components 930 and cover 610. In FIG. 119B, illuminator 9011 may be replaced with illuminator array, for example illuminators 901101, 901102, 901103, 901104, 901105, and sensor 9013 may be replaced with sensor array, for example sensors 901301, 901302, 901303, 901304, 901305, as in FIG. 112A through FIG. 116B, where optical components 930 may exist on one or more of each of said illuminators or said sensors.

FIG. 120A illustrates an embodiment of an optical detector 901 having illuminator 9011, forward scatter sensors 9013 and back scatter sensors 9012 with controller 950 of the optical detector 901 embedded in the UFL substrate 611. FIG. 120A is same as FIG. 111C, except that the illuminator 9011, forward scatter sensors 9013 and back scatter sensors 9012 are connected to the embedded controller 950 through electrical connections 951, where electrical connections 951 may also be embedded within substrate 611. Controller 950 may be composed of electrical components including any of but not limited to: transistors, logic components, logic circuits, digital processor, digital signal processor, analog component, analog processor, analog circuits, analog to digital converter, digital to analog converter, digital amplifier, analog amplifier, data storage component, digital communication component, image processor, LED driver, OLED driver, photo diode driver, voltage driver, current driver, voltage sensor, current sensor, piezo driver, lock-in amplifier, phase-lock controller. Controller 950 connects to the optical components including: illuminator 9011, forward scatter sensors 9013 and back scatter sensors 9012, through electrical connections 951 to perform any of, but not limited to: providing power to said optical components, adjusting function parameters of said optical components, sensing optical signal detected by one or more of said optical components. Connections 951 may be conductive lines composed of any element of: copper, tungsten, tantalum, titanium, nitrogen, gold, silver, iridium, hafnium, iron, carbon. Controller 950 may be formed, or fabricated, within substrate 611 as a logic layer composed of semiconductor components prior to forming, or fabrication of, channel 601/6072/910, and illuminator 9011, forward scatter sensors 9013 and back scatter sensors 9012, in substrate 611, where controller 950 may be fabricated in a first manufacturing facility and channel 601/6072/910 may be fabricated in a second manufacturing facility. Substrate 611 may be composed of two distinctive layers, with a second layer overlapping a first layer, where controller 950 may be fabricated and contained within first layer, and channel 601/6072/910 may be fabricated within second layer, and where first and second layers of substrate 611 may be composed of materials including any of: glass, silicon, quartz, plastic, metal, AlTiC and quartz. An annealing process of said first layer of substrate 611 may be performed before second layer is formed on top of said first layer. An annealing step may be performed after forming of electrical connections 951 and before second layer is formed. An annealing step may be performed after second layer is formed on first layer. An annealing step may be performed after cover 610 is positioned, or attached to, substrate 611. Said second layer may be formed on said first layer by any of: PVD or CVD film deposition, electroplating, spin coating, injection molding, or direct physical placement.

FIG. 120B illustrates an embodiment of an optical detector 901 having illuminator 9011, forward scatter sensors 9013 and back scatter sensors 9012 embedded in UFL substrate 6011 with controller 954 of the optical detector 901 being outside the UFL substrate 611. FIG. 120B is a variation from FIG. 120A, where all other aspects are same, except controller 950 in FIG. 120A becomes controller 954 in FIG. 120B positioned outside of ULF substrate 611. In FIG. 120B, electrical connections 951 may connect to illuminator 9011, forward scatter sensors 9013 and back scatter sensors 9012 and terminate at surface electrical contacts 952 on the one or more of the external surfaces

60114/60115 of the substrate 611. Electrical connections 951 may be embedded within substrate 611. Surface electrical contacts 952 may be composed of any of, but not limited to: copper, silver, gold, tungsten, iridium, aluminum. Surface electrical contacts 952 may be in the form of surface contact pads; may be deposited on substrate 611 by any of: PVD or CVD film deposition, electroplating, vacuum plating, spin coating, or direct physical placement; and may be further formed into pad shape by any of: dry etch, wet etch. Electrical connections 953 external to substrate 611 then connect between surface electrical contacts 952 and the external controller 954. Through electrical connections 951 and 953, and surface electrical contacts 952, controller 954 electrically connects to illuminator 9011, and sensors 9012 and 9013, and controller 954 functions same as controller 950 as in FIG. 120A. Controller 954 may be composed of electrical components including any of but not limited to: logic components, logic circuits, digital processor, digital signal processor, analog component, analog processor, analog circuits, analog to digital converter, digital to analog converter, digital amplifier, analog amplifier, data storage component, digital communication component, image processor, LED driver, OLED driver, photo diode driver, voltage driver, current driver, voltage sensor, current sensor, piezo driver, lock-in amplifier, phase-lock controller. Controller 954 may perform any of, but not limited to: providing power to optical components 9011, 9012, or 9013, adjusting function parameters of said optical components, sensing optical signal detected by one or more of said optical components. Connections 951 may be conductive lines composed of any element of: copper, tungsten, tantalum, titanium, nitrogen, gold, silver, iridium, hafnium, iron, carbon. Connections 951 may be formed, or fabricated, within substrate 611 as a logic layer, and may be composed of semiconductor components prior to forming, or fabrication of, channel 601/6072/910, and illuminator 9011, forward scatter sensors 9013 and back scatter sensors 9012, in substrate 611, where connections 951 may be fabricated in a first manufacturing facility and channel 601/6072/910 may be fabricated in a second manufacturing facility. Substrate 611 may be composed of two distinctive layers, with a second layer overlapping a first layer, where connections 951 may be fabricated and contained within first layer, and channel 601/6072/910 may be fabricated within second layer, and where first and second layers of substrate 611 may be composed of materials including any of: glass, silicon, quartz, plastic, metal, AlTiC and quartz. An annealing process of said first layer of substrate 611 may be performed before second layer is formed on top of said first layer. An annealing step may be performed after forming of electrical connections 951 and before second layer is formed. An annealing step may be performed after second layer is formed on first layer. An annealing step may be performed after cover 610 is positioned, or attached to, substrate 611. Said second layer may be formed on said first layer by any of: PVD or CVD film deposition, electroplating, spin coating, injection molding, or direct physical placement. Connections 953 may be in the form of electrical probes that make electrical connection to surface contacts 952 through surface-to-surface contact. Connections 953 may be made part of controller 954. Controller 954 may be part of, or attached to, a computing device 955 as described in FIG. 121A.

FIG. 121A illustrates an embodiment of FIG. 120A controller 950 of the optical detector 901 communicating with and external computing device 955 through electrical connections 9501, 952 and 953. In FIG. 121A, electrical connections 9501 may connect to embedded controller 950 and terminate at surface electrical contacts 952 on the one or more of the external surfaces 60114/60115 of the substrate 611. Surface electrical contacts 952 of FIG. 121A are same as in FIG. 120B. Electrical connections 953 external to substrate 611 then connect between surface electrical contacts 952 and the external computing device 955. Through electrical connections 9501 and 953, and surface electrical contacts 952, computing device 955 electrically connects to controller 950, where computing device 955 may provide power to controller 950, and may communicate with, send command to, receive information from, and exchange data with, controller 950. Computing device 955 may contain hardware, electronics, software, algorithm, internet, data storage component, and database that may enable computing device 955 to control detector 901 through controller 950. Connections 9501 may be conductive lines composed of any element of: copper, tungsten, tantalum, titanium, nitrogen, gold, silver, iridium, hafnium, iron, carbon. Electrical connections 9501 may be embedded within substrate 611 similar as connections 951 of FIG. 120A. In one embodiment, connections 9501 and 951 may be formed, or fabricated, in substrate 611 in same step, as described in FIG. 120A. Connections 953 may be in the form of electrical probes that make electrical connection to surface contacts 952 through surface-to-surface contact. Connections 953 may be made part of computing device 955.

FIG. 121B illustrates an embodiment of FIG. 120A controller 950 of the optical detector 901 communicating with external computing device 955 through wireless means 9502 and 9504. In FIG. 121B, electrical connections 9503 may connect between embedded controller 950 and a wireless communication unit 9502, where communication unit 9502 may be embedded in substrate 611. External computing device 955 connects to an external wireless communication unit 9504 through electrical connections 9505 external to substrate 611. Communication units 9502 and 9504 may each contain any of: an inductive coil, a wireless communication antenna, optical emitter, optical sensor, wireless communication electronics. Communication units 9502 and 9504 may transfer electrical power, analog signal or digital signal between each other through any mean of: inductive coupling, RF coupling, optical coupling. Through communication units 9502 and 9504 and electrical connections 9503 and 9505, computing device 955 may wirelessly provide power to controller 950, and may communicate with, send command to, receive information from, and exchange data with, controller 950. Computing device 955 may contain hardware, electronics, software, algorithm, interne, data storage component, and database that may enable computing device 955 to control detector 901 through controller 950. Connections 9503 may be conductive lines composed of any element of: copper, tungsten, tantalum, titanium, nitrogen, gold, silver, iridium, hafnium, iron, carbon. Electrical connections 9503 may be embedded within substrate 611 similar as connections 951 of FIG. 120A. In one embodiment, connections 9503 and 951 may be formed, or fabricated, in substrate 611 in same step, as described in FIG. 120A. Connections 9505 and wireless communication unit 9054 may be made part of computing device 955.

FIG. 122A illustrates an embodiment of electrically controlled optical filter 9301 positioned between UFL channel 601/6072/910 wall 60112 and FIG. 118A illuminator 9011 and scatter sensors 9012 and 9013. In FIG. 122A, controller 950 is same as controller 950 as described in FIG. 120A through FIG. 121B, and electrical connection 9511 is same as electrical connections 951 as described in FIG. 120A and FIG. 120B. FIG. 122A is a variation from FIG. 118A, where an optical filter 9301 is positioned between the optical component 930 and the illuminator and scatter sensors 9011/9012/9013, with one end of 9301 terminating at channel 601/6072/910 wall 60112. Optical filter 9301 functions to allow optical light of a first wavelength range to pass through with lower loss than a second wave length range. Optical filter 9301 positioned next to different optical components of the illuminator and scatter sensors 9011/9012/9013 may produce different optical filtering effect with allowing different first wavelength range optical light to pass with lower loss. Optical filter 9301 may be any of: optical low pass filter, optical high pass filter, optical band pass filter, optical band stop filter, optical shutter. Optical filter 9301 may provide different optical filtering effect by any of: having different material composition, having different optical coating, being a multilayer thin film structure and having different film stack configuration. In one embodiment, controller 950 through electrical connection 9511 may electrically control the optical filtering effect of optical filter 9301 through electrical voltage or electrical current, where an application of electrical signal from controller 950 may cause optical filter 9301 to allow certain optical light wavelength range to pass through optical filter 9301 with lowest loss, while a change of electrical signal from controller 950 may cause optical filter 9301 to change the optical light wavelength range that may pass through optical filter 9301 with lowest loss. In one embodiment, optical filter 9301 may be composed of liquid crystal (LC) and may be a liquid crystal tunable filter (LCTF), where LCTF may have a tunable optical wavelength between 400 nm to 2450 nm. In another embodiment, optical filter 9301 may be composed of electronic ink. In FIG. 122A, controller 950 may produce an alternating electrical control signal to optical filter 9301 to modulate the light passage intensity through optical filter 9301 corresponding to said alternating control signal, for example within certain optical wavelength range, to realize a lock-in modulation function as described in FIG. 111A. Optical filter 9301 may be embedded within substrate 611 similarly as illuminator 9011 and scatter sensors 9012 and 9013. Optical filter 9301 may be externally inserted into substrate 611 through an opening within substrate 611, where said opening may be formed within substrate 611 during fabrication of UFL 600/6000.

FIG. 122B illustrates an embodiment of electrically controlled optical lens 93021/93022/93023 positioned between UFL channel 601/6072/910 wall 60112 and FIG. 118A illuminator 9011 and scatter sensors 9012 and 9013. FIG. 122B is same as FIG. 122A, except the optical filter 9301 of FIG. 122A is replaced with optical lens 93021/93022/93023 as in FIG. 122B. FIG. 122B is a variation from FIG. 122A, where optical lens 93021/93022/93023 is positioned between the optical component 930 and the illuminator and scatter sensors 9011/9012/9013. Optical lens 93021 may function to focus optical light from illuminator 9011 into the optical component 930 and further into channel 601/6072/910, or to disperse optical light from channel 601/6072/910 into sensors 9012 and 9013. Optical lens 93022 may function to disperse optical light from illuminator 9011 into the optical component 930 and further into channel 601/6072/910, or to focus optical light from channel 601/6072/910 into sensors 9012 and 9013. Optical lens 93023 may function similarly as lens 93021 or similarly as lens 93022. Optical lens 93023 may be attached to a mechanical positioning component 93024, which may move optical lens 93023 in direction 93025 towards or away from channel 601/6072/910, or may move optical lens 93023 in direction 93026 along channel 601/6072/910, wherein said positioning component 93024 may move in direction 93025 or 93026 with movement produced by a transducer comprising any of: piezo electric element, micro-electro-mechanical-system (MEMS), magnetic actuator, thermal expansion actuator, memory alloy. Optical lens 93021/93022/93023 may be any one of, or a combination of multiple of: convex lens, concave lens, cylindrical lens, spherical lens, or prism. Optical lens 93021/93022/93023 may be composed of electrically adjustable optical index material, where optical index of lens 93021/93022/93023 may be adjusted by an electric voltage or an electric current applied to lens 93021/93022/93023, and thus optical focal length of lens 93021/93022/93023 may be adjusted by an electrical signal. Optical lens 93021/93022/93023 may be composed of an optical body containing two or more liquids, where said two or more liquids have different optical index and different dielectric constant, and wherein an applied electric voltage may alter the liquids distribution in said optical body and causing effective optical focal length change of said lens 93021/93022/93023. Optical lens 93021/93022/93023 may be composed of a piezo-optic material, wherein an applied electric voltage may alter the optical index of said material and cause an effective optical focal length change of said lens 93021/93022/93023. In one embodiment, controller 950 through electrical connection 9511 may electrically control the optical index of optical lens 93021/93022/93023 through electrical voltage or electrical current, where an application of electrical signal from controller 950 may cause optical lens 93021/93022/93023 to change its focal length. In one embodiment, controller 950 through electrical connection 9511 may electrically control the positioning component 93024 through electrical voltage or electrical current, where an application of electrical signal from controller 950 may cause component 93024 to move optical lens 93023 in direction 93025 or direction 93026 and thus change the optical focus or optical dispersion behavior through optical lens 93023. In FIG. 122B, controller 950 may produce an alternating electrical control signal to optical lens 93021/93022/93023 or to positioning component 93024 to modulate the light passing through the optical lens 93021/93022/93023 corresponding to said alternating control signal, to realize a lock-in modulation function as described in FIG. 111A. Optical lens 93021/93022/93023 may be embedded within substrate 611 similarly as illuminator 9011 and scatter sensors 9012 and 9013. Optical lens 93021/93022/93023 may be externally inserted into substrate 611 through an opening within substrate 611, where said opening may be formed within substrate 611 during fabrication of UFL 600/6000.

FIG. 122C illustrates an embodiment of using an optical gratings 93031 as optical filter and optionally using electrically positioned optical gratings 93031 between UFL channel 601/6072/910 wall and FIG. 118A illuminator 9011 and scatter sensors 9012/9013. FIG. 122C is same as FIG. 122A, except the optical filter 9301 of FIG. 122A is replaced with optical gratings 93031 as in FIG. 122B. Optical gratings 93031 may function similarly as optical filter 9301 of FIG. 122A to allow light of certain wavelength range to pass from illuminator 9011 into the optical component 930 and further into channel 601/6072/910, or to allow optical light of certain wavelength range from channel 601/6072/910 into sensors 9012 and 9013. Optical filtering effect by optical gratings 93031 may be different from 9301 in the aspect that optical light of different wavelength may pass optical gratings 93031 and exit in different diffraction angles, similar to an optical prism, and thus orientation of optical gratings 93031 may be used to select which optical wavelength passes between channel 601/6072/910 and 9011/9012/9013. Optical gratings 93031 may be formed as periodic straight clearances, including: slits, slots, holes, spaced across a distance that overlap illuminator 9011 and sensors 9012/9013, wherein said clearances may be identical, oriented with an angle, and may be evenly spaced across said distance. Optical gratings 93031 may be fabricated directly from the UFL substrate 611 in area between 9011/9012/9013 and channel 601/6072/910, as a physical structure formed within UFL substrate 611 material by dry etch or wet etch process to remove UFL substrate 611 material and form said clearances of optical gratings 93031. Optical gratings 93031 may also be fabricated as an embedded optical element within UFL substrate 611 with a PVD or CVD process to provide materials forming optical gratings 93031. Optical gratings 93032, same as optical gratings 93031, may be attached to a mechanical positioning component 93024, which may move optical gratings 93032 in direction 93025 towards or away from channel 601/6072/910, or may move optical gratings 93032 in direction 93026 along channel 601/6072/910, or may rotate optical gratings 93032 in direction 93027 to change the orientation of said clearances, wherein said positioning component 93024 may move in direction 93025 or 93026 or 93027 with movement produced by a transducer comprising any of: piezo electric element, micro-electro-mechanical-system (MEMS), magnetic actuator, thermal expansion actuator, memory alloy. In one embodiment, controller 950 through electrical connection 9511 may electrically control the positioning component 93024 through electrical voltage or electrical current, where an application of electrical signal from controller 950 may cause component 93024 to move optical gratings 93032 in direction 93025 or direction 93026 or direction 93027 and thus change the optical filtering effect through optical gratings 93032. In FIG. 122C, controller 950 may produce an alternating electrical control signal to positioning component 93024 to modulate the light passing through the optical gratings 93032 corresponding to said alternating control signal, to realize a lock-in modulation function as described in FIG. 111A. Optical gratings 93031/93032 may be externally inserted into substrate 611 through an opening within substrate 611, where said opening may be formed within substrate 611 during fabrication of UFL 600/6000.

Optical filter 9301 of FIG. 122A and optical gratings 93031 of FIG. 122C, may be combined with optical lens 93021/93022/93023 of FIG. 122B into an in-serial element, which may include one or more optical filter 9301, or one or more optical gratings 93031/93032, or one of more optical lens 93021/93022/93023 arranged in series, to allow optical light from illuminator 9011 to pass through, or to allow optical light from channel 601/6072/910 to pass through, all included filters, gratings, and lenses within said in-serial element.

FIG. 123A through FIG. 123F illustrate an embodiment of method to fabricate embedded illuminator 9011, sensors 9012/9013 and optical component 930 within substrate 611 of UFL 600/6000.

In FIG. 123A, FIG. 118A optical detector 901 components, including illuminator 9011, scatter sensors 9012/9013, optical components 930, as well as filters 9301, lenses 93021/93022/93023, and gratings 93031/93032, may be formed on a first sub-layer 61100 of UFL substrate 611 after a first fabrication step during manufacture process of the UFL 600/6000. During first fabrication step of FIG. 123A, components of optical detector 901 including 9011/9012/9013/930/9301/93021/93022/93023/93031/93032 may be fabricated on sub-layer 61100 with processes including any of: one or more times of deposition of single layer or multi-layer thin film stacks with any process of: PVD, CVD, ALD, MBE, plating; one or more steps of photoresist coating; one or more steps of photoresist exposure with using a photo mask; one or more steps of photoresist development and photoresist removal; one or more steps of dry etch including any of: reactive ion etch (RIE), ion beam etch (IBE), plasma etch (PE), chemical dry etch (CDE); one or more steps of wet etch. After first fabrication step of FIG. 123A, optical detector 901 components 9011/9012/9013/930/9301/93021/93022/93023/93031/93032 may be formed on sub-layer 61100 surface as patterned devices. Sub-layer 61100 may be composed any of: silicon, glass, AlTiC, ceramic, metal, polymer, plastics. After step of FIG. 123A, components of optical detector 901 may appear substantially patterned thin film stack islands on sub-layer 61100.

In step FIG. 123B, a top layer 61101 may be deposited over FIG. 123A sub-layer 61100 surface and completely covering over components of optical detector 901, including 9011/9012/9013/930/9301/93021/93022/93023/93031/93032. Top layer 61101 may exhibit uneven topography following the shape of components of optical detector 901 on sub-layer 61100. Top layer 61101 may be deposited on sub-layer 61100 with any of: PVD, CVD, ALD, PECVD, PEALD, MBE, electro-plating, and spin coating.

In step of FIG. 123C, top layer 61101 surface may be planarized to be substantially a flat surface 61102, or planarized with topography of step of FIG. 123B being reduced, for example with surface roughness root-mean-square value reduced less than 10 nm, or less than lnm. Planarization of top layer 61101 may be performed by any of: IBE, PE, chemical-mechanical-polish (CMP).

In step of FIG. 123D, a trench is created within the top layer 61101 after step of FIG. 123C, where the trench forms bottom surface and two side walls of the channel 601/6072/910 of the UFL 600/6000. Trench of FIG. 123D may be formed by: (step-1) depositing photoresist, or depositing a hard-mask layer and then a photoresist, on surface 61102; (step-2) expose photoresist mask under a light source; (step-3) remove photoresist covering over the area corresponding to said trench; (step-4) etch the top layer 61101, or etch the hard mask on top of surface 61102 and then etch the top layer 61101, with etch method including any of: RIE, IBE, PE, CDE, wet etch, to remove material from said top lay 61101 to form said trench, where said etching of top layer 61101 may stop in top layer 61101 or stop in sub-layer 61100. During etching of top layer 61101 to form said trench, part of one or more components of optical detector 901 may be exposed at the side walls of the said trench or side walls of channel 601/6072/910, for example optical component 930.

After step of FIG. 123D, in step of FIG. 123E, protection layer 9103 may be deposited and may be conformally covering over FIG. 123D top layer 61101 surface, side walls and bottom surface of etched trench or channel 601/6072/910. Protection layer 9103 may also cover over any exposed components of optical detector 901 after forming the trench of FIG. 123D. Protection layer 9103 is same as in FIG. 111D and FIG. 111E. In FIG. 123E, protection layer 9103, top layer 61101 and sub-layer 61100 may be regarded as the substrate 611.

After step of FIG. 123D or FIG. 123E, in step of FIG. 123F, top cover 610 may be positioned over the substrate 611, for example contacting top layer surface 61101 directly if after FIG. 123D step, or contacting protection layer 9103 if after step of FIG. 123E, and forms an enclosure of the main channel 601/6072/910 of the UFL 600/6000, where bottom surface of cover 610 forms top surface 60111, layer 9013 forms side walls 60112 and bottom surface 60113, of channel 601/6072/910. An annealing step may be performed during or after the top cover 610 is positioned over substrate 611. Top cover 610 may bond to substrate 611 through any of: (1) surface to surface Van der Waals force; (2) gluing; (3) ultrasound thermal melting; (4) metallic bond or covalent bond. Material at bottom surface of top cover 610 and material at top surface of substrate 611 contacting top cover 610 may exhibit element, or molecule, or material, interdiffusion or intermixing, which may be facilitated by said annealing, such that a bonding is established.

FIG. 124A illustrates another embodiment of an optical detector 901 having illuminator 9011, forward scatter sensors 9013 and back scatter sensors 9012, being used to detect biological entity 1/10/20/30/612. In FIG. 124A, flow 6021/6043/6071/9101 carries biological entities 1/10/20/30/612 through channel 601/6072/910. Dashed line indicates detector 901, which include components of illuminator 9011, forward scatter sensors 9013 and back scatter sensors 9012. FIG. 124A is similar as FIG. 111A, while FIG. 124A describes a vertical arrangement of optical components of optical detector 901.

FIG. 124B shows an example of FIG. 124A embodiment implementation, where in FIG. 124B, components 9011, 9012 are shown to be embedded within the substrate 611 underneath the bottom surface of channel 601/6072/910, and component 9013 is shown to be embedded within top cover 610 of channel 601/6072/910. When a biological entity 1/10/20/30/612 flows through the dashed box of 901 detector region of detection as in FIG. 124A, information of biological entity 1/10/20/30/612 as described in FIG. 110A through FIG. 110D may be optically extracted by components 9011, 9012, and 9013. Components 9011 and 9012 may terminate at bottom surface 60113 of channel 601/6072/910. Component 9013 may terminate at top surface 60111 of channel 601/6072/910. Illuminator 9011 may include any of: light emitting diodes (LED), organic light emitting diode (OLED), laser diode, edge emitting laser. Illuminator 9011 is preferred to be a vertical-cavity-surface emitting laser (VCSEL). Detector 9012 and detector 9013 may each include any of: photo diode, avalanche photo diode (APD), charge-coupled device (CCD), or a complementary metal-oxide-semiconductor (CMOS) device.

In FIG. 124B, illuminator 9011 may be driven by a first modulation signal that modulates intensity of light emitted by illuminator 9011 at a modulation frequency. Detected optical signal from detector 9012, or from detector 9013, may then be converted to second electrical signal, and a lock-in-amplification operation may then be performed with multiplying, or convolution of, the first modulation signal and second electrical signal at the modulation frequency, with necessary phase correction, and signal processing including band pass or low pass filtering, to extract the optical signal component generated from the biological entity 1/10/20/30/612 with higher signal to noise ratio. Extraction of said optical signal component generated from the biological entity 1/10/20/30/612 may be from first, second, third, or fourth harmonic of the modulation frequency during said lock-in amplification operation. Lock-in amplification operation may be achieved by feeding first modulation signal as reference signal, and second electrical signal as input signal into a lock-in amplifier control, or circuit, or component.

Illuminator 9011 may be replaced by an illuminator array, for example 901101/901102/901103/901104/901105, and sensor 9013 may each be replaced by sensor array 901301/901302/901303/901304/901305, similarly as in FIG. 112A through FIG. 114D, FIG. 116A and FIG. 116B, where illuminator array 901101/901102/901103/901104/901105 and sensor array 901301/901302/901303/901304/901305 may function and detect entity 1/10/20/30/612 similarly as described in FIG. 115A, FIG. 115B, and FIG. 117.

FIG. 124C is substantially same as FIG. 124B, except that the forward scatter sensor 9013 may not be embedded in the top cover 610 but attached to the top surface 60116 of cover 610 external to channel 601/6072/910. In FIG. 124C, sensor 9013 may sense the scatter light 90132 with the light 90132 passing through top cover 610, whereas light 90132 may pass through the top cover 610 where the top cover 601 may be substantially transparent, or light 90132 may pass through an optical window existing in the top cover 610, where said optical window may be a patterned solid transparent material embedded within, and being part of, the top cover 601.

FIG. 124D is substantially same as FIG. 124B, except that the forward scatter sensor 9013 is not embedded in the top cover 610 but disposed in proximity to the top surface 60116 of cover 610 external to channel 601/6072/910, where sensor 9013 may be positioned away from said top surface of cover 610 or may be in physical contact of said top surface 60116 of cover 610. In FIG. 124D, sensor 9013 may sense the scatter light 90132 with the light 90132 passing through top cover 610, whereas light 90132 may pass through the top cover 610 where the top cover 601 may be substantially transparent, or light 90132 may pass through an optical window existing in the top cover 610, where said optical window may be a patterned solid transparent material embedded within, and being part of, the top cover 601.

FIG. 124E is substantially same as FIG. 124B, except that the forward scatter sensor 9013 is not embedded in the top cover 610 and illuminator 9011 and back scatter sensor 9012 are not embedded in substrate 611. Forward scatter sensor 9013 may either be disposed in proximity to the top surface 60116 of cover 610 external to channel 601/6072/910, where sensor 9013 may be positioned away from said top surface 60116 of cover 610 or may be in physical contact of said top surface of cover 610, or may be attached to the top surface 60116 of cover 610. In FIG. 124E, sensor 9013 may sense the scatter light 90132 with the light 90132 passing through top cover 610, whereas light 90132 may pass through the top cover 610 where the top cover 601 may be substantially transparent, or light 90132 may pass through an optical window existing in the top cover 610, where said optical window may be a patterned solid transparent material embedded within, and being part of, the top cover 601. Illuminator 9011 and back scatter sensor 9012 may either be disposed in proximity to the bottom surface 60115 of substrate 611 external to channel 601/6072/910, where illuminator 9011 and sensor 9012 may be positioned away from said bottom surface 60115 of substrate 611 or may be in physical contact of said bottom surface 60115 of substrate 611, or may be attached to the bottom surface 60115 of substrate 611. In FIG. 124E, sensor 9012 may sense the scatter light 90122 and illuminator 9011 may emit light 90112, with the light 90112 and 90122 passing through substrate 611, whereas light 90112 and 90122 may pass through the substrate 611 where the substrate 611 may be substantially transparent, or light 90112 and 90122 may pass through an optical window existing in substrate 611, where said optical window may be a patterned solid transparent material embedded within, and being part of, the substrate 611.

FIG. 125A shows another example of FIG. 124A embodiment implementation, where in FIG. 125A, component 9013 is shown to be embedded within the substrate 611 underneath the bottom surface 60113 of channel 601/6072/910, and component 9011 is shown to be embedded within top cover 610 of channel 601/6072/910. Component 9011 may terminate at top surface 60111 of channel 601/6072/910. Component 9013 may terminate at bottom surface 60113 of channel 601/6072/910. When a biological entity 1/10/20/30/612 flows through the dashed box of 901 detector region of detection as in FIG. 124A, information of biological entity 1/10/20/30/612 as described in FIG. 110A through FIG. 110D may be optically extracted by components 9011 and 9013. Illuminator 9011 may include any of: light emitting diodes (LED), organic light emitting diode (OLED), laser diode, edge emitting laser. Illuminator 9011 is preferred to be a vertical-cavity-surface emitting laser (VCSEL). Detector 9012 and detector 9013 may each include any of: photo diode, avalanche photo diode (APD), charge-coupled device (CCD), or a complementary metal-oxide-semiconductor (CMOS) device.

In FIG. 125A, illuminator 9011 may be driven by a first modulation signal that modulates intensity of light emitted by illuminator 9011 at a modulation frequency. Detected optical signal from detector 9012, or from detector 9013, may then be converted to second electrical signal, and a lock-in-amplification operation may then be performed with multiplying, or convolution of, the first modulation signal and second electrical signal at the modulation frequency, with necessary phase correction, and signal processing including band pass or low pass filtering, to extract the optical signal component generated from the biological entity 1/10/20/30/612 with higher signal to noise ratio. Extraction of said optical signal component generated from the biological entity 1/10/20/30/612 may be from first, second, third, or fourth harmonic of the modulation frequency during said lock-in amplification operation. Lock-in amplification operation may be achieved by feeding first modulation signal as reference signal, and second electrical signal as input signal into a lock-in amplifier control, or circuit, or component.

FIG. 125B is substantially same as FIG. 125A, except that the illuminator 9011 is not embedded in the top cover 610 but attached to the top surface 60116 of cover 610 external to channel 601/6072/910. In FIG. 125B, illuminator 9011 may emit the light 90112 with the light 90112 passing through top cover 610, whereas light 90112 may pass through the top cover 610 where the top cover 601 may be substantially transparent, or light 90112 may pass through an optical window existing in the top cover 610, where said optical window may be a patterned solid transparent material embedded within, and being part of, the top cover 601.

FIG. 125C is substantially same as FIG. 125A, except that the illuminator 9011 is not embedded in the top cover 610 and forward scatter sensor 9013 is not embedded in substrate 611. Illuminator 9011 may either be disposed in proximity to the top surface 60116 of cover 610 external to channel 601/6072/910, where illuminator 9011 may be positioned away from said top surface 60116 of cover 610 or may be in physical contact of said top surface 60116 of cover 610, or may be attached to the top surface of cover 610. In FIG. 125C, illuminator 9011 may emit light 90112 with the light 90112 passing through top cover 610, whereas light 90112 may pass through the top cover 610 where the top cover 601 may be substantially transparent, or light 90112 may pass through an optical window existing in the top cover 610, where said optical window may be a patterned solid transparent material embedded within, and being part of, the top cover 601. Forward scatter sensor 9013 may either be disposed in proximity to the bottom surface 60115 of substrate 611 external to channel 601/6072/910, where forward scatter sensor 9013 may be positioned away from said bottom surface 60115 of substrate 611 or may be in physical contact of said bottom surface 60115 of substrate 611, or may be attached to the bottom surface 60115 of substrate 611. In FIG. 125C, sensor 9013 may sense the scatter light 90132 with the light 90132 passing through substrate 611, whereas light 90132 may pass through the substrate 611 where the substrate 611 may be substantially transparent, or light 90132 may pass through an optical window existing in substrate 611, where said optical window may be a patterned solid transparent material embedded within, and being part of, the substrate 611.

FIG. 125D is substantially similar as FIG. 124E, except the forward scatter sensor 9013 being disposed in proximity to the top surface 60116 of cover 610 external to channel 601/6072/910, and the illuminator 9011 being disposed in proximity to the bottom surface 60115 of substrate 611 external to channel 601/6072/910, where sensor 9013 may be positioned away from said top surface 60116 of cover 610. In FIG. 125D, and where illuminator 9011 may be positioned away from said bottom surface 60115 of substrate 611.

Illuminator 9011 and sensor 9012 and 9013 in FIG. 124A through FIG. 125D may each be operated by controllers 950 and 954, and by external computing device 955 in methods as described in FIG. 120A through FIG. 121B. Illuminator 9011 and sensor 9012 and 9013 in FIG. 124A through FIG. 125D may each be operated with components 9301, 93021/93022/93023/93024, 93031, 93032 as described in FIG. 122A through FIG. 122C.

FIG. 126A illustrates an embodiment of FIG. 125C with said optical window 930 as described in FIG. 125C formed in the top cover 610 to allow passage of optical light 90112 from illuminator 9011 into the UFL channel 601/6072/910 and another optical window 930 as described in FIG. 125C formed in the substrate 611 to allow passage of optical light 90132 from UFL channel 601/6072/910 into the forward scatter sensor 9013. Optical window 930 may be formed and function similarly as the optical component 930 as described in FIG. 118A, FIG. 118B, FIG. 119A, FIG. 119B, FIG. 122A, FIG. 122B, FIG. 122C.

FIG. 126B illustrates an embodiment of FIG. 125D with an optical window 930 formed in the substrate 611 to allow passage of optical light 90112 from illuminator 9011 into the UFL channel 601/6072/910 and another optical window 930 formed in the cover 610 to allow passage of optical light 90132 from UFL channel 601/6072/910 into the forward scatter sensor 9013. Optical window 930 may be formed and function similarly as the optical component 930 as described in FIG. 118A, FIG. 118B, FIG. 119A, FIG. 119B, FIG. 122A, FIG. 122B, FIG. 122C.

FIG. 127A illustrates an embodiment where an illuminator 9011 is embedded within the cover 610 or the substrate 611 of a UFL channel 601/6072/910 and light 90112 from the illuminator 9011 may be passed through an optical grating 9305 embedded within the cover 610 or substrate 611 of the UFL channel 601/6072/910. Gratings 9305 may be same as gratings 93031 of FIG. 122C. Gratings 9305 may be composed of a series of isolated optical light guides, as shown in FIG. 127A, with each light guide having a bottom end 93052 facing the light emission surface 90111 of illuminator 9011 and a top end 93051 facing the channel 601/6072/910 and entity 1/10/20/30/612, where light 90112 emitted from illuminator 9011 surface 90111 enters bottom end 93052 of optical light guides, then passes through optical light guides of gratings 9305, and then emitted from the top end 93051 of optical light guides. Top end 90351 may coincide with the channel wall 60111/60112/60113. Each of the optical light guides of the gratings 9305 may have any of: different width, different length, different height. Each of the optical light guides of the gratings 9305 may produce a different effective optical path length for the 90112 light that passes through said each light guide. After light 90112 passes through the gratings 9305, light 90112 may be phase modulated by gratings 9305 such that light 90112 may be optically converging or optically collimated towards center of the UFL channel 601/6072/910 or towards entity 1/10/20/30/612.

FIG. 127B illustrates an embodiment where forward scatter sensor 9013 is embedded within the cover 610 or the substrate 611 of a UFL channel 601/6072/910 and scattered light 90132 is passed to the forward scatter sensor 9013 through optical gratings 9305 embedded within the cover 610 or substrate 611 of the UFL channel 601/6072/910. Gratings 9305 of FIG. 127B are same as in FIG. 127A, except gratings 9305 may be used to collect light 90132 from channel 601/6072/910 and transmit light 90132 to sensor 9013. In FIG. 127B, scattered light 90132 from entity 1/10/20/30/612 may enter top end 93051 of optical light guides of gratings 9305, then pass through each of said optical light guides, and then exits from bottom end 93052 of said optical light guides and entering optical detection surface 90131 of sensor 9013. After light 90132 passes through the gratings 9305, light 90132 may be phase modulated by gratings 9305 such that light 90132 may be optically collimated or optically converged towards the optical detection surface 90131 of sensor 9013.

FIG. 127C illustrates an embodiment where an illuminator 9011 is embedded within the cover 610 or the substrate 611 of a UFL channel 601/6072/910 and light 90112 from the illuminator 9011 may be passed through an optical phase plate 9306 embedded within the cover 610 or substrate 611 of the UFL channel 601/6072/910. Phase plate 9306 may be a Fresnel lens or an optical phase array. Phase plate 9306 may take the form of a circularly shaped optical component having a continuously varying effective optical path along a radius direction of said circular shape for light passing through said phase plate 9306. Phase plate 9306 may be composed of a series of isolated optical light guides that may be in the form of concentric circular rings with each light guide's circular ring having a varying effective optical path for light passing through said light guide. Phase plate 9306 may have a bottom end 93062 facing the light emission surface 90111 of illuminator 9011 and a top end 93061 facing the channel 601/6072/910 and entity 1/10/20/30/612, where light 90112 emitted from illuminator 9011 surface 90111 enters bottom end 93062 of phase plate 9306, then passes through phase plate 9306 or through optical light guides of phase plate 9306, and then emitted from the top end 93061 of phase plate 9306. Top end 90361 may coincide with the channel wall 60111/60112/60113 of FIG. 90B and FIG. 91A. Each of the optical light guides of the phase plate 9306 may have any of: different width, different length, different height. After light 90112 passes through the phase plate 9306, light 90112 may be phase modulated by phase plate 9306 such that light 90112 may be optically converged or optically collimated towards center of the UFL channel 601/6072/910 or towards entity 1/10/20/30/612.

FIG. 127D illustrates an embodiment where forward scatter sensor 9013 is embedded within the cover 610 or the substrate 611 of a UFL channel 601/6072/910 and scattered light 90132 is passed to the forward scatter sensor 9013 through phase plate 9306 embedded within the cover 610 or substrate 611 of the UFL channel 601/6072/910. Phase plate 9306 of FIG. 127D is same as in FIG. 127C, except phase plate 9306 may be used to collect light 90132 from channel 601/6072/910 and transmit light 90132 to sensor 9013. In FIG. 127D, scattered light 90132 from entity 1/10/20/30/612 may enter top end 93061 of phase plate 9306 or the optical light guides of phase plate 9306, then pass through phase plate 9306 or each of said optical light guides of phase plate 9306, and then exits from bottom end 93062 of said phase plate 9306 and entering optical detection surface 90131 of sensor 9013. After light 90132 passes through the phase plate 9306, light 90132 may be phase modulated by phase plate 9306 such that light 90132 may be optically collimated or optically converged towards the optical detection surface 90131 of sensor 9013.

FIG. 128A illustrates an embodiment where an illuminator 9011 is located external to UFL channel 601/6072/910 and light 90112 from the illuminator 9011 may be passed through an optical grating 9305 embedded within the cover 610 or substrate 611 of the UFL channel 601/6072/910. FIG. 128A is substantially similar to FIG. 127A, except that gratings 9305 may terminate on surface 60111/60112/60113 facing entity 1/10/20/30/612 and also terminate on external surface 60114/60115/60116 of UFL 600/600 facing illuminator 9011. Gratings 9305 may be composed of a series of isolated optical light guides, same as in FIG. 127A, with each light guide having a bottom end 93052 facing the light emission surface 90111 of illuminator 9011 and a top end 93051 facing the channel 601/6072/910 and entity 1/10/20/30/612, where light 90112 emitted from illuminator 9011 surface 90111 enters bottom end 93052 of optical light guides, then passes through optical light guides of gratings 9305, and then emitted from the top end 93051 of optical light guides. Light emission surface 90111 of illuminator 9011 may be in contact with bottom end 93052 of gratings 9305.

FIG. 128B illustrates an embodiment where forward scatter sensor 9013 is located external to UFL channel 601/6072/910 and scattered light 90132 is passed to the forward scatter sensor 9013 through optical gratings 9305 embedded within the cover 610 or substrate 611 of the UFL channel 601/6072/910. FIG. 128B is substantially similar to FIG. 127B, except that gratings 9305 may terminate on surface 60111/60112/60113 facing entity 1/10/20/30/612 and also terminate on external surface 60114/60115/60116 of UFL 600/600 facing sensor 9013. In FIG. 128B, scattered light 90132 from entity 1/10/20/30/612 may enter top end 93051 of optical light guides of gratings 9305, then pass through each of said optical light guides, and then exits from bottom end 93052 of said optical light guides and entering optical detection surface 90131 of sensor 9013. Optical detection surface 90131 of detector 9013 may be in contact with bottom end 93052 of gratings 9305.

FIG. 128C illustrates an embodiment where an illuminator 9011 is located external to UFL channel 601/6072/910 and light 90112 from the illuminator 9011 may be passed through an optical phase plate 9306 embedded within the cover 610 or substrate 611 of the UFL channel 601/6072/910. FIG. 128C is substantially similar to FIG. 127C, phase plate 9306 is also same as in FIG. 127C, except that phase plate 9306 may terminate on surface 60111/60112/60113 facing entity 1/10/20/30/612 and also terminate on external surface 60114/60115/60116 of UFL 600/600 facing illuminator 9011. Light emission surface 90111 of illuminator 9011 may be in contact with bottom end 93062 of phase plate 9306.

FIG. 128D illustrates an embodiment where forward scatter sensor 9013 is located external to UFL channel 601/6072/910 and scattered light 90132 is passed to the forward scatter sensor 9013 through phase plate 9306 embedded within the cover 610 or substrate 611 of the UFL channel 601/6072/910. FIG. 128D is substantially similar to FIG. 127D, phase plate 9306 is also same as in FIG. 127D, except that phase plate 9306 may terminate on surface 60111/60112/60113 facing entity 1/10/20/30/612 and also terminate on external surface 60114/60115/60116 of UFL 600/600 facing illuminator 9011. Optical detection surface 90131 of detector 9013 may be in contact with bottom end 93062 of phase plate 9306.

In one embodiment, spatially periodic arrangement of optical light guides of gratings 9305 of FIG. 127A and FIG. 128A may produce spatially periodic illumination light 90112 upon entity 1/10/20/30/612 when entity 1/10/20/30/612 passes through illumination region of illuminator 9011 of optical detector 910. Such spatially periodic illumination created by periodic optical light guides may subsequently cause a production of temporally periodic scattered light 90132 signal when entity 1/10/20/30/612 passes through illumination region of illuminator 9011, especially when flow speed of entity 1/10/20/30/612 through said illumination region is substantially constant, thereby said temporally periodic scattered light 90132 may in turn produce a periodic 90132 signal detected by sensor 9013 at a frequency that may correlate to said spatial period of said light guides of gratings 9305 and may correlate to the flow speed of entity 1/10/20/30/612 passing through the illumination region of illuminator 9011, for example said frequency may be calculated as said flow speed of said entity divided by said spatial period of said light guides of gratings, wherein a signal filter including any of, or a combination thereof: a band pass filter, a low pass filter, a high pass filter, may be applied to said periodic signal detected by sensor 9013 to enhance signal detection from entity 1/10/20/30/612 and to reduce noise from other entities 2/3/22/613. Said signal filter may be implemented by electronic components of controller 950 or 954, or by programs within computing device 955 of FIG. 120A through FIG. 122C, FIG. 129A illustrates an embodiment of multiple optical detectors 9001, 9002, 9003, each being same as detector 901, and each having illuminator 9011, forward scatter sensors 9012 or back scatter sensors 9013 positioned along the channel walls 60111/60112/60113 of a UFL channel 601/6072/910 to achieve an in-serial optical detection of biological entities 1/10/20/30/612. Function of each of optical detectors 9001, 9002, and 9003 is same as detector 901 as in FIG. 111A, except each detector 9001/9002/9003 may be different in any of: light 90112 emitted from different illuminator 9011 may have different wavelength or color; light 90122 or 90132 detected by different sensor 9012 or 9013 may be at different wavelength or color. Each different detector 9001/9002/9003 may detect existence of different type of fluorescent molecules that produce emission light of different wavelength or different color, on an entity 1/10/20/30/612 under illumination light 90112 from different illuminator 9011.

FIG. 129B illustrates one example of fluorescent optical signals from FIG. 129A optical detectors when biological entities pass through the UFL channel. Signal 9021 shows optical signal detected by sensor 9013 of each of the detectors 9001, 9002, 9003 when a first entity 1/10/20/30/612 passes sequentially through detector 9001, detector 9002, and detector 9003 following flow direction 6021/6043/6071/9101. Illuminator 9011 of each of detector 9001, 9002, 9003 may emit same or different color illumination light 90112. Sensor 9013 of detector 9001 may sense 90132 light of a first color, which may be produced by emission of a first type of fluorescent molecules that may: bind to first type of surface antigens that may exist on entity 1/10/20/30/612 surface, or bind to first type of DNA or RNA sections or first type of intracellular antigens inside entity 1/10/20/30/612, under excitation from light 90112 emitted from illuminator 9011 of detector 9001. Sensor 9013 of detector 9002 may sense 90132 light of a second color, which may be produced by emission of a second type of fluorescent molecules that may: bind to second type of surface antigens that may exist on entity 1/10/20/30/612 surface, or bind to second type of DNA or RNA sections or second type of intracellular antigens inside entity 1/10/20/30/612, under excitation from light 90112 emitted from illuminator 9011 of detector 9002. Sensor 9013 of detector 9003 may sense 90132 light of a third color, which may be produced by emission of a third type of fluorescent molecules that may: bind to third type of surface antigens that may exist on entity 1/10/20/30/612 surface, or bind to third type of DNA or RNA sections or third type of intracellular antigens inside entity 1/10/20/30/612, under excitation from light 90112 emitted from illuminator 9011 of detector 9003.

In FIG. 129B, for signal 9021 obtained from first entity 1/10/20/30/612, existence of detected signal peaks in signal 9021 corresponding to first entity 1/10/20/30/612 passing through detector 9001 and detector 9002 indicates existence of said first and second types of fluorescent molecules, and thereby existence of said first and second types of surface antigens on first entity 1/10/20/30/612, or existence of first and second types of DNA or RNA sections or first and second types of intracellular antigens in first entity 1/10/20/30/612. Detected signal 9021 peak height 90012 from detector 9001 may be used to calculate or estimate number, or abundance, of first type of surface antigen or first type of DNA or RNA sections or first type of intracellular antigens that first entity 1/10/20/30/612 may contain, while peak width 90011, for example full-width-half-maximum, of said signal peak from detector 9011 may be used to calculate or estimate: physical size of first entity 1/10/20/30/612; size of internal volume of first entity 1/10/20/30/612 where first type of DNA or RNA sections or first type of intracellular antigens are contained; or density and distribution of said first type surface antigen or first type DNA or RNA sections or first type of intracellular antigens. Similarly, peak height 90022 from detector 9002 may be used to calculate or estimate number, or abundance, of second type of surface antigen or second type of DNA or RNA sections or second type of intracellular antigens that first entity 1/10/20/30/612 may contain, while peak width 90021 may be used to calculate or estimate: physical size of first entity 1/10/20/30/612; size of internal volume of first entity 1/10/20/30/612 where second type of DNA or RNA sections or second type of intracellular antigens are contained; or density and distribution of said second type surface antigen or second type DNA or RNA sections or second type of intracellular antigens. Non-existence of signal peak in 9021 from detector 9003 may indicate non-existence or un-detectable existence of third type of surface antigens or third type of DNA or RNA sections or third type of intracellular antigens in first entity 1/10/20/30/612. By combining information retrieved, calculated from, or estimated from signal 9021, including any of: number, amount, density, distribution of first and second types of surface antigens expressed by first entity 1/10/20/30/612; first and second types of DNA or RNA sections contained within first entity 1/10/20/30/612; first and second types of intracellular antigens contained within first entity 1/10/20/30/612; size of first entity 1/10/20/30/612; non-existence of third type of surface antigens or third type of DNA or RNA sections or third type of intracellular antigens, first entity 1/10/20/30/612 may be qualitatively, quantitatively, or categorically, described or classified or identified.

In FIG. 129B, for signal 9022 obtained from second entity 1/10/20/30/612, existence of detected signal peaks in signal 9022 corresponding to second entity 1/10/20/30/612 passing through detector 9002 and detector 9003 indicates existence of said second and third types of fluorescent molecules, and thereby existence of said second and third types of surface antigens on second entity 1/10/20/30/612, or existence of second and third types of DNA or RNA section or second and third types of intracellular antigens in second entity 1/10/20/30/612. Non-existence of signal peak in 9022 from detector 9001 may indicate non-existence or un-detectable existence of first type of surface antigens or first type of DNA or RNA sections or first type of intracellular antigens in second entity 1/10/20/30/612. Similarly as described for signal 9021, by combining information retrieved, calculated from, or estimated from signal 9022, including any of: number, amount, density, distribution of second and third types of surface antigens expressed by second entity 1/10/20/30/612; second and third types of DNA or RNA sections contained within second entity 1/10/20/30/612; second and third types of intracellular antigens contained within second entity 1/10/20/30/612; size of second entity 1/10/20/30/612; non-existence of first type of surface antigens or first type of DNA or RNA sections or first type of intracellular antigens, second entity 1/10/20/30/612 may be qualitatively, quantitatively, or categorically, described, classified or identified, where second entity 1/10/20/30/612 may be categorized as being qualitatively, quantitatively, or categorically different from first entity.

In FIG. 129A and FIG. 129B, three detectors 9001, 9002, 9003 are shown as an example, while the number of detectors that may be used in similar manner as described in FIG. 129A and FIG. 129B is not limited in detection existence of: various types of surface antigens on entities 1/10/20/30/612; or various types of DNA or RNA sections or various types of intracellular antigens within entities 1/10/20/30/612. In one embodiment, sensor 9012 or sensor 9013 may be composed of an imaging device, for example a CCD sensor or a CMOS image sensor, signal 9021 or signal 9022 may then be replaced with series of images captured when entity 1/10/20/30/612 flows through detectors 9001, 9002, 9003, where each image may be labeled or accompanied by a time stamp of the time when said image was captured, and existence of any one type of fluorescent molecules on or within entity 1/10/20/30/612 as described in FIG. 129A and FIG. 129B may be observed as optical patterns, including: optical scatter pattern, optical diffraction pattern, optical interference pattern, projection image or projection shape of entity 1/10/20/30/612, corresponding to passage of entity 1/10/20/30/612 through one or more of the detectors 9001, 9002, 9003.

FIG. 129A and FIG. 129B show the example of each of different detectors 9001, 9002, 9003 may be used to detect a different wavelength or different color light 90132, which may be emitted from different fluorescent molecules attached to, or included within, entities 1/10/20/30/612. Alternatively, when sensor 9013 of detectors 9001, 9002, or 9003 is comprised of one or more of CCD color sensors, or one or more CMOS color sensors, sensor 9013 may capture light 90132 components of various wavelengths or various colors, during detection of light 90132, wherein said different wavelength or different color components of light 90132 may be captured, detected, or quantized by sensor 9013 of a single detector of 9001, 9002, or 9003, wherein said sensor 9013 may detect the amplitude 90012, 90022, 90032 of each different wavelength or color component of light 90132, wherein said single sensor 9013 may also detect peak width 90011, 90021, 90031 of each different wavelength or color component of light 90132, when entities 1/10/20/30/612 flow through said single detector of 9001, 9002, or 9003 containing said single sensor 9013.

FIG. 130A illustrates the method to align biological entities 1/10/20/30/612/613 into a linear single file stream in flow channel 601/6072/910, preferably at center of said flow channel 601/6072/910, for optical detection by detector 901 as described from FIG. 110A through FIG. 129B, with using acoustic generated fluidic pressure node as described in FIG. 38C, FIG. 38D, FIG. 91A, FIG. 91B, FIG. 91C, FIG. 92A through FIG. 93B. In FIG. 130A, an acoustic device, for example PZT 614, may be attached to the external surface of channel 601/6072/910 to generate fluidic pressure node that may align entity 1/10/20/30/612/613 into a linear single file stream within flow of 6043 flowing through channel 601/6072/910, which is similarly described in FIG. 38D, FIG. 93A and FIG. 93B, where the linear single file stream of entities 1/10/20/30/612/613 may be aligned with the illumination region of the illuminator 9011 or detection region of sensors 9012 and 9013 of the detector 901 and thus may help enhance detection of 1/10/20/30/612/613 by detector 901 in aspect including any of: better accuracy, higher flow speed, and higher resolution.

FIG. 130B illustrates the method to align biological entities 1/10/20/30/612/613 into a linear single file stream in flow channel 601, preferably at center of said flow channel 601, for optical detection detector 901 with using laminar flow. UFL channel 600 may be utilized to achieve laminar flow enabled entity 1/10/20/30/612/613 single file alignment for detection by detector 901. In FIG. 130B, sample 6020 containing entities 1/10/20/30/612/613 may be injected through inlet 604, and buffer fluid or sheath fluid 6040 may be injected into inlet 602. Buffer fluid 6040 after passing through side channels 603 as flow 6031 may meet sample flow 6043 in main channel 601, where flow 6031 becomes sheath flow 6033 flowing at both sides of center sample flow 6043. When flow 6033 and 6043 form a laminar flow in channel 601, with fluid 6020 injection into inlet 604 may be at a higher pressure than fluid 6040, entities 1/10/20/30/612/613 may align into a linear single file flow stream in the direction of flow 6043. Said linear single file stream may be aligned with the illumination region of the illuminator 9011 or detection region of sensors 9012 and 9013 of the detector 901 and thus may help enhance detection of 10/20/30/612/613 by detector 901 in aspect including any of: better accuracy, higher flow speed, and higher resolution.

FIG. 130C illustrates the method to align biological entities 1/10/20/30/612/613 into a linear single file stream in flow channel 601, preferably at center of said flow channel 601, for optical detection detector 901 with using laminar flow in combination with acoustic generated fluidic pressure node. FIG. 130C is substantially same as FIG. 130B, where UFL channel 600 may be utilized to achieve laminar flow enabled entity 1/10/20/30/612/613 single file alignment for detection by detector 901. Same as in FIG. 130B, sample 6020 containing entities 1/10/20/30/612/613 may be injected through inlet 604, and buffer fluid or sheath fluid 6040 may be injected into inlet 602. Buffer fluid 6040 after passing through side channels 603 as flow 6031 may meet sample flow 6043 in main channel 601, where flow 6031 becomes sheath flow 6033 flowing at both sides of center sample flow 6043. When flow 6033 and 6043 form a laminar flow in channel 601, with fluid 6020 injection into inlet 604 may be at a higher pressure than fluid 6040, entities 1/10/20/30/612/613 may align into a linear single file flow stream in the direction of flow 6043. In FIG. 130C an acoustic device, for example PZT 614, may be attached to the external surface of channel 601 to generate fluidic pressure node that may further help maintain alignment of entity 1/10/20/30/612/613 as said linear single file stream within flow of 6043 flowing through channel 601. Said linear single file stream of entities 1/10/20/30/612/613 in flow 6043 may be aligned with the illumination region of the illuminator 9011 or detection region of sensors 9012 and 9013 of the detector 901 and thus may help enhance detection of 1/10/20/30/612/613 by detector 901 in aspect including any of: better accuracy, higher flow speed, and higher resolution.

Said linear single file stream in flow 6043 may be further maintained by the aligned with the illumination region of the illuminator 9011 or detection region of sensors 9012 and 9013 of the detector 901 and thus may help enhance detection of 10/20/30/612/613 by detector 901 in aspect including any of: better accuracy, higher flow speed, and higher resolution.

FIG. 131A illustrates the method to use spatially periodic illuminators 9011 or optical light guides of gratings 9305 to detect biological entities. Illumination light 90112 may be emitted from illuminators 9011 in FIG. 131A, which may be same as illuminators 9011, 901101, 901102, 901103, 901104, 901105 of FIG. 112A through FIG. 117. Illuminators 9011 in FIG. 131A may be placed in a spatially periodic arrangement and may produce spatially periodic illumination light 90112 upon entity 1/10/20/30/612 when entity 1/10/20/30/612 passes through illumination region of illuminator 9011 of optical detector 910. Alternatively, illumination light 90112 may be emitted from optical light guides of gratings 9305 of FIG. 127A and FIG. 128A, which may also produce spatially periodic illumination light 90112 upon entity 1/10/20/30/612 when entity 1/10/20/30/612 passes through illumination region of illuminator 9011 of optical detector 910. Such spatially periodic illumination created by spatially periodic illuminators 9011 or light guides of gratings 9305, may induce a production of temporally periodic scattered light 90132 when entity 1/10/20/30/612 passes through illumination region of illuminator 9011, especially when flow speed of entity 1/10/20/30/612 within flow 6021/6043/6071/9101 is substantially constant, where said temporally periodic scattered light 90132 may in turn produce a detected periodic signal by sensor 9013 or sensors 901301, 901302, 901303, 901304, 901305, at a frequency that may correlate to said spatial period of said illuminators 9011 or light guides of gratings 9305, and may correlate to the flow speed of entity 1/10/20/30/612 passing through the detector region of sensor 9013 as in FIG. 131A, for example said frequency may be calculated as said flow speed of said entity divided by said spatial period of said illuminators or light guides of gratings. In FIG. 131A, where flow 6021/6043/6071/9101 may contain single file of entities 1/10/20/30/612 such that each entity 1/10/20/30/612 may pass sensor 9013 as in FIG. 131A individually, thus producing periodic signal by sensor 9013 corresponding to periodic arrangement of illuminators 9011 or light guides of gratings 9035 as in FIG. 131A. Flow 6021/6043/6071/9101 may also contain debris or small size entities 2/3/22/613, which may be randomly distributed in said flow and produce effectively random noise signal from sensor 9013 when passing sensor 9013.

FIG. 131B illustrates example of detected signal by sensor 9013 of FIG. 131A. Signal profile 90135 showing periodic signal peaks represents signal induced by a single entity 1/10/20/30/612 that passes through sensor 9013 sensing region as in FIG. 131A, while signal profile 90136 represents noise floor produced by debris or small entities 2/3/22/613 randomly distributed in flow 6021/6043/6071/9101. Combining signals 90135 and 90136 produce effective total signal profile produced by sensor 9013, where noise floor of 90136 may obscure signal peaks of 90135 from detection when population of debris or small entities 2/3/22/613 in flow 6021/6043/6071/9101 is sufficiently large.

FIG. 131C illustrates frequency domain conversion of FIG. 131B signal profiles 90135 and 90136, for example after a Fourier Transformation, where signal 90135 of FIG. 131B due to its periodic nature may be converted to a signal peak 90235 in the frequency domain of FIG. 131C, while noise signal 90136 of FIG. 131B due to its random nature may be converted to: (1) a mainly low frequency 1/f type of noise spectrum distribution 90236 in frequency domain of FIG. 131C; or (2) increased side lobes around peak 90235 in FIG. 131C. By using a band pass filter 90237, or a high pass filter 90238, in frequency domain of FIG. 131C, noise signal 90136 contribution to total signal of time domain in FIG. 131B may be sufficiently suppressed and thus enabling a better strength of signal 90135 over a lowered noise level of signal 90136 and an effectively higher signal-to-noise-ratio (SNR) of signal 90135 over noise signal 90136 in FIG. 131B, and thus a better detection of entity 1/10/20/30/612 may be achieved.

In one embodiment, with knowing the physical spacing between spatially periodic illuminators 9011 or optical light guides of gratings 9305 of FIG. 131A, the time spacing 90335 between two adjacent signal peaks in temporal signal trace 90135 of FIG. 131B, or the averaged time spacing 90335 between any two adjacent signal peaks in temporal signal trace 90135 of FIG. 131B, or the time spacing 90336 of any selected two signal peaks in temporal signal 90135 of FIG. 131B, may be used to calculate or estimate actual speed of movement of entity 1/10/20/30/612 within channel along flow 6021/6043/6071/9101. Alternatively, with knowing the physical spacing between spatially periodic illuminators 9011 or optical light guides of gratings 9305 of FIG. 131A, the frequency value 90337 of peak 90235 in FIG. 131C spectrum, where 90235 peak frequency value 09337 correlates to period of signal peaks in curve 90135 of FIG. 131B, may also be used to calculate or estimate actual speed of movement of entity 1/10/20/30/612 within channel along flow 6021/6043/6071/9101

FIG. 132 illustrates a first embodiment of a biological entity sorting device 2001 having a fluid path selector 9701 being at a first sorting position. Sorting device 2001 may be included within a device body 9600. Device 2001 may be part of UFL chip 600/6000 and may be contained within part of substrate 611 of UFL chip 600/6000, or may be a separate device by itself. Sorting device 2001 may contain a fluidic sample injection path 2100 for entity 1/10/20/30/612 injection into device 2001 for sorting, said path 2100 may be a continuation of channel 601/6072/910 of FIG. 110A through FIG. 131A. In path 2100, or as part of channel 601/6072/910, entities 1/10/20/30/612 may first be detected by one or more detectors 901/9001/9002/9003, where controller 950 through connections 951 may control, and sense entity 1/10/20/30/612 optical signal from, detectors 901/9001/9002/9003. Said entity 1/10/20/30/612 optical signal may be processed or analyzed for category, or type, or identification, of the entities 1/10/20/30/612, for example into categories of 9601 and 9602 as in FIG. 132, by controller 950, or by computing device 955 of FIG. 121A and FIG. 121B connected to controller 950. Sorting function of sorting device 2001 is achieved by a voice coil 9708 actuated rotational fluid path selector 9701. FIG. 132 shows a substantially circular first cavity 97032 may be created within device body 9600 with a cavity wall 97042. Path selector 9701 having a substantially circular shape may be located within said cavity 97032 and surrounded by cavity wall 97042. Path selector circumference wall 97012 and cavity wall 97042 may be in contact, or a spacing may exist between selector wall 97012 and cavity wall 97042. Fluid path 9605 in device body 9600 may connect from cavity wall 97042 to an outlet 9607, and fluid path 9606 in device body 9600 may connect from cavity wall 97042 to another outlet 9608. Fluid path 9702 and fluid path 9703 may exist within path selector 9701. Path selector 9701 may be positioned over, or around, or onto, a central hinge 9704 at the center of the path selector 9701, and path selector 9701 may rotate around hinge 9704 in the first cavity 97032 within the cavity wall 97042. Actuator 9707 embedded with, or covered with, one or more voice coils 9708 may be attached to the path selector 9701, where a movement of actuator 9707 may cause path selector 9710 to rotate within the cavity wall 97042 around hinge 9704. FIG. 132 shows when path selector 9701 being at a first sorting position, where path 9702 within path selector 9701 may align with the channel 2100 exit at one end, and align with path 9605 entrance at another end, and thus establish a continuous fluid path from path 2100, through path 9702, and through path 9605 and exiting device 2001 through outlet 9607. In the case when path selector 9701 rotates due to movement of actuator 9707 to a second sorting position, where path 9703 within path selector 9701 may align with the channel 2100 exit at one end, and align with path 9606 entrance at another end, and thus may establish a second continuous fluid path from path 2100, through path 9703, and through path 9606 and exiting through outlet 9608. Actuator 9707 may be located within a second cavity 9706 in the device body 9600, where second cavity 9706 may be created at the same step as the first cavity 97032. Magnetic field 9709 having north and south polarities simultaneously may exist within the cavity 9706, where FIG. 132 shows north (N) polarity and south (S) polarity of the magnetic field 9709 exists side by side within cavity 9706, with N polarity on the left having magnetic field direction pointing out of the plane and S polarity on the right with magnetic field direction pointing into the plane of FIG. 132, and with the magnetic field from both N and S polarities having magnetic field components perpendicular to the voice coil 9708 plane. Voice coil 9708 may be in the form of single-turn or multiple-turn coils that may be located on a surface of the actuator 9707, or may be embedded within the body of the actuator 9707. Voice coil 9708 may be created by a first thin film deposition step including: PVD, CVD, ALD, PECVD, PEALD, or by a first metal electro-plating step, and then patterned into coil form by an etching step including: RIE, IBE, wet-etch. Voice coil 9708 may also be formed by a single thin film deposition step including: PVD, CVD, ALD, PECVD, PEALD, or by a first metal electro-plating step, over a pre-patterned photoresist-mask, or hard-mask existing on actuator 9707 to create coils 9708 on actuator 9707 through the spaces within said photoresist-mask, or hard-mask, where a photoresist removal or hard-mask removal process may be used to remove said photo-resist-mask, or hard-mask afterwards. Clearance 97071 may exist at center of the actuator 9707 to reduce overall mass of actuator 9707, where voice coil 9708 may be created surrounding the clearance 97071. Sensor 9801 may exist at one or more locations on, or embedded within, the inside boundary wall of the cavity 9706, where sensor 9801 may sense the proximity, or distance, of the actuator 9707 to the boundary wall of cavity 9706. Controller 950 may receive signal from sensor 9801 through electrical connection 952 on proximity or distance of actuator 9707 to the left and right boundaries of FIG. 132 cavity 9706, and controller 950 through electrical connection 953 may adjust or control the electric current amplitude and current direction within coil 9708 of actuator 9707 to control the movement of actuator 9707 and thus the rotation of path selector 9701. Electric current may be applied to the voice coils 9708, where the arrows on the coils 9708 of FIG. 132 illustrate an example of a clock-wise electric current flowing within coils 9708, where said current within coil 9708 of FIG. 132 creates a magnetic field with a direction pointing into the plane of FIG. 132 against N polarity and being in same direction as S polarity of magnetic field 9709 of FIG. 132, where a net force may be exerted by the magnetic field 9709 onto the voice coil 9708, and cause a movement of the voice coil 9708, together with the actuator 9707, to move away from N polarity region and into the S polarity region of field 9709 as in FIG. 132, and thus causing an rotation of path selector 9701.

In the example as illustrated by FIG. 132, entities 1/10/20/30/612 in a fluid sample is injected into path 2100 in fluid flow 91010, where path 2100 may be an extension of channel 601/6072/910. One or more detectors 901/9001/9002/9003 located along path 2100 or channel 601/6072/910, similar as in FIG. 118A, FIG. 124A, FIG. 129A, may detect optical signal from entities 1/10/20/30/612, where controller 950, which may be connected to detectors 901/9001/9002/9003 through connection 951, may receive and analyze signals from detectors 901/9001/9002/9003 and separate entities 1/10/20/30/612 into type 9601 "solid" entity and type 9602 "hollow" entity. Controller 950 may also determine a type 9602 entity may be the immediate entity that will exit path 2100 towards path selector 9701. Controller 950 through connection 952 may receive signal from sensor 9801 and may determine that path selector 9701 is at first sorting position, where type 9601 entities may be expected to flow through path 9702 and continue into path 9605 in the fluid flow 9603 and exiting the sorting device 2001 through outlet 9607. Controller 950 may determine path selector 9801 need to rotate to a second sorting position to allow said immediate type 9602 entity in path 2100 to enter path 9703 and continue into path 9606 into flow 9604 and exit device 2001 through outlet 9608. Controller 950 through connection 953 may command, or provide, or alternate, or change, electric current in voice coils 9708 into clock-wise direction as shown in FIG. 132 to cause voice coils 9708 to generate a magnetic field that is in the direction of S polarity, which is against the N polarity region of magnetic field 9709. With voice coils 9708 being mostly located within N polarity region of magnetic field 9709 as in FIG. 132, a net force may be exerted on voice coils 9708 by magnetic field 9709 with clock-wise current applied to voice coils 9708, making voice coils 9708, together with actuator 9707, move out of N region and into S region of magnetic field 9709. Movement of actuator 9707 that is attached to path selector 9701 will then cause path selector 9701 to rotate around hinge 9704 in direction 9705 towards said second sorting position of device 2001.

During operation of sorting device 2001, spacing between path selector 9701 wall 97012 and cavity 97032 wall 97042 may be minimized to form continuous flow of fluid between path 2100 to paths 9702 and 9703, and further to paths 9605 and 9606, and to avoid fluid of flow 91010 flowing into cavity 97032 or cavity 9706. In one embodiment, wall 97012 and wall 97042 may be in contact during rotation of path selector 9701 around hinge 9704, where lubricating film or anti-abrasion coating may be applied to either or both of contacting surfaces of wall 97012 and wall 97042, wherein said lubricating film of anti-abrasion coating may be a layer composed of organic molecules, said organic molecules may be repellant to water and oil. In one embodiment, spacing between wall 97012 and wall 97042 may be any of: from 0.1 nanometer (nm) to lnm, from 1 nm to 10 nm, from 10 nm to 100 nm, from 100 nm to 200 nm, from 200 nm to 500 nm, from 500 nm to 1 micrometer (um), from 1 um to 10 um, from 10 um to 20 um. In one embodiment, cavity 97032 may be filled with air, or gas including but not limited to: nitrogen, helium, argon, carbon dioxide, oxygen, where spacing between wall 97012 and wall 97042 may be sufficiently small where surface tension of fluid within liquid sample flow 91010 maintains fluid within paths 2100, 9702, 9703, 9605, 9606 at first and second sorting positions and during rotation of path selector 9701, where surfaces of wall 97012 and wall 97042 may be composed of, or coated with, materials that is non-wettable, or hydrophobic, for liquid within sample flow 91010, thus help maintaining fluid within paths 2100, 9702, 9703, 9605, 9606.

In one embodiment, cavity 97032 space between wall 97012 and wall 97042, where paths 9702, 9703, 9605 and 9606 terminate, may be filled with cavity fluid that is biological compatible with fluid sample of flow 91010, 9603 and 9604, where switching between sorting first and second positions of path selector 9701 and passage of fluid between paths 2100, 9702, 9703, 9605, 9606 may carry certain amount of said cavity fluid into flows 9603 and 9604, said cavity fluid may contain any of, but not limited to: water, saline, phosphate buffered saline, Ficoll. Said cavity fluid may be maintained at same, or higher, fluid pressure than flows 91010, 9603 and 9604, where fluid of sample flow 91010 may be maintained within paths 2100, 9702, 9703, 9605, 9606. Said cavity fluid may be supplied continuously from outside device 2001 directly into cavity 97032 during operation of device 2001. Said cavity fluid may be initially supplied through flow 91010 when entities 1/10/20/30/612 are not supplied to flow 91010 and cavity fluid may flow from path 2100 in between walls 97012 and 97042 into the cavity 97032 space, and cavity fluid may then maintain its effective volume during operation of device 2001 during rotation of path selector 9701, where pressure within cavity fluid is maintained same as in flow 91010. Said cavity fluid may be confined, or sealed within, cavity 97032 wall 97042 and not entering cavity 9706, where cavity 9706 may be filled with air, or gas including but not limited to: nitrogen, helium, argon, carbon dioxide, oxygen, where walls of cavity 9706 may be composed of, or coated with, materials that is non-wettable, or hydrophobic, for cavity fluid within cavity 97032, to help maintain cavity fluid within cavity 97032.

In FIG. 132, device body 9600, path selector 9701, actuator 9707 may each be composed of any of: glass, silicon, quartz, aluminum-titanium-carbon (AlTiC), SiC, SiN, silicon-oxide, alumina, plastic, PDMS, polymer, ceramic, or metal, where metal may be composed any one or any alloy of aluminum, iron, nickel, titanium, chromium, platinum, tungsten, rhenium, copper, gold, silver. Path selector 9701 and actuator 9707 may be created as a single piece, where voice coils 9708 are formed on or within the actuator 9707 part of said single piece. Path selector 9701 and actuator 9707 may also be created as separate pieces, and joined together afterwards through any of: soldering, welding, gluing, mechanical attachment.

FIG. 133 illustrates FIG. 132 sorting device 2001 at a second sorting position. FIG. 133 is the result of the operation as described in FIG. 132 example. Following FIG. 132 operation, actuator 9707 moves towards S region of the magnetic field 9709, where controller 950 through sensor 9801 detects actuator 9707 proximity or distance to the right side boundary wall of cavity 9706 while controlling electric current amplitude and direction flowing in voice coils 9708, until actuator 9707 rotates the path selector 9701 to reach second sorting position, where path 9703 is aligned with exit of path 2100 on one end and aligned with entrance of path 9604 on the other end. At second sorting position of FIG. 133, the immediate type 9602 entity exiting the path 2100 as in FIG. 132 moves into desired path 9703 of path selector 9701 following flow 91010, while one or more type 9602 entities originally contained within path 9703 as shown in FIG. 132 may continue into path 9606 and ultimately exiting sorting device 2001 through outlet 9608. From described example of FIG. 132 and FIG. 133, one step of sorting one type 9602 entity into desired flow path 9703 may be achieved. At second position of FIG. 133, following same operation as in FIG. 132, controller 950 may determine the immediate exiting entity within path 2100 may now become type 9601 entity, where controller 950 may reverse the electric current in voice coil 9708 to counter-clock-wise direction, such that voice coil 9708 may produce a magnetic field in the N direction and the net magnetic force exerted on actuator 9707 from magnetic field 9709 may become pushing the actuator back into the N region of the magnetic field 9709 and cause rotation of path selector 9701 back to the first sorting position as shown in FIG. 132 to complete another sorting step of moving immediate 9601 entity into desired path 9702 of path selector 9701.

FIG. 134A illustrates FIG. 132 type sorting device 2002 having four sorting positions and being in first sorting position. Sorting device 2002 is same as sorting device 2001, except four selector paths exist on path selector 9701, and four exit paths exist within device body 9600 with each path having an outlet. At first sorting position of FIG. 134A, selector path 97101 may align with exit of path 2100 on one end and align with entrance of path 96101 on the other end, thus entities within path 2100 may continue flow through path 97101, path 96101 and exit device 2002 through outlet 9607.

FIG. 134B illustrates FIG. 134A sorting device 2002 in second sorting position. At second sorting position of FIG. 134B, selector path 97102 may align with exit of path 2100 on one end and align with entrance of path 96102 on the other end, thus entities within path 2100 may continue flow through path 97102, path 96102 and exit device 2002 through outlet 9608.

FIG. 134C illustrates FIG. 134A sorting device 2002 in third sorting position. At third sorting position of FIG. 134C, selector path 97103 may align with exit of path 2100 on one end and align with entrance of path 96103 on the other end, thus entities within path 2100 may continue flow through path 97103, path 96103 and exit device 2002 through outlet 9609.

FIG. 134D illustrates FIG. 134A sorting device 2002 in fourth sorting position. At fourth sorting position of FIG. 134D, selector path 97104 may align with exit of path 2100 on one end and align with entrance of path 96104 on the other end, thus entities within path 2100 may continue flow through path 97104, path 96104 and exit device 2002 through outlet 9610.

FIG. 134A through FIG. 134D illustrate example of sorting entities 1/10/20/30/612 of FIG. 132 into four different flow paths, which enables sorting of at least four different types of entities 1/10/20/30/612, where controller 950 of sorting device 2002 through detectors 901/9001/9002/9003 of sorting device 2002 may be able to categorize entities 1/10/20/30/612 into four different types and make each type entity enter each desired selector path 97101/97102/97103/97104 at four sorting positions and further into outlets 9607/9608/9609/9610. Similar to FIG. 132 and FIG. 133, transition between four sorting positions of FIG. 134A to FIG. 134D is through controller 950 sensing actuator 9707 position in cavity 9706 and making changes in amplitude and direction of electric current flowing in voice coil 9708 of actuator 9707.

FIG. 135A illustrates FIG. 132 sorting device utilizing coil lines 97081 of voice coil 9708 connecting to device body 9600. FIG. 135A sorting device 2003 serves as another example of implementation of FIG. 132. Sorting device 2003, in addition to device 2001 as described in FIG. 132, coil lines 97081 may connect from voice coil 9708 of actuator 9707 to device body 9600, where coil lines 97081 connection points on device body 9600 may then further connect to controller 950 through connection 953. Coil lines 97081 may be made as part of extension lines of voice coil 9708 during fabrication of voice coil 9708 on or within actuator 9707, where coil lines 97081 may be part of actuator 9707. Coil lines 97081 may be separately made and attached to both voice coil 9708 and device body 9600 at anchor points. Said anchor points may be made of metal, for example metal thin film pads, and coil lines 97081 may be soldered, or welded, or be in mechanical contact, to said anchor points. Coil lines 97081 may be made of any of: metal, conductive carbon fiber, conductive plastic line. Coil lines 97081 maybe composed of a metal or metal alloy including any element of: copper, gold, silver, iron, nickel, chromium, tungsten, titanium, zinc, tin. Coil lines 97081 may be in the form of thin wire structure and may provide spring function to actuator 9707 and may exert spring back force on actuator 9707 during movement of actuator 9707 within cavity 9706 under magnetic force generated by electric current from voice coil 9708, where magnetic force from voice coil 9708 and spring back force from coil lines 97081 may work together to achieve precision in reaching desired sorting positions as in FIG. 132 through FIG. 134D. When current is not applied to voice coil 9708, spring force by coil lines 97081 may return actuator 9707 and path selector 9701 to a determined position, for example as shown in FIG. 135A, for repeatable initial position of sorting device 2003 operation. Coil lines 97081 may also serve as mechanical anchoring structure that may help keep the actuator 9707 moving within a sufficiently horizontal plane and avoid tilting of path selector 9701 during rotation around hinge 9704.

FIG. 135B illustrates an example cross-section view of FIG. 135A device 2003 along cross section direction 9901 of FIG. 135A. Path 2100, which may also be extension of channel 601/6072/910 as described in FIG. 132, may be formed within substrate 611, which may be same as device body 9600, and enclosed by top cover 610.

FIG. 135C illustrates a first example view of FIG. 135A device 2003 along cross section direction 9902 of FIG. 135A. In FIG. 135C, paths 9605 and 9606 are shown to be also formed within substrate 611 and enclosed by cover 610. In one embodiment, paths 2100, 9605 and 9606 of device 2003 may be formed in substrate 611 or device body 9600 in a single etching step. FIG. 135C also shows that cavity 97032 may be formed as a circular trench within substrate 611. Hinge 9704 may be in the form of a solid protrusion structure from bottom surface 97033 of cavity 97032. Path selector 9701 may reside within the cavity 97032 and may rest on top of hinge 9704 with a notch 97041 at the bottom of path selector 9701. Notch 97041 may match to hinge 9704 shape and may provide rotational stability of path selector 9701 during operation as described in FIG. 132 and FIG. 133. Air, various gas, or cavity fluid as described in FIG. 132 may reside within gap between cavity 97032 surface 97033 and bottom surface 97013 of path selector 9701. Top surface of path selector 9701 may be separated from top cover 610, while edge 97012 of path selector 9701 may be separated from circular wall 97042 of cavity 97032.

FIG. 135D illustrates a second example view of FIG. 135A device along cross section direction 9902. FIG. 135D is same as FIG. 135C in all other aspects, except the path selector 9701 may reside within the cavity 97032 and may rest on top of hinge 9704 directly by bottom surface 97013 of path selector 9701 without notch 97041 of FIG. 135C. Air, various gas, or cavity fluid as described in FIG. 132 may reside within gap between surfaces 97013 and 97033, as well as between path selector 9701 circular side wall 97012 and cavity circular wall 97042. Top surface of path selector 9701 may be separated from top cover 610. Contact from hinge 9704 to surface 97013 may be a point contact to minimize fiction during operation of path selector 9701 as described in FIG. 132 and FIG. 133.

FIG. 135E illustrates view of FIG. 135A device along cross section direction 9903. FIG. 135E shows actuator 9707 having voice coil 9708 may reside within cavity 9706, where coil lines 97081 attached to voice coil 9708 and substrate 611 may provide electrical connection between controller 950 and voice coil 9708. Coil lines 97081 may function as mechanical anchors of actuator 9707 to substrate 611 and may provide spring-back function for movement of actuator 9707 and rotation of path selector 9701 as described in FIG. 135A. Bottom surface 97061 of cavity 9706 may be same surface as surface 97033 of cavity 97032 when cavity 97302 and 9706 may be created in same steps during fabrication of sorting device 2003. Surface 97061 may be above surface 97033, where cavity 97302 and cavity 9706 may be created in different steps. Cavity fluid as described FIG. 132 may be confined within cavity 97032 gap between path selector 9701 bottom surface 97013 and cavity 97032 surface 97033, especially when surface 97061 is above surface 97013 of path selector 9701, where a sufficiently narrow gap between walls 97012 and 97042, or when walls 97012 and 97042 are in contact, may provide an effective confinement, or sealing, of cavity fluid in said cavity 97032 gap between surfaces 97013 and 97033.

FIG. 136A illustrates view of FIG. 132 through FIG. 135A sorting device 2001, 2002, 2003 having a first magnetic field application scheme with FIG. 136A as an example of viewing along direction 9904 of FIG. 135A. In FIG. 136A, dashed lines illustrate boundary of actuator 9707 and boundary of cavity 9706, both of which are hidden from view of FIG. 136A. Permanent magnet 9710 may be used to create neighboring N region and S region of magnetic field 9709 of FIG. 132 through FIG. 135A, where N region may be created by a left part of magnet 9710 having an effective magnetization 9711 pointing up, and where S region may be created by a right part of magnet 9710 having an effective magnetization 9712 pointing downwards. Opposing magnetizations 9711 and 9712 of permanent magnet 9710 may be produced during fabrication of permanent magnet 9710. Permanent magnet 9710 may be positioned in close proximity to but not contacting, or may be in physical contact with, bottom surface of substrate 611, and permanent magnet 9701 may be aligned to a desired location relative to cavity 9706 to produce effective force on actuator 9707 when there is current in voice coil 9708 of actuator 9707.

FIG. 136B illustrates view of FIG. 132 through FIG. 135A sorting device 2001, 2002, 2003 having a second magnetic field application scheme with FIG. 136A as an example of viewing along direction 9904 of FIG. 135A. To produce N region and S region of magnetic field 9709 similar as permanent magnet 9710 of FIG. 136A, FIG. 136B utilizes two soft magnetic pole pieces, with left pole piece 9715 attached to, or placed in close proximity to, a north pole of a permanent magnet 9713, and with right pole piece 9716 attached to, or placed in close proximity to, a south pole of same permanent magnet 9713. Pole pieces 9715 and 9716 may each have a field generation surface, where left pole piece 9715 may conduct magnetic flux from north pole of magnet 9713 and emit said north magnetic flux from said field generation surface of left pole piece 9715 and produce N region of magnetic field 9709, while right pole piece 9716 may conduct magnetic flux from south pole of magnet 9713 and emit said south magnetic flux from said field generation surface of right pole piece 9716 and produce S region of magnetic field 9709. Said field generation surfaces of pole pieces 9715 and 9716 may be positioned in close proximity to but not contacting, or may be in physical contact with, bottom surface of substrate 611, and may be aligned to a desired location relative to cavity 9706 to produce effective force on actuator 9707 when there is current in voice coil of actuator 9707.

FIG. 136C illustrates view of FIG. 132 through FIG. 135A sorting device 2001, 2002, 2003 having a third magnetic field application scheme with FIG. 136A as an example of viewing along direction 9904 of FIG. 135A. FIG. 136C is same as FIG. 136B, except that soft magnetic pole piece 9715 of FIG. 136B is attached to north pole of permanent magnet 9717, while soft magnetic pole piece 9716 of FIG. 136B is attached to south pole of another permanent magnet 9718, where permanent magnets 9717 and 9718 are separate and may have magnetizations 9719 and 9720 in opposing directions.

FIG. 136D illustrates view of FIG. 132 through FIG. 135A sorting device 2001, 2002, 2003 having a fourth magnetic field application scheme with FIG. 136A as an example of viewing along direction 9904 of FIG. 135A. To produce N region and S region of magnetic field 9709 similar as permanent magnet of FIG. 136A, FIG. 136D utilizes an electromagnet that has a soft magnetic pole piece 9721 having two field generation surfaces. Electrical coils 9722 conducting electric current may wrap around a section of said soft magnetic pole piece 9721, where electric current in coils 9722 may generator magnetic flux within pole piece 9721, where pole piece 9721 may function as an electromagnet, with left field generation surface of pole piece 9721 generating N region of magnetic field 9709, and right field generation surface of pole piece 9721 generating S region of magnetic field 9709. Field generation surfaces of pole piece 9721 may be positioned in close proximity to but not contacting, or may be in physical contact with, bottom surface of substrate 611, and may be aligned to a desired location relative to cavity 9706 to produce effective force on actuator 9707 when there is current in voice coil of actuator 9707.

FIG. 137 illustrates sorting device 2004 incorporating actuator position decoders 9732. Sorting device 2004 is similar to sorting devices 2001, 2002 and 2003. Sensor 9801 of sorting device 2001 in FIG. 132 may be replaced by position decoder 9732 of sorting device 2004 as in FIG. 137. FIG. 137 shows that an encoder housing 9730 may be attached to actuator 9707. Position encoders 9731 may be included within encoder housing 9730. Decoders 9732 embedded in device body 9600, may be positioned at wall edge of cavity 9760 to be in proximity to encoders 9731. During movement of actuator 9707, decoders 9732 may sense the change of position of encoders 9731 and may detect the actual position of actuator 9707 in cavity 9706 and subsequently detect rotational position of path selector 9701 around hinge 9704.

In one embodiment, decoder 9732 may be composed of one or more optical sensors, and may be composed of one of more optical emitters. Encoder 9731 may be composed of one or more optical patterns or one or more optical reflectors. Optical sensor of decoder 9732 may detect optical patterns or optical reflectors of encoder 9731 movement and position within cavity 9706, where optical emitter of decoder 9732 may emit probing light towards encoder 9731 for optical sensor of decoder 9732 to sense. In another embodiment, decoder 9732 may be composed of one or more magnetic sensors. Encoder 9731 may be composed of one or more magnetic field sources, for example soft magnetic poles or permanent magnets. Encoder 9731 movement within cavity 9706 may cause change of magnetic field on magnetic sensor of decoder 9732, where such change of magnetic field may be caused by movement of soft magnetic poles of encoder 9731 in magnetic field 9709, or movement of permanent magnets of encoder 9731. Such change of magnetic field may be detected by magnetic sensor of decoder 9732 and interpreted into movement or position of actuator 9707 in cavity 9706. In yet another embodiment, decoder 9732 may be composed of one or more capacitive sensors. Encoder 9731 may be composed of one or more conductive or insulating parts, for example metal pads or non-metal pads. Encoder 9731 movement within cavity 9706, preferably in proximity to decoder 9732, may cause change of capacitance between conductive or insulating parts of encoder 9731 and capacitive sensors of decoder 9732, where such change of capacitance may be detected by capacitance sensor of decoder 9732 and interpreted into movement or position of actuator 9707 in cavity 9706. In yet another embodiment, decoder 9732 may be composed of one or more acoustic sensors, and may be composed of one of more acoustic emitters. Encoder 9731 may be composed of one or more acoustic absorbers or one or more acoustic reflectors. Acoustic emitters of decoder 9732 may emit probing acoustic wave towards encoder 9731, where acoustic absorbers or acoustic reflectors encoder 9731 may cause reflected acoustic wave in various patterns according to the movement or position of actuator 9707 in cavity 9706, where acoustic sensor of decoder 9732 may detect reflected acoustic wave patterns, and position or movement of actuator 9707 may be interpreted from said detected reflected acoustic wave patterns.

FIG. 138A illustrates first current driving scheme of actuator voice coil 9708 in FIG. 132 through FIG. 137 devices. In FIG. 138A, DC type electric current may be applied in voice coil 9708 to move actuator 9707 and path selector 9701 between sorting positions. Slope 97083 of positive rotation in FIG. 138A may illustrate example of electric current in voice coil 9708 when path selector 9701 rotates from first sorting position to second sorting position in FIG. 132. Initial high current value of 97083 in positive current direction may help start path selector 9701 rotation from first sorting position towards second sorting position, while lower current value of 97083 may indicate reaching desired second sorting position and reduction of rotational force to the value needed to maintain path selector 9701 to remain at second sorting position. Slope 97084 of negative rotation in FIG. 138A then illustrates example of electric current in voice coil 9708 when path selector 9701 rotates from second sorting position to first sorting position in FIG. 132. Initial high current value of 97084 in negative current direction may help start path selector 9701 rotation from second sorting position towards first sorting position, while lower current value of 97084 may indicate reaching desired first sorting position and reduction of rotational force to the value needed to maintain path selector 9701 to remain at first sorting position.

FIG. 138B illustrates second current driving scheme of actuator voice coil 9708 in FIG. 132 through FIG. 137 devices. In FIG. 138B, electric current is applied as modulated AC current 97085. During position rotation, AC current 97085 shows a bias to positive current polarity at start of rotation, and gradually changes to a lower positive bias. Dashed line 97083 shows time averaged mean current value which is similar to the DC type current 97083 of FIG. 138A during positive rotation, whereas higher mean current value 97083 due to a larger AC current 97085 positive bias at the start of slope 97083 of FIG. 13 8B may help start path selector 9701 rotation from first sorting position towards second sorting position, while lower mean current value of 97083 due to a smaller positive bias of AC current 97085 may indicate reaching desired second sorting position and reduction of rotational force to the value needed to maintain path selector 9701 to remain at second sorting position. Similarly, dashed line 97084 shows time averaged mean current value which is similar to the DC type current 97084 of FIG. 138A during negative rotation, whereas higher mean current value 97084 due to a larger AC current 97085 negative bias at the start of slope 97084 of FIG. 138B may help start path selector 9701 rotation from second sorting position towards first sorting position, while lower mean current value of 97084 due to a smaller negative bias of AC current 97085 may indicate reaching desired first sorting position and reduction of rotational force to the value needed to maintain path selector 9701 to remain at first sorting position.

FIG. 138B AC current frequency may be same as the resonant frequency of the combined mass of path selector 9701 and actuator 9707 during operation within cavities 97032 and 9706. FIG. 138B AC current frequency may also be at a value that correlates to said resonant frequency of the combined mass of path selector 9701 and actuator 9707, where said AC current frequency value may be an integer multiple of said resonant frequency, said AC current frequency may be at an value that this an offset increase or an offset decrease from said resonant frequency, said AC current frequency may also be at an value that this an offset increase or an offset decrease from an integer multiple of said resonant frequency. Said AC current frequency may be in the range of any of: between 10 Hertz (Hz) to 100 Hz, between 100 Hz to 1 kilo-Hertz (kHz), between 1 kHz to 10 kHz, between 10 kHz to 100 kHz, between 100 kHz to 1 Mega-Hertz (MHz), between 1 MHz to 2 MHz, between 2 MHz to 5 MHz, between 5 MHz to 10 MHz, between 10 MHz to 100 MHz. Said resonant frequency of the combined mass may be affected by any of: mass of path selector 9701, mass of actuator 9707, young's modulus of path selector 9701 and actuator 9707, spring force of coil lines 97081, inductance of voice coil 9708. FIG. 138B AC current driving scheme may provide a faster response time than FIG. 138A scheme in rotating path selector 9701 between various sorting positions, for example for sorting device 2002 with more than two sorting positions, which may also enable faster sorting of entities 1/10/20/30/612. FIG. 138B AC current driving scheme may also provide more resilience of actuator 9707 and path selector 9701 to external perturbations during sorting of entity 1/10/20/30/612 than FIG. 138A scheme FIG. 139 illustrates a second embodiment of a biological entity sorting device 2005 having a voice coil actuator 9707 being at a first sorting position. FIG. 139 is similar to FIG. 132 with a difference in the aspect where path selector 9701 and actuator 9707 of FIG. 132 are replaced with a single actuator 9707 of FIG. 139, and selection of fluidic path 9702 and path 9703, which are part of actuator 9707, is achieved through linear movement of actuator 9707 in FIG. 139, rather than rotation of path selector 9701 as in FIG. 132. Device 2005 of FIG. 139 may be part of UFL chip 600/6000 and may be contained within part of substrate 611 of UFL chip 600/6000, or may be a separate device by itself. Sorting device 2005 may contain a fluidic sample injection path 2100 for entity 1/10/20/30/612 injection into device 2005 for sorting, said path 2100 may be a continuation of channel 601/6072/910 of FIG. 110A through FIG. 131. In path 2100, or as part of channel 601/6072/910, entities 1/10/20/30/612 may first be detected by one or more detectors 901/9001/9002/9003, where controller 950 through connections 951 may control, and sense entity 1/10/20/30/612 optical signal from, detectors 901/9001/9002/9003. Said entity 1/10/20/30/612 optical signal may be processed or analyzed for category, or type, or identification, of the entities 1/10/20/30/612, for example into categories of 9601 and 9602 as in FIG. 139, by controller 950, or by computing device 955 of FIG. 121A and FIG. 121B connected to controller 950. FIG. 139 shows a substantially rectangular cavity 9706 that may be created within device body 9600 with a cavity wall 97042. Actuator 9707 may be located within said cavity 9706. Actuator 9707 and cavity wall 97042 may be in contact, especially at the edge of actuator 9707 where path 9702 or path 9703 fluidically connects to path 2100. Fluid path 9605 in device body 9600 may connect from cavity wall 97042 to an outlet 9607, and fluid path 9606 in device body 9600 may connect from cavity wall 97042 to another outlet 9608. Fluid path 9702 and fluid path 9703 may exist within actuator 9707. Actuator 9707 may move linearly within cavity 9706 within the cavity wall 97042. Actuator 9707 may be embedded with, or covered with, one or more voice coils 9708. Sorting function of sorting device 2005 is achieved by driving electric current through voice coil 9708 and cause a movement of actuator 9707 between different sorting positions. FIG. 139 shows when actuator 9707 may be at a first sorting position, where path 9703 within actuator 9707 may align with the channel 2100 exit at one end, and align with path 9606 entrance at another end, and thus establish a continuous fluid path from path 2100, through path 9703, and through path 9606 and exiting device 2005 through outlet 9608. In the case when actuator 9707 moves to a second sorting position, where path 9702 within actuator 9707 may align with the channel 2100 exit at one end, and align with path 9605 entrance at another end, and thus may establish a second continuous fluid path from path 2100, through path 9702, and through path 9605 and exiting through outlet 9607. Magnetic field 9709 having north and south polarities simultaneously may exist within the cavity 9706, where FIG. 139 shows north (N) polarity and south (S) polarity of the magnetic field 9709 exists side by side within cavity 9706, with N polarity on the left having magnetic field direction pointing out of the plane and S polarity on the right with magnetic field direction pointing into the plane of FIG. 139, and with the magnetic field from both N and S polarities having magnetic field components perpendicular to the voice coil 9708 plane. Voice coil 9708 may be in the form of single-turn or multiple-turn coils that may be located on a surface of the actuator 9707, or may be embedded within the body of the actuator 9707. Voice coil 9708 may be created by a first thin film deposition step including: PVD, CVD, ALD, PECVD, PEALD, or by a first metal electro-plating step, and then patterned into coil form by an etching step including: RIE, IBE, wet-etch. Voice coil 9708 may also be formed by a single thin film deposition step including: PVD, CVD, ALD, PECVD, PEALD, or by a first metal electro-plating step, over a pre-patterned photoresist-mask, or hard-mask existing on actuator 9707 to create coils 9708 on actuator 9707 through the spaces within said photoresist-mask, or hard-mask, where a photoresist removal or hard-mask removal process may be used to remove said photoresist-mask, or hard-mask afterwards. Clearance 97071 may exist at center of the actuator 9707 to reduce overall mass of actuator 9707, where voice coil 9708 may be created surrounding the clearance 97071. Sensor 9801 may exist at one or more locations on, or embedded within, the inside boundary wall 97042 of the cavity 9706, where sensor 9801 may sense the proximity, or distance, of the actuator 9707 to the boundary wall 97042 of cavity 9706. Controller 950 may receive signal from sensor 9801 through electrical connection 952 on proximity or distance of actuator 9707 to wall 97042, and controller 950 through electrical connection 953 may adjust or control the electric current amplitude and current direction within coil 9708 of actuator 9707 to control the movement of actuator 9707. Electric current may be applied to the voice coils 9708, where the arrows on the coils 9708 of FIG. 139 illustrate an example of a clock-wise electric current flowing within coils 9708, where said current within coil 9708 of FIG. 139 creates a magnetic field with a direction pointing into the plane of FIG. 139 against N polarity and being in same direction as S polarity of magnetic field 9709 of FIG. 139, where a net force may be exerted by the magnetic field 9709 onto the voice coil 9708, and cause a movement of the voice coil 9708, together with the actuator 9707, to move away from N polarity region and into the S polarity region of field 9709 as in FIG. 139, and thus causing an movement of actuator 9707 to right side of the cavity 9706 as in FIG. 139.

In the example as illustrated by FIG. 139, entities 1/10/20/30/612 in a fluid sample is injected into path 2100 in fluid flow 91010, where path 2100 may be an extension of channel 601/6072/910. One or more detectors 901/9001/9002/9003 located along path 2100 or channel 601/6072/910, similar as in FIG. 132, may detect optical signal from entities 1/10/20/30/612, where controller 950, which may be connected to detectors 901/9001/9002/9003 through connection 951, may receive and analyze signals from detectors 901/9001/9002/9003 and separate entities 1/10/20/30/612 into type 9601 "solid" entity and type 9602 "hollow" entity. Controller 950 may also determine a type 9601 entity may be the immediate entity that will exit path 2100 towards actuator 9707. Controller 950 through connection 952 may receive signal from sensor 9801 and may determine that actuator 9707 is at first sorting position, where type 9602 entities may be expected to flow through path 9703 and continue into path 9606 in the fluid flow 9604 and exiting the sorting device 2005 through outlet 9608. Controller 950 may determine actuator 9707 need to move to a second sorting position to allow said immediate type 9601 entity in path 2100 to enter path 9702 and continue into path 9605 into flow 9603 and exit device 2005 through outlet 9607. Controller 950 through connection 953 may command, or provide, or alternate, or change, electric current in voice coils 9708 into clock-wise direction as shown in FIG. 139 to cause voice coils 9708 to generate a magnetic field that is in the direction of S polarity, which is against the N polarity region of magnetic field 9709. With voice coils 9708 being mostly located within N polarity region of magnetic field 9709 as in FIG. 139, a net force may be exerted on voice coils 9708 by magnetic field 9709 with clock-wise current applied to voice coils 9708, making voice coils 9708, together with actuator 9707, move out of N region and into S region of magnetic field 9709, resulting in movement of actuator 9707 towards said second sorting position of device 2005.

During operation of sorting device 2005 of FIG. 139, spacing between actuator 9707 wall 97022 and cavity 9706 wall 97042 may be minimized to form continuous flow of fluid between path 2100 to paths 9702 and 9703, and further to paths 9605 and 9606, and to avoid fluid of flow 91010 flowing into cavity 9706. In one embodiment, wall 97022 and wall 97042 may be in contact during movement of actuator 9707, where lubricating film or anti-abrasion coating may be applied to either or both of contacting surfaces of wall 97022 and wall 97042, wherein said lubricating film of anti-abrasion coating may be a layer composed of organic molecules, said organic molecules may be repellant to water and oil. In one embodiment, spacing between wall 97022 and wall 97042 may be any of: from 0.1 nanometer (nm) to lnm, from 1 nm to 10 nm, from 10 nm to 100 nm, from 100 nm to 200 nm, from 200 nm to 500 nm, from 500 nm to 1 micrometer (um), from 1 um to 10 um, from 10 um to 20 um. In one embodiment, cavity 9706 may be filled with air, or gas including but not limited to: nitrogen, helium, argon, carbon dioxide, oxygen, where spacing between wall 97022 and wall 97042 may be sufficiently small where surface tension of fluid within liquid sample flow 91010 maintains fluid within paths 2100, 9702, 9703, 9605, 9606 at first and second sorting positions and during movement of actuator 9707, where surfaces of wall 97022 and wall 97042 may be composed of, or coated with, materials that is non-wettable, or hydrophobic, for liquid within sample flow 91010, thus help maintaining fluid within paths 2100, 9702, 9703, 9605, 9606.

In one embodiment, cavity 9706, especially the space between wall 97022 and wall 97042, where paths 9702, 9703, 9605 and 9606 terminate, may be filled with cavity fluid that is biological compatible with fluid sample of flow 91010, 9603 and 9604, where switching between sorting first and second positions of actuator 9707 and passage of fluid between paths 2100, 9702, 9703, 9605, 9606 may carry certain amount of said cavity fluid into flows 9603 and 9604, said cavity fluid may contain any of, but not limited to: water, saline, phosphate buffered saline, Ficoll. Said cavity fluid may be maintained at same, or higher, fluid pressure than flows 91010, 9603 and 9604, where fluid of sample flow 91010 may be maintained within paths 2100, 9702, 9703, 9605, 9606. Said cavity fluid may be supplied continuously from outside device 2005 of FIG. 139 and directly into cavity 9706 during operation of device 2005. Said cavity fluid may be initially supplied through flow 91010 when entities 1/10/20/30/612 are not supplied to flow 91010 and cavity fluid may flow from path 2100 in between walls 97022 and 97042 into the cavity 9706 space, and cavity fluid may then maintain its effective volume during operation of device 2005 and during movement of actuator 9707, where pressure within cavity fluid is maintained same as in flow 91010. Said cavity fluid may be confined, or sealed within, cavity 9706 wall 97042, where walls of cavity 9706 may be composed of, or coated with, materials that is non-wettable, or hydrophobic.

In FIG. 139, device body 9600, actuator 9707 may each be composed of any of: glass, silicon, quartz, aluminum-titanium-carbon (AlTiC), SiC, SiN, silicon-oxide, alumina, plastic, PDMS, polymer, ceramic, or metal, where metal may be composed any one or any alloy of aluminum, iron, nickel, titanium, chromium, platinum, tungsten, rhenium, copper, gold, silver. Voice coils 9708 may be formed on or within the actuator 9707. Spring 9802 may be optionally used to attach actuator 9707 to device body 9600, or wall 97042 of cavity 9706. Spring 9802 may provide spring back force in the movement direction of actuator 9707 to help stability and maintain actuator 9707 position when actuator 9707 reaches desired sorting positions. Spring 9802 may provide an enhanced resonance frequency of actuator 9707 and increase speed of response and movement of actuator 9707 during sorting operation. Spring 9802 may provide pressure force to maintain contact between surface 97022 and surface 97042 during movement of actuator 9707. Spring 9802 may act as electrical connection between device body and voice coil 9708, similar to coil wire 97081 of FIG. 137, where spring 9802 may connect to both voice coil 9708 on actuator 9707 and anchor points on device body 9600 of FIG. 139, where controller 950 may further connect to said anchor points through connection 953 to provide or control electric current in voice coil 9708 of FIG. 139.

Electric current in voice coil 9708 of FIG. 139 may be applied in schemes similar as described in FIG. 138A and FIG. 138B. Position encoders 9731 of FIG. 137 may be attached to actuator 9707 of FIG. 139 similarly as in FIG. 137, and position decoders 9732 may be embedded in device 2005 body 9600 or in cavity 9706 wall 97042 similar to FIG. 137, to provide detection of actuator 9707 position in cavity 9706 of FIG. 139.

FIG. 140 illustrates a third embodiment of a biological entity sorting device 2006 having a capacitive actuator being at a first sorting position. Sorting device 2006 may be similar to sorting device 2001 of FIG. 132 in every other aspect, except that actuator 9707 of device 2006 in FIG. 140 is moved by a capacitive driving mechanism instead of the voice coil 9708 of device 2001 in FIG. 132. In FIG. 140, actuator 9707 may include an actuator handle 9804 with attached actuator arms 98041. A base handle 9803 with attached base arms 98031 may be included in device body 9600, or within cavity 9706 as shown in FIG. 140. Actuator arms 98041 and base arms 98031 may be parallel plates that have parallel surfaces directly facing each other, or overlapping each other, where a movement of actuator arms 98041 and base arms 98031 relative to each other may increase or decrease effective surface areas of actuator arms 98041 and base arms 98031 directly facing each other. During operation of device 2006, controller 950 through connection 953 may provide electric voltage or current to actuator handle 9804, and subsequently to actuator arms 98041; controller 950 through connection 953 may provide electric voltage or current to base handle 9803, and subsequently to base arms 98031. Voltage applied to actuator arms 98041 and base arms 98031 may produce net electric charges on surfaces of actuator arms 98041 and base arms 98031, for example negative voltage may produce negative charges, i.e. electrons, on actuator arms 98041 and base arms 98031, while positive voltage may produce positive charges, i.e. electrons deficiencies on actuator arms 98041 and base arms 98031. When charges on actuator arms 98041 and base arms 98031 are of same polarity, for example both having negative charges, i.e. electrons existing on actuator arms 98041 and base arms 98031, actuator arms 98041 and base arms 98031 may repel each other and actuator arms 98041 may move away from the stationary base arms 98031 to reduce overlapping surface areas between actuator arms 98041 and base arms 98031. Thus, actuator arms 98041 may push actuator move to the left side of the cavity 9706 and causing path selector 9701 to rotate around hinge 9704 to first sorting position as shown in FIG. 140. When charges on actuator arms 98041 and base arms 98031 are of opposite polarity, for example one having negative charge and the other having negative charges, actuator arms 98041 and base arms 98031 may attract each other and actuator arms 98041 may move towards the stationary base arms 98031 to increase overlapping surface areas between actuator arms 98041 and base arms 98031. Thus, actuator arms 98041 may push actuator move to the right side of the cavity 9706 and causing path selector 9701 to rotate around hinge 9704 to second sorting position where path 9703 may align with path 2100 of device 2006. Actuator arms 98041 and base arms 98031 may comprise any of: glass, silicon, quartz, AlTiC, SiC, SiN, silicon-oxide, alumina, plastic, PDMS, polymer, ceramic, carbon, or metal, where metal may be composed any one or any alloy of aluminum, iron, nickel, titanium, tantalum, ruthenium, chromium, platinum, tungsten, rhenium, copper, gold, silver. Actuator arms 98041 and base arms 98031 may be composed of a non-metallic substrate coated with metallic layer. Actuator arms 98041 and base arms 98031 may be composed of a semiconductor material. Actuator handle 9804, base handle 9803, actuator arms 98041 and base arms 98031 may be part of a MEMS system included in sorting device 2006. Spring 9802 may be optionally used to attach actuator 9707 or actuator handle 9804 to device body 9600, or wall 97042 of cavity 9706. Spring 9802 may provide spring back force in the movement direction of actuator 9707 to help stability and maintain actuator 9707 position when actuator 9707 reaches desired sorting positions. Spring 9802 may provide an enhanced resonance frequency of actuator 9707 and increase speed of response and movement of actuator 9707 during sorting operation. Spring 9802 may act as electrical connection between device body 9600 and actuator handle 9804, where spring 9802 may connect to both actuator 9707, or actuator handle 9804, and anchor points on device body 9600 of FIG. 140, where controller 950 may further connect to said anchor points through connection 953 to provide or control electric voltage or current to actuator handle 9804 and actuator arms 98041. Voltage or current applied to one of actuator arms 98041 or base arms 98031 may take the form of: (1) DC signal, which may be in form similar to FIG. 138A; (2) AC signal, which may be in form similar to FIG. 138B, while voltage or current applied to the other one of actuator arms 98041 or base arms 98031 may take the form of: (1) constant DC signal; (2) DC signal, which may be in form similar to FIG. 138A; (3) AC signal, which may be in form similar to FIG. 138B. When AC voltage or current signal is applied to at least one of actuator arms 98041 or base arms 98031, frequency of said AC signal may be at resonant frequency of combined structure of path selector 9701, actuator 9707, actuator handle 9804, actuator arms 97041 and spring 9802.

Actuator sensors 9801 of FIG. 132 may be included in cavity 9706 of FIG. 140. Position encoders 9731 of FIG. 137 may be attached to actuator 9707 of FIG. 140 similarly as in FIG. 137, and position decoders 9732 may be embedded in device 2006 body 9600 or in cavity 9706 wall 97042 similar to FIG. 137, to provide detection of actuator 9707 position in cavity 9706 of FIG. 140.

FIG. 141 illustrates a fourth embodiment of a biological entity sorting device 2007 having a capacitive actuator being at a first sorting position. Sorting device 2007 may be similar to sorting device 2005 of FIG. 139 in every other aspect, except that actuator 9707 of device 2007 in FIG. 141 is moved by a capacitive driving mechanism instead of the voice coil 9708 of device 2005 in FIG. 139. In FIG. 141, actuator 9707 may include an actuator handle 9804 with attached actuator arms 98041. A base handle 9803 with attached base arms 98031 may be included in device body 9600, or within cavity 9706 as shown in FIG. 141. Actuator arms 98041 and base arms 98031 may be parallel plates that have parallel surfaces directly facing each other, or overlapping each other, where a movement of actuator arms 98041 and base arms 98031 relative to each other may increase or decrease effective surface areas of actuator arms 98041 and base arms 98031 directly facing each other. During operation of device 2007, controller 950 through connection 953 may provide electric voltage or current to actuator arms 98041 and base arms 98031. Voltage or current applied to actuator arms 98041 and base arms 98031 may cause actuator arms 98041 to move away, or move towards, stationary base arms 98031 similar to operation of actuator arms 98041 and base arms 98031 in FIG. 140. When charges on actuator arms 98041 and base arms 98031 are of same polarity, actuator arms 98041 and base arms 98031 may repel each other and actuator arms 98041 may move away from the stationary base arms 98031, where actuator arms 98041 may push actuator 9707 to the left side of the cavity 9706 to first sorting position as shown in FIG. 141. When charges on actuator arms 98041 and base arms 98031 are of opposite polarity, actuator arms 98041 and base arms 98031 may attract each other and actuator arms 98041 may move towards the stationary base arms 98031, where actuator arms 98041 may push actuator 9707 move to the right side of the cavity 9706 to second sorting position where path 9702 may align with path 2100 of device 2007. Actuator arms 98041 and base arms 98031 may comprise same materials and structures as in FIG. 140. Actuator handle 9804, base handle 9803, actuator arms 98041 and base arms 98031 may be part of a MEMS system included in sorting device 2007. Spring 9802 may be optionally used to attach actuator 9707 or actuator handle 9804 to device body 9600, or wall 97042 of cavity 9706. Spring 9802 may provide spring back force in the movement direction of actuator 9707 to help stability and maintain actuator 9707 position when actuator 9707 reaches desired sorting positions. Spring 9802 may provide an enhanced resonance frequency of actuator 9707 and increase speed of response and movement of actuator 9707 during sorting operation. Voltage or current application schemes to actuator arms 98041 and base arms 98031 may be same as described in FIG. 140. When AC voltage or current signal is applied to at least one of actuator arms 98041 or base arms 98031, frequency of said AC signal may be at resonant frequency of combined structure of actuator 9707, actuator handle 9804, actuator arms 97041 and spring 9802.

Actuator sensors 9801 of FIG. 132 may be included in cavity 9706 of FIG. 141. Position encoders 9731 of FIG. 137 may be attached to actuator 9707 of FIG. 141 similarly as in FIG. 137, and position decoders 9732 may be embedded in device 2007 body 9600 or in cavity 9706 wall 97042 similar to FIG. 137, to provide detection of actuator 9707 position in cavity 9706 of FIG. 141.

FIG. 142 illustrates a fifth embodiment of a biological entity sorting device 2008 having a thermal-elastic actuator being at a first sorting position. Sorting device 2008 may be similar to sorting device 2006 of FIG. 140 in every other aspect, except that actuator 9707 of device 2008 in FIG. 142 is moved by a thermal-elastic driving mechanism instead of the capacitive driving mechanism of device 2006 in FIG. 140. In FIG. 142, actuator 9707 may be attached to one end of elastic arm 98051 through an actuator handle 9804, where the other end of the elastic arm 98051 may attached to a base handle 9805. Base handle 9805 may be included in device body 9600, or within cavity 9706 as shown in FIG. 142. During operation of device 2008, controller 950 through connection 953 may provide electric voltage or current to actuator handle 9804 and base handle 9805, and subsequently may cause an electric voltage across, or an electric current flowing within, elastic arm 98051. Voltage or current applied to elastic arm 98051, including amplitude, polarity, frequency and time of duration of applied voltage or current, may cause increase of length, i.e. elongation, or reduction of length, i.e. contraction, of elastic arm 98051. When elastic arm 98051 elongates, elastic arm 98051 may push actuator 9707 to the left side of the cavity 9706 and causing path selector 9701 to rotate around hinge 9704 to first sorting position as shown in FIG. 142. When elastic arm 98051 contracts, elastic arm 98051 may pull actuator 9707 move to the right side of the cavity 9706 and causing path selector 9701 to rotate around hinge 9704 to second sorting position where path 9703 may align with path 2100 of device 2008. Elastic arm 98051 may comprise any of: glass, silicon, quartz, AlTiC, SiC, SiN, silicon-oxide, alumina, plastic, PDMS, polymer, ceramic, carbon, or metal, where metal may be composed any one or any alloy of aluminum, iron, nickel, titanium, tantalum, ruthenium, chromium, platinum, tungsten, rhenium, copper, gold, silver. Elastic arm 98051 may be composed of a memory metal that may change to a specific shape, or length, when elastic arm 98051 is heated, for example by current applied to elastic arm 98051. Elastic arm 98051 may be composed of a metallic or non-metallic material that expands or contracts when elastic arm 98051 may be heated or cooled.

Actuator handle 9804, base handle 9805, elastic arm 98051 may be part of a MEMS system included in sorting device 2008. Spring 9802 may be optionally used to attach actuator 9707 or actuator handle 9804 to device body 9600, or wall 97042 of cavity 9706. Spring 9802 of FIG. 142 may function similarly as described in FIG. 140. Voltage or current applied to elastic arm 98051 may take the form of: (1) constant DC signal; (2) DC signal, which may be in form similar to FIG. 138A; (3) AC signal, which may be in form similar to FIG. 138B. When AC voltage or current signal is applied to elastic arm 98051, frequency of said AC signal may be at resonant frequency of combined structure of path selector 9701, actuator 9707, actuator handle 9804, elastic arm 97051 and spring 9802.

Actuator sensors 9801 of FIG. 132 may be included in cavity 9706 of FIG. 142. Position encoders 9731 of FIG. 137 may be attached to actuator 9707 of FIG. 142 similarly as in FIG. 137, and position decoders 9732 may be embedded in device 2007 body 9600 or in cavity 9706 wall 97042 similar to FIG. 137, to provide detection of actuator 9707 position in cavity 9706 of FIG. 142.

FIG. 143 illustrates a sixth embodiment of a biological entity sorting device 2009 having a thermal-elastic actuator being at a first sorting position. Sorting device 2009 may be similar to sorting device 2007 of FIG. 141 in every other aspect, except that actuator 9707 of device 2009 in FIG. 143 is moved by a thermal-elastic driving mechanism instead of the capacitive driving mechanism of device 2007 in FIG. 141. In FIG. 143, actuator 9707 may be attached to one end of elastic arm 98051 through an actuator handle 9804, where the other end of the elastic arm 98051 may attached to a base handle 9805. Base handle 9805 may be included in device body 9600, or within cavity 9706 as shown in FIG. 143. During operation of device 2009, controller 950 through connection 953 may provide electric voltage or current to actuator handle 9804 and base handle 9805, and subsequently may cause an electric voltage across, or an electric current flowing within, elastic arm 98051. Voltage or current applied to elastic arm 98051, including amplitude, polarity, frequency and time of duration of applied voltage or current, may cause increase of length, i.e. elongation, or reduction of length, i.e. contraction, of elastic arm 98051. When elastic arm 98051 elongates, elastic arm 98051 may push actuator 9707 to the left side of the cavity 9706 to first sorting position as shown in FIG. 143. When elastic arm 98051 contracts, elastic arm 98051 may pull actuator 9707 move to the right side of the cavity 9706 to second sorting position where path 9702 may align with path 2100 of device 2009. Elastic arm 98051 may comprise same material as described in FIG. 142.

Actuator handle 9804, base handle 9805, elastic arm 98051 may be part of a MEMS system included in sorting device 2009. Spring 9802 may be optionally used to attach actuator 9707 or actuator handle 9804 to device body 9600, or wall 97042 of cavity 9706. Spring 9802 of FIG. 143 may function similarly as described in FIG. 140. Voltage or current applied to elastic arm 98051 may take the form of: (1) constant DC signal; (2) DC signal, which may be in form similar to FIG. 138A; (3) AC signal, which may be in form similar to FIG. 138B. When AC voltage or current signal is applied to elastic arm 98051, frequency of said AC signal may be at resonant frequency of combined structure of actuator 9707, actuator handle 9804, elastic arm 97051 and spring 9802.

Actuator sensors 9801 of FIG. 132 may be included in cavity 9706 of FIG. 143. Position encoders 9731 of FIG. 137 may be attached to actuator 9707 of FIG. 143 similarly as in FIG. 137, and position decoders 9732 may be embedded in device 2007 body 9600 or in cavity 9706 wall 97042 similar to FIG. 137, to provide detection of actuator 9707 position in cavity 9706 of FIG. 143.

FIG. 144A illustrates example of FIG. 135A device having flow paths 9605 and 9606 with device body 9600 being covered by top covers 610, and flow paths 9702 and 9703 within path selector 9701 being covered by separate top cover 97015. FIG. 144A sorting device 2010 serves as another example of implementation of FIG. 132. Sorting device 2010, same as device 2003 of FIG. 135A, may have same coil lines 97081 connecting from voice coil 9708 of actuator 9707 to device body 9600, where coil lines 97081 connection points on device body 9600 may then further connect to controller 950 through connection 953. Coil lines 97081 may have same function, material and properties as in FIG. 135A. FIG. 144A differs from FIG. 135A in that the path selector 9701 is capped with cover layer 97015, which may cover over the paths 9702 and 9703 and share the same circular boundary wall 97012 as the path selector 9701. Path selector 9701, with the cover 97015 and actuator 9707, may form a single rotational body around hinge 9704, where said rotation body separates from cavity wall 97042 of third cavity 97052 by a gap 97052, whereas cavity 97032 may be same as described in FIG. 135A. Cover 610 then covers over the device body 9600 and cover the paths 2100, 9605 and 9606. In FIG. 144A, device body 9600 with cover 610, path selector 9701 with cover 97015, may be fabricated as separate parts and assembled together into sorting device 2010. Gap 97052 may be zero when walls 97012 and 97042 may be in contact and lubricating layer may exist on surfaces of walls 97012 and 97042.

FIG. 144B illustrates an example view of FIG. 144A device 2010 along cross section direction 9902 of FIG. 144A. In FIG. 144B, paths 9605 and 9606 are shown to be also formed within substrate 611 and enclosed by cover 610. In one embodiment, paths 2100, 9605 and 9606 of device 2003 may be formed in substrate 611 or device body 9600 in a single etching step. FIG. 144B also shows that cavity 97032 may be formed as a circular trench within substrate 611. Hinge 9704 may be in the form of a solid protrusion structure same as described in FIG. 135C, from bottom surface 97033 of cavity 97032. Path selector 9701 may reside within the cavity 97032 and may rest on top of hinge 9704 with a notch 97041 at the bottom of path selector 9701. Notch 97041 may match to hinge 9704 shape and may provide rotational stability of path selector 9701 during operation as described in FIG. 132 and FIG. 133. Paths 9702 and 9703 are shown to be formed within path selector 9701 and enclosed by cover 97015. Air, various gas, or cavity fluid as described in FIG. 132 may reside within gap 97052 between walls 97012 and 97042, and between cavity 97032 surface 97033 and bottom surface 97013 of path selector 9701.

FIG. 144C illustrates view of FIG. 144A device along cross section direction 9903. FIG. 144C shows actuator 9707 having voice coil 9708 may reside within cavity 9706, where coil lines 97081 attached to voice coil 9708 and substrate 611 may provide electrical connection between controller 950 and voice coil 9708. Coil lines 97081 may function same as described in FIG. 135A. Bottom surface 97061 of cavity 9706 may be same surface as surface 97033 of cavity 97032 when cavity 97302 and 9706 may be created in same steps during fabrication of sorting device 2010. Surface 97061 may be above surface 97033, where cavity 97302 and cavity 9706 may be created in different steps. Cavity fluid as described FIG. 132 may be confined within cavity 97032, especially when surface 97061 is above surface 97013 of path selector 9701, where a sufficiently narrow gap 97052 between walls 97012 and 97042, or when walls 97012 and 97042 are in contact, may provide an effective confinement, or sealing, of cavity fluid in said cavity 97032 gap between surfaces 97013 and 97033. In FIG. 144C, actuator 9707 does not have cover 97015 of FIG. 144B.

FIG. 144D illustrates an alternative example of FIG. 144C, where FIG. 144D may be same as FIG. 144C, except the cover 97015 also covers over actuator 9707, and may encapsulate the voice coil 9708.

FIG. 144E illustrates an alternative example of FIG. 144B, where FIG. 144E may be same as FIG. 144B, except that another cover 61001 may cover over the entire device body 9600 of FIG. 144A, forming an enclosure that encapsulates the structures including cavity 97032, cavity 9706, rotation entity comprising path selector 9701, actuator 9707 and cover 97015, wherein said enclosure may hermitically encapsulates said structures. Air, various gas, or cavity fluid as described in FIG. 132 may reside within said encapsulation by said cover 61001 and said device body 9600. Cover 601 of FIG. 144E may be part of said cover 61001. Encapsulation by a cover 61001 over device body 9600 as shown in FIG. 144E may be applied to sorting devices 2001, 2002, 2003, 2004, 2005, 2006, 2007, 2008, 2009, 2011, 2012, 2013, from FIG. 132 through FIG. 150 similarly.

FIG. 145 illustrates external controller driving of sorting devices, including any of sorting devices 2001, 2002, 2003, 2004, 2005, 2006, 2007, 2008, 2009, 2011, 2012, 2013, from FIG. 132 through FIG. 150. FIG. 132 sorting device 2001 is used as an example structure as sorting device 2011 as in FIG. 145. In FIG. 145, embedded controller 950 as in FIG. 132 is replaced with external controller 954, similarly as described in FIG. 120B, where all electronically controlled components, including detectors 901/9001/9002/9003, sensors 9801, voice coil 9708, position decoder 9732 may be connected by electrical connections 951 to external electrical contacts 952 on the outside surface of device body 9600, where external electrical connections 953 may then further connect from said contacts 952 to an external controller 954, where controller 954 may realize functions of embedded controller 950 of FIG. 132. External controller 954 scheme of FIG. 145 may be applied to replaced embedded controller 950 of sorting devices 2001, 2002, 2003, 2004, 2005, 2006, 2007, 2008, 2009, 2012, 2013, from FIG. 132 through FIG. 150 similarly.

FIG. 146 illustrates an example of using multiple FIG. 134A devices 2002 in cascade arrangement to increase sorting categories. In FIG. 146, output samples from outlets 9607, 9608, 9609, 9610 of a first tier device 2002 may be sent to input path 2100 of four second tier sorting devices 2002, where entities 1/10/20/30/612 within each said output sample may be further sorted by each corresponding second tier sorting device 2002 according to optical properties, for example types fluorescent molecules included in entities 1/10/20/30/612, or physical properties, for example entity 1/10/20/30/612 size, with detector 901/9001/9002/9003 of each of said corresponding second tier sorting device 2002. When one or more of said second tier sorting device 2002 detects same optical properties as first tier device 2002, said second tier sorting device 2002 may function to further purify the sorted sample from outlets 9607, 9608, 9609, 9610 of said first tier device 2002. When one or more of said second tier sorting device 2002 detects different optical properties as first tier device 2002, said second tier sorting device 2002 may function to further categorize and separate the sorted sample from outlets 9607, 9608, 9609, 9610 of said first tier device 2002 into more categories. First tier and second tier devices 2002 may be isolated devices, where fluidic connections from outlets 9607, 9608, 9609, 9610 of first tier device 2002 to input path 2100 of second tier sorting devices 2002 may be through fluidic lines or external tubing. First tier and second tier devices 2002 may be manufactured at different locations, or at different thickness levels, within a same device body 9600, where fluidic connections from outlets 9607, 9608, 9609, 9610 of first tier device 2002 to input path 2100 of second tier sorting devices 2002 may be through fluidic paths embedded within said device body 9600. First tier and second tier devices 2002 of FIG. 146 may each be replaced by any of sorting devices 2001, 2003, 2004, 2005, 2006, 2007, 2008, 2009, 2012, 2013, from FIG. 132 through FIG. 150, where a second tier device may be used to further purify or to further sub-categorize output sample from a first tier device may be readily applied.

FIG. 147 illustrates a seventh embodiment of a biological entity sorting device 2012 having a voice coil actuator 9707 being at a first sorting position. FIG. 147 sorting device 2012 is similar to device 2001 of FIG. 132 in operation, except the path selector 9701 of device 2012 does not have embedded flow paths 9702 or 9703 as in device 2001 of FIG. 132, where in FIG. 147 entities 9601 and 9602 are selected and passed into path 9605 or path 9606 within device body 9600 by a selector gate 97011 attached to path selector 9701 of device 2012 in FIG. 147 to selectively allow entities 9601 or 9602 to pass into one of path 9605 or path 9606 while blocking passage into other path.

Sorting device 2012 may be included within a device body 9600. Device 2012 may be part of UFL chip 600/6000 and may be contained within part of substrate 611 of UFL chip 600/6000, or may be a separate device by itself. Sorting device 2012 may contain a fluidic sample injection path 2100 for entity 1/10/20/30/612 injection into device 2012 for sorting, said path 2100 may be a continuation of channel 601/6072/910 of FIG. 110A through FIG. 131A. In path 2100, or as part of channel 601/6072/910, entities 1/10/20/30/612 may first be detected by one or more detectors 901/9001/9002/9003, where controller 950 through connections 951 may control, and sense entity 1/10/20/30/612 optical signal from, detectors 901/9001/9002/9003. Said entity 1/10/20/30/612 optical signal may be processed or analyzed for category, or type, or identification, of the entities 1/10/20/30/612, for example into categories of 9601 and 9602 as in FIG. 147, by controller 950, or by computing device 955 of FIG. 121A and FIG. 121B connected to controller 950. Sorting function of sorting device 2012 is achieved by a voice coil 9708 actuated rotational fluid path selector 9701. FIG. 147 shows a substantially circular first cavity 97062 may be created within device body 9600 with a cavity wall 97042. First cavity 97062 of FIG. 147 is different than first cavity 97032 of FIG. 132 in that first cavity 97062 has opening towards flow paths 2100, 9605, 9606 to allow selector gate 97011 to extend into fluid flow 91010 and flow 9603. Path selector 9701 having a substantially circular shape may be located within said cavity 97062 and surrounded by cavity wall 97042. Path selector 9701 circumference wall 97012 and cavity wall 97042 may be in contact, or a spacing may exist between selector wall 97012 and cavity wall 97042. Path selector 9701 may be positioned over, or around, or onto, a central hinge 9704 at the center of the path selector 9701, and path selector 9701 may rotate around hinge 9704 in the first cavity 97062 within the cavity wall 97042. Actuator 9707 embedded with, or covered with, one or more voice coils 9708 may be attached to the path selector 9701, where a movement of actuator 9707 may cause path selector 9710 to rotate within the cavity wall 97042 around hinge 9704. FIG. 147 shows when path selector 9701 being at a first sorting position, where selector gate 97011 attached to path selector 9701 is positioned at the entrance of path 9606 to block entities 1/10/20/30/612 in flow 91010 within path 2100 from entering path 9606, while allowing said entities 1/10/20/30/612 to enter path 9605 as flow 9603. In the case when path selector 9701 rotates due to movement of actuator 9707 to a second sorting position, where selector gate 97011 attached to path selector 9701 may be positioned at the entrance of path 9605 to block entities 1/10/20/30/612 in flow 91010 within path 2100 from entering path 9605, while allowing said entities 1/10/20/30/612 to enter path 9606. Actuator 9707 may be located within a second cavity 9706 in the device body 9600, where second cavity 9706 may be created at the same step as the first cavity 97062. Magnetic field 9709 having north and south polarities simultaneously may exist within the cavity 9706, where FIG. 147 shows north (N) polarity and south (S) polarity of the magnetic field 9709 exists side by side within cavity 9706, with N polarity on the left having magnetic field direction pointing out of the plane and S polarity on the right with magnetic field direction pointing into the plane of FIG. 147, and with the magnetic field from both N and S polarities having magnetic field components perpendicular to the voice coil 9708 plane. Voice coil 9708 may be in the form of single-turn or multiple-turn coils that may be located on a surface of the actuator 9707, or may be embedded within the body of the actuator 9707. Voice coil 9708 may be created on top of, or within actuator 9708, same as described in FIG. 132. Clearance 97071 may exist at center of the actuator 9707 to reduce overall mass of actuator 9707, where voice coil 9708 may be created surrounding the clearance 97071. Sensor 9801 may exist at one or more locations on, or embedded within, the inside boundary wall of the cavity 9706, where sensor 9801 may sense the proximity, or distance, of the actuator 9707 to the boundary wall of cavity 9706. Controller 950 may receive signal from sensor 9801 through electrical connection 952 on proximity or distance of actuator 9707 to the left and right boundaries of FIG. 132 cavity 9706, and controller 950 through electrical connection 953 may adjust or control the electric current amplitude and current direction within coil 9708 of actuator 9707 to control the movement of actuator 9707 and thus the rotation of path selector 9701. Electric current may be applied to the voice coils 9708, where the arrows on the coils 9708 of FIG. 147 illustrate an example of a clock-wise electric current flowing within coils 9708, where said current within coil 9708 of FIG. 147 creates a magnetic field with a direction pointing into the plane of FIG. 147 against N polarity and being in same direction as S polarity of magnetic field 9709 of FIG. 132, where a net force may be exerted by the magnetic field 9709 onto the voice coil 9708, and cause a movement of the voice coil 9708, together with the actuator 9707, to move away from N polarity region and into the S polarity region of field 9709 as in FIG. 147, and thus causing an rotation of path selector 9701.

In the example as illustrated by FIG. 147, entities 1/10/20/30/612 in a fluid sample is injected into path 2100 in fluid flow 91010, where path 2100 may be an extension of channel 601/6072/910. One or more detectors 901/9001/9002/9003 located along path 2100 or channel 601/6072/910, similar as in FIG. 118A, FIG. 124A, FIG. 129A, may detect optical signal from entities 1/10/20/30/612, where controller 950, which may be connected to detectors 901/9001/9002/9003 through connection 951, may receive and analyze signals from detectors 901/9001/9002/9003 and separate entities 1/10/20/30/612 into type 9601 "solid" entity and type 9602 "hollow" entity. Controller 950 may also determine a type 9602 entity may be the immediate entity that will exit path 2100 towards selector gate 97011. Controller 950 through connection 952 may receive signal from sensor 9801 and may determine that path selector 9701 is at first sorting position, where type 9601 entities may be expected to flow into path 9605 in the fluid flow 9603 due to blockage of selector gate 97011 on path 9606, and exiting the sorting device 2012 through outlet 9607. Controller 950 may determine path selector 9801 need to rotate to a second sorting position to allow said immediate type 9602 entity in path 2100 to enter path 9606 into flow 9604 and exit device 2012 through outlet 9608. Controller 950 through connection 953 may command, or provide, or alternate, or change, electric current in voice coils 9708 into clock-wise direction as shown in FIG. 147 to cause voice coils 9708 to generate a magnetic field that is in the direction of S polarity and against the N polarity region of magnetic field 9709. With voice coils 9708 being mostly located within N polarity region of magnetic field 9709 as in FIG. 147, a net force may be exerted on voice coils 9708 by magnetic field 9709 with clock-wise current applied to voice coils 9708, making voice coils 9708, together with actuator 9707, move out of N region and into S region of magnetic field 9709. Movement of actuator 9707 that is attached to path selector 9701 will then cause path selector 9701 to rotate around hinge 9704 in direction 9705 towards said second sorting position of device 2012 and allowing selector gate 97011 to block flow 91010 entrance into path 9605 and allow flow 91010 entrance into path 9606.

Selector gate 97011 may comprise micro-fluidic pathways 9990. Micro-fluidic pathways 9990 may be in the form of clearances through selector gate 97011 in the direction of selector gate 97011 movement. Micro-fluidic pathways 9990 may also be in the form of through trenches formed on top surface of selector gate 97011 facing out of FIG. 147 view, or form on bottom surface of selector gate 97011 facing into FIG. 147 view. Micro-fluidic pathways 9990 may have dimensions that are enough to allow passage of fluidic solution of flow 91010 to pass through selector gate 97011 during movement of selector gate 97011 through the fluid of flow 91010, while said dimensions being small enough to block entity 1/10/20/30/612 from moving through selector gate 97011. Micro-fluidic pathways 9990 may function to reduce fluidic drag on selector gate 97011 during movement of selector gate 97011.

During operation of sorting device 2012, spacing between path selector 9701 wall 97012 and cavity 97062 wall 97042 may be minimized to avoid fluid of flow 91010 flowing into cavity 97062 or cavity 9706. In one embodiment, wall 97012 and wall 97042 may be in contact during rotation of path selector 9701 around hinge 9704, where lubricating film or anti-abrasion coating may be applied to either or both of contacting surfaces of wall 97012 and wall 97042, wherein said lubricating film of anti-abrasion coating may be a layer composed of organic molecules, said organic molecules may be repellant to water and oil. In one embodiment, spacing between wall 97012 and wall 97042 may be any of: from 0.1 nanometer (nm) to lnm, from 1 nm to 10 nm, from 10 nm to 100 nm, from 100 nm to 200 nm, from 200 nm to 500 nm, from 500 nm to 1 micrometer (um), from 1 um to 10 um, from 10 um to 20 um. In one embodiment, cavity 97062 may be filled with air, or gas including but not limited to: nitrogen, helium, argon, carbon dioxide, oxygen, where spacing between wall 97012 and wall 97042 may be sufficiently small where surface tension of fluid within liquid sample flow 91010 maintains fluid within paths 2100, 9605, 9606 at first and second sorting positions and during rotation of path selector 9701, where surfaces of wall 97012 and wall 97042 may be composed of, or coated with, materials that is non-wettable, or hydrophobic, for liquid within sample flow 91010, thus help maintaining fluid within paths 2100, 9605, 9606.

In one embodiment, cavity 97062 space between wall 97012 and wall 97042, may be filled with cavity fluid that is biological compatible with fluid sample of flow 91010, 9603 and 9604, where said cavity fluid may contain any of, but not limited to: water, saline, phosphate buffered saline, Ficoll. Said cavity fluid may be maintained at same, or higher, fluid pressure than flows 91010, 9603 and 9604, where fluid of sample flow 91010 may be maintained within paths 2100, 9605, 9606. Said cavity fluid may be supplied continuously from outside device 2012 directly into cavity 97062 during operation of device 2012. Said cavity fluid may be initially supplied through flow 91010 when entities 1/10/20/30/612 are not supplied to flow 91010 and cavity fluid may flow from path 2100 in between walls 97012 and 97042 into the cavity 97062 space, and cavity fluid may then maintain its effective volume during operation of device 2012 during rotation of path selector 9701, where pressure within cavity fluid is maintained same as in flow 91010. Said cavity fluid may be confined, or sealed within, cavity 97062 wall 97042 and not entering cavity 9706, where cavity 9706 may be filled with air, or gas including but not limited to: nitrogen, helium, argon, carbon dioxide, oxygen, where walls of cavity 9706 may be composed of, or coated with, materials that is non-wettable, or hydrophobic, for cavity fluid within cavity 97062, to help maintain cavity fluid within cavity 97062.

In FIG. 147, device body 9600, path selector 9701, actuator 9707, selector gate 97011 may each be composed of any of: glass, silicon, quartz, aluminum-titanium-carbon (AlTiC), SiC, SiN, silicon-oxide, alumina, plastic, PDMS, polymer, ceramic, or metal, where metal may be composed any one or any alloy of aluminum, iron, nickel, titanium, chromium, platinum, tungsten, rhenium, copper, gold, silver. Path selector 9701, selector gate 97011, and actuator 9707 may be created as a single piece, where voice coils 9708 are formed on or within the actuator 9707 part of said single piece. Path selector 9701, selector gate 97011, and actuator 9707 may also be created as separate pieces, and joined together afterwards through any of: soldering, welding, gluing, mechanical attachment. Paths 2100, 9605, 9606 may be formed within device body 9600 in same manufacture steps simultaneously.

Encapsulation structure of FIG. 135A through FIG. 135E may be applied to FIG. 147 device 2012 similarly. Hinge 9704 form and function with path selector 9701 as described in FIG. 135C and FIG. 135D may be applied to FIG. 147 device 2012 similarly. Method to create field 9709 of FIG. 132 as described in FIG. 136A through FIG. 136D may be applied to FIG. 147 device 2012 similarly. Position encoders 9731 of FIG. 137 may be attached to actuator 9707 of FIG. 147 similarly as in FIG. 137, and position decoders 9732 may be embedded in device 2012 body 9600 or in cavity 9706 wall 97042 similar to FIG. 137, to provide detection of actuator 9707 position in cavity 9706 of FIG. 147. Electric current driving methods of FIG. 138A and FIG. 138B may be applied to device 2012 of FIG. 147 similarly. For FIG. 138B AC current driving application to device 2012 of FIG. 147, FIG. 138B AC current frequency may be same as the resonant frequency of the combined mass of path selector 9701, selector gate 91011 and actuator 9707. FIG. 138B AC current frequency applied in device 2012 may also be at a value that correlates to said resonant frequency of the combined mass of path selector 9701, selector gate 91011 and actuator 9707, where said AC current frequency value may be an integer multiple of said resonant frequency, said AC current frequency may be at an value that this an offset increase or an offset decrease from said resonant frequency, said AC current frequency may also be at an value that this an offset increase or an offset decrease from an integer multiple of said resonant frequency. Said resonant frequency of the combined mass may be affected by any of: mass of path selector 9701, mass of selector gate 91011, mass of actuator 9707; young's modulus values of path selector 9701, selector gate 91011 and actuator 9707; spring force of coil lines 97081; inductance of voice coil 9708. Said AC current frequency may be in the range of any of: between 10 Hertz (Hz) to 100 Hz, between 100 Hz to 1 kilo-Hertz (kHz), between 1 kHz to 10 kHz, between 10 kHz to 100 kHz, between 100 kHz to 1 Mega-Hertz (MHz), between 1 MHz to 2 MHz, between 2 MHz to 5 MHz, between 5 MHz to 10 MHz, between 10 MHz to 100 MHz. Capacitive actuator of FIG. 140, thermal-elastic actuator of FIG. 142 may also be applied to device 2012 of FIG. 147 to replace the voice coil actuator 9707 of device 2012 similarly.

FIG. 148 illustrates FIG. 147 sorting device 2012 at a second sorting position. FIG. 148 is the result of the operation as described in FIG. 147 example. Following FIG. 147 operation, actuator 9707 moves towards S region of the magnetic field 9709, where controller 950 through sensor 9801 detects actuator 9707 proximity or distance to the right side boundary wall of cavity 9706 while controlling electric current amplitude and direction flowing in voice coils 9708, until actuator 9707 rotates the path selector 9701 to reach second sorting position, where selector gate 97011 attached to path selector 9701 may be positioned at the entrance of path 9605 to block entities 1/10/20/30/612 in flow 91010 within path 2100 from entering path 9605, while allowing said entities 1/10/20/30/612 to enter path 9606. At second sorting position of FIG. 148, the immediate type 9602 entity exiting the path 2100 as in FIG. 147 moves into desired path 9606 and ultimately exiting sorting device 2001 through outlet 9608. From described example of FIG. 147 and FIG. 148, one step of sorting one type 9602 entity into desired flow path 9606 may be achieved. At second position of FIG. 148, following same operation as in FIG. 147, controller 950 may determine the immediate exiting entity within path 2100 may now become type 9601 entity, where controller 950 may reverse the electric current in voice coil 9708 to counter-clock-wise direction, such that voice coil 9708 may produce a magnetic field in the N direction and the net magnetic force exerted on actuator 9707 from magnetic field 9709 may become pushing the actuator back into the N region of the magnetic field 9709 and cause rotation of path selector 9701 back to the first sorting position as shown in FIG. 147 to complete another sorting step of moving immediate 9601 entity into desired path 9605.

FIG. 149 illustrates an eighth embodiment of a biological entity sorting device 2013 having a voice coil actuator 9707 being at a first sorting position. FIG. 149 sorting device 2013 is similar to device 2005 of FIG. 139 in operation, except the path selector 9701 of device 2013 does not have embedded flow paths 9702 or 9703 as in device 2005 of FIG. 139, where in FIG. 149 entities 9601 and 9602 are selected and passed into path 9605 or path 9606 within device body 9600 by a selector gate 97011 attached to path selector 9701 of device 2013 in FIG. 149 to selectively allow entities 9601 or 9602 to pass into one of path 9605 or path 9606 while blocking passage into other path. Device 2013 of FIG. 149 may be part of UFL chip 600/6000 and may be contained within part of substrate 611 of UFL chip 600/6000, or may be a separate device by itself. Sorting device 2013 may contain a fluidic sample injection path 2100 for entity 1/10/20/30/612 injection into device 2013 for sorting, said path 2100 may be a continuation of channel 601/6072/910 of FIG. 110A through FIG. 131. In path 2100, or as part of channel 601/6072/910, entities 1/10/20/30/612 may first be detected by one or more detectors 901/9001/9002/9003, where controller 950 through connections 951 may control, and sense entity 1/10/20/30/612 optical signal from, detectors 901/9001/9002/9003. Said entity 1/10/20/30/612 optical signal may be processed or analyzed for category, or type, or identification, of the entities 1/10/20/30/612, for example into categories of 9601 and 9602 as in FIG. 149, by controller 950, or by computing device 955 of FIG. 121A and FIG. 121B connected to controller 950. FIG. 149 shows a substantially rectangular cavity 9706 that may be created within device body 9600 with a cavity wall 97042. Actuator 9707 may be located within said cavity 9706. Actuator 9707 and cavity wall 97042 may be in contact, especially at the edge 97022 of actuator 9707 that forms part of fluid entrance into path 9705 or into path 9706. Fluid path 9605 in device body 9600 may connect from main path 2100 to an outlet 9607, and fluid path 9606 in device body 9600 may connect from main path to another outlet 9608. Actuator 9707 may move linearly within cavity 9706 within the cavity wall 97042. Actuator 9707 may be embedded with, or covered with, one or more voice coils 9708. Sorting function of sorting device 2013 is achieved by driving electric current through voice coil 9708 and cause a movement of actuator 9707 between different sorting positions. FIG. 149 shows when actuator 9707 may be at a first sorting position, where selector gate 97011 attached to actuator 9707 may block entrance of path 9605, while selector gate 97011 may form a path way together with surface 97022 of actuator 9707 to allow entities 1/10/20/30/612 within flow 91010 to flow into path 9606 and finally exiting device 2013 through outlet 9608. In the case when actuator 9707 moves to a second sorting position, where selector gate 97011 attached to actuator 9707 may block entrance of path 9606, while selector gate 97011 may form a path way together with surface 97022 of actuator 9707 to allow entities 1/10/20/30/612 within flow 91010 to flow into path 9605 and finally exiting device 2013 through outlet 9607. Magnetic field 9709 having north and south polarities simultaneously may exist within the cavity 9706, where FIG. 149 shows north (N) polarity and south (S) polarity of the magnetic field 9709 exists side by side within cavity 9706, with N polarity on the left having magnetic field direction pointing out of the plane and S polarity on the right with magnetic field direction pointing into the plane of FIG. 149, and with the magnetic field from both N and S polarities having magnetic field components perpendicular to the voice coil 9708 plane. Voice coil 9708 may be in the form of single-turn or multiple-turn coils that may be located on a surface of the actuator 9707, or may be embedded within the body of the actuator 9707. Voice coil 9708 may be created on top of, or within, actuator 9707 similarly as described in FIG. 139. Clearance 97071 may exist at center of the actuator 9707 to reduce overall mass of actuator 9707, where voice coil 9708 may be created surrounding the clearance 97071. Sensor 9801 may exist at one or more locations on, or embedded within, the inside boundary wall 97042 of the cavity 9706, where sensor 9801 may sense the proximity, or distance, of the actuator 9707 to the boundary wall 97042 of cavity 9706. Controller 950 may receive signal from sensor 9801 through electrical connection 952 on proximity or distance of actuator 9707 to wall 97042, and controller 950 through electrical connection 953 may adjust or control the electric current amplitude and current direction within coil 9708 of actuator 9707 to control the movement of actuator 9707. Electric current may be applied to the voice coils 9708, where the arrows on the coils 9708 of FIG. 149 illustrate an example of a clock-wise electric current flowing within coils 9708, where said current within coil 9708 of FIG. 149 creates a magnetic field with a direction pointing into the plane of FIG. 149 against N polarity and being in same direction as S polarity of magnetic field 9709 of FIG. 149, where a net force may be exerted by the magnetic field 9709 onto the voice coil 9708, and cause a movement of the voice coil 9708, together with the actuator 9707, to move away from N polarity region and into the S polarity region of field 9709 as in FIG. 149, and thus causing an movement of actuator 9707 to right side of the cavity 9706 as in FIG. 149.

In the example as illustrated by FIG. 149, entities 1/10/20/30/612 in a fluid sample is injected into path 2100 in fluid flow 91010, where path 2100 may be an extension of channel 601/6072/910. One or more detectors 901/9001/9002/9003 located along path 2100 or channel 601/6072/910, similar as in FIG. 132, may detect optical signal from entities 1/10/20/30/612, where controller 950, which may be connected to detectors 901/9001/9002/9003 through connection 951, may receive and analyze signals from detectors 901/9001/9002/9003 and separate entities 1/10/20/30/612 into type 9601 "solid" entity and type 9602 "hollow" entity. Controller 950 may also determine a type 9601 entity may be the immediate entity that will exit path 2100 towards actuator 9707. Controller 950 through connection 952 may receive signal from sensor 9801 and may determine that actuator 9707 is at first sorting position, where type 9602 entities may be expected to flow into path 9606 in the fluid flow 9604 and exiting the sorting device 2013 through outlet 9608. Controller 950 may determine actuator 9707 need to move to a second sorting position to allow said immediate type 9601 entity in path 2100 to enter path 9605 into flow 9603 and exit device 2013 through outlet 9607. Controller 950 through connection 953 may command, or provide, or alternate, or change, electric current in voice coils 9708 into clock-wise direction as shown in FIG. 149 to cause voice coils 9708 to generate a magnetic field that is in the direction of S polarity, which is against the N polarity region of magnetic field 9709. With voice coils 9708 being mostly located within N polarity region of magnetic field 9709 as in FIG. 149, a net force may be exerted on voice coils 9708 by magnetic field 9709 with clock-wise current applied to voice coils 9708, making voice coils 9708, together with actuator 9707, move out of N region and into S region of magnetic field 9709, resulting in movement of actuator 9707 towards said second sorting position of device 2013 and allowing selector gate 97011 to block flow 91010 entrance into path 9606 and allow flow 91010 entrance into path 9605.

Selector gate 97011 may comprise micro-fluidic pathways 9990 similar as in FIG. 147. Micro-fluidic pathways 9990 may be in the form of clearances through selector gate 97011 in the direction of selector gate 97011 movement. Micro-fluidic pathways 9990 may also be in the form of through trenches formed on top surface of selector gate 97011 facing out of FIG. 149 view, or form on bottom surface of selector gate 97011 facing into FIG. 149 view. Micro-fluidic pathways 9990 may have dimensions that are enough to allow passage of fluidic solution of flow 91010 to pass through selector gate 97011 during movement of selector gate 97011 through the fluid of flow 91010, while said dimensions being small enough to block entity 1/10/20/30/612 from moving through selector gate 97011. Micro-fluidic pathways 9990 may function to reduce fluidic drag on selector gate 97011 during movement of selector gate 97011.

During operation of sorting device 2013 of FIG. 149, spacing between actuator 9707 wall 97022 and cavity 9706 wall 97042 may be minimized to form sealing of fluid between path 2100 to paths 9605 and 9606, and to avoid fluid of flow 91010 flowing into cavity 9706. In one embodiment, wall 97022 and wall 97042 may be in contact during movement of actuator 9707, where lubricating film or anti-abrasion coating may be applied to either or both of contacting surfaces of wall 97022 and wall 97042, wherein said lubricating film of anti-abrasion coating may be a layer composed of organic molecules, said organic molecules may be repellant to water and oil. In one embodiment, spacing between wall 97022 and wall 97042 may be any of: from 0.1 nanometer (nm) to 1 nm, from 1 nm to 10 nm, from 10 nm to 100 nm, from 100 nm to 200 nm, from 200 nm to 500 nm, from 500 nm to 1 micrometer (um), from 1 um to 10 um, from 10 um to 20 um. In one embodiment, cavity 9706 may be filled with air, or gas including but not limited to: nitrogen, helium, argon, carbon dioxide, oxygen, where spacing between wall 97022 and wall 97042 may be sufficiently small where surface tension of fluid within liquid sample flow 91010 maintains fluid within paths 2100, 9605, 9606 at first and second sorting positions and during movement of actuator 9707, where surfaces of wall 97022 and wall 97042 may be composed of, or coated with, materials that is non-wettable, or hydrophobic, for liquid within sample flow 91010, thus help maintaining fluid within paths 2100, 9605, 9606.

In one embodiment, cavity 9706, especially the space between wall 97022 and wall 97042, may be filled with cavity fluid that is biological compatible with fluid sample of flow 91010, 9603 and 9604, where said cavity fluid may contain any of, but not limited to: water, saline, phosphate buffered saline, Ficoll. Said cavity fluid may be maintained at same, or higher, fluid pressure than flows 91010, 9603 and 9604, where fluid of sample flow 91010 may be maintained within paths 2100, 9605, 9606. Said cavity fluid may be supplied continuously from outside device 2013 of FIG. 149 and directly into cavity 9706 during operation of device 2005. Said cavity fluid may be initially supplied through flow 91010 when entities 1/10/20/30/612 are not supplied to flow 91010 and cavity fluid may flow from path 2100 in between walls 97022 and 97042 into the cavity 9706 space, and cavity fluid may then maintain its effective volume during operation of device 2013 and during movement of actuator 9707, where pressure within cavity fluid is maintained same as in flow 91010. Said cavity fluid may be confined, or sealed within, cavity 9706 wall 97042, where walls of cavity 9706 may be composed of, or coated with, materials that is non-wettable, or hydrophobic.

In FIG. 149, device body 9600, actuator 9707, selector gate 97011 may each be composed of any of: glass, silicon, quartz, aluminum-titanium-carbon (AlTiC), SiC, SiN, silicon-oxide, alumina, plastic, PDMS, polymer, ceramic, or metal, where metal may be composed any one or any alloy of aluminum, iron, nickel, titanium, chromium, platinum, tungsten, rhenium, copper, gold, silver. Voice coils 9708 may be formed on or within the actuator 9707. Spring 9802 may be optionally used to attach actuator 9707 to device body 9600, or wall 97042 of cavity 9706. Spring 9802 may function similarly as described in device 2005 of FIG. 139.

Encapsulation structure of FIG. 135A through FIG. 135E may be applied to FIG. 149 device 2013 similarly. Method to create field 9709 of FIG. 132 as described in FIG. 136A through FIG. 136D may be applied to FIG. 149 device 2013 similarly. Position encoders 9731 of FIG. 137 may be attached to actuator 9707 of FIG. 149 similarly as in FIG. 137, and position decoders 9732 may be embedded in device 2013 body 9600 or in cavity 9706 wall 97042 similar to FIG. 137, to provide detection of actuator 9707 position in cavity 9706 of FIG. 149. Electric current driving methods of FIG. 138A and FIG. 138B may be applied to device 2013 of FIG. 149 similarly. For FIG. 138B AC current driving application to device 2013 of FIG. 149, FIG. 138B AC current frequency may be same as the resonant frequency of the combined mass of selector gate 91011 and actuator 9707. FIG. 138B AC current frequency applied in device 2013 may also be at a value that correlates to said resonant frequency of the combined mass of selector gate 91011 and actuator 9707, where said AC current frequency value may be an integer multiple of said resonant frequency, said AC current frequency may be at an value that this an offset increase or an offset decrease from said resonant frequency, said AC current frequency may also be at an value that this an offset increase or an offset decrease from an integer multiple of said resonant frequency. Said resonant frequency of the combined mass may be affected by any of: mass of selector gate 91011, mass of actuator 9707; young's modulus values of selector gate 91011 and actuator 9707; spring force of coil lines 97081; inductance of voice coil 9708. Said AC current frequency may be in the range of any of: between 10 Hertz (Hz) to 100 Hz, between 100 Hz to 1 kilo-Hertz (kHz), between 1 kHz to 10 kHz, between 10 kHz to 100 kHz, between 100 kHz to 1 Mega-Hertz (MHz), between 1 MHz to 2 MHz, between 2 MHz to 5 MHz, between 5 MHz to 10 MHz, between 10 MHz to 100 MHz. Capacitive actuator of FIG. 141, thermal-elastic actuator of FIG. 143 may also be applied to device 2013 of FIG. 149 to replace the voice coil actuator 9707 of device 2013 similarly.

FIG. 150 illustrates FIG. 149 sorting device 2013 at a second sorting position. FIG. 150 is the result of the operation as described in FIG. 149 example. Following FIG. 149 operation, actuator 9707 moves towards S region of the magnetic field 9709, where controller 950 through sensor 9801 detects actuator 9707 proximity or distance to the right side boundary wall of cavity 9706 while controlling electric current amplitude and direction flowing in voice coils 9708, until actuator 9707 reaches second sorting position, where selector gate 97011 attached to actuator 9707 may be positioned at the entrance of path 9606 to block entities 1/10/20/30/612 in flow 91010 within path 2100 from entering path 9606, while allowing said entities 1/10/20/30/612 to enter path 9605. At second sorting position of FIG. 150, the immediate type 9601 entity exiting the path 2100 as in FIG. 149 moves into desired path 9605 and ultimately exiting sorting device 2013 through outlet 9607. From described example of FIG. 149 and FIG. 150, one step of sorting one type 9601 entity into desired flow path 9605 may be achieved. At second position of FIG. 150, following same operation as in FIG. 149, controller 950 may determine the immediate exiting entity within path 2100 may now become type 9602 entity, where controller 950 may reverse the electric current in voice coil 9708 to counter-clock-wise direction, such that voice coil 9708 may produce a magnetic field in the N direction and the net magnetic force exerted on actuator 9707 from magnetic field 9709 may become pushing the actuator back into the N region of the magnetic field 9709 and cause movement of actuator 9707 back to the first sorting position as shown in FIG. 149 to complete another sorting step of moving immediate 9602 entity into desired path 9606.

During sorting functions as described in FIG. 147 through FIG. 150, selector gate 97011 may alternate between first and second sorting positions in between events of entity 9601 or entity 9602 exiting path 2100, whereas such alternation may not achieve actual entity 9601 or entity 9602 sorting, but rather may allow sufficient amount of fluid solution flowing into both path 9605 and path 9606 to produce effective output sample flow rate through outlets 9607 and 9608. Such alternation may be desirable in the case where one first type entities being at much smaller quantity than one second type of entities to avoid insufficiently output sample volume that contains said first type entities.

While the current invention has been shown and described with reference to certain embodiments, it is to be understood that those skilled in the art will no doubt devise certain alterations and modifications thereto which nevertheless include the true spirit and scope of the current invention. Thus the scope of the invention should be determined by the appended claims and their legal equivalents, rather than by examples given.

What is claimed is:

1. A device for separating biological entities in a fluid sample comprising:

an input channel formed in a substrate and having an exit;

a first output channel formed in said substrate and having a first entrance fluidically connected to said exit;

a second output channel formed in said substrate and having a second entrance fluidically connected to said exit;

an optical detector configured to identify said biological entities flowing through said input channel;

an actuator including:

a coil made of a conductive material and having one or more turns, and one or more magnets generating magnetic field components with opposite field directions; and a selector gate attached to said actuator and operable to deflect said biological entities from said input channel to either said first or second output channel, wherein said coil and said selector gate move when an electric current is applied to said coil.

2. The device according to claim 1, wherein said selector gate moves in a first direction along a linear path to a first position that deflects said biological entities to said first output channel with continued application of a first current to said coil, and wherein said selector gate moves in a second direction, opposite to said first direction, along said linear path to a second position that deflects said biological entities to said second output channel with continued application of a second current, opposite to said first current, to said coil.

3. The device according to claim 1, wherein said coil comprises one of copper, silver, or gold.

4. The device according to claim 1, wherein said selector gate moves in a first direction along an arc path to a first position that deflects said biological entities to said first output channel with continued application of a first current to said coil, and wherein said selector gate moves in a second direction, opposite to said first direction, along said arc path to a second position that deflects said biological entities to said second output channel with continued application of a second current, opposite to said first current, to said coil.

5. The device according to claim 1, wherein said substrate comprises one of glass, plastic, or silicon.

6. The device according to claim 1, wherein said coil has a flat geometry and lies on a planar surface of said actuator.

7. The device according to claim 1 further comprising a position sensor formed on said substrate that detects position of said coil.

8. The device according to claim 7 further comprising a controller in communication with said optical detector, said actuator, and said position sensor through electrical connections, wherein said controller operates to:

(i) control said optical detector to detect said biological entities; and (ii) apply said electric current to said coil based on a signal from said position sensor.

9. The device according to claim 1, wherein said optical detector comprises at least one optical illuminator and at least one optical sensor.

10. The device according to claim 9, wherein said at least one optical illuminator and at least one optical sensor are respectively disposed on opposite wall surfaces of said input channel having a substantially rectangular cross section.

11. The device according to claim 1 further comprising two springs disposed in between said coil and said substrate and providing electrical connections to said coil.

12. The device according to claim 1, wherein said input channel and said first and second output channels lie in a same plane in said substrate.

13. The device according to claim 1 further comprising an acoustic generation component attached to said substrate for generating an acoustic standing wave within said input channel to steer said biological entities into a detection region of said optical detector within said input channel.

14. The device according to claim 1, wherein said one or more magnets comprise a permanent magnet.

15. A device for separating biological entities in a fluid sample comprising:

an input channel formed in a substrate and having an exit;

a first output channel formed in said substrate and having a first entrance;

a second output channel formed in said substrate and having a second entrance;

an optical detector configured to identify said biological entities flowing through said input channel;

an actuator including:

a coil made of a conductive material and having one or more turns; and one or more magnets generating magnetic field components with opposite field directions; and a path selector attached to said actuator and including first and second passageways embedded in said path selector, said first and second passageways fluidically connecting said exit to said first and second entrances, respectively, wherein said coil and said path selector move when an electric current is applied to said coil.

16. The device according to claim 15, wherein said path selector moves in a first direction along a linear path to a first position that enables said first passageway to fluidically connect said exit to said first entrance with continued application of a first current to said coil, wherein said path selector moves in a second direction, opposite to said first direction, along said linear path to a second position that enables said second passageway to fluidically connect said exit to said second entrance with continued application of a second current, opposite to said first current, to said coil.

17. The device according to claim 15, wherein said coil has a flat geometry and lies on a planar surface of said actuator.

18. The device according to claim 15, wherein said one or more magnets comprise a permanent magnet.

19. The device according to claim 15, wherein said path selector rotates in a first direction to a first position that enables said first passageway to fluidically connect said exit to said first entrance with continued application of a first current to said coil, and wherein said path selector rotates in a second direction, opposite to said first direction, to a second position that enables said second passageway to fluidically connect said exit to said second entrance with continued application of a second current, opposite to said first current, to said coil.

20. The device according to claim 19 further comprising:

a third output channel formed in said substrate and having a third entrance; and a fourth output channel formed in said substrate and having a fourth entrance, wherein said path selector further includes third and fourth passageways embedded in said path selector, said third and fourth passageways fluidically connecting said exit to said third and fourth entrances, respectively.

* * * * *